US012721377B2

(12) United States Patent
Ferrie et al.

(10) Patent No.: US 12,721,377 B2
(45) Date of Patent: Sep. 1, 2026

(54) SMOKING SUBSTITUTE SYSTEM

(71) Applicant: Imperial Tobacco Limited

(72) Inventors: Kate Ferrie, Liverpool (GB); Ross Shenton, Liverpool (GB); Mohammed Benyezzar, Liverpool (GB); Chris Lord, Liverpool (GB)

(73) Assignee: Imperial Tobacco Limited, Bristol (GB)

( * ) Notice: Subject to any disclaimer, the term of this patent is extended or adjusted under 35 U.S.C. 154(b) by 688 days.

(21) Appl. No.: 17/479,939

(22) Filed: Sep. 20, 2021

(65) Prior Publication Data

US 2022/0095692 A1 Mar. 31, 2022

Related U.S. Application Data

(63) Continuation of application No. PCT/EP2020/056844, filed on Mar. 13, 2020, and a (Continued)

(30) Foreign Application Priority Data

Mar. 22, 2019 (EP) ..... 19020143
Mar. 22, 2019 (EP) ..... 19020148
(Continued)

(51) Int. Cl.
*A24F 40/57* (2020.01)
*A24F 40/53* (2020.01)
*A24F 40/60* (2020.01)

(52) U.S. Cl.
CPC ..... *A24F 40/57* (2020.01); *A24F 40/53* (2020.01); *A24F 40/60* (2020.01)

(58) Field of Classification Search
CPC ..... A24F 40/57; A24F 40/53; A24F 40/60
See application file for complete search history.

(56) References Cited

U.S. PATENT DOCUMENTS 5,505,214 A 4/1996 Collins et al.
6,095,153 A 8/2000 Kessler et al.
(Continued)

FOREIGN PATENT DOCUMENTS

CA 3047236 6/2018
CN 103763954 A 4/2014
(Continued)

OTHER PUBLICATIONS

European Patent Office, Examination Report regarding European Patent Application No. 20715739.7, dated Mar. 15, 2024, 32 pages.
(Continued)

*Primary Examiner* — Michael H. Wilson
*Assistant Examiner* — Jennifer A Kessie
(74) *Attorney, Agent, or Firm* — Dykema Gossett PLLC

(57) ABSTRACT

Disclosed is a system having a smoking substitute device for heating a consumable according to a consumable cycle. The smoking substitute device comprises a measurement means for measuring a usage of the device by a user during the consumable cycle, and a controller configured to determine an exhaustion level of the consumable during the consumable cycle based on the usage. The controller is further configured to control an aspect of the operation of the smoking substitute device during the consumable operating cycle based on the exhaustion level.

17 Claims, 123 Drawing Sheets

Related U.S. Application Data continuation of application No. PCT/EP2020/056842, filed on Mar. 13, 2020, and a continuation of application No. PCT/EP2020/056765, filed on Mar. 13, 2020, and a continuation of application No. PCT/EP2020/056848, filed on Mar. 13, 2020, and a continuation of application No. PCT/EP2020/056944, filed on Mar. 13, 2020, and a continuation of application No. PCT/EP2020/056791, filed on Mar. 13, 2020, and a continuation of application No. PCT/EP2020/056846, filed on Mar. 13, 2020, and a continuation of application No. PCT/EP2020/072842, filed on Aug. 14, 2020, and a continuation of application No. PCT/EP2020/056778, filed on Mar. 13, 2020, and a continuation of application No. PCT/EP2020/056767, filed on Mar. 13, 2020, and a continuation of application No. PCT/EP2020/056850, filed on Mar. 13, 2020, and a continuation of application No. PCT/EP2020/056826, filed on Mar. 13, 2020, and a continuation of application No. PCT/EP2020/056832, filed on Mar. 13, 2020, and a continuation of application No. PCT/EP2020/056773, filed on Mar. 13, 2020, and a continuation of application No. PCT/EP2020/056839, filed on Mar. 13, 2020, and a continuation of application No. PCT/EP2020/056819, filed on Mar. 13, 2020, and a continuation of application No. PCT/EP2020/056821, filed on Mar. 13, 2020, and a continuation of application No. PCT/EP2020/056770, filed on Mar. 13, 2020, and a continuation of application No. PCT/EP2020/056849, filed on Mar. 13, 2020, and a continuation of application No. PCT/EP2020/056763, filed on Mar. 13, 2020.

(30) Foreign Application Priority Data

| | | |
|---|---|---|
| Mar. 22, 2019 | (EP) | 19020152 |
| Mar. 22, 2019 | (EP) | 19020157 |
| Mar. 22, 2019 | (EP) | 19020160 |
| Mar. 22, 2019 | (EP) | 19020161 |
| Mar. 22, 2019 | (EP) | 19020165 |
| Mar. 22, 2019 | (EP) | 19020166 |
| Mar. 22, 2019 | (EP) | 19020167 |
| Mar. 22, 2019 | (EP) | 19020171 |
| Mar. 22, 2019 | (EP) | 19020172 |
| Mar. 22, 2019 | (EP) | 19020177 |
| Mar. 22, 2019 | (EP) | 19020178 |
| Mar. 22, 2019 | (EP) | 19020180 |
| Mar. 22, 2019 | (EP) | 19020182 |
| Mar. 22, 2019 | (EP) | 19020186 |
| Mar. 22, 2019 | (EP) | 19020190 |
| Mar. 22, 2019 | (EP) | 19020193 |
| Mar. 22, 2019 | (EP) | 19020194 |
| Mar. 22, 2019 | (EP) | 19020199 |
| Mar. 22, 2019 | (EP) | 19020205 |
| Mar. 22, 2019 | (EP) | 19020208 |
| Aug. 14, 2019 | (EP) | 19191703 |

(56) References Cited

U.S. PATENT DOCUMENTS

| | | | |
|---|---|---|---|
| 8,820,330 | B2 | 9/2014 | Bellinger et al. |
| 9,674,894 | B2 | 6/2017 | Schneider et al. |
| 9,801,412 | B2 | 10/2017 | Grant |
| 9,826,780 | B2 | 11/2017 | Krietzman |
| 2003/0154991 | A1 | 8/2003 | Fournier et al. |
| 2006/0047368 | A1 | 3/2006 | Maharajh et al. |
| 2007/0045288 | A1 | 3/2007 | Nelson |
| 2008/0092912 | A1 | 4/2008 | Robinson et al. |
| 2013/0042865 | A1 | 2/2013 | Monsees et al. |
| 2013/0340775 | A1 | 12/2013 | Juster et al. |
| 2014/0014126 | A1 | 1/2014 | Peleg et al. |
| 2014/0060554 | A1 | 3/2014 | Collett et al. |
| 2014/0096781 | A1 | 4/2014 | Sears et al. |
| 2014/0182608 | A1 | 7/2014 | Egoyants et al. |
| 2014/0238423 | A1 | 8/2014 | Tucker et al. |
| 2014/0261486 | A1 | 9/2014 | Potter et al. |
| 2014/0270727 | A1 | 9/2014 | Ampolini et al. |
| 2014/0278250 | A1 | 9/2014 | Smith et al. |
| 2015/0013697 | A1 | 1/2015 | Ampolini et al. |
| 2015/0208727 | A1 | 7/2015 | Kuczaj |
| 2015/0237917 | A1 | 8/2015 | Lord |
| 2015/0359264 | A1 | 12/2015 | Fernando et al. |
| 2016/0137395 | A1 | 5/2016 | Fernando et al. |
| 2016/0331038 | A1 | 11/2016 | Farine et al. |
| 2016/0374397 | A1 | 12/2016 | Brandon et al. |
| 2017/0014582 | A1* | 1/2017 | Skoda ..... A24F 40/42 |
| 2017/0023952 | A1 | 1/2017 | Henry, Jr. et al. |
| 2017/0027232 | A1 | 2/2017 | Scheck et al. |
| 2017/0042243 | A1 | 2/2017 | Plojoux et al. |
| 2017/0042250 | A1 | 2/2017 | Takeuchi et al. |
| 2017/0045994 | A1 | 2/2017 | Murison et al. |
| 2017/0119049 | A1 | 5/2017 | Blandino et al. |
| 2017/0135411 | A1 | 5/2017 | Cameron |
| 2017/0136193 | A1 | 5/2017 | Cameron |
| 2017/0181474 | A1* | 6/2017 | Cameron ..... A24B 15/167 |
| 2017/0188627 | A1 | 7/2017 | Sur |
| 2017/0196257 | A1 | 7/2017 | Lavanchy |
| 2017/0196273 | A1 | 7/2017 | Qiu |
| 2017/0238596 | A1 | 8/2017 | Matsumoto et al. |
| 2017/0280771 | A1* | 10/2017 | Courbat ..... B05B 17/0661 |
| 2017/0304563 | A1 | 10/2017 | Adelson |
| 2017/0318861 | A1* | 11/2017 | Thorens ..... A24F 40/53 |
| 2018/0000157 | A1 | 1/2018 | Batista et al. |
| 2018/0000160 | A1 | 1/2018 | Taschner et al. |
| 2018/0007966 | A1 | 1/2018 | Li et al. |
| 2018/0007971 | A1 | 1/2018 | Plojoux et al. |
| 2018/0020727 | A1 | 1/2018 | Hoffman et al. |
| 2018/0020729 | A1 | 1/2018 | Alarcon et al. |
| 2018/0084831 | A1 | 3/2018 | Mironov |
| 2018/0146711 | A1 | 5/2018 | Mazur et al. |
| 2018/0177231 | A1 | 6/2018 | Woodbine et al. |
| 2018/0192699 | A1 | 7/2018 | Wang |
| 2018/0192701 | A1 | 7/2018 | Stoner |
| 2018/0213847 | A1 | 8/2018 | Reevell |
| 2018/0263290 | A1 | 9/2018 | Collett et al. |
| 2019/0029325 | A1 | 1/2019 | Liu |
| 2019/0059448 | A1 | 2/2019 | Talon |
| 2023/0096771 | A1 | 3/2023 | Garcia Garcia |

FOREIGN PATENT DOCUMENTS

| | | | |
|---|---|---|---|
| CN | 103974638 | A | 8/2014 |
| CN | 104470386 | A | 3/2015 |
| CN | 104470387 | B | 6/2016 |
| CN | 106037014 | A | 10/2016 |
| CN | 205648910 | U | 10/2016 |
| CN | 206197023 | U | 5/2017 |
| CN | 106942791 | A | 7/2017 |
| CN | 107095343 | A | 8/2017 |
| CN | 107278126 | | 10/2017 |
| CN | 107278126 | A | 10/2017 |
| CN | 206687163 | | 12/2017 |
| CN | 206687163 | U | 12/2017 |
| CN | 107692317 | A | 2/2018 |
| CN | 207220158 | U | 4/2018 |
| CN | 207269842 | U | 4/2018 |
| CN | 107995846 | A | 5/2018 |
| CN | 108185528 | | 6/2018 |
| CN | 108185528 | A | 6/2018 |
| CN | 108495386 | A | 9/2018 |
| CN | 108652088 | | 10/2018 |
| CN | 108652088 | A | 10/2018 |
| CN | 108770084 | A | 11/2018 |

(56) References Cited

FOREIGN PATENT DOCUMENTS

| | | | |
|---|---|---|---|
| CN | 208242853 | | 12/2018 |
| CN | 208242853 | U | 12/2018 |
| CN | 109123809 | | 1/2019 |
| CN | 109123809 | A | 1/2019 |
| CN | 109156902 | | 1/2019 |
| CN | 109156902 | A | 1/2019 |
| CN | 109288133 | | 2/2019 |
| CN | 109288133 | A | 2/2019 |
| CN | 109315838 | | 2/2019 |
| CN | 109315838 | A | 2/2019 |
| CN | 109363247 | | 2/2019 |
| CN | 109363247 | A | 2/2019 |
| CN | 109496129 | A | 3/2019 |
| CN | 107095343 | | 5/2020 |
| CN | 107407941 | B | 5/2020 |
| DE | 102017222528 | | 1/2019 |
| DE | 102017222528 | B3 | 1/2019 |
| EP | 0503767 | A1 | 9/1992 |
| EP | 0585015 | A1 | 3/1994 |
| EP | 0430559 | B1 | 1/1995 |
| EP | 0503767 | B1 | 3/1995 |
| EP | 0585015 | B1 | 2/1997 |
| EP | 2394520 | A1 | 12/2010 |
| EP | 2520186 | A1 | 11/2012 |
| EP | 2609821 | A1 | 3/2013 |
| EP | 27974472 | | 11/2014 |
| EP | 2921065 | A1 | 9/2015 |
| EP | 2797445 | B2 | 4/2016 |
| EP | 2797445 | B1 | 5/2016 |
| EP | 3108760 | B1 | 7/2016 |
| EP | 3108760 | A1 | 12/2016 |
| EP | 3171666 | A2 | 5/2017 |
| EP | 3180998 | B1 | 6/2017 |
| EP | 3456213 | A1 | 3/2019 |
| EP | 3054798 | B1 | 5/2019 |
| EP | 3485747 | A1 | 5/2019 |
| EP | 3554189 | A1 | 10/2019 |
| EP | 3586655 | A1 | 1/2020 |
| EP | 3777577 | A1 | 2/2021 |
| EP | 3808195 | A2 | 4/2021 |
| EP | 2493342 | A1 | 7/2022 |
| GB | 2148676 | A | 5/1985 |
| GB | 2507102 | A | 4/2014 |
| GB | 2542008 | A | 3/2017 |
| GB | 2542013 | A | 3/2017 |
| GB | 2542695 | A | 3/2017 |
| GB | 2542013 | B | 8/2017 |
| JP | 2002037356 | A | 2/2002 |
| JP | 2003098863 | A | 4/2003 |
| JP | 2011115141 | A | 6/2011 |
| JP | 2013545474 | A | 12/2013 |
| JP | 2014530632 | A | 11/2014 |
| JP | 2017500848 | A | 1/2017 |
| JP | 2018007684 | A | 1/2018 |
| JP | 2018007691 | A | 1/2018 |
| JP | 3215568 | U | 3/2018 |
| JP | 2018514197 | A | 6/2018 |
| JP | 2018534909 | A | 11/2018 |
| KR | 10-2019-0016907 | A | 2/2019 |
| KR | 20190016907 | A | 2/2019 |
| WO | WO2012072790 | A1 | 6/2012 |
| WO | 2013034452 | A1 | 3/2013 |
| WO | 2013034460 | A1 | 3/2013 |
| WO | 2013060784 | A2 | 5/2013 |
| WO | WO2013/060743 | A2 | 5/2013 |
| WO | WO2013060781 | A1 | 5/2013 |
| WO | 2013098396 | A2 | 7/2013 |
| WO | 2013098397 | A2 | 7/2013 |
| WO | WO2013/098395 | A1 | 7/2013 |
| WO | WO2013/138384 | A2 | 9/2013 |
| WO | WO2014/066730 | A1 | 5/2014 |
| WO | WO2014102092 | A1 | 7/2014 |
| WO | WO2014190079 | A2 | 11/2014 |
| WO | WO2015/052513 | A2 | 4/2015 |
| WO | WO2015091258 | A1 | 6/2015 |
| WO | WO2015/101479 | A1 | 7/2015 |
| WO | WO2015/107552 | A1 | 7/2015 |
| WO | WO2015/140012 | A1 | 9/2015 |
| WO | 2015155289 | A1 | 10/2015 |
| WO | WO2015/192084 | A1 | 12/2015 |
| WO | WO2016/091558 | A1 | 6/2016 |
| WO | WO2016/091658 | A1 | 6/2016 |
| WO | WO2016/124552 | A1 | 8/2016 |
| WO | WO2016/135271 | A1 | 9/2016 |
| WO | WO2016/147188 | A1 | 9/2016 |
| WO | WO2017037457 | A1 | 9/2016 |
| WO | WO2016/156103 | A1 | 10/2016 |
| WO | WO2016166064 | A1 | 10/2016 |
| WO | WO2016/123738 | A1 | 11/2016 |
| WO | WO2016/188967 | A1 | 12/2016 |
| WO | WO2017115277 | A1 | 12/2016 |
| WO | 2017033007 | A1 | 3/2017 |
| WO | WO2017/068101 | A1 | 4/2017 |
| WO | WO2017/144374 | A1 | 8/2017 |
| WO | WO2017/205692 | A1 | 11/2017 |
| WO | WO2018/014817 | A1 | 1/2018 |
| WO | WO2018001910 | | 1/2018 |
| WO | 2018027189 | A2 | 2/2018 |
| WO | WO2018/019855 | A1 | 2/2018 |
| WO | WO2018/110834 | A2 | 6/2018 |
| WO | WO2018/141467 | A1 | 8/2018 |
| WO | WO2018167817 | A1 | 9/2018 |
| WO | 2018190590 | | 10/2018 |
| WO | WO2018/182322 | A1 | 10/2018 |
| WO | WO2018/190590 | A2 | 10/2018 |
| WO | WO2018178114 | A2 | 10/2018 |
| WO | WO2018/202727 | A1 | 11/2018 |
| WO | WO2018/216961 | A1 | 11/2018 |
| WO | WO2018/217054 | A1 | 11/2018 |
| WO | WO2018234792 | A1 | 12/2018 |
| WO | WO2019/002329 | A1 | 1/2019 |
| WO | WO2019/002613 | A1 | 1/2019 |
| WO | WO2019/020826 | A1 | 1/2019 |
| WO | 2019030301 | A1 | 2/2019 |
| WO | WO2019030168 | A1 | 2/2019 |
| WO | 2019122344 | A1 | 6/2019 |
| WO | 2019170886 | A1 | 9/2019 |
| WO | WO 2019170897 | A1 | 9/2019 |
| WO | WO2019186669 | A1 | 10/2019 |
| WO | 2020193170 | A3 | 10/2020 |
| WO | 2020193171 | A1 | 10/2020 |
| WO | 2020193172 | A1 | 10/2020 |
| WO | 2020193174 | A1 | 10/2020 |
| WO | 2020193176 | A1 | 10/2020 |
| WO | 2020193179 | A1 | 10/2020 |
| WO | 2020193188 | A1 | 10/2020 |
| WO | 2020193202 | A1 | 10/2020 |
| WO | 2020193203 | A1 | 10/2020 |
| WO | 2020193207 | A1 | 10/2020 |
| WO | 2020193210 | A1 | 10/2020 |
| WO | 2020193217 | A1 | 10/2020 |
| WO | 2020193219 | A1 | 10/2020 |
| WO | 2020193220 | A1 | 10/2020 |
| WO | 2020193221 | A1 | 10/2020 |
| WO | 2020193222 | A1 | 10/2020 |
| WO | 2020193224 | A1 | 10/2020 |
| WO | 2020193237 | A1 | 10/2020 |
| WO | 2021028561 | A1 | 2/2021 |

OTHER PUBLICATIONS

European Patent Office, Extended Examination and Search Report regarding European Patent Application No. 19191703.8, filed Mar. 22, 2019, dated Feb. 20, 2014.

European Patent Office, Extended Examination and Search Report regarding European Patent Application No. 19020178.0, filed Mar. 22, 2019, dated Sep. 18, 2019.

European Patent Office, Extended Examination and Search Report regarding European Patent Application No. 19020186.3, filed Mar. 22, 2019, dated Sep. 19, 2019.

European Patent Office, Extended Examination and Search Report regarding European Patent Application No. 19020161.6, filed Mar. 22, 2019, dated Oct. 7, 2019.

(56) References Cited

OTHER PUBLICATIONS

European Patent Office, Extended Examination and Search Report regarding European Patent Application No. 19020152.5, filed Mar. 22, 2019, dated Oct. 7, 2019.
European Patent Office, Extended Examination and Search Report regarding European Patent Application No. 19020157.4, filed Mar. 22, 2019, dated Oct. 7, 2019.
European Patent Office, Extended Examination and Search Report regarding European Patent Application No. 19020190.5, filed Mar. 22, 2019, dated Oct. 7, 2019.
European Patent Office, Extended Examination and Search Report regarding European Patent Application No. 19020208.5, filed Mar. 22, 2019, dated Oct. 7, 2019.
European Patent Office, Extended Examination and Search Report regarding European Patent Application No. 19020167.3, filed Mar. 22, 2019, dated Oct. 8, 2019.
European Patent Office, Extended Examination and Search Report regarding European Patent Application No. 19020171.5, filed Mar. 22, 2019, dated Oct. 9, 2019.
European Patent Office, Extended Examination and Search Report regarding European Patent Application No. 19020193.9, filed Mar. 22, 2019, dated Oct. 9, 2019.
European Patent Office, Extended Examination and Search Report regarding European Patent Application No. 19020194.7, filed Mar. 22, 2019, dated Oct. 9, 2019.
European Patent Office, Extended Examination and Search Report regarding European Patent Application No. 19020148.3, filed Mar. 22, 2019, dated Oct. 15, 2019.
European Patent Office, Extended Examination and Search Report regarding European Patent Application No. 19020160.8, filed Mar. 22, 2019, dated Oct. 15, 2019.
European Patent Office, Extended Examination and Search Report regarding European Patent Application No. 19020165.7, filed Mar. 22, 2019, dated Oct. 15, 2019.
European Patent Office, Extended Examination and Search Report regarding European Patent Application No. 19020182.2, filed Mar. 22, 2019, dated Oct. 15, 2019.
European Patent Office, Extended Examination and Search Report regarding European Patent Application No. 19020180.6, filed Mar. 22, 2019, dated Oct. 16, 2019.
European Patent Office, Extended Examination and Search Report regarding European Patent Application No. 19020199.6, filed Mar. 22, 2019, dated Oct. 16, 2019.
European Patent Office, Extended Examination and Search Report regarding European Patent Application No. 19020205.1, filed Mar. 22, 2019, dated Oct. 16, 2019.
European Patent Office, Extended Examination and Search Report regarding European Patent Application No. 19020143.4, filed Mar. 22, 2019, dated Oct. 18, 2019.
European Patent Office, Extended Examination and Search Report regarding European Patent Application No. 19020172.3, filed Mar. 22, 2019, dated Nov. 4, 2019.
European Patent Office, Extended Examination and Search Report regarding European Patent Application No. 19020166.5, filed Mar. 22, 2019, dated Nov. 12, 2019.
European Patent Office, Extended Examination and Search Report regarding European Patent Application No. 19120177.2, filed Mar. 22, 2019, dated Oct. 17, 2019.
European Patent Office, Extended Examination Report regarding European Patent Application No. 20715746.2, dated Jun. 10, 2023.
Taiwan Intellectual Property Office, Taiwan Application No. 109109091; Office Action and Search Report with English Translation dated Jul. 26, 2023.
European Patent Office, Extended Examination Report regarding European Patent Application No. 20715746.2, dated Oct. 6, 2023, 5 pages.
China National Intellectual Property Administration, First Office Action regarding Chinese Application No. 202080034831.4, dated Dec. 16, 2023, 7 pages. (English Translation Attached, 5 pages.).
International Search Report and Written Opinion (PCT/EP2020/056770), May 13, 2020, 10 pages.
International Search Report and Written Opinion (PCT/EP2020/056848), May 13, 2020, 5 pages.
International Search Report and Written Opinion (PCT/EP2020/056767), May 13, 2020, 5 pages.
International Search Report and Written Opinion (PCT/EP2020/056832), Jun. 15, 2020, 10 pages.
International Search Report and Written Opinion (PCT/EP2020/056773), Jun. 5, 2020, 10 pages.
International Search Report and Written Opinion (PCT/EP2020/056944), May 13, 2020, 10 pages.
International Search Report and Written Opinion (PCT/EP2020/056832), Jul. 16, 2020, 10 pages.
International Search Report and Written Opinion (PCT/EP2020/056850), Jul. 7, 2020, 10 pages.
International Search Report and Written Opinion (PCT/EP2020/056778), May 6, 2020, 13 pages.
International Search Report and Written Opinion (PCT/EP2020/056791), Jul. 2, 2020, 11 pages.
International Search Report and Written Opinion (PCT/EP2020/056763), Sep. 29, 2020, 9 pages.
International Search Report and Written Opinion (PCT/EP2020/056642), Jul. 3, 12 pages.
International Search Report and Written Opinion (PCT/EP2020/056826), Aug. 6, 2020, 11 pages.
International Search Report and Written Opinion (PCT/EP2020/056839), May 13, 2020, 9 pages.
International Search Report and Written Opinion (PCT/EP2020/056819), Jul. 9, 2020, 10 pages.
International Search Report and Written Opinion (PCT/EP2020/056765), Jun. 4, 2020, 14 pages.
International Search Report and Written Opinion (PCT/EP2020/056846), Jul. 13, 2020, 9 pages.
International Search Report and Written Opinion (PCT/EP2020/056844), Jul. 3, 2020, 10 pages.
International Search Report and Written Opinion (PCT/EP2020/072842), Oct. 14, 2020, 11 pages.
International Search Report and Written Opinion (PCT/EP2020/056849), May 13, 2020, 10 pages.
Japan Patent Office, Notice of Reasons for Refusal of Japanese Patent Application No. 2021-556984, dated Mar. 14, 2024, 6 pages (with English translation, 7 pages).
Japan Patent Office, Notice of Reasons for Refusal of Japanese Patent Application No. 2021-556985, dated Mar. 14, 2024, 6 pages (with English translation, 8 pages).
Japan Patent Office, Notice of Reasons for Refusal of Japanese Patent Application No. 2021-556989, dated Apr. 2, 2024, 5 pages (with English translation, 7 pages).
Japan Patent Office, Notice of Reasons for Refusal of Japanese Patent Application No. 2021-556991, dated Mar. 28, 2024, 5 pages (with English translation, 6 pages).
Japan Patent Office, Notice of Reasons for Refusal of Japanese Patent Application No. 2021-556993, dated Apr. 12, 2024, 5 pages (with English translation, 5 pages).
Taiwan Intellectual Property Office, Search Report regarding Taiwan Invention Patent Application No. 109109191, dated Aug. 31, 2023, with English Translation.
Taiwan Intellectual Property Office, Search Report regarding Taiwan Invention Patent Application No. 109109202, dated Nov. 6, 2023, with English translation.
Japanese Patent Office, Decision of Refusal regarding Japanese Patent Application No. 2021-556993, dated Sep. 4, 2024, with English Machine Translation.
Japanese Patent Office, Notice of Reasons for Refusal regarding Japanese Patent Application No. 2021-556984, dated Sep. 17, 2024, with English Machine Translation.
Japanese Patent Office, Notice of Reasons for Refusal regarding Japanese Patent Application No. 2021-556985, dated Oct. 1, 2024, with English Machine Translation.

* cited by examiner

SMOKING SUBSTITUTE SYSTEM

CROSS REFERENCE TO RELATED APPLICATIONS/INCORPORATION BY REFERENCE STATEMENT

This application is a non-provisional application claiming benefit to the international application no. PCT/EP20/56770 filed Mar. 13, 2020, which claims benefit to EP 19020166.5, filed Mar. 22, 2019. This application also claims benefit to the international application no. PCT/EP20/56848 filed Mar. 13, 2020, which claims priority to EP19020193.9 filed Mar. 22, 2019. This application also claims benefit to the international application no. PCT/EP20/56767 filed Mar. 13, 2020, which claims priority to EP 19020152.5 filed Mar. 22, 2019. This application also claims benefit to international application no. PCT/EP20/56832 filed Mar. 13, 2020, which claims priority to EP19020167.3 filed Mar. 22, 2019. This application also claims benefit to international application no. PCT/EP20/56773 filed Mar. 13, 2020, which claims priority to EP 19020172.3 filed Mar. 22, 2019 and EP19020190.5 filed Mar. 22, 2019. This application also claims benefit to PCT/EP20/56849 filed Mar. 13, 2020, which claims priority to EP 19020171.5 filed Mar. 22, 2019. This application also claims benefit to international application no. PCT/EP20/56944 filed Mar. 13, 2020, which claims priority to EP 19020178.0 filed Mar. 22, 2019 and EP 19020186.3 filed Mar. 22, 2019. This application also claims benefit to PCT/EP20/56850 filed Mar. 13, 2020 which claims priority to EP 19020177.2 filed Mar. 22, 2019. This application also claims benefit to international application no. PCT/EP20/56778 filed Mar. 13, 2020, which claims priority to EP 19020148.3 filed Mar. 22, 2019 and EP19020160.8 filed Mar. 22, 2019. This application also claims benefit to the international application no. PCT/EP20/56791 filed Mar. 13, 2020, which claims priority to EP 19020182.2 filed Mar. 22, 2019. This application also claims benefit to the international application no. PCT/EP20/56763 filed Mar. 13, 2020, which claims priority to EP 19020143.4 filed Mar. 22, 2019. This application also claims benefit to the international application no. PCT/EP20/56821 filed Mar. 13, 2020, which claims priority to EP 19020161.6 filed Mar. 22, 2019. This application also claims benefit of international application no. PCT/EP20/56842 filed Mar. 13, 2020, which claims priority to EP 19020180.6 filed Mar. 22, 2019. This application also claims benefit of international application no. PCT/EP20/56826 filed Mar. 13, 2020, which claims priority to EP 19020165.7 filed Mar. 22, 2019. This application also claims benefit to international application no. PCT/EP20/56839 filed Mar. 13, 2020, which claims priority to EP 19020194.7 filed Mar. 22, 2019. This application also claims benefit to the international application no. PCT/EP20/56819 filed Mar. 13, 2020, which claims priority to EP 19020208.5 filed Mar. 22, 2019. This application also claims benefit to the international application no. PCT/EP20/56765 filed Mar. 13, 2020, which claims priority to EP 19020157.4 filed Mar. 22, 2019. This application also claims benefit of international application no. PCT/EP20/56846 filed Mar. 13, 2020, which claims priority to EP 19020199.6 filed Mar. 22, 2019. This application also claims benefit to international application no. PCT/EP20/56844 filed Mar. 13, 2020, which claims priority to EP 19020205.1 filed Mar. 22, 2019. This application also claims benefit of international application no. PCT/EP20/72842 filed Aug. 14, 2020, which claims priority to EP 19191703.8 filed Aug. 14, 2019. All of the foregoing patent applications are hereby incorporated herein by reference.

TECHNICAL FIELD

In a first mode, the present disclosure relates to a smoking substitute system and particularly, although not exclusively, to a smoking substitute system comprising a device for heating a consumable during a consumable cycle.

In a second mode, the present disclosure relates to a smoking substitute system and particularly, although not exclusively, to a smoking substitute system comprising a device and an aerosol-forming article.

In a third mode, the present disclosure relates to a heat-not-burn device and particularly, although not exclusively, to a heat-not-burn comprising a heater and a controller for controlling operation of the heater.

In a fourth mode, the present disclosure relates to a smoking substitute system and particularly, although not exclusively, to a heater for a smoking substitute system.

In a fifth mode, the present disclosure relates to a smoking substitute system and particularly, although not exclusively, to a heat not burn device. The disclosure also relates to a method for controlling operation of the heat-not-burn device based on a measured ambient temperature.

In a sixth mode, the present disclosure relates to a heat not burn system and particularly, although not exclusively, to a heat not burn system comprising a device and an aerosol-forming article.

In a seventh mode, the present disclosure relates to a smoking substitute system and particularly, although not exclusively, to a smoking substitute system comprising a heat not burn device. The present disclosure also relates to a heat-not-burn device and particularly, although not exclusively, to a heat-not-burn device comprising a movable cap, and capable of controlling the power supply to a heating element based on the position of the cap.

In an eighth mode, the present disclosure relates to a smoking substitute system and particularly, although not exclusively, to a smoking substitute system comprising a heat not burn smoking device, and an aerosol forming article.

In a ninth mode, the present disclosure relates to a smoking substitute system and particularly, although not exclusively, to a smoking substitute system comprising a heated tobacco device.

In a tenth mode, the present disclosure relates to a smoking substitute system and particularly, although not exclusively, to a heat not burn device and a method of operating a heat not burn device with different power levels supplied to the heat not burn device.

In an eleventh mode, the present disclosure relates to a smoking substitute device and particularly, although not exclusively, to a smoking substitute device.

In a twelfth mode, the present disclosure relates to a smoking substitute system and particularly, although not exclusively, to a smoking substitute system comprising a heat not burn device.

In a thirteenth mode, the present disclosure relates to a smoking substitute system and particularly, although not exclusively, to a smoking substitute system comprising a heat not burn device and an aerosol-forming article.

In a fourteenth mode, the present disclosure relates to a smoking substitute system and particularly, although not exclusively, to a smoking substitute system comprising a heat not burn device.

In a fifteenth mode, the present disclosure relates to a smoking substitute system and particularly, although not exclusively, to a smoking substitute system comprising a device having a longitudinal heater rod and an aerosol-forming article.

In a sixteenth mode, the present disclosure relates to a smoking substitute system and particularly, although not exclusively, to a smoking substitute system comprising a heat-not-burn device configured to ensure safe operation of the device.

In a seventeenth mode, the present disclosure relates to a smoking substitute system and particularly, although not exclusively, to a smoking substitute system comprising a heat not burn device and an aerosol-forming article.

In an eighteenth mode, the present disclosure relates to a smoking substitute system and particularly, although not exclusively, to a smoking substitute system comprising a heat not burn device and an aerosol-forming article.

In a nineteenth mode, the present disclosure relates to a smoking substitute system and particularly, although not exclusively, to a smoking substitute system comprising a device having a heater and an aerosol-forming article.

In a twentieth mode, the present disclosure relates to a smoking substitute system and particularly, although not exclusively, to a smoking substitute system comprising a device and an aerosol-forming article. Specifically, the present disclosure relates to a heater apparatus for a smoking substitute device, in particular a heat-not-burn smoking substitute device.

BACKGROUND

The smoking of tobacco is generally considered to expose a smoker to potentially harmful substances. It is generally thought that a significant amount of the potentially harmful substances are generated through the heat caused by the burning and/or combustion of the tobacco and the constituents of the burnt tobacco in the tobacco smoke itself.

Conventional combustible smoking articles, such as cigarettes, typically comprise a cylindrical rod of tobacco comprising shreds of tobacco which is surrounded by a wrapper, and usually also a cylindrical filter axially aligned in an abutting relationship with the wrapped tobacco rod. The filter typically comprises a filtration material which is circumscribed by a plug wrap. The wrapped tobacco rod and the filter are joined together by a wrapped band of tipping paper that circumscribes the entire length of the filter and an adjacent portion of the wrapped tobacco rod. A conventional cigarette of this type is used by lighting the end opposite to the filter and burning the tobacco rod. The smoker receives mainstream smoke into their mouth by drawing on the mouth end or filter end of the cigarette.

Combustion of organic material such as tobacco is known to produce tar and other potentially harmful by-products. There have been proposed various smoking substitute systems (or "substitute smoking systems") in order to avoid the smoking of tobacco.

Such smoking substitute systems can form part of nicotine replacement therapies aimed at people who wish to stop smoking and overcome a dependence on nicotine.

Smoking substitute systems include electronic systems that permit a user to simulate the act of smoking by producing an aerosol (also referred to as a "vapor") that is drawn into the lungs through the mouth (inhaled) and then exhaled. The inhaled aerosol typically bears nicotine and/or flavorings without, or with fewer of, the odor and health risks associated with traditional smoking.

In general, smoking substitute systems are intended to provide a substitute for the rituals of smoking, whilst providing the user with a similar experience and satisfaction to those experienced with traditional smoking and with combustible tobacco products. Some smoking substitute systems use smoking substitute articles (also referred to as a "consumables") that are designed to resemble a traditional cigarette and are cylindrical in form with a mouthpiece at one end.

The popularity and use of smoking substitute systems has grown rapidly in the past few years. Although originally marketed as an aid to assist habitual smokers wishing to quit tobacco smoking, consumers are increasingly viewing smoking substitute systems as desirable lifestyle accessories.

There are a number of different categories of smoking substitute systems, each utilizing a different smoking substitute approach.

One approach for a smoking substitute system is the so-called Heated Tobacco ("HT") approach in which tobacco (rather than an "e-liquid") is heated or warmed to release vapor. HT is also known as "heat not burn" ("HNB"). The tobacco may be leaf tobacco or reconstituted tobacco. The vapor may contain nicotine and/or flavorings. In the HT approach the intention is that the tobacco is heated but not burned, i.e., the tobacco does not undergo combustion.

A typical HT smoking substitute system may include a device and a consumable. The consumable may include the tobacco material. The device and consumable may be configured to be physically coupled together. In use, heat may be imparted to the tobacco material by a heating element of the device, wherein airflow through the tobacco material causes components in the tobacco material to be released as vapor. A vapor may also be formed from a carrier in the tobacco material (this carrier may for example include propylene glycol and/or vegetable glycerin) and additionally volatile compounds released from the tobacco. The released vapor may be entrained in the airflow drawn through the tobacco.

As the vapor passes through the consumable (entrained in the airflow) from the location of vaporization to an outlet of the consumable (e.g., a mouthpiece), the vapor cools and condenses to form an aerosol for inhalation by the user. The aerosol will normally contain the volatile compounds.

In HT smoking substitute systems, heating as opposed to burning the tobacco material is believed to cause fewer, or smaller quantities, of the more harmful compounds ordinarily produced during smoking. Consequently, the HT approach may reduce the odor and/or health risks that can arise through the burning, combustion and pyrolytic degradation of tobacco.

Such systems generally operate by heating a consumable for a predetermined period of time. That predetermined time is the same for each consumable cycle (i.e., each time a consumable is consumed using the device). Thus, in some cases, the device may prevent further consumption (due to the predetermined time ending), even where the consumable is not necessarily entirely consumed (e.g. where the consumable has been consumed slower than normal). In other cases, where e.g., the consumable is consumed faster than normal, the device may allow heating of the consumable after it has been consumed.

There may be a need for improved design of smoking substitute systems, in particular HT smoking substitute systems, to enhance the user experience and improve the function of the HT smoking substitute system.

Another approach is the so-called "vaping" approach, in which a vaporizable liquid, typically referred to (and referred to herein) as "e-liquid", is heated by a heating device (referred to herein as an electronic cigarette or "e-cigarette" device) to produce an aerosol vapor which is inhaled by a user. The e-liquid typically includes a base liquid as well as nicotine and/or a flavorant. The resulting vapor therefore also typically contains nicotine and/or a flavorant. The base liquid may include propylene glycol and/or vegetable glycerin.

A typical e-cigarette device includes a mouthpiece, a power source (typically a battery), a tank for containing e-liquid, as well as a heating device. In use, electrical energy is supplied from the power source to the heating device, which heats the e-liquid to produce an aerosol (or "vapor") which is inhaled by a user through the mouthpiece.

E-cigarettes can be configured in a variety of ways. For example, there are "closed system" vaping smoking substitute systems, which typically have a sealed tank and heating element. The tank is pre-filled with e-liquid and is not intended to be refilled by an end user. One subset of closed system vaping smoking substitute systems include a main body which includes the power source, wherein the main body is configured to be physically and electrically coupled to a consumable including the tank and the heating element. In this way, when the tank of a consumable has been emptied, that consumable is disposed of. The main body can be reused by connecting it to a new, replacement, consumable. Another subset of closed system vaping smoking substitute systems are completely disposable, and intended for one-use only.

There are also "open system" vaping smoking substitute systems which typically have a tank that is configured to be refilled by a user. In this way the entire device can be used multiple times.

There may be a need for improved design of smoking substitute systems to enhance the user experience and provide more versatility to a user.

The present disclosure has been devised in the light of the above considerations.

SUMMARY OF THE DISCLOSURE

First Mode of the Disclosure: Smoking Substitute Device for Heating a Consumable During a Consumable Cycle.

At its most general, the first mode of the present disclosure relates to smoking substitute device for heating a consumable during a consumable cycle. The smoking substitute device may be controlled based on exhaustion level of the consumable.

According to a first aspect of the first mode of the present disclosure there is provided a smoking substitute device for heating a consumable according to a consumable cycle, the smoking substitute device comprising: a measurement means for measuring a usage of the device by a user during the consumable cycle; and a controller configured to determine an exhaustion level of the consumable during the consumable cycle based on the usage, and wherein the controller is further configured to control an aspect of the operation of the smoking substitute device during the consumable operating cycle based on the exhaustion level.

By providing a device having a controller able to determine an exhaustion level of a consumable, the operation of the device may be altered based on that determination. For example, in situations where a consumable is consumed slower than normal, the controller may be able to extend the length of the consumable cycle. This may ensure that each consumable is fully consumed. Similarly, in cases where the consumable is consumed faster than normal, the controller may limit the consumable cycle.

The term "consumable cycle" may refer to a predetermined heating cycle for a single consumable. The term "exhaustion level" is used to describe the extent to which the consumable has been consumed.

Optional features will now be set out. These are applicable singly or in any combination with any aspect.

The measurement means may comprise a sensor. The sensor may be a puff sensor configured to detect a user puffing (i.e., inhaling) on the consumable. The usage of the device may be based on a detection of at least one puff by the puff sensor. In addition to detecting the presence of a puff, the puff sensor may be configured to detect one or more characteristics of the puff, such as the length of the puff and/or the intensity of the puff. The puff sensor may be in the form of (or may comprise) a pressure sensor or an acoustic sensor. The measurements by the puff sensor can be used to calculate the volume of a puff. The pause time between puffs may also be used in the determination of usage.

The determination of the exhaustion level (e.g., by calculation) may be based on an operating temperature of a heater of the device during the consumable cycle. The device may comprise a temperature sensor for sensing the temperature of the heater. The temperature sensor may be in the form of a temperature sensing track formed into or mounted to a heating element of the heater. The temperature sensor may be connected to the controller for transmitting a signal indicative of the temperature of the heater to the controller.

The determination of the exhaustion level may be based on a power level supplied to a heater of the device during the consumable cycle. The controller may be configured to control the power supplied to the heater from a power source of the device. The controller may be configured to control the power and at first and second power levels. More power may be supplied to the heater when the power supply is controlled according to the second power level. The exhaustion level may be based on the proportion of the consumable cycle attributed to each power level. A higher proportion of the second power level may be indicative of a higher exhaustion level.

The device may comprise an environmental temperature measurement means configured to measure an environmental temperature of the device. The environmental temperature may be an ambient (e.g., room) temperature. The device may comprise an ambient air temperature sensor arranged to measure the ambient air temperature. The ambient air temperature sensor may be disposed at or proximate to an outer surface of the device. A higher environmental temperature may lead to faster exhaustion of the consumable. Thus, the determination of the exhaustion level may be based on an environmental temperature measurement.

The determination of the exhaustion level may be based on a user-selectable operating mode of the device during the consumable cycle. The operating mode may correspond to a power level supplied to the heater (e.g., such as the power levels discussed above). The controller may be configured to operate according to a plurality of operating modes. The operating modes may differ in how the heater is controlled by the controller. For example, one power mode may comprise gradual heating of the heater and another power mode may comprise more rapid heating (e.g., at the expense of power consumption).

The aspect of operation of the device of the first mode may comprise controlling a duration of the consumable cycle based on the exhaustion level. The controller may be configured to compare the exhaustion level to a predetermined threshold level. If the exhaustion level exceeds the predetermined level then the controller may reduce the duration of the consumable cycle. On the other hand, if the exhaustion level is less than a predetermined level, the controller may increase the duration of the consumable cycle. The predetermined threshold level may be selected based on the expected exhaustion at the point in time in the cycle (i.e., at which the comparison is made). For example, if the comparison is made at (or near) the end of the cycle, the predetermined threshold may be indicative of full exhaustion of a consumable.

The controller may be configured to extend the duration of the consumable cycle by a predetermined extension period if the exhaustion level is a below a predetermined minimum exhaustion threshold. The controller may compare the exhaustion level to the minimum exhaustion level at the end (or near the end) of the cycle. The controller may be configured to control a user interface (UI) of the device to indicate to a user that the duration of the consumable cycle is being extended. The controller may be configured to extend the duration of the consumable cycle upon receipt of an input signal from the UI (e.g., in response to the indication that the duration is to be extended). In this respect, the device may be configured to give the user the option to extend the duration of the consumable cycle.

The controller may be configured to shorten a duration of the consumable cycle if the exhaustion level is above a predetermined maximum exhaustion threshold. This may ensure that the consumable is not over-exhausted (e.g., and consumed by a user when the consumable is in a fully exhausted state).

The aspect of operation of the device of the first mode may comprise controlling an operating temperature of a heater of the device during the consumable cycle based on the exhaustion level. For example, the controller may be configured to reduce the temperature of the heater if the exhaustion level is above a predetermined maximum exhaustion level. This may slow exhaustion of the consumable. Likewise, the controller may be configured to increase the temperature of the heater if the exhaustion level is below a predetermined minimum exhaustion level. The minimum and maximum exhaustion levels may define a desired exhaustion range for the point in the consumable cycle at which the comparison is made.

The smoking substitute device may comprise a user output means (e.g., forming part of the UI) for providing user feedback to the user. The controller may be configured to control the user output means to indicate to the user the control of the aspect of the operation of the smoking substitute device. The user output means may include one or more lights or a haptic feedback component.

The device may comprise an elongate body. An end of the elongate body may be configured for engagement with an aerosol-forming article. For example, the body may be configured for engagement with a heated tobacco (HT) consumable (or heat-not-burn (HNB) consumable) or an e-cigarette consumable. The terms "heated tobacco" and "heat-not-burn" are used interchangeably herein to describe a consumable that is of the type that is heated rather than combusted (or are used interchangeably to describe a device for use with such a consumable). The device may comprise a cavity that is configured for receipt of at least a portion of the consumable (i.e., for engagement with the consumable). The aerosol-forming article may be of the type that comprises an aerosol former (e.g., carried by an aerosol-forming substrate).

As discussed above, the device may comprise a heater for heating the aerosol-forming article. The heater may comprise a heating element, which may be in the form of a rod that extends from the body of the device. The heating element may extend from the end of the body that is configured for engagement with the aerosol-forming article.

The heater (and thus the heating element) may be rigidly mounted to the body. The heating element may be elongate so as to define a longitudinal axis and may, for example, have a transverse profile (i.e., transverse to a longitudinal axis of the heating element) that is substantially circular (i.e., the heating element may be generally cylindrical). Alternatively, the heating element may have a transverse profile that is rectangular (i.e., the heater may be a "blade heater"). The heating element may alternatively be in the shape of a tube (i.e., the heater may be a "tube heater"). The heating element may take other forms (e.g., the heating element may have an elliptical transverse profile). The shape and/or size (e.g. diameter) of the transverse profile of the heating element may be generally consistent for the entire length (or substantially the entire length) of the heating element.

The heating element may be between 15 mm and 25 mm long, e.g., between 18 mm and 20 mm long, e.g., around 19 mm long. The heating element may have a diameter of between 1.5 mm and 2.5 mm, e.g., a diameter between 2 mm and 2.3 mm, e.g., a diameter of around 2.15 mm.

The heating element may be formed of ceramic. The heating element may comprise a core (e.g., a ceramic core) comprising $Al_2O_3$. The core of the heating element may have a diameter of 1.8 mm to 2.1 mm, e.g., between 1.9 mm and 2 mm. The heating element may comprise an outer layer (e.g., an outer ceramic layer) comprising $Al_2O_3$. The thickness of the outer layer may be between 160 μm and 220 μm, e.g., between 170 μm and 190 μm, e.g., around 180 μm. The heating element may comprise a heating track, which may extend longitudinally along the heating element. The heating track may be sandwiched between the outer layer and the core of the heating element. The heating track may comprise tungsten and/or rhenium. The heating track may have a thickness of around 20 μm.

The heating element may be located in the cavity (of the device), and may extend (e.g., along a longitudinal axis) from an internal base of the cavity towards an opening of the cavity. The length of the heating element (i.e., along the longitudinal axis of the heater) may be less than the depth of the cavity. Hence, the heating element may extend for only a portion of the length of the cavity. That is, the heating element may not extend through (or beyond) the opening of the cavity.

The heating element may be configured for insertion into an aerosol-forming article (e.g., a HT consumable) when an aerosol-forming article is received in the cavity. In that respect, a distal end (i.e., distal from a base of the heating element where it is mounted to the device) of the heating element may comprise a tapered portion, which may facilitate insertion of the heating element into the aerosol-forming article. The heating element may fully penetrate an aerosol-forming article when the aerosol-forming article is received in the cavity. That is, the entire length, or substantially the entire length, of the heating element may be received in the aerosol-forming article.

The heating element may have a length that is less than, or substantially the same as, an axial length of an aerosol-forming substrate forming part of an aerosol-forming article (e.g., a HT consumable). Thus, when such an aerosol-forming article is engaged with the device, the heating element may only penetrate the aerosol-forming substrate, rather than other components of the aerosol-forming article. The heating element may penetrate the aerosol-forming substrate for substantially the entire axial length of the aerosol forming-substrate of the aerosol-forming article. Thus, heat may be transferred from (e.g., an outer circumferential surface of) the heating element to the surrounding aerosol-forming substrate, when penetrated by the heating element. That is, heat may be transferred radially outwardly (in the case of a cylindrical heating element) or e.g., radially inwardly (in the case of a tube heater).

Where the heater is a tube heater, the heating element of the tube heater may surround at least a portion of the cavity. When the portion of the aerosol-forming article is received in the cavity, the heating element may surround a portion of the aerosol-forming article (i.e., so as to heat that portion of the aerosol-forming article). In particular, the heating element may surround an aerosol forming substrate of the aerosol-forming article. That is, when an aerosol-forming article is engaged with the device, the aerosol forming substrate of the aerosol-forming article may be located adjacent an inner surface of the (tubular) heating element. When the heating element is activated, heat may be transferred radially inwardly from the inner surface of the heating element to heat the aerosol forming substrate.

The cavity may comprise a (e.g., circumferential) wall (or walls) and the (tubular) heating element may extend around at least a portion of the wall(s). In this way, the wall may be located between the inner surface of the heating element and an outer surface of the aerosol-forming article. The wall (or walls) of the cavity may be formed from a thermally conductive material (e.g., a metal) to allow heat conduction from the heating element to the aerosol-forming article. Thus, heat may be conducted from the heating element, through the cavity wall (or walls), to the aerosol-forming substrate of an aerosol-forming article received in the cavity.

In some embodiments the heater may form part of an aerosol-forming article for use with the device. In such cases the device may not comprise a heater. Rather, the aerosol-forming article may comprise a heater. Such arrangements may, for example, be suited to e-cigarette systems in which the aerosol-forming article comprises a tank containing an aerosol former (e.g., in liquid form). In such embodiments, the device may comprise means for connecting the device the heater of an aerosol-forming article engaged with the device. For example, the device may comprise one or more device connectors for (e.g., electrically) connecting the device to a corresponding heater connector of the aerosol-forming article. The connectors (i.e., of both the device and the aerosol-forming article) may be in the form of electrically conductive elements (e.g., plates) that contact when the aerosol-forming article is engaged with the device.

In some embodiments the device may comprise a cap disposed at the end of the body that is configured for engagement with an aerosol-forming article. Where the device comprises, a heater having a heating element, the cap may at least partially enclose the heating element. The cap may be moveable between an open position in which access is provided to the heating element, and a closed position in which the cap at least partially encloses the heating element. The cap may be slideably engaged with the body of the device and may be slidable between the open and closed positions.

The cap may define at least a portion of the cavity of the device. That is, the cavity may be fully defined by the cap, or each of the cap and body may define a portion of the cavity. Where the cap fully defines the cavity, the cap may comprise an aperture for receipt of the heating element into the cavity (when the cap is in the closed position). The cap may comprise an opening to the cavity. The opening may be configured for receipt of at least a portion of an aerosol-forming article. That is, an aerosol-forming article may be inserted through the opening and into the cavity (so as to be engaged with the device).

The cap may be configured such that when an aerosol-forming article is engaged with the device (e.g., received in the cavity), only a portion of the aerosol-forming article is received in the cavity. That is, a portion of the aerosol-forming article (not received in the cavity) may protrude from (i.e., extend beyond) the opening. This (protruding) portion of the aerosol-forming article may be a terminal (e.g., mouth) end of the aerosol-forming article, which may be received in a user's mouth for the purpose of inhaling aerosol formed by the device.

As mentioned above, the device may comprise a power source or may be connectable to a power source (e.g., a power source separate to the device). The power source may be electrically connectable to the heater. In that respect, altering (e.g., toggling) the electrical connection of the power source to the heater may affect a state of the heater. For example, toggling the electrical connection of the power source to the heater may toggle the heater between an on state and an off state. The power source may be a power store. For example, the power source may be a battery or rechargeable battery (e.g., a lithium ion battery).

The device may comprise an input connection (e.g., a USB port, Micro USB port, USB-C port, etc.). The input connection may be configured for connection to an external source of electrical power, such as a mains electrical supply outlet. The input connection may, in some cases, be used as a substitute for an internal power source (e.g., battery or rechargeable battery). That is, the input connection may be electrically connectable to the heater (for providing power to the heater). Hence, in some forms, the input connection may form at least part of the power source of the device.

Where the power source comprises a rechargeable power source (such as a rechargeable battery), the input connection may be used to charge and recharge the power source.

In some embodiments the UI may include input means to receive operative commands from the user. The input means of the UI may allow the user to control at least one aspect of the operation of the device. In some embodiments the input means may comprise a power button to switch the device between an on state and an off state. Alternatively or additionally, the button may be used to extend the duration of the consumable cycle as discussed above.

In some embodiments the UI may additionally or alternatively comprise output means to convey information to the user. In some embodiments the output means may comprise a light to indicate a condition of the device (and/or the aerosol-forming article) to the user. The condition of the device (and/or aerosol-forming article) indicated to the user may comprise a condition indicative of the operation of the heater. For example, the condition may comprise whether the heater is in an off state or an on state. In some embodiments, the UI unit may comprise at least one of a button, a display, a touchscreen, a switch, a light, and the like. For example, the output means may comprise one or more (e.g., two, three, four, etc.) light-emitting diodes ("LEDs") that may be located on the body of the device. The LEDs (or display or touchscreen) may indicate to a user that the duration of the consumable cycle has been increased or decreased, or may indicate to a user that they may extend the duration (e.g., by pressing a button or touchscreen).

As discussed above, the device may further comprise a puff sensor (e.g., airflow sensor), which may form part of the input means of the UI. The puff sensor may be configured to detect a user drawing on an end (i.e., a terminal (mouth) end) of the aerosol-forming article. The puff sensor may, for example, be a pressure sensor or a microphone. The puff sensor may be configured to produce a signal indicative of a puff state. The signal may be indicative of the user drawing (an aerosol from the aerosol-forming article) such that it is e.g., in the form of a binary signal. Alternatively or additionally, the signal may be indicative of a characteristic of the draw (e.g., a flow rate of the draw, length of time of the draw, etc).

The controller may comprise a microcontroller that may e.g., be mounted on a printed circuit board (PCB). The controller may also comprise a memory, e.g., non-volatile memory. The memory may include instructions, which, when implemented, may cause the controller to perform certain tasks or steps of a method. Where the device comprises an input connection, the controller may be connected to the input connection.

The controller may be configured to control the operation of the heater (and e.g., the heating element). Thus, the controller may be configured to control vaporization of an aerosol forming part of an aerosol-forming article engaged with the device. The controller may be configured to control the voltage applied by power source to the heater. For example, the controller may be configured to toggle between applying a full output voltage (of the power source) to the heater and applying no voltage to the heater. Alternatively or additionally, the control unit may implement a more complex heater control protocol.

The device may further comprise a voltage regulator to regulate the output voltage supplied by the power source to form a regulated voltage. The regulated voltage may subsequently be applied to the heater.

In some embodiments, where the device comprises a UI, the controller may be operatively connected to one or more components of the UI. The controller may be configured to receive command signals from an input means of the UI. The controller may be configured to control the heater in response to the command signals. For example, the controller may be configured to receive "on" and "off" command signals from the UI and, in response, may control the heater so as to be in a corresponding on or off state.

The controller may be configured to send output signals to a component of the UI. The UI may be configured to convey information to a user, via an output means, in response to such output signals (received from the controller). For example, where the device comprises one or more LEDs, the LEDs may be operatively connected to the controller. Hence, the controller may configured to control the illumination of the LEDs (e.g., in response to an output signal). For example, the controller may be configured to control the illumination of the LEDs according to (e.g., an on or off) state of the heater.

The device may comprise a wireless interface configured to communicate wirelessly (e.g., via Bluetooth (e.g., a Bluetooth low-energy connection) or WiFi) with an external device. Similarly, the input connection may be configured for wired connection to an external device so as to provide communication between the device and the external device.

The external device may be a mobile device. For example, the external device may be a smart phone, tablet, smart watch, or smart car. An application (e.g., app) may be installed on the external device (e.g., mobile device). The application may facilitate communication between the device and the external device via the wired or wireless connection.

The wireless or wired interface may be configured to transfer signals between the external device and the controller of the device. In this respect, the controller may control an aspect of the device in response to a signal received from an external device. Alternatively or additionally, an external device may respond to a signal received from the device (e.g., from the controller of the device).

In a second aspect of the first mode, there is provided a system (e.g., a smoking substitute system) comprising a device according to the first aspect and an aerosol-forming article. The aerosol-forming article may comprise an aerosol-forming substrate at an upstream end of the aerosol-forming article. The article may be in the form of a smoking substitute article, e.g., heated tobacco (HT) consumable (also known as a heat-not-burn (HNB) consumable).

As used herein, the terms "upstream" and "downstream" are intended to refer to the flow direction of the vapor/aerosol i.e., with the downstream end of the article/consumable being the mouth end or outlet where the aerosol exits the consumable for inhalation by the user. The upstream end of the article/consumable is the opposing end to the downstream end.

The aerosol-forming substrate is capable of being heated to release at least one volatile compound that can form an aerosol. The aerosol-forming substrate may be located at the upstream end of the article/consumable.

In order to generate an aerosol, the aerosol-forming substrate comprises at least one volatile compound that is intended to be vaporized/aerosolized and that may provide the user with a recreational and/or medicinal effect when inhaled. Suitable chemical and/or physiologically active volatile compounds include the group consisting of: nicotine, cocaine, caffeine, opiates and opioids, cathine and cathinone, kavalactones, mysticin, beta-carboline alkaloids, salvinorin A together with any combinations, functional equivalents to, and/or synthetic alternatives of the foregoing.

The aerosol-forming substrate may comprise plant material. The plant material may comprise least one plant material selected from the list including *Amaranthus dubius, Arctostaphylos uva-ursi* (Bearberry), *Argemone mexicana, Amica, Artemisia vulgaris*, Yellow Tees, *Galea zacatechichi, Canavalia maritima* (Baybean), *Cecropia mexicana* (Guamura), *Cestrum noctumum, Cynoglossum virginianum* (wild comfrey), *Cytisus scoparius, Damiana, Entada rheedii, Eschscholzia califomica* (California Poppy), *Fittonia albivenis, Hippobroma longiflora, Humulus japonica* (Japanese Hops), *Humulus lupulus* (Hops), *Lactuca virosa* (Lettuce Opium), *Laggera alata, Leonotis leonurus, Leonurus cardiaca* (Motherwort), *Leonurus sibiricus* (Honeyweed), *Lobelia cardinalis, Lobelia inflata* (Indian-tobacco), *Lobelia siphilitica, Nepeta cataria* (Catnip), *Nicotiana* species (Tobacco), *Nymphaea alba* (White Lily), *Nymphaea caerulea* (Blue Lily), Opium poppy, *Passiflora incamata* (Passionflower), *Pedicularis densiflora* (Indian Warrior), *Pedicularis groenlandica* (Elephant's Head), *Salvia divinorum, Salvia dorrii* (Tobacco Sage), *Salvia* species (Sage), *Scutellaria galericulata, Scutellaria lateriflora, Scutellaria nana, Scutellaria* species (Skullcap), *Sida acuta* (Wireweed), *Sida rhombifolia, Silene capensis, Syzygium aromaticum* (Clove), *Tagetes lucida* (Mexican Tarragon), *Tarchonanthus camphoratus, Tumera diffusa* (Damiana), *Verbascum* (Mullein), *Zamia latifolia* (Maconha Brava) together with any combinations, functional equivalents to, and/or synthetic alternatives of the foregoing.

The plant material may be tobacco. Any type of tobacco may be used. This includes, but is not limited to, flue-cured tobacco, burley tobacco, Maryland Tobacco, dark-air cured tobacco, oriental tobacco, dark-fired tobacco, perique tobacco and rustica tobacco. This also includes blends of the above mentioned tobaccos.

The tobacco may comprise one or more of leaf tobacco, stem tobacco, tobacco powder, tobacco dust, tobacco derivatives, expanded tobacco, homogenized tobacco, shredded tobacco, extruded tobacco, cut rag tobacco and/or reconstituted tobacco (e.g., slurry recon or paper recon).

The aerosol-forming substrate may comprise a gathered sheet of homogenized (e.g., paper/slurryrecon) tobacco or gathered shreds/strips formed from such a sheet.

The aerosol-forming substrate may comprise one or more additives selected from humectants, flavorants, fillers, aqueous/non-aqueous solvents and binders.

The flavorant may be provided in solid or liquid form. It may include menthol, licorice, chocolate, fruit flavor (including e.g., citrus, cherry etc.), vanilla, spice (e.g., ginger, cinnamon) and tobacco flavor. The flavorant may be evenly dispersed throughout the aerosol-forming substrate or may be provided in isolated locations and/or varying concentrations throughout the aerosol-forming substrate.

The aerosol-forming substrate may be formed in a substantially cylindrical shape such that the article/consumable resembles a conventional cigarette. It may have a diameter of between 5 and 10 mm e.g., between 6 and 9 mm or 6 and 8 mm e.g., around 7 mm. It may have an axial length of between 10 and 15 mm e.g., between 11 and 14 mm such as around 12 or 13 mm.

The article/consumable may comprise at least one filter element. There may be a terminal filter element at the downstream/mouth end of the article/consumable.

The or at least one of the filter element(s) (e.g., the terminal filter element) may be comprised of cellulose acetate or polypropylene tow. The at least one filter element (e.g., the terminal filter element) may be comprised of activated charcoal. The at least one filter element (e.g., the terminal element) may be comprised of paper. The or each filter element may be at least partly (e.g., entirely) circumscribed with a plug wrap e.g., a paper plug wrap.

The terminal filter element (at the downstream end of the article/consumable) may be joined to the upstream elements forming the article/consumable by a circumscribing tipping layer e.g., a tipping paper layer. The tipping paper may have an axial length longer than the axial length of the terminal filter element such that the tipping paper completely circumscribes the terminal filter element plus the wrapping layer surrounding any adjacent upstream element.

In some embodiments, the article/consumable may comprise an aerosol-cooling element which is adapted to cool the aerosol generated from the aerosol-forming substrate (by heat exchange) before being inhaled by the user.

The article/consumable may comprise a spacer element that defines a space or cavity between the aerosol-forming substrate and the downstream end of the consumable. The spacer element may comprise a cardboard tube. The spacer element may be circumscribed by the (paper) wrapping layer.

In some embodiments the system may be in the form of an e-cigarette system (i.e., rather than a heated tobacco system as described above). In such a system, the consumable may be in the form of an e-cigarette consumable. The e-cigarette system may be configured such that the consumable can be received and retained in the cavity of the device (i.e., so as to be engaged with the device). The consumable may be retained by way of e.g., an interference fit, screwing one onto (or onto) the other, a bayonet fitting, or by way of a snap engagement mechanism.

The consumable may comprise a tank, which may define a reservoir for the storage of an aerosol former. The aerosol former may be in the form of an e-liquid (stored in the reservoir).

The consumable may be a "single-use" consumable. That is, upon exhausting the e-liquid in the tank, the intention may be that the user disposes of the entire consumable. Alternatively, the e-liquid may be the only part of the system that is truly "single-use". For example, the tank may be refillable with e-liquid or another component of the system (internal to the device or external to the device e.g., a refillable cartomizer) may define a reservoir for the e-liquid.

As set forth above, the consumable may comprise a heater (i.e., instead of the heater forming part of the device) configured to heat and vaporize the e-liquid. The consumable may comprise a porous wick that conveys e-liquid from the tank to a heating element of the heater. The heating element may be a heating filament that is wound (e.g., helically) around at least a portion of the porous wick, such that when the heating element is heated (e.g., by the action of electrical current passing through the heating element), heat may be transferred from the heating element to the e-liquid conveyed by the wick. This transfer of heat may vaporize the e-liquid and the resultant vapor may be entrained in an airflow passing through the consumable.

The consumable may further comprise one or more heater connectors for connecting the heater (of the consumable) to the device. The heater connectors may be in the form of electrically conductive element or contacts (e.g., metal plates) and may be disposed on an in-use device-facing surface of the consumable. The heater connectors may be electrically connected to the heater of the consumable, such that electricity supplied via the heater connectors may pass to the heater. In other words, a voltage applied across the heater connectors may generally correspond to a voltage applied across the heating element of the heater.

The heater connectors may be arranged such that they contact corresponding device connectors of the device when the consumable is engaged with the device. The device connectors may be connected (e.g., electrically) to a power source (e.g., battery) of the device. Thus, electricity may be supplied from the power source to the heating element, via in-contact heater and device connectors. In this way, the heater forming part of the consumable may operate (and interact with e.g., a controller) as otherwise described above with respect to a heater forming part of the device.

According to a third aspect of the first mode of the present disclosure, there is provided a method of using the system according to the second aspect, the method comprising inserting the aerosol-forming article into the device; and heating the article using the heater of the device.

In some embodiments the method may comprise inserting the article into a cavity within a body of the device and penetrating the article with the heating element of the device upon insertion of the article.

In a fourth aspect there is provided a method of operating a smoking substitute device for heating a consumable during a consumable cycle, the method comprising: measuring a usage of the device by a user during the consumable cycle; determining an exhaustion level of the consumable during the consumable cycle based on the usage, and controlling an aspect of the operation of the smoking substitute device during the consumable operating cycle based on the exhaustion level.

Measuring a usage of the device by a user may comprise detecting one or more puffs by a user during the consumable cycle. The method of the fourth aspect may be as otherwise described above with regards to the operation of the controller of the first aspect.

The first mode of the disclosure includes the combination of the aspects and preferred features described except where such a combination is clearly impermissible or expressly avoided.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

Second Mode of the Disclosure: Smoking Substitute Device Able to Operate With Both E-cigarette and Heat-Not-Burn Consumables.

At its most general, the second mode of the present disclosure relates to a smoking substitute device that is able to operate with both e-cigarette and heat-not-burn consumables.

According to the second mode of the present disclosure, there is provided a smoking substitute device, comprising one or more heaters for heating a consumable, and a controller configured to control the one or more heaters according to first and second heating modes, wherein the first heating mode is for heating a heat-not-burn consumable and the second heating mode is for heating an e-cigarette consumable.

By providing a smoking substitute device capable of operating under two different heating modes, the device can accommodate multiple consumable types. This means a user does not require two different devices to support heat-not-burn and e-cigarette consumables (i.e., the device provides cross-vaping experience). As is discussed above, a heat-not-burn consumable generally comprises tobacco leaf or reconstituted tobacco in solid form, whilst an e-cigarette consumable comprises an e-liquid (i.e., a liquid) formed of a base liquid and nicotine and/or a flavorant. In this respect, a heat-not-burn consumable generally comprises a solid aerosol-forming substrate, whilst an e-cigarette consumable generally comprises an aerosol-forming liquid contained in e.g., a tank.

Optional features will now be set out. These are applicable singly or in any combination with any aspect.

The first heating mode and the second heating mode may be operated by a single heater. That is, the controller may control the single heater differently depending on whether the heating mode is the first or second heating mode. This may simplify maintenance of the device and may minimise the cost of producing the device.

The heater may comprise first and second heating tracks for heating the consumable. The first and second tracks may be configured to heat to different temperatures (e.g., when the same voltage is applied to both tracks). The first and second tracks may be configured to heat at different rates (e.g., when the same voltage is applied to both tracks). The first and second tracks may be located at different regions of the heating element. The first and second tracks may be different shapes and/or sizes. The first and second tracks may be formed of different materials. The first and second tracks may be configured so as to have different impedance. Both tracks may be electrically connected to the same power source. Both tracks may be electrically connected to one another.

The first heating track may be configured for direct contact with an aerosol-forming substrate of the consumable. The second heating track may be configured for contact with a heating element of the consumable such that the second heating track may be configured to heat the aerosol-forming substrate of the consumable indirectly.

In the first heating mode, the first track may be active and the second track may be inactive. In the second heating mode, the first track may be inactive and the second track may be active. In other words, in each of the two heating modes only one of the tracks may be active. Thus, each track may be configured for operating in one of the two heating modes. For example, the first track may be configured for heating a heat-not-burn consumable and the second track may be configured for heating an e-cigarette consumable (or vice versa).

In one of the first and second heating modes, the first and second tracks may be active, and in the other of the first and second heating modes, the first track may be active and the second track may be inactive. In other words, in one heating mode, a single track may be active and in the other heating mode both tracks may be active. This may be suitable where one of the two heating modes requires more heating than the other, or where one of the two heating modes requires more rapid heating than the other. For example, in the second heating mode both heating tracks may be active and in the first heating mode only one heating track may be active (or vice versa).

The device may comprise first and second heaters. In this case, in one of the first and second heating modes, the first and second heaters may be active, and in the other of the first and second heating modes, the first heater may be active and the second heater may be inactive. In other words, in one heating mode only one of the heaters may be active and in the other heating mode, both heaters may be active. As above, this may be suitable where one of the two heating modes requires more heating than the other, or where one of the two heating modes requires more rapid heating than the other. For example, in the second heating mode both heaters may be active and in the first heating mode only one heater may be active (or vice versa).

The device may comprise a first heater configured to operate according to the first heating mode and a second heater configured to operated according to the second heating mode. In this embodiment the heaters may only operate separately (and not concurrently). The first and second heaters may be configured to heat to different temperatures (e.g., when the same voltage is applied to both heaters). The first and second heaters may be configured to heat at different rates (e.g., when the same voltage is applied to both heaters). The first and second heaters may be different shapes and/or sizes and/or may have different arrangements of heater tracks. The first and second heaters may be formed of different materials. One of the first and second heaters may be an internal heater (e.g., for insertion into the consumable) and the other of the first and second heaters may be an external heater (e.g., contact with, but not insertion into, the consumable).

The first heater may be configured for direct contact with an aerosol-forming substrate of the consumable. The second heater may be configured for contact with a heating element of the consumable such that the second heater may heat the aerosol-forming substrate of the consumable indirectly.

The device may comprise a consumable detection sensor for detecting the type of consumable engaged with the device. The controller may be configured to control the one or more heaters in response to the detected consumable type. For example, the consumable detection sensor may be a switch or button that is activated by one consumable type but not the other. Alternatively, the sensor may be an RFID reader or a barcode reader. In this respect, consumables may be provided with barcodes or RFID tags for reading by the device. The sensor may detect the shape, size, and/or colour (e.g., by light sensor) of the consumable. The controller may switch between the first and second heating modes depending on the type of the detected consumable.

The device may comprise a user input module configured to receive a selection of consumable type from a user. The user input module may form part of a user interface (UI) of the device. The controller may be configured to control the one or more heaters in response to the selected consumable type. The input module may comprise, for example, a switch, a button, a touchscreen, etc. When the input module comprises a touchscreen, the user may be presented with two consumable type selections and may be able to select a consumable type by touching the screen at the appropriate location. The controller may switch between the first and second modes depending on the consumable type selected by the user.

The user input module may allow the user to control further aspects of the operation of the device. For example, the user input module may comprise a power button to switch the device between an on state and an off state. In some embodiments the UI may additionally or alternatively comprise output means to convey information to the user (i.e., which may include the touchscreen). The output means may be configured to indicate the current mode of the device (i.e., whether the heaters are operating according to the first or second mode). In some embodiments the output means may comprise a light to indicate a condition of the device (and/or the aerosol-forming article) to the user. The condition of the device (and/or aerosol-forming article) indicated to the user may comprise a condition indicative of the operation of the at least one heater (i.e., the mode of the at least one heater). The condition may also comprise whether the heater is in an off state or an on state. The output means may comprise one or more (e.g., two, three, four, etc.) light-emitting diodes ("LEDs") that may be located on the body of the device.

The device may comprise a valve for controlling airflow through the consumable. For example, the device may comprise an inlet for supplying air to the consumable (i.e., when inhaled by a user). The valve may be located in a passageway connecting the inlet to the consumable. The valve may be configured to alter the airflow through the passageway (e.g., by changing the size of a portion of the passageway). The valve may comprise an actuator for altering the position of the valve. The actuator may be controllable by the controller. The controller may cause the actuator to move the valve between a first position and a second position depending on whether the one or more heaters are operating according to the first or second heating mode. For example, greater airflow may be provided through the consumable when the device is in the second mode (i.e., when heating an e-cigarette consumable). That is, the controller may be configured to move the valve to a first position in the first mode and a second position in the second mode and the valve may allow a greater airflow in the second position.

The device may further comprise a puff sensor (e.g., airflow sensor). The puff sensor may be configured to detect user inhalation through the consumable. The puff sensor may, for example, be a pressure sensor or a microphone. The puff sensor may be configured to produce a signal indicative of a puff state. The signal may be indicative of the user drawing (an aerosol from the aerosol-forming article) such that it is e.g., in the form of a binary signal. Alternatively or additionally, the signal may be indicative of a characteristic of the draw (e.g., a flow rate of the draw, length of time of the draw, etc). The second heating mode may comprise controlling the at least one heater in response to the detection of user inhalation. For example, when in the second heating mode, the controller may only activate the at least one heater or particular heating tracks when an inhalation is detected (or for a period of time when inhalation is detected).

In some embodiments, rather than altering the airflow through the device via a valve, the e-cigarette and heat not burn consumables may be configured to permit different airflows there through. For example, the consumables may comprise different opening sizes, or other means for providing different airflows. In this case, the puff sensor may instead provide means for detecting which type of consumable is engaged with the device. The puff sensor may detect a characteristic of the airflow that may be different between the different types of consumable. This information may be provided to the controller and in response the controller may switch between the first and second modes.

The first heating mode may comprise activating the at least one heater for a predetermined period of time. The first heating mode may comprise activating the heater for a predetermined maximum period of time. That is, the controller may be configured to deactivate the heater prior to the predetermined period of time completing if e.g., a user turns the device off.

The device may comprise a body supporting the heater, and cap that is removably engagable with the body. The cap may be configured for receipt of a consumable such that, when engaged with the body, the heater is able to heat the consumable (e.g., by insertion into, or contact with, the consumable). The cap may be interchangeable with a further (separate) cap. One of the caps may be configured for receipt of a heat-not-burn consumable and the other may be configured for receipt of an e-cigarette consumable.

The body of the device may be elongate. An end of the elongate body may be configured for engagement with the consumable. The terms "heated tobacco" and "heat-not-burn" are used interchangeably herein to describe a consumable that is of the type that is heated rather than combusted (or are used interchangeably to describe a device for use with such a consumable). The device may comprise a cavity that is configured for receipt of at least a portion of the consumable (i.e., for engagement with the consumable).

The at least one heater may comprise a heating element, which may be in the form of a rod that extends from the body of the device. Only one heating element is described below for brevity, but as is provided above, the device may comprise multiple heating elements and that some or all of these heating elements may be as described below.

The at least one heater (and thus the heating element) may be rigidly mounted to the body. The heating element may be elongate so as to define a longitudinal axis and may, for example, have a transverse profile (i.e., transverse to a longitudinal axis of the heating element) that is substantially circular (i.e., the heating element may be generally cylindrical). Alternatively, the heating element may have a transverse profile that is rectangular (i.e., the heater may be a "blade heater"). The heating element may alternatively be in the shape of a tube (i.e., the heater may be a "tube heater"). The heating element may take other forms (e.g., the heating element may have an elliptical transverse profile). The shape and/or size (e.g., diameter) of the transverse profile of the heating element may be generally consistent for the entire length (or substantially the entire length) of the heating element.

The heating element may be between 15 mm and 25 mm long, e.g., between 18 mm and 20 mm long, e.g., around 19 mm long. The heating element may have a diameter of between 1.5 mm and 2.5 mm, e.g., a diameter between 2 mm and 2.3 mm, e.g., a diameter of around 2.15 mm.

The heating element may be formed of ceramic. The heating element may comprise a core (e.g., a ceramic core) comprising Al2O3. The core of the heating element may have a diameter of 1.8 mm to 2.1 mm, e.g., between 1.9 mm and 2 mm. The heating element may comprise an outer layer (e.g., an outer ceramic layer) comprising Al2O3. The thickness of the outer layer may be between 160 μm and 220 μm, e.g., between 170 μm and 190 μm, e.g., around 180 μm. As is discussed above, the heating element may comprise one or more heating tracks, which may extend longitudinally along the heating element. The heating track(s) may be sandwiched between the outer layer and the core of the heating element. The heating track(s) may comprise tungsten and/or rhenium. The heating track(s) may have a thickness of around 20 μm.

The heating element may be located in the cavity (of the device), and may extend (e.g., along a longitudinal axis) from an internal base of the cavity towards an opening of the cavity. The length of the heating element (i.e., along the longitudinal axis of the at least one heater) may be less than the depth of the cavity. Hence, the heating element may extend for only a portion of the length of the cavity. That is, the heating element may not extend through (or beyond) the opening of the cavity.

Where the at least one heater is configured for insertion into the consumable, the distal end (i.e., distal from a base of the heating element where it is mounted to the device) of the heating element of the at least one heater may comprise a tapered portion, which may facilitate insertion of the heating element into the consumable. The heating element may fully penetrate a consumable when the consumable is received in the cavity. That is, the entire length, or substantially the entire length, of the heating element may be received in the consumable.

The heating element may have a length that is less than, or substantially the same as, an axial length of an aerosol-forming substrate or aerosol-forming liquid (i.e., or tank) part of the consumable. Thus, when such a consumable is engaged with the device, the heating element of the at least one heater may only penetrate into the aerosol-forming substrate or tank, rather than other components of the consumable. The heating element may penetrate the aerosol-forming substrate or tank for substantially the entire axial length of the aerosol forming-substrate or tank of the consumable. Thus, heat may be transferred from (e.g., an outer circumferential surface of) the heating element to the surrounding aerosol-forming substrate or aerosol-forming liquid, when penetrated by the heating element. That is, heat may be transferred radially outwardly (in the case of a cylindrical heating element) or e.g., radially inwardly (in the case of a tube heater).

Where the at least one heater is e.g., an external tube heater, the heating element of the tube heater may surround at least a portion of the cavity. When the portion of the consumable is received in the cavity, the heating element may surround a portion of the consumable (i.e., so as to heat that portion of the consumable). In particular, the heating element may surround an aerosol forming substrate or aerosol-forming liquid (tank) of the consumable. That is, when a consumable is engaged with the device, the aerosol forming substrate or aerosol-forming liquid tank of the consumable may be located adjacent an inner surface of the (tubular) heating element. When the heating element is activated, heat may be transferred radially inwardly from the inner surface of the heating element to heat the aerosol forming substrate or aerosol-forming liquid of the consumable.

The cavity may comprise a (e.g., circumferential) wall (or walls) and the (tubular) heating element may extend around at least a portion of the wall(s). In this way, the wall may be located between the inner surface of the heating element and an outer surface of the consumable. The wall (or walls) of the cavity may be formed from a thermally conductive material (e.g., a metal) to allow heat conduction from the heating element to the consumable. Thus, heat may be conducted from the heating element, through the cavity wall (or walls), to the aerosol-forming substrate or aerosol-forming liquid of a consumable received in the cavity.

In some embodiments the heater may be configured to provide heat to a heating element of the consumable (rather than heating an aerosol-forming substrate or aerosol-forming liquid of the consumable directly). In such cases the at least one heater may comprise a heat transfer plate for contact with a corresponding heat transfer plate of the consumable. This transfer of heat may, for example, be suited to e-cigarette systems in which the consumable comprises a tank containing an aerosol-forming liquid (e.g., an e-liquid).

The cap may be disposed at the end of the body that is configured for engagement with an aerosol-forming article. The cap may at least partially enclose the at least one heater when engaged with the body. The cap may be moveable between an open position in which access is provided to the heater, and a closed position in which the cap at least partially encloses the at least one heater. The cap may be slideably engaged with the body of the device, and may be slideable between the open and closed positions.

The cap may define at least a portion of the cavity of the device. That is, the cavity may be fully defined by the cap, or each of the cap and body may define a portion of the cavity. Where the cap fully defines the cavity, the cap may comprise an aperture for receipt of the at least one heater in the cavity (when the cap is in the closed position). The cap may comprise an opening to the cavity. The opening may be configured for receipt of at least a portion of the consumable. That is, the consumable may be inserted through the opening and into the cavity (so as to be engaged with the device). The opening and cavity may be configured for receipt of both e-cigarette consumables and heat-not-burn consumables.

The cap may be configured such that when a consumable is engaged with the device (e.g., received in the cavity), only a portion of the consumable is received in the cavity. That is, a portion of the consumable (not received in the cavity) may protrude from (i.e., extend beyond) the opening. This (protruding) portion of the consumable may be a terminal (e.g., mouth) end of the consumable, which may be received in a user's mouth for the purpose of inhaling aerosol formed by the device.

The device may comprise a power source or may be connectable to a power source (e.g., a power source separate to the device). The power source may be electrically connectable to the at least one heater. In that respect, altering (e.g., toggling) the electrical connection of the power source to the at least one heater may affect a state of the at least one heater. For example, toggling the electrical connection of the power source to the at least one heater may toggle the at least one heater between an on state and an off state. The power source may be a power store. For example, the power source may be a battery or rechargeable battery (e.g., a lithium ion battery).

The device may comprise an input connection (e.g., a USB port, Micro USB port, USB-C port, etc.). The input connection may be configured for connection to an external source of electrical power, such as a mains electrical supply outlet. The input connection may, in some cases, be used as a substitute for an internal power source (e.g., battery or rechargeable battery). That is, the input connection may be electrically connectable to the heater (for providing power to the heater). Hence, in some forms, the input connection may form at least part of the power source of the device.

Where the power source comprises a rechargeable power source (such as a rechargeable battery), the input connection may be used to charge and recharge the power source.

The controller may comprise a microcontroller that may e.g., be mounted on a printed circuit board (PCB). The controller may also comprise a memory, e.g., non-volatile memory. The memory may include instructions, which, when implemented, may cause the controller to perform certain tasks or steps of a method. Where the device comprises an input connection, the controller may be connected to the input connection.

The controller may be configured to control the voltage applied by the power source to the heater. For example, the controller may be configured to toggle between applying a full output voltage (of the power source) to the heater and applying no voltage to the heater. Alternatively or additionally, the control unit may implement a more complex heater control protocol (i.e., that may differ depending on the heating mode).

The device may further comprise a voltage regulator to regulate the output voltage supplied by the power source to form a regulated voltage. The regulated voltage may subsequently be applied to the heater.

As is discussed above, where the device comprises a UI, the controller may be operatively connected to one or more components of the UI. The controller may be configured to receive command signals from an input means of the UI. The controller may be configured to control the heater in response to the command signals. For example, in addition to controlling the mode of the at least one heater, the controller may be configured to receive "on" and "off" command signals from the UI and, in response, may control the at least one heater so as to be in a corresponding on or off state.

The controller may be configured to send output signals to a component of the UI. The UI may be configured to convey information to a user, via an output means, in response to such output signals (received from the controller). For example, where the device comprises one or more LEDs, the LEDs may be operatively connected to the controller. Hence, the controller may configured to control the illumination of the LEDs (e.g., in response to an output signal). For example, the controller may be configured to control the illumination of the LEDs according to (e.g., an on or off) state of the at least one heater and the mode of the at least one heater.

Where the device comprises a sensor (e.g., a puff/airflow sensor), the controller may be operatively connected to the sensor. The controller may be configured to receive a signal from the sensor (e.g., indicative of a condition of the device and/or engaged aerosol-forming article). The controller may be configured to control the heater, or an aspect of the output means, based on the signal from the sensor.

The device may comprise a wireless interface configured to communicate wirelessly (e.g., via Bluetooth (e.g., a Bluetooth low-energy connection) or WiFi) with an external device. Similarly, the input connection may be configured for wired connection to an external device so as to provide communication between the device and the external device.

The external device may be a mobile device. For example, the external device may be a smart phone, tablet, smart watch, or smart car. An application (e.g., app) may be installed on the external device (e.g., mobile device). The application may facilitate communication between the device and the external device via the wired or wireless connection.

The wireless or wired interface may be configured to transfer signals between the external device and the controller of the device. In this respect, the controller may control an aspect of the device in response to a signal received from an external device. Alternatively or additionally, an external device may respond to a signal received from the device (e.g., from the controller of the device).

In a second aspect of the second mode there is provided a smoking substitute kit comprising: a device as described above with respect to the first aspect, a first cap that is removably engagable with the device, the first cap configured for receipt of a heat-not-burn consumable such that, when engaged with the device, the heater is able to heat the heat-not-burn consumable; and a second cap that is removably engagable with the device, the cap component configured for receipt of an e-cigarette consumable such that, when engaged with the device, the heater is able to heat the e-cigarette consumable.

In a third aspect of the second mode, there is provided a system (e.g., a smoking substitute system) comprising a device according to the first aspect and a smoking substitute consumable. The system may comprise a further consumable. The system may comprise a heat-not-burn consumable and an e-cigarette consumable.

As used herein, the terms "upstream" and "downstream" are intended to refer to the flow direction of the vapor/aerosol i.e., with the downstream end of the article/consumable being the mouth end or outlet where the aerosol exits the consumable for inhalation by the user. The upstream end of the article/consumable is the opposing end to the downstream end. The heat not burn consumable may comprise an aerosol-forming substrate.

The aerosol-forming substrate is capable of being heated to release at least one volatile compound that can form an aerosol. The aerosol-forming substrate may be located at the upstream end of the article/consumable.

In order to generate an aerosol, the aerosol-forming substrate comprises at least one volatile compound that is intended to be vaporized/aerosolized and that may provide the user with a recreational and/or medicinal effect when inhaled. Suitable chemical and/or physiologically active volatile compounds include the group consisting of: nicotine, cocaine, caffeine, opiates and opioids, cathine and cathinone, kavalactones, mysticin, beta-carboline alkaloids, salvinorin A together with any combinations, functional equivalents to, and/or synthetic alternatives of the foregoing.

The aerosol-forming substrate may comprise plant material. The plant material may comprise least one plant material selected from the list including *Amaranthus dubius, Arctostaphylos uva-ursi* (Bearberry), *Argemone mexicana, Amica, Artemisia vulgaris*, Yellow Tees, *Galea zacatechichi, Canavalia maritima* (Baybean), *Cecropia mexicana* (Guamura), *Cestrum noctumum, Cynoglossum virginianum* (wild comfrey), *Cytisus scoparius, Damiana, Entada rheedii,*

*Eschscholzia califomica* (California Poppy), *Fittonia albivenis, Hippobroma longiflora, Humulus japonica* (Japanese Hops), *Humulus lupulus* (Hops), *Lactuca virosa* (Lettuce Opium), *Laggera alata, Leonotis leonurus, Leonurus cardiaca* (Motherwort), *Leonurus sibiricus* (Honeyweed), *Lobelia cardinalis, Lobelia inflata* (Indian-tobacco), *Lobelia siphilitica, Nepeta cataria* (Catnip), *Nicotiana* species (Tobacco), *Nymphaea alba* (White Lily), *Nymphaea caerulea* (Blue Lily), Opium poppy, *Passiflora incamata* (Passionflower), *Pedicularis densiflora* (Indian Warrior), *Pedicularis groenlandica* (Elephant's Head), *Salvia divinorum, Salvia dorrii* (Tobacco Sage), Salvia species (Sage), *Scutellaria galericulata, Scutellaria lateriflora, Scutellaria nana, Scutellaria* species (Skullcap), *Sida acuta* (Wireweed), *Sida rhombifolia, Silene capensis, Syzygium aromaticum* (Clove), *Tagetes lucida* (Mexican Tarragon), *Tarchonanthus camphoratus, Tumera diffusa* (Damiana), *Verbascum* (Mullein), *Zamia latifolia* (Maconha Brava) together with any combinations, functional equivalents to, and/or synthetic alternatives of the foregoing.

The plant material may be tobacco. Any type of tobacco may be used. This includes, but is not limited to, flue-cured tobacco, burley tobacco, Maryland Tobacco, dark-air cured tobacco, oriental tobacco, dark-fired tobacco, perique tobacco and rustica tobacco. This also includes blends of the above mentioned tobaccos.

The tobacco may comprise one or more of leaf tobacco, stem tobacco, tobacco powder, tobacco dust, tobacco derivatives, expanded tobacco, homogenized tobacco, shredded tobacco, extruded tobacco, cut rag tobacco and/or reconstituted tobacco (e.g., slurry recon or paper recon).

The aerosol-forming substrate of the heat-not-burn consumable may comprise a gathered sheet of homogenized (e.g., paper/slurry recon) tobacco or gathered shreds/strips formed from such a sheet.

The aerosol-forming substrate of the heat-not-burn consumable may comprise one or more additives selected from humectants, flavorants, fillers, aqueous/non-aqueous solvents and binders.

The flavorant may be provided in solid or liquid form. It may include menthol, licorice, chocolate, fruit flavor (including e.g., citrus, cherry etc.), vanilla, spice (e.g., ginger, cinnamon) and tobacco flavor. The flavorant may be evenly dispersed throughout the aerosol-forming substrate or may be provided in isolated locations and/or varying concentrations throughout the aerosol-forming substrate.

The aerosol-forming substrate of the heat-not-burn consumable may be formed in a substantially cylindrical shape such that the article/consumable resembles a conventional cigarette. It may have a diameter of between 5 and 10 mm e.g., between 6 and 9 mm or 6 and 8 mm e.g., around 7 mm. It may have an axial length of between 10 and 15 mm e.g., between 11 and 14 mm such as around 12 or 13 mm.

The heat-not-burn consumable may comprise at least one filter element. There may be a terminal filter element at the downstream/mouth end of the article/consumable.

The or at least one of the filter element(s) (e.g., the terminal filter element) may be comprised of cellulose acetate or polypropylene tow. The at least one filter element (e.g., the terminal filter element) may be comprised of activated charcoal. The at least one filter element (e.g., the terminal element) may be comprised of paper. The or each filter element may be at least partly (e.g., entirely) circumscribed with a plug wrap e.g., a paper plug wrap.

The terminal filter element (at the downstream end of the article/consumable) may be joined to the upstream elements forming the article/consumable by a circumscribing tipping layer e.g., a tipping paper layer. The tipping paper may have an axial length longer than the axial length of the terminal filter element such that the tipping paper completely circumscribes the terminal filter element plus the wrapping layer surrounding any adjacent upstream element.

In some embodiments, the heat-not-burn consumable may comprise an aerosol-cooling element which is adapted to cool the aerosol generated from the aerosol-forming substrate (by heat exchange) before being inhaled by the user.

The heat-not-burn consumable may comprise a spacer element that defines a space or cavity between the aerosol-forming substrate and the downstream end of the consumable. The spacer element may comprise a cardboard tube. The spacer element may be circumscribed by the (paper) wrapping layer.

The e-cigarette consumable may be configured to be received and retained in the cavity of the device (i.e., so as to be engaged with the device). The e-cigarette consumable may be retained by way of e.g., an interference fit, screwing one onto (or onto) the other, a bayonet fitting, or by way of a snap engagement mechanism.

The e-cigarette consumable may comprise a tank, which may define a reservoir for the storage of an aerosol former. The aerosol former may be in the form of an e-liquid (stored in the reservoir).

The e-cigarette consumable may be a "single-use" consumable. That is, upon exhausting the e-liquid in the tank, the intention may be that the user disposes of the entire consumable. Alternatively, the e-liquid may be the only part of the system that is truly "single-use". For example, the tank may be refillable with e-liquid or another component of the system (internal to the device or external to the device e.g., a refillable cartomizer) may define a reservoir for the e-liquid.

As set forth above, the e-cigarette consumable may comprise a heating element configured to receive heat from the heater of the device to heat and vaporize the e-liquid. The e-cigarette consumable may comprise a porous wick that conveys e-liquid from the tank to the heating element. The heating element of the e-cigarette consumable may be a heating filament that is wound (e.g., helically) around at least a portion of the porous wick, such that when the heating element is heated by the heater of the device, heat may be transferred from the heating element to the e-liquid conveyed by the wick. This transfer of heat may vaporize the e-liquid and the resultant vapor may be entrained in an airflow passing through the consumable.

As is discussed above, the e-cigarette consumable may further comprise one or more heater connectors for thermally connecting the heater of the device to the heating element of the consumable. The heater connectors may be in the form of thermally conductive element or contacts (e.g., metal plates) and may be disposed on an in-use device-facing surface of the e-cigarette consumable.

The disclosure includes the combination of the aspects and preferred features described except where such a combination is clearly impermissible or expressly avoided.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

Third Mode of the Disclosure: Heat Not Burn Device Having a Controller for Controlling Operation of a Heater.

At its most general, the third mode of the present disclosure relates to heat not burn device having a controller for controlling operation of a heater of the heat-not-burn device.

According to a first aspect of the third mode of the present disclosure, there is provided a heat-not-burn device, comprising: a heater for heating an aerosol-forming article, wherein the heater penetrates into the aerosol-forming article, and a controller for controlling operation of the heater; wherein the controller is configured to control power supplied to the heater such that the heater is heated to lower than or equal to a first predefined target operating temperature during an off-puff period, and to a second predefined target operating temperature during an on-puff period when a user puff is detected, wherein the second predefined target operating temperature is higher than the first predefined target operating temperature.

By providing a heat-not-burn device comprising a controller for controlling operation of a heater of the heat-not-burn device, battery life of the heat-not-burn device is increased. This may be achieved by varying temperature of the heater based on ON-state of the heat-not-burn device and draw detection in the heat-not-burn device.

Optional features will now be set out. These are applicable singly or in any combination with any aspect.

Optionally, the device further comprises a body configured for engagement with an aerosol-forming article in the form of a heated tobacco (HT) consumable; and a puff sensor; wherein: the heater comprises a heating element in the form of a rod that extends from the body of the device; the controller uses a signal from the puff sensor to detect a user puff, indicative of a puff state (i.e., drawing or not drawing); and wherein the heater is maintained at the second predefined target operating temperature until a user draw (puff) is no longer detected and decreasing the temperature to the first predefined target operating temperature.

Optionally, the first predefined target operating temperature is between 150 and 280 degrees Celsius.

Optionally, the first predefined target operating temperature is between 150 and 190 degrees Celsius.

Optionally, the second predefined target operating temperature is between 280 and 360 degrees Celsius.

Optionally, the device further includes a puff sensor, wherein the controller uses a signal from the puff sensor to detect the user puff.

Optionally, the puff sensor includes a pressure sensor.

Optionally, the device further includes a wireless communication module, wherein the controller is configured to send information associated with the operation of the heater to a compute device wirelessly connected to the wireless communication module.

The device may comprise an elongate body. An end of the elongate body may be configured for engagement with an aerosol-forming article. For example, the body may be configured for engagement with a heated tobacco (HT) consumable (or heat-not-burn (HNB) consumable). The terms "heated tobacco" and "heat-not-burn" are used interchangeably herein to describe a consumable that is of the type that is heated rather than combusted (or are used interchangeably to describe a device for use with such a consumable). The device may comprise a cavity that is configured for receipt of at least a portion of the consumable (i.e., for engagement with the consumable). The aerosol-forming article may be of the type that comprises an aerosol former (e.g., carried by an aerosol-forming substrate).

The device may comprise a heater for heating the aerosol-forming article. The heater may comprise a heating element, which may be in the form of a rod that extends from the body of the device. The heating element may extend from the end of the body that is configured for engagement with the aerosol-forming article.

The heater (and thus the heating element) may be rigidly mounted to the body. The heating element may be elongate so as to define a longitudinal axis and may, for example, have a transverse profile (i.e., transverse to a longitudinal axis of the heating element) that is substantially circular (i.e., the heating element may be generally cylindrical). Alternatively, the heating element may have a transverse profile that is rectangular (i.e., the heater may be a "blade heater"). The heating element may alternatively be in the shape of a tube (i.e., the heater may be a "tube heater"). The heating element may take other forms (e.g., the heating element may have an elliptical transverse profile). The shape and/or size (e.g., diameter) of the transverse profile of the heating element may be generally consistent for the entire length (or substantially the entire length) of the heating element.

The heating element may be between 15 mm and 25 mm long, e.g., between 18 mm and 20 mm long, e.g., around 19 mm long. The heating element may have a diameter of between 1.5 mm and 2.5 mm, e.g., a diameter between 2 mm and 2.3 mm, e.g., a diameter of around 2.15 mm.

The heating element may be formed of ceramic. The heating element may comprise a core (e.g., a ceramic core) comprising Al2O3. The core of the heating element may have a diameter of 1.8 mm to 2.1 mm, e.g., between 1.9 mm and 2 mm. The heating element may comprise an outer layer (e.g., an outer ceramic layer) comprising Al2O3. The thickness of the outer layer may be between 160 μm and 220 μm, e.g., between 170 μm and 190 μm, e.g., around 180 μm. The heating element may comprise a heating track, which may extend longitudinally along the heating element. The heating track may be sandwiched between the outer layer and the core of the heating element. The heating track may comprise tungsten and/or rhenium. The heating track may have a thickness of around 20 μm.

The heating element may be located in the cavity (of the device), and may extend (e.g., along a longitudinal axis) from an internal base of the cavity towards an opening of the cavity. The length of the heating element (i.e., along the longitudinal axis of the heater) may be less than the depth of the cavity. Hence, the heating element may extend for only a portion of the length of the cavity. That is, the heating element may not extend through (or beyond) the opening of the cavity.

The heating element may be configured for insertion into an aerosol-forming article (e.g., a HT consumable) when an aerosol-forming article is received in the cavity. In that respect, a distal end (i.e., distal from a base of the heating element where it is mounted to the device) of the heating element may comprise a tapered portion, which may facilitate insertion of the heating element into the aerosol-forming article. The heating element may fully penetrate an aerosol-forming article when the aerosol-forming article is received in the cavity. That is, the entire length, or substantially the entire length, of the heating element may be received in the aerosol-forming article.

The heating element may have a length that is less than, or substantially the same as, an axial length of an aerosol-forming substrate forming part of an aerosol-forming article (e.g., a HT consumable). Thus, when such an aerosol-forming article is engaged with the device, the heating element may only penetrate the aerosol-forming substrate, rather than other components of the aerosol-forming article. The heating element may penetrate the aerosol-forming substrate for substantially the entire axial length of the aerosol forming-substrate of the aerosol-forming article. Thus, heat may be transferred from (e.g., an outer circumferential surface of) the heating element to the surrounding aerosol-forming substrate, when penetrated by the heating element. That is, heat may be transferred radially outwardly (in the case of a cylindrical heating element) or e.g., radially inwardly (in the case of a tube heater).

Where the heater is a tube heater, the heating element of the tube heater may surround at least a portion of the cavity. When the portion of the aerosol-forming article is received in the cavity, the heating element may surround a portion of the aerosol-forming article (i.e., so as to heat that portion of the aerosol-forming article). In particular, the heating element may surround an aerosol forming substrate of the aerosol-forming article. That is, when an aerosol-forming article is engaged with the device, the aerosol forming substrate of the aerosol-forming article may be located adjacent an inner surface of the (tubular) heating element. When the heating element is activated, heat may be transferred radially inwardly from the inner surface of the heating element to heat the aerosol forming substrate.

The cavity may comprise a (e.g., circumferential) wall (or walls) and the (tubular) heating element may extend around at least a portion of the wall(s). In this way, the wall may be located between the inner surface of the heating element and an outer surface of the aerosol-forming article. The wall (or walls) of the cavity may be formed from a thermally conductive material (e.g., a metal) to allow heat conduction from the heating element to the aerosol-forming article. Thus, heat may be conducted from the heating element, through the cavity wall (or walls), to the aerosol-forming substrate of an aerosol-forming article received in the cavity.

In some embodiments, the device may comprise a cap disposed at the end of the body that is configured for engagement with an aerosol-forming article. Where the device comprises a heater having a heating element, the cap may at least partially enclose the heating element. The cap may be moveable between an open position in which access is provided to the heating element, and a closed position in which the cap at least partially encloses the heating element. The cap may be slideably engaged with the body of the device, and may be slideable between the open and closed positions.

The cap may define at least a portion of the cavity of the device. That is, the cavity may be fully defined by the cap, or each of the cap and body may define a portion of the cavity. Where the cap fully defines the cavity, the cap may comprise an aperture for receipt of the heating element into the cavity (when the cap is in the closed position). The cap may comprise an opening to the cavity. The opening may be configured for receipt of at least a portion of an aerosol-forming article. That is, an aerosol-forming article may be inserted through the opening and into the cavity (so as to be engaged with the device).

The cap may be configured such that when an aerosol-forming article is engaged with the device (e.g., received in the cavity), only a portion of the aerosol-forming article is received in the cavity. That is, a portion of the aerosol-forming article (not received in the cavity) may protrude from (i.e., extend beyond) the opening. This (protruding) portion of the aerosol-forming article may be a terminal (e.g., mouth) end of the aerosol-forming article, which may be received in a user's mouth for the purpose of inhaling aerosol formed by the device.

The device may comprise a power source or may be connectable to a power source (e.g., a power source separate to the device). The power source may be electrically connectable to the heater. In that respect, altering (e.g., toggling) the electrical connection of the power source to the heater may affect a state of the heater. For example, toggling the electrical connection of the power source to the heater may toggle the heater between an on state and an off state. The power source may be a power store. For example, the power source may be a battery or rechargeable battery (e.g., a lithium ion battery).

The device may comprise an input connection (e.g., a USB port, Micro USB port, USB-C port, etc.). The input connection may be configured for connection to an external source of electrical power, such as a mains electrical supply outlet. The input connection may, in some cases, be used as a substitute for an internal power source (e.g., battery or rechargeable battery). That is, the input connection may be electrically connectable to the heater (for providing power to the heater). Hence, in some forms, the input connection may form at least part of the power source of the device.

Where the power source comprises a rechargeable power source (such as a rechargeable battery), the input connection may be used to charge and recharge the power source.

The device may comprise a user interface (UI). In some embodiments the UI may include input means to receive operative commands from the user. The input means of the UI may allow the user to control at least one aspect of the operation of the device. In some embodiments the input means may comprise a power button to switch the device between an on state and an off state.

In some embodiments the UI may additionally or alternatively comprise output means to convey information to the user. In some embodiments the output means may comprise a light to indicate a condition of the device (and/or the aerosol-forming article) to the user. The condition of the device (and/or aerosol-forming article) indicated to the user may comprise a condition indicative of the operation of the heater. For example, the condition may comprise whether the heater is in an off state or an on state. In some embodiments, the UI unit may comprise at least one of a button, a display, a touchscreen, a switch, a light, and the like. For example, the output means may comprise one or more (e.g., two, three, four, etc.) light-emitting diodes ("LEDs") that may be located on the body of the device.

The device may further comprise a puff sensor (e.g., airflow sensor), which form part of the input means of the UI. The puff sensor may be configured to detect a user drawing on an end (i.e., a terminal (mouth) end) of the aerosol-forming article. The puff sensor may, for example, be a pressure sensor or a microphone. The puff sensor may be configured to produce a signal indicative of a puff state. The signal may be indicative of the user drawing (an aerosol from the aerosol-forming article) such that it is e.g., in the form of a binary signal. Alternatively or additionally, the signal may be indicative of a characteristic of the draw (e.g., a flow rate of the draw, length of time of the draw, etc).

The device may comprise a controller, or may be connectable to a controller that may be configured to control at least one function of the device. The controller may comprise a microcontroller that may e.g. be mounted on a printed circuit board (PCB). The controller may also comprise a memory, e.g., non-volatile memory. The memory may include instructions, which, when implemented, may cause the controller to perform certain tasks or steps of a method. Where the device comprises an input connection, the controller may be connected to the input connection.

The controller may be configured to control the operation of the heater (and e.g., the heating element). Thus, the controller may be configured to control vaporization of an aerosol forming part of an aerosol-forming article engaged with the device. The controller may be configured to control the voltage applied by power source to the heater. For example, the controller may be configured to toggle between applying a full output voltage (of the power source) to the heater and applying no voltage to the heater. Alternatively or additionally, the control unit may implement a more complex heater control protocol.

The device may further comprise a voltage regulator to regulate the output voltage supplied by the power source to form a regulated voltage. The regulated voltage may subsequently be applied to the heater.

In some embodiments, where the device comprises a UI, the controller may be operatively connected to one or more components of the UI. The controller may be configured to receive command signals from an input means of the UI. The controller may be configured to control the heater in response to the command signals. For example, the controller may be configured to receive "on" and "off" command signals from the UI and, in response, may control the heater so as to be in a corresponding on or off state.

The controller may be configured to send output signals to a component of the UI. The UI may be configured to convey information to a user, via an output means, in response to such output signals (received from the controller). For example, where the device comprises one or more LEDs, the LEDs may be operatively connected to the controller. Hence, the controller may be configured to control the illumination of the LEDs (e.g., in response to an output signal). For example, the controller may be configured to control the illumination of the LEDs according to (e.g., an on or off) state of the heater.

Where the device comprises a sensor (e.g., a puff/airflow sensor), the controller may be operatively connected to the sensor. The controller may be configured to receive a signal from the sensor (e.g., indicative of a condition of the device and/or engaged aerosol-forming article). The controller may be configured to control the heater, or an aspect of the output means, based on the signal from the sensor.

In some embodiments of the third mode, the sensor may be configured to detect state of device. The state of the device may indicate whether the heater is switched ON or switched OFF. In some embodiments, the controller may be configured to receive signal from such sensor and control operation of the device. The controller may therefore be able to operate the heater such that the heater is heated to a first predefined operating temperature when the device is switched ON and in an off-puff state (i.e., the user is not currently puffing on the consumable).

In some embodiments of the third mode, the controller may be configured to receive signal indicating user drawing in the heat-not-burn device. The controller may therefore be able to operate the heater such that the heater is heated to a second predefined operating temperature when a user puff is detected (i.e., during an on-puff period).

The device may comprise a wireless interface configured to communicate wirelessly (e.g., via Bluetooth (e.g., a Bluetooth low-energy connection) or WiFi) with an external device. This is an example of wireless communication module. Similarly, the input connection may be configured for wired connection to an external device so as to provide communication between the device and the external device.

The external device may be a mobile device. For example, the external device may be a smart phone, tablet, smart watch, or smart car. An application (e.g., app) may be installed on the external device (e.g., mobile device). The application may facilitate communication between the device and the external device via the wired or wireless connection. In some embodiment the external device may also be referred to a user device or compute device.

The wireless or wired interface may be configured to transfer signals between the external device and the controller of the device. In this respect, the controller may control an aspect of the device in response to a signal received from an external device. Alternatively or additionally, an external device may respond to a signal received from the device (e.g., from the controller of the device).

In some embodiments of the third mode, the controller may be operatively connected to a user device connected to the heat-not-burn device. The controller may therefore be able to communicate information associated with the operation of the heater to the user device.

According to a second aspect of the third mode there is provided a system (e.g., a smoking substitute system) comprising a device according to the first aspect and an aerosol-forming article. The aerosol-forming article may comprise an aerosol-forming substrate at an upstream end of the aerosol-forming article. The article may be in the form of a smoking substitute article, e.g., heated tobacco (HT) consumable (also known as a heat-not-burn (HNB) consumable).

As used herein, the terms "upstream" and "downstream" are intended to refer to the flow direction of the vapor/aerosol i.e., with the downstream end of the article/consumable being the mouth end or outlet where the aerosol exits the consumable for inhalation by the user. The upstream end of the article/consumable is the opposing end to the downstream end.

The aerosol-forming substrate is capable of being heated to release at least one volatile compound that can form an aerosol. The aerosol-forming substrate may be located at the upstream end of the article/consumable.

In order to generate an aerosol, the aerosol-forming substrate comprises at least one volatile compound that is intended to be vaporized/aerosolized and that may provide the user with a recreational and/or medicinal effect when inhaled. Suitable chemical and/or physiologically active volatile compounds include the group consisting of: nicotine, cocaine, caffeine, opiates and opioids, cathine and cathinone, kavalactones, mysticin, beta-carboline alkaloids, salvinorin A together with any combinations, functional equivalents to, and/or synthetic alternatives of the foregoing.

The aerosol-forming substrate may comprise plant material. The plant material may comprise least one plant material selected from the list including *Amaranthus dubius, Arctostaphylos uva-ursi* (Bearberry), *Argemone mexicana, Amica, Artemisia vulgaris*, Yellow Tees, *Galea zacatechichi, Canavalia maritima* (Baybean), *Cecropia mexicana* (Guamura), *Cestrum noctumum, Cynoglossum virginianum* (wild comfrey), *Cytisus scoparius, Damiana, Entada rheedii, Eschscholzia califomica* (California Poppy), *Fittonia albivenis, Hippobroma longiflora, Humulus japonica* (Japanese Hops), *Humulus lupulus* (Hops), *Lactuca virosa* (Lettuce Opium), *Laggera alata, Leonotis leonurus, Leonurus cardiaca* (Motherwort), *Leonurus sibiricus* (Honeyweed), *Lobelia cardinalis, Lobelia inflata* (Indian-tobacco), *Lobelia siphilitica, Nepeta cataria* (Catnip), *Nicotiana* species (Tobacco), *Nymphaea alba* (White Lily), *Nymphaea caerulea* (Blue Lily), Opium poppy, *Passiflora incamata* (Passionflower), *Pedicularis densiflora* (Indian Warrior), *Pedicularis groenlandica* (Elehant's Head), *Salvia divinorum, Salvia dorrii* (Tobacco Sage), Salvia species (Sage), *Scutellaria galericulata, Scutellaria lateriflora, Scutellaria nana, Scutellaria* species (Skullcap), *Sida acuta* (Wireweed), *Sida*

*rhombifolia, Silene capensis, Syzygium aromaticum* (Clove), *Tagetes lucida* (Mexican Tarragon), *Tarchonanthus camphoratus, Tumera diffusa* (Damiana), *Verbascum* (Mullein), *Zamia latifolia* (Maconha Brava) together with any combinations, functional equivalents to, and/or synthetic alternatives of the foregoing.

The plant material may be tobacco. Any type of tobacco may be used. This includes, but is not limited to, flue-cured tobacco, burley tobacco, Maryland Tobacco, dark-air cured tobacco, oriental tobacco, dark-fired tobacco, perique tobacco and rustica tobacco. This also includes blends of the above mentioned tobaccos.

The tobacco may comprise one or more of leaf tobacco, stem tobacco, tobacco powder, tobacco dust, tobacco derivatives, expanded tobacco, homogenized tobacco, shredded tobacco, extruded tobacco, cut rag tobacco and/or reconstituted tobacco (e.g., slurry recon or paper recon).

The aerosol-forming substrate may comprise a gathered sheet of homogenized (e.g., paper/slurryrecon) tobacco or gathered shreds/strips formed from such a sheet.

The aerosol-forming substrate may comprise one or more additives selected from humectants, flavorants, fillers, aqueous/non-aqueous solvents and binders.

The flavorant may be provided in solid or liquid form. It may include menthol, licorice, chocolate, fruit flavor (including e.g., citrus, cherry etc.), vanilla, spice (e.g., ginger, cinnamon) and tobacco flavor. The flavorant may be evenly dispersed throughout the aerosol-forming substrate or may be provided in isolated locations and/or varying concentrations throughout the aerosol-forming substrate.

The aerosol-forming substrate may be formed in a substantially cylindrical shape such that the article/consumable resembles a conventional cigarette. It may have a diameter of between 5 and 10 mm e.g., between 6 and 9 mm or 6 and 8 mm e.g., around 7 mm. It may have an axial length of between 10 and 15 mm e.g., between 11 and 14 mm such as around 12 or 13 mm.

The article/consumable may comprise at least one filter element. There may be a terminal filter element at the downstream/mouth end of the article/consumable.

The or at least one of the filter element(s) (e.g., the terminal filter element) may be comprised of cellulose acetate or polypropylene tow. The at least one filter element (e.g., the terminal filter element) may be comprised of activated charcoal. The at least one filter element (e.g., the terminal element) may be comprised of paper. The or each filter element may be at least partly (e.g., entirely) circumscribed with a plug wrap e.g., a paper plug wrap.

The terminal filter element (at the downstream end of the article/consumable) may be joined to the upstream elements forming the article/consumable by a circumscribing tipping layer e.g., a tipping paper layer. The tipping paper may have an axial length longer than the axial length of the terminal filter element such that the tipping paper completely circumscribes the terminal filter element plus the wrapping layer surrounding any adjacent upstream element.

In some embodiments, the article/consumable may comprise an aerosol-cooling element which is adapted to cool the aerosol generated from the aerosol-forming substrate (by heat exchange) before being inhaled by the user.

The article/consumable may comprise a spacer element that defines a space or cavity between the aerosol-forming substrate and the downstream end of the consumable. The spacer element may comprise a cardboard tube. The spacer element may be circumscribed by the (paper) wrapping layer.

According to a third aspect of the present disclosure, there is provided a method of using the system according to the second aspect, the method comprising engaging the aerosol-forming article with the heat-not-burn device; and heating the aerosol-forming article using the heater of the heat-not-burn device.

Optionally, the method further comprising inserting the aerosol-forming article into a cavity within a body of the heat-not-burn device and penetrating a portion of the aerosol-forming article with the heater upon insertion of the aerosol-forming article.

In some embodiments of the third mode the method may comprise inserting the article into a cavity within a body of the device and penetrating the article with the heater element of the device upon insertion of the article.

The third mode of the disclosure includes the combination of the aspects and preferred features described except where such a combination is clearly impermissible or expressly avoided.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

Fourth Mode of the Disclosure

At its most general, the present disclosure relates to a heater for heat not burn device. The heater includes a coating of silica on an external surface of the heater.

According to a first aspect of the present disclosure, there is provided a heater for a heat not burn device, comprising a rod portion with a heating track located thereon and a coating formed from silica. The coating forms an external surface of a portion of the heater for heating tobacco in a consumable for engagement with the device.

By providing a heater for a heat not burn device comprising a coating formed from silica, deposition of residues on the heater can be avoided or minimized. Reduction in deposition of residue may result in cleaner system requiring less downtime for cleaning, reduction in burnt odor from the device, thus improving overall user experience with the heat not burn device. Further, reduction in deposition of residues on the heater may also provide for improvement in performance and/or life of the heater by protecting the heating element.

Optional features will now be set out. These are applicable singly or in any combination with any aspect.

Optionally, the rod portion comprises a ceramic core.

Optionally, the ceramic core comprises $Al_2O_3$. The core may be formed predominantly or solely from $Al_2O_3$.

Optionally, the heating track extends along a longitudinal axis of the rod portion to form a heating portion of the heater.

Optionally, the rod portion includes a tapered distal tip.

Optionally, the tapered distal tip is conical.

Optionally, the tapered distal tip is attached to the rod portion.

Optionally, the coating covers at least the heating portion and the tapered distal tip.

Optionally, the heater includes a mount at a proximal end of the rod portion for attachment to the device.

Optionally the mount is formed on a portion of the coating.

Optionally, the thickness of the coating is greater than a maximum surface deviation of the rod.

Optionally, the thickness of the coating is greater than an arithmetic average roughness of the rod.

Optionally, the thickness of the coating is greater than a root mean square roughness of the rod.

Optionally, the rod includes a track layer on which the heating track is formed.

Optionally, the track layer includes a temperature measurement track.

Optionally, the coating has a thickness 5 to 25 micrometres, optionally 5 to 15 micrometres, optionally substantially 10 micrometres.

Optionally, the rod portion is dipped into the silica to form the coating.

Optionally, the coating is of uniform thickness over the cone and the rod.

In a second aspect, a heat not burn device comprising a heater as disclosed herein is provided.

The device may comprise an elongate body. An end of the elongate body may be configured for engagement with an aerosol-forming article. For example, the body may be configured for engagement with a heated tobacco (HT) consumable (or heat-not-burn (HNB) consumable). The terms "heated tobacco" and "heat-not-burn" are used interchangeably herein to describe a consumable that is of the type that is heated rather than combusted (or are used interchangeably to describe a device for use with such a consumable). The device may comprise a cavity that is configured for receipt of at least a portion of the consumable (i.e., for engagement with the consumable). The aerosol-forming article may be of the type that comprises an aerosol former (e.g., carried by an aerosol-forming substrate).

The device may comprise a heater for heating the aerosol-forming article. The heater may comprise a heating element, which may be in the form of a rod that extends from the body of the device. The heating element may extend from the end of the body that is configured for engagement with the aerosol-forming article.

The heater (and thus the heating element) may be rigidly mounted to the body. The heating element may be elongate so as to define a longitudinal axis and may, for example, have a transverse profile (i.e. transverse to a longitudinal axis of the heating element) that is substantially circular (i.e., the heating element may be generally cylindrical). Alternatively, the heating element may have a transverse profile that is rectangular (i.e., the heater may be a "blade heater"). The heating element may alternatively be in the shape of a tube (i.e., the heater may be a "tube heater"). The heating element may take other forms (e.g., the heating element may have an elliptical transverse profile). The shape and/or size (e.g., diameter) of the transverse profile of the heating element may be generally consistent for the entire length (or substantially the entire length) of the heating element.

The heating element may be between 15 mm and 25 mm long, e.g., between 18 mm and 20 mm long, e.g., around 19 mm long. The heating element may have a diameter of between 1.5 mm and 2.5 mm, e.g., a diameter between 2 mm and 2.3 mm, e.g., a diameter of around 2.15 mm.

The heating element may be formed of ceramic. The heating element may comprise a core (e.g., a ceramic core) comprising Al2O3. The core of the heating element may have a diameter of 1.8 mm to 2.1 mm, e.g., between 1.9 mm and 2 mm. The heating element may comprise an outer layer (e.g., an outer ceramic layer) comprising Al2O3. The thickness of the outer layer may be between 160 μm and 220 μm, e.g., between 170 μm and 190 μm, e.g., around 180 μm. The heating element may comprise a heating track, which may extend longitudinally along the heating element to form a heating portion of the heater. The heating track may be sandwiched between the outer layer and the core of the heating element. The heating track may comprise tungsten and/or rhenium. The heating track may have a thickness of around 20 μm. The heating track may provide for a uniform heating across the length of the heating element. Further, the heating element may include a track layer on which the heating track is formed. The track layer may be configured to detect and/or monitor various parameters related to the heating element or its environment. In an embodiment, the track layer may be a temperature measurement track. The temperature measurement track may facilitate detecting and monitoring of temperature at different lengths of the heating track.

The heating element may be located in the cavity (of the device), and may extend (e.g., along a longitudinal axis) from an internal base of the cavity towards an opening of the cavity. The length of the heating element (i.e., along the longitudinal axis of the heater) may be less than the depth of the cavity. Hence, the heating element may extend for only a portion of the length of the cavity. That is, the heating element may not extend through (or beyond) the opening of the cavity.

The heating element may be configured for insertion into an aerosol-forming article (e.g., a HT consumable) when an aerosol-forming article is received in the cavity. In that respect, a distal end (i.e., distal from a base of the heating element where it is mounted to the device) of the heating element may comprise a tapered portion, which may facilitate insertion of the heating element into the aerosol-forming article. The heating element may fully penetrate an aerosol-forming article when the aerosol-forming article is received in the cavity. That is, the entire length, or substantially the entire length, of the heating element may be received in the aerosol-forming article.

The heating element may have a length that is less than, or substantially the same as, an axial length of an aerosol-forming substrate forming part of an aerosol-forming article (e.g., a HT consumable).

Thus, when such an aerosol-forming article is engaged with the device, the heating element may only penetrate the aerosol-forming substrate, rather than other components of the aerosol-forming article. The heating element may penetrate the aerosol-forming substrate for substantially the entire axial length of the aerosol forming-substrate of the aerosol-forming article. Thus, heat may be transferred from (e.g., an outer circumferential surface of) the heating element to the surrounding aerosol-forming substrate, when penetrated by the heating element. That is, heat may be transferred radially outwardly (in the case of a cylindrical heating element) or e.g., radially inwardly (in the case of a tube heater).

Where the heater is a tube heater, the heating element of the tube heater may surround at least a portion of the cavity. When the portion of the aerosol-forming article is received in the cavity, the heating element may surround a portion of the aerosol-forming article (i.e., so as to heat that portion of the aerosol-forming article). In particular, the heating element may surround an aerosol forming substrate of the aerosol-forming article. That is, when an aerosol-forming article is engaged with the device, the aerosol forming substrate of the aerosol-forming article may be located adjacent an inner surface of the (tubular) heating element. When the heating element is activated, heat may be transferred radially inwardly from the inner surface of the heating element to heat the aerosol forming substrate.

The cavity may comprise a (e.g., circumferential) wall (or walls) and the (tubular) heating element may extend around at least a portion of the wall(s). In this way, the wall may be located between the inner surface of the heating element and an outer surface of the aerosol-forming article. The wall (or walls) of the cavity may be formed from a thermally conductive material (e.g., a metal) to allow heat conduction from the heating element to the aerosol-forming article. Thus, heat may be conducted from the heating element, through the cavity wall (or walls), to the aerosol-forming substrate of an aerosol-forming article received in the cavity.

The heater may further include a mount at a proximal end of the heating element. The mount may facilitate mounting of the heating element in the device. The mount may be formed on a portion of the coating. The mount may be configured for fitting in the body of the device. The mount may provide for a greater surface area for engagement of the heater with the body of the device to ensure firm fitting of the heater in the body. The mount may be formed of any suitable material, e.g., zirconia.

The heater has a coating formed of silica. The coating may form an outer surface of at least a portion of the heater. The coating of silica may provide for a non-stick outer surface of the heater. The coating may prevent or minimize residue deposition on the outer surface. The coating may be formed by a dipping process. For example, the coating may be formed by low temperature dipping process. The coating may form a glaze layer on the outer layer of the heater. A portion of the rod of the heating element may be dipped into silica to form the coating.

The coating may cover at least a portion of the rod of the heating element. The rod may have a tapered distal tip. The tapered distal tip may facilitate penetration of the aerosol forming substrate by the heater. The tapered distal tip may be conical in shape and/or may be attached with the heating element. The tip of the conical tapered distal tip may be inserted in the aerosol forming substrate by pushing the aerosol forming substrate over the tip of the heater. The conical tip may guide the heater inside the substrate while the heater is being inserted in the aerosol forming substrate. The tapered distal tip may be formed of any suitable material, e.g., zirconia. In addition to the portion of the rod, the coating may also cover the tapered distal tip of the rod. The tapered distal tip may be attached to the distal end of the rod of the heating element as shown in FIG. 3. In an embodiment, the tapered distal tip may be formed integrally with the rod. The coating may cover at least the heating portion and the tapered distal tip. The coating on the heating portion of the rod and on the tapered distal tip may protect at least the portion of the heating element that contacts the aerosol forming substrate and prevent deposition of residues on the heating element. In an embodiment, the mount may be formed on a portion of the coating.

The coating may have thickness of 5-30 μm. In an embodiment, the thickness of the coating may be 5-15 μm. In an embodiment, the thickness of the coating may be substantially 10 μm. The word 'substantially' herein is used to include variation of 10-25% of in the value as indicated. In an embodiment, the thickness of the coating may be greater than a maximum surface deviation of the rod. Having thickness of the coating greater than the maximum surface deviation may ensure that the heating element is covered with coating entirely and no surface of heating element is left exposed. In an embodiment, the thickness of the coating may be greater than an arithmetic average roughness of the rod. Yet in an embodiment, the thickness of the coating may be greater than a root mean square roughness of the rod. Having thickness of the coating greater than the average roughness or root mean square of roughness may ensure that the coating has adequate thickness to entirely cover surface of heating element. In both cases, the coating may smoothen out irregularities of the surface structure, so to obtain a substantially smooth and uniform or evenly shaped surface. Such a smoothened surface reduces building up of residue or debris on the surface from tobacco material and enables an easier insertion and removal operation of a consumable, which the heating element has to penetrate.

In some embodiments the device may comprise a cap disposed at the end of the body that is configured for engagement with an aerosol-forming article. Where the device comprises a heater having a heating element, the cap may at least partially enclose the heating element. The cap may be moveable between an open position in which access is provided to the heating element, and a closed position in which the cap at least partially encloses the heating element. The cap may be slideably engaged with the body of the device, and may be slideable between the open and closed positions.

The cap may define at least a portion of the cavity of the device. That is, the cavity may be fully defined by the cap, or each of the cap and body may define a portion of the cavity. Where the cap fully defines the cavity, the cap may comprise an aperture for receipt of the heating element into the cavity (when the cap is in the closed position). The cap may comprise an opening to the cavity. The opening may be configured for receipt of at least a portion of an aerosol-forming article. That is, an aerosol-forming article may be inserted through the opening and into the cavity (so as to be engaged with the device).

The cap may be configured such that when an aerosol-forming article is engaged with the device (e.g., received in the cavity), only a portion of the aerosol-forming article is received in the cavity. That is, a portion of the aerosol-forming article (not received in the cavity) may protrude from (i.e., extend beyond) the opening. This (protruding) portion of the aerosol-forming article may be a terminal (e.g., mouth) end of the aerosol-forming article, which may be received in a user's mouth for the purpose of inhaling aerosol formed by the device.

The device may comprise a power source or may be connectable to a power source (e.g., a power source separate to the device). The power source may be electrically connectable to the heater. In that respect, altering (e.g., toggling) the electrical connection of the power source to the heater may affect a state of the heater. For example, toggling the electrical connection of the power source to the heater may toggle the heater between an on state and an off state. The power source may be a power store. For example, the power source may be a battery or rechargeable battery (e.g., a lithium ion battery).

The device may comprise an input connection (e.g., a USB port, Micro USB port, USB-C port, etc.). The input connection may be configured for connection to an external source of electrical power, such as a mains electrical supply outlet. The input connection may, in some cases, be used as a substitute for an internal power source (e.g., battery or rechargeable battery). That is, the input connection may be electrically connectable to the heater (for providing power to the heater). Hence, in some forms, the input connection may form at least part of the power source of the device.

Where the power source comprises a rechargeable power source (such as a rechargeable battery), the input connection may be used to charge and recharge the power source.

The device may comprise a user interface (UI). In some embodiments the UI may include input means to receive operative commands from the user. The input means of the UI may allow the user to control at least one aspect of the operation of the device. In some embodiments the input means may comprise a power button to switch the device between an on state and an off state.

In some embodiments the UI may additionally or alternatively comprise output means to convey information to the user. In some embodiments the output means may comprise a light to indicate a condition of the device (and/or the aerosol-forming article) to the user. The condition of the device (and/or aerosol-forming article) indicated to the user may comprise a condition indicative of the operation of the heater. For example, the condition may comprise whether the heater is in an off state or an on state. In some embodiments, the UI unit may comprise at least one of a button, a display, a touchscreen, a switch, a light, and the like. For example, the output means may comprise one or more (e.g., two, three, four, etc.) light-emitting diodes ("LEDs") that may be located on the body of the device.

The device may further comprise a puff sensor (e.g., airflow sensor), which form part of the input means of the UI. The puff sensor may be configured to detect a user drawing on an end (i.e., a terminal (mouth) end) of the aerosol-forming article. The puff sensor may, for example, be a pressure sensor or a microphone. The puff sensor may be configured to produce a signal indicative of a puff state. The signal may be indicative of the user drawing (an aerosol from the aerosol-forming article) such that it is e.g., in the form of a binary signal. Alternatively or additionally, the signal may be indicative of a characteristic of the draw (e.g., a flow rate of the draw, length of time of the draw, etc).

The device may comprise a controller, or may be connectable to a controller that may be configured to control at least one function of the device. The controller may comprise a microcontroller that may e.g., be mounted on a printed circuit board (PCB). The controller may also comprise a memory, e.g., non-volatile memory. The memory may include instructions, which, when implemented, may cause the controller to perform certain tasks or steps of a method. Where the device comprises an input connection, the controller may be connected to the input connection.

The controller may be configured to control the operation of the heater (and e.g., the heating element). Thus, the controller may be configured to control vaporization of an aerosol forming part of an aerosol-forming article engaged with the device. The controller may be configured to control the voltage applied by power source to the heater. For example, the controller may be configured to toggle between applying a full output voltage (of the power source) to the heater and applying no voltage to the heater. Alternatively or additionally, the control unit may implement a more complex heater control protocol.

The device may further comprise a voltage regulator to regulate the output voltage supplied by the power source to form a regulated voltage. The regulated voltage may subsequently be applied to the heater.

In some embodiments, where the device comprises a UI, the controller may be operatively connected to one or more components of the UI. The controller may be configured to receive command signals from an input means of the UI. The controller may be configured to control the heater in response to the command signals. For example, the controller may be configured to receive "on" and "off" command signals from the UI and, in response, may control the heater so as to be in a corresponding on or off state.

The controller may be configured to send output signals to a component of the UI. The UI may be configured to convey information to a user, via an output means, in response to such output signals (received from the controller). For example, where the device comprises one or more LEDs, the LEDs may be operatively connected to the controller. Hence, the controller may configured to control the illumination of the LEDs (e.g., in response to an output signal). For example, the controller may be configured to control the illumination of the LEDs according to (e.g., an on or off) state of the heater.

Where the device comprises a sensor (e.g., a puff/airflow sensor), the controller may be operatively connected to the sensor. The controller may be configured to receive a signal from the sensor (e.g., indicative of a condition of the device and/or engaged aerosol-forming article). The controller may be configured to control the heater, or an aspect of the output means, based on the signal from the sensor.

The device may comprise a wireless interface configured to communicate wirelessly (e.g., via Bluetooth (e.g., a Bluetooth low-energy connection) or WiFi) with an external device. Similarly, the input connection may be configured for wired connection to an external device so as to provide communication between the device and the external device.

The external device may be a mobile device. For example, the external device may be a smart phone, tablet, smart watch, or smart car. An application (e.g., app) may be installed on the external device (e.g., mobile device). The application may facilitate communication between the device and the external device via the wired or wireless connection.

The wireless or wired interface may be configured to transfer signals between the external device and the controller of the device. In this respect, the controller may control an aspect of the device in response to a signal received from an external device. Alternatively or additionally, an external device may respond to a signal received from the device (e.g., from the controller of the device).

In an aspect, there is provided a system (e.g., a smoking substitute system) comprising a device according to the second aspect and an aerosol-forming article. The aerosol-forming article may comprise an aerosol-forming substrate at an upstream end of the aerosol-forming article. The article may be in the form of a smoking substitute article, e.g., heated tobacco (HT) consumable (also known as a heat-not-burn (HNB) consumable).

As used herein, the terms "upstream" and "downstream" are intended to refer to the flow direction of the vapor/aerosol i.e., with the downstream end of the article/consumable being the mouth end or outlet where the aerosol exits the consumable for inhalation by the user. The upstream end of the article/consumable is the opposing end to the downstream end.

The aerosol-forming substrate is capable of being heated to release at least one volatile compound that can form an aerosol. The aerosol-forming substrate may be located at the upstream end of the article/consumable.

In order to generate an aerosol, the aerosol-forming substrate comprises at least one volatile compound that is intended to be vaporized/aerosolized and that may provide the user with a recreational and/or medicinal effect when inhaled. Suitable chemical and/or physiologically active volatile compounds include the group consisting of: nicotine, cocaine, caffeine, opiates and opioids, cathine and cathinone, kavalactones, mysticin, beta-carboline alkaloids, salvinorin A together with any combinations, functional equivalents to, and/or synthetic alternatives of the foregoing.

The aerosol-forming substrate may comprise plant material. The plant material may comprise least one plant material selected from the list including *Amaranthus dubius, Arctostaphylos uva-ursi* (Bearberry), *Argemone mexicana,*

*Amica, Artemisia vulgaris*, Yellow Tees, *Galea zacatechichi, Canavalia maritima* (Baybean), *Cecropia mexicana* (Guamura), *Cestrum noctumum, Cynoglossum virginianum* (wild comfrey), *Cytisus scoparius, Damiana, Entada rheedii, Eschscholzia califomica* (California Poppy), *Fittonia albivenis, Hippobroma longiflora, Humulus japonica* (Japanese Hops), *Humulus lupulus* (Hops), *Lactuca virosa* (Lettuce Opium), *Laggera alata, Leonotis leonurus, Leonurus cardiaca* (Motherwort), *Leonurus sibiricus* (Honeyweed), *Lobelia cardinalis, Lobelia inflata* (Indian-tobacco), *Lobelia siphilitica, Nepeta cataria* (Catnip), *Nicotiana* species (Tobacco), *Nymphaea alba* (White Lily), *Nymphaea caerulea* (Blue Lily), Opium poppy, *Passiflora incamata* (Passionflower), *Pedicularis densiflora* (Indian Warrior), *Pedicularis groenlandica* (Elephant's Head), *Salvia divinorum, Salvia dorrii* (Tobacco Sage), Salvia species (Sage), *Scutellaria galericulata, Scutellaria lateriflora, Scutellaria nana, Scutellaria* species (Skullcap), *Sida acuta* (Wireweed), *Sida rhombifolia, Silene capensis, Syzygium aromaticum* (Clove), *Tagetes lucida* (Mexican Tarragon), *Tarchonanthus camphoratus, Tumera diffusa* (Damiana), *Verbascum* (Mullein), *Zamia latifolia* (Maconha Brava) together with any combinations, functional equivalents to, and/or synthetic alternatives of the foregoing.

The plant material may be tobacco. Any type of tobacco may be used. This includes, but is not limited to, flue-cured tobacco, burley tobacco, Maryland Tobacco, dark-air cured tobacco, oriental tobacco, dark-fired tobacco, perique tobacco and rustica tobacco. This also includes blends of the above mentioned tobaccos.

The tobacco may comprise one or more of leaf tobacco, stem tobacco, tobacco powder, tobacco dust, tobacco derivatives, expanded tobacco, homogenized tobacco, shredded tobacco, extruded tobacco, cut rag tobacco and/or reconstituted tobacco (e.g., slurry recon or paper recon).

The aerosol-forming substrate may comprise a gathered sheet of homogenized (e.g., paper/slurry recon) tobacco or gathered shreds/strips formed from such a sheet.

The aerosol-forming substrate may comprise one or more additives selected from humectants, flavorants, fillers, aqueous/non-aqueous solvents and binders.

The flavorant may be provided in solid or liquid form. It may include menthol, licorice, chocolate, fruit flavor (including e.g., citrus, cherry etc.), vanilla, spice (e.g., ginger, cinnamon) and tobacco flavor. The flavorant may be evenly dispersed throughout the aerosol-forming substrate or may be provided in isolated locations and/or varying concentrations throughout the aerosol-forming substrate.

The aerosol-forming substrate may be formed in a substantially cylindrical shape such that the article/consumable resembles a conventional cigarette. It may have a diameter of between 5 and 10 mm e.g., between 6 and 9 mm or 6 and 8 mm e.g., around 7 mm. It may have an axial length of between 10 and 15 mm e.g., between 11 and 14 mm such as around 12 or 13 mm.

The article/consumable may comprise at least one filter element. There may be a terminal filter element at the downstream/mouth end of the article/consumable.

The or at least one of the filter element(s) (e.g., the terminal filter element) may be comprised of cellulose acetate or polypropylene tow. The at least one filter element (e.g., the terminal filter element) may be comprised of activated charcoal. The at least one filter element (e.g., the terminal element) may be comprised of paper. The or each filter element may be at least partly (e.g., entirely) circumscribed with a plug wrap e.g., a paper plug wrap.

The terminal filter element (at the downstream end of the article/consumable) may be joined to the upstream elements forming the article/consumable by a circumscribing tipping layer e.g., a tipping paper layer. The tipping paper may have an axial length longer than the axial length of the terminal filter element such that the tipping paper completely circumscribes the terminal filter element plus the wrapping layer surrounding any adjacent upstream element.

In some embodiments, the article/consumable may comprise an aerosol-cooling element which is adapted to cool the aerosol generated from the aerosol-forming substrate (by heat exchange) before being inhaled by the user.

The article/consumable may comprise a spacer element that defines a space or cavity between the aerosol-forming substrate and the downstream end of the consumable. The spacer element may comprise a cardboard tube. The spacer element may be circumscribed by the (paper) wrapping layer.

According to a third aspect of the present disclosure, there is provided a method of using the system according to the second aspect, the method comprising inserting the aerosol-forming article into the device; and heating the article using the heater of the device.

In some embodiments the method may comprise inserting the article into a cavity within a body of the device and penetrating the article with the heating element of the device upon insertion of the article.

The disclosure includes the combination of the aspects and preferred features described except where such a combination is clearly impermissible or expressly avoided.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

Fifth Mode of the Disclosure: A Heat Not Burn Device and Method of Controlling Operation of a Heat Not Burn Device Based on Ambient Temperature At its most general, the fifth mode of the present disclosure relates to a heat not burn device and method of controlling operation of a heat not burn device based on ambient temperature.

According to a first aspect of the fifth mode of the present disclosure, a heat not burn device comprising: a heater for heating an aerosol forming substrate; an ambient temperature sensor for making an ambient temperature measurement for the device; and a controller configured to operate the heater in at least two operating modes, wherein the controller is configured to disable at least one of the at least two operating modes based upon at least the ambient temperature measurement.

Optional features of the fifth mode will now be set out. These are applicable singly or in any combination with any aspect.

Optionally, the at least two operating modes include a high temperature operating mode and a low temperature operating mode, wherein the heater is maintained at a higher temperature in the high temperature operating mode and a lower temperature in the low temperature operating mode.

Optionally, the controller is configured to allow the user to select from the high and low temperature operating modes.

Optionally, if the ambient temperature measurement is higher than or equal to a predetermined mid-temp maximum operating ambient temperature, the high temperature operating mode is disabled for use.

Optionally, wherein if the ambient temperature measurement is higher than or equal to a pre-determined high-temp maximum operating ambient temperature, the high temperature operating temperature mode and low temperature operating temperature mode are both disabled.

Optionally, the heater includes the ambient temperature sensor.

Optionally, the controller is configured to make the ambient temperature measurement when no power is being supplied to the heater.

Optionally, the controller is configured to wait for a predetermined cool-down period after power was last supplied to the heater before making the ambient temperature measurement.

Optionally, the predetermined cool down period is greater than one minute; optionally, greater than 2 minutes, optionally greater than three minutes.

Optionally, the ambient temperature sensor is an ambient temperature sensor within the controller.

Optionally, the device further comprises a rechargeable power supply for suppling power to the heater.

According to a second aspect, there is provided a heat not burn device comprising: an ambient temperature sensor for making an ambient temperature measurement for the device; a heater for heating an aerosol forming substrate; and a controller configured to control an amount of power supplied to the heater, wherein an amount of power supplied to the heater is based upon at least the ambient temperature measurement.

Optionally, the device further comprises a heater temperature sensor configured to measure the present temperature of the heater.

Optionally, the controller is configured to control power supplied to the heater to regulate the temperature of the heater, wherein the amount of power supplied to the heater is based on a comparison of the ambient temperature measurement and the present temperature of the heater. Optionally, the power supplied to the heater is pulse width modulated.

Optionally, the ambient temperature sensor is an ambient temperature sensor within the controller.

According to a third aspect of the present disclosure, there is provided a heat-not-burn (HNB) device comprising: a heater configured to operate at a first temperature in a first heating mode and a second temperature in a second heating mode, the second temperature is higher than the first temperature; and a sensor configured to measure an ambient temperature; wherein the heat-not-burn device is configured to disable the second heating mode when the measured ambient temperature exceeds a predetermined threshold.

The first heating mode may be defined as a normal operating mode, e.g., the heater may operate at the first temperature which is a typical operating temperature. The first heating mode may be an operating mode where the consumable is heated at a standard operating temperature. The second heating mode may be defined as a boost operating mode, e.g., the heater may operate at the second temperature which is higher than the first temperature. When operating in the second heating mode, the consumable may be able to reach the desired temperature quickly and/or being heated at a higher temperature and thereby increases the rate of aerosol generation.

The first temperature may range from 300° C. to 330° C., preferably the first temperature may range from 305° C. to 325° C., and may be 315° C. The second temperature may range from 330° C. to 360° C., preferably the second temperature may range from 335° C. to 355° C., and may be 345° C.

The predetermined threshold may be at least 40° C., e.g., when a monoacetate filter is used in the aerosol-forming article. Alternatively, the predetermined threshold may range from 35° C.-40° C., e.g., when a hollow bore is used instead of the monoacetate filter in the aerosol-forming article.

However, during warmer seasons or at locations with tropical climate, the ambient temperature may be so high that when the heater operates at the second temperature it may overheat the consumable, e.g., it may unfavourably causes the consumable to generate too much aerosol or to produce undesired volatiles. Therefore advantageously, by disabling the second operating mode once the ambient temperature exceeds a predetermined threshold or predetermined threshold temperature, the device may be prevented from generating undesired volatiles. Additionally, the risk of overheating at the heater may be greatly reduced.

Optionally, the device may comprise a controller electrically connected with the heater and the sensor, the controller is configured to receive the measured ambient temperature from the sensor and to disable the second heating mode upon determining that said measured ambient temperature exceeds the pre-determined threshold. The sensor may be configured to continuously measure the ambient temperature and therefrom feeds the measured ambient temperature to the controller. Therefrom the controller may be configured to compare said measured ambient temperature with a predetermined threshold temperature in a device storage. If the measured ambient temperature is determined to have exceeded the pre-determined threshold the controller may disable the second heating mode. Thus, the controller may be configured to intelligently control the heating of the consumable based on ambient temperature.

Optionally, the controller may be configured to disable the second heating mode by switching the operation of the heater from the second heating mode to the first heating mode. That is, the heater is not switched off but instead it operates at a lowered temperature. This may ensure the device continuously to generate aerosol.

Alternatively, the controller may be configured to disable the second heating mode by disabling the heater altogether. That is, the controller may cease energising the heater so as to allow the heater and/or consumable to cool down. The heater may resume operating in a first operating mode once the device receives a user input, e.g., to switch on the device, or after a predetermined period of time, e.g., 30 seconds.

Optionally, the device further comprises an output means configured to output one or more of a haptic feedback, an audio feedback and a visual feedback upon disabling of the second heating mode. For example, the output means may be a haptic device for providing said haptic feedback. The output means may be a buzzer or a speaker for providing audio feedback. The output means may be an LED, an array of LED, or any other visual indicators known to the person skilled in the art. Upon disabling the second heating mode, the controller may activate the output means for outputting one or more of the haptic feedback, the audio feedback and the visual feedback. In some embodiment, the output means may be used to indicate the user that the ambient temperature of the device is too high and thus second heating mode has been disabled. In this way, a versatile device is provided which is able to inform the user of second heating mode disabled.

Optionally, further comprises a user interface, wherein upon receiving a user input at the user interface the heater is configured to switch between operating in the second heating mode and the first heating mode. This may advantageously allow the user to manually specify the desired operating temperature. For example, the controller may be configured to receive the user input, via the user interface, to switch to the second heating mode from the first heating mode. The controller may further generate a feedback, via the output means, indicating the user that the second heating mode is not enabled if the controller detected that the ambient temperature exceeds the predetermined threshold.

Optionally, the heater is prevented from switching from operating in the first operating mode to the second operating mode if the measured ambient temperature exceeds the predetermined threshold. Optionally, the device is configured to, via an output means, output one or more of a haptic feedback, an audio feedback and a visual feedback when the heater is prevented from switching from operating in the first operating mode to the second operating mode. That is when the measured ambient temperature exceeds the predetermined threshold, the controller prevents the user from manually switching to second operating mode, and thereby informs the user.

The device may comprise an elongate body. An end of the elongate body may be configured for engagement with an aerosol-forming article. For example, the body may be configured for engagement with a heated tobacco (HT) consumable (or heat-not-burn (HNB) consumable). The terms "heated tobacco" and "heat-not-burn" are used interchangeably herein to describe a consumable that is of the type that is heated rather than combusted (or are used interchangeably to describe a device for use with such a consumable). The device may comprise a cavity that is configured for receipt of at least a portion of the consumable (i.e., for engagement with the consumable). The aerosol-forming article may be of the type that comprises an aerosol former (e.g., carried by an aerosol-forming substrate).

The device may comprise a heater for heating the aerosol-forming article. The heater may comprise a heating element, which may be in the form of a rod that extends from the body of the device. The heating element may extend from the end of the body that is configured for engagement with the aerosol-forming article. In an embodiment, the heater is configured to operate in dual heating mode. Precisely, the heater is configured to operate at a first temperature in a first heating mode and at a second temperature in the second heating mode, wherein the second temperature being higher than the first temperature.

The heater (and thus the heating element) may be rigidly mounted to the body. The heating element may be elongate so as to define a longitudinal axis and may, for example, have a transverse profile (i.e. transverse to a longitudinal axis of the heating element) that is substantially circular (i.e., the heating element may be generally cylindrical). Alternatively, the heating element may have a transverse profile that is rectangular (i.e., the heater may be a "blade heater"). The heating element may alternatively be in the shape of a tube (i.e., the heater may be a "tube heater"). The heating element may take other forms (e.g., the heating element may have an elliptical transverse profile). The shape and/or size (e.g., diameter) of the transverse profile of the heating element may be generally consistent for the entire length (or substantially the entire length) of the heating element.

The heating element may be between 15 mm and 25 mm long, e.g., between 18 mm and 20 mm long, e.g., around 19 mm long. The heating element may have a diameter of between 1.5 mm and 2.5 mm, e.g., a diameter between 2 mm and 2.3 mm, e.g., a diameter of around 2.15 mm.

The heating element may be formed of ceramic. The heating element may comprise a core (e.g., a ceramic core) comprising $Al_2O_3$. The core of the heating element may have a diameter of 1.8 mm to 2.1 mm, e.g., between 1.9 mm and 2 mm. The heating element may comprise an outer layer (e.g., an outer ceramic layer) comprising $Al_2O_3$. The thickness of the outer layer may be between 160 μm and 220 μm, e.g., between 170 μm and 190 μm, e.g., around 180 μm. The heating element may comprise a heating track, which may extend longitudinally along the heating element. The heating track may be sandwiched between the outer layer and the core of the heating element. The heating track may comprise tungsten and/or rhenium. The heating track may have a thickness of around 20 μm.

The heating element may be located in the cavity (of the device), and may extend (e.g., along a longitudinal axis) from an internal base of the cavity towards an opening of the cavity. The length of the heating element (i.e., along the longitudinal axis of the heater) may be less than the depth of the cavity. Hence, the heating element may extend for only a portion of the length of the cavity. That is, the heating element may not extend through (or beyond) the opening of the cavity.

The heating element may be configured for insertion into an aerosol-forming article (e.g., a HT consumable) when an aerosol-forming article is received in the cavity. In that respect, a distal end (i.e., distal from a base of the heating element where it is mounted to the device) of the heating element may comprise a tapered portion, which may facilitate insertion of the heating element into the aerosol-forming article. The heating element may fully penetrate an aerosol-forming article when the aerosol-forming article is received in the cavity. That is, the entire length, or substantially the entire length, of the heating element may be received in the aerosol-forming article.

The heating element may have a length that is less than, or substantially the same as, an axial length of an aerosol-forming substrate forming part of an aerosol-forming article (e.g., a HT consumable). Thus, when such an aerosol-forming article is engaged with the device, the heating element may only penetrate the aerosol-forming substrate, rather than other components of the aerosol-forming article. The heating element may penetrate the aerosol-forming substrate for substantially the entire axial length of the aerosol forming-substrate of the aerosol-forming article. Thus, heat may be transferred from (e.g., an outer circumferential surface of) the heating element to the surrounding aerosol-forming substrate, when penetrated by the heating element. That is, heat may be transferred radially outwardly (in the case of a cylindrical heating element) or e.g., radially inwardly (in the case of a tube heater).

Where the heater is a tube heater, the heating element of the tube heater may surround at least a portion of the cavity. When the portion of the aerosol-forming article is received in the cavity, the heating element may surround a portion of the aerosol-forming article (i.e., so as to heat that portion of the aerosol-forming article). In particular, the heating element may surround an aerosol forming substrate of the aerosol-forming article. That is, when an aerosol-forming article is engaged with the device, the aerosol forming substrate of the aerosol-forming article may be located adjacent an inner surface of the (tubular) heating element. When the heating element is activated, heat may be transferred radially inwardly from the inner surface of the heating element to heat the aerosol forming substrate.

The cavity may comprise a (e.g., circumferential) wall (or walls) and the (tubular) heating element may extend around at least a portion of the wall(s). In this way, the wall may be located between the inner surface of the heating element and an outer surface of the aerosol-forming article. The wall (or walls) of the cavity may be formed from a thermally conductive material (e.g., a metal) to allow heat conduction from the heating element to the aerosol-forming article. Thus, heat may be conducted from the heating element, through the cavity wall (or walls), to the aerosol-forming substrate of an aerosol-forming article received in the cavity.

The device may comprise one or more temperature sensors including an ambient temperature sensor and a heater temperature sensor. The ambient temperature sensor detects ambient temperature of the device and the heater temperature sensor measures the temperature of the heater, in particular the heater rod. The temperature sensors may be configured to generate respective signal indicative of ambient temperature or heater temperature. In another aspect, the ambient temperature sensor is also capable of measuring the temperature of the heater. Also, the heater temperature is also capable of measuring the temperature of the ambient air.

In some embodiments the device may comprise a cap disposed at the end of the body that is configured for engagement with an aerosol-forming article. Where the device comprises a heater having a heating element, the cap may at least partially enclose the heating element. The cap may be moveable between an open position in which access is provided to the heating element, and a closed position in which the cap at least partially encloses the heating element. The cap may be slideably engaged with the body of the device, and may be slideable between the open and closed positions.

The cap may define at least a portion of the cavity of the device. That is, the cavity may be fully defined by the cap, or each of the cap and body may define a portion of the cavity. Where the cap fully defines the cavity, the cap may comprise an aperture for receipt of the heating element into the cavity (when the cap is in the closed position). The cap may comprise an opening to the cavity. The opening may be configured for receipt of at least a portion of an aerosol-forming article. That is, an aerosol-forming article may be inserted through the opening and into the cavity (so as to be engaged with the device).

The cap may be configured such that when an aerosol-forming article is engaged with the device (e.g., received in the cavity), only a portion of the aerosol-forming article is received in the cavity. That is, a portion of the aerosol-forming article (not received in the cavity) may protrude from (i.e., extend beyond) the opening. This (protruding) portion of the aerosol-forming article may be a terminal (e.g., mouth) end of the aerosol-forming article, which may be received in a user's mouth for the purpose of inhaling aerosol formed by the device.

The device may comprise a power source or may be connectable to a power source (e.g., a power source separate to the device). The power source may be electrically connectable to the heater. In that respect, altering (e.g., toggling) the electrical connection of the power source to the heater may affect a state of the heater. For example, toggling the electrical connection of the power source to the heater may toggle the heater between an on state and an off state. The power source may be a power store. For example, the power source may be a battery or rechargeable battery (e.g., a lithium ion battery).

The device may comprise an input connection (e.g., a USB port, Micro USB port, USB-C port, etc.). The input connection may be configured for connection to an external source of electrical power, such as a mains electrical supply outlet. The input connection may, in some cases, be used as a substitute for an internal power source (e.g., battery or rechargeable battery). That is, the input connection may be electrically connectable to the heater (for providing power to the heater). Hence, in some forms, the input connection may form at least part of the power source of the device.

Where the power source comprises a rechargeable power source (such as a rechargeable battery), the input connection may be used to charge and recharge the power source.

The device may comprise a user interface (UI). In some embodiments the UI may include input means to receive operative commands from the user. The input means of the UI may allow the user to control at least one aspect of the operation of the device. In some embodiments the input means may comprise a power button to switch the device between an on state and an off state. In some embodiment, the input means of the UI may allow a user to switch the device between the first heating mode and the second heating mode.

In some embodiments the UI may additionally or alternatively comprise output means to convey information to the user. In some embodiments, the output means may be configured to indicate the user that the second heating mode is disabled if the ambient temperature is determined to have exceeded a predetermined threshold temperature. In some embodiments the output means may comprise a light to indicate a condition of the device (and/or the aerosol-forming article) to the user. The condition of the device (and/or aerosol-forming article) indicated to the user may comprise a condition indicative of the operation of the heater. For example, the condition may comprise whether the heater is in an off state or an on state. In some embodiments, the UI unit may comprise at least one of a button, a display, a touchscreen, a switch, a light, and the like. For example, the output means may comprise one or more (e.g., two, three, four, etc.) light-emitting diodes ("LEDs") that may be located on the body of the device.

The device may further comprise a puff sensor (e.g., airflow sensor), which form part of the input means of the UI. The puff sensor may be configured to detect a user drawing on an end (i.e., a terminal (mouth) end) of the aerosol-forming article. The puff sensor may, for example, be a pressure sensor or a microphone. The puff sensor may be configured to produce a signal indicative of a puff state. The signal may be indicative of the user drawing (an aerosol from the aerosol-forming article) such that it is e.g., in the form of a binary signal. Alternatively or additionally, the signal may be indicative of a characteristic of the draw (e.g., a flow rate of the draw, length of time of the draw, etc).

The device may comprise a controller, or may be connectable to a controller that may be configured to control at least one function of the device. The controller may comprise a microcontroller that may e.g., be mounted on a printed circuit board (PCB). The controller may also comprise a memory, e.g., non-volatile memory. The memory may include instructions, which, when implemented, may cause the controller to perform certain tasks or steps of a method. Where the device comprises an input connection, the controller may be connected to the input connection.

The controller may be configured to control the operation of the heater (and e.g., the heating element). The controller may be electrically connected to the heater and a sensor, and may be configured to control the operation of the heater (and e.g., the heating element) based on measurement of the sensor. In one example, the sensor is a temperature sensor to detect the ambient temperature of the device. In one aspect, the controller may be configured to receive the measured ambient temperature from the sensor and disable the second heating mode upon determining that the ambient temperature exceeds the predetermined threshold temperature. Thus, the controller may be configured to control vaporization of an aerosol forming part of an aerosol-forming article engaged with the device. The controller may be configured to control the voltage applied by power source to the heater. For example, the controller may be configured to toggle between applying a full output voltage (of the power source) to the heater and applying no voltage to the heater. Alternatively or additionally, the control unit may implement a more complex heater control protocol.

The device may further comprise a voltage regulator to regulate the output voltage supplied by the power source to form a regulated voltage. The regulated voltage may subsequently be applied to the heater. In some embodiments, the voltage regulator may be used to control the output voltage supplied to the heater to operate in one of the first heating mode and the second heating mode based on ambient temperature measurement.

In some embodiments, where the device comprises a UI, the controller may be operatively connected to one or more components of the UI. The controller may be configured to receive command signals from an input means of the UI. The controller may be configured to control the heater in response to the command signals. For example, the controller may be configured to receive "on" and "off" command signals from the UI and, in response, may control the heater so as to be in a corresponding on or off state. Further, the controller may be configured to receive a command for controlling the heater or the device to switch from the first heating mode to the second heating mode via user input means. In response, the controller may be configured to indicate, through the output means, that the second heating mode is disabled if the controller detects that the ambient temperature exceeds the predetermined threshold temperature.

The controller may be configured to send output signals to a component of the UI. The UI may be configured to convey information to a user, via an output means, in response to such output signals (received from the controller). For example, where the device comprises one or more LEDs, the LEDs may be operatively connected to the controller. Hence, the controller may configured to control the illumination of the LEDs (e.g., in response to an output signal). For example, the controller may be configured to control the illumination of the LEDs according to (e.g., an on or off) state of the heater. In another example, the controller may be configured to control the illumination of the LEDs indicating that the second heating mode is disabled. Further, the controller may be configured to indicate the user that the second heating mode disabled through other output means such as haptic sensor and audio sensor etc.

Where the device comprises sensor (e.g., a puff/airflow sensor/temperature sensors), the controller may be operatively connected to the sensor. The controller may be configured to receive a signal from the sensor (e.g., indicative of a condition of the device and/or engaged aerosol-forming article). The controller may be configured to control the heater, or an aspect of the output means, based on the signal from the sensor.

The device may comprise a wireless interface configured to communicate wirelessly (e.g., via Bluetooth (e.g., a Bluetooth low-energy connection) or Wi-Fi) with an external device. Similarly, the input connection may be configured for wired connection to an external device so as to provide communication between the device and the external device.

The external device may be a mobile device. For example, the external device may be a smart phone, tablet, smart watch, or smart car. An application (e.g., app) may be installed on the external device (e.g., mobile device). The application may facilitate communication between the device and the external device via the wired or wireless connection.

The wireless or wired interface may be configured to transfer signals between the external device and the controller of the device. In this respect, the controller may control an aspect of the device in response to a signal received from an external device. Alternatively or additionally, an external device may respond to a signal received from the device (e.g., from the controller of the device).

In a fourth aspect of the fifth mode, there is provided a system (e.g., a smoking substitute system) comprising a device according to the first aspect, the second aspect, or the third aspect, and an aerosol-forming article. The aerosol-forming article may comprise an aerosol-forming substrate at an upstream end of the aerosol-forming article. The article may be in the form of a smoking substitute article, e.g., heated tobacco (HT) consumable (also known as a heat-not-burn (HNB) consumable).

As used herein, the terms "upstream" and "downstream" are intended to refer to the flow direction of the vapor/aerosol i.e., with the downstream end of the article/consumable being the mouth end or outlet where the aerosol exits the consumable for inhalation by the user. The upstream end of the article/consumable is the opposing end to the downstream end.

The aerosol-forming substrate is capable of being heated to release at least one volatile compound that can form an aerosol. The aerosol-forming substrate may be located at the upstream end of the article/consumable.

In order to generate an aerosol, the aerosol-forming substrate comprises at least one volatile compound that is intended to be vaporized/aerosolized and that may provide the user with a recreational and/or medicinal effect when inhaled. Suitable chemical and/or physiologically active volatile compounds include the group consisting of: nicotine, cocaine, caffeine, opiates and opioids, cathine and cathinone, kavalactones, mysticin, beta-carboline alkaloids, salvinorin A together with any combinations, functional equivalents to, and/or synthetic alternatives of the foregoing.

The aerosol-forming substrate may comprise plant material. The plant material may comprise least one plant material selected from the list including *Amaranthus dubius, Arctostaphylos uva-ursi* (Bearberry), *Argemone mexicana, Amica, Artemisia vulgaris*, Yellow Tees, *Galea zacatechichi, Canavalia maritima* (Baybean), *Cecropia mexicana* (Guamura), *Cestrum noctumum, Cynoglossum virginianum* (wild comfrey), *Cytisus scoparius, Damiana, Entada rheedii, Eschscholzia califomica* (California Poppy), *Fittonia albivenis, Hippobroma longiflora, Humulus japonica* (Japanese Hops), *Humulus lupulus* (Hops), *Lactuca virosa* (Lettuce Opium), *Laggera alata, Leonotis leonurus, Leonurus cardiaca* (Motherwort), *Leonurus sibiricus* (Honeyweed), *Lobelia cardinalis, Lobelia inflata* (Indian-tobacco), *Lobelia siphilitica, Nepeta cataria* (Catnip), *Nicotiana* species (Tobacco), *Nymphaea alba* (White Lily), *Nymphaea caerulea* (Blue Lily), Opium poppy, *Passiflora incamata* (Passionflower), *Pedicularis densiflora* (Indian Warrior), *Pedicularis groenlandica* (Elephant's Head), *Salvia divinorum, Salvia dorrii* (Tobacco Sage), Salvia species (Sage), *Scutellaria*

*galericulata, Scutellaria lateriflora, Scutellaria nana, Scutellaria* species (Skullcap), *Sida acuta* (Wireweed), *Sida rhombifolia, Silene capensis, Syzygium aromaticum* (Clove), *Tagetes lucida* (Mexican Tarragon), *Tarchonanthus camphoratus, Tumera diffusa* (Damiana), *Verbascum* (Mullein), *Zamia latifolia* (Maconha Brava) together with any combinations, functional equivalents to, and/or synthetic alternatives of the foregoing.

The plant material may be tobacco. Any type of tobacco may be used. This includes, but is not limited to, flue-cured tobacco, burley tobacco, Maryland Tobacco, dark-air cured tobacco, oriental tobacco, dark-fired tobacco, perique tobacco and rustica tobacco. This also includes blends of the above mentioned tobaccos.

The tobacco may comprise one or more of leaf tobacco, stem tobacco, tobacco powder, tobacco dust, tobacco derivatives, expanded tobacco, homogenized tobacco, shredded tobacco, extruded tobacco, cut rag tobacco and/or reconstituted tobacco (e.g., slurry recon or paper recon).

The aerosol-forming substrate may comprise a gathered sheet of homogenized (e.g., paper/slurryrecon) tobacco or gathered shreds/strips formed from such a sheet.

The aerosol-forming substrate may comprise one or more additives selected from humectants, flavorants, fillers, aqueous/non-aqueous solvents and binders.

The flavorant may be provided in solid or liquid form. It may include menthol, licorice, chocolate, fruit flavor (including e.g., citrus, cherry etc.), vanilla, spice (e.g., ginger, cinnamon) and tobacco flavor. The flavorant may be evenly dispersed throughout the aerosol-forming substrate or may be provided in isolated locations and/or varying concentrations throughout the aerosol-forming substrate.

The aerosol-forming substrate may be formed in a substantially cylindrical shape such that the article/consumable resembles a conventional cigarette. It may have a diameter of between 5 and 10 mm e.g., between 6 and 9 mm or 6 and 8 mm e.g., around 7 mm. It may have an axial length of between 10 and 15 mm e.g., between 11 and 14 mm such as around 12 or 13 mm.

The article/consumable may comprise at least one filter element. There may be a terminal filter element at the downstream/mouth end of the article/consumable.

The or at least one of the filter element(s) (e.g., the terminal filter element) may be comprised of cellulose acetate or polypropylene tow. The at least one filter element (e.g., the terminal filter element) may be comprised of activated charcoal. The at least one filter element (e.g., the terminal element) may be comprised of paper. The or each filter element may be at least partly (e.g., entirely) circumscribed with a plug wrap e.g., a paper plug wrap.

The terminal filter element (at the downstream end of the article/consumable) may be joined to the upstream elements forming the article/consumable by a circumscribing tipping layer e.g., a tipping paper layer. The tipping paper may have an axial length longer than the axial length of the terminal filter element such that the tipping paper completely circumscribes the terminal filter element plus the wrapping layer surrounding any adjacent upstream element.

In some embodiments, the article/consumable may comprise an aerosol-cooling element which is adapted to cool the aerosol generated from the aerosol-forming substrate (by heat exchange) before being inhaled by the user.

The article/consumable may comprise a spacer element that defines a space or cavity between the aerosol-forming substrate and the downstream end of the consumable. The spacer element may comprise a cardboard tube. The spacer element may be circumscribed by the (paper) wrapping layer.

According to a fifth aspect of the fifth mode of the present disclosure, there is provided a method of using the system according to the fourth aspect, the method comprising inserting the aerosol-forming article into the device; and heating the article using the heater of the device.

In some embodiments the method may comprise inserting the article into a cavity within a body of the device and penetrating the article with the heating element of the device upon insertion of the article.

According to a sixth aspect of the fifth mode of the present disclosure, there is provided a method of operating a heat-not-burn device having a heater, said heater configured to operate at a first temperature in a first heating mode and a second temperature in a second heating mode, the second temperature being higher than the first temperature. The method further comprises sensing an ambient temperature and disabling the second heating mode when the measured ambient temperature exceeds a predetermined threshold.

Optionally, the method comprises receiving, by the controller, the ambient temperature from a sensor and disabling the second heating mode upon determining that the ambient temperature exceeds the predetermined threshold.

Advantageously, the method comprises disabling, by the controller, the second heating mode by switching the operation of the heater from the second heating mode to the first heating mode.

Conveniently, the first heating mode described in the method is a normal mode whereas, the second heating mode described in the method is a boost mode.

Advantageously, the method comprises generating, via output means, one of haptic, audio and visual feedback indicating a user that the controller has disabled the second heating mode.

Conveniently, the method comprises receiving user input, via a user input means, for switching to the second heating mode from the first heating mode, and generating a feedback, via the output means, indicating the user that the second heating mode is not enabled if the controller detected that the ambient temperature exceeds the predetermined threshold.

The fifth mode of the disclosure includes the combination of the aspects and preferred features described except where such a combination is clearly impermissible or expressly avoided.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

Sixth Mode of the Disclosure: Heat Not Burn System Including a Feature of Removably Engaging the Heater Apparatus With the Device At its most general, the sixth mode of the present disclosure relates to heat not burn system including a feature of removably engaging the heater apparatus with the device.

According to the sixth mode of the present disclosure, there is provided a heat not burn system. The heat not burn system may include a device, which may include a power source. Further, the device comprises a heater apparatus, which includes a heater. The heater apparatus may be configured to removably engage with the device so that power may be supplied from the power source to the heater.

By providing a device comprising a removably engaging heater apparatus, the device may facilitate an option for replacing the malfunctioning heater apparatus, thus eliminating the need of replacing the entire device.

Optional features will now be set out. These are applicable singly or in any combination with any aspect.

Optionally, the heater apparatus may include a pair of heater electrical contacts for engagement with a corresponding pair of heater device contacts in the device. This feature of providing heater electrical contacts, to contact with the heater device contacts, eliminates the requirement of using conductive wires to connect the heater apparatus with the heater device (i.e., power source). This enables disengagement of the heater apparatus from the device with ease.

Advantageously, the device and heater apparatus include a locking mechanism to removably retain the heater apparatus in engagement with the device. The locking mechanism may help in retaining the heater apparatus firmly within the device, when in use and also help in quick disengagement of the heater apparatus from the device for replacement.

Conveniently, the device may be configured to unlock the locking mechanism when the temperature of the heater apparatus is measured to be below a locking temperature threshold. This feature of unlocking the locking mechanism, below the locking temperature threshold, may prevent the user from contacting the heater apparatus in hot condition, and thus ensures safety of the user.

Conveniently, the device may be configured to unlock the locking mechanism when the pre-set cooling period is in the range of 20 to 100 seconds, preferably in the range of 45 to 90 seconds. The cooling period ensures that the heater is cooled sufficiently, to ensure additional safety for the user.

Conveniently, the locking temperature threshold may be 50 degree Celsius. This locking temperature ensures operational safety for the user, as the heater apparatus may not be disengaged unless the temperature of the heater apparatus reaches a temperature less than or equal to the locking temperature threshold.

Optionally, the heater apparatus contacts may be biased, and spring-loaded. This configuration of the heater apparatus contacts may maintain sufficient contact with the heater device contacts to receive the energy (i.e., voltage from the power source).

Optionally, the heater apparatus may include a temperature sensing component. The temperature sensing component may monitor the temperature of the heater apparatus, based on which the locking mechanism may be configured to unlock the heater apparatus from the device for disengagement.

Optionally, the heater apparatus may include a pair of temperature sensing contacts for engagement with a corresponding pair of temperature measurement device contacts in the device.

Optionally, the temperature measurement device contacts may be biased, and spring-loaded. The spring-loaded contacts may facilitate in solderless interconnections between the contacts, and also eliminate the use of conductive wires to connect the heater apparatus and the heater device.

Optionally, the device may be configured to determine when the heater apparatus is engaged with the device.

Optionally, the device may be configured to perform a calibration routine to calibrate the heater apparatus when the heater apparatus is brought into engagement with the device. Calibrating the heater apparatus may ensure accurate functioning according to preferred operational parameters of the heater apparatus.

Optionally, the calibration routine may include of making a measurement of ambient temperature using an ambient temperature sensor of the device, the ambient temperature sensor may be located within a microcontroller of the device.

Optionally, the calibration routine may further include of making a measurement of the resistance of the heating track and or the temperature sensing track. By providing a resistive heater track in the heating apparatus, it may be possible to achieve quick and efficient heating (i.e., heat dissipation) of the heating apparatus.

Conveniently, the heater apparatus may include an airflow channel to permit airflow to the heater in use. Air flow onto the heater apparatus may facilitate in improving aerosol formation and total particulate matter (TPM) output of the aerosol.

The device may comprise an elongate body. An end of the elongate body may be configured for engagement with an aerosol-forming article. For example, the body may be configured for engagement with a heated tobacco (HT) consumable (or heat-not-burn (HNB) consumable). The terms "heated tobacco" and "heat-not-burn" are used interchangeably herein to describe a consumable that is of the type that is heated rather than combusted (or are used interchangeably to describe a device for use with such a consumable). The device may comprise a cavity that is configured for receipt of at least a portion of the consumable (i.e., for engagement with the consumable). The aerosol-forming article may be of the type that comprises an aerosol former (e.g., carried by an aerosol-forming substrate).

The device may comprise a heater apparatus (also referred as heater) for heating the aerosol-forming article. The heater may comprise a heating element, which may be in the form of a rod that extends from the body of the device. The heating element may extend from the end of the body that is configured for engagement with the aerosol-forming article.

The heater (and thus the heating element) may be rigidly mounted to the body. The heating element may be elongate so as to define a longitudinal axis and may, for example, have a transverse profile (i.e., transverse to a longitudinal axis of the heating element) that is substantially circular (i.e., the heating element may be generally cylindrical). Alternatively, the heating element may have a transverse profile that is rectangular (i.e., the heater may be a "blade heater"). The heating element may alternatively be in the shape of a tube (i.e., the heater may be a "tube heater"). The heating element may take other forms (e.g., the heating element may have an elliptical transverse profile). The shape and/or size (e.g., diameter) of the transverse profile of the heating element may be generally consistent for the entire length (or substantially the entire length) of the heating element.

The heating element may be between 15 mm and 25 mm long, e.g., between 18 mm and 20 mm long, e.g., around 19 mm long. The heating element may have a diameter of between 1.5 mm and 2.5 mm, e.g., a diameter between 2 mm and 2.3 mm, e.g., a diameter of around 2.15 mm.

The heating element may be formed of ceramic. The heating element may comprise a core (e.g., a ceramic core) comprising $Al_2O_3$. The core of the heating element may have a diameter of 1.8 mm to 2.1 mm, e.g., between 1.9 mm and 2 mm. The heating element may comprise an outer layer (e.g., an outer ceramic layer) comprising $Al_2O_3$. The thickness of the outer layer may be between 160 μm and 220 μm, e.g., between 170 μm and 190 μm, e.g., around 180 μm. The heating element may comprise a heating track, which may extend longitudinally along the heating element. The heating track may be sandwiched between the outer layer and the core of the heating element. The heating track may comprise tungsten and/or rhenium. The heating track may have a thickness of around 20 μm.

The heating element may be located in the cavity (of the device), and may extend (e.g., along a longitudinal axis) from an internal base of the cavity towards an opening of the cavity. The length of the heating element (i.e., along the longitudinal axis of the heater) may be less than the depth of the cavity. Hence, the heating element may extend for only a portion of the length of the cavity. That is, the heating element may not extend through (or beyond) the opening of the cavity.

The heating element may be configured for insertion into an aerosol-forming article (e.g., a HT consumable) when an aerosol-forming article is received in the cavity. In that respect, a distal end (i.e., distal from a base of the heating element where it is mounted to the device) of the heating element may comprise a tapered portion, which may facilitate insertion of the heating element into the aerosol-forming article. The heating element may fully penetrate an aerosol-forming article when the aerosol-forming article is received in the cavity. That is, the entire length, or substantially the entire length, of the heating element may be received in the aerosol-forming article.

The heating element may have a length that is less than, or substantially the same as, an axial length of an aerosol-forming substrate forming part of an aerosol-forming article (e.g., a HT consumable). Thus, when such an aerosol-forming article is engaged with the device, the heating element may only penetrate the aerosol-forming substrate, rather than other components of the aerosol-forming article. The heating element may penetrate the aerosol-forming substrate for substantially the entire axial length of the aerosol forming-substrate of the aerosol-forming article. Thus, heat may be transferred from (e.g., an outer circumferential surface of) the heating element to the surrounding aerosol-forming substrate, when penetrated by the heating element. That is, heat may be transferred radially outwardly (in the case of a cylindrical heating element) or e.g., radially inwardly (in the case of a tube heater).

Where the heater is a tube heater, the heating element of the tube heater may surround at least a portion of the cavity. When the portion of the aerosol-forming article is received in the cavity, the heating element may surround a portion of the aerosol-forming article (i.e., so as to heat that portion of the aerosol-forming article). In particular, the heating element may surround an aerosol forming substrate of the aerosol-forming article. That is, when an aerosol-forming article is engaged with the device, the aerosol forming substrate of the aerosol-forming article may be located adjacent an inner surface of the (tubular) heating element. When the heating element is activated, heat may be transferred radially inwardly from the inner surface of the heating element to heat the aerosol forming substrate.

The cavity may comprise a (e.g., circumferential) wall (or walls) and the (tubular) heating element may extend around at least a portion of the wall(s). In this way, the wall may be located between the inner surface of the heating element and an outer surface of the aerosol-forming article. The wall (or walls) of the cavity may be formed from a thermally conductive material (e.g., a metal) to allow heat conduction from the heating element to the aerosol-forming article. Thus, heat may be conducted from the heating element, through the cavity wall (or walls), to the aerosol-forming substrate of an aerosol-forming article received in the cavity.

In some embodiments of the sixth mode the device may comprise a cap disposed at the end of the body that is configured for engagement with an aerosol-forming article. Where the device comprises a heater having a heating element, the cap may at least partially enclose the heating element. The cap may be moveable between an open position in which access is provided to the heating element, and a closed position in which the cap at least partially encloses the heating element. The cap may be slideably engaged with the body of the device, and may be slideable between the open and closed positions.

The cap may define at least a portion of the cavity of the device. That is, the cavity may be fully defined by the cap, or each of the cap and body may define a portion of the cavity. Where the cap fully defines the cavity, the cap may comprise an aperture for receipt of the heating element into the cavity (when the cap is in the closed position). The cap may comprise an opening to the cavity. The opening may be configured for receipt of at least a portion of an aerosol-forming article. That is, an aerosol-forming article may be inserted through the opening and into the cavity (so as to be engaged with the device).

The cap may be configured such that when an aerosol-forming article is engaged with the device (e.g., received in the cavity), only a portion of the aerosol-forming article is received in the cavity. That is, 25 a portion of the aerosol-forming article (not received in the cavity) may protrude from (i.e., extend beyond) the opening. This (protruding) portion of the aerosol-forming article may be a terminal (e.g., mouth) end of the aerosol-forming article, which may be received in a user's mouth for the purpose of inhaling aerosol formed by the device.

The device may comprise a power source or may be connectable to a power source (e.g., a power source separate to the device). The power source may be electrically connectable to the heater. In that respect, altering (e.g., toggling) the electrical connection of the power source to the heater may affect a state of the heater. For example, toggling the electrical connection of the power source to the heater may toggle the heater between an on state and an off state. The power source may be a power store. For example, the power source may be a battery or rechargeable battery (e.g., a lithium ion battery).

The device may comprise an input connection (e.g., a USB port, Micro USB port, USB-C port, etc.). The input connection may be configured for connection to an external source of electrical power, such as a mains electrical supply outlet. The input connection may, in some cases, be used as a substitute for an internal power source (e.g., battery or rechargeable battery). That is, the input connection may be electrically connectable to the heater (for providing power to the heater). Hence, in some forms, the input connection may form at least part of the power source of the device.

Where the power source comprises a rechargeable power source (such as a rechargeable battery), the input connection may be used to charge and recharge the power source.

The device may comprise a user interface (UI). In some embodiments the UI may include input means to receive operative commands from the user. The input means of the UI may allow the user to control at least one aspect of the operation of the device. In some embodiments the input means may comprise a power button to switch the device between an on state and an off state.

In some embodiments of the sixth mode the UI may additionally or alternatively comprise output means to convey information to the user. In some embodiments the output means may comprise a light to indicate a condition of the device (and/or the aerosol-forming article) to the user. The condition of the device (and/or aerosol-forming article)

indicated to the user may comprise a condition indicative of the operation of the heater. For example, the condition may comprise whether the heater is in an off state or an on state. In some embodiments, the UI unit may comprise at least one of a button, a display, a touchscreen, a switch, a light, and the like. For example, the output means may comprise one or more (e.g., two, three, four, etc.) light-emitting diodes ("LEDs") that may be located on the body of the device.

The device may further comprise a puff sensor (e.g., airflow sensor), which form part of the input means of the UI. The puff sensor may be configured to detect a user drawing on an end (i.e., a terminal (mouth) end) of the aerosol-forming article. The puff sensor may, for example, be a pressure sensor or a microphone. The puff sensor may be configured to produce a signal indicative of a puff state. The signal may be indicative of the user drawing (an aerosol from the aerosol-forming article) such that it is e.g., in the form of a binary signal. Alternatively or additionally, the signal may be indicative of a characteristic of the draw (e.g., a flow rate of the draw, length of time of the draw, etc).

The device may comprise a controller, or may be connectable to a controller that may be configured to control at least one function of the device. The controller may comprise a microcontroller that may e.g., be mounted on a printed circuit board (PCB). The controller may also comprise a memory, e.g., non-volatile memory. The memory may include instructions, which, when implemented, may cause the controller to perform certain tasks or steps of a method. Where the device comprises an input connection, the controller may be connected to the input connection.

The controller may be configured to control the operation of the heater (and e.g., the heating element). Thus, the controller may be configured to control vaporization of an aerosol forming part of an aerosol-forming article engaged with the device. The controller may be configured to control the voltage applied by power source to the heater. For example, the controller may be configured to toggle between applying a full output voltage (of the power source) to the heater and applying no voltage to the heater. Alternatively or additionally, the control unit may implement a more complex heater control protocol.

The device may further comprise a voltage regulator to regulate the output voltage supplied by the power source to form a regulated voltage. The regulated voltage may subsequently be applied to the heater.

In some embodiments, where the device comprises a UI, the controller may be operatively connected to one or more components of the UI. The controller may be configured to receive command signals from an input means of the UI. The controller may be configured to control the heater in response to the command signals. For example, the controller may be configured to receive "on" and "off" command signals from the UI and, in response, may control the heater so as to be in a corresponding on or off state.

The controller may be configured to send output signals to a component of the UI. The UI may be configured to convey information to a user, via an output means, in response to such output signals (received from the controller). For example, where the device comprises one or more LEDs, the LEDs may be operatively connected to the controller. Hence, the controller may configured to control the illumination of the LEDs (e.g., in response to an output signal). For example, the controller may be configured to control the illumination of the LEDs according to (e.g., an on or off) state of the heater.

Where the device comprises a sensor (e.g., a puff/airflow sensor), the controller may be operatively connected to the sensor. The controller may be configured to receive a signal from the sensor (e.g., indicative of a condition of the device and/or engaged aerosol-forming article). The controller may be configured to control the heater, or an aspect of the output means, based on the signal from the sensor.

The device may comprise a wireless interface configured to communicate wirelessly (e.g., via Bluetooth (e.g., a Bluetooth low-energy connection) or WiFi) with an external device. Similarly, the input connection may be configured for wired connection to an external device so as to provide communication between the device and the external device.

The external device may be a mobile device. For example, the external device may be a smart phone, tablet, smart watch, or smart car. An application (e.g., app) may be installed on the external device (e.g., mobile device). The application may facilitate communication between the device and the external device via the wired or wireless connection.

The wireless or wired interface may be configured to transfer signals between the external device and the controller of the device. In this respect, the controller may control an aspect of the device in response to a signal received from an external device. Alternatively or additionally, an external device may respond to a signal received from the device (e.g., from the controller of the device).

The system (e.g., a heat not burn system) comprising a device and an aerosol-forming article. The aerosol-forming article may comprise an aerosol-forming substrate at an upstream end of the aerosol-forming article. The article may be in the form of a smoking substitute article, e.g., heated tobacco (HT) consumable (also known as a heat-not-burn (HNB) consumable).

As used herein, the terms "upstream" and "downstream" are intended to refer to the flow direction of the vapor/aerosol i.e., with the downstream end of the article/consumable being the mouth end or outlet where the aerosol exits the consumable for inhalation by the user. The upstream end of the article/consumable is the opposing end to the downstream end.

The aerosol-forming substrate is capable of being heated to release at least one volatile compound that can form an aerosol. The aerosol-forming substrate may be located at the upstream end of the article/consumable.

In order to generate an aerosol, the aerosol-forming substrate comprises at least one volatile compound that is intended to be vaporized/aerosolized and that may provide the user with a recreational and/or medicinal effect when inhaled. Suitable chemical and/or physiologically active volatile compounds include the group consisting of: nicotine, cocaine, caffeine, opiates and opioids, cathine and cathinone, kavalactones, mysticin, beta-carboline alkaloids, salvinorin A together with any combinations, functional equivalents to, and/or synthetic alternatives of the foregoing.

The aerosol-forming substrate may comprise plant material. The plant material may comprise least one plant material selected from the list including *Amaranthus dubius, Arctostaphylos uva-ursi* (Bearberry), *Argemone mexicana, Amica, Artemisia vulgaris*, Yellow Tees, *Galea zacatechichi, Canavalia maritima* (Baybean), *Cecropia mexicana* (Guamura), *Cestrum noctumum, Cynoglossum virginianum* (wild comfrey), *Cytisus scoparius, Damiana, Entada rheedii, Eschscholzia califomica* (California Poppy), *Fittonia albivenis, Hippobroma longiflora, Humulus japonica* (Japanese Hops), *Humulus lupulus* (Hops), *Lactuca virosa* (Lettuce Opium), *Laggera alata, Leonotis leonurus, Leonurus cardiaca* (Motherwort), *Leonurus sibiricus* (Honeyweed), *Lobelia cardinalis, Lobelia inflata* (Indian-tobacco), *Lobelia*

*siphilitica, Nepeta cataria* (Catnip), *Nicotiana* species (Tobacco), *Nymphaea alba* (White Lily), *Nymphaea caerulea* (Blue Lily), Opium poppy, *Passiflora incamata* (Passionflower), *Pedicularis densiflora* (Indian Warrior), *Pedicularis groenlandica* (Elehant's Head), *Salvia divinorum, Salvia dorrii* (Tobacco Sage), Salvia species (Sage), *Scutellaria galericulata, Scutellaria lateriflora, Scutellaria nana, Scutellaria* species (Skullcap), *Sida acuta* (Wireweed), *Sida rhombifolia, Silene capensis, Syzygium aromaticum* (Clove), *Tagetes lucida* (Mexican Tarragon), *Tarchonanthus camphoratus, Tumera diffusa* (Damiana), *Verbascum* (Mullein), *Zamia latifolia* (Maconha Brava) together with any combinations, functional equivalents to, and/or synthetic alternatives of the foregoing.

The plant material may be tobacco. Any type of tobacco may be used. This includes, but is not limited to, flue-cured tobacco, burley tobacco, Maryland Tobacco, dark-air cured tobacco, oriental tobacco, dark-fired tobacco, perique tobacco and rustica tobacco. This also includes blends of the above mentioned tobaccos.

The tobacco may comprise one or more of leaf tobacco, stem tobacco, tobacco powder, tobacco dust, tobacco derivatives, expanded tobacco, homogenized tobacco, shredded tobacco, extruded tobacco, cut rag tobacco and/or reconstituted tobacco (e.g., slurry recon or paper recon).

The aerosol-forming substrate may comprise a gathered sheet of homogenized (e.g., paper/slurry recon) tobacco or gathered shreds/strips formed from such a sheet.

The aerosol-forming substrate may comprise one or more additives selected from humectants, flavorants, fillers, aqueous/non-aqueous solvents and binders.

The flavorant may be provided in solid or liquid form. It may include menthol, licorice, chocolate, fruit flavor (including e.g., citrus, cherry etc.), vanilla, spice (e.g., ginger, cinnamon) and tobacco flavor. The flavorant may be evenly dispersed throughout the aerosol-forming substrate or may be provided in isolated locations and/or varying concentrations throughout the aerosol-forming substrate.

The aerosol-forming substrate may be formed in a substantially cylindrical shape such that the article/consumable resembles a conventional cigarette. It may have a diameter of between 5 and 10 mm e.g., between 6 and 9 mm or 6 and 8 mm e.g., around 7 mm. It may have an axial length of between 10 and 15 mm e.g., between 11 and 14 mm such as around 12 or 13 mm.

The article/consumable may comprise at least one filter element. There may be a terminal filter element at the downstream/mouth end of the article/consumable.

The or at least one of the filter element(s) (e.g., the terminal filter element) may be comprised of cellulose acetate or polypropylene tow. The at least one filter element (e.g., the terminal filter element) 15 may be comprised of activated charcoal. The at least one filter element (e.g., the terminal element) may be comprised of paper. The or each filter element may be at least partly (e.g., entirely) circumscribed with a plug wrap e.g., a paper plug wrap.

The terminal filter element (at the downstream end of the article/consumable) may be joined to the upstream elements forming the article/consumable by a circumscribing tipping layer e.g., a tipping paper layer. The tipping paper may have an axial length longer than the axial length of the terminal filter element such that the tipping paper completely circumscribes the terminal filter element plus the wrapping layer surrounding any adjacent upstream element.

In some embodiments of the sixth mode, the article/consumable may comprise an aerosol-cooling element which is adapted to cool the aerosol generated from the aerosol-forming substrate (by heat exchange) before being inhaled by the user.

The article/consumable may comprise a spacer element that defines a space or cavity between the aerosol-forming substrate and the downstream end of the consumable. The spacer element may comprise a cardboard tube. The spacer element may be circumscribed by the (paper) wrapping layer.

The sixth mode of the disclosure includes the combination of the aspects and preferred features described except where such a combination is clearly impermissible or expressly avoided.

The skilled person will appreciate that except where mutually exclusive, a feature or parameter described in relation to any one of the above aspects may be applied to any other aspect. Furthermore, except where mutually exclusive, any feature or parameter described herein may be applied to any aspect of the sixth mode and/or combined with any other feature or parameter described herein.

Seventh Mode of the Disclosure: Heat Not Burn Device Including Controlling Operation of the Heat Not Burn Device Including Detecting Cap Removal.

At its most general, an aspect of the seventh mode of the present disclosure relates to a heat not burn device including controlling operation of the heat not burn device including detecting cap removal. At its most general, another aspect of the present disclosure relates to heat-not-burn device with a movable cap wherein the device is configured to control power supply to a heating element based on the position of the movable cap. The disclosure also provides a corresponding method of operating a heat-not-burn device which controls power supply to a heating element based on the position of the movable cap.

According to a first aspect of the seventh mode of the present disclosure, there is provided a heat not burn device, comprising: a heater for heating an aerosol forming substrate; a movable cap that at least partially covers the heater; a sensor for detecting cap movement; and a controller configured to reduce power supplied to the heater based at least upon detecting movement of the cap.

Optional features will now be set out. These are applicable singly or in any combination with any aspect.

Optionally, the movable cap defines at least a portion of a cavity of the device and the movable cap comprises an aperture for receipt of the heating element into the cavity, wherein the movable cap further comprises an opening to the cavity configured to receive at least a portion of the aerosol-forming substrate.

Optionally, the sensor detects movement of the cap if the heater is partially or fully exposed.

Optionally, the device includes a user interface, and wherein the device is configured to indicate to the user when the sensor detects movement of the cap using the user interface.

Optionally, the aerosol forming substrate is part of a heat not burn consumable.

Optionally, the cap is configured to engage with the consumable.

Optionally, the heater penetrates the aerosol forming substrate in use.

Optionally, the cap includes a detected component for detection by the sensor.

Optionally, the detected component includes a cap magnet.

Optionally, a housing of the device includes a housing magnetic for magnetic interaction with the cap magnet to thereby retain the cap in a closed position.

Optionally, reducing the power supplied to y include the heater comprises switching off of the power supplied to the heater.

According to a second aspect of the seventh mode of the present disclosure, there is provided a method of operating a heat-not-burn device. The heat-not-burn device comprises a cap movable between an engaged position to conceal a heating element and a disengaged position to expose the heating element. The method comprises the steps of enabling a power supply to the heating element when the cap is detected to be in the engaged position, and disabling said power supply when the cap is detected to be in the disengaged position.

The method provides a safe and efficient means of operating a heat-not-burn device. When the cap is disengaged the heating element becomes exposed, presenting a potential hazard to the user if power continues to be supplied to the heater. By cutting power to the heater when the cap is disengaged, the device therefore reduces the risk of harm to the user. Furthermore, disabling the heater when the cap is open saves power, increasing the battery life and efficiency of the device.

The term "conceal a heating element" indicates that one purpose of the cap is to protect the user from exposure to the heating element. The heating element may be partially or substantially concealed (e.g., invisible, or inaccessible) when the cap is engaged, e.g., still being accessible through a cavity adapted to receive a heat-not-burn consumable. Thus "conceal a heating element" refers to the heating element being substantially concealed, or concealed relative to when the cap is in the disengaged position.

The term "expose the heating element" indicates that at least a portion of the heating element which is not visible or accessible when the cap is engaged becomes visible or accessible to the user when the cap is disengaged. Nevertheless at least a portion of the heating element may still be concealed (not visible, or not accessible) when the heating element is exposed. In some embodiments, when the cap is in the disengaged position, the cap defines an aperture through which the heating element is accessible, e.g., for inspection and cleaning. When the cap is in the engaged position this aperture may close to "conceal" the heating element.

Further optional features will now be set out. These are applicable singly or in any combination with any aspect.

The device comprises a body and a cap engageable with the body. The device also comprises a heating element extending from the body. In some embodiments, the cap is biased into the engaged position, biased into the disengaged position, or both. The device may comprise biasing means which bias the cap into the engaged position, biased into the disengaged position, or both. In some embodiments, the biasing means comprise one or more magnets. In some embodiments, the cap comprises one or more magnets. In some embodiments, the body comprises one or more magnets. In some embodiments, the cap and the body each respectively comprise one or more magnets.

In some embodiments, the cap is biased into the engaged position. In this way, the cap will "snap" back into the engaged position once the user no longer requires the cap to be disengaged, simply by the user releasing the cap.

The detection of the position of the cap may be achieved by a suitable switch or sensor, including but not limited to a proximity sensor, light sensor or motion sensor.

In some embodiments, the device comprises a proximity sensor configured to detect the position of the cap and coupled to a controller configured to determine whether the cap is in the engaged position or the disengaged position, and the method comprises the steps of enabling a power supply to the heating element when the cap is detected by the proximity sensor to be in the engaged position, and disabling said power supply when the cap is detected by the proximity sensor to be in the disengaged position.

In some embodiments, the device comprises one or more magnets and the proximity sensor comprises a Hall effect sensor configured to measure a magnetic field associated with the one or more magnets to detect the position of the cap. In some embodiments, the one or more magnets act as both biasing means to bias the cap into the engaged position, disengaged position or both as act to provide a magnetic field which is detected by the Hall effect sensor to determine the position of the cap.

Conveniently, the cap may be detected to be disengaged when the magnetic field is lesser than a threshold value and the cap may be detected to be engaged when the magnetic field is greater than the threshold value. The threshold value may be a predetermined value stored within a memory of the device. The threshold value may be selected to be a suitable value such that the cap is determined to be "disengaged" when the cap reaches a certain distance from the body of the device, e.g., when the distance of the cap from the device is sufficient to expose the heater to an extent considered dangerous. In this way, unwanted disabling of the heater caused by small, insignificant movements of the cap is avoided.

Optionally, the method may further comprise preventing any further power supply to the heating element if the cap is detected to be in the disengaged position, when the device is in a state in which power to the heating element has been disabled (e.g., because the cap has previously detected that the cap is in the disengaged position). For example, if the cap is in the disengaged position and a user attempts to power-up the heating element (e.g., by pressing a power button), the device will not supply power to the heater. As a result, power supply to the heater remains disabled until the user engages the cap with the body of the device.

In some embodiments, the method comprises powering down the device when the cap is detected to be in the disengaged position. In other words, in some embodiments if the device is in a powered-up state (switched "on") and the cap is detected to be in the disengaged position, the method comprises powering down (switching "off") the device to disable device functions, including the heating element.

Optionally, when the device is powered down (switched "off"), the method further comprises preventing powering up (switching "on") if the cap is detected to be in the disengaged position. As a result, the device remains powered down until the user engages the cap with the body of the device.

According to a third aspect of the seventh mode of the present disclosure, there is provided a heat-not-burn device comprising a cap movable between an engaged position to conceal a heating element and a disengaged position to expose the heating element. The heat-not-burn device is configured to enable a power supply to the heating element when the cap is detected to be in the engaged position, and disable said power supply when the cap is detected to be in the disengaged position.

The device comprises a body and a cap engageable with the body. The device also comprises a heating element extending from the body. In some embodiments, the cap is biased into the engaged position, biased into the disengaged position, or both. The device may comprise biasing means which bias the cap into the engaged position, biased into the disengaged position, or both. In some embodiments, the biasing means comprise one or more magnets. In some embodiments, the cap comprises one or more magnets. In some embodiments, the body comprises one or more magnets. In some embodiments, the cap and the body each respectively comprise one or more magnets.

In some embodiments, the device comprises a controller which is configured to enable a power supply to the heating element when the cap is detected to be in the engaged position, and disable said power supply when the cap is detected to be in the disengaged position. The controller may be connected to one or more sensors which detect the position of the cap and send a corresponding signal to the controller which determines whether the cap is in the engaged or disengaged position.

In some embodiments, the cap is biased into the engaged position. In this way, the cap will "snap"back into the engaged position once the user no longer requires the cap to be disengaged, simply by the user releasing the cap.

The detection of the position of the cap may be achieved by a suitable switch or sensor, including but not limited to a proximity sensor, light sensor or motion sensor.

In some embodiments, the device comprises a proximity sensor configured to detect the position of the cap and coupled to a controller configured to determine whether the cap is in the engaged position or the disengaged position.

In some embodiments, the device comprises one or more magnets and the proximity sensor comprises a Hall effect sensor configured to measure a magnetic field associated with the one or more magnets to detect the position of the cap. In some embodiments, the one or more magnets act as both biasing means to bias the cap into the engaged position, disengaged position or both as act to provide a magnetic field which is detected by the Hall effect sensor to determine the position of the cap.

Conveniently, the cap may be detected to be disengaged when the magnetic field is lesser than a threshold value and the cap may be detected to be engaged when the magnetic field is greater than the threshold value. The threshold value may be a predetermined value stored within a memory of the device. The threshold value may be selected to be a suitable value such that the cap is determined to be "disengaged" when the cap reaches a certain distance from the body of the device, e.g., when the distance of the cap from the device is sufficient to expose the heater to an extent considered dangerous. In this way, unwanted disabling of the heater caused by small, insignificant movements of the cap is avoided.

Optionally, when the device is in a state in which power to the heating element has been disabled (e.g., because the cap has previously detected that the cap is in the disengaged position), the device may be configured to prevent any further power supply to the heating element if the cap is detected to be in the disengaged position. For example, if the cap is in the disengaged position and a user attempts to power-up the heating element (e.g., by pressing a power button), the device will not supply power to the heater. As a result, power supply to the heater remains disabled until the user engages the cap with the body of the device.

In some embodiments, the device is configured to power down when the cap is detected to be in the disengaged position. In other words, in some embodiments if the device is in a powered-up state (switched "on") and the cap is detected to be in the disengaged position, the device is configured to power down (switch "off") to disable device functions, including the heating element. Optionally, when the device is powered down (switched "off"), the device is configured to prevent powering up (switching "on") if the cap is detected to be in the disengaged position. As a result, the device remains powered down until the user engages the cap with the body of the device.

The device may comprise an elongate body. An end of the elongate body may be configured for engagement with an aerosol-forming article. For example, the body may be configured for engagement with a heated tobacco (HT) consumable (or heat-not-burn (HNB) consumable). The terms "heated tobacco" and "heat-not-burn" are used interchangeably herein to describe a consumable that is of the type that is heated rather than combusted (or are used interchangeably to describe a device for use with such a consumable). The device may comprise a cavity that is configured for receipt of at least a portion of the consumable (i.e., for engagement with the consumable). The aerosol-forming article may be of the type that comprises an aerosol former (e.g., carried by an aerosol-forming substrate).

The device may comprise a heater for heating the aerosol-forming article. The heater may comprise a heating element, which may be in the form of a rod that extends from the body of the device. The heating element may extend from the end of the body that is configured for engagement with the aerosol-forming article.

The heater (and thus the heating element) may be rigidly mounted to the body. The heating element may be elongate so as to define a longitudinal axis and may, for example, have a transverse profile (i.e., transverse to a longitudinal axis of the heating element) that is substantially circular (i.e., the heating element may be generally cylindrical). Alternatively, the heating element may have a transverse profile that is rectangular (i.e., the heater may be a "blade heater"). The heating element may alternatively be in the shape of a tube (i.e., the heater may be a "tube heater"). The heating element may take other forms (e.g., the heating element may have an elliptical transverse profile). The shape and/or size (e.g. diameter) of the transverse profile of the heating element may be generally consistent for the entire length (or substantially the entire length) of the heating element.

The heating element may be between 15 mm and 25 mm long, e.g., between 18 mm and 20 mm long, e.g., around 19 mm long. The heating element may have a diameter of between 1.5 mm and 2.5 mm, e.g., a diameter between 2 mm and 2.3 mm, e.g., a diameter of around 2.15 mm.

The heating element may be formed of ceramic. The heating element may comprise a core (e.g., a ceramic core) comprising $Al_2O_3$. The core of the heating element may have a diameter of 1.8 mm to 2.1 mm, e.g., between 1.9 mm and 2 mm. The heating element may comprise an outer layer (e.g., an outer ceramic layer) comprising $Al_2O_3$. The thickness of the outer layer may be between 160 μm and 220 μm, e.g., between 170 μm and 190 μm, e.g., around 180 μm. The heating element may comprise a heating track, which may extend longitudinally along the heating element. The heating track may be sandwiched between the outer layer and the core of the heating element. The heating track may comprise tungsten and/or rhenium. The heating track may have a thickness of around 20 μm.

The heating element may be located in the cavity (of the device), and may extend (e.g., along a longitudinal axis) from an internal base of the cavity towards an opening of the cavity. The length of the heating element (i.e., along the longitudinal axis of the heater) may be less than the depth of the cavity. Hence, the heating element may extend for only a portion of the length of the cavity. That is, the heating element may not extend through (or beyond) the opening of the cavity.

The heating element may be configured for insertion into an aerosol-forming article (e.g., a HT consumable) when an aerosol-forming article is received in the cavity. In that respect, a distal end (i.e., distal from a base of the heating element where it is mounted to the device) of the heating element may comprise a tapered portion, which may facilitate insertion of the heating element into the aerosol-forming article. The heating element may fully penetrate an aerosol-forming article when the aerosol-forming article is received in the cavity. That is, the entire length, or substantially the entire length, of the heating element may be received in the aerosol-forming article.

The heating element may have a length that is less than, or substantially the same as, an axial length of an aerosol-forming substrate forming part of an aerosol-forming article (e.g., a HT consumable). Thus, when such an aerosol-forming article is engaged with the device, the heating element may only penetrate the aerosol-forming substrate, rather than other components of the aerosol-forming article. The heating element may penetrate the aerosol-forming substrate for substantially the entire axial length of the aerosol forming-substrate of the aerosol-forming article. Thus, heat may be transferred from (e.g., an outer circumferential surface of) the heating element to the surrounding aerosol-forming substrate, when penetrated by the heating element. That is, heat may be transferred radially outwardly (in the case of a cylindrical heating element) or e.g., radially inwardly (in the case of a tube heater).

Where the heater is a tube heater, the heating element of the tube heater may surround at least a portion of the cavity. When the portion of the aerosol-forming article is received in the cavity, the heating element may surround a portion of the aerosol-forming article (i.e., so as to heat that portion of the aerosol-forming article). In particular, the heating element may surround an aerosol forming substrate of the aerosol-forming article. That is, when an aerosol-forming article is engaged with the device, the aerosol forming substrate of the aerosol-forming article may be located adjacent an inner surface of the (tubular) heating element. When the heating element is activated, heat may be transferred radially inwardly from the inner surface of the heating element to heat the aerosol forming substrate.

The cavity may comprise a (e.g., circumferential) wall (or walls) and the (tubular) heating element may extend around at least a portion of the wall(s). In this way, the wall may be located between the inner surface of the heating element and an outer surface of the aerosol-forming article. The wall (or walls) of the cavity may be formed from a thermally conductive material (e.g., a metal) to allow heat conduction from the heating element to the aerosol-forming article. Thus, heat may be conducted from the heating element, through the cavity wall (or walls), to the aerosol-forming substrate of an aerosol-forming article received in the cavity.

In some embodiments the device may comprise a cap disposed at the end of the body that is configured for engagement with an aerosol-forming article. Where the device comprises a heater having a heating element, the cap may at least partially enclose the heating element. The cap may be moveable between an open position in which access is provided to the heating element, and a closed position in which the cap at least partially encloses the heating element. The cap may be slideably engaged with the body of the device, and may be slideable between the open and closed positions.

In some embodiments the device comprises a cap movable between an engaged position to conceal a heating element and a disengaged position to expose the heating element. In some embodiments the cap may be disposed at the end of the body. In some embodiments, the cap is configured for engagement with an aerosol-forming article. The device comprises a heater having a heating element, and the cap may at least partially enclose the heating element. The cap is moveable between an open position or disengaged position in which access is provided to the heating element or the heating element is exposed, and a closed position or engaged position in which the cap at least partially encloses (conceals) the heating element. The cap may be slideably engaged with the body of the device, and may be slideable between the engaged and disengaged positions.

The cap may define at least a portion of the cavity of the device. That is, the cavity may be fully defined by the cap, or each of the cap and body may define a portion of the cavity. Where the cap fully defines the cavity, the cap may comprise an aperture for receipt of the heating element into the cavity (when the cap is in the closed position). The cap may comprise an opening to the cavity. The opening may be configured for receipt of at least a portion of an aerosol-forming article. That is, an aerosol-forming article may be inserted through the opening and into the cavity (so as to be engaged with the device).

The cap may be configured such that when an aerosol-forming article is engaged with the device (e.g., received in the cavity), only a portion of the aerosol-forming article is received in the cavity. That is, a portion of the aerosol-forming article (not received in the cavity) may protrude from (i.e., extend beyond) the opening. This (protruding) portion of the aerosol-forming article may be a terminal (e.g., mouth) end of the aerosol-forming article, which may be received in a user's mouth for the purpose of inhaling aerosol formed by the device.

The cap may comprise a magnet to detect the movement when moved from closed position to open position or from open position to closed position, by a sensor.

The device may further comprise a sensor to detect movement of the cap. In one example, the movement of the cap may be removal or disengagement of the cap. The sensor may, for example, be a Hall effect sensor. The sensor may be configured to generate a signal indicative of movement of the cap from open position to close position or close to open position.

The device may comprise a power source or may be connectable to a power source (e.g., a power source separate to the device). The power source may be electrically connectable to the heater. In that respect, altering (e.g., toggling) the electrical connection of the power source to the heater may affect a state of the heater. For example, toggling the electrical connection of the power source to the heater may toggle the heater between an on state and an off state. The power source may be a power store. For example, the power source may be a battery or rechargeable battery (e.g., a lithium ion battery).

The power supply to the heating element may be controlled based on the position of the cap. When the cap is in the engaged position, the power supply to the heating element is enabled. When the cap is in the disengaged position, the power supply to the heating element is disabled.

The device may comprise an input connection (e.g., a USB port, Micro USB port, USB-C port, etc.). The input connection may be configured for connection to an external source of electrical power, such as a mains electrical supply outlet. The input connection may, in some cases, be used as a substitute for an internal power source (e.g., battery or rechargeable battery). That is, the input connection may be electrically connectable to the heater (for providing power to the heater). Hence, in some forms, the input connection may form at least part of the power source of the device.

Where the power source comprises a rechargeable power source (such as a rechargeable battery), the input connection may be used to charge and recharge the power source.

The device may comprise a user interface (UI). In some embodiments the UI may include input means to receive operative commands from the user. The input means of the UI may allow the user to control at least one aspect of the operation of the device. In some embodiments the input means may comprise a power button to switch the device between an on state and an off state.

In some embodiments the UI may additionally or alternatively comprise output means to convey information to the user. In some embodiments the output means may comprise a light to indicate a condition of the device (and/or the aerosol-forming article) to the user. The condition of the device (and/or aerosol-forming article) indicated to the user may comprise a condition indicative of the operation of the heater. For example, the condition may comprise whether the heater is in an off state or an on state. In some embodiments, the UI unit may comprise at least one of a button, a display, a touchscreen, a switch, a light, and the like. For example, the output means may comprise one or more (e.g., two, three, four, etc.) light-emitting diodes ("LEDs") that may be located on the body of the device.

The device may further comprise a puff sensor (e.g., airflow sensor), which form part of the input means of the UI. The puff sensor may be configured to detect a user drawing on an end (i.e., a terminal (mouth) end) of the aerosol-forming article. The puff sensor may, for example, be a pressure sensor or a microphone. The puff sensor may be configured to produce a signal indicative of a puff state. The signal may be indicative of the user drawing (an aerosol from the aerosol-forming article) such that it is e.g., in the form of a binary signal. Alternatively or additionally, the signal may be indicative of a characteristic of the draw (e.g., a flow rate of the draw, length of time of the draw, etc).

The device may comprise a controller, or may be connectable to a controller that may be configured to control at least one function of the device. The controller may comprise a microcontroller that may e.g., be mounted on a printed circuit board (PCB). The controller may also comprise a memory, e.g., non-volatile memory. The memory may include instructions, which, when implemented, may cause the controller to perform certain tasks or steps of a method. Where the device comprises an input connection, the controller may be connected to the input connection.

The controller may be configured to control the operation of the heater (and e.g., the heating element). Thus, the controller may be configured to control vaporization of an aerosol forming part of an aerosol-forming article engaged with the device. The controller may be configured to control the voltage applied by power source to the heater. For example, the controller may be configured to toggle between applying a full output voltage (of the power source) to the heater and applying no voltage to the heater. Alternatively or additionally, the control unit may implement a more complex heater control protocol.

The device may further comprise a voltage regulator to regulate the output voltage supplied by the power source to form a regulated voltage. The regulated voltage may subsequently be applied to the heater.

In some embodiments, where the device comprises a UI, the controller may be operatively connected to one or more components of the UI. The controller may be configured to receive command signals from an input means of the UI. The controller may be configured to control the heater in response to the command signals. For example, the controller may be configured to receive "on" and "off" command signals from the UI and, in response, may control the heater so as to be in a corresponding on or off state.

The controller may be configured to send output signals to a component of the UI. The UI may be configured to convey information to a user, via an output means, in response to such output signals (received from the controller). For example, where the device comprises one or more LEDs, the LEDs may be operatively connected to the controller. Hence, the controller may configured to control the illumination of the LEDs (e.g., in response to an output signal). For example, the controller may be configured to control the illumination of the LEDs according to (e.g., an on or off) state of the heater.

Where the device comprises sensor (e.g., a puff/airflow sensor/cap sensor), the controller may be operatively connected to the sensor. The controller may be configured to receive a signal from the sensor (e.g., indicative of a condition of the device and/or engaged aerosol-forming article). The controller may be configured to control the heater, or an aspect of the output means, based on the signal from the sensor. For example, when the device comprises a sensor to detect the position of the cap, the controller may be configured to determine the position of the cap based on a signal received from the sensor and control power supply to the heating element accordingly. In some embodiments, the device comprises a proximity sensor to detect the position of the cap (through detection of the proximity of the cap to the body of the device), the proximity sensor being configured to send a signal to the controller which thereby determines the position of the cap. When the cap is determined by the controller to be in the engaged position, power supply to the heating element is enabled by the controller. When the cap is determined by the controller to be in the disengaged position, power supply to the heating element is disabled by the controller. In some embodiments, when the cap is determined by the controller to be in the disengaged position, power supply to the heating element is disabled and no further power supply is permitted until the controller determines that the cap is in the engaged position.

In some embodiments, the controller may be configured to control the power supply to the heating element. In some embodiments, the controller may be configured to control the power supply to the heating element based on the position of the cap.

The device may comprise a wireless interface configured to communicate wirelessly (e.g., via Bluetooth (e.g., a Bluetooth low-energy connection) or WiFi) with an external device. Similarly, the input connection may be configured for wired connection to an external device so as to provide communication between the device and the external device.

The external device may be a mobile device. For example, the external device may be a smart phone, tablet, smart watch, or smart car. An application (e.g., app) may be installed on the external device (e.g., mobile device). The application may facilitate communication between the device and the external device via the wired or wireless connection.

The wireless or wired interface may be configured to transfer signals between the external device and the controller of the device. In this respect, the controller may control an aspect of the device in response to a signal received from an external device. Alternatively or additionally, an external device may respond to a signal received from the device (e.g., from the controller of the device).

In a fourth aspect of the seventh mode, there is provided a system (e.g., a smoking substitute system) comprising a device according to the first aspect, the second aspect, or the third aspect, and an aerosol-forming article.

The aerosol-forming article may comprise an aerosol-forming substrate at an upstream end of the aerosol-forming article. The article may be in the form of a smoking substitute article, e.g., heated tobacco (HT) consumable (also known as a heat-not-burn (HNB) consumable).

As used herein, the terms "upstream" and "downstream" are intended to refer to the flow direction of the vapor/aerosol i.e., with the downstream end of the article/consumable being the mouth end or outlet where the aerosol exits the consumable for inhalation by the user. The upstream end of the article/consumable is the opposing end to the downstream end.

The aerosol-forming substrate is capable of being heated to release at least one volatile compound that can form an aerosol. The aerosol-forming substrate may be located at the upstream end of the article/consumable.

In order to generate an aerosol, the aerosol-forming substrate comprises at least one volatile compound that is intended to be vaporized/aerosolized and that may provide the user with a recreational and/or medicinal effect when inhaled. Suitable chemical and/or physiologically active volatile compounds include the group consisting of: nicotine, cocaine, caffeine, opiates and opioids, cathine and cathinone, kavalactones, mysticin, beta-carboline alkaloids, salvinorin A together with any combinations, functional equivalents to, and/or synthetic alternatives of the foregoing.

The aerosol-forming substrate may comprise plant material. The plant material may comprise least one plant material selected from the list including *Amaranthus dubius, Arctostaphylos uva-ursi* (Bearberry), *Argemone mexicana, Amica, Artemisia vulgaris*, Yellow Tees, *Galea zacatechichi, Canavalia maritima* (Baybean), *Cecropia mexicana* (Guamura), *Cestrum noctumum, Cynoglossum virginianum* (wild comfrey), *Cytisus scoparius, Damiana, Entada rheedii, Eschscholzia califomica* (California Poppy), *Fittonia albivenis, Hippobroma longiflora, Humulus japonica* (Japanese Hops), *Humulus lupulus* (Hops), *Lactuca virosa* (Lettuce Opium), *Laggera alata, Leonotis leonurus, Leonurus cardiaca* (Motherwort), *Leonurus sibiricus* (Honeyweed), *Lobelia cardinalis, Lobelia inflata* (Indian-tobacco), *Lobelia siphilitica, Nepeta cataria* (Catnip), *Nicotiana* species (Tobacco), *Nymphaea alba* (White Lily), *Nymphaea caerulea* (Blue Lily), Opium poppy, *Passiflora incamata* (Passionflower), *Pedicularis densiflora* (Indian Warrior), *Pedicularis groenlandica* (Elephant's Head), *Salvia divinorum, Salvia dorrii* (Tobacco Sage), Salvia species (Sage), *Scutellaria galericulata, Scutellaria lateriflora, Scutellaria nana, Scutellaria* species (Skullcap), *Sida acuta* (Wireweed), *Sida rhombifolia, Silene capensis, Syzygium aromaticum* (Clove), *Tagetes lucida* (Mexican Tarragon), *Tarchonanthus camphoratus, Tumera diffusa* (Damiana), *Verbascum* (Mullein), *Zamia latifolia* (Maconha Brava) together with any combinations, functional equivalents to, and/or synthetic alternatives of the foregoing.

The plant material may be tobacco. Any type of tobacco may be used. This includes, but is not limited to, flue-cured tobacco, burley tobacco, Maryland Tobacco, dark-air cured tobacco, oriental tobacco, dark-fired tobacco, perique tobacco and rustica tobacco. This also includes blends of the above mentioned tobaccos.

The tobacco may comprise one or more of leaf tobacco, stem tobacco, tobacco powder, tobacco dust, tobacco derivatives, expanded tobacco, homogenized tobacco, shredded tobacco, extruded tobacco, cut rag tobacco and/or reconstituted tobacco (e.g., slurry recon or paper recon).

The aerosol-forming substrate may comprise a gathered sheet of homogenized (e.g., paper/slurryrecon) tobacco or gathered shreds/strips formed from such a sheet.

The aerosol-forming substrate may comprise one or more additives selected from humectants, flavorants, fillers, aqueous/non-aqueous solvents and binders.

The flavorant may be provided in solid or liquid form. It may include menthol, licorice, chocolate, fruit flavor (including e.g., citrus, cherry etc.), vanilla, spice (e.g., ginger, cinnamon) and tobacco flavor. The flavorant may be evenly dispersed throughout the aerosol-forming substrate or may be provided in isolated locations and/or varying concentrations throughout the aerosol-forming substrate.

The aerosol-forming substrate may be formed in a substantially cylindrical shape such that the article/consumable resembles a conventional cigarette. It may have a diameter of between 5 and 10 mm e.g., between 6 and 9 mm or 6 and 8 mm e.g., around 7 mm. It may have an axial length of between 10 and 15 mm e.g., between 11 and 14 mm such as around 12 or 13 mm.

The article/consumable may comprise at least one filter element. There may be a terminal filter element at the downstream/mouth end of the article/consumable.

The or at least one of the filter element(s) (e.g., the terminal filter element) may be comprised of cellulose acetate or polypropylene tow. The at least one filter element (e.g., the terminal filter element) may be comprised of activated charcoal. The at least one filter element (e.g., the terminal element) may be comprised of paper. The or each filter element may be at least partly (e.g., entirely) circumscribed with a plug wrap e.g., a paper plug wrap.

The terminal filter element (at the downstream end of the article/consumable) may be joined to the upstream elements forming the article/consumable by a circumscribing tipping layer e.g., a tipping paper layer. The tipping paper may have an axial length longer than the axial length of the terminal filter element such that the tipping paper completely circumscribes the terminal filter element plus the wrapping layer surrounding any adjacent upstream element.

In some embodiments, the article/consumable may comprise an aerosol-cooling element which is adapted to cool the aerosol generated from the aerosol-forming substrate (by heat exchange) before being inhaled by the user.

The article/consumable may comprise a spacer element that defines a space or cavity between the aerosol-forming substrate and the downstream end of the consumable. The spacer element may comprise a cardboard tube. The spacer element may be circumscribed by the (paper) wrapping layer.

According to a fifth aspect of the seventh mode of the present disclosure, there is provided a method of using the system according to the fourth aspect, the method comprising inserting the aerosol-forming article into the device; and heating the article using the heater of the device.

In some embodiments the method may comprise inserting the article into a cavity within a body of the device and penetrating the article with the heating element of the device upon insertion of the article.

The seventh mode of the disclosure includes the combination of the aspects and preferred features described except where such a combination is clearly impermissible or expressly avoided.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

Eighth Mode of the Disclosure: Heater Apparatus Including A Rod Having a Tapered Transverse Cross Section.

At its most general, the eighth mode of the present disclosure relates to a heating apparatus for a heat not burn smoking device.

According to a first aspect of the eighth mode of the present disclosure, there is provided a heater apparatus for a heat not burn smoking device. The heater apparatus comprising a rod including a heater element. The rod has a tapered transverse cross section.

By providing a HNB device comprising a heater apparatus having tapered rod, the device may allow the HNB consumable to be removed more freely with minimum efforts from the user.

Optional features will now be set out. These are applicable singly or in any combination with any aspect.

Optionally, heater element comprises a resistive heater track. By providing a resistive heater track in the heating apparatus, it may be possible to achieve quick and efficient heating.

Advantageously, the resistive heater track is located on the rod. This configuration of the heater track may facilitate an option for replacing the heater track in case of a failure.

Optionally, the resistive heater track comprises a first portion with a first resistivity and a second portion with a second resistivity, wherein the first resistivity is higher than the second resistivity.

Optionally, the resistive heater track comprises a first portion with a first resistance and a second portion with a second resistance, wherein the first resistance is higher than the second resistance.

By configuring, the resistive heater track into the first portion and second portion, it may be possible to vary the heat at selected portions. This may help in effective supply of the heat to the HNB consumable in use.

Advantageously, the first portion may be located adjacent a base of the rod and the second portion may be located adjacent a distal end of the rod. By this configuration of the first and second portion, it may be possible to generate more heat at the base portion of the rod than at the distal end, and thereby it may help to supply maximum heat to the portion of the HNB consumable which is near to the base of the rod in use. This may enhance aerosol generation from the HNB consumable.

Optionally, the heater apparatus comprises a tip component located at the distal end of the rod. By configuring the tip component at distal end of the rod, it may be easy to penetrate the HNB consumable onto the heater apparatus.

Optionally, the tip component may be separate from the rod. By configuring the tip component to be separate from the rod, it may be possible to provide a wear resistant material for the tip component.

Conveniently, the tip component may be conical in shape. This configuration of the tip component, reduces the efforts to penetrate the HNB consumable onto the heater apparatus. This may also allow the HNB consumable to be removed more freely with minimum efforts from the user.

Optionally, the cone angle of the tip component may be about 10 degrees to about 80 degrees.

Optionally, cone angle of the tip component may be between 20 and 70 degrees, preferably, between 30 and 60 degrees, more preferably between 40 and 50 degrees. The cone angle of the tip component defines the resistance to penetration of the heater apparatus into the HNB consumable, and thereby smoothens the insertion of the consumable into the device.

Optionally, the rod of the heater element may be frustoconical in shape.

Advantageously, the rod has a draft angle of about 0.5 to about 10 degrees defined between the base of the rod and distal end of the rod. Preferably, the draft angle may be between 2 and 4 degrees. Conveniently, the draft angle between the base of the rod and the distal end of the rod defines the tapered transverse cross section of the rod. The tapered transverse cross section of the rod may allow the HNB consumable to be removed more freely with minimum efforts from the user.

Optionally, the rod may be of a circular in cross-section. By configuring the rod in circular cross section, the HNB consumable may be inserted and removed freely.

Optionally, the base of the rod has a diameter of about 1.5 to about 3 mm.

The device may comprise an elongate body. An end of the elongate body may be configured for engagement with an aerosol-forming article. For example, the body may be configured for engagement with a heated tobacco (HT) consumable (or heat-not-burn (HNB) consumable). The terms "heated tobacco" and "heat-not-burn" are used interchangeably herein to describe a consumable that is of the type that is heated rather than combusted (or are used interchangeably to describe a device for use with such a consumable). The device may comprise a cavity that is configured for receipt of at least a portion of the consumable (i.e., for engagement with the consumable). The aerosol-forming article may be of the type that comprises an aerosol former (e.g., carried by an aerosol-forming substrate).

The device may comprise a heater for heating the aerosol-forming article. The heater may comprise a heating element, which may be in the form of a rod that extends from the body of the device. The heating element may extend from the end of the body that is configured for engagement with the aerosol-forming article.

The heater (and thus the heating element) may be rigidly mounted to the body. The heating element may be elongate so as to define a longitudinal axis and may, for example, have a transverse profile (i.e., transverse to a longitudinal axis of the heating element) that is substantially circular (i.e., the heating element may be generally cylindrical). Alternatively, the heating element may have a transverse profile that is rectangular (i.e., the heater may be a "blade heater"). The heating element may alternatively be in the shape of a tube (i.e., the heater may be a "tube heater"). The heating element may take other forms (e.g., the heating element may have an elliptical transverse profile). The shape and/or size (e.g., diameter) of the transverse profile of the heating element may be generally consistent for the entire length (or substantially the entire length) of the heating element.

The heating element may be between 15 mm and 25 mm long, e.g., between 18 mm and 20 mm long, e.g., around 19 mm long. The heating element may have a diameter of between 1.5 mm and 2.5 mm, e.g., a diameter between 2 mm and 2.3 mm, e.g., a diameter of around 2.15 mm.

The heating element may be formed of ceramic. The heating element may comprise a core (e.g., a ceramic core) comprising Al2O3. The core of the heating element may have a diameter of 1.8 mm to 2.1 mm, e.g., between 1.9 mm and 2 mm. The heating element may comprise an outer layer (e.g., an outer ceramic layer) comprising Al2O3. The thickness of the outer layer may be between 160 μm and 220 μm, e.g., between 170 μm and 190 μm, e.g., around 180 μm. The heating element may comprise a heating track, which may extend longitudinally along the heating element. The heating track may be sandwiched between the outer layer and the core of the heating element. The heating track may comprise tungsten and/or rhenium. The heating track may have a thickness of around 20 μm.

The heating element may be located in the cavity (of the device), and may extend (e.g., along a longitudinal axis) from an internal base of the cavity towards an opening of the cavity. The length of the heating element (i.e., along the longitudinal axis of the heater) may be less than the depth of the cavity. Hence, the heating element may extend for only a portion of the length of the cavity. That is, the heating element may not extend through (or beyond) the opening of the cavity.

The heating element may be configured for insertion into an aerosol-forming article (e.g., a HT consumable) when an aerosol-forming article is received in the cavity. In that respect, a distal end (i.e., distal from a base of the heating element where it is mounted to the device) of the heating element may comprise a tapered portion, which may facilitate insertion of the heating element into the aerosol-forming article. The heating element may fully penetrate an aerosol-forming article when the aerosol-forming article is received in the cavity. That is, the entire length, or substantially the entire length, of the heating element may be received in the aerosol-forming article.

The heating element may have a length that is less than, or substantially the same as, an axial length of an aerosol-forming substrate forming part of an aerosol-forming article (e.g., a HT consumable). Thus, when such an aerosol-forming article is engaged with the device, the heating element may only penetrate the aerosol-forming substrate, rather than other components of the aerosol-forming article. The heating element may penetrate the aerosol-forming substrate for substantially the entire axial length of the aerosol forming-substrate of the aerosol-forming article. Thus, heat may be transferred from (e.g., an outer circumferential surface of) the heating element to the surrounding aerosol-forming substrate, when penetrated by the heating element. That is, heat may be transferred radially outwardly (in the case of a cylindrical heating element) or e.g., radially inwardly (in the case of a tube heater).

Where the heater is a tube heater, the heating element of the tube heater may surround at least a portion of the cavity. When the portion of the aerosol-forming article is received in the cavity, the heating element may surround a portion of the aerosol-forming article (i.e., so as to heat that portion of the aerosol-forming article). In particular, the heating element may surround an aerosol forming substrate of the aerosol-forming article. That is, when an aerosol-forming article is engaged with the device, the aerosol forming substrate of the aerosol-forming article may be located adjacent an inner surface of the (tubular) heating element. When the heating element is activated, heat may be transferred radially inwardly from the inner surface of the heating element to heat the aerosol forming substrate.

The cavity may comprise a (e.g., circumferential) wall (or walls) and the (tubular) heating element may extend around at least a portion of the wall(s). In this way, the wall may be located between the inner surface of the heating element and an outer surface of the aerosol-forming article. The wall (or walls) of the cavity may be formed from a thermally conductive material (e.g., a metal) to allow heat conduction from the heating element to the aerosol-forming article. Thus, heat may be conducted from the heating element, through the cavity wall (or walls), to the aerosol-forming substrate of an aerosol-forming article received in the cavity.

In some embodiments the device may comprise a cap disposed at the end of the body that is configured for engagement with an aerosol-forming article. Where the device comprises a heater having a heating element, the cap may at least partially enclose the heating element. The cap may be moveable between an open position in which access is provided to the heating element, and a closed position in which the cap at least partially encloses the heating element. The cap may be slideably engaged with the body of the device, and may be slideable between the open and closed positions.

The cap may define at least a portion of the cavity of the device. That is, the cavity may be fully defined by the cap, or each of the cap and body may define a portion of the cavity. Where the cap fully defines the cavity, the cap may comprise an aperture for receipt of the heating element into the cavity (when the cap is in the closed position). The cap may comprise an opening to the cavity. The opening may be configured for receipt of at least a portion of an aerosol-forming article. That is, an aerosol-forming article may be inserted through the opening and into the cavity (so as to be engaged with the device).

The cap may be configured such that when an aerosol-forming article is engaged with the device (e.g., received in the cavity), only a portion of the aerosol-forming article is received in the cavity. That is, a portion of the aerosol-forming article (not received in the cavity) may protrude from (i.e., extend beyond) the opening. This (protruding) portion of the aerosol-forming article may be a terminal (e.g., mouth) end of the aerosol-forming article, which may be received in a user's mouth for the purpose of inhaling aerosol formed by the device.

The device may comprise a power source or may be connectable to a power source (e.g., a power source separate to the device). The power source may be electrically connectable to the heater. In that respect, altering (e.g., toggling) the electrical connection of the power source to the heater may affect a state of the heater. For example, toggling the electrical connection of the power source to the heater may toggle the heater between an on state and an off state. The power source may be a power store. For example, the power source may be a battery or rechargeable battery (e.g., a lithium ion battery).

The device may comprise an input connection (e.g., a USB port, Micro USB port, USB-C port, etc.). The input connection may be configured for connection to an external source of electrical power, such as a mains electrical supply outlet. The input connection may, in some cases, be used as a substitute for an internal power source (e.g., battery or rechargeable battery). That is, the input connection may be electrically connectable to the heater (for providing power to the heater). Hence, in some forms, the input connection may form at least part of the power source of the device.

Where the power source comprises a rechargeable power source (such as a rechargeable battery), the input connection may be used to charge and recharge the power source.

The device may comprise a user interface (UI). In some embodiments the UI may include input means to receive operative commands from the user. The input means of the UI may allow the user to control at least one aspect of the operation of the device. In some embodiments the input means may comprise a power button to switch the device between an on state and an off state.

In some embodiments the UI may additionally or alternatively comprise output means to convey information to the user. In some embodiments the output means may comprise a light to indicate a condition of the device (and/or the aerosol-forming article) to the user. The condition of the device (and/or aerosol-forming article) indicated to the user may comprise a condition indicative of the operation of the heater. For example, the condition may comprise whether the heater is in an off state or an on state. In some embodiments, the UI unit may comprise at least one of a button, a display, a touchscreen, a switch, a light, and the like. For example, the output means may comprise one or more (e.g., two, three, four, etc. light-emitting diodes ("LEDs") that may be located on the body of the device.

The device may further comprise a puff sensor (e.g., airflow sensor), which form part of the input means of the UI. The puff sensor may be configured to detect a user drawing on an end (i.e., a terminal (mouth) end) of the aerosol-forming article. The puff sensor may, for example, be a pressure sensor or a microphone. The puff sensor may be configured to produce a signal indicative of a puff state. The signal may be indicative of the user drawing (an aerosol from the aerosol-forming article) such that it is e.g., in the form of a binary signal. Alternatively or additionally, the signal may be indicative of a characteristic of the draw (e.g., a flow rate of the draw, length of time of the draw, etc.).

The device may comprise a controller, or may be connectable to a controller that may be configured to control at least one function of the device. The controller may comprise a microcontroller that may e.g.

20 be mounted on a printed circuit board (PCB). The controller may also comprise a memory, e.g., non-volatile memory. The memory may include instructions, which, when implemented, may cause the controller to perform certain tasks or steps of a method. Where the device comprises an input connection, the controller may be connected to the input connection.

The controller may be configured to control the operation of the heater (and e.g., the heating element). Thus, the controller may be configured to control vaporization of an aerosol forming part of an aerosol-forming article engaged with the device. The controller may be configured to control the voltage applied by power source to the heater. For example, the controller may be configured to toggle between applying a full output voltage (of the power source) to the heater and applying no voltage to the heater. Alternatively or additionally, the control unit may implement a more complex heater control protocol.

The device may further comprise a voltage regulator to regulate the output voltage supplied by the power source to form a regulated voltage. The regulated voltage may subsequently be applied to the heater.

In some embodiments, where the device comprises a UI, the controller may be operatively connected to one or more components of the UI. The controller may be configured to receive command signals from an input means of the UI. The controller may be configured to control the heater in response to the command signals. For example, the controller may be configured to receive "on" and "off" command signals from the UI and, in response, may control the heater so as to be in a corresponding on or off state.

The controller may be configured to send output signals to a component of the UI. The UI may be configured to convey information to a user, via an output means, in response to such output signals (received from the controller). For example, where the device comprises one or more LEDs, the LEDs may be operatively connected to the controller. Hence, the controller may configured to control the illumination of the LEDs (e.g., in response to an output signal). For example, the controller may be configured to control the illumination of the LEDs according to (e.g., an on or off) state of the heater.

Where the device comprises a sensor (e.g., a puff/airflow sensor), the controller may be operatively connected to the sensor. The controller may be configured to receive a signal from the sensor (e.g., indicative of a condition of the device and/or engaged aerosol-forming article). The controller may be configured to control the heater, or an aspect of the output means, based on the signal from the sensor.

The device may comprise a wireless interface configured to communicate wirelessly (e.g., via Bluetooth (e.g., a Bluetooth low-energy connection) or WiFi) with an external device. Similarly, the input connection may be configured for wired connection to an external device so as to provide communication between the device and the external device.

The external device may be a mobile device. For example, the external device may be a smart phone, tablet, smart watch, or smart car. An application (e.g., app) may be installed on the external device (e.g., mobile device). The application may facilitate communication between the device and the external device via the wired or wireless connection.

The wireless or wired interface may be configured to transfer signals between the external device and the controller of the device. In this respect, the controller may control an aspect of the device in response to a signal received from an external device. Alternatively or additionally, an external device may respond to a signal received from the device (e.g., from the controller of the device).

In a second aspect, there is provided a system (e.g., a smoking substitute system) comprising a device according to the first aspect and an aerosol-forming article. The aerosol-forming article may comprise an aerosol-forming substrate at an upstream end of the aerosol-forming article. The article may be in the form of a smoking substitute article, e.g., heated tobacco (HT) consumable (also known as a heat-not-burn (HNB) consumable).

As used herein, the terms "upstream" and "downstream" are intended to refer to the flow direction of the vapor/aerosol i.e., with the downstream end of the article/consumable being the mouth end or outlet where the aerosol exits the consumable for inhalation by the user. The upstream end of the article/consumable is the opposing end to the downstream end.

The aerosol-forming substrate is capable of being heated to release at least one volatile compound that can form an aerosol. The aerosol-forming substrate may be located at the upstream end of the article/consumable.

In order to generate an aerosol, the aerosol-forming substrate comprises at least one volatile compound that is intended to be vaporized/aerosolized and that may provide the user with a recreational and/or medicinal effect when inhaled. Suitable chemical and/or physiologically active volatile compounds include the group consisting of: nicotine, cocaine, caffeine, opiates and opioids, cathine and cathinone, kavalactones, mysticin, beta-carboline alkaloids, salvinorin A together with any combinations, functional equivalents to, and/or synthetic alternatives of the foregoing.

The aerosol-forming substrate may comprise plant material. The plant material may comprise least one plant material selected from the list including *Amaranthus dubius, Arctostaphylos uva-ursi* (Bearberry), *Argemone mexicana, Amica, Artemisia vulgaris*, Yellow Tees, *Galea zacatechichi, Canavalia maritima* (Baybean), *Cecropia mexicana* (Guamura), *Cestrum noctumum, Cynoglossum virginianum* (wild comfrey), *Cytisus scoparius, Damiana, Entada rheedii, Eschscholzia califomica* (California Poppy), *Fittonia albivenis, Hippobroma longiflora, Humulus japonica* (Japanese Hops), *Humulus lupulus* (Hops), *Lactuca virosa* (Lettuce Opium), *Laggera alata, Leonotis leonurus, Leonurus cardiaca* (Motherwort), *Leonurus sibiricus* (Honeyweed), *Lobelia cardinalis, Lobelia inflata* (Indian-tobacco), *Lobelia siphilitica, Nepeta cataria* (Catnip), *Nicotiana* species (Tobacco), *Nymphaea alba* (White Lily), *Nymphaea caerulea* (Blue Lily), Opium poppy, *Passiflora incamata* (Passionflower), *Pedicularis densiflora* (Indian Warrior), *Pedicularis groenlandica* (Elephant's Head), *Salvia divinorum, Salvia dorrii* (Tobacco Sage), Salvia species (Sage), *Scutellaria galericulata, Scutellaria lateriflora, Scutellaria nana, Scutellaria* species (Skullcap), *Sida acuta* (Wireweed), *Sida rhombifolia, Silene capensis, Syzygium aromaticum* (Clove), *Tagetes lucida* (Mexican Tarragon), *Tarchonanthus camphoratus, Tumera diffusa* (Damiana), *Verbascum* (Mullein), *Zamia latifolia* (Maconha Brava) together with any combinations, functional equivalents to, and/or synthetic alternatives of the foregoing.

The plant material may be tobacco. Any type of tobacco may be used. This includes, but is not limited to, flue-cured tobacco, burley tobacco, Maryland Tobacco, dark-air cured tobacco, oriental tobacco, dark-fired tobacco, perique tobacco and rustica tobacco. This also includes blends of the above mentioned tobaccos.

The tobacco may comprise one or more of leaf tobacco, stem tobacco, tobacco powder, tobacco dust, tobacco derivatives, expanded tobacco, homogenized tobacco, shredded tobacco, extruded tobacco, cut rag tobacco and/or reconstituted tobacco (e.g., slurry recon or paper recon).

The aerosol-forming substrate may comprise a gathered sheet of homogenized (e.g., paper/slurry recon) tobacco or gathered shreds/strips formed from such a sheet.

The aerosol-forming substrate may comprise one or more additives selected from humectants, flavorants, fillers, aqueous/non-aqueous solvents and binders.

The flavorant may be provided in solid or liquid form. It may include menthol, licorice, chocolate, fruit flavor (including e.g., citrus, cherry etc.), vanilla, spice (e.g., ginger, cinnamon) and tobacco flavor. The flavorant may be evenly dispersed throughout the aerosol-forming substrate or may be provided in isolated locations and/or varying concentrations throughout the aerosol-forming substrate.

The aerosol-forming substrate may be formed in a substantially cylindrical shape such that the article/consumable resembles a conventional cigarette. It may have a diameter of between 5 and 10 mm e.g., between 6 and 9 mm or 6 and 8 mm e.g., around 7 mm. It may have an axial length of between 10 and 15 mm e.g., between 11 and 14 mm such as around 12 or 13 mm.

The article/consumable may comprise at least one filter element. There may be a terminal filter element at the downstream/mouth end of the article/consumable.

The or at least one of the filter element(s) (e.g., the terminal filter element) may be comprised of cellulose acetate or polypropylene tow. The at least one filter element (e.g., the terminal filter element) may be comprised of activated charcoal. The at least one filter element (e.g., the terminal element) may be comprised of paper. The or each filter element may be at least partly (e.g., entirely) circumscribed with a plug wrap e.g., a paper plug wrap.

The terminal filter element (at the downstream end of the article/consumable) may be joined to the upstream elements forming the article/consumable by a circumscribing tipping layer e.g., a tipping paper layer. The tipping paper may have an axial length longer than the axial length of the terminal filter element such that the tipping paper completely circumscribes the terminal filter element plus the wrapping layer surrounding any adjacent upstream element.

In some embodiments, the article/consumable may comprise an aerosol-cooling element which is adapted to cool the aerosol generated from the aerosol-forming substrate (by heat exchange) before being inhaled by the user.

The article/consumable may comprise a spacer element that defines a space or cavity between the aerosol-forming substrate and the downstream end of the consumable. The spacer element may comprise a cardboard tube. The spacer element may be circumscribed by the (paper) wrapping layer.

According to a third aspect of the present disclosure, there is provided a method of using the system according to the second aspect, the method comprising inserting the aerosol-forming article into the device; and heating the article using the heater of the device.

In some embodiments the method may comprise inserting the article into a cavity within a body of the device and penetrating the article with the heating element of the device upon insertion of the article.

According to a fourth aspect of the eighth mode of the present disclosure, there is provided a heat not burn smoking device including a heater according to the first aspect. The HNB smoking device including a heating apparatus of tapered transverse cross section may allow the HNB consumable to be removed more freely with minimum efforts from the user.

The eighth mode of the disclosure includes the combination of the aspects and preferred features described except where such a combination is clearly impermissible or expressly avoided.

The skilled person will appreciate that except where mutually exclusive, a feature or parameter described in relation to any one of the above aspects of the eighth mode may be applied to any other aspect of the eighth mode. Furthermore, except where mutually exclusive, any feature or parameter described herein may be applied to any aspect and/or combined with any other feature or parameter described herein.

Ninth Mode of the Disclosure: A Heated Tobacco Device Operable in Different Modes At its most general, one aspect of the ninth mode of the present disclosure relates to a heated tobacco device for operable in different modes, and another aspect of the present disclosure relates to a heat not burn device for controlling the vapor generation.

According to a first aspect of the ninth mode of the present disclosure, there is provided a heated tobacco device, comprising: a heater; a controller configured to operate the heater according to at least two user-selectable operating modes, the operating mode being selectable by the user via user input means, wherein the heater is for engagement with a heated tobacco consumable, the heated tobacco consumable including an active component for delivery to the user; wherein the at least two user-selectable operating modes include: a first mode in which the heater is operated to deliver a first amount of active component to the user, and a second mode in which the heater is operated to deliver a second amount of active component to the user, and wherein the second amount of active component is higher than the first amount of active component.

By providing a heated tobacco device comprising a controller to operate the device at least in two user-selectable modes, the device may operate in intense mode for providing higher delivery of active component of the consumable.

Optional features will now be set out. These are applicable singly or in any combination with any aspect.

Optionally, in the second mode the controller operates the heater to deliver the active component at a higher rate than in the first mode.

Optionally, the controller is configured to operate the heater at a first operating temperature in the first mode and at a second operating temperature in the second mode, wherein the second operating temperature is higher than the first operating temperature.

Optionally, the controller is configured to operate the heater for a first consumable cycle duration in the first mode and for a second consumable cycle duration in the second mode, wherein the second consumable cycle duration is longer than the first consumable cycle duration.

Optionally, the controller is configured to select from the at least two operating modes based on a user default mode.

Optionally, the controller is configured to permit the user to set the user default mode.

Optionally, the controller is configured to set the user default mode based on historic usage of the device.

Optionally, the active component is nicotine.

Optionally, the device further comprises: a consumable detector sensor for detecting a type of consumable engaged with the heater or for detecting the active component content of the consumable.

Optionally, the controller is configured to select from the at least two operating modes based on the type of consumable detected or on the active component content of the type of consumable detected.

Optionally, the user input means includes a button.

Optionally, the user input means includes a touch screen.

Optionally, the user input means includes a motion sensor for detecting a predetermined movement of the device.

Optionally, the user input means includes a voice recognition means.

Advantageously, the controller is configured to enable the device to operate in the second mode based on the type and/or content of the consumable.

According to a second aspect of the ninth mode of the present disclosure, there is provided a heat not burn device, comprising: a heater; and a controller, the controller configured to operate the heater to heat an aerosol forming substrate engaged with the heater to a predetermined operating temperature, wherein the controller is configured to operate the heater in at least two modes, the at least two modes include a first mode in which vapor is formed from the aerosol forming substrate with a first visibility, and a second mode in which vapor is formed from the aerosol forming substrate with a second visibility, where the first visibility is lower than the second visibility.

By providing a heat not burn device comprising a controller to control vapor generation, it is possible to operate the device in two modes of differing vapor generation. In the first mode, the visibility of the vapor produced is lower. This mode may also be referred to as a "stealth mode" given that the use of the device becomes less obvious to outside observers due to the low vapor visibility. In the second mode, the visibility of the vapor produced is higher than in the first mode.

A benefit of operation of the device in the first mode may be an increased intensity of flavor and an increased intensity of nicotine. Without wishing to be bound by theory, it is believed that when the device operates in a mode which produces less visible vapor, the relative concentration of nicotine and flavorant in the aerosol may be higher. The low visibility vapor may also be desirable for a user wishing to reduce the amount of visible vapor generated for aesthetic purposes, e.g., when in a public place.

The terms "first visibility" and "second visibility" refer to the visibility of vapor generated by the aerosol forming substrate (e.g., HNB consumable) during a smoking session, e.g., the visibility of vapor subsequently exhaled by a user after being inhaled from the aerosol forming substrate. Such visibility may generally be assessed by eye, but may also be assessed using more accurate methods known to the skilled person by determining the amount to which a vapor scatters incident light. A vapor of higher "visibility" as defined herein will scatter or attenuate incident light to a greater extent, thereby appearing more visible (i.e., "cloudier" or "hazier") to an observer.

Optionally, the controller is configured operate the heater at a first predetermined operating temperature in the first mode, and a second predetermined operating temperature in the second mode, wherein the first predetermined operating temperature is lower than the second predetermined operating temperature.

Control of the temperature of the heater when in the different modes is a way to provide the differing vapor visibilities. Without wishing to be bound by theory, it is believed that the differing vaporization temperatures of nicotine on the one hand and aerosol-forming substances on the other hand may be utilized to tailor the visibility of the vapor. Selecting a temperature at which a lower quantity of aerosol-forming substance is vaporized from the aerosol-forming substrate makes it possible to reduce the amount of vapor produced, thereby reducing its visibility.

In some embodiments, the first predetermined operating temperature is lower than the second predetermined operating temperature by at least 25° C., for example at least 30° C., at least 35° C., at least 40° C., at least 45° C., at least 50° C., at least 55° C. or at least 60° C.

In some embodiments, the first predetermined operating temperature is between 140 and 170° C. Within this temperature range an acceptable level of nicotine is vaporized from the aerosol-forming substrate whereas the amount of other substances which contribute to the visibility of the vapor (aerosol-forming substances).

In some embodiments, the second predetermined operating temperature is greater than 170° C. In some embodiments, the second predetermined operating temperature is at least 180° C., for example at least 185° C., at least 190° C., at least 195° C. or at least 200° C. In some embodiments, the second predetermined operating temperature is greater than 170° C. and less than or equal to about 220° C. In some embodiments, the second predetermined operating temperature is 175 to 220° C., for example 175 to 215° C., 175 to 210° C., 180 to 210° C., 190 to 210° C. or 195 to 205° C. In some embodiments, the second predetermined operating temperature is about 200° C.

In some embodiments, the first predetermined operating temperature is between 140 and 170° C.; and the second predetermined operating temperature is greater than 170° C. and less than or equal to about 220° C. In some embodiments, the first predetermined operating temperature is between 140 and 170° C.; and the second predetermined operating temperature is at least 200° C.

In some embodiments, the controller is configured to alter the pressure drop across the consumable. In some embodiments, the controller is configured to alter the pressure drop across the aerosol forming article between a first condition and a second condition, wherein the pressure drop across the aerosol forming article in the first condition is higher than in the second condition. A higher pressure drop provides a reduced level of visible vapor from the aerosol forming article, and as such the first condition corresponds with the first mode of the device.

In some embodiments, the controller is configured to alter the airflow so as to control the pressure drop based on the selected mode. In some embodiments, the controller is configured to alter the airflow into the device between a first condition and a second condition, wherein the airflow into the device in the first condition is lower than in the second condition.

In some embodiments, the controller is configured to alter the airflow such that the pressure drop when in the first mode is higher than the pressure drop when in the second mode.

In some embodiments, the controller is configured to detect the type of consumable present in the device and incorporate this into the parameters of one or more device functions when switching between the first mode and the second mode. In other words, the actions taken by the controller when switching between modes may depend upon the type of consumable present in the device. For example, certain consumables may require a greater decrease in temperature between second and first modes in order to achieve a given reduction in vapor visibility. Similarly, certain consumables may require a greater increase in pressure drop between second and first modes in order to achieve a given reduction in vapor visibility.

In some embodiments, the device is adapted to move the heater and the aerosol forming substrate relative to one another so as to change the amount of contact between the heater and the substrate according to the mode selected. Altering the extent of contact between the heater and the aerosol forming substrate will alter the amount of visible vapor produced by the device. A greater amount of contact between the heater and the substrate will increase the amount of vapor produced for a given heater temperature. Movement of the heater relative to the aerosol forming substrate may be achieved by effecting movement of the heater, the aerosol forming substrate, or both. For example, the device may be adapted to move the heater. In some embodiments, the heater is adapted to move in a linear manner along the longitudinal axis of the device, such that the extent to which the heater is inserted into the aerosol forming substrate may be altered. In some embodiments, the device is adapted to move the aerosol forming substrate relative to the heater, to provide greater or lesser contact between the heater and aerosol forming substrate as necessary.

Optionally, the amount of contact of heater with the aerosol forming substrate in the first mode is lesser than the amount of contact of heater with the aerosol forming substrate in the second mode.

In some embodiments, the heater is a rod heater adapted to be inserted into an upstream end of a HNB consumable during a smoking session, and the device is adapted to move the heater and the consumable relative to one another in response to mode selection to achieve a certain extent of insertion of the heater into the upstream end of the consumable. The device may be adapted to move the heater and the consumable closer to one another in response to a selection of the second mode, thereby increasing the visibility of the produced vapor. The device may be adapted to move the heater and the consumable away from one another in response to a selection of the first mode, thereby reducing the visibility of the produced vapor. In some embodiments, a portion of the heater of a length of around 10 mm is inserted into the consumable in the second mode. In some embodiments, a portion of the heater of a length of around 5 mm is inserted into the consumable in the first mode.

In some embodiments, the device comprises a user input means for selection of the mode by a user. In some embodiments, the user input means comprises a user interface through which the user may select the mode, for example the first mode or the second mode. In some embodiments, the user interface comprises one or more buttons or switches for selecting a particular mode.

In some embodiments, the device further comprises an output means configured to indicate a current selected operating mode to the user (e.g., first or second mode). The device may comprise a display which indicates to the user the current selected mode. For example, the device may comprise one or more lights (e.g., LEDs) which light up according to the selected mode, or a screen which includes an indication of the selected mode.

In some embodiments, the controller is configured to maintain the selected mode for at least one whole smoking cycle, i.e., the time for which the heater is activated for the smoking of a single HNB consumable. This ensures that the user obtains the desired smoking experience for the whole cycle and that it is not interrupted by any unwanted switching between modes.

The device may comprise an elongate body. An end of the elongate body may be configured for engagement with an aerosol-forming article. For example, the body may be configured for engagement with a heated tobacco (HT) consumable (or heat-not-burn (HNB) consumable). The terms "heated tobacco" and "heat-not-burn" are used interchangeably herein to describe a consumable that is of the type that is heated rather than combusted (or are used interchangeably to describe a device for use with such a consumable). The device may comprise a cavity that is configured for receipt of at least a portion of the consumable (i.e., for engagement with the consumable). The aerosol-forming article may be of the type that comprises an aerosol former (e.g., carried by an aerosol-forming substrate).

The device may comprise a heater for heating the aerosol-forming article. The heater may comprise a heating element, which may be in the form of a rod that extends from the body of the device. The heating element may extend from the end of the body that is configured for engagement with the aerosol-forming article.

The heater (and thus the heating element) may be rigidly mounted to the body. The heating element may be elongate so as to define a longitudinal axis and may, for example, have a transverse profile (i.e., transverse to a longitudinal axis of the heating element) that is substantially circular (i.e., the heating element may be generally cylindrical). Alternatively, the heating element may have a transverse profile that is rectangular (i.e., the heater may be a "blade heater"). The heating element may alternatively be in the shape of a tube (i.e., the heater may be a "tube heater"). The heating element may take other forms (e.g., the heating element may have an elliptical transverse profile). The shape and/or size (e.g., diameter) of the transverse profile of the heating element may be generally consistent for the entire length (or substantially the entire length) of the heating element.

The heating element may be between 15 mm and 25 mm long, e.g., between 18 mm and 20 mm long, e.g., around 19 mm long. The heating element may have a diameter of between 1.5 mm and 2.5 mm, e.g., a diameter between 2 mm and 2.3 mm, e.g., a diameter of around 2.15 mm.

The heating element may be formed of ceramic. The heating element may comprise a core (e.g., a ceramic core) comprising Al2O3. The core of the heating element may have a diameter of 1.8 mm to 2.1 mm, e.g., between 1.9 mm and 2 mm. The heating element may comprise an outer layer (e.g., an outer ceramic layer) comprising Al2O3. The thickness of the outer layer may be between 160 μm and 220 μm, e.g., between 170 μm and 190 μm, e.g., around 180 μm. The heating element may comprise a heating track, which may extend longitudinally along the heating element. The heating track may be sandwiched between the outer layer and the core of the heating element. The heating track may comprise tungsten and/or rhenium. The heating track may have a thickness of around 20 μm.

The heating element may be located in the cavity (of the device), and may extend (e.g., along a longitudinal axis) from an internal base of the cavity towards an opening of the cavity. The length of the heating element (i.e., along the longitudinal axis of the heater) may be less than the depth of the cavity. Hence, the heating element may extend for only a portion of the length of the cavity. That is, the heating element may not extend through (or beyond) the opening of the cavity.

The heating element may be configured for insertion into an aerosol-forming article (e.g., a HT consumable) when an aerosol-forming article is received in the cavity. In that respect, a distal end (i.e., distal from a base of the heating element where it is mounted to the device) of the heating element may comprise a tapered portion, which may facilitate insertion of the heating element into the aerosol-forming article. The heating element may fully penetrate an aerosol-forming article when the aerosol-forming article is received in the cavity. That is, the entire length, or substantially the entire length, of the heating element may be received in the aerosol-forming article.

The heating element may have a length that is less than, or substantially the same as, an axial length of an aerosol-forming substrate forming part of an aerosol-forming article (e.g., a HT consumable). Thus, when such an aerosol-forming article is engaged with the device, the heating element may only penetrate the aerosol-forming substrate, rather than other components of the aerosol-forming article. The heating element may penetrate the aerosol-forming substrate for substantially the entire axial length of the aerosol forming-substrate of the aerosol-forming article. Thus, heat may be transferred from (e.g., an outer circumferential surface of) the heating element to the surrounding aerosol-forming substrate, when penetrated by the heating element. That is, heat may be transferred radially outwardly (in the case of a cylindrical heating element) or e.g., radially inwardly (in the case of a tube heater).

Where the heater is a tube heater, the heating element of the tube heater may surround at least a portion of the cavity. When the portion of the aerosol-forming article is received in the cavity, the heating element may surround a portion of the aerosol-forming article (i.e., so as to heat that portion of the aerosol-forming article). In particular, the heating element may surround an aerosol forming substrate of the aerosol-forming article. That is, when an aerosol-forming article is engaged with the device, the aerosol forming substrate of the aerosol-forming article may be located adjacent an inner surface of the (tubular) heating element. When the heating element is activated, heat may be transferred radially inwardly from the inner surface of the heating element to heat the aerosol forming substrate.

The cavity may comprise a (e.g., circumferential) wall (or walls) and the (tubular) heating element may extend around at least a portion of the wall(s). In this way, the wall may be located between the inner surface of the heating element and an outer surface of the aerosol-forming article. The wall (or walls) of the cavity may be formed from a thermally conductive material (e.g., a metal) to allow heat conduction from the heating element to the aerosol-forming article. Thus, heat may be conducted from the heating element, through the cavity wall (or walls), to the aerosol-forming substrate of an aerosol-forming article received in the cavity.

In some embodiments the device may comprise a cap disposed at the end of the body that is configured for engagement with an aerosol-forming article. Where the device comprises a heater having a heating element, the cap may at least partially enclose the heating element. The cap may be moveable between an open position in which access is provided to the heating element, and a closed position in which the cap at least partially encloses the heating element. The cap may be slideably engaged with the body of the device, and may be slideable between the open and closed positions.

The cap may define at least a portion of the cavity of the device. That is, the cavity may be fully defined by the cap, or each of the cap and body may define a portion of the cavity. Where the cap fully defines the cavity, the cap may comprise an aperture for receipt of the heating element into the cavity (when the cap is in the closed position). The cap may comprise an opening to the cavity. The opening may be configured for receipt of at least a portion of an aerosol-forming article. That is, an aerosol-forming article may be inserted through the opening and into the cavity (so as to be engaged with the device).

The cap may be configured such that when an aerosol-forming article is engaged with the device (e.g., received in the cavity), only a portion of the aerosol-forming article is received in the cavity. That is, a portion of the aerosol-forming article (not received in the cavity) may protrude from (i.e., extend beyond) the opening. This (protruding) portion of the aerosol-forming article may be a terminal (e.g., mouth) end of the aerosol-forming article, which may be received in a user's mouth for the purpose of inhaling aerosol formed by the device.

The device may comprise a power source or may be connectable to a power source (e.g., a power source separate to the device). The power source may be electrically connectable to the heater. In that respect, altering (e.g., toggling) the electrical connection of the power source to the heater may affect a state of the heater. For example, toggling the electrical connection of the power source to the heater may toggle the heater between an on state and an off state. The power source may be a power store. For example, the power source may be a battery or rechargeable battery (e.g., a lithium ion battery).

The device may comprise an input connection (e.g., a USB port, Micro USB port, USB-C port, etc.). The input connection may be configured for connection to an external source of electrical power, such as a mains electrical supply outlet. The input connection may, in some cases, be used as a substitute for an internal power source (e.g., battery or rechargeable battery). That is, the input connection may be electrically connectable to the heater (for providing power to the heater). Hence, in some forms, the input connection may form at least part of the power source of the device.

Where the power source comprises a rechargeable power source (such as a rechargeable battery), the input connection may be used to charge and recharge the power source.

The device may comprise a user interface (UI). In some embodiments the UI may include input means to receive operative commands from the user. The input means of the UI may allow the user to control at least one aspect of the operation of the device. In some embodiments the input means may comprise a power button to switch the device between an on state and an off state. In some embodiments, the input means may comprise a motion sensor for receiving operative commands from the user by detecting movement of the device. In some embodiments, the input means may comprise a microphone for receiving operative commands by a sound of the user. In some embodiments, the input means may comprise a touch screen for user to provide operative commands by touch. In some embodiments, the operative command may comprise changing of modes for modifying user experience by changing an operating mode of the device.

In some embodiments the UI may additionally or alternatively comprise output means to convey information to the user. In some embodiments the output means may comprise a light to indicate a condition of the device (and/or the aerosol-forming article) to the user. In some embodiments, the output means may comprise a haptic feedback to indicate the condition of the device. In some embodiments the output means may comprise a display screen to display the condition of the device. The condition of the device (and/or aerosol-forming article) indicated to the user may comprise a condition indicative of the operation of the heater. For example, the condition may comprise whether the heater is in an off state or an on state. In some embodiments, the UI unit may comprise at least one of a button, a display, a touchscreen, a switch, a light, and the like. For example, the output means may comprise one or more (e.g., two, three, four, etc.) light-emitting diodes ("LEDs") that may be located on the body of the device.

The device may further comprise a puff sensor (e.g., airflow sensor), which forms part of the input means of the UI. The puff sensor may be configured to detect a user drawing on an end (i.e., a terminal (mouth) end) of the aerosol-forming article. The puff sensor may, for example, be a pressure sensor or a microphone. The puff sensor may be configured to produce a signal indicative of a puff state. The signal may be indicative of the user drawing (an aerosol from the aerosol-forming article) such that it is e.g., in the form of a binary signal. Alternatively or additionally, the signal may be indicative of a characteristic of the draw (e.g., a flow rate of the draw, length of time of the draw, etc). The pressure sensor/airflow sensor, for example, may detect the pressure drop across the consumable. Alternatively, the sensor may detect the airflow into the device.

The device may further comprise a consumable detector sensor (e.g., nicotine sensor, tobacco sensor), which may form part of the input means of the UI. The consumable detector sensor may be configured to detect the type of tobacco used or present in the consumable. The consumable detector sensor may be configured to detect the nicotine content present in the consumable. The consumable detector sensor may detect the type of tobacco or nicotine content based on detecting the active compound/molecule in the consumable. The consumable detector sensor may be configured to produce a signal indicative of type of tobacco or nicotine content. The signal may be indicative of the type of consumable inserted in the device such that it is e.g., in the form of a binary signal. For example, the consumable detector sensor may be able to determine a visual characteristic of the consumable. For example, a colour of the consumable may be indicative of the type of consumable. Alternatively, the consumable may include a detectable visual cue (e.g., a barcode) that is detectable by the consumable detector sensor. Additionally or alternatively, the signal may be indicative of a characteristic/nature of the consumable.

The device may comprise a controller, or may be connectable to a controller that may be configured to control at least one function of the device. The controller may comprise a microcontroller that may e.g. be mounted on a printed circuit board (PCB). The controller may also comprise a memory, e.g., non-volatile memory. The memory may include instructions, which, when implemented, may cause the controller to perform certain tasks or steps of a method. Where the device comprises an input connection, the controller may be connected to the input connection.

The controller may be configured to control the operation of the heater (and e.g., the heating element). Thus, the controller may be configured to control vaporization of an aerosol forming part of an aerosol-forming article engaged with the device. The controller may be configured to control the intensity of aerosol delivery by controlling an operation of the heater. In some embodiments, the controller is configured to control the duration of aerosol delivery by controlling operations of the heater. In some embodiments, the controller may be configured to control the amount of aerosol delivery. The controller may be configured to control functions of the device for controlling amount of vapor generation as per the user preference. The controller may be configured to generate low or no visibility of the vapors in a particular mode. This may be achieved by controlling one or more of the device functions such as controlling temperature of the heater, controlling pressure of the airflow, controlling relative position of an aerosol forming substrate and the heater to change the extent of contact between the heater and the aerosol forming substrate. In some embodiments, the controller may be configured to control the voltage applied by power source to the heater. For example, the controller may be configured to toggle between applying a full output voltage (of the power source) to the heater and applying no voltage to the heater. Alternatively or additionally, the control unit may implement a more complex heater control protocol.

The device may further comprise a voltage regulator to regulate the output voltage supplied by the power source to form a regulated voltage. The regulated voltage may subsequently be applied to the heater.

In some embodiments, where the device comprises a UI, the controller may be operatively connected to one or more components of the UI. The controller may be configured to receive command signals from an input means of the UI. The controller may be configured to control the heater in response to the command signals. For example, the controller may be configured to receive "on" and "off" command signals from the UI and, in response, may control the heater so as to be in a corresponding on or off state. The controller may be configured to receive command signals from the consumable detector sensor, and in response, may control the heater. Additionally, the controller may be configured to receive command signals from user via input means to change modes of the device to control amount of aerosol delivery.

The controller may be configured to send output signals to a component of the UI. The UI may be configured to convey information to a user, via an output means, in response to such output signals (received from the controller). For example, where the device comprises one or more LEDs, the LEDs may be operatively connected to the controller. Hence, the controller may be configured to control the illumination of the LEDs (e.g., in response to an output signal). For example, the controller may be configured to control the illumination of the LEDs according to (e.g., an on or off) state of the heater.

Where the device comprises sensor (e.g., a puff/airflow sensor/consumable detector sensor), the controller may be operatively connected to the sensor. The controller may be configured to receive a signal from the sensor (e.g., indicative of a condition of the device and/or engaged aerosol-forming article). The controller may be configured to control the heater, or an aspect of the output means, based on the signal from the sensor.

The device may comprise a wireless interface configured to communicate wirelessly (e.g., via Bluetooth (e.g., a Bluetooth low-energy connection) or Wi-Fi) with an external device. Similarly, the input connection may be configured for wired connection to an external device so as to provide communication between the device and the external device.

The external device may be a mobile device. For example, the external device may be a smart phone, tablet, smart watch, or smart car. An application (e.g., app) may be installed on the external device (e.g., mobile device). The application may facilitate communication between the device and the external device via the wired or wireless connection.

The wireless or wired interface may be configured to transfer signals between the external device and the controller of the device. In this respect, the controller may control an aspect of the device in response to a signal received from an external device. Alternatively or additionally, an external device may respond to a signal received from the device (e.g., from the controller of the device).

In a third aspect of the ninth mode of the disclosure, there is provided a system (e.g., a smoking substitute system) comprising a device according to the first aspect and an aerosol-forming article. The aerosol-forming article may comprise an aerosol-forming substrate at an upstream end of the aerosol-forming article. The article may be in the form of a smoking substitute article, e.g., heated tobacco (HT) consumable (also known as a heat-not-burn (HNB) consumable).

In a fourth aspect of the ninth mode of the disclosure, there is provided a heat not burn device, comprising: a heater; and a controller, the controller configured to operate the heater to heat an aerosol forming substrate engaged with the heater to a predetermined operating temperature, wherein the predetermined operating temperature is between 140 and 170° C.

Since usual operating temperatures of HNB devices are around 200° C. or greater, this aspect provides a device which is able to operate at a lower temperature and thereby deliver vapor of lower visibility, which provides the advantages described above.

All of the options and preferences set out above in relation to the second aspect apply equally to the fourth aspect, *mutatis mutandis*.

In particular, the controller may be further configured to operate the heater to heat an aerosol forming substrate engaged with the heater to a second predetermined operating temperature, wherein the second predetermined operating temperature is greater than 170° C. In some embodiments, the second predetermined operating temperature is at least 180° C., for example at least 185° C., at least 190° C., at least 195° C. or at least 200° C. In some embodiments, the second predetermined operating temperature is greater than 170° C. and less than or equal to about 220° C. In some embodiments, the second predetermined operating temperature is 175 to 220° C., for example 175 to 215° C., 175 to 210° C., 180 to 210° C., 190 to 210° C. or 195 to 205° C. In some embodiments, the second predetermined operating temperature is about 200° C.

A fifth aspect of the ninth mode of the disclosure is a method of reducing the amount of vapor produced by a heat-not-burn device, said heat-not-burn device comprising a heater and a controller, the controller configured to operate the heater to heat an aerosol forming substrate engaged with the heater to a predetermined operating temperature, said method comprising reducing the predetermined operating temperature to a temperature between 140 and 170° C.

In a sixth aspect of the ninth mode of the disclosure, there is provided a system (e.g., a smoking substitute system) comprising a device according to the second or fourth aspect and an aerosol-forming article. The aerosol-forming article may comprise an aerosol-forming substrate at an upstream end of the aerosol-forming article. The article may be in the form of a smoking substitute article, e.g., heated tobacco (HT) consumable (also known as a heat-not-burn (HNB) consumable).

A seventh aspect of the ninth mode of the disclosure is a method of using the device according to the second or fourth aspect, or the system according to the sixth aspect as used herein, the terms "upstream" and "downstream" are intended to refer to the flow direction of the vapor/aerosol i.e., with the downstream end of the article/consumable being the mouth end or outlet where the aerosol exits the consumable for inhalation by the user. The upstream end of the article/consumable is the opposing end to the downstream end.

The aerosol-forming substrate is capable of being heated to release at least one volatile compound that can form an aerosol. The aerosol-forming substrate may be located at the upstream end of the article/consumable.

In order to generate an aerosol, the aerosol-forming substrate comprises at least one volatile compound that is intended to be vaporized/aerosolized and that may provide the user with a recreational and/or medicinal effect when inhaled. Suitable chemical and/or physiologically active volatile compounds include the group consisting of: nicotine, cocaine, caffeine, opiates and opioids, cathine and cathinone, kavalactones, mysticin, beta-carboline alkaloids, salvinorin A together with any combinations, functional equivalents to, and/or synthetic alternatives of the foregoing.

The aerosol-forming substrate may comprise plant material. The plant material may comprise least one plant material selected from the list including *Amaranthus dubius, Arctostaphylos uva-ursi* (Bearberry), *Argemone mexicana, Amica, Artemisia vulgaris*, Yellow Tees, *Galea zacatechichi, Canavalia maritima* (Baybean), *Cecropia mexicana* (Guamura), *Cestrum noctumum, Cynoglossum virginianum* (wild comfrey), *Cytisus scoparius, Damiana, Entada rheedii, Eschscholzia califomica* (California Poppy), *Fittonia albivenis, Hippobroma longiflora, Humulus japonica* (Japanese Hops), *Humulus lupulus* (Hops), *Lactuca virosa* (Lettuce Opium), *Laggera alata, Leonotis leonurus, Leonurus cardiaca* (Motherwort), *Leonurus sibiricus* (Honeyweed), *Lobelia cardinalis, Lobelia inflata* (Indian-tobacco), *Lobelia*

*siphilitica, Nepeta cataria* (Catnip), *Nicotiana* species (Tobacco), *Nymphaea alba* (White Lily), *Nymphaea caerulea* (Blue Lily), Opium poppy, *Passiflora incamata* (Passionflower), *Pedicularis densiflora* (Indian Warrior), *Pedicularis groenlandica* (Elephant's Head), *Salvia divinorum, Salvia dorrii* (Tobacco Sage), Salvia species (Sage), *Scutellaria galericulata, Scutellaria lateriflora, Scutellaria nana, Scutellaria* species (Skullcap), *Sida acuta* (Wireweed), *Sida rhombifolia, Silene capensis, Syzygium aromaticum* (Clove), *Tagetes lucida* (Mexican Tarragon), *Tarchonanthus camphoratus, Tumera diffusa* (Damiana), *Verbascum* (Mullein), *Zamia latifolia* (Maconha Brava) together with any combinations, functional equivalents to, and/or synthetic alternatives of the foregoing.

The plant material may be tobacco. Any type of tobacco may be used. This includes, but is not limited to, flue-cured tobacco, burley tobacco, Maryland Tobacco, dark-air cured tobacco, oriental tobacco, dark-fired tobacco, perique tobacco and rustica tobacco. This also includes blends of the above mentioned tobaccos.

The tobacco may comprise one or more of leaf tobacco, stem tobacco, tobacco powder, tobacco dust, tobacco derivatives, expanded tobacco, homogenized tobacco, shredded tobacco, extruded tobacco, cut rag tobacco and/or reconstituted tobacco (e.g., slurry recon or paper recon).

The aerosol-forming substrate may comprise a gathered sheet of homogenized (e.g., paper/slurryrecon) tobacco or gathered shreds/strips formed from such a sheet.

The aerosol-forming substrate may comprise one or more additives selected from humectants, flavorants, fillers, aqueous/non-aqueous solvents and binders.

The flavorant may be provided in solid or liquid form. It may include menthol, licorice, chocolate, fruit flavor (including e.g., citrus, cherry etc.), vanilla, spice (e.g., ginger, cinnamon) and tobacco flavor. The flavorant may be evenly dispersed throughout the aerosol-forming substrate or may be provided in isolated locations and/or varying concentrations throughout the aerosol-forming substrate.

The aerosol-forming substrate may be formed in a substantially cylindrical shape such that the article/consumable resembles a conventional cigarette. It may have a diameter of between 5 and 10 mm e.g., between 6 and 9 mm or 6 and 8 mm e.g., around 7 mm. It may have an axial length of between 10 and 15 mm e.g., between 11 and 14 mm such as around 12 or 13 mm.

The article/consumable may comprise at least one filter element. There may be a terminal filter element at the downstream/mouth end of the article/consumable.

The or at least one of the filter element(s) (e.g., the terminal filter element) may be comprised of cellulose acetate or polypropylene tow. The at least one filter element (e.g., the terminal filter element) may be comprised of activated charcoal. The at least one filter element (e.g., the terminal element) may be comprised of paper. The or each filter element may be at least partly (e.g., entirely) circumscribed with a plug wrap e.g., a paper plug wrap.

The terminal filter element (at the downstream end of the article/consumable) may be joined to the upstream elements forming the article/consumable by a circumscribing tipping layer e.g., a tipping paper layer. The tipping paper may have an axial length longer than the axial length of the terminal filter element such that the tipping paper completely circumscribes the terminal filter element plus the wrapping layer surrounding any adjacent upstream element.

In some embodiments, the article/consumable may comprise an aerosol-cooling element which is adapted to cool the aerosol generated from the aerosol-forming substrate (by heat exchange) before being inhaled by the user.

The article/consumable may comprise a spacer element that defines a space or cavity between the aerosol-forming substrate and the downstream end of the consumable. The spacer element may comprise a cardboard tube. The spacer element may be circumscribed by the (paper) wrapping layer.

The ninth mode of the disclosure includes the combination of the aspects and preferred features described except where such a combination is clearly impermissible or expressly avoided.

The skilled person will appreciate that except where mutually exclusive, a feature or parameter described in relation to any one of the above aspects of the ninth mode may be applied to any other aspect of the ninth mode. Furthermore, except where mutually exclusive, any feature or parameter described herein may be applied to any aspect and/or combined with any other feature or parameter described herein.

Tenth Mode of the Disclosure: Operating a Heat Not Burn Device by Supplying Different Levels of Power to a Heating Element After Switching the Device on.

At its most general, the tenth mode of the present disclosure relates to method of operating a heat-not-burn device by supplying different levels of power to a heating element after switching the device on.

According to a first aspect of the tenth mode of the present disclosure, there is provided a method of operating a heat not burn device, the method comprising: supplying a first power level to a heating element of the device, upon activation of the device, for a first period; supplying a second power level to the heating element, for a second period, wherein the first power level is greater than the second power level; and providing an indication to a user of the device after the completion of the second period.

Optionally, the first period is different from the second period.

Optionally, the first period is longer than the second period.

Optionally, the first period is shorter than the second period.

Optionally, the second period occurs subsequent to the first period.

Optionally, the method further includes supplying at least one intermediate power level to the heating element, for a respective intermediate period, wherein each respective intermediate power level is between the first power level and the second power level.

Optionally, the method further comprising supplying the at least one intermediate power level between supplying the first power level and supplying the second power level.

Optionally, each intermediate power level is between the first power level and the second power level.

Optionally, the indication notifies the user that the device is ready to use.

Optionally, the method further comprises supplying power to the heater during an operating phase, the operating phase following the notification to the user.

Optionally, the first and second periods are within a heat-up phase of the device.

According to a second aspect of the tenth mode of the present disclosure, there is provided a device configured to implement the method of the first aspect.

By providing a device and method according to the first or second aspects of the tenth mode, the device may be configured to evenly heat the consumable to a target temperature, thereby improving user experience.

According to a third aspect of the tenth mode of the present disclosure, there is provided a device according to the second aspect and an aerosol-forming article. The aerosol-forming article may comprise an aerosol-forming substrate at an upstream end of the aerosol-forming article. The article may be in the form of a smoking substitute article, e.g., heated tobacco (HT) consumable (also known as a heat-not-burn (HNB) consumable).

According to a fourth aspect of the tenth mode of the present disclosure, there is provided a method of using the system according to the third aspect, the method comprising: inserting the article into the device; and operating the device according to the method of the first aspect.

The device may comprise an elongate body. An end of the elongate body may be configured for engagement with an aerosol-forming article. For example, the body may be configured for engagement with a heated tobacco (HT) consumable (or heat-not-burn (HNB) consumable). The terms "heated tobacco" and "heat-not-burn" are used interchangeably herein to describe a consumable that is of the type that is heated rather than combusted (or are used interchangeably to describe a device for use with such a consumable). The device may comprise a cavity that is configured for receipt of at least a portion of the consumable (i.e., for engagement with the consumable). The aerosol-forming article may be of the type that comprises an aerosol former (e.g., carried by an aerosol-forming substrate).

The device may comprise a heater for heating the aerosol-forming article. The heater may comprise a heating element, which may be in the form of a rod that extends from the body of the device. The heating element may extend from the end of the body that is configured for engagement with the aerosol-forming article.

The heater (and thus the heating element) may be rigidly mounted to the body. The heating element may be elongate so as to define a longitudinal axis and may, for example, have a transverse profile (i.e. transverse to a longitudinal axis of the heating element) that is substantially circular (i.e., the heating element may be generally cylindrical). Alternatively, the heating element may have a transverse profile that is rectangular (i.e., the heater may be a "blade heater"). The heating element may alternatively be in the shape of a tube (i.e., the heater may be a "tube heater"). The heating element may take other forms (e.g., the heating element may have an elliptical transverse profile). The shape and/or size (e.g., diameter) of the transverse profile of the heating element may be generally consistent for the entire length (or substantially the entire length) of the heating element.

The heating element may be between 15 mm and 25 mm long, e.g., between 18 mm and 20 mm long, e.g., around 19 mm long. The heating element may have a diameter of between 1.5 mm and 2.5 mm, e.g., a diameter between 2 mm and 2.3 mm, e.g., a diameter of around 2.15 mm.

The heating element may be formed of ceramic. The heating element may comprise a core (e.g., a ceramic core) comprising Al2O3. The core of the heating element may have a diameter of 1.8 mm to 2.1 mm, e.g., between 1.9 mm and 2 mm. The heating element may comprise an outer layer (e.g., an outer ceramic layer) comprising Al2O3. The thickness of the outer layer may be between 160 μm and 220 μm, e.g., between 170 μm and 190 μm, e.g., around 180 μm. The heating element may comprise a heating track, which may extend longitudinally along the heating element. The heating track may be sandwiched between the outer layer and the core of the heating element. The heating track may comprise tungsten and/or rhenium. The heating track may have a thickness of around 20 μm.

The heating element may be located in the cavity (of the device), and may extend (e.g., along a longitudinal axis) from an internal base of the cavity towards an opening of the cavity. The length of the heating element (i.e., along the longitudinal axis of the heater) may be less than the depth of the cavity. Hence, the heating element may extend for only a portion of the length of the cavity. That is, the heating element may not extend through (or beyond) the opening of the cavity.

The heating element may be configured for insertion into an aerosol-forming article (e.g., a HT consumable) when an aerosol-forming article is received in the cavity. In that respect, a distal end (i.e. distal from a base of the heating element where it is mounted to the device) of the heating element may comprise a tapered portion, which may facilitate insertion of the heating element into the aerosol-forming article. The heating element may fully penetrate an aerosol-forming article when the aerosol-forming article is received in the cavity. That is, the entire length, or substantially the entire length, of the heating element may be received in the aerosol-forming article.

The heating element may have a length that is less than, or substantially the same as, an axial length of an aerosol-forming substrate forming part of an aerosol-forming article (e.g., a HT consumable). Thus, when such an aerosol-forming article is engaged with the device, the heating element may only penetrate the aerosol-forming substrate, rather than other components of the aerosol-forming article. The heating element may penetrate the aerosol-forming substrate for substantially the entire axial length of the aerosol forming-substrate of the aerosol-forming article. Thus, heat may be transferred from (e.g., an outer circumferential surface of) the heating element to the surrounding aerosol-forming substrate, when penetrated by the heating element. That is, heat may be transferred radially outwardly (in the case of a cylindrical heating element) or e.g., radially inwardly (in the case of a tube heater).

Where the heater is a tube heater, the heating element of the tube heater may surround at least a portion of the cavity. When the portion of the aerosol-forming article is received in the cavity, the heating element may surround a portion of the aerosol-forming article (i.e., so as to heat that portion of the aerosol-forming article). In particular, the heating element may surround an aerosol forming substrate of the aerosol-forming article. That is, when an aerosol-forming article is engaged with the device, the aerosol forming substrate of the aerosol-forming article may be located adjacent an inner surface of the (tubular) heating element. When the heating element is activated, heat may be transferred radially inwardly from the inner surface of the heating element to heat the aerosol forming substrate.

The cavity may comprise a (e.g., circumferential) wall (or walls) and the (tubular) heating element may extend around at least a portion of the wall(s). In this way, the wall may be located between the inner surface of the heating element and an outer surface of the aerosol-forming article. The wall (or walls) of the cavity may be formed from a thermally conductive material (e.g., a metal) to allow heat conduction from the heating element to the aerosol-forming article. Thus, heat may be conducted from the heating element, through the cavity wall (or walls), to the aerosol-forming substrate of an aerosol-forming article received in the cavity.

In some embodiments the device may comprise a cap disposed at the end of the body that is configured for engagement with an aerosol-forming article. Where the device comprises a heater having a heating element, the cap may at least partially enclose the heating element. The cap may be moveable between an open position in which access is provided to the heating element, and a closed position in which the cap at least partially encloses the heating element. The cap may be slideably engaged with the body of the device, and may be slideable between the open and closed positions.

The cap may define at least a portion of the cavity of the device. That is, the cavity may be fully defined by the cap, or each of the cap and body may define a portion of the cavity. Where the cap fully defines the cavity, the cap may comprise an aperture for receipt of the heating element into the cavity (when the cap is in the closed position). The cap may comprise an opening to the cavity. The opening may be configured for receipt of at least a portion of an aerosol-forming article. That is, an aerosol-forming article may be inserted through the opening and into the cavity (so as to be engaged with the device).

The cap may be configured such that when an aerosol-forming article is engaged with the device (e.g., received in the cavity), only a portion of the aerosol-forming article is received in the cavity. That is, a portion of the aerosol-forming article (not received in the cavity) may protrude from (i.e., extend beyond) the opening. This (protruding) portion of the aerosol-forming article may be a terminal (e.g., mouth) end of the aerosol-forming article, which may be received in a user's mouth for the purpose of inhaling aerosol formed by the device.

The device may comprise a power source or may be connectable to a power source (e.g., a power source separate to the device). The power source may be electrically connectable to the heater to supply power to the heating element. In that respect, altering (e.g., toggling) the electrical connection of the power source to the heater may affect a state of the heater. For example, toggling the electrical connection of the power source to the heater may toggle the heater between an on state and an off state. The power source may be a power store. For example, the power source may be a battery or rechargeable battery (e.g., a lithium ion battery). Further, the power supply to the heating element may be controlled in a predefined manner. Upon activation of the device, a first power level of the power supply is supplied to the heating element. The first power level is supplied for a first period. Further, a second power level of the power supply is supplied to the heating element. The second power level is supplied for a second period. By supplying power at different power levels in two periods, uniform heating of the consumable nearer to the heating element and away from the heating element may be achieved. This may give an improved user experience. The first and second periods of heating may, between the commencement of the first period and the completion of the second period, define a heat-up phase of the device. After the heat up phase, there may be an operating phase during which the user is expected to puff on the consumable. During the heat-up phase the temperature of the heating element may be maintained at the target temperature.

The device may comprise an input connection (e.g., a USB port, Micro USB port, USB-C port, etc.). The input connection may be configured for connection to an external source of electrical power, such as a mains electrical supply outlet. The input connection may, in some lie cases, be used as a substitute for an internal power source (e.g., battery or rechargeable battery). That is, the input connection may be electrically connectable to the heater (for providing power to the heater). Hence, in some forms, the input connection may form at least part of the power source of the device.

Where the power source comprises a rechargeable power source (such as a rechargeable battery), the input connection may be used to charge and recharge the power source.

The device may comprise a user interface (UI). In some embodiments the UI may include input means to receive operative commands from the user. The input means of the UI may allow the user to control at least one aspect of the operation of the device. In some embodiments the input means may comprise a power button to switch the device between an on state and an off state.

In some embodiments the UI may additionally or alternatively comprise output means to convey information to the user. In some embodiments the output means may comprise a light to indicate a condition of the device (and/or the aerosol-forming article) to the user. The condition of the device (and/or aerosol-forming article) indicated to the user may comprise a condition indicative of the operation of the heater. For example, the condition may comprise whether the heater is in an off state or an on state. In some embodiments, the UI unit may comprise at least one of a button, a display, a touchscreen, a switch, a light, and the like. For example, the output means may comprise one or more (e.g., two, three, four, etc.) light-emitting diodes ("LEDs") that may be located on the body of the device. At the completion of the heat up phase, the indication of device ready status to the user may be provided via the output means.

The device may further comprise a puff sensor (e.g., airflow sensor), which form part of the input means of the UI. The puff sensor may be configured to detect a user drawing on an end (i.e., a terminal (mouth) end) of the aerosol-forming article. The puff sensor may, for example, be a pressure sensor or a microphone. The puff sensor may be configured to produce a signal indicative of a puff state. The signal may be indicative of the user drawing (an aerosol from the aerosol-forming article) such that it is e.g., in the form of a binary signal. Alternatively or additionally, the signal may be indicative of a characteristic of the draw (e.g., a flow rate of the draw, length of time of the draw, etc).

The device may comprise a controller, or may be connectable to a controller that may be configured to control at least one function of the device. The controller may comprise a microcontroller that may e.g., be mounted on a printed circuit board (PCB). The controller may also comprise a memory, e.g., non-volatile memory. The memory may include instructions, which, when implemented, may cause the controller to perform certain tasks or steps of a method. Where the device comprises an input connection, the controller may be connected to the input connection.

The controller may be configured to control the operation of the heater (and e.g., the heating element). Thus, the controller may be configured to control vaporization of an aerosol forming part of an aerosol-forming article engaged with the device. The controller may be configured to control the voltage applied by power source to the heater. For example, the controller may be configured to toggle between applying a full output voltage (of the power source) to the heater and applying no voltage to the heater. Alternatively or additionally, the control unit may implement a more complex heater control protocol.

The device may further comprise a voltage regulator to regulate the output voltage supplied by the power source to form a regulated voltage. The regulated voltage may subsequently be applied to the heater.

In some embodiments, where the device comprises a UI, the controller may be operatively connected to one or more components of the UI. The controller may be configured to receive command signals from an input means of the UI. The controller may be configured to control the heater in response to the command signals. For example, the controller may be configured to receive "on" and "off" command signals from the UI and, in response, may control the heater so as to be in a corresponding on or off state.

The controller may be configured to send output signals to a component of the UI. The UI may be configured to convey information to a user, via an output means, in response to such output signals (received from the controller). For example, where the device comprises one or more LEDs, the LEDs may be operatively connected to the controller. Hence, the controller may be configured to control the illumination of the LEDs (e.g., in response to an output signal). For example, the controller may be configured to control the illumination of the LEDs according to (e.g., an on or off) state of the heater.

Where the device comprises a sensor (e.g., a puff/airflow sensor), the controller may be operatively connected to the sensor. The controller may be configured to receive a signal from the sensor (e.g., indicative of a condition of the device and/or engaged aerosol-forming article). The controller may be configured to control the heater, or an aspect of the output means, based on the signal from the sensor.

In some embodiments, the controller may be configured to control the power supply to the heating element, upon activation of the device during a heat up phase. The device may therefore be able to achieve uniform heating of the consumable, thereby eliminating burnt taste to the user during first inhale of the consumable.

The device may comprise a wireless interface configured to communicate wirelessly (e.g., via Bluetooth (e.g., a Bluetooth low-energy connection) or Wi-Fi) with an external device. Similarly, the input connection may be configured for wired connection to an external device so as to provide communication between the device and the external device.

The external device may be a mobile device. For example, the external device may be a smart phone, tablet, smart watch, or smart car. An application (e.g., app) may be installed on the external device (e.g., mobile device). The application may facilitate communication between the device and the external device via the wired or wireless connection.

The wireless or wired interface may be configured to transfer signals between the external device and the controller of the device. In this respect, the controller may control an aspect of the device in response to a signal received from an external device. Alternatively or additionally, an external device may respond to a signal received from the device (e.g., from the controller of the device).

As used herein, the terms "upstream" and "downstream" are intended to refer to the flow direction of the vapor/aerosol i.e., with the downstream end of the article/consumable being the mouth end or outlet where the aerosol exits the consumable for inhalation by the user. The upstream end of the article/consumable is the opposing end to the downstream end.

The aerosol-forming substrate is capable of being heated to release at least one volatile compound that can form an aerosol. The aerosol-forming substrate may be located at the upstream end of the article/consumable.

In order to generate an aerosol, the aerosol-forming substrate comprises at least one volatile compound that is intended to be vaporized/aerosolized and that may provide the user with a recreational and/or medicinal effect when inhaled. Suitable chemical and/or physiologically active volatile compounds include the group consisting of: nicotine, cocaine, caffeine, opiates and opioids, cathine and cathinone, kavalactones, mysticin, beta-carboline alkaloids, salvinorin A together with any combinations, functional equivalents to, and/or synthetic alternatives of the foregoing.

The aerosol-forming substrate may comprise plant material. The plant material may comprise least one plant material selected from the list including *Amaranthus dubius, Arctostaphylos uva-ursi* (Bearberry), *Argemone mexicana, Amica, Artemisia vulgaris*, Yellow Tees, *Galea zacatechichi, Canavalia maritima* (Baybean), *Cecropia mexicana* (Guamura), *Cestrum noctumum, Cynoglossum virginianum* (wild comfrey), *Cytisus scoparius, Damiana, Entada rheedii, Eschscholzia califomica* (California Poppy), *Fittonia albivenis, Hippobroma longiflora, Humulus japonica* (Japanese Hops), *Humulus lupulus* (Hops), *Lactuca virosa* (Lettuce Opium), *Laggera alata, Leonotis leonurus, Leonurus cardiaca* (Motherwort), *Leonurus sibiricus* (Honeyweed), *Lobelia cardinalis, Lobelia inflata* (Indian-tobacco), *Lobelia siphilitica, Nepeta cataria* (Catnip), *Nicotiana* species (Tobacco), *Nymphaea alba* (White Lily), *Nymphaea caerulea* (Blue Lily), Opium poppy, *Passiflora incamata* (Passionflower), *Pedicularis densiflora* (Indian Warrior), *Pedicularis groenlandica* (Elephant's Head), *Salvia divinorum, Salvia dorrii* (Tobacco Sage), Salvia species (Sage), *Scutellaria galericulata, Scutellaria lateriflora, Scutellaria nana, Scutellaria* species (Skullcap), *Sida acuta* (Wireweed), *Sida rhombifolia, Silene capensis, Syzygium aromaticum* (Clove), *Tagetes lucida* (Mexican Tarragon), *Tarchonanthus camphoratus, Tumera diffusa* (Damiana), *Verbascum* (Mullein), *Zamia latifolia* (Maconha Brava) together with any combinations, functional equivalents to, and/or synthetic alternatives of the foregoing.

The plant material may be tobacco. Any type of tobacco may be used. This includes, but is not limited to, flue-cured tobacco, burley tobacco, Maryland Tobacco, dark-air cured tobacco, oriental tobacco, dark-fired tobacco, perique tobacco and rustica tobacco. This also includes blends of the above mentioned tobaccos.

The tobacco may comprise one or more of leaf tobacco, stem tobacco, tobacco powder, tobacco dust, tobacco derivatives, expanded tobacco, homogenized tobacco, shredded tobacco, extruded tobacco, cut rag tobacco and/or reconstituted tobacco (e.g., slurry recon or paper recon).

The aerosol-forming substrate may comprise a gathered sheet of homogenized (e.g., paper/slurryrecon) tobacco or gathered shreds/strips formed from such a sheet.

The aerosol-forming substrate may comprise one or more additives selected from humectants, flavorants, fillers, aqueous/non-aqueous solvents and binders.

The flavorant may be provided in solid or liquid form. It may include menthol, licorice, chocolate, fruit flavor (including e.g., citrus, cherry etc.), vanilla, spice (e.g., ginger, cinnamon) and tobacco flavor. The flavorant may be evenly dispersed throughout the aerosol-forming substrate or may be provided in isolated locations and/or varying concentrations throughout the aerosol-forming substrate.

The aerosol-forming substrate may be formed in a substantially cylindrical shape such that the article/consumable resembles a conventional cigarette. It may have a diameter of between 5 and 10 mm e.g., between 6 and 9 mm or 6 and 8 mm e.g., around 7 mm. It may have an axial length of between 10 and 15 mm e.g., between 11 and 14 mm such as around 12 or 13 mm.

The article/consumable may comprise at least one filter element. There may be a terminal filter element at the downstream/mouth end of the article/consumable.

The or at least one of the filter element(s) (e.g., the terminal filter element) may be comprised of cellulose acetate or polypropylene tow. The at least one filter element (e.g., the terminal filter element) may be comprised of activated charcoal. The at least one filter element (e.g., the terminal element) may be comprised of paper. The or each filter element may be at least partly (e.g., entirely) circumscribed with a plug wrap e.g., a paper plug wrap.

The terminal filter element (at the downstream end of the article/consumable) may be joined to the upstream elements forming the article/consumable by a circumscribing tipping layer e.g., a tipping paper layer. The tipping paper may have an axial length longer than the axial length of the terminal filter element such that the tipping paper completely circumscribes the terminal filter element plus the wrapping layer surrounding any adjacent upstream element.

In some embodiments, the article/consumable may comprise an aerosol-cooling element which is adapted to cool the aerosol generated from the aerosol-forming substrate (by heat exchange) before being inhaled by the user.

The article/consumable may comprise a spacer element that defines a space or cavity between the aerosol-forming substrate and the downstream end of the consumable. The spacer element may comprise a cardboard tube. The spacer element may be circumscribed by the (paper) wrapping layer.

According to a fourth aspect of the tenth mode of the present disclosure, there is provided a method of using the system according to the third aspect, the method comprising inserting the aerosol-forming article into the device; and heating the article using the heater of the device.

In some embodiments the method may comprise inserting the article into a cavity within a body of the device and penetrating the article with the heating element of the device upon insertion of the article.

The tenth mode of the disclosure includes the combination of the aspects and preferred features described except where such a combination is clearly impermissible or expressly avoided.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

Eleventh Mode of the Disclosure: Smoking Substitute Device to Change Operation by Determining Puff Duration At its most general, the eleventh mode of the present disclosure relates to smoking substitute device to change operation by determining puff duration.

According to a first aspect of the eleventh mode of the present disclosure, there is provided a smoking substitute device, comprising: a puff measurement means configured to measure a puff duration associated with a user puff action; and a controller configured to change an operating temperature of a heating element of the smoking substitute device, based on the measured puff duration.

By providing a smoking substitute device comprising a controller configured to change operating temperature of a heating element based on puff duration associated with a user puff action, the device provides adaptive heating of the heating element to counteract the effect of the user puff on temperature. This may provide an improved user experience.

Optional features will now be set out. These are applicable singly or in any combination with any aspect.

Optionally, the change of operating temperature includes an increase in operating temperature.

Optionally, the change of temperature occurs during the user puff action.

Optionally, the change of temperature occurs during a subsequent user puff action.

Optionally, the controller changes the operating temperature when the measured puff duration is greater than a predefined threshold duration.

Optionally, the controller increases the operating temperature to a predefined elevated temperature.

Optionally, the controller increases the operating temperature until the user puff action ends.

Optionally, the puff measurement means includes a puff sensor.

Optionally, the substitute smoking device is a heat not burn device.

In a second aspect of the eleventh mode, there is provided a method of operating a smoking substitute device, the method comprising: measuring a puff duration associated with a user puff action of the smoking substitute device; and changing an operating temperature of a heating element of the smoking substitute device, based on the measured puff duration.

Optionally, the operating temperature is increased when the puff duration is greater than a predefined threshold value.

Optionally, the operating temperature is increased to a predefined elevated temperature.

Optionally, the operating temperature is increased until the user puff action ends.

Optionally, the operating temperature is gradually increases until the user puff action ends.

In a third aspect of the eleventh mode, there is provided a substitute smoking system comprising: a device according to the first aspect or a device operated according to the second aspect; and an aerosol-forming article.

In a fourth aspect of the eleventh mode, there is provided a method of a system according the third aspect, the method comprising: inserting the aerosol-forming article into the device; and operating the device to heat the aerosol-forming article using a heating element of the device.

The device may comprise an elongate body. An end of the elongate body may be configured for engagement with an aerosol-forming article. For example, the body may be configured for engagement with a heated tobacco (HT) consumable (or heat-not-burn (HNB) consumable) or an e-cigarette consumable. The terms "heated tobacco" and "heat-not-burn" are used interchangeably herein to describe a consumable that is of the type that is heated rather than combusted (or are used interchangeably to describe a device for use with such a consumable). The device may comprise a cavity that is configured for receipt of at least a portion of the consumable (i.e., for engagement with the consumable). The aerosol-forming article may be of the type that comprises an aerosol former (e.g., carried by an aerosol-forming substrate).

The device may comprise a heater for heating the aerosol-forming article. The heater may comprise a heating element, which may be in the form of a rod that extends from the body of the device. The heating element may extend from the end of the body that is configured for engagement with the aerosol-forming article.

The heater (and thus the heating element) may be rigidly mounted to the body. The heating element may be elongate so as to define a longitudinal axis and may, for example, have a transverse profile (i.e. transverse to a longitudinal axis of the heating element) that is substantially circular (i.e., the heating element may be generally cylindrical). Alternatively, the heating element may have a transverse profile that is rectangular (i.e., the heater may be a "blade heater"). The heating element may alternatively be in the shape of a tube (i.e., the heater may be a "tube heater"). The heating element may take other forms (e.g., the heating element may have an elliptical transverse profile). The shape and/or size (e.g., diameter) of the transverse profile of the heating element may be generally consistent for the entire length (or substantially the entire length) of the heating element.

The heating element may be between 15 mm and 25 mm long, e.g., between 18 mm and 20 mm long, e.g., around 19 mm long. The heating element may have a diameter of between 1.5 mm and 2.5 mm, e.g., a diameter between 2 mm and 2.3 mm, e.g., a diameter of around 2.15 mm.

The heating element may be formed of ceramic. The heating element may comprise a core (e.g., a ceramic core) comprising Al2O3. The core of the heating element may have a diameter of 1.8 mm to 2.1 mm, e.g., between 1.9 mm and 2 mm. The heating element may comprise an outer layer (e.g., an outer ceramic layer) comprising Al2O3. The thickness of the outer layer may be between 160 μm and 220 μm, e.g., between 170 μm and 190 μm, e.g., around 180 μm. The heating element may comprise a heating track, which may extend longitudinally along the heating element. The heating track may be sandwiched between the outer layer and the core of the heating element. The heating track may comprise tungsten and/or rhenium. The heating track may have a thickness of around 20 μm.

The heating element may be located in the cavity (of the device), and may extend (e.g., along a longitudinal axis) from an internal base of the cavity towards an opening of the cavity. The length of the heating element (i.e., along the longitudinal axis of the heater) may be less than the depth of the cavity. Hence, the heating element may extend for only a portion of the length of the cavity. That is, the heating element may not extend through (or beyond) the opening of the cavity.

The heating element may be configured for insertion into an aerosol-forming article (e.g., a HT consumable) when an aerosol-forming article is received in the cavity. In that respect, a distal end (i.e. distal from a base of the heating element where it is mounted to the device) of the heating element may comprise a tapered portion, which may facilitate insertion of the heating element into the aerosol-forming article. The heating element may fully penetrate an aerosol-forming article when the aerosol-forming article is received in the cavity. That is, the entire length, or substantially the entire length, of the heating element may be received in the aerosol-forming article.

The heating element may have a length that is less than, or substantially the same as, an axial length of an aerosol-forming substrate forming part of an aerosol-forming article (e.g., a HT consumable). Thus, when such an aerosol-forming article is engaged with the device, the heating element may only penetrate the aerosol-forming substrate, rather than other components of the aerosol-forming article. The heating element may penetrate the aerosol-forming substrate for substantially the entire axial length of the aerosol forming-substrate of the aerosol-forming article. Thus, heat may be transferred from (e.g., an outer circumferential surface of) the heating element to the surrounding aerosol-forming substrate, when penetrated by the heating element. That is, heat may be transferred radially outwardly (in the case of a cylindrical heating element) or e.g., radially inwardly (in the case of a tube heater).

Where the heater is a tube heater, the heating element of the tube heater may surround at least a portion of the cavity. When the portion of the aerosol-forming article is received in the cavity, the heating element may surround a portion of the aerosol-forming article (i.e., so as to heat that portion of the aerosol-forming article). In particular, the heating element may surround an aerosol forming substrate of the aerosol-forming article. That is, when an aerosol-forming article is engaged with the device, the aerosol forming substrate of the aerosol-forming article may be located adjacent an inner surface of the (tubular) heating element. When the heating element is activated, heat may be transferred radially inwardly from the inner surface of the heating element to heat the aerosol forming substrate.

The cavity may comprise a (e.g., circumferential) wall (or walls) and the (tubular) heating element may extend around at least a portion of the wall(s). In this way, the wall may be located between the inner surface of the heating element and an outer surface of the aerosol-forming article. The wall (or walls) of the cavity may be formed from a thermally conductive material (e.g., a metal) to allow heat conduction from the heating element to the aerosol-forming article. Thus, heat may be conducted from the heating element, through the cavity wall (or walls), to the aerosol-forming substrate of an aerosol-forming article received in the cavity.

In some embodiments the heater may form part of an aerosol-forming article for use with the device. In such cases the device may not comprise a heater. Rather, the aerosol-forming article may comprise a heater. Such arrangements may, for example, be suited to e-cigarette systems in which the aerosol-forming article comprises a tank containing an aerosol former (e.g., in liquid form). In such embodiments, the device may comprise means for connecting the device the heater of an aerosol-forming article engaged with the device. For example, the device may comprise one or more device connectors for (e.g., electrically) connecting the device to a corresponding heater connector of the aerosol-forming article. The connectors (i.e., of both the device and the aerosol-forming article) may be in the form of electrically conductive elements (e.g., plates) that contact when the aerosol-forming article is engaged with the device.

In some embodiments the device may comprise a cap disposed at the end of the body that is configured for engagement with an aerosol-forming article. Where the device comprises a heater having a heating element, the cap may at least partially enclose the heating element. The cap may be moveable between an open position in which access is provided to the heating element, and a closed position in which the cap at least partially encloses the heating element. The cap may be slideably engaged with the body of the device, and may be slideable between the open and closed positions.

The cap may define at least a portion of the cavity of the device. That is, the cavity may be fully defined by the cap, or each of the cap and body may define a portion of the cavity. Where the cap fully defines the cavity, the cap may comprise an aperture for receipt of the heating element into the cavity (when the cap is in the closed position). The cap may comprise an opening to the cavity. The opening may be configured for receipt of at least a portion of an aerosol-forming article. That is, an aerosol-forming article may be inserted through the opening and into the cavity (so as to be engaged with the device).

The cap may be configured such that when an aerosol-forming article is engaged with the device (e.g., received in the cavity), only a portion of the aerosol-forming article is received in the cavity. That is, a portion of the aerosol-forming article (not received in the cavity) may protrude from (i.e., extend beyond) the opening. This (protruding) portion of the aerosol-forming article may be a terminal (e.g., mouth) end of the aerosol-forming article, which may be received in a user's mouth for the purpose of inhaling aerosol formed by the device.

The device may comprise a power source or may be connectable to a power source (e.g., a power source separate to the device). The power source may be electrically connectable to the heater. In that respect, altering (e.g., toggling) the electrical connection of the power source to the heater may affect a state of the heater. For example, toggling the electrical connection of the power source to the heater may toggle the heater between an on state and an off state. The power source may be a power store. For example, the power source may be a battery or rechargeable battery (e.g., a lithium ion battery).

The device may comprise an input connection (e.g., a USB port, Micro USB port, USB-C port, etc.). The input connection may be configured for connection to an external source of electrical power, such as a mains electrical supply outlet. The input connection may, in some cases, be used as a substitute for an internal power source (e.g., battery or rechargeable battery). That is, the input connection may be electrically connectable to the heater (for providing power to the heater). Hence, in some forms, the input connection may form at least part of the power source of the device.

Where the power source comprises a rechargeable power source (such as a rechargeable battery), the input connection may be used to charge and recharge the power source.

The device may comprise a user interface (UI). In some embodiments the UI may include input means to receive operative commands from the user. The input means of the UI may allow the user to control at least one aspect of the operation of the device. In some embodiments the input means may comprise a power button to switch the device between an on state and an off state.

In some embodiments the UI may additionally or alternatively comprise output means to convey information to the user. In some embodiments the output means may comprise a light to indicate a condition of the device (and/or the aerosol-forming article) to the user. The condition of the device (and/or aerosol-forming article) indicated to the user may comprise a condition indicative of the operation of the heater. For example, the condition may comprise whether the heater is in an off state or an on state. In some embodiments, the UI unit may comprise at least one of a button, a display, a touchscreen, a switch, a light, and the like. For example, the output means may comprise one or more (e.g., two, three, four, etc.) light-emitting diodes ("LEDs") that may be located on the body of the device.

The device may further comprise a puff sensor (e.g., airflow sensor), which form part of the input means of the UI. The puff sensor may be configured to detect a user drawing on an end (i.e., a terminal (mouth) end) of the aerosol-forming article. The puff sensor may, for example, be a pressure sensor or a microphone. The puff sensor may be configured to produce a signal indicative of a puff state. The signal may be indicative of the user drawing (an aerosol from the aerosol-forming article) such that it is e.g., in the form of a binary signal. The puff sensor may be configured to measure puff duration of a user puff action. The signal may be indicative of such puff duration. Alternatively or additionally, the signal may be indicative of a characteristic of the draw (e.g., a flow rate of the draw, length of time of the draw, etc).

The device may comprise a controller, or may be connectable to a controller that may be configured to control at least one function of the device. The controller may comprise a microcontroller that may e.g., be mounted on a printed circuit board (PCB). The controller may also comprise a memory, e.g., non-volatile memory. The memory may include instructions, which, when implemented, may cause the controller to perform certain tasks or steps of a method. Where the device comprises an input connection, the controller may be connected to the input connection.

The controller may be configured to control the operation of the heater (and e.g., the heating element). Thus, the controller may be configured to control vaporization of an aerosol forming part of an aerosol-forming article engaged with the device. The controller may be configured to control the voltage applied by power source to the heater. For example, the controller may be configured to toggle between applying a full output voltage (of the power source) to the heater and applying no voltage to the heater. Alternatively or additionally, the control unit may implement a more complex heater control protocol.

The device may further comprise a voltage regulator to regulate the output voltage supplied by the power source to form a regulated voltage. The regulated voltage may subsequently be applied to the heater.

In some embodiments, where the device comprises a UI, the controller may be operatively connected to one or more components of the UI. The controller may be configured to receive command signals from an input means of the UI. The controller may be configured to control the heater in response to the command signals. For example, the controller may be configured to receive "on" and "off" command signals from the UI and, in response, may control the heater so as to be in a corresponding on or off state.

The controller may be configured to send output signals to a component of the UI. The UI may be configured to convey information to a user, via an output means, in response to such output signals (received from the controller). For example, where the device comprises one or more LEDs, the LEDs may be operatively connected to the controller. Hence, the controller may configured to control the illumination of the LEDs (e.g., in response to an output signal). For example, the controller may be configured to control the illumination of the LEDs according to (e.g., an on or off) state of the heater.

Where the device comprises a sensor (e.g., a puff/airflow sensor), the controller may be operatively connected to the sensor. The controller may be configured to receive a signal from the sensor (e.g., indicative of a condition of the device and/or engaged aerosol-forming article). The controller may be configured to control the heater, or an aspect of the output means, based on the signal from the sensor.

In some embodiments, the controller may be operatively connected to the puff sensor to receive the signal from the puff sensor.

In some embodiments, the controller may be configured to receive the puff duration measured by the puff sensor. The controller may therefore be able to change an operating temperature of the heating element based on the puff.

The device may comprise a wireless interface configured to communicate wirelessly (e.g., via Bluetooth (e.g., a Bluetooth low-energy connection) or WiFi) with an external device. Similarly, the input connection may be configured for wired connection to an external device so as to provide communication between the device and the external device.

The external device may be a mobile device. For example, the external device may be a smart phone, tablet, smart watch, or smart car. An application (e.g., app) may be installed on the external device (e.g., mobile device). The application may facilitate communication between the device and the external device via the wired or wireless connection.

The wireless or wired interface may be configured to transfer signals between the external device and the controller of the device. In this respect, the controller may control an aspect of the device in response to a signal received from an external device. Alternatively or additionally, an external device may respond to a signal received from the device (e.g., from the controller of the device).

In a further aspect of the eleventh mode, there is provided a system (e.g., a smoking substitute system) comprising a device according to the first aspect and an aerosol-forming article. The aerosol-forming article may comprise an aerosol-forming substrate at an upstream end of the aerosol-forming article. The article may be in the form of a smoking substitute article, e.g., heated tobacco (HT) consumable (also known as a heat-not-burn (HNB) consumable).

As used herein, the terms "upstream" and "downstream" are intended to refer to the flow direction of the vapor/aerosol i.e., with the downstream end of the article/consumable being the mouth end or outlet where the aerosol exits the consumable for inhalation by the user. The upstream end of the article/consumable is the opposing end to the downstream end.

The aerosol-forming substrate is capable of being heated to release at least one volatile compound that can form an aerosol. The aerosol-forming substrate may be located at the upstream end of the article/consumable.

In order to generate an aerosol, the aerosol-forming substrate comprises at least one volatile compound that is intended to be vaporized/aerosolized and that may provide the user with a recreational and/or medicinal effect when inhaled. Suitable chemical and/or physiologically active volatile compounds include the group consisting of: nicotine, cocaine, caffeine, opiates and opioids, cathine and cathinone, kavalactones, mysticin, beta-carboline alkaloids, salvinorin A together with any combinations, functional equivalents to, and/or synthetic alternatives of the foregoing.

The aerosol-forming substrate may comprise plant material. The plant material may comprise least one plant material selected from the list including *Amaranthus dubius, Arctostaphylos uva-ursi* (Bearberry), *Argemone mexicana, Amica, Artemisia vulgaris*, Yellow Tees, *Galea zacatechichi, Canavalia maritima* (Baybean), *Cecropia mexicana* (Guamura), *Cestrum noctumum, Cynoglossum virginianum* (wild comfrey), *Cytisus scoparius, Damiana, Entada rheedii, Eschscholzia califomica* (California Poppy), *Fittonia albivenis, Hippobroma longiflora, Humulus japonica* (Japanese Hops), *Humulus lupulus* (Hops), *Lactuca virosa* (Lettuce Opium), *Laggera alata, Leonotis leonurus, Leonurus cardiaca* (Motherwort), *Leonurus sibiricus* (Honeyweed), *Lobelia cardinalis, Lobelia inflata* (Indian-tobacco), *Lobelia siphilitica, Nepeta cataria* (Catnip), *Nicotiana* species (Tobacco), *Nymphaea alba* (White Lily), *Nymphaea caerulea* (Blue Lily), Opium poppy, *Passiflora incamata* (Passionflower), *Pedicularis densiflora* (Indian Warrior), *Pedicularis groenlandica* (Elephant's Head), *Salvia divinorum, Salvia dorrii* (Tobacco Sage), Salvia species (Sage), *Scutellaria galericulata, Scutellaria lateriflora, Scutellaria nana, Scutellaria* species (Skullcap), *Sida acuta* (Wireweed), *Sida rhombifolia, Silene capensis, Syzygium aromaticum* (Clove), *Tagetes lucida* (Mexican Tarragon), *Tarchonanthus camphoratus, Tumera diffusa* (Damiana), *Verbascum* (Mullein), *Zamia latifolia* (Maconha Brava) together with any combinations, functional equivalents to, and/or synthetic alternatives of the foregoing.

The plant material may be tobacco. Any type of tobacco may be used. This includes, but is not limited to, flue-cured tobacco, burley tobacco, Maryland Tobacco, dark-air cured tobacco, oriental tobacco, dark-fired tobacco, perique tobacco and rustica tobacco. This also includes blends of the above mentioned tobaccos.

The tobacco may comprise one or more of leaf tobacco, stem tobacco, tobacco powder, tobacco dust, tobacco derivatives, expanded tobacco, homogenized tobacco, shredded tobacco, extruded tobacco, cut rag tobacco and/or reconstituted tobacco (e.g., slurry recon or paper recon).

The aerosol-forming substrate may comprise a gathered sheet of homogenized (e.g., paper/slurryrecon) tobacco or gathered shreds/strips formed from such a sheet.

The aerosol-forming substrate may comprise one or more additives selected from humectants, flavorants, fillers, aqueous/non-aqueous solvents and binders.

The flavorant may be provided in solid or liquid form. It may include menthol, licorice, chocolate, fruit flavor (including e.g., citrus, cherry etc.), vanilla, spice (e.g., ginger, cinnamon) and tobacco flavor. The flavorant may be evenly dispersed throughout the aerosol-forming substrate or may be provided in isolated locations and/or varying concentrations throughout the aerosol-forming substrate.

The aerosol-forming substrate may be formed in a substantially cylindrical shape such that the article/consumable resembles a conventional cigarette. It may have a diameter of between 5 and 10 mm e.g., between 6 and 9 mm or 6 and 8 mm e.g., around 7 mm. It may have an axial length of between 10 and 15 mm e.g., between 11 and 14 mm such as around 12 or 13 mm.

The article/consumable may comprise at least one filter element. There may be a terminal filter element at the downstream/mouth end of the article/consumable.

The or at least one of the filter element(s) (e.g., the terminal filter element) may be comprised of cellulose acetate or polypropylene tow. The at least one filter element (e.g., the terminal filter element) may be comprised of activated charcoal. The at least one filter element (e.g., the terminal element) may be comprised of paper. The or each filter element may be at least partly (e.g., entirely) circumscribed with a plug wrap e.g., a paper plug wrap.

The terminal filter element (at the downstream end of the article/consumable) may be joined to the upstream elements forming the article/consumable by a circumscribing tipping layer e.g., a tipping paper layer. The tipping paper may have an axial length longer than the axial length of the terminal filter element such that the tipping paper completely circumscribes the terminal filter element plus the wrapping layer surrounding any adjacent upstream element.

In some embodiments, the article/consumable may comprise an aerosol-cooling element which is adapted to cool the aerosol generated from the aerosol-forming substrate (by heat exchange) before being inhaled by the user.

The article/consumable may comprise a spacer element that defines a space or cavity between the aerosol-forming substrate and the downstream end of the consumable. The spacer element may comprise a cardboard tube. The spacer element may be circumscribed by the (paper) wrapping layer.

In some embodiments the system may be in the form of an e-cigarette system (i.e., rather than a heated tobacco system as described above). In such a system, the consumable may be in the form of an e-cigarette consumable. The e-cigarette system may be configured such that the consumable can be received and retained in the cavity of the device (i.e., so as to be engaged with the device). The consumable may be retained by way of e.g., an interference fit, screwing one onto (or onto) the other, a bayonet fitting, or by way of a snap engagement mechanism.

The consumable may comprise a tank, which may define a reservoir for the storage of an aerosol former. The aerosol former may be in the form of an e-liquid (stored in the reservoir).

The consumable may be a "single-use" consumable. That is, upon exhausting the e-liquid in the tank, the intention may be that the user disposes of the entire consumable. Alternatively, the e-liquid may be the only part of the system that is truly "single-use". For example, the tank may be refillable with e-liquid or another component of the system (internal to the device or external to the device e.g., a refillable cartomizer) may define a reservoir for the e-liquid.

As set forth above, the consumable may comprise a heater (i.e., instead of the heater forming part of the device) configured to heat and vaporize the e-liquid. The consumable may comprise a porous wick that conveys e-liquid from the tank to a heating element of the heater. The heating element may be a heating filament that is wound (e.g., helically) around at least a portion of the porous wick, such that when the heating element is heated (e.g., by the action of electrical current passing through the heating element), heat may be transferred from the heating element to the e-liquid conveyed by the wick. This transfer of heat may vaporize the e-liquid and the resultant vapor may be entrained in an airflow passing through the consumable.

The consumable may further comprise one or more heater connectors for connecting the heater (of the consumable) to the device. The heater connectors may be in the form of electrically conductive element or contacts (e.g., metal plates) and may be disposed on an in-use device-facing surface of the consumable. The heater connectors may be electrically connected to the heater of the consumable, such that electricity supplied via the heater connectors may pass to the heater. In other words, a voltage applied across the heater connectors may generally correspond to a voltage applied across the heating element of the heater.

The heater connectors may be arranged such that they contact corresponding device connectors of the device when the consumable is engaged with the device. The device connectors may be connected (e.g., electrically) to a power source (e.g., battery) of the device. Thus, electricity may be supplied from the power source to the heating element, via in-contact heater and device connectors. In this way, the heater forming part of the consumable may operate (and interact with e.g., a controller) as otherwise described above with respect to a heater forming part of the device.

According to a fourth aspect of the eleventh mode of the present disclosure, there is provided a method of using the system according to the third aspect, the method comprising inserting the aerosol-forming article into the device; and heating the article using the heater of the device.

In some embodiments the method may comprise inserting the article into a cavity within a body of the device and penetrating the article with the heating element of the device upon insertion of the article.

The eleventh mode of the disclosure includes the combination of the aspects and preferred features described except where such a combination is clearly impermissible or expressly avoided.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

Twelfth Mode of the Disclosure: A Heat Not Burn Device for Controlling Power Level for Heating At its most general, the twelfth mode of the present disclosure relates to a heat not burn device for controlling power level for heating.

According to the twelfth mode of the present disclosure, there is provided a heat not burn device including a heater, wherein the device is configured: to supply power to the heater from a power supply; to supply a first power level for a first predetermined heating period, to raise a temperature of the heater to an operating temperature; and to supply a second power level to maintain the temperature of the heater at the operating temperature; wherein the second power level is lower than the first power level.

By providing a heat not burn device for controlling power levels to maintain the operating temperature of the heater, for providing precise amount of heating resulting in repeatable performance.

Optional features will now be set out. These are applicable singly or in any combination with any aspect.

Optionally, further comprising a controller 108 configured to control first power level for heating the rod heater from ambient temperature to a threshold temperature level and second power level in order to maintain the temperature to the threshold temperature level. Alternatively, the second power level is applied to increase the temperature to the threshold temperature level, in case, if there is any dip in the temperature. By using first power level and second power level, the rod heater can be selectively heated to increase or maintain the temperature.

Advantageously, the power supplied to the heater is pulse width modulated in order to control the energy applied to heat the rod heater. By using pulse width modulation it is possible to selectively supply energy to the rod heater.

Conveniently, the first power level is supplied with a pulse width modulation of a first duty cycle in order to heat the rod heater to increase the temperature from unheated state to a threshold temperature. It is preferable to set the first power level with first duty cycle to provide only the required energy and save battery.

Optionally, the first duty cycle is not dependent on a temperature of the heater, so that first duty cycle can be applied in various other conditions as well.

Advantageously, the first duty cycle is optionally one of: 60 to 100%, 70 to 100%, or 80 to 100%, indicating that only in these specified percentage or percentage ranges, energy is applied to the rod heater. This will ensure reducing power consumption.

Conveniently, the second power level is supplied with a pulse width modulation of a second duty cycle. It is preferable to set the second power level with second duty cycle to provide only the required energy to maintain the temperature in a desired level. This will avoid over heating of the rod heater and save power.

Optionally, the second duty cycle is not dependent on a temperature of the heater, so that second duty cycle can be applied in various other conditions as well.

Advantageously, the second duty cycle is optionally one of: below 100%, less than 90%, less than 80%, less than 70%, less than 60%, less than 50%, less than 40%. Ensuring that only in these specified percentage or percentage ranges, energy is applied to the rod heater. This will ensure reducing power consumption and yet archive constant temperature.

Conveniently, the first power level is supplied for a predetermined heating period to rise the temperature of the rod heater to the desired level.

Optionally, the first power level is constant throughout the predetermined heating period for ensuring steady heating of temperature and providing optimum user experience.

Advantageously, the heating period is optionally, one of between 10 and 45 seconds, and between 10 and 25 seconds for ensuring minimal waiting time for user to start using the consumable without much delay.

Conveniently, the operating temperature is optionally between 250 degrees C. and 400 degrees. Alternatively, the operating temperature may optionally be between 300 degrees C. and 350 degrees C.

Optionally, the second power level is supplied for a predetermined operating period for maintaining the temperature during a consumable cycle to provide optimum user experience.

Advantageously, the second power level is constant throughout the predetermined operating period. This may ensure steady maintaining of temperature during consumable cycle and providing optimum user experience.

Conveniently, the predetermined operating period is optionally between 3 and 7 minutes.

Optionally, each of the first power level, the second power level and the operating temperature of the heater is previously predetermined. This can allow user to configure according to his needs or can be pre-set and modified according to various modes of usage.

The device may comprise an elongate body. An end of the elongate body may be configured for engagement with an aerosol-forming article. For example, the body may be configured for engagement with a heated tobacco (HT) consumable (or heat-not-burn (HNB) consumable). The terms "heated tobacco" and "heat-not-burn" are used interchangeably herein to describe a consumable that is of the type that is heated rather than combusted (or are used interchangeably to describe a device for use with such a consumable). The device may comprise a cavity that is configured for receipt of at least a portion of the consumable (i.e., for engagement with the consumable). The aerosol-forming article may be of the type that comprises an aerosol former (e.g., carried by an aerosol-forming substrate).

The device may comprise a heater for heating the aerosol-forming article. The heater may comprise a heating element, which may be in the form of a rod that extends from the body of the device. The heating element may extend from the end of the body that is configured for engagement with the aerosol-forming article.

The heater (and thus the heating element) may be rigidly mounted to the body. The heating element may be elongate so as to define a longitudinal axis and may, for example, have a transverse profile (i.e., transverse to a longitudinal axis of the heating element) that is substantially circular (i.e., the heating element may be generally cylindrical). Alternatively, the heating element may have a transverse profile that is rectangular (i.e., the heater may be a "blade heater"). The heating element may alternatively be in the shape of a tube (i.e., the heater may be a "tube heater"). The heating element may take other forms (e.g., the heating element may have an elliptical transverse profile). The shape and/or size (e.g., diameter) of the transverse profile of the heating element may be generally consistent for the entire length (or substantially the entire length) of the heating element.

The heating element may be between 15 mm and 25 mm long, e.g., between 18 mm and 20 mm long, e.g., around 19 mm long. The heating element may have a diameter of between 1.5 mm and 2.5 mm, e.g., a diameter between 2 mm and 2.3 mm, e.g., a diameter of around 2.15 mm.

The heating element may be formed of ceramic. The heating element may comprise a core (e.g., a ceramic core) comprising Al2O3. The core of the heating element may have a diameter of 1.8 mm to 2.1 mm, e.g., between 1.9 mm and 2 mm. The heating element may comprise an outer layer (e.g., an outer ceramic layer) comprising Al2O3. The thickness of the outer layer may be between 160 μm and 220 μm, 10 e.g., between 170 μm and 190 μm, e.g., around 180 μm. The heating element may comprise a heating track, which may extend longitudinally along the heating element. The heating track may be sandwiched between the outer layer and the core of the heating element. The heating track may comprise tungsten and/or rhenium. The heating track may have a thickness of around 20 μm.

The heating element may be located in the cavity (of the device), and may extend (e.g., along a longitudinal axis) from an internal base of the cavity towards an opening of the cavity. The length of the heating element (i.e., along the longitudinal axis of the heater) may be less than the depth of the cavity. Hence, the heating element may extend for only a portion of the length of the cavity. That is, the heating element may not extend through (or beyond) the opening of the cavity.

The heating element may be configured for insertion into an aerosol-forming article (e.g., a HT 20 consumable) when an aerosol-forming article is received in the cavity. In that respect, a distal end (i.e., distal from a base of the heating element where it is mounted to the device) of the heating element may comprise a tapered portion, which may facilitate insertion of the heating element into the aerosol-forming article. The heating element may fully penetrate an aerosol-forming article when the aerosol-forming article is received in the cavity. That is, the entire length, or substantially the entire length, of the heating element may be received in the aerosol-forming article.

The heating element may have a length that is less than, or substantially the same as, an axial length of an aerosol-forming substrate forming part of an aerosol-forming article (e.g., a HT consumable). Thus, when such an aerosol-forming article is engaged with the device, the heating element may only penetrate the aerosol-forming substrate, rather than other components of the aerosol-forming article. The heating element may penetrate the aerosol-forming substrate for substantially the entire axial length of the aerosol forming-substrate of the aerosol-forming article. Thus, heat may be transferred from (e.g., an outer circumferential surface of) the heating element to the surrounding aerosol-forming substrate, when penetrated by the heating element. That is, heat may be transferred radially outwardly (in the case of a cylindrical heating element) or e.g., radially inwardly (in the case of a tube heater).

Where the heater is a tube heater, the heating element of the tube heater may surround at least a portion of the cavity. When the portion of the aerosol-forming article is received in the cavity, the heating element may surround a portion of the aerosol-forming article (i.e., so as to heat that portion of the aerosol-forming article). In particular, the heating element may surround an aerosol forming substrate of the aerosol-forming article. That is, when an aerosol-forming article is engaged with the device, the aerosol forming substrate of the aerosol-forming article may be located adjacent an inner surface of the (tubular) heating element. When the heating element is activated, heat may be transferred radially inwardly from the inner surface of the heating element to heat the aerosol forming substrate.

The cavity may comprise a (e.g., circumferential) wall (or walls) and the (tubular) heating element may extend around at least a portion of the wall(s). In this way, the wall may be located between the inner surface of the heating element and an outer surface of the aerosol-forming article. The wall (or walls) of the cavity may be formed from a thermally conductive material (e.g., a metal) to allow heat conduction from the heating element to the aerosol-forming article. Thus, heat may be conducted from the heating element, through the cavity wall (or walls), to the aerosol-forming substrate of an aerosol-forming article received in the cavity.

In some embodiments the device may comprise a cap disposed at the end of the body that is configured for engagement with an aerosol-forming article. Where the device comprises a heater having a heating element, the cap may at least partially enclose the heating element. The cap may be moveable between an open position in which access is provided to the heating element, and a closed position in which the cap at least partially encloses the heating element. The cap may be slideably engaged with the body of the device, and may be slideable between the open and closed positions.

The cap may define at least a portion of the cavity of the device. That is, the cavity may be fully defined by the cap, or each of the cap and body may define a portion of the cavity. Where the cap fully defines the cavity, the cap may comprise an aperture for receipt of the heating element into the cavity (when the cap is in the closed position). The cap may comprise an opening to the cavity. The opening may be configured for receipt of at least a portion of an aerosol-forming article. That is, an aerosol-forming article may be inserted through the opening and into the cavity (so as to be engaged with the device).

The cap may be configured such that when an aerosol-forming article is engaged with the device (e.g., received in the cavity), only a portion of the aerosol-forming article is received in the cavity. That is, a portion of the aerosol-forming article (not received in the cavity) may protrude from (i.e., extend beyond) the opening. This (protruding) portion of the aerosol-forming article may be a terminal (e.g., mouth) end of the aerosol-forming article, which may be received in a user's mouth for the purpose of inhaling aerosol formed by the device.

The device may comprise a power source or may be connectable to a power source (e.g., a power source separate to the device). The power source may be electrically connectable to the heater. In that respect, altering (e.g., toggling) the electrical connection of the power source to the heater may affect a state of the heater. For example, toggling the electrical connection of the power source to the heater may toggle the heater between an on state and an off state. The power source may be a power store. For example, the power source may be a battery or rechargeable battery (e.g., a lithium ion battery).

The device may comprise an input connection (e.g., a USB port, Micro USB port, USB-C port, etc.). The input connection may be configured for connection to an external source of electrical power, such as a mains electrical supply outlet. The input connection may, in some cases, be used as a substitute for an internal power source (e.g., battery or rechargeable battery). That is, the input connection may be electrically connectable to the heater (for providing power to the heater). Hence, in some forms, the input connection may form at least part of the power source of the device.

Where the power source comprises a rechargeable power source (such as a rechargeable battery), the input connection may be used to charge and recharge the power source.

The device may comprise a user interface (UI). In some embodiments the UI may include input means to receive operative commands from the user. The input means of the UI may allow the user to control at least one aspect of the operation of the device. In some embodiments the input means may comprise a power button to switch the device between an on state and an off state.

In some embodiments the UI may additionally or alternatively comprise output means to convey information to the user. In some embodiments the output means may comprise a light to indicate a condition of the device (and/or the aerosol-forming article) to the user. The condition of the device (and/or aerosol-forming article) indicated to the user may comprise a condition indicative of the operation of the heater. For example, the condition may comprise whether the heater is in an off state or an on state. In some embodiments, the UI unit may comprise at least one of a button, a display, a touchscreen, a switch, a light, and the like. For example, the output means may comprise one or more (e.g., two, three, four, etc.) light-emitting diodes ("LEDs") that may be located on the body of the device.

The device may further comprise a puff sensor (e.g., airflow sensor), which form part of the input means of the UI. The puff sensor may be configured to detect a user drawing on an end (i.e., a terminal (mouth) end) of the aerosol-forming article. The puff sensor may, for example, be a pressure sensor or a microphone. The puff sensor may be configured to produce a signal indicative of a puff state. The signal may be indicative of the user drawing (an aerosol from the aerosol-forming article) such that it is e.g., in the form of a binary signal. Alternatively or additionally, the signal may be indicative of a characteristic of the draw (e.g., a flow rate of the draw, length of time of the draw, etc.).

The device may comprise a controller, or may be connectable to a controller that may be configured to control at least one function of the device. The controller may comprise a microcontroller that may e.g.

30 be mounted on a printed circuit board (PCB). The controller may also comprise a memory, e.g., non-volatile memory. The memory may include instructions, which, when implemented, may cause the controller to perform certain tasks or steps of a method. Where the device comprises an input connection, the controller may be connected to the input connection.

The controller may be configured to control the operation of the heater (and e.g., the heating element). Thus, the controller may be configured to control vaporization of an aerosol forming part of an aerosol-forming article engaged with the device. The controller may be configured to control the voltage applied by power source to the heater. For example, the controller may be configured to toggle between applying a full output voltage (of the power source) to the heater and applying no voltage to the heater. Alternatively or additionally, the control unit may implement a more complex heater control protocol.

In some embodiments, the controller may control the power supply for supplying a predetermined first or second power level to the heater for heating to a first or second predetermined heating level.

5 Alternatively, the power supplied to the heater is pulse width modulation. Additionally, duty cycle of the pulse width modulation varies from the first power level to the second power level.

The device may further comprise a voltage regulator to regulate the output voltage supplied by the power source to form a regulated voltage. The regulated voltage may subsequently be applied to the heater.

In some embodiments, where the device comprises a UI, the controller may be operatively connected to one or more components of the UI. The controller may be configured to receive command signals from an input means of the UI. The controller may be configured to control the heater in response to the command signals. For example, the controller may be configured to receive "on" and "off" command signals from the UI and, in response, may control the heater so as to be in a corresponding on or off state.

The controller may be configured to send output signals to a component of the UI. The UI may be configured to convey information to a user, via an output means, in response to such output signals (received from the controller). For example, where the device comprises one or more LEDs, the LEDs may be operatively connected to the controller. Hence, the controller may be configured to control the illumination of the LEDs (e.g., in response to an output signal). For example, the controller may be configured to control the illumination of the LEDs according to (e.g., an on or off) state of the heater.

Where the device comprises sensor (e.g., a puff/airflow sensor), the controller may be operatively connected to the sensor. The controller may be configured to receive a signal from the sensor (e.g., indicative of a condition of the device and/or engaged aerosol-forming article). The controller may be configured to control the heater, or an aspect of the output means, based on the signal from the sensor.

The device may comprise a wireless interface configured to communicate wirelessly (e.g., via Bluetooth (e.g., a Bluetooth low-energy connection) or Wi-Fi) with an external device. Similarly, the input connection may be configured for wired connection to an external device so as to provide communication between the device and the external device.

The external device may be a mobile device. For example, the external device may be a smartphone, tablet, smart watch, or smart car. An application (e.g., app) may be installed on the external device (e.g., mobile device). The application may facilitate communication between the device and the external device via the wired or wireless connection.

The wireless or wired interface may be configured to transfer signals between the external device and the controller of the device. In this respect, the controller may control an aspect of the device in response to a signal received from an external device. Alternatively or additionally, an external device may respond to a signal received from the device (e.g., from the controller of the device).

In a second aspect of the twelfth mode, there is provided a system (e.g., a smoking substitute system) comprising a device according to the first aspect and an aerosol-forming article. The aerosol-forming article may comprise an aerosol-forming substrate at an upstream end of the aerosol-forming article. The article may be in the form of a smoking substitute article, e.g., heated tobacco (HT) consumable (also known as a heat-not-burn (HNB) consumable).

As used herein, the terms "upstream" and "downstream" are intended to refer to the flow direction of the vapor/aerosol i.e., with the downstream end of the article/consumable being the mouth end or outlet where the aerosol exits the consumable for inhalation by the user. The upstream end of the article/consumable is the opposing end to the downstream end.

The aerosol-forming substrate is capable of being heated to release at least one volatile compound that can form an aerosol. The aerosol-forming substrate may be located at the upstream end of the article/consumable.

In order to generate an aerosol, the aerosol-forming substrate comprises at least one volatile compound that is intended to be vaporized/aerosolized and that may provide the user with a recreational and/or medicinal effect when inhaled. Suitable chemical and/or physiologically active volatile compounds include the group consisting of: nicotine, cocaine, caffeine, opiates and opioids, cathine and cathinone, kavalactones, mysticin, beta-carboline alkaloids, salvinorin A together with any combinations, functional equivalents to, and/or synthetic alternatives of the foregoing.

The aerosol-forming substrate may comprise plant material. The plant material may comprise least one plant material selected from the list including *Amaranthus dubius, Arctostaphylos uva-ursi* (Bearberry), *Argemone mexicana, Amica, Artemisia vulgaris*, Yellow Tees, *Galea zacatechichi, Canavalia maritima* (Baybean), *Cecropia mexicana* (Guamura), *Cestrum noctumum, Cynoglossum virginianum* (wild comfrey), *Cytisus scoparius, Damiana, Entada rheedii, Eschscholzia califomica* (California Poppy), *Fittonia albivenis, Hippobroma longiflora, Humulus japonica* (Japanese Hops), *Humulus lupulus* (Hops), *Lactuca virosa* (Lettuce Opium), *Laggera alata, Leonotis leonurus, Leonurus cardiaca* (Motherwort), *Leonurus sibiricus* (Honeyweed), *Lobelia cardinalis, Lobelia inflata* (Indian-tobacco), *Lobelia siphilitica, Nepeta cataria* (Catnip), *Nicotiana* species (Tobacco), *Nymphaea alba* (White Lily), *Nymphaea caerulea* (Blue Lily), Opium poppy, *Passiflora incamata* (Passionflower), *Pedicularis densiflora* (Indian Warrior), *Pedicularis groenlandica* (Elehant's Head), *Salvia divinorum, Salvia dorrii* (Tobacco Sage), Salvia species (Sage), *Scutellaria galericulata, Scutellaria lateriflora, Scutellaria nana, Scutellaria* species (Skullcap), *Sida acuta* (Wireweed), *Sida rhombifolia, Silene capensis, Syzygium aromaticum* (Clove), *Tagetes lucida* (Mexican Tarragon), *Tarchonanthus camphoratus, Tumera diffusa* (Damiana), *Verbascum* (Mullein), *Zamia latifolia* (Maconha Brava) together with any combinations, functional equivalents to, and/or synthetic alternatives of the foregoing.

The plant material may be tobacco. Any type of tobacco may be used. This includes, but is not limited to, flue-cured tobacco, burley tobacco, Maryland Tobacco, dark-air cured tobacco, oriental tobacco, dark-fired tobacco, perique tobacco and rustica tobacco. This also includes blends of the above mentioned tobaccos.

The tobacco may comprise one or more of leaf tobacco, stem tobacco, tobacco powder, tobacco dust, tobacco derivatives, expanded tobacco, homogenized tobacco, shredded tobacco, extruded tobacco, cut rag tobacco and/or reconstituted tobacco (e.g., slurry recon or paper recon).

The aerosol-forming substrate may comprise a gathered sheet of homogenized (e.g., paper/slurry recon) tobacco or gathered shreds/strips formed from such a sheet.

The aerosol-forming substrate may comprise one or more additives selected from humectants, flavorants, fillers, aqueous/non-aqueous solvents and binders.

The flavorant may be provided in solid or liquid form. It may include menthol, licorice, chocolate, fruit flavor (including e.g., citrus, cherry etc.), vanilla, spice (e.g., ginger, cinnamon) and tobacco flavor. The flavorant may be evenly dispersed throughout the aerosol-forming substrate or may be provided in isolated locations and/or varying concentrations throughout the aerosol-forming substrate.

The aerosol-forming substrate may be formed in a substantially cylindrical shape such that the article/consumable resembles a conventional cigarette. It may have a diameter of between 5 and 10 mm e.g., between 6 and 9 mm or 6 and 8 mm e.g., around 7 mm. It may have an axial length of between 10 and 15 mm e.g., between 11 and 14 mm such as around 12 or 13 mm.

The article/consumable may comprise at least one filter element. There may be a terminal filter element at the downstream/mouth end of the article/consumable.

The or at least one of the filter element(s) (e.g., the terminal filter element) may be comprised of cellulose acetate or polypropylene tow. The at least one filter element (e.g., the terminal filter element) may be comprised of activated charcoal. The at least one filter element (e.g., the terminal element) may be comprised of paper. The or each filter element may be at least partly (e.g., entirely) circumscribed with a plug wrap e.g., a paper plug wrap.

The terminal filter element (at the downstream end of the article/consumable) may be joined to the upstream elements forming the article/consumable by a circumscribing tipping layer e.g., a tipping paper layer. The tipping paper may have an axial length longer than the axial length of the terminal filter element such that the tipping paper completely circumscribes the terminal filter element plus the wrapping layer surrounding any adjacent upstream element.

In some embodiments, the article/consumable may comprise an aerosol-cooling element which is adapted to cool the aerosol generated from the aerosol-forming substrate (by heat exchange) before being inhaled by the user.

The article/consumable may comprise a spacer element that defines a space or cavity between the aerosol-forming substrate and the downstream end of the consumable. The spacer element may comprise a cardboard tube. The spacer element may be circumscribed by the (paper) wrapping layer.

The twelfth mode of the disclosure includes the combination of the aspects and preferred features described except where such a combination is clearly impermissible or expressly avoided.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

Thirteenth Mode of the Disclosure: A Heat Not Burn Device Having a Longitudinal Heating Element At its most general, the thirteen mode of the present disclosure relates to a heat not burn device.

According to a first aspect of the thirteenth mode of the present disclosure, there is provided heater for a heat not burn device. The heater includes a longitudinal heating element including a resistive heating track formed thereon. The heater further includes a mount surrounding a portion of the heating element and the heating track. The heating element is formed from a heater material of a first thermal conductivity and the mount is formed from a mount material of a second thermal conductivity. The second thermal conductivity is lower than the first thermal conductivity.

By providing a heat not burn device comprising a heater having a mount formed from a material having lower thermal conductivity than the material of the heating element, the device may be enabled to contain the heat where it most needed. i.e., in the region where the heating element is located and minimize losses in heat.

Optional features will now be set out. These are applicable singly or in any combination with any aspect.

Advantageously, the first thermal conductivity is at least 3 times greater than the second thermal conductivity, preferably 6 times, more preferably 10 times greater or more than the second thermal conductivity. Thereby more heat is imparted and kept in the region where it is needed with less losses in heat.

Optionally, the longitudinal heating element is configured to penetrate the tobacco portion of a consumable engaged with the device.

Advantageously, the heater material is alumina, thereby improving the hardness of the rod heater.

Conveniently, the mount material is zirconia, thereby improving the longevity of the mount.

Optionally, the resistivity of the heating track is substantially uniform along a portion of the longitudinal heating element extending between the mount and a heating region of the longitudinal heating element. This enables uniform heat distribution to the aerosol forming substrate.

Conveniently, the mount extends longitudinally along the heating element by a distance of between 1 and 4 mm.

Optionally, the longitudinal heating element is located within a passage through the mount.

Optionally, the heater includes connection means connected to the heater track at a contact location.

Optionally, the contact location is on an opposite side of the mount to the heating portion of the heater.

Optionally, the mount is connected to the device.

Advantageously, the mount is bonded to the device.

The device may comprise an elongate body. An end of the elongate body may be configured for engagement with an aerosol-forming article. For example, the body may be configured for engagement with a heated tobacco (HT) consumable (or heat-not-burn (HNB) consumable). The terms "heated tobacco" and "heat-not-burn" are used interchangeably herein to describe a consumable that is of the type that is heated rather than combusted (or are used interchangeably to describe a device for use with such a consumable). The device may comprise a cavity that is configured for receipt of at least a portion of the consumable (i.e., for engagement with the consumable). The aerosol-forming article may be of the type that comprises an aerosol former (e.g., carried by an aerosol-forming substrate).

The device may comprise a heater for heating the aerosol-forming article. The heater may comprise a heating element, which may be in the form of a rod that extends from the body of the device. The heating element may extend from the end of the body that is configured for engagement with the aerosol-forming article.

The heater (and thus the heating element) may be rigidly mounted to the body. The heating element may be elongate so as to define a longitudinal axis and may, for example, have a transverse profile (i.e., transverse to a longitudinal axis of the heating element) that is substantially circular (i.e., the heating element may be generally cylindrical). Alternatively, the heating element may have a transverse profile that is rectangular (i.e., the heater may be a "blade heater"). The heating element may alternatively be in the shape of a tube (i.e., the heater may be a "tube heater"). The heating element may take other forms (e.g., the heating element may have an elliptical transverse profile). The shape and/or size (e.g., diameter) of the transverse profile of the heating element may be generally consistent for the entire length (or substantially the entire length) of the heating element.

The heating element may be between 15 mm and 25 mm long, e.g., between 18 mm and 20 mm long, e.g., around 19 mm long. The heating element may have a diameter of between 1.5 mm and 2.5 mm, e.g., a diameter between 2 mm and 2.3 mm, e.g., a diameter of around 2.15 mm.

The heating element may be formed of ceramic. The heating element may comprise a core (e.g., a ceramic core) comprising Al2O3. The core of the heating element may have a diameter of 1.8 mm to 2.1 mm, e.g., between 1.9 mm and 2 mm. The heating element may comprise an outer layer (e.g., an outer ceramic layer) comprising Al2O3. The thickness of the outer layer may be between 160 μm and 220 μm, e.g., between 170 μm and 190 μm, e.g., around 180 μm. The heating element may comprise a heating track, which may extend longitudinally along the heating element. The heating track may be sandwiched between the outer layer and the core of the heating element. The heating track may comprise tungsten and/or rhenium. The heating track may have a thickness of around 20 μm.

The heating element may be located in the cavity (of the device), and may extend (e.g., along a longitudinal axis) from an internal base of the cavity towards an opening of the cavity. The length of the heating element (i.e., along the longitudinal axis of the heater) may be less than the depth of the cavity.

30 Hence, the heating element may extend for only a portion of the length of the cavity. That is, the heating element may not extend through (or beyond) the opening of the cavity.

The heating element may be configured for insertion into an aerosol-forming article (e.g., a HT consumable) when an aerosol-forming article is received in the cavity. In that respect, a distal end (i.e., distal from a base of the heating element where it is mounted to the device) of the heating element may comprise a tapered portion, which may facilitate insertion of the heating element into the aerosol-forming article. The heating element may fully penetrate an aerosol-forming article when the aerosol-forming article is received in the cavity. That is, the entire length, or substantially the entire length, of the heating element may be received in the aerosol-forming article.

The heating element may have a length that is less than, or substantially the same as, an axial length of an aerosol-forming substrate forming part of an aerosol-forming article (e.g., a HT consumable).

Thus, when such an aerosol-forming article is engaged with the device, the heating element may only penetrate the aerosol-forming substrate, rather than other components of the aerosol-forming article. The heating element may penetrate the aerosol-forming substrate for substantially the entire axial length of the aerosol forming-substrate of the aerosol-forming article. Thus, heat may be transferred from (e.g., an outer circumferential surface of) the heating element to the surrounding aerosol-forming substrate, when penetrated by the heating element. That is, heat may be transferred radially outwardly (in the case of a cylindrical heating element) or e.g., radially inwardly (in the case of a tube heater).

Where the heater is a tube heater, the heating element of the tube heater may surround at least a portion of the cavity. When the portion of the aerosol-forming article is received in the cavity, the heating element may surround a portion of the aerosol-forming article (i.e., so as to heat that portion of the aerosol-forming article). In particular, the heating element may surround an aerosol forming substrate of the aerosol-forming article. That is, when an aerosol-forming article is engaged with the device, the aerosol forming substrate of the aerosol-forming article may be located adjacent an inner surface of the (tubular) heating element. When the heating element is activated, heat may be transferred radially inwardly from the inner surface of the heating element to heat the aerosol forming substrate.

In one embodiment, the heater includes a longitudinal heating element including a resistive heating track formed thereon. The heater further includes a mount surrounding a portion of the heating element and the heating track. The heating element is formed from a heater material of a first thermal conductivity and the mount is formed from a mount material of a second thermal conductivity. The second thermal conductivity is at least 3 times lower than the first thermal conductivity. The longitudinal heating element is configured to penetrate the tobacco portion of a consumable engaged with the device. Optionally, the heater material may be alumina and the mount material may be zirconia. The resistivity of the heating track is substantially uniform along a portion of the longitudinal heating element extending between the mount and a heating region of the longitudinal heating element. The mount may extend longitudinally along the heating element by a distance of between 1 and 4 mm and the longitudinal heating element may be located within a passage through the mount. The heater may include connection means connected to the heater track at a contact location. The contact location is on an opposite side of the mount to the heating portion of the heater.

Providing a mount with in accordance with the thirteenth mode of the present disclosure may provide an improvement of the hardness of the rod heater mounting plate for a heated tobacco device, an improvement of the longevity of the mounting plate for the heater device, and thermal characteristics of the heated tobacco device in general. Isolation of other parts of the overall device from the heated part of the rod heater may be increased, and thus the heat impact on other parts reduced. Further, reflection of heat back to the heated area of the rod heater may result in less heat needed to keep the rod heater and overall device at temperature. Mounting material made out of zirconia may be used as a mounting base as well as a thermal shield for rod heater. Because zirconia has a thermal conductivity which is a fraction of that e.g., for alumina or other material of which the rod heating element is made of, much of the heat produced by the rod heater in the region near the zirconia base is reflected back into the heater. The zirconia material surrounds the rod heater preferably in a cylindrical structure. Mounting and longevity of usage are facilitated owing to the high hardness of the zirconia. The shape of the zirconia base may be square or round and may have a thickness, which extends along the rod heater. The thickness of the zirconia plate may preferably be at least 1 mm.

Mounting and longevity of usage are facilitated owing to the high hardness of the zirconia. The shape of the zirconia base can be square or round and has a thickness which extends along the rod heater (cylindrical shape). The thickness of the zirconia plate is at least 1 mm.

The cavity may comprise a (e.g., circumferential) wall (or walls) and the (tubular) heating element may extend around at least a portion of the wall(s). In this way, the wall may be located between the inner surface of the heating element and an outer surface of the aerosol-forming article. The wall (or walls) of the cavity may be formed from a thermally conductive material (e.g., a metal) to allow heat conduction from the heating element to the aerosol-forming article. Thus, heat may be conducted from the heating element, through the cavity wall (or walls), to the aerosol-forming substrate of an aerosol-forming article received in the cavity.

In some embodiments the device may comprise a cap disposed at the end of the body that is configured for engagement with an aerosol-forming article. Where the device comprises a heater having a heating element, the cap may at least partially enclose the heating element. The cap may be moveable between an open position in which access is provided to the heating element, and a closed position in which the cap at least partially encloses the heating element. The cap may be slideably engaged with the body of the device, and may be slideable between the open and closed positions.

The cap may define at least a portion of the cavity of the device. That is, the cavity may be fully defined by the cap, or each of the cap and body may define a portion of the cavity. Where the cap fully defines the cavity, the cap may comprise an aperture for receipt of the heating element into the cavity (when the cap is in the closed position). The cap may comprise an opening to the cavity. The opening may be configured for receipt of at least a portion of an aerosol-forming article. That is, an aerosol-forming article may be inserted through the opening and into the cavity (so as to be engaged with the device).

The cap may be configured such that when an aerosol-forming article is engaged with the device (e.g., received in the cavity), only a portion of the aerosol-forming article is received in the cavity. That is, a portion of the aerosol-forming article (not received in the cavity) may protrude from (i.e., extend beyond 35 the opening. This (protruding) portion of the aerosol-forming article may be a terminal (e.g., mouth) end of the aerosol-forming article, which may be received in a user's mouth for the purpose of inhaling aerosol formed by the device.

The device may comprise a power source or may be connectable to a power source (e.g., a power source separate to the device). The power source may be electrically connectable to the heater. In that respect, altering (e.g., toggling) the electrical connection of the power source to the heater may affect a state of the heater. For example, toggling the electrical connection of the power source to the heater may toggle the heater between an on state and an off state. The power source may be a power store. For example, the power source may be a battery or rechargeable battery (e.g., a lithium ion battery).

The device may comprise an input connection (e.g., a USB port, Micro USB port, USB-C port, etc.). The input connection may be configured for connection to an external source of electrical power, such as a mains electrical supply outlet. The input connection may, in some cases, be used as a substitute for an internal power source (e.g., battery or rechargeable battery). That is, the input connection may be electrically connectable to the heater (for providing power to the heater). Hence, in some forms, the input connection may form at least part of the power source of the device where the power source comprises a rechargeable power source (such as a rechargeable battery), the input connection may be used to charge and recharge the power source.

The device may comprise a user interface (UI). In some embodiments the UI may include input means to receive operative commands from the user. The input means of the UI may allow the user to control at least one aspect of the operation of the device. In some embodiments the input means may comprise a power button to switch the device between an on state and an off state.

In some embodiments the UI may additionally or alternatively comprise output means to convey information to the user. In some embodiments the output means may comprise a light to indicate a condition of the device (and/or the aerosol-forming article) to the user. The condition of the device (and/or aerosol-forming article) indicated to the user may comprise a condition indicative of the operation of the heater. For example, the condition may comprise whether the heater is in an off state or an on state. In some embodiments, the UI unit may comprise at least one of a button, a display, a touchscreen, a switch, a light, and the like. For example, the output means may comprise one or more (e.g., two, three, four, etc.) light-emitting diodes ("LEDs") that may be located on the body of the device.

The device may further comprise a puff sensor (e.g., airflow sensor), which form part of the input means of the UI. The puff sensor may be configured to detect a user drawing on an end (i.e., a terminal (mouth) end) of the aerosol-forming article. The puff sensor may, for example, be a pressure sensor or a microphone. The puff sensor may be configured to produce a signal indicative of a puff state. The signal may be indicative of the user drawing (an aerosol from the aerosol-forming article) such that it is e.g., in the form of a binary signal. Alternatively, or additionally, the signal may be indicative of a characteristic of the draw (e.g., a flow rate of the draw, length of time of the draw, etc).

The device may comprise a controller, or may be connectable to a controller that may be configured to control at least one function of the device. The controller may comprise a microcontroller that may e.g., be mounted on a printed circuit board (PCB). The controller may also comprise a memory, e.g., non-volatile memory. The memory may include instructions, which, when implemented, may cause the controller to perform certain tasks or steps of a method.

Where the device comprises an input connection, the controller may be connected to the input connection.

The controller may be configured to control the operation of the heater (and e.g., the heating element). Thus, the controller may be configured to control vaporization of an aerosol forming part of an aerosol-forming article engaged with the device. The controller may be configured to control the voltage applied by power source to the heater. For example, the controller may be configured to toggle between applying a full output voltage (of the power source) to the heater and applying no voltage to the heater. Alternatively, or additionally, the control unit may implement a more complex heater control protocol.

The device may further comprise a voltage regulator to regulate the output voltage supplied by the power source to form a regulated voltage. The regulated voltage may subsequently be applied to the heater.

In some embodiments, where the device comprises a UI, the controller may be operatively connected to one or more components of the UI. The controller may be configured to receive command signals from an input means of the UI. The controller may be configured to control the heater in response to the command signals. For example, the controller may be configured to receive "on" and "off" command signals from the UI and, in response, may control the heater so as to be in a corresponding on or off state.

The controller may be configured to send output signals to a component of the UI. The UI may be configured to convey information to a user, via an output means, in response to such output signals (received from the controller). For example, where the device comprises one or more LEDs, the LEDs may be operatively connected to the controller. Hence, the controller may configured to control the illumination of the LEDs (e.g., in response to an output signal). For example, the controller may be configured to control the illumination of the LEDs according to (e.g., an on or off) state of the heater.

Where the device comprises a sensor (e.g., a puff/airflow sensor), the controller may be operatively connected to the sensor. The controller may be configured to receive a signal from the sensor (e.g., indicative of a condition of the device and/or engaged aerosol-forming article). The controller may be configured to control the heater, or an aspect of the output means, based on the signal from the sensor.

The device may comprise a wireless interface configured to communicate wirelessly (e.g., via Bluetooth (e.g., a Bluetooth low-energy connection) or WiFi) with an external device. Similarly, the input connection may be configured for wired connection to an external device so as to provide communication between the device and the external device.

The external device may be a mobile device. For example, the external device may be a smart phone, tablet, smart watch, or smart car. An application (e.g., app) may be installed on the external device (e.g., mobile device). The application may facilitate communication between the device and the external device via the wired or wireless connection.

The wireless or wired interface may be configured to transfer signals between the external device and the controller of the device. In this respect, the controller may control an aspect of the device in response to a signal received from an external device. Alternatively, or additionally, an external device may respond to a signal received from the device (e.g., from the controller of the device).

In a second aspect of the thirteenth mode, there is provided a system (e.g., a smoking substitute system) comprising a heating not burn device according to the present disclosure and an aerosol-forming article. The aerosol-forming article may comprise an aerosol-forming substrate at an upstream end of the aerosol-forming article. The article may be in the form of a smoking substitute article, e.g., heated tobacco (HT) consumable (also known as a heat-not-burn (HNB) consumable).

As used herein, the terms "upstream" and "downstream" are intended to refer to the flow direction of the vapor/aerosol i.e., with the downstream end of the article/consumable being the mouth end or outlet where the aerosol exits the consumable for inhalation by the user. The upstream end of the article/consumable is the opposing end to the downstream end.

The aerosol-forming substrate is capable of being heated to release at least one volatile compound that can form an aerosol. The aerosol-forming substrate may be located at the upstream end of the article/consumable.

In order to generate an aerosol, the aerosol-forming substrate comprises at least one volatile compound that is intended to be vaporized/aerosolized and that may provide the user with a recreational and/or medicinal effect when inhaled. Suitable chemical and/or physiologically active volatile compounds include the group consisting of: nicotine, cocaine, caffeine, opiates and opioids, cathine and cathinone, kavalactones, mysticin, beta-carboline alkaloids, salvinorin A together with any combinations, functional equivalents to, and/or synthetic alternatives of the foregoing.

The aerosol-forming substrate may comprise plant material. The plant material may comprise least one plant material selected from the list including *Amaranthus dubius, Arctostaphylos uva-ursi* (Bearberry), *Argemone mexicana, Amica, Artemisia vulgaris*, Yellow Tees, *Galea zacatechichi, Canavalia maritima* (Baybean), *Cecropia mexicana* (Guamura), *Cestrum noctumum, Cynoglossum virginianum* (wild comfrey), *Cytisus scoparius, Damiana, Entada rheedii, Eschscholzia califomica* (California Poppy), *Fittonia albivenis, Hippobroma longiflora, Humulus japonica* (Japanese Hops), *Humulus lupulus* (Hops), *Lactuca virosa* (Lettuce Opium), *Laggera alata, Leonotis leonurus, Leonurus cardiaca* (Motherwort), *Leonurus sibiricus* (Honeyweed), *Lobelia cardinalis, Lobelia inflata* (Indian-tobacco), *Lobelia siphilitica, Nepeta cataria* (Catnip), *Nicotiana* species (Tobacco), *Nymphaea alba* (White Lily), *Nymphaea caerulea* (Blue Lily), Opium poppy, *Passiflora incamata* (Passionflower), *Pedicularis densiflora* (Indian Warrior), *Pedicularis groenlandica* (Elehant's Head), *Salvia divinorum, Salvia dorrii* (Tobacco Sage), Salvia species (Sage), *Scutellaria galericulata, Scutellaria lateriflora, Scutellaria nana, Scutellaria* species (Skullcap), *Sida acuta* (Wireweed), *Sida rhombifolia, Silene capensis, Syzygium aromaticum* (Clove), *Tagetes lucida* (Mexican Tarragon), *Tarchonanthus camphoratus, Tumera diffusa* (Damiana), *Verbascum* (Mullein), *Zamia latifolia* (Maconha Brava) together with any combinations, functional equivalents to, and/or synthetic alternatives of the foregoing.

The plant material may be tobacco. Any type of tobacco may be used. This includes, but is not limited to, flue-cured tobacco, burley tobacco, Maryland Tobacco, dark-air cured tobacco, oriental tobacco, dark-fired tobacco, perique tobacco and rustica tobacco. This also includes blends of the above mentioned tobaccos.

The tobacco may comprise one or more of leaf tobacco, stem tobacco, tobacco powder, tobacco dust, tobacco derivatives, expanded tobacco, homogenized tobacco, shredded tobacco, extruded tobacco, cut rag tobacco and/or reconstituted tobacco (e.g., slurry recon or paper recon).

The aerosol-forming substrate may comprise a gathered sheet of homogenized (e.g., paper/slurry recon) tobacco or gathered shreds/strips formed from such a sheet.

The aerosol-forming substrate may comprise one or more additives selected from humectants, flavorants, fillers, aqueous/non-aqueous solvents and binders.

The flavorant may be provided in solid or liquid form. It may include menthol, licorice, chocolate, fruit flavor (including e.g., citrus, cherry etc.), vanilla, spice (e.g., ginger, cinnamon) and tobacco flavor. The flavorant may be evenly dispersed throughout the aerosol-forming substrate or may be provided in isolated locations and/or varying concentrations throughout the aerosol-forming substrate.

The aerosol-forming substrate may be formed in a substantially cylindrical shape such that the article/consumable resembles a conventional cigarette. It may have a diameter of between 5 and 10 mm e.g., between 6 and 9 mm or 6 and 8 mm e.g., around 7 mm. It may have an axial length of between 10 and 15 mm e.g., between 11 and 14 mm such as around 12 or 13 mm.

The article/consumable may comprise at least one filter element. There may be a terminal filter element at the downstream/mouth end of the article/consumable.

The or at least one of the filter element(s) (e.g., the terminal filter element) may be comprised of cellulose acetate or polypropylene tow. The at least one filter element (e.g., the terminal filter element) may be comprised of activated charcoal. The at least one filter element (e.g., the terminal element) may be comprised of paper. The or each filter element may be at least partly (e.g., entirely) circumscribed with a plug wrap e.g., a paper plug wrap.

The terminal filter element (at the downstream end of the article/consumable) may be joined to the upstream elements forming the article/consumable by a circumscribing tipping layer e.g., a tipping paper layer. The tipping paper may have an axial length longer than the axial length of the terminal filter element such that the tipping paper completely circumscribes the terminal filter element plus the wrapping layer surrounding any adjacent upstream element.

In some embodiments, the article/consumable may comprise an aerosol-cooling element which is adapted to cool the aerosol generated from the aerosol-forming substrate (by heat exchange) before being inhaled by the user.

The article/consumable may comprise a spacer element that defines a space or cavity between the aerosol-forming substrate and the downstream end of the consumable. The spacer element may comprise a cardboard tube. The spacer element may be circumscribed by the (paper) wrapping layer.

According to another aspect of the thirteenth mode of the present disclosure, there is provided a method of using the smoking substitute system according to the second aspect, the method comprising inserting the aerosol-forming article into the device; and heating the article using the heater of the device.

In some embodiments the method may comprise inserting the article into a cavity within a body of the device and penetrating the article with the heating element of the device upon insertion of the article.

According to one more aspect of the thirteenth mode of the present disclosure, there is provided a smoking substitute system comprising a heat not burn device including a heater in accordance with the present disclosure.

The thirteenth mode of the disclosure includes the combination of the aspects and preferred features described except where such a combination is clearly impermissible or expressly avoided.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

Fourteenth Mode of the Disclosure:

At its most general, the fourteenth mode of the present disclosure relates to a heat not burn device for controlling heating in different phases.

According to the fourteenth mode of the present disclosure, there is provided a heat not burn device including a heater and a power supply, wherein the device is configured to: control power supplied to the heater from the power supply during an initial heating phase to raise the temperature of the heater to an operating temperature; wherein the initial heating phase includes a pause period, during which power is supplied to the heater to maintain the temperature of the heater at a pause temperature, wherein the pause temperature is between the ambient temperature and the operating temperature.

By providing a heat not burn device for controlling heating in a delayed or phased manner, this results in whole or part of the consumable reaching the desired temperature while exhibiting none of the charring, singeing, burns or thermal shock, thereby avoiding burnt or near burnt state of the tobacco.

The term "initial heating phase" is intended to refer to the phase between initial heating state and state of predetermined operating temperature. The term "pause period" is intended to refer to time period during which the heater may not be heated or heated with low intensity. The term "pause temperature" is the temperature of the heater during the pause period.

Optional features will now be set out. These are applicable singly or in any combination with any aspect.

Optionally, the heater is maintained at the pause temperature for the pause period for avoiding burnt or near burnt state of the tobacco.

Advantageously, the pause period is one of: between 0.1 to 30 seconds, between 1 and 10 seconds, between 2 and 7 seconds, and between 3 and 4 seconds. The duration may be chosen for a shorter period of time, which may last only for few seconds and therefore impacting little on the heating performance.

Conveniently, the pause period is calculated based on the present voltage of the power supply.

Optionally, the pause temperature is calculated based on the present voltage of the power supply.

Advantageously, the pause period occurs after a predetermined period from the commencement of the initial heating phase, ensuring that the increase in the temperature is gradual and in a phased manner.

Conveniently, the device is configured to include more than one pause period, wherein each pause period has a different pause temperature, to ensure phased step up of the heating of the rod heater to a desired temperature level.

Optionally, the device 101 is configured to implement more than one pause period above ambient temperature and within the target temperature. This provides flexibility to choose the pause period at various temperature points between unheated states to threshold temperature level.

Advantageously, the device 101 is configured to implement more than one pause period before the temperature reaches 30% of the temperature difference between ambient and target temperature, above ambient temperature.

Conveniently, the pause temperature is greater than 30% of the temperature difference between ambient and target temperature, above ambient temperature is optionally 50% or 70% or 85%.

Optionally, the device 101 supplies a first power level before the pause period, and further supplies a second power level supplied immediately after the pause period wherein the first power level is different from the second power level. To ensure heating of the rod heater to reach first temperature level and second or any subsequent temperatures, before and after pause period.

Advantageously, the device supplies a first power level immediately before the pause period, and further supplies a second power level immediately after the pause period, wherein the first power level is substantially equal to the second power level. To ensure heating of the rod heater to reach first temperature level and second or any subsequent temperatures, before and after pause period.

Conveniently, further comprising a controller configured to selectively control temperature of the heater during the one or more pause period to ensure gradual increase of the temperature of the rod heater to avoid burnt or near burnt state of the tobacco and provide pleasant user experience.

The device may comprise an elongate body. An end of the elongate body may be configured for engagement with an aerosol-forming article. For example, the body may be configured for engagement with a heated tobacco (HT) consumable (or heat-not-burn (HNB) consumable). The terms "heated tobacco" and "heat-not-burn" are used interchangeably herein to describe a consumable that is of the type that is heated rather than combusted (or are used interchangeably to describe a device for use with such a consumable). The device may comprise a cavity that is configured for receipt of at least a portion of the consumable (i.e., for engagement with the consumable). The aerosol-forming article may be of the type that comprises an aerosol former (e.g., carried by an aerosol-forming substrate).

The device may comprise a heater for heating the aerosol-forming article. The heater may comprise a heating element, which may be in the form of a rod that extends from the body of the device. The heating element may extend from the end of the body that is configured for engagement with the aerosol-forming article.

The heater (and thus the heating element) may be rigidly mounted to the body. The heating element may be elongate so as to define a longitudinal axis and may, for example, have a transverse profile (i.e., transverse to a longitudinal axis of the heating element) that is substantially circular (i.e., the heating element may be generally cylindrical). Alternatively, the heating element may have a transverse profile that is rectangular (i.e., the heater may be a "blade heater"). The heating element may alternatively be in the shape of a tube (i.e., the heater may be a "tube heater"). The heating element may take other forms (e.g., the heating element may have an elliptical transverse profile). The shape and/or size (e.g., diameter) of the transverse profile of the heating element may be generally consistent for the entire length (or substantially the entire length) of the heating element.

The heating element may be between 15 mm and 25 mm long, e.g., between 18 mm and 20 mm long, e.g., around 19 mm long. The heating element may have a diameter of between 1.5 mm and 2.5 mm, e.g., a diameter between 2 mm and 2.3 mm, e.g., a diameter of around 2.15 mm.

The heating element may be formed of ceramic. The heating element may comprise a core (e.g., a ceramic core) comprising Al2O3. The core of the heating element may have a diameter of 1.8 mm to 2.1 mm, e.g., between 1.9 mm and 2 mm. The heating element may comprise an outer layer (e.g., an outer ceramic layer) comprising Al2O3. The thickness of the outer layer may be between 160 μm and 220 μm, e.g., between 170 μm and 190 μm, e.g., around 180 μm. The heating element may comprise a heating track, which may extend longitudinally along the heating element. The heating track may be sandwiched between the outer layer and the core of the heating element. The heating track may comprise tungsten and/or rhenium. The heating track may have a thickness of around 20 μm.

The heating element may be located in the cavity (of the device), and may extend (e.g., along a longitudinal axis) from an internal base of the cavity towards an opening of the cavity. The length of the heating element (i.e., along the longitudinal axis of the heater) may be less than the depth of the cavity. Hence, the heating element may extend for only a portion of the length of the cavity. That is, the heating element may not extend through (or beyond) the opening of the cavity.

The heating element may be configured for insertion into an aerosol-forming article (e.g., a HT consumable) when an aerosol-forming article is received in the cavity. In that respect, a distal end (i.e. distal from a base of the heating element where it is mounted to the device) of the heating element may comprise a tapered portion, which may facilitate insertion of the heating element into the aerosol-forming article. The heating element may fully penetrate an aerosol-forming article when the aerosol-forming article is received in the cavity. That is, the entire length, or substantially the entire length, of the heating element may be received in the aerosol-forming article.

The heating element may have a length that is less than, or substantially the same as, an axial length of an aerosol-forming substrate forming part of an aerosol-forming article (e.g., a HT consumable). Thus, when such an aerosol-forming article is engaged with the device, the heating element may only penetrate the aerosol-forming substrate, rather than other components of the aerosol-forming article. The heating element may penetrate the aerosol-forming substrate for substantially the entire axial length of the aerosol forming-substrate of the aerosol-forming article. Thus, heat may be transferred from (e.g., an outer circumferential surface of) the heating element to the surrounding aerosol-forming substrate, when penetrated by the heating element. That is, heat may be transferred radially outwardly (in the case of a cylindrical heating element) or e.g., radially inwardly (in the case of a tube heater).

Where the heater is a tube heater, the heating element of the tube heater may surround at least a portion of the cavity. When the portion of the aerosol-forming article is received in the cavity, the heating element may surround a portion of the aerosol-forming article (i.e., so as to heat that portion of the aerosol-forming article). In particular, the heating element may surround an aerosol forming substrate of the aerosol-forming article. That is, when an aerosol-forming article is engaged with the device, the aerosol forming substrate of the aerosol-forming article may be located adjacent an inner surface of the (tubular) heating element. When the heating element is activated, heat may be transferred radially inwardly from the inner surface of the heating element to heat the aerosol forming substrate.

The cavity may comprise a (e.g., circumferential) wall (or walls) and the (tubular) heating element may extend around at least a portion of the wall(s). In this way, the wall may be located between the inner surface of the heating element and an outer surface of the aerosol-forming article. The wall (or walls) of the cavity may be formed from a thermally conductive material (e.g., a metal) to allow heat conduction from the heating element to the aerosol-forming article. Thus, heat may be conducted from the heating element, through the cavity wall (or walls), to the aerosol-forming substrate of an aerosol-forming article received in the cavity.

In some embodiments the device may comprise a cap disposed at the end of the body that is configured for engagement with an aerosol-forming article. Where the device comprises a heater having a heating element, the cap may at least partially enclose the heating element. The cap may be moveable between an open position in which access is provided to the heating element, and a closed position in which the cap at least partially encloses the heating element. The cap may be slideably engaged with the body of the device, and may be slideable between the open and closed positions.

The cap may define at least a portion of the cavity of the device. That is, the cavity may be fully defined by the cap, or each of the cap and body may define a portion of the cavity. Where the cap fully defines the cavity, the cap may comprise an aperture for receipt of the heating element into the cavity (when the cap is in the closed position). The cap may comprise an opening to the cavity. The opening may be configured for receipt of at least a portion of an aerosol-forming article. That is, an aerosol-forming article may be inserted through the opening and into the cavity (so as to be engaged with the device).

The cap may be configured such that when an aerosol-forming article is engaged with the device (e.g., received in the cavity), only a portion of the aerosol-forming article is received in the cavity. That is, a portion of the aerosol-forming article (not received in the cavity) may protrude from (i.e., extend beyond) the opening. This (protruding) portion of the aerosol-forming article may be a terminal (e.g., mouth) end of the aerosol-forming article, which may be received in a user's mouth for the purpose of inhaling aerosol formed by the device.

The device may comprise a power source or may be connectable to a power source (e.g., a power source separate to the device). The power source may be electrically connectable to the heater. In that respect, altering (e.g., toggling) the electrical connection of the power source to the heater may affect a state of the heater. For example, toggling the electrical connection of the power source to the heater may toggle the heater between an on state and an off state. The power source may be a power store. For example, the power source may be a battery or rechargeable battery (e.g., a lithium ion battery).

The device may comprise an input connection (e.g., a USB port, Micro USB port, USB-C port, etc.). The input connection may be configured for connection to an external source of electrical power, such as a mains electrical supply outlet. The input connection may, in some cases, be used as a substitute for an internal power source (e.g., battery or rechargeable battery). That is, the input connection may be electrically connectable to the heater (for providing power to the heater). Hence, in some forms, the input connection may form at least part of the power source of the device.

Where the power source comprises a rechargeable power source (such as a rechargeable battery), the input connection may be used to charge and recharge the power source.

The device may comprise a user interface (UI). In some embodiments the UI may include input means to receive operative commands from the user. The input means of the UI may allow the user to control at least one aspect of the operation of the device. In some embodiments the input means may comprise a power button to switch the device between an on state and an off state.

In some embodiments the UI may additionally or alternatively comprise output means to convey information to the user. In some embodiments the output means may comprise a light to indicate a condition of the device (and/or the aerosol-forming article) to the user. The condition of the device (and/or aerosol-forming article) indicated to the user may comprise a condition indicative of the operation of the heater. For example, the condition may comprise whether the heater is in an off state or an on state. In some embodiments, the UI unit may comprise at least one of a button, a display, a touchscreen, a switch, a light, and the like. For example, the output means may comprise one or more (e.g., two, three, four, etc.) light-emitting diodes ("LEDs") that may be located on the body of the device.

The device may further comprise a puff sensor (e.g., airflow sensor), which form part of the input means of the UI. The puff sensor may be configured to detect a user drawing on an end (i.e., a terminal (mouth) end) of the aerosol-forming article. The puff sensor may, for example, be a pressure sensor or a microphone. The puff sensor may be configured to produce a signal indicative of a puff state. The signal may be indicative of the user drawing (an aerosol from the aerosol-forming article) such that it is e.g., in the form of a binary signal. Alternatively or additionally, the signal may be indicative of a characteristic of the draw (e.g., a flow rate of the draw, length of time of the draw, etc.).

The device may comprise a controller, or may be connectable to a controller that may be configured to control at least one function of the device. The controller may comprise a microcontroller that may e.g.

20 be mounted on a printed circuit board (PCB). The controller may also comprise a memory, e.g., non-volatile memory. The memory may include instructions, which, when implemented, may cause the controller to perform certain tasks or steps of a method. Where the device comprises an input connection, the controller may be connected to the input connection.

The controller may be configured to control the operation of the heater (and e.g., the heating element). Thus, the controller may be configured to control vaporization of an aerosol forming part of an aerosol-forming article engaged with the device. The controller may be configured to control the voltage applied by power source to the heater. For example, the controller may be configured to toggle between applying a full output voltage (of the power source) to the heater and applying no voltage to the heater. Alternatively or additionally, the control unit may implement a more complex heater control protocol.

In some embodiments, the controller is configured for selectively raising the temperature of the heater to a predetermined operating temperature in one or more phases in a given time period. A phase comprises both a (first) heating time period and a non-heating or reduced-heating time period, and possibly a further (second) heating time period thereafter. When chaining more than one phase after one another, the second heating time period of an earlier (a first) phase may correspond to the first heating time period of a consecutive or later (second) phase, in particularly directly following the earlier phase. More than two phases, e.g., three, four, five, six, etc. are conceivable to follow one another.

The device may further comprise a voltage regulator to regulate the output voltage supplied by the power source to form a regulated voltage. The regulated voltage may subsequently be applied to the heater.

In some embodiments, where the device comprises a UI, the controller may be operatively connected to one or more components of the UI. The controller may be configured to receive command signals from an input means of the UI. The controller may be configured to control the heater in response to the command signals. For example, the controller may be configured to receive "on" and "off" command signals from the UI and, in response, may control the heater so as to be in a corresponding on or off state.

The controller may be configured to send output signals to a component of the UI. The UI may be configured to convey information to a user, via an output means, in response to such output signals (received from the controller). For example, where the device comprises one or more LEDs, the LEDs may be operatively connected to the controller. Hence, the controller may be configured to control the illumination of the LEDs (e.g., in response to an output signal). For example, the controller may be configured to control the illumination of the LEDs according to (e.g., an on or off) state of the heater.

Where the device comprises sensor (e.g., a puff/airflow sensor), the controller may be operatively connected to the sensor. The controller may be configured to receive a signal from the sensor (e.g., indicative of a condition of the device and/or engaged aerosol-forming article). The controller may be configured to control the heater, or an aspect of the output means, based on the signal from the sensor.

The device may comprise a wireless interface configured to communicate wirelessly (e.g., via Bluetooth (e.g., a Bluetooth low-energy connection) or Wi-Fi) with an external device. Similarly, the input connection may be configured for wired connection to an external device so as to provide communication between the device and the external device.

The external device may be a mobile device. For example, the external device may be a smart phone, tablet, smart watch, or smart car. An application (e.g., app) may be installed on the external device (e.g., mobile device). The application may facilitate communication between the device and the external device via the wired or wireless connection.

The wireless or wired interface may be configured to transfer signals between the external device and the controller of the device. In this respect, the controller may control an aspect of the device in response to a signal received from an external device. Alternatively or additionally, an external device may respond to a signal received from the device (e.g., from the controller of the device).

In a second aspect, there is provided a system (e.g., a smoking substitute system) comprising a device according to the first aspect and an aerosol-forming article. The aerosol-forming article may comprise an aerosol-forming substrate at an upstream end of the aerosol-forming article. The article may be in the form of a smoking substitute article, e.g., heated tobacco (HT) consumable (also known as a heat-not-burn (HNB) consumable).

As used herein, the terms "upstream" and "downstream" are intended to refer to the flow direction of the vapor/aerosol i.e., with the downstream end of the article/consumable being the mouth end or outlet where the aerosol exits the consumable for inhalation by the user. The upstream end of the article/consumable is the opposing end to the downstream end.

The aerosol-forming substrate is capable of being heated to release at least one volatile compound that can form an aerosol. The aerosol-forming substrate may be located at the upstream end of the article/consumable.

In order to generate an aerosol, the aerosol-forming substrate comprises at least one volatile compound that is intended to be vaporized/aerosolized and that may provide the user with a recreational and/or medicinal effect when inhaled. Suitable chemical and/or physiologically active volatile compounds include the group consisting of: nicotine, cocaine, caffeine, opiates and opioids, cathine and cathinone, kavalactones, mysticin, beta-carboline alkaloids, salvinorin A together with any combinations, functional equivalents to, and/or synthetic alternatives of the foregoing.

The aerosol-forming substrate may comprise plant material. The plant material may comprise least one plant material selected from the list including *Amaranthus dubius, Arctostaphylos uva-ursi* (Bearberry), *Argemone mexicana, Amica, Artemisia vulgaris*, Yellow Tees, *Galea zacatechichi, Canavalia maritima* (Baybean), *Cecropia mexicana* (Guamura), *Cestrum noctumum, Cynoglossum virginianum* (wild comfrey), *Cytisus scoparius, Damiana, Entada rheedii, Eschscholzia califomica* (California Poppy), *Fittonia albivenis, Hippobroma longiflora, Humulus japonica* (Japanese Hops), *Humulus lupulus* (Hops), *Lactuca virosa* (Lettuce Opium), *Laggera alata, Leonotis leonurus, Leonurus cardiaca* (Motherwort), *Leonurus sibiricus* (Honeyweed), *Lobelia cardinalis, Lobelia inflata* (Indian-tobacco), *Lobelia siphilitica, Nepeta cataria* (Catnip), *Nicotiana* species (Tobacco), *Nymphaea alba* (White Lily), *Nymphaea caerulea* (Blue Lily), Opium poppy, *Passiflora incamata* (Passionflower), *Pedicularis densiflora* (Indian Warrior), *Pedicularis groenlandica* (Elehant's Head), *Salvia divinorum, Salvia dorrii* (Tobacco Sage), Salvia species (Sage), *Scutellaria galericulata, Scutellaria lateriflora, Scutellaria nana, Scutellaria* species (Skullcap), *Sida acuta* (Wireweed), *Sida rhombifolia, Silene capensis, Syzygium aromaticum* (Clove), *Tagetes lucida* (Mexican Tarragon), *Tarchonanthus camphoratus, Tumera diffusa* (Damiana), *Verbascum* (Mullein), *Zamia latifolia* (Maconha Brava) together with any combinations, functional equivalents to, and/or synthetic alternatives of the foregoing.

The plant material may be tobacco. Any type of tobacco may be used. This includes, but is not limited to, flue-cured tobacco, burley tobacco, Maryland Tobacco, dark-air cured tobacco, oriental tobacco, dark-fired tobacco, perique tobacco and rustica tobacco. This also includes blends of the above mentioned tobaccos.

The tobacco may comprise one or more of leaf tobacco, stem tobacco, tobacco powder, tobacco dust, tobacco derivatives, expanded tobacco, homogenized tobacco, shredded tobacco, extruded tobacco, cut rag tobacco and/or reconstituted tobacco (e.g., slurry recon or paper recon).

The aerosol-forming substrate may comprise a gathered sheet of homogenized (e.g., paper/slurryrecon) tobacco or gathered shreds/strips formed from such a sheet.

The aerosol-forming substrate may comprise one or more additives selected from humectants, flavorants, fillers, aqueous/non-aqueous solvents and binders.

The flavorant may be provided in solid or liquid form. It may include menthol, licorice, chocolate, fruit flavor (including e.g., citrus, cherry etc.), vanilla, spice (e.g., ginger, cinnamon) and tobacco flavor. The flavorant may be evenly dispersed throughout the aerosol-forming substrate or may be provided in isolated locations and/or varying concentrations throughout the aerosol-forming substrate.

The aerosol-forming substrate may be formed in a substantially cylindrical shape such that the article/consumable resembles a conventional cigarette. It may have a diameter of between 5 and 10 mm e.g., between 6 and 9 mm or 6 and 8 mm e.g., around 7 mm. It may have an axial length of between 10 and 15 mm e.g., between 11 and 14 mm such as around 12 or 13 mm.

The article/consumable may comprise at least one filter element. There may be a terminal filter element at the downstream/mouth end of the article/consumable.

The or at least one of the filter element(s) (e.g., the terminal filter element) may be comprised of cellulose acetate or polypropylene tow. The at least one filter element (e.g., the terminal filter element) may be comprised of activated charcoal. The at least one filter element (e.g., the terminal element) may be comprised of paper. The or each filter element may be at least partly (e.g., entirely) circumscribed with a plug wrap e.g., a paper plug wrap.

The terminal filter element (at the downstream end of the article/consumable) may be joined to the upstream elements forming the article/consumable by a circumscribing tipping layer e.g., a tipping paper layer. The tipping paper may have an axial length longer than the axial length of the terminal filter element such that the tipping paper completely circumscribes the terminal filter element plus the wrapping layer surrounding any adjacent upstream element.

In some embodiments, the article/consumable may comprise an aerosol-cooling element which is adapted to cool the aerosol generated from the aerosol-forming substrate (by heat exchange) before being inhaled by the user.

The article/consumable may comprise a spacer element that defines a space or cavity between the aerosol-forming substrate and the downstream end of the consumable. The spacer element may comprise a cardboard tube. The spacer element may be circumscribed by the (paper) wrapping layer.

The fourteenth mode of the disclosure includes the combination of the aspects and preferred features described except where such a combination is clearly impermissible or expressly avoided.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

Fifteenth Mode of the Disclosure: A Heat Not Burn Device Including Longitudinal Heater to Heat a Heat Not Burn Consumable At its most general, the fifteenth mode of the present disclosure relates to a heat not burn device including longitudinal heater to heat a heat not burn (HNB) consumable.

According to a first aspect of the fifteenth mode of the present disclosure, there is provided a heat not burn device including a longitudinal heater, such that heater includes a heating track. The heating track has a first portion configured to be resistively heated to a first operating temperature when power is supplied to the heater. Further, the device includes a second portion configured to supply power to the first portion. The first operating temperature being greater than an operating temperature of the second portion. The heater includes a mount attached to the device, such that the mount is in contact with the first portion.

By providing a heat not burn device comprising a specifically dimensioned longitudinal heater, it may heat wider area of HNB consumable. An advantage arising from the heater mount being arranged to contact the first portion of the heating track, which achieves a higher temperature than the second portion in use of the device, is that the heat sink effect of the mount (which would draw heat away from the heater) can be overcome or reduced, meaning that the heater is thus mounted in a manner which maximises the effective area of the heater presented for vaporization of tobacco in a consumable.

Optional features will now be set out. These are applicable singly or in any combination with any aspect.

Optionally, the mount may be located within the first portion. By providing mount in the first portion uniform heating of the heater may be achieved.

Optionally, the heater may include a pair of heater electrodes connected to the heating track at the second portion. The heater electrodes connected to the heating track may allow heating of the heater at required temperatures.

Conveniently, the heater electrodes may be connected at least 0.5 mm from the first portion. By configuring the heater electrodes at least 0.5 mm from the first portion direct contact of the electrodes with the heater may be prevented, thereby any potential damage to the heater electrodes due to high temperatures of the heater rod may be avoided.

Optionally, the heater electrodes may be connected to the heater track along a heater connection length of greater than 1 mm. This may be varied as per the temperature at which the heater may be heated preferably, the heater electrodes may be connected to the heater track along a heater connection length of greater than 1.5 mm. This provides the heating of the heater at greater temperatures.

Preferably, the heater track electrodes are connected to the heater track along a heater connection length of greater than 2 mm. This configuration may allow uniform and substantially greater heating temperatures of the heater.

Conveniently, the heater includes a temperature sensor track. The temperature sensor track provides efficient detection of the temperature along the length of the heater.

Optionally, the heater includes a pair of sensor track electrodes connected to a temperature sensor track. The sensor electrodes may provide required power to detect the temperature of the temperature sensor track, during working and thereby provides an indication about the temperature of the heater.

Conveniently, the sensor track electrodes may be connected to the temperature sensor track at the second portion. The sensor track electrodes connected to the temperature sensor track may allow detection of temperatures of the heater.

Optionally, the sensor track electrodes connected at 0.5 mm from the first position. By configuring the sensor track electrodes at least 0.5 mm from the first portion prevents direct contact of the sensor track electrodes with the heater thereby preventing damage to the sensor track electrodes from damage due to high temperatures of the heater rod.

Conveniently, the sensor track electrodes may be connected to the temperature sensor track along a sensor connection length of greater than 1 mm. This provides the detecting of the temperatures of the heater effectively.

Preferably, the sensor track electrodes are connected to the temperature sensor track along a sensor connection length of greater than 1.5 mm. This configuration may allow greater detection of temperatures of the heater.

Preferably, the sensor track electrodes are connected to the temperature sensor track along a sensor connection length of greater than 2 mm. This configuration may allow uniform and substantially greater detection of temperatures of the heater.

Optionally, the mount is located at least 0.5 mm from an end of the first portion. This configuration may facilitate lower heat conduction towards the second portion of the heater thereby substantially preventing overheating of the temperature sensor and heater electrodes connected in the second portion.

Optionally, the heater track electrodes have lower electrical impedance than the temperature sensor track. The heater track electrodes have lower electrical impedance than the temperature sensor track, thereby minimises power requirement for heating the heater.

Conveniently, the heater track electrodes have a larger cross-sectional area than the temperature sensor track. The heater track electrodes having large cross-sectional area may allow withstanding of high temperatures.

Optionally, the heater track electrodes have a larger diameter than a diameter of each sensor track electrode. The heater track electrodes having large diameter allows withstanding of high temperatures during heating having high thermal conductivity.

Advantageously, the heater is configured to penetrate a tobacco portion of a heat not burn consumable engaged with the device. The heater is penetrated to the tobacco portion of the heat not burn consumable to substantially heat the consumable to generate aerosol to be inhaled by the user.

Optionally, the longitudinal heater is in rod-shaped. The rod-shaped heater allows the easy penetration into the consumable and uniform heating of the consumable, thereby increasing the yield.

The device may comprise an elongate body. An end of the elongate body may be configured for engagement with an aerosol-forming article (e.g., a heated tobacco (HT) consumable). The device may comprise a cavity that is configured for receipt of at least a portion of the consumable (i.e., for engagement with the consumable). The aerosol-forming article may be of the type that comprises an aerosol former (e.g., carried by an aerosol-forming substrate).

The device may comprise a heater for heating the aerosol-forming article. The heater may comprise a heating element, which may be in the form of a rod that extends from the body of the device. The heating element may extend from the end of the body that is configured for engagement with the aerosol-forming article.

The heater (and thus the heating element) may be rigidly mounted to the body. The heating element may be elongate so as to define a longitudinal axis and may, for example, have a transverse profile (i.e., transverse to a longitudinal axis of the heating element) that is substantially circular (i.e., the heating element may be generally cylindrical). Alternatively, the heating element may have a transverse profile that is rectangular (i.e., the heater may be a "blade heater"). The heating element may alternatively be in the shape of a tube (i.e., the heater may be a "tube heater"). The heating element may take other forms (e.g., the heating element may have an elliptical transverse profile). The shape and/or size (e.g., diameter) of the transverse profile of the heating element may be generally consistent for the entire length (or substantially the entire length) of the heating element.

The heating element may be between 15 mm and 25 mm long, e.g., between 18 mm and 20 mm long, e.g., around 19 mm long. The heating element may have a diameter of between 1.5 mm and 2.5 mm, e.g., a diameter between 2 mm and 2.3 mm, e.g., a diameter of around 2.15 mm.

The heating element may be formed of ceramic. The heating element may comprise a core (e.g., a ceramic core) comprising Al2O3. The core of the heating element may have a diameter of 1.8 mm to 2.1 mm, e.g., between 1.9 mm and 2 mm. The heating element may comprise an outer layer (e.g., an outer ceramic layer) comprising Al2O3. The thickness of the outer layer may be between 160 μm and 220 μm, e.g., between 170 μm and 190 μm, e.g., around 180 μm. The heating element may comprise a heating track, which may extend longitudinally along the heating element. The heating track may be sandwiched between the outer layer and the core of the heating element. The heating track may comprise tungsten and/or rhenium. The heating track may have a thickness of around 20 μm.

The heating element may be located in the cavity (of the device), and may extend (e.g., along a longitudinal axis) from an internal base of the cavity towards an opening of the cavity. The length of the heating element (i.e., along the longitudinal axis of the heater) may be less than the depth of the cavity. Hence, the heating element may extend for only a portion of the length of the cavity. That is, the heating element may not extend through (or beyond) the opening of the cavity.

The heating element may be configured for insertion into an aerosol-forming article (e.g., a HT consumable) when an aerosol-forming article is received in the cavity. In that respect, a distal end (i.e., distal from a base of the heating element where it is mounted to the device) of the heating element may comprise a tapered portion, which may facilitate insertion of the heating element into the aerosol-forming article. The heating element may fully penetrate an aerosol-forming article when the aerosol-forming article is received in the cavity. That is, the entire length, or substantially the entire length, of the heating element may be received in the aerosol-forming article.

The heating element may have a length that is less than, or substantially the same as, an axial length of an aerosol-forming substrate forming part of an aerosol-forming article (e.g., a HT consumable). Thus, when such an aerosol-forming article is engaged with the device, the heating element may only penetrate the aerosol-forming substrate, rather than other components of the aerosol-forming article. The heating element may penetrate the aerosol-forming substrate for substantially the entire axial length of the aerosol forming-substrate of the aerosol-forming article. Thus, heat may be transferred from (e.g., an outer circumferential surface of) the heating element to the surrounding aerosol-forming substrate, when penetrated by the heating element. That is, heat may be transferred radially outwardly (in the case of a cylindrical heating element) or e.g., radially inwardly (in the case of a tube heater).

Where the heater is a tube heater, the heating element of the tube heater may surround at least a portion of the cavity. When the portion of the aerosol-forming article is received in the cavity, the heating element may surround a portion of the aerosol-forming article (i.e., so as to heat that portion of the aerosol-forming article). In particular, the heating element may surround an aerosol forming substrate of the aerosol-forming article. That is, when an aerosol-forming article is engaged with the device, the aerosol forming substrate of the aerosol-forming article may be located adjacent an inner surface of the (tubular) heating element. When the heating element is activated, heat may be transferred radially inwardly from the inner surface of the heating element to heat the aerosol forming substrate.

The cavity may comprise a (e.g., circumferential) wall (or walls) and the (tubular) heating element may extend around at least a portion of the wall(s). In this way, the wall may be located between the inner surface of the heating element and an outer surface of the aerosol-forming article. The wall (or walls) of the cavity may be formed from a thermally conductive material (e.g., a metal) to allow heat conduction from the heating element to the aerosol-forming article. Thus, heat may be conducted from the heating element, through the cavity wall (or walls), to the aerosol-forming substrate of an aerosol-forming article received in the cavity.

In some embodiments the device may comprise a cap disposed at the end of the body that is configured for engagement with an aerosol-forming article. Where the device comprises a heater having a heating element, the cap may at least partially enclose the heating element. The cap may be moveable between an open position in which access is provided to the heating element, and a closed position in which the cap at least partially encloses the heating element. The cap may be slideably engaged with the body of the device, and may be slideable between the open and closed positions.

The cap may define at least a portion of the cavity of the device. That is, the cavity may be fully defined by the cap, or each of the cap and body may define a portion of the cavity. The cap may comprise an opening to the cavity. The opening may be configured for receipt of at least a portion of an aerosol-forming article. That is, an aerosol-forming article may be inserted through the opening and into the cavity (so as to be engaged with the device).

The cap may be configured such that when an aerosol-forming article is engaged with the device (e.g., received in the cavity), only a portion of the aerosol-forming article is received in the cavity. That is, a portion of the aerosol-forming article (not received in the cavity) may protrude from (i.e., extend beyond the opening. This (protruding) portion of the aerosol-forming article may be a terminal (e.g., mouth) end of the aerosol-forming article, which may be received in a user's mouth for the purpose of inhaling aerosol formed by the device.

The device may comprise a power source or may be connectable to a power source (e.g., a power source separate to the device). The power source may be electrically connectable to the heater. In that respect, altering (e.g., toggling) the electrical connection of the power source to the heater may affect a state of the heater. For example, toggling the electrical connection of the power source to the heater may toggle the heater between an on state and an off state. The power source may be a power store. For example, the power source may be a battery or rechargeable battery (e.g., a lithium ion battery).

The device may comprise an input connection (e.g., a USB port, Micro USB port, USB-C port, etc.). The input connection may be configured for connection to an external source of electrical power, such as a mains electrical supply outlet. The input connection may, in some cases, be used as a substitute for an internal power source (e.g., battery or rechargeable battery). That is, the input connection may be electrically connectable to the heater (for providing power to the heater). Hence, in some forms, the input connection may form at least part of the power source of the device.

Where the power source comprises a rechargeable power source (such as a rechargeable battery), the input connection may be used to charge and recharge the power source.

The device may comprise a user interface (UI). In some embodiments the UI may include input means to receive operative commands from the user. The input means of the UI may allow the user to control at least one aspect of the operation of the device. In some embodiments the input means may comprise a power button to switch the device between an on state and an off state.

In some embodiments the UI may additionally or alternatively comprise output means to convey information to the user. In some embodiments the output means may comprise a light to indicate a condition of the device (and/or the aerosol-forming article) to the user. The condition of the device (and/or aerosol-forming article) indicated to the user may comprise a condition indicative of the operation of the heater. For example, the condition may comprise whether the heater is in an off state or an on state. In some embodiments, the UI unit may comprise at least one of a button, a display, a touchscreen, a switch, a light, and the like. For example, the output means may comprise one or more (e.g., two, three, four, etc.) light-emitting diodes ("LEDs") that may be located on the body of the device.

The device may further comprise a puff sensor (e.g., airflow sensor), which form part of the input means of the UI. The puff sensor may be configured to detect a user drawing on an end (i.e., a terminal (mouth) end) of the aerosol-forming article. The puff sensor may, for example, be a pressure sensor or a microphone. The puff sensor may be configured to produce a signal indicative of a puff state. The signal may be indicative of the user drawing (an aerosol from the aerosol-forming article) such that it is e.g., in the form of a binary signal. Alternatively or additionally, the signal may be indicative of a characteristic of the draw (e.g., a flow rate of the draw, length of time of the draw, etc).

The device may comprise a controller, or may be connectable to a controller that may be configured to control at least one function of the device. The controller may comprise a microcontroller that may e.g., be mounted on a printed circuit board (PCB). The controller may also comprise a memory, e.g., non-volatile memory. The memory may include instructions, which, when implemented, may cause the controller to perform certain tasks or steps of a method. Where the device comprises an input connection, the controller may be connected to the input connection.

The controller may be configured to control the operation of the heater (and e.g., the heating element). Thus, the controller may be configured to control vaporization of an aerosol forming part of an aerosol-forming article engaged with the device. The controller may be configured to control the voltage applied by power source to the heater. For example, the controller may be configured to toggle between applying a full output voltage (of the power source) to the heater and applying no voltage to the heater. Alternatively or additionally, the control unit may implement a more complex heater control protocol.

The device may further comprise a voltage regulator to regulate the output voltage supplied by the power source to form a regulated voltage. The regulated voltage may subsequently be applied to the heater.

In some embodiments, where the device comprises a UI, the controller may be operatively connected to one or more components of the UI. The controller may be configured to receive command signals from an input means of the UI. The controller may be configured to control the heater in response to the command signals. For example, the controller may be configured to receive "on" and "off" command signals from the UI and, in response, may control the heater so as to be in a corresponding on or off state.

The controller may be configured to send output signals to a component of the UI. The UI may be configured to convey information to a user, via an output means, in response to such output signals (received from the controller). For example, where the device comprises one or more LEDs, the LEDs may be operatively connected to the controller. Hence, the controller may configured to control the illumination of the LEDs (e.g., in response to an output signal). For example, the controller may be configured to control the illumination of the LEDs according to (e.g., an on or off) state of the heater.

Where the device comprises a sensor (e.g., a puff/airflow sensor), the controller may be operatively connected to the sensor. The controller may be configured to receive a signal from the sensor (e.g. indicative of a condition of the device and/or engaged aerosol-forming article). The controller may be configured to control the heater, or an aspect of the output means, based on the signal from the sensor.

The device may comprise a wireless interface configured to communicate wirelessly (e.g., via Bluetooth (e.g., a Bluetooth low-energy connection) or WiFi) with an external device. Similarly, the input connection may be configured for wired connection to an external device so as to provide communication between the device and the external device.

The external device may be a mobile device. For example, the external device may be a smart phone, tablet, smart watch, or smart car. An application (e.g., app) may be installed on the external device (e.g., mobile device). The application may facilitate communication between the device and the external device via the wired or wireless connection.

The wireless or wired interface may be configured to transfer signals between the external device and the controller of the device. In this respect, the controller may control an aspect of the device in response to a signal received from an external device. Alternatively or additionally, an external device may respond to a signal received from the device (e.g., from the controller of the device).

In a second aspect of the fifteenth mode, there is provided a system (e.g., a smoking substitute system) comprising a device according to an aspect and an aerosol-forming article. The aerosol-forming article may comprise an aerosol-forming substrate at an upstream end of the aerosol-forming article. The article may be in the form of a smoking substitute article, e.g., heated tobacco (HT) consumable (also known as a heat-not-burn (HNB) consumable).

As used herein, the terms "upstream" and "downstream" are intended to refer to the flow direction of the vapor/aerosol i.e., with the downstream end of the article/consumable being the mouth end or outlet where the aerosol exits the consumable for inhalation by the user. The upstream end of the article/consumable is the opposing end to the downstream end.

The aerosol-forming substrate is capable of being heated to release at least one volatile compound that can form an aerosol. The aerosol-forming substrate may be located at the upstream end of the article/consumable.

In order to generate an aerosol, the aerosol-forming substrate comprises at least one volatile compound that is intended to be vaporized/aerosolized and that may provide the user with a recreational and/or medicinal effect when inhaled. Suitable chemical and/or physiologically active volatile compounds include the group consisting of: nicotine, cocaine, caffeine, opiates and opioids, cathine and cathinone, kavalactones, mysticin, beta-carboline alkaloids, salvinorin A together with any combinations, functional equivalents to, and/or synthetic alternatives of the foregoing.

The aerosol-forming substrate may comprise plant material. The plant material may comprise least one plant material selected from the list including *Amaranthus dubius, Arctostaphylos uva-ursi* (Bearberry), *Argemone mexicana, Amica, Artemisia vulgaris*, Yellow Tees, *Galea zacatechichi, Canavalia maritima* (Baybean), *Cecropia mexicana* (Guamura), *Cestrum noctumum, Cynoglossum virginianum* (wild comfrey), *Cytisus scoparius, Damiana, Entada rheedii, Eschscholzia califomica* (California Poppy), *Fittonia albivenis, Hippobroma longiflora, Humulus japonica* (Japanese Hops), *Humulus lupulus* (Hops), *Lactuca virosa* (Lettuce Opium), *Laggera alata, Leonotis leonurus, Leonurus cardiaca* (Motherwort), *Leonurus sibiricus* (Honeyweed), *Lobelia cardinalis, Lobelia inflata* (Indian-tobacco), *Lobelia siphilitica, Nepeta cataria* (Catnip), *Nicotiana* species (Tobacco), *Nymphaea alba* (White Lily), *Nymphaea caerulea* (Blue Lily), Opium poppy, *Passiflora incamata* (Passionflower), *Pedicularis densiflora* (Indian Warrior), *Pedicularis groenlandica* (Elehant's Head), *Salvia divinorum, Salvia dorrii* (Tobacco Sage), Salvia species (Sage), *Scutellaria galericulata, Scutellaria lateriflora, Scutellaria nana, Scutellaria* species (Skullcap), *Sida acuta* (Wireweed), *Sida rhombifolia, Silene capensis, Syzygium aromaticum* (Clove), *Tagetes lucida* (Mexican Tarragon), *Tarchonanthus camphoratus, Tumera diffusa* (Damiana), *Verbascum* (Mullein), *Zamia latifolia* (Maconha Brava) together with any combinations, functional equivalents to, and/or synthetic alternatives of the foregoing.

The plant material may be tobacco. Any type of tobacco may be used. This includes, but is not limited to, flue-cured tobacco, burley tobacco, Maryland Tobacco, dark-air cured tobacco, oriental tobacco, dark-fired tobacco, perique tobacco and rustica tobacco. This also includes blends of the above mentioned tobaccos.

The tobacco may comprise one or more of leaf tobacco, stem tobacco, tobacco powder, tobacco dust, tobacco derivatives, expanded tobacco, homogenized tobacco, shredded tobacco, extruded tobacco, cut rag tobacco and/or reconstituted tobacco (e.g., slurry recon or paper recon).

The aerosol-forming substrate may comprise a gathered sheet of homogenized (e.g., paper/slurry recon) tobacco or gathered shreds/strips formed from such a sheet.

The aerosol-forming substrate may comprise one or more additives selected from humectants, flavorants, fillers, aqueous/non-aqueous solvents and binders.

The flavorant may be provided in solid or liquid form. It may include menthol, licorice, chocolate, fruit flavor (including e.g., citrus, cherry etc.), vanilla, spice (e.g., ginger, cinnamon) and tobacco flavor. The flavorant may be evenly dispersed throughout the aerosol-forming substrate or may be provided in isolated locations and/or varying concentrations throughout the aerosol-forming substrate.

The aerosol-forming substrate may be formed in a substantially cylindrical shape such that the article/consumable resembles a conventional cigarette. It may have a diameter of between 5 and 10 mm e.g., between 6 and 9 mm or 6 and 8 mm e.g., around 7 mm. It may have an axial length of between 10 and 15 mm e.g., between 11 and 14 mm such as around 12 or 13 mm.

The article/consumable may comprise at least one filter element. There may be a terminal filter element at the downstream/mouth end of the article/consumable.

The or at least one of the filter element(s) (e.g., the terminal filter element) may be comprised of cellulose acetate or polypropylene tow. The at least one filter element (e.g., the terminal filter element) may be comprised of activated charcoal. The at least one filter element (e.g., the terminal element) may be comprised of paper. The or each filter element may be at least partly (e.g., entirely) circumscribed with a plug wrap e.g., a paper plug wrap.

The terminal filter element (at the downstream end of the article/consumable) may be joined to the upstream elements forming the article/consumable by a circumscribing tipping layer e.g., a tipping paper layer. The tipping paper may have an axial length longer than the axial length of the terminal filter element such that the tipping paper completely circumscribes the terminal filter element plus the wrapping, layer surrounding any adjacent upstream element.

In some embodiments, the article/consumable may comprise an aerosol-cooling element which is adapted to cool the aerosol generated from the aerosol-forming substrate (by heat exchange) before being inhaled by the user.

The article/consumable may comprise a spacer element that defines a space or cavity between the aerosol-forming substrate and the downstream end of the consumable. The spacer element may comprise a cardboard tube. The spacer element may be circumscribed by the (paper) wrapping layer.

According to a third aspect of the fifteenth mode of the present disclosure, there is provided a method of using the system according to the system for smoking substitute device, the method comprising inserting the aerosol-forming article into the device; and heating the article using the heater of the device.

In some embodiments the method may comprise inserting the article into a cavity within a body of the device and penetrating the article with the heating element of the device upon insertion of the article.

The fifteenth mode of the disclosure includes the combination of the aspects and preferred features described except where such a combination is clearly impermissible or expressly avoided.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

Sixteenth Mode of the Disclosure: Controller In a Heat Not Burn Device Configured to Run a Cyclic Operating Routine At its most general, the sixteenth mode of the present disclosure relates to the inclusion of a controller in the heat-not-burn device configured to run a cyclic operating routine. This may permit improved computational stability of the controller.

According to a first aspect of the sixteenth mode of the present disclosure, there is provided a heat not burn device including a controller having a cyclic operating routine, wherein the controller is configured to, during each cycle of the cyclic operating routine, perform at least one function of the device; and wherein a period of the cyclic operating routine is between 10 milliseconds and 500 milliseconds.

By providing a device according to the first aspect, the device has the ability to ensure safe operations and increased stability. In one example, the controller may be configured to detect the temperature of the heater, at continuous intervals, during each cycle of the cyclic operating routine to ensure safe operation of the device. In some embodiments, making measurement during each cycle permit the controller more time to dedicate other running processes which may check the device safety.

Optional features will now be set out. These are applicable singly or in any combination with any aspect.

Optionally, said period of the cyclic operating routine is between 150 milliseconds and 400 milliseconds.

Optionally, at least one of the at least one function is performed exactly once during each cycle of the cyclic operating routine.

Optionally, each of the at least one function is performed exactly once during each cycle of the cyclic operating routine.

Optionally, the at least one function includes measuring a heater temperature of a heater of the device.

Optionally, the at least one function includes comparing the heater temperature with a predetermined heater threshold.

Optionally, the at least one function includes controlling a power supplied to the heater based on the comparison between the heater temperature and the predetermined heater threshold.

Optionally, the device further comprises a voltage detection means connected to the controller, and the at least one function including measuring an output voltage of a power supply of the device.

Optionally, the at least one function includes controlling a power supplied to the heater based on the measured output voltage.

Optionally, the device further comprises an ambient temperature sensor connected to the controller and wherein the at least one function includes measuring an ambient temperature for the device.

Optionally, the at least one function includes controlling a power supplied to the heater based on the measured ambient temperature.

Optionally, the at least one function includes making a determination of the presence of a user input command to an input of a user interface of the device.

Optionally, the at least one function includes updating an output of a user interface of the device.

Optionally, the at least one function includes determining the puff status of a puff sensing means of the device.

Optionally, the at least one function includes making a determination of a charging status of a power supply of the device.

Optionally, the controller includes a microcontroller or a microprocessor.

In some embodiments, the controller may be configured to measure the temperature of a heater during each cycle of the cyclic operating routine. To achieve this, the controller may remain connected to a temperature sensor which is configured to constantly measure the temperature of the heater and simultaneously indicate the same to the controller. The frequency of measuring temperature by the sensor may correspond to the period of cyclic routine check selected by the controller. In one example, if the period of cyclic routine check is selected to be small the sensor may be configured to measure and share the temperature of the heater, with the controller, less frequently. Whereas, when the period of cyclic routine check is selected to be comparatively long, the sensor may be configured to measure and share the temperature of the heater, with the controller, more frequently.

Advantageously, the controller may be configured to compare the temperature of the heater with a predetermined threshold. The predetermined threshold may denote a cut-off value of temperature above which the heater shall not be heated. Said value may be pre-stored in the memory of the device. In some embodiments, the predetermined threshold may depend on a present operating mode of the device. The controller may be configured to always compare the measured value of temperature with this predetermined threshold. This ensures that the heater of the device does not overheat, thus preventing any damage to be caused to the heater or to the consumable.

Conveniently, the controller may be configured to control the power supply to the heater based on the comparison between the measured temperature and the predetermined threshold. In an embodiment, this ensures the safety of the device and the consumable. For example, if the temperature of the heater is determined to be above the threshold, the controller may disconnect the supply of power from the power source to the heater.

Optionally, the device may be configured to have a voltage regulator to ensure that the correct amount of voltage is supplied to the heater during the cyclic operating routine. In one example, the voltage regulator may remain connected to the controller. Further, the controller may be configured to calculate the amount of voltage to be supplied to the heater based on the current temperature of the heater and the mode selected. This information may then be passed to the voltage regulator to control voltage supply to the heater. In some embodiments, power supplied to heater may be controlled via pulse width modulation of the output voltage of the power supply.

In some embodiments, the device may include a temperature sensor to measure the ambient temperature. Said temperature sensor may be connected to the controller to allow the controller to decide when to disable the heater of the device and/or a particular mode of operation. To achieve this, the temperature sensor measures the ambient temperature and passes this information to the controller.

The controller may be able to take various decision based on this information. For example, the controller may be able to take a decision to disable the heater in response to detecting that the ambient temperature is too high. Further, the controller may be able to take a decision one or more operational modes of the device in response to detecting that the ambient temperature is too high.

In some embodiments, the device may include a plurality of output means to provide status update of the device to the user. The output means may be connected to the controller such that upon receiving signal from the controller, the output device may indicate the status update of the device. In one example, the output means may include a plurality of LEDs that may be controlled by the controller to indicate disabling of heater, change of mode and status. In other examples, the output means may be configured to provide audio, visual or haptic feedback indicating the status of the device.

Conveniently, the device may include a plurality of input means connected to the controller and configured to receive user input related to various operations of the device. In some embodiment, the input means may include a button which is configured to receive a user input in response to pressing. Further, the input means may include a microphone, a motion sensor etc.

In some embodiment, the device may comprise a hall sensor connected to the controller. The hall sensor may be configured to detect one of insertion and removal of a cap of the device during cyclic operating routine indicating whether the device is safe to be used or not.

Optionally, the device may further comprise a puff sensor that remain connected to the controller. The puffs sensor may be configured to detect each puff inhaled by the user during a smoking session. Further, to keep a track of number of puffs inhaled by the user, the controller may be configured to increment a puff counter with each puff. The controller may be configured to use this information to perform one or more functions of the device. For example, the controller may be able to decide the amount of consumable left in the smoking session based on total puffs available and number of puffs consumed.

The device may comprise an elongate body. An end of the elongate body may be configured for engagement with an aerosol-forming article. For example, the body may be configured for engagement with a heated tobacco (HT) consumable (or heat-not-burn (HNB) consumable). The terms "heated tobacco" and "heat-not-burn" are used interchangeably herein to describe a consumable that is of the type that is heated rather than combusted (or are used interchangeably to describe a device for use with such a consumable). The device may comprise a cavity that is configured for receipt of at least a portion of the consumable (i.e., for engagement with the consumable). The aerosol-forming article may be of the type that comprises an aerosol former (e.g., carried by an aerosol-forming substrate).

The device may comprise a heater for heating the aerosol-forming article. The heater may comprise a heating element, which may be in the form of a rod that extends from the body of the device. The heating element may extend from the end of the body that is configured for engagement with the aerosol-forming article.

The heater (and thus the heating element) may be rigidly mounted to the body. The heating element may be elongate so as to define a longitudinal axis and may, for example, have a transverse profile (i.e., transverse to a longitudinal axis of the heating element) that is substantially circular (i.e., the heating element may be generally cylindrical). Alternatively, the heating element may have a transverse profile that is rectangular (i.e., the heater may be a "blade heater"). The heating element may alternatively be in the shape of a tube (i.e., the heater may be a "tube heater"). The heating element may take other forms (e.g., the heating element may have an elliptical transverse profile). The shape and/or size (e.g., diameter) of the transverse profile of the heating element may be generally consistent for the entire length (or substantially the entire length) of the heating element.

The heating element may be between 15 mm and 25 mm long, e.g., between 18 mm and 20 mm long, e.g., around 19 mm long. The heating element may have a diameter of between 1.5 mm and 2.5 mm, e.g., a diameter between 2 mm and 2.3 mm, e.g., a diameter of around 2.15 mm.

The heating element may be formed of ceramic. The heating element may comprise a core (e.g., a ceramic core) comprising Al2O3. The core of the heating element may have a diameter of 1.8 mm to 2.1 mm, e.g., between 1.9 mm and 2 mm. The heating element may comprise an outer layer (e.g., an outer ceramic layer) comprising Al2O3. The thickness of the outer layer may be between 160 μm and 220 μm, e.g., between 170 μm and 190 μm, e.g., around 180 μm. The heating element may comprise a heating track, which may extend longitudinally along the heating element. The heating track may be sandwiched between the outer layer and the core of the heating element. The heating track may comprise tungsten and/or rhenium. The heating track may have a thickness of around 20 μm.

The heating element may be located in the cavity (of the device), and may extend (e.g., along a longitudinal axis) from an internal base of the cavity towards an opening of the cavity. The length of the heating element (i.e., along the longitudinal axis of the heater) may be less than the depth of the cavity. Hence, the heating element may extend for only a portion of the length of the cavity. That is, the heating element may not extend through (or beyond) the opening of the cavity.

The heating element may be configured for insertion into an aerosol-forming article (e.g., a HT consumable) when an aerosol-forming article is received in the cavity. In that respect, a distal end (i.e., distal from a base of the heating element where it is mounted to the device) of the heating element may comprise a tapered portion, which may facilitate insertion of the heating element into the aerosol-forming article. The heating element may fully penetrate an aerosol-forming article when the aerosol-forming article is received in the cavity. That is, the entire length, or substantially the entire length, of the heating element may be received in the aerosol-forming article.

The heating element may have a length that is less than, or substantially the same as, an axial length of an aerosol-forming substrate forming part of an aerosol-forming article (e.g., a HT consumable). Thus, when such an aerosol-forming article is engaged with the device, the heating element may only penetrate the aerosol-forming substrate, rather than other components of the aerosol-forming article. The heating element may penetrate the aerosol-forming substrate for substantially the entire axial length of the aerosol forming-substrate of the aerosol-forming article. Thus, heat may be transferred from (e.g., an outer circumferential surface of) the heating element to the surrounding aerosol-forming substrate, when penetrated by the heating element. That is, heat may be transferred radially outwardly (in the case of a cylindrical heating element) or e.g., radially inwardly (in the case of a tube heater).

Where the heater is a tube heater, the heating element of the tube heater may surround at least a portion of the cavity. When the portion of the aerosol-forming article is received in the cavity, the heating element may surround a portion of the aerosol-forming article (i.e., so as to heat that portion of the aerosol-forming article). In particular, the heating element may surround an aerosol forming substrate of the aerosol-forming article. That is, when an aerosol-forming article is engaged with the device, the aerosol forming substrate of the aerosol-forming article may be located adjacent an inner surface of the (tubular) heating element. When the heating element is activated, heat may be transferred radially inwardly from the inner surface of the heating element to heat the aerosol forming substrate.

The cavity may comprise a (e.g., circumferential) wall (or walls) and the (tubular) heating element may extend around at least a portion of the wall(s). In this way, the wall may be located between the inner surface of the heating element and an outer surface of the aerosol-forming article. The wall (or walls) of the cavity may be formed from a thermally conductive material (e.g., a metal) to allow heat conduction from the heating element to the aerosol-forming article. Thus, heat may be conducted from the heating element, through the cavity wall (or walls), to the aerosol-forming substrate of an aerosol-forming article received in the cavity.

In some embodiments the device may comprise a cap disposed at the end of the body that is configured for engagement with an aerosol-forming article. Where the device comprises a heater having a heating element, the cap may at least partially enclose the heating element. The cap may be moveable between an open position in which access is provided to the heating element, and a closed position in which the cap at least partially encloses the heating element. The cap may be slideably engaged with the body of the device, and may be slideable between the open and closed positions.

The cap may define at least a portion of the cavity of the device. That is, the cavity may be fully defined by the cap, or each of the cap and body may define a portion of the cavity. Where the cap fully defines the cavity, the cap may comprise an aperture for receipt of the heating element into the cavity (when the cap is in the closed position). The cap may comprise an opening to the cavity. The opening may be configured for receipt of at least a portion of an aerosol-forming article. That is, an aerosol-forming article may be inserted through the opening and into the cavity (so as to be engaged with the device).

The cap may be configured such that when an aerosol-forming article is engaged with the device (e.g., received in the cavity), only a portion of the aerosol-forming article is received in the cavity. That is, a portion of the aerosol-forming article (not received in the cavity) may protrude from (i.e., extend beyond) the opening. This (protruding) portion of the aerosol-forming article may be a terminal (e.g., mouth) end of the aerosol-forming article, which may be received in a user's mouth for the purpose of inhaling aerosol formed by the device.

The device may comprise a power source or may be connectable to a power source (e.g., a power source separate to the device). The power source may be electrically connectable to the heater. In that respect, altering (e.g., toggling) the electrical connection of the power source to the heater may affect a state of the heater. For example, toggling the electrical connection of the power source to the heater may toggle the heater between an on state and an off state. The power source may be a power store. For example, the power source may be a battery or rechargeable battery (e.g., a lithium ion battery).

The device may comprise an input connection (e.g., a USB port, Micro USB port, USB-C port, etc.). The input connection may be configured for connection to an external source of electrical power, such as a mains electrical supply outlet. The input connection may, in some cases, be used as a substitute for an internal power source (e.g., battery or rechargeable battery). That is, the input connection may be electrically connectable to the heater (for providing power to the heater). Hence, in some forms, the input connection may form at least part of the power source of the device.

Where the power source comprises a rechargeable power source (such as a rechargeable battery), the input connection may be used to charge and recharge the power source.

The device may comprise a user interface (UI). In some embodiments the UI may include input means to receive operative commands from the user. The input means of the UI may allow the user to control at least one aspect of the operation of the device. In some embodiments the input means may comprise a power button to switch the device between an on state and an off state.

In some embodiments the UI may additionally or alternatively comprise output means to convey information to the user. In some embodiments, the output means may be configured to indicate the status of the device to the user. In some embodiments the output means may comprise a light to indicate a condition of the device (and/or the aerosol-forming article) to the user. The condition of the device (and/or aerosol-forming article) indicated to the user may comprise a condition indicative of the operation of the heater. For example, the condition may comprise whether the heater is in an off state or an on state. In some embodiments, the UI unit may comprise at least one of a button, a display, a touchscreen, a switch, a light, and the like. For example, the output means may comprise one or more (e.g., two, three, four, etc.) light-emitting diodes ("LEDs") that may be located on the body of the device.

The device may further comprise a puff sensor (e.g., airflow sensor), which form part of the input means of the UI. The puff sensor may be configured to detect a user drawing on an end (i.e., a terminal (mouth) end) of the aerosol-forming article. The puff sensor may, for example, be a pressure sensor or a microphone. The puff sensor may be configured to produce a signal indicative of a puff state. The signal may be indicative of the user drawing (an aerosol from the aerosol-forming article) such that it is e.g., in the form of a binary signal. Alternatively or additionally, the signal may be indicative of a characteristic of the draw (e.g., a flow rate of the draw, length of time of the draw, etc). In some embodiment, the puff sensor may be configured to keep a track of each puff inhaled during a session. In an example, the puff sensor may be configured to increment a puff counter with each puff inhaled, to keep a count of each puff inhaled, during a session. By doing so the puff sensor may help in determining the amount of consumable available for consumption in said session.

The device may comprise a controller or may be connectable to a controller that may be configured to control at least one function of the device. The controller may comprise a microcontroller that may e.g., be mounted on a printed circuit board (PCB). The controller may also comprise a memory, e.g., non-volatile memory. The memory may include instructions, which, when implemented, may cause the controller to perform certain tasks or steps of a method. Where the device comprises an input connection, the controller may be connected to the input connection.

The controller may be configured to control the operation of the heater (and e.g., the heating element). Thus, the controller may be configured to control vaporization of an aerosol forming part of an aerosol-forming article engaged with the device. Further, the controller may be configured to run a cyclic operating routine in the device with a period between 10 ms to 500 ms. The controller may be configured to perform a number of functions during the cyclic operating routine to ensure safety of the device. In addition, the controller may be configured to control the voltage applied by power source to the heater. For example, the controller may be configured to toggle between applying a full output voltage (of the power source) to the heater and applying no voltage to the heater. Alternatively or additionally, the control unit may implement a more complex heater control protocol.

The device may further comprise a voltage regulator to regulate the output voltage supplied by the power source to form a regulated voltage. The regulated voltage may subsequently be applied to the heater.

In some embodiments, where the device comprises a UI, the controller may be operatively connected to one or more components of the UI. The controller may be configured to receive command signals from an input means of the UI. The controller may be configured to control the heater in response to the command signals. For example, the controller may be configured to receive "on" and "off" command signals from the UI and, in response, may control the heater so as to be in a corresponding on or off state.

The controller may be configured to send output signals to a component of the UI. The UI may be configured to convey information to a user, via an output means, in response to such output signals (received from the controller). For example, where the device comprises one or more LEDs, the LEDs may be operatively connected to the controller. Hence, the controller may configured to control the illumination of the LEDs (e.g., in response to an output signal). For example, the controller may be configured to control the illumination of the LEDs according to (e.g., an on or off) state of the heater. Further in an example, the UI may include other output means that may be configured to provide one of audio, visual and haptic feedback, to the user, indicating the status of the device.

Where the device comprises a sensor (e.g., a puff/airflow sensor), the controller may be operatively connected to the sensor. The controller may be configured to receive a signal from the sensor (e.g., indicative of a condition of the device and/or engaged aerosol-forming article). The controller may be configured to control the heater, or an aspect of the output means, based on the signal from the sensor. In one example, the puff sensor may be configured to count the number of puffs inhaled during a session and pass this information to the controller. The controller may then utilize this information to determine for example, the amount of consumable remaining in the session.

The device may comprise a wireless interface configured to communicate wirelessly (e.g., via Bluetooth (e.g., a Bluetooth low-energy connection) or WiFi) with an external device. Similarly, the input connection may be configured for wired connection to an external device so as to provide communication between the device and the external device.

The external device may be a mobile device. For example, the external device may be a smart phone, tablet, smart watch, or smart car. An application (e.g., app) may be installed on the external device (e.g., mobile device). The application may facilitate communication between the device and the external device via the wired or wireless connection.

The wireless or wired interface may be configured to transfer signals between the external device and the controller of the device. In this respect, the controller may control an aspect of the device in response to a signal received from an external device. Alternatively or additionally, an external device may respond to a signal received from the device (e.g., from the controller of the device).

In a second aspect of the sixteenth mode, there is provided a system (e.g., a smoking substitute system) comprising a device according to the first aspect and an aerosol-forming article. The aerosol-forming article may comprise an aerosol-forming substrate at an upstream end of the aerosol-forming article. The article may be in the form of a smoking substitute article, e.g., heated tobacco (HT) consumable (also known as a heat-not-burn (HNB) consumable).

As used herein, the terms "upstream" and "downstream" are intended to refer to the flow direction of the vapor/aerosol i.e., with the downstream end of the article/consumable being the mouth end or outlet where the aerosol exits the consumable for inhalation by the user. The upstream end of the article/consumable is the opposing end to the downstream end.

The aerosol-forming substrate is capable of being heated to release at least one volatile compound that can form an aerosol. The aerosol-forming substrate may be located at the upstream end of the article/consumable.

In order to generate an aerosol, the aerosol-forming substrate comprises at least one volatile compound that is intended to be vaporized/aerosolized and that may provide the user with a recreational and/or medicinal effect when inhaled. Suitable chemical and/or physiologically active volatile compounds include the group consisting of: nicotine, cocaine, caffeine, opiates and opioids, cathine and cathinone, kavalactones, mysticin, beta-carboline alkaloids, salvinorin A together with any combinations, functional equivalents to, and/or synthetic alternatives of the foregoing.

The aerosol-forming substrate may comprise plant material. The plant material may comprise least one plant material selected from the list including *Amaranthus dubius, Arctostaphylos uva-ursi* (Bearberry), *Argemone mexicana, Amica, Artemisia vulgaris*, Yellow Tees, *Galea zacatechichi, Canavalia maritima* (Baybean), *Cecropia mexicana* (Guamura), *Cestrum noctumum, Cynoglossum virginianum* (wild comfrey), *Cytisus scoparius, Damiana, Entada rheedii, Eschscholzia califomica* (California Poppy), *Fittonia albivenis, Hippobroma longiflora, Humulus japonica* (Japanese Hops), *Humulus lupulus* (Hops), *Lactuca virosa* (Lettuce Opium), *Laggera alata, Leonotis leonurus, Leonurus cardiaca* (Motherwort), *Leonurus sibiricus* (Honeyweed), *Lobelia cardinalis, Lobelia inflata* (Indian-tobacco), *Lobelia siphilitica, Nepeta cataria* (Catnip), *Nicotiana* species (Tobacco), *Nymphaea alba* (White Lily), *Nymphaea caerulea* (Blue Lily), Opium poppy, *Passiflora incamata* (Passionflower), *Pedicularis densiflora* (Indian Warrior), *Pedicularis groenlandica* (Elehant's Head), *Salvia divinorum, Salvia dorrii* (Tobacco Sage), Salvia species (Sage), *Scutellaria galericulata, Scutellaria lateriflora, Scutellaria nana, Scutellaria* species (Skullcap), *Sida acuta* (Wireweed), *Sida rhombifolia, Silene capensis, Syzygium aromaticum* (Clove), *Tagetes lucida* (Mexican Tarragon), *Tarchonanthus camphoratus, Tumera diffusa* (Damiana), *Verbascum* (Mullein), *Zamia latifolia* (Maconha Brava) together with any combinations, functional equivalents to, and/or synthetic alternatives of the foregoing.

The plant material may be tobacco. Any type of tobacco may be used. This includes, but is not limited to, flue-cured tobacco, burley tobacco, Maryland Tobacco, dark-air cured tobacco, oriental tobacco, dark-fired tobacco, perique tobacco and rustica tobacco. This also includes blends of the above mentioned tobaccos.

The tobacco may comprise one or more of leaf tobacco, stem tobacco, tobacco powder, tobacco dust, tobacco derivatives, expanded tobacco, homogenized tobacco, shredded tobacco, extruded tobacco, cut rag tobacco and/or reconstituted tobacco (e.g., slurry recon or paper recon).

The aerosol-forming substrate may comprise a gathered sheet of homogenized (e.g., paper/slurry recon) tobacco or gathered shreds/strips formed from such a sheet.

The aerosol-forming substrate may comprise one or more additives selected from humectants, flavorants, fillers, aqueous/non-aqueous solvents and binders.

The flavorant may be provided in solid or liquid form. It may include menthol, licorice, chocolate, fruit flavor (including e.g., citrus, cherry etc.), vanilla, spice (e.g., ginger, cinnamon) and tobacco flavor. The flavorant may be evenly dispersed throughout the aerosol-forming substrate or may be provided in isolated locations and/or varying concentrations throughout the aerosol-forming substrate.

The aerosol-forming substrate may be formed in a substantially cylindrical shape such that the article/consumable resembles a conventional cigarette. It may have a diameter of between 5 and 10 mm e.g., between 6 and 9 mm or 6 and 8 mm e.g., around 7 mm. It may have an axial length of between 10 and 15 mm e.g., between 11 and 14 mm such as around 12 or 13 mm.

The article/consumable may comprise at least one filter element. There may be a terminal filter element at the downstream/mouth end of the article/consumable.

The or at least one of the filter element(s) (e.g., the terminal filter element) may be comprised of cellulose acetate or polypropylene tow. The at least one filter element (e.g., the terminal filter element) may be comprised of activated charcoal. The at least one filter element (e.g., the terminal element) may be comprised of paper. The or each filter element may be at least partly (e.g., entirely) circumscribed with a plug wrap e.g., a paper plug wrap.

The terminal filter element (at the downstream end of the article/consumable) may be joined to the upstream elements forming the article/consumable by a circumscribing tipping layer e.g., a tipping paper layer. The tipping paper may have an axial length longer than the axial length of the terminal filter element such that the tipping paper completely circumscribes the terminal filter element plus the wrapping layer surrounding any adjacent upstream element.

In some embodiments, the article/consumable may comprise an aerosol-cooling element which is adapted to cool the aerosol generated from the aerosol-forming substrate (by heat exchange) before being inhaled by the user.

The article/consumable may comprise a spacer element that defines a space or cavity between the aerosol-forming substrate and the downstream end of the consumable. The spacer element may comprise a cardboard tube. The spacer element may be circumscribed by the (paper) wrapping layer.

According to a third aspect of the sixteenth mode of the present disclosure, there is provided a method of using the system according to the second aspect, the method comprising inserting the aerosol-forming article into the device; and heating the article using the heater of the device.

In some embodiments the method may comprise inserting the article into a cavity within a body of the device and penetrating the article with the heating element of the device upon insertion of the article.

The sixteenth mode of the disclosure includes the combination of the aspects and preferred features described except where such a combination is clearly impermissible or expressly avoided.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

Seventeenth Mode of the Disclosure: Heat Not Burn Device Controlling Supply of Power to Heater Based on Operating Temperature of the Heater At its most general, the present disclosure relates to a heat not burn device capable of controlling supply of power to heater based on operating temperature of the heater.

According to a first aspect of the seventeenth mode of the present disclosure, there is provided a heat not burn device including: a power supply; a heater; and a controller; wherein the controller is configured to control a supply of power from the power supply to the heater, the device further including a temperature sensing means configured to measure the temperature of the heater, wherein the controller is configured to supply power to the heater until a first threshold temperature is met or exceeded; and to subsequently apply power again to the heater when the temperature of the heater falls below a second threshold temperature, where the second threshold temperature is lower than the first threshold temperature.

By providing a device comprising a monitoring operating temperature of the heater and supplying power to the heater based on two threshold temperature values the device may more accurately maintain the temperature of the heater. In particular, over shoot of the first temperature threshold value may be reduced.

Optional features will now be set out. These are applicable singly or in any combination with any aspect.

Optionally, the second threshold temperature is lower than the first threshold temperature by an amount ranging between 0.2 degrees to 15 degrees.

Optionally, the second threshold value may be selected based on a frequency of measurement of the operating temperature.

Optionally, the second threshold value may be selected based on time constant and/or dead time of the device.

Optionally, the second threshold temperature is selected based on a time constant of the heater.

Optionally, the second threshold temperature is selected based on a dead time of the heater.

Optionally, the device further includes an ambient temperature measurement means for measuring an ambient temperature for the device.

Optionally, the second threshold temperature is selected based on an ambient temperature measurement for the device.

Optionally, the controller is configured to pulse width modulate the power supply to the heater.

Optionally, the first threshold temperature is an operating target temperature of the heater during a consumable cycle.

The device may comprise an elongate body. An end of the elongate body may be configured for engagement with an aerosol-forming article. For example, the body may be configured for engagement with a heated tobacco (HT) consumable (or heat-not-burn (HNB) consumable). The terms "heated tobacco" and "heat-not-burn" are used interchangeably herein to describe a consumable that is of the type that is heated rather than combusted (or are used interchangeably to describe a device for use with such a consumable). The device may comprise a cavity that is configured for receipt of at least a portion of the consumable (i.e., for engagement with the consumable). The aerosol-forming article may be of the type that comprises an aerosol former (e.g., carried by an aerosol-forming substrate).

The device may comprise a heater for heating the aerosol-forming article. The heater may comprise a heating element, which may be in the form of a rod that extends from the body of the device. The heating element may extend from the end of the body that is configured for engagement with the aerosol-forming article.

The heater (and thus the heating element) may be rigidly mounted to the body. The heating element may be elongate so as to define a longitudinal axis and may, for example, have a transverse profile (i.e., transverse to a longitudinal axis of the heating element) that is substantially circular (i.e., the heating element may be generally cylindrical). Alternatively, the heating element may have a transverse profile that is rectangular (i.e., the heater may be a "blade heater"). The heating element may alternatively be in the shape of a tube (i.e., the heater may be a "tube heater"). The heating element may take other forms (e.g., the heating element may have an elliptical transverse profile). The shape and/or size (e.g., diameter) of the transverse profile of the heating element may be generally consistent for the entire length (or substantially the entire length) of the heating element.

The heating element may be between 15 mm and 25 mm long, e.g., between 18 mm and 20 mm long, e.g., around 19 mm long. The heating element may have a diameter of between 1.5 mm and 2.5 mm, e.g., a diameter between 2 mm and 2.3 mm, e.g., a diameter of around 2.15 mm.

The heating element may be formed of ceramic. The heating element may comprise a core (e.g., a ceramic core) comprising Al2O3. The core of the heating element may have a diameter of 1.8 mm to 2.1 mm, e.g., between 1.9 mm and 2 mm. The heating element may comprise an outer layer (e.g., an outer ceramic layer) comprising Al2O3. The thickness of the outer layer may be between 160 μm and 220 μm, e.g., between 170 μm and 190 μm, e.g., around 180 μm. The heating element may comprise a heating track, which may extend longitudinally along the heating element. The heating track may be sandwiched between the outer layer and the core of the heating element. The heating track may comprise tungsten and/or rhenium. The heating track may have a thickness of around 20 μm.

The heating element may be located in the cavity (of the device), and may extend (e.g., along a longitudinal axis) from an internal base of the cavity towards an opening of the cavity. The length of the heating element (i.e., along the longitudinal axis of the heater) may be less than the depth of the cavity. Hence, the heating element may extend for only a portion of the length of the cavity. That is, the heating element may not extend through (or beyond) the opening of the cavity.

The heating element may be configured for insertion into an aerosol-forming article (e.g., a HT consumable) when an aerosol-forming article is received in the cavity. In that respect, a distal end (i.e., distal from a base of the heating element where it is mounted to the device) of the heating element may comprise a tapered portion, which may facilitate insertion of the heating element into the aerosol-forming article. The heating element may fully penetrate an aerosol-forming article when the aerosol-forming article is received in the cavity. That is, the entire length, or substantially the entire length, of the heating element may be received in the aerosol-forming article.

The heating element may have a length that is less than, or substantially the same as, an axial length of an aerosol-forming substrate forming part of an aerosol-forming article (e.g., a HT consumable). Thus, when such an aerosol-forming article is engaged with the device, the heating element may only penetrate the aerosol-forming substrate, rather than other components of the aerosol-forming article. The heating element may penetrate the aerosol-forming substrate for substantially the entire axial length of the aerosol forming-substrate of the aerosol-forming article. Thus, heat may be transferred from (e.g., an outer circumferential surface of) the heating element to the surrounding aerosol-forming substrate, when penetrated by the heating element. That is, heat may be transferred radially outwardly (in the case of a cylindrical heating element) or e.g., radially inwardly (in the case of a tube heater).

Where the heater is a tube heater, the heating element of the tube heater may surround at least a portion of the cavity. When the portion of the aerosol-forming article is received in the cavity, the heating element may surround a portion of the aerosol-forming article (i.e., so as to heat that portion of the aerosol-forming article). In particular, the heating element may surround an aerosol forming substrate of the aerosol-forming article. That is, when an aerosol-forming article is engaged with the device, the aerosol forming substrate of the aerosol-forming article may be located adjacent an inner surface of the (tubular) heating element. When the heating element is activated, heat may be transferred radially inwardly from the inner surface of the heating element to heat the aerosol forming substrate.

The cavity may comprise a (e.g., circumferential) wall (or walls) and the (tubular) heating element may extend around at least a portion of the wall(s). In this way, the wall may be located between the inner surface of the heating element and an outer surface of the aerosol-forming article. The wall (or walls) of the cavity may be formed from a thermally conductive material (e.g., a metal) to allow heat conduction from the heating element to the aerosol-forming article. Thus, heat may be conducted from the heating element, through the cavity wall (or walls), to the aerosol-forming substrate of an aerosol-forming article received in the cavity.

In some embodiments, the device may comprise a temperature sensor coupled with the heater and the controller. The temperature sensor may be configured to sense operating temperature of the heater and transmit the measured operating temperature value to the controller.

In some embodiments the device may comprise a cap disposed at the end of the body that is configured for engagement with an aerosol-forming article. Where the device comprises a heater having a heating element, the cap may at least partially enclose the heating element. The cap may be moveable between an open position in which access is provided to the heating element, and a closed position in which the cap at least partially encloses the heating element. The cap may be slideably engaged with the body of the device, and may be slideable between the open and closed positions.

The cap may define at least a portion of the cavity of the device. That is, the cavity may be fully defined by the cap, or each of the cap and body may define a portion of the cavity. Where the cap fully defines the cavity, the cap may comprise an aperture for receipt of the heating element into the cavity (when the cap is in the closed position). The cap may comprise an opening to the cavity. The opening may be configured for receipt of at least a portion of an aerosol-forming article. That is, an aerosol-forming article may be inserted through the opening and into the cavity (so as to be engaged with the device).

The cap may be configured such that when an aerosol-forming article is engaged with the device (e.g., received in the cavity), only a portion of the aerosol-forming article is received in the cavity. That is, a portion of the aerosol-forming article (not received in the cavity) may protrude from (i.e., extend beyond) the opening. This (protruding) portion of the aerosol-forming article may be a terminal (e.g., mouth) end of the aerosol-forming article, which may be received in a user's mouth for the purpose of inhaling aerosol formed by the device.

The device may comprise a power source or may be connectable to a power source (e.g., a power source separate to the device). The power source may be electrically connectable to the heater. In that respect, altering (e.g., toggling) the electrical connection of the power source to the heater may affect a state of the heater. For example, toggling the electrical connection of the power source to the heater may toggle the heater between an on state and an off state. The power source may be a power store. For example, the power source may be a battery or rechargeable battery (e.g., a lithium ion battery).

The device may comprise an input connection (e.g., a USB port, Micro USB port, USB-C port, etc.). The input connection may be configured for connection to an external source of electrical power, such as a mains electrical supply outlet. The input connection may, in some cases, be used as a substitute for an internal power source (e.g., battery or rechargeable battery). That is, the input connection may be electrically connectable to the heater (for providing power to the heater). Hence, in some forms, the input connection may form at least part of the power source of the device.

Where the power source comprises a rechargeable power source (such as a rechargeable battery), the input connection may be used to charge and recharge the power source.

The device may comprise a user interface (UI). In some embodiments the UI may include input means to receive operative commands from the user. The input means of the UI may allow the user to control at least one aspect of the operation of the device. In some embodiments the input means may comprise a power button to switch the device between an on state and an off state.

In some embodiments the UI may additionally or alternatively comprise output means to convey information to the user. In some embodiments the output means may comprise a light to indicate a condition of the device (and/or the aerosol-forming article) to the user. The condition of the device (and/or aerosol-forming article) indicated to the user may comprise a condition indicative of the operation of the heater. For example, the condition may comprise whether the heater is in an off state or an on state. In some embodiments, the UI unit may comprise at least one of a button, a display, a touchscreen, a switch, a light, and the like. For example, the output means may comprise one or more (e.g., two, three, four, etc.) light-emitting diodes ("LEDs") that may be located on the body of the device.

The device may further comprise a puff sensor (e.g., airflow sensor), which form part of the input means of the UI. The puff sensor may be configured to detect a user drawing on an end (i.e., a terminal (mouth) end) of the aerosol-forming article. The puff sensor may, for example, be a pressure sensor or a microphone. The puff sensor may be configured to produce a signal indicative of a puff state. The signal may be indicative of the user drawing (an aerosol from the aerosol-forming article) such that it is e.g., in the form of a binary signal. Alternatively or additionally, the signal may be indicative of a characteristic of the draw (e.g., a flow rate of the draw, length of time of the draw, etc).

The device may comprise a controller, or may be connectable to a controller that may be configured to control at least one function of the device. The controller may comprise a microcontroller that may e.g., be mounted on a printed circuit board (PCB). The controller may also comprise a memory, e.g., non-volatile memory. The memory may include instructions, which, when implemented, may cause the controller to perform certain tasks or steps of a method. Where the device comprises an input connection, the controller may be connected to the input connection.

The controller may be configured to control the operation of the heater (and e.g., the heating element). Thus, the controller may be configured to control vaporization of an aerosol forming part of an aerosol-forming article engaged with the device. The controller may be configured to control the voltage applied by power source to the heater. For example, the controller may be configured to toggle between applying a full output voltage (of the power source) to the heater and applying no voltage to the heater. Alternatively or additionally, the control unit may implement a more complex heater control protocol.

The device may further comprise a voltage regulator to regulate the output voltage supplied by the power source to form a regulated voltage. The regulated voltage may subsequently be applied to the heater.

In some embodiments, where the device comprises a UI, the controller may be operatively connected to one or more components of the UI. The controller may be configured to receive command signals from an input means of the UI. The controller may be configured to control the heater in response to the command signals. For example, the controller may be configured to receive "on" and "off" command signals from the UI and, in response, may control the heater so as to be in a corresponding on or off state.

The controller may be configured to send output signals to a component of the UI. The UI may be configured to convey information to a user, via an output means, in response to such output signals (received from the controller). For example, where the device comprises one or more LEDs, the LEDs may be operatively connected to the controller. Hence, the controller may be configured to control the illumination of the LEDs (e.g., in response to an output signal). For example, the controller may be configured to control the illumination of the LEDs according to (e.g., an on or off) state of the heater.

Where the device comprises a sensor (e.g., a puff/airflow sensor), the controller may be operatively connected to the sensor. The controller may be configured to receive a signal from the sensor (e.g. indicative of a condition of the device and/or engaged aerosol-forming article). The controller may be configured to control the heater, or an aspect of the output means, based on the signal from the sensor.

In some embodiments, the controller may be configured to control the supply of power from the power source to the heater. The supply of power may be controlled based on the operating temperature of the heater measured by the temperature sensor. The device may therefore be able to maintain the operating temperature of the device at the desired range of temperatures.

In some embodiments, the controller may be operatively connected to at least one of power source, the heater and the temperature sensor, to control the supply of power.

The device may comprise a wireless interface configured to communicate wirelessly (e.g., via Bluetooth (e.g., a Bluetooth low-energy connection) or WiFi) with an external device. Similarly, the input connection may be configured for wired connection to an external device so as to provide communication between the device and the external device.

The external device may be a mobile device. For example, the external device may be a smart phone, tablet, smart watch, or smart car. An application (e.g., app) may be installed on the external device (e.g., mobile device). The application may facilitate communication between the device and the external device via the wired or wireless connection.

The wireless or wired interface may be configured to transfer signals between the external device and the controller of the device. In this respect, the controller may control an aspect of the device in response to a signal received from an external device. Alternatively or additionally, an external device may respond to a signal received from the device (e.g., from the controller of the device).

According to a further aspect of the seventeenth mode, there is provided a method of using the system according to the second aspect the method comprising: inserting the article into the device; and heating the article using the heater of the device.

Optionally, the method includes inserting the article into a cavity within a body of the device and penetrating the article with the heating element heater upon insertion of the article.

As used herein, the terms "upstream" and "downstream" are intended to refer to the flow direction of the vapor/aerosol i.e., with the downstream end of the article/consumable being the mouth end or outlet where the aerosol exits the consumable for inhalation by the user. The upstream end of the article/consumable is the opposing end to the downstream end.

The aerosol-forming substrate is capable of being heated to release at least one volatile compound that can form an aerosol. The aerosol-forming substrate may be located at the upstream end of the article/consumable.

In order to generate an aerosol, the aerosol-forming substrate comprises at least one volatile compound that is intended to be vaporized/aerosolized and that may provide the user with a recreational and/or medicinal effect when inhaled. Suitable chemical and/or physiologically active volatile compounds include the group consisting of: nicotine, cocaine, caffeine, opiates and opioids, cathine and cathinone, kavalactones, mysticin, beta-carboline alkaloids, salvinorin A together with any combinations, functional equivalents to, and/or synthetic alternatives of the foregoing.

The aerosol-forming substrate may comprise plant material. The plant material may comprise least one plant material selected from the list including *Amaranthus dubius, Arctostaphylos uva-ursi* (Bearberry), *Argemone mexicana, Amica, Artemisia vulgaris*, Yellow Tees, *Galea zacatechichi, Canavalia maritima* (Baybean), *Cecropia mexicana* (Guamura), *Cestrum noctumum, Cynoglossum virginianum* (wild comfrey), *Cytisus scoparius, Damiana, Entada rheedii, Eschscholzia califomica* (California Poppy), *Fittonia albivenis, Hippobroma longiflora, Humulus japonica* (Japanese Hops), *Humulus lupulus* (Hops), *Lactuca virosa* (Lettuce Opium), *Laggera alata, Leonotis leonurus, Leonurus cardiaca* (Motherwort), *Leonurus sibiricus* (Honeyweed), *Lobelia cardinalis, Lobelia inflata* (Indian-tobacco), *Lobelia siphilitica, Nepeta cataria* (Catnip), *Nicotiana* species (Tobacco), *Nymphaea alba* (White Lily), *Nymphaea caerulea* (Blue Lily), Opium poppy, *Passiflora incamata* (Passionflower), *Pedicularis densiflora* (Indian Warrior), *Pedicularis groenlandica* (Elehant's Head), *Salvia divinorum, Salvia dorrii* (Tobacco Sage), Salvia species (Sage), *Scutellaria galericulata, Scutellaria lateriflora, Scutellaria nana, Scutellaria* species (Skullcap), *Sida acuta* (Wireweed), *Sida rhombifolia, Silene capensis, Syzygium aromaticum* (Clove), *Tagetes lucida* (Mexican Tarragon), *Tarchonanthus camphoratus, Tumera diffusa* (Damiana), *Verbascum* (Mullein), *Zamia latifolia* (Maconha Brava) together with any combinations, functional equivalents to, and/or synthetic alternatives of the foregoing.

The plant material may be tobacco. Any type of tobacco may be used. This includes, but is not limited to, flue-cured tobacco, burley tobacco, Maryland Tobacco, dark-air cured tobacco, oriental tobacco, dark-fired tobacco, perique tobacco and rustica tobacco. This also includes blends of the above mentioned tobaccos.

The tobacco may comprise one or more of leaf tobacco, stem tobacco, tobacco powder, tobacco dust, tobacco derivatives, expanded tobacco, homogenized tobacco, shredded tobacco, extruded tobacco, cut rag tobacco and/or reconstituted tobacco (e.g., slurry recon or paper recon).

The aerosol-forming substrate may comprise a gathered sheet of homogenized (e.g., paper/slurry recon) tobacco or gathered shreds/strips formed from such a sheet.

The aerosol-forming substrate may comprise one or more additives selected from humectants, flavorants, fillers, aqueous/non-aqueous solvents and binders.

The flavorant may be provided in solid or liquid form. It may include menthol, licorice, chocolate, fruit flavor (including e.g., citrus, cherry etc.), vanilla, spice (e.g., ginger, cinnamon) and tobacco flavor. The flavorant may be evenly dispersed throughout the aerosol-forming substrate or may be provided in isolated locations and/or varying concentrations throughout the aerosol-forming substrate.

The aerosol-forming substrate may be formed in a substantially cylindrical shape such that the article/consumable resembles a conventional cigarette. It may have a diameter of between 5 and 10 mm e.g., between 6 and 9 mm or 6 and 8 mm e.g., around 7 mm. It may have an axial length of between 10 and 15 mm e.g., between 11 and 14 mm such as around 12 or 13 mm.

The article/consumable may comprise at least one filter element. There may be a terminal filter element at the downstream/mouth end of the article/consumable.

The or at least one of the filter element(s) (e.g., the terminal filter element) may be comprised of cellulose acetate or polypropylene tow. The at least one filter element (e.g., the terminal filter element) may be comprised of activated charcoal. The at least one filter element (e.g., the terminal element) may be comprised of paper. The or each filter element may be at least partly (e.g., entirely) circumscribed with a plug wrap e.g., a paper plug wrap.

The terminal filter element (at the downstream end of the article/consumable) may be joined to the upstream elements forming the article/consumable by a circumscribing tipping layer e.g., a tipping paper layer. The tipping paper may have an axial length longer than the axial length of the terminal filter element such that the tipping paper completely circumscribes the terminal filter element plus the wrapping layer surrounding any adjacent upstream element.

In some embodiments, the article/consumable may comprise an aerosol-cooling element which is adapted to cool the aerosol generated from the aerosol-forming substrate (by heat exchange) before being inhaled by the user.

The article/consumable may comprise a spacer element that defines a space or cavity between the aerosol-forming substrate and the downstream end of the consumable. The spacer element may comprise a cardboard tube. The spacer element may be circumscribed by the (paper) wrapping layer.

According to a third aspect of the seventeenth mode of the present disclosure, there is provided a method of using the system according to the second aspect, the method comprising inserting the aerosol-forming article into the device; and heating the article using the heater of the device.

In some embodiments the method may comprise inserting the article into a cavity within a body of the device and penetrating the article with the heating element of the device upon insertion of the article.

The seventeenth mode of the disclosure includes the combination of the aspects and preferred features described except where such a combination is clearly impermissible or expressly avoided.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

Eighteenth Mode of the Disclosure: Heater for a Heat Not Burn Device Including a Longitudinal Heating Element At its most general, the eighteenth mode of the present disclosure relates to a heat not burn device.

According to a first aspect of the eighteenth mode of the present disclosure, there is provided heater for a heat not burn device. The heater includes a longitudinal heating element including a resistive heating track formed thereon. The heater further includes a tapered tip for penetrating a consumable engaged with the device.

The heating element is formed from a heater material of a first thermal conductivity and the tapered tip is formed from a tip material of a second thermal conductivity. The second thermal conductivity is lower than the first thermal conductivity.

By providing a heat not burn device comprising a heater having a tip formed from a material having lower thermal conductivity than the material of the heating element, the device may be enabled to contain the heat where it most needed. i.e., in the region where the heating element is located and minimize losses in heat.

Optional features will now be set out. These are applicable singly or in any combination with any aspect.

Advantageously, the first thermal conductivity is at least 3 times greater than the second thermal conductivity, preferably 6 times, more preferably 10 times greater than the second thermal conductivity. Thereby more heat is imparted and kept in the region where it is needed with less losses in heat.

Advantageously, the longitudinal heating element comprises a proximal end and a distal end; such that the heater is mounted to the device at the proximal end and the tip is located at the distal end.

Conveniently, the heater material is alumina, thereby improving the hardness of the rod heater.

Optionally, the tip material is zirconia, thereby improving the longevity of the tip.

Conveniently, the tip has conical configuration. This enables easy insertion of the tip into an aerosol forming article.

Optionally, the cone has a draft angle of 20 to 70 degrees.

Optionally, the cone has a draft angle of 30 to 60 degrees.

Optionally, the cone has a draft angle of 40 to 50 degrees.

Optionally, the cone has a draft angle substantially equal to 45 degrees.

Advantageously, an edge of a base of the tip is flush with an edge of the distal end of the longitudinal heating element.

Conveniently, the tip and the longitudinal heating element of the heater are coated with a protective layer.

Optionally, the protective layer is formed of silica.

Conveniently, the cone is bonded to the distal end of a non-tapered portion of the heater.

The device may comprise an elongate body. An end of the elongate body may be configured for engagement with an aerosol-forming article. For example, the body may be configured for engagement with a heated tobacco (HT) consumable (or heat-not-burn (HNB) consumable). The terms "heated tobacco" and "heat-not-burn" are used interchangeably herein to describe a consumable that is of the type that is heated rather than combusted (or are used interchangeably to describe a device for use with such a consumable). The device may comprise a cavity that is configured for receipt of at least a portion of the consumable (i.e., for engagement with the consumable). The aerosol-forming article may be of the type that comprises an aerosol former (e.g., carried by an aerosol-forming substrate).

The device may comprise a heater for heating the aerosol-forming article. The heater may comprise a heating element, which may be in the form of a rod that extends from the body of the device. The heating element may extend from the end of the body that is configured for engagement with the aerosol-forming article.

The heater (and thus the heating element) may be rigidly mounted to the body. The heating element may be elongate so as to define a longitudinal axis and may, for example, have a transverse profile (i.e., transverse to a longitudinal axis of the heating element) that is substantially circular (i.e., the heating element may be generally cylindrical). Alternatively, the heating element may have a transverse profile that is rectangular (i.e., the heater may be a "blade heater"). The heating element may alternatively be in the shape of a tube (i.e., the heater may be a "tube heater"). The heating element may take other forms (e.g., the heating element may have an elliptical transverse profile). The shape and/or size (e.g., diameter) of the transverse profile of the heating element may be generally consistent for the entire length (or substantially the entire length) of the heating element.

The heating element may be between 15 mm and 25 mm long, e.g., between 18 mm and 20 mm long, e.g., around 19 mm long. The heating element may have a diameter of between 1.5 mm and 2.5 mm, e.g., a diameter between 2 mm and 2.3 mm, e.g., a diameter of around 2.15 mm.

The heating element may be formed of ceramic. The heating element may comprise a core (e.g., a ceramic core) comprising $Al_2O_3$. The core of the heating element may have a diameter of 1.8 mm to 2.1 mm, e.g., between 1.9 mm and 2 mm. The heating element may comprise an outer layer (e.g., an outer ceramic layer) comprising $Al_2O_3$. The thickness of the outer layer may be between 160 μm and 220 μm, e.g., between 170 μm and 190 μm, e.g., around 180 μm. The heating element may comprise a heating track, which may extend longitudinally along the heating element. The heating track may be sandwiched between the outer layer and the core of the heating element. The heating track may comprise tungsten and/or rhenium. The heating track may have a thickness of around 20 μm.

The heating element may be located in the cavity (of the device), and may extend (e.g., along a longitudinal axis) from an internal base of the cavity towards an opening of the cavity. The length of the heating element (i.e., along the longitudinal axis of the heater) may be less than the depth of the cavity.

Hence, the heating element may extend for only a portion of the length of the cavity. That is, the heating element may not extend through (or beyond) the opening of the cavity.

The heating element may be configured for insertion into an aerosol-forming article (e.g., a HT consumable) when an aerosol-forming article is received in the cavity. In that respect, a distal end (i.e., distal from a base of the heating element where it is mounted to the device) of the heating element may comprise a tapered portion, which may facilitate insertion of the heating element into the aerosol-forming article. The heating element may fully penetrate an aerosol-forming article when the aerosol-forming article is received in the cavity. That is, the entire length, or substantially the entire length, of the heating element may be received in the aerosol-forming article.

The heating element may have a length that is less than, or substantially the same as, an axial length of an aerosol-forming substrate forming part of an aerosol-forming article (e.g., a HT consumable).

Thus, when such an aerosol-forming article is engaged with the device, the heating element may only penetrate the aerosol-forming substrate, rather than other components of the aerosol-forming article. The heating element may penetrate the aerosol-forming substrate for substantially the entire axial length of the aerosol forming-substrate of the aerosol-forming article. Thus, heat may be transferred from (e.g., an outer circumferential surface of) the heating element to the surrounding aerosol-forming substrate, when penetrated by the heating element. That is, heat may be transferred radially outwardly (in the case of a cylindrical heating element) or e.g., radially inwardly (in the case of a tube heater).

Where the heater is a tube heater, the heating element of the tube heater may surround at least a portion of the cavity. When the portion of the aerosol-forming article is received in the cavity, the heating element may surround a portion of the aerosol-forming article (i.e., so as to heat that portion of the aerosol-forming article). In particular, the heating element may surround an aerosol forming substrate of the aerosol-forming article. That is, when an aerosol-forming article is engaged with the device, the aerosol forming substrate of the aerosol-forming article may be located adjacent an inner surface of the (tubular) heating element. When the heating element is activated, heat may be transferred radially inwardly from the inner surface of the heating element to heat the aerosol forming substrate.

In one embodiment, the heater includes a longitudinal heating element including a resistive heating track formed thereon. The heater further includes a tapered tip for penetrating the consumable engaged with the device. The heating element is formed from a heater material of a first thermal conductivity and the tapered tip is formed from a tip material of a second thermal conductivity. The second thermal conductivity is at least 3 times lower than the first thermal conductivity. In a preferred embodiment, the second thermal conductivity is 6 times lower than the first thermal conductivity. In a more preferred embodiment, second thermal conductivity is 10 times lower than the first thermal conductivity. Optionally, the heater material may be alumina and the tip material may be zirconia. The lower heat conductivity of zirconia causes reflection of heat towards the heating element, when operating the device. The specific configuration of the heating element and the tapered tip enable more heat being imparted and being kept where it is needed most, that is in the region of the heating element. Thereby heat losses through the tip of the heater are substantially reduced which in turn leads to more efficient heating and lower power consumption. The tip has conical configuration with the cone having a draft angle of 20 to 70 degrees, or 30 to 60 degrees, or 40 to 50 degrees or substantially equal to 45 degrees. The longitudinal heating element comprises a proximal end and a distal end, such that the heater is mounted to the device at the proximal end and the tip is located at the distal end. The tip and the longitudinal heating element of the heater may be coated with a protective layer formed of silica, The cavity may comprise a (e.g., circumferential) wall (or walls) and the (tubular) heating element may extend around at least a portion of the wall(s). In this way, the wall may be located between the inner surface of the heating element and an outer surface of the aerosol-forming article. The wall (or walls) of the cavity may be formed from a thermally conductive material (e.g., a metal) to allow heat conduction from the heating element to the aerosol-forming article. Thus, heat may be conducted from the heating element, through the cavity wall (or walls), to the aerosol-forming substrate of an aerosol-forming article received in the cavity.

In some embodiments the device may comprise a cap disposed at the end of the body that is configured for engagement with an aerosol-forming article. Where the device comprises a heater having a heating element, the cap may at least partially enclose the heating element. The cap may be moveable between an open position in which access is provided to the heating element, and a closed position in which the cap at least partially encloses the heating element. The cap may be slideably engaged with the body of the device, and may be slideable between the open and closed positions.

The cap may define at least a portion of the cavity of the device. That is, the cavity may be fully defined by the cap, or each of the cap and body may define a portion of the cavity. Where the cap fully defines the cavity, the cap may comprise an aperture for receipt of the heating element into the cavity (when the cap is in the closed position). The cap may comprise an opening to the cavity. The opening may be configured for receipt of at least a portion of an aerosol-forming article. That is, an aerosol-forming article may be inserted through the opening and into the cavity (so as to be engaged with the device).

The cap may be configured such that when an aerosol-forming article is engaged with the device (e.g., received in the cavity), only a portion of the aerosol-forming article is received in the cavity. That is, a portion of the aerosol-forming article (not received in the cavity) may protrude from (i.e., extend beyond) the opening. This (protruding) portion of the aerosol-forming article may be a terminal (e.g., mouth) end of the aerosol-forming article, which may be received in a user's mouth for the purpose of inhaling aerosol formed by the device.

The device may comprise a power source or may be connectable to a power source (e.g., a power source separate to the device). The power source may be electrically connectable to the heater. In that respect, altering (e.g., toggling) the electrical connection of the power source to the heater may affect a state of the heater. For example, toggling the electrical connection of the power source to the heater may toggle the heater between an on state and an off state. The power source may be a power store. For example, the power source may be a battery or rechargeable battery (e.g., a lithium ion battery).

The device may comprise an input connection (e.g., a USB port, Micro USB port, USB-C port, etc.). The input connection may be configured for connection to an external source of electrical power, such as a mains electrical supply outlet. The input connection may, in some cases, be used as a substitute for an internal power source (e.g., battery or rechargeable battery). That is, the input connection may be electrically connectable to the heater (for providing power to the heater). Hence, in some forms, the input connection may form at least part of the power source of the device.

Where the power source comprises a rechargeable power source (such as a rechargeable battery), the input connection may be used to charge and recharge the power source.

The device may comprise a user interface (UI). In some embodiments the UI may include input means to receive operative commands from the user. The input means of the UI may allow the user to control at least one aspect of the operation of the device. In some embodiments the input means may comprise a power button to switch the device between an on state and an off state.

In some embodiments the UI may additionally or alternatively comprise output means to convey information to the user. In some embodiments the output means may comprise a light to indicate a condition of the device (and/or the aerosol-forming article) to the user. The condition of the device (and/or aerosol-forming article) indicated to the user may comprise a condition indicative of the operation of the heater. For example, the condition may comprise whether the heater is in an off state or an on state. In some embodiments, the UI unit may comprise at least one of a button, a display, a touchscreen, a switch, a light, and the like. For example, the output means may comprise one or more (e.g., two, three, four, etc.) light-emitting diodes ("LEDs") that may be located on the body of the device.

The device may further comprise a puff sensor (e.g., airflow sensor), which form part of the input means of the UI. The puff sensor may be configured to detect a user drawing on an end (i.e., a terminal (mouth) end) of the aerosol-forming article. The puff sensor may, for example, be a pressure sensor or a microphone. The puff sensor may be configured to produce a signal indicative of a puff state. The signal may be indicative of the user drawing (an aerosol from the aerosol-forming article) such that it is e.g., in the form of a binary signal. Alternatively, or additionally, the signal may be indicative of a characteristic of the draw (e.g., a flow rate of the draw, length of time of the draw, etc.).

The device may comprise a controller, or may be connectable to a controller that may be configured to control at least one function of the device. The controller may comprise a microcontroller that may e.g., be mounted on a printed circuit board (PCB). The controller may also comprise a memory, e.g., non-volatile memory. The memory may include instructions, which, when implemented, may cause the controller to perform certain tasks or steps of a method. Where the device comprises an input connection, the controller may be connected to the input connection.

The controller may be configured to control the operation of the heater (and e.g., the heating element). Thus, the controller may be configured to control vaporization of an aerosol forming part of an aerosol-forming article engaged with the device. The controller may be configured to control the voltage applied by power source to the heater. For example, the controller may be configured to toggle between applying a full output voltage (of the power source) to the heater and applying no voltage to the heater. Alternatively, or additionally, the control unit may implement a more complex heater control protocol.

The device may further comprise a voltage regulator to regulate the output voltage supplied by the power source to form a regulated voltage. The regulated voltage may subsequently be applied to the heater.

In some embodiments, where the device comprises a UI, the controller may be operatively connected to one or more components of the UI. The controller may be configured to receive command signals from an input means of the UI. The controller may be configured to control the heater in response to the command signals. For example, the controller may be configured to receive "on" and "off" command signals from the UI and, in response, may control the heater so as to be in a corresponding on or off state.

The controller may be configured to send output signals to a component of the UI. The UI may be configured to convey information to a user, via an output means, in response to such output signals (received from the controller). For example, where the device comprises one or more LEDs, the LEDs may be operatively connected to the controller. Hence, the controller may configured to control the illumination of the LEDs (e.g., in response to an output signal). For example, the controller may be configured to control the illumination of the LEDs according to (e.g., an on or off) state of the heater.

Where the device comprises a sensor (e.g., a puff/airflow sensor), the controller may be operatively connected to the sensor. The controller may be configured to receive a signal from the sensor (e.g. indicative of a condition of the device and/or engaged aerosol-forming article). The controller may be configured to control the heater, or an aspect of the output means, based on the signal from the sensor.

The device may comprise a wireless interface configured to communicate wirelessly (e.g., via Bluetooth (e.g., a Bluetooth low-energy connection) or WiFi) with an external device. Similarly, the input connection may be configured for wired connection to an external device so as to provide communication between the device and the external device.

The external device may be a mobile device. For example, the external device may be a smart phone, tablet, smart watch, or smart car. An application (e.g., app) may be installed on the external device (e.g., mobile device). The application may facilitate communication between the device and the external device via the wired or wireless connection.

The wireless or wired interface may be configured to transfer signals between the external device and the controller of the device. In this respect, the controller may control an aspect of the device in response to a signal received from an external device. Alternatively, or additionally, an external device may respond to a signal received from the device (e.g., from the controller of the device).

In a second aspect of the eighteenth mode, there is provided a system (e.g., a smoking substitute system) comprising a heating not burn device according to the present disclosure and an aerosol-forming article. The aerosol-forming article may comprise an aerosol-forming substrate at an upstream end of the aerosol-forming article. The article may be in the form of a smoking substitute article, e.g., heated tobacco (HT) consumable (also known as a heat-not-burn (HNB) consumable).

As used herein, the terms "upstream" and "downstream" are intended to refer to the flow direction of the vapor/aerosol i.e., with the downstream end of the article/consumable being the mouth end or outlet where the aerosol exits the consumable for inhalation by the user. The upstream end of the article/consumable is the opposing end to the downstream end.

The aerosol-forming substrate is capable of being heated to release at least one volatile compound that can form an aerosol. The aerosol-forming substrate may be located at the upstream end of the article/consumable.

In order to generate an aerosol, the aerosol-forming substrate comprises at least one volatile compound that is intended to be vaporized/aerosolized and that may provide the user with a recreational and/or medicinal effect when inhaled. Suitable chemical and/or physiologically active volatile compounds include the group consisting of: nicotine, cocaine, caffeine, opiates and opioids, cathine and cathinone, kavalactones, mysticin, beta-carboline alkaloids, salvinorin A together with any combinations, functional equivalents to, and/or synthetic alternatives of the foregoing.

The aerosol-forming substrate may comprise plant material. The plant material may comprise least one plant material selected from the list including *Amaranthus dubius, Arctostaphylos uva-ursi* (Bearberry), *Argemone mexicana, Amica, Artemisia vulgaris*, Yellow Tees, *Galea zacatechichi, Canavalia maritima* (Baybean), *Cecropia mexicana* (Guamura), *Cestrum noctumum, Cynoglossum virginianum* (wild comfrey), *Cytisus scoparius, Damiana, Entada rheedii, Eschscholzia califomica* (California Poppy), *Fittonia albivenis, Hippobroma longiflora, Humulus japonica* (Japanese Hops), *Humulus lupulus* (Hops), *Lactuca virosa* (Lettuce Opium), *Laggera alata, Leonotis leonurus, Leonurus cardiaca* (Motherwort), *Leonurus sibiricus* (Honeyweed), *Lobelia cardinalis, Lobelia inflata* (Indian-tobacco), *Lobelia siphilitica, Nepeta cataria* (Catnip), *Nicotiana* species (Tobacco), *Nymphaea alba* (White Lily), *Nymphaea caerulea* (Blue Lily), Opium poppy, *Passiflora incamata* (Passionflower), *Pedicularis densiflora* (Indian Warrior), *Pedicularis groenlandica* (Elehant's Head), *Salvia divinorum, Salvia dorrii* (Tobacco Sage), Salvia species (Sage), *Scutellaria galericulata, Scutellaria lateriflora, Scutellaria nana, Scutellaria* species (Skullcap), *Sida acuta* (Wireweed), *Sida rhombifolia, Silene capensis, Syzygium aromaticum* (Clove), *Tagetes lucida* (Mexican Tarragon), *Tarchonanthus camphoratus, Tumera diffusa* (Damiana), *Verbascum* (Mullein), *Zamia latifolia* (Maconha Brava) together with any combinations, functional equivalents to, and/or synthetic alternatives of the foregoing.

The plant material may be tobacco. Any type of tobacco may be used. This includes, but is not limited to, flue-cured tobacco, burley tobacco, Maryland Tobacco, dark-air cured tobacco, oriental tobacco, dark-fired tobacco, perique tobacco and rustica tobacco. This also includes blends of the above mentioned tobaccos.

The tobacco may comprise one or more of leaf tobacco, stem tobacco, tobacco powder, tobacco dust, tobacco derivatives, expanded tobacco, homogenized tobacco, shredded tobacco, extruded tobacco, cut rag tobacco and/or reconstituted tobacco (e.g., slurry recon or paper recon).

The aerosol-forming substrate may comprise a gathered sheet of homogenized (e.g., paper/slurry recon) tobacco or gathered shreds/strips formed from such a sheet.

The aerosol-forming substrate may comprise one or more additives selected from humectants, flavorants, fillers, aqueous/non-aqueous solvents and binders.

The flavorant may be provided in solid or liquid form. It may include menthol, licorice, chocolate, fruit flavor (including e.g., citrus, cherry etc.), vanilla, spice (e.g., ginger, cinnamon) and tobacco flavor. The flavorant may be evenly dispersed throughout the aerosol-forming substrate or may be provided in isolated locations and/or varying concentrations throughout the aerosol-forming substrate.

The aerosol-forming substrate may be formed in a substantially cylindrical shape such that the article/consumable resembles a conventional cigarette. It may have a diameter of between 5 and 10 mm e.g., between 6 and 9 mm or 6 and 8 mm e.g., around 7 mm. It may have an axial length of between 10 and 15 mm e.g., between 11 and 14 mm such as around 12 or 13 mm.

The article/consumable may comprise at least one filter element. There may be a terminal filter element at the downstream/mouth end of the article/consumable.

The or at least one of the filter element(s) (e.g., the terminal filter element) may be comprised of cellulose acetate or polypropylene tow. The at least one filter element (e.g., the terminal filter element) may be comprised of activated charcoal. The at least one filter element (e.g., the terminal element) may be comprised of paper. The or each filter element may be at least partly (e.g., entirely) circumscribed with a plug wrap e.g., a paper plug wrap.

The terminal filter element (at the downstream end of the article/consumable) may be joined to the upstream elements forming the article/consumable by a circumscribing tipping layer e.g., a tipping paper layer. The tipping paper may have an axial length longer than the axial length of the terminal filter element such that the tipping paper completely circumscribes the terminal filter element plus the wrapping layer surrounding any adjacent upstream element.

In some embodiments, the article/consumable may comprise an aerosol-cooling element which is adapted to cool the aerosol generated from the aerosol-forming substrate (by heat exchange) before being inhaled by the user.

The article/consumable may comprise a spacer element that defines a space or cavity between the aerosol-forming substrate and the downstream end of the consumable. The spacer element may comprise a cardboard tube. The spacer element may be circumscribed by the (paper) wrapping layer.

According to another aspect of the eighteenth mode of the present disclosure, there is provided a method of using the smoking substitute system according to the second aspect, the method comprising inserting the aerosol-forming article into the device; and heating the article using the heater of the device.

In some embodiments the method may comprise inserting the article into a cavity within a body of the device and penetrating the article with the heating element of the device upon insertion of the article.

According to one more aspect of the eighteenth mode of the present disclosure, there is provided a smoking substitute system comprising a heat not burn device including a heater in accordance with the present disclosure.

The eighteenth mode of the disclosure includes the combination of the aspects and preferred features described except where such a combination is clearly impermissible or expressly avoided.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

Nineteenth Mode of the Disclosure: Heater for Heat Not Burn Device Including an Electrically Conductive Heating Track At its most general, the nineteenth mode of the present disclosure relates to a heat not burn device including a heater to heat a heat not burn consumable.

According to a first aspect of the nineteenth mode of the present disclosure, there is provided a heat not burn device including a heater, for penetrating a portion of a heat not burn consumable engaged with the device. The heater includes an electrically conductive heating track. Further, the heater includes an electrically conductive temperature sensing track such that the temperature sensing track has a serpentine section extending along a major axis of the heater.

By providing a heat not burn device comprising a heater with a fabricated electrically conductive temperature sensing track, it may facilitate accurate measurement of temperature during heating of an HNB consumable.

Optional features will now be set out. These are applicable singly or in any combination with any aspect.

Optionally, the serpentine section may be between 20%-80% of a length of a heating zone of the heater. The serpentine section between 20%-80% of a length of the heating zone may facilitate larger surface area to detect the measurement of temperature.

Advantageously, the serpentine section may comprise at least one turn of the temperature sensing track of a first sense and at least one turn of a second sense, such that each turn includes an apex.

Optionally, the serpentine section may comprise at least two turns of the first sense and second sense. This configuration may provide required surface area within a definite section of the length to conduct the heat within the heater.

Optionally, the apexes of adjacent turns of first sense and second sense may be separated by at least 1 mm. This configuration allows heat transfer within the heater in short period of time.

Optionally, the serpentine section may comprise a first line defined by joining apexes of the first sense, such that the apexes of first sense may be aligned along a longitudinal direction of the heater. The apexes of first sense aligned along the longitudinal direction of the heater provides uniform heat transfer within the heater thereby allowing uniform heating of the heater.

Optionally, the serpentine section may comprise a second line defined by joining the apexes of the second sense, when the apexes of second sense may be aligned along the longitudinal direction of the heater. The apexes of second sense aligned along the longitudinal direction of the heater provides uniform heat transfer within the heater thereby allowing uniform heating of the heater.

Conveniently, the first and second lines may be parallel. The parallel configuration allows simultaneous heat transfer in the first sense and the second sense.

Optionally, the temperature sensing track may comprise a straight section which may be parallel to the first or second lines. The straight section provides the structural integrity and thermal conduction of the heater.

Optionally, the straight section and the serpentine section forms at least one of a forward path of the electrically conductive temperature sensing track and a return path of the electrically conductive temperature sensing track. This configuration may allow effective heat transfer from one section to another section.

Optionally, the temperature sensing track has a configuration in the form of a non-square-wave profile.

Optionally, the temperature sensing track has wave profile configuration, said wave profile comprising at least one region of the track oriented at an acute angle to the major axis of the heater.

Optionally, the temperature sensing track may have configuration of at least one of a sawtooth profile, a sinusoidal profile, a triangle wave and a square-wave profile.

The above-noted optional wave profile configurations of the temperature sensing track may provide structural integrity with larger surface area thereby providing effective heat transfer in the heater. These wave profile configurations also allow a greater area of the heater to be covered by the sensing track, for any given length of the track.

The device may comprise an elongate body. An end of the elongate body may be configured for engagement with an aerosol-forming article (e.g., a heated tobacco (HT) consumable). The device may comprise a cavity that is configured for receipt of at least a portion of the consumable (i.e., for engagement with the consumable). The aerosol-forming article may be of the type that comprises an aerosol former (e.g., carried by an aerosol-forming substrate).

The device may comprise a heater for heating the aerosol-forming article. The heater may comprise a heating element, which may be in the form of a rod that extends from the body of the device. The heating element may extend from the end of the body that is configured for engagement with the aerosol-forming article.

The heater (and thus the heating element) may be rigidly mounted to the body. The heating element may be elongate so as to define a longitudinal axis and may, for example, have a transverse profile (i.e., transverse to a longitudinal axis of the heating element) that is substantially circular (i.e., the heating element may be generally cylindrical). Alternatively, the heating element may have a transverse profile that is rectangular (i.e., the heater may be a "blade heater"). The heating element may alternatively be in the shape of a tube (i.e., the heater may be a "tube heater"). The heating element may take other forms (e.g., the heating element may have an elliptical transverse profile). The shape and/or size (e.g., diameter) of the transverse profile of the heating element may be generally consistent for the entire length (or substantially the entire length) of the heating element.

The heating element may be between 15 mm and 25 mm long, e.g., between 18 mm and 20 mm long, e.g., around 19 mm long. The heating element may have a diameter of between 1.5 mm and 2.5 mm, e.g., a diameter between 2 mm and 2.3 mm, e.g., a diameter of around 2.15 mm.

The heating element may be formed of ceramic. The heating element may comprise a core (e.g., a ceramic core) comprising $Al_2O_3$. The core of the heating element may have a diameter of 1.8 mm to 2.1 mm, e.g., between 1.9 mm and 2 mm. The heating element may comprise an outer layer (e.g. an outer ceramic layer) comprising $Al_2O_3$. The thickness of the outer layer may be between 160 μm and 220 μm, e.g., between 170 μm and 190 μm, e.g., around 180 μm. The heating element may comprise a heating track, which may extend longitudinally along the heating element. The heating track may be sandwiched between the outer layer and the core of the heating element. The heating track may comprise tungsten and/or rhenium. The heating track may have a thickness of around 20 μm.

The heating element may be located in the cavity (of the device), and may extend (e.g., along a longitudinal axis) from an internal base of the cavity towards an opening of the cavity. The length of the heating element (i.e., along the longitudinal axis of the heater) may be less than the depth of the cavity. Hence, the heating element may extend for only a portion of the length of the cavity. That is, the heating element may not extend through (or beyond) the opening of the cavity.

The heating element may be configured for insertion into an aerosol-forming article (e.g., a HT consumable) when an aerosol-forming article is received in the cavity. In that respect, a distal end (i.e., distal from a base of the heating element where it is mounted to the device) of the heating element may comprise a tapered portion, which may facilitate insertion of the heating element into the aerosol-forming article. The heating element may fully penetrate an aerosol-forming article when the aerosol-forming article is received in the cavity. That is, the entire length, or substantially the entire length, of the heating element may be received in the aerosol-forming article.

The heating element may have a length that is less than, or substantially the same as, an axial length of an aerosol-forming substrate forming part of an aerosol-forming article (e.g., a HT consumable). Thus, when such an aerosol-forming article is engaged with the device, the heating element may only penetrate the aerosol-forming substrate, rather than other components of the aerosol-forming article. The heating element may penetrate the aerosol-forming substrate for substantially the entire axial length of the aerosol forming-substrate of the aerosol-forming article. Thus, heat may be transferred from (e.g., an outer circumferential surface of) the heating element to the surrounding aerosol-forming substrate, when penetrated by the heating element. That is, heat may be transferred radially outwardly (in the case of a cylindrical heating element) or e.g., radially inwardly (in the case of a tube heater).

Where the heater is a tube heater, the heating element of the tube heater may surround at least a portion of the cavity. When the portion of the aerosol-forming article is received in the cavity, the heating element may surround a portion of the aerosol-forming article (i.e., so as to heat that portion of the aerosol-forming article). In particular, the heating element may surround an aerosol forming substrate of the aerosol-forming article. That is, when an aerosol-forming article is engaged with the device, the aerosol forming substrate of the aerosol-forming article may be located adjacent an inner surface of the (tubular) heating element. When the heating element is activated, heat may be transferred radially inwardly from the inner surface of the heating element to heat the aerosol forming substrate.

The cavity may comprise a (e.g., circumferential) wall (or walls) and the (tubular) heating element may extend around at least a portion of the wall(s). In this way, the wall may be located between the inner surface of the heating element and an outer surface of the aerosol-forming article. The wall (or walls) of the cavity may be formed from a thermally conductive material (e.g., a metal) to allow heat conduction from the heating element to the aerosol-forming article. Thus, heat may be conducted from the heating element, through the cavity wall (or walls), to the aerosol-forming substrate of an aerosol-forming article received in the cavity.

In some embodiments the device may comprise a cap disposed at the end of the body that is configured for engagement with an aerosol-forming article. Where the device comprises a heater having a heating element, the cap may at least partially enclose the heating element. The cap may be moveable between an open position in which access is provided to the heating element, and a closed position in which the cap at least partially encloses the heating element. The cap may be slideably engaged with the body of the device, and may be slideable between the open and closed positions.

The cap may define at least a portion of the cavity of the device. That is, the cavity may be fully defined by the cap, or each of the cap and body may define a portion of the cavity. The cap may comprise an opening to the cavity. The opening may be configured for receipt of at least a portion of an aerosol-forming article. That is, an aerosol-forming article may be inserted through the opening and into the cavity (so as to be engaged with the device).

The cap may be configured such that when an aerosol-forming article is engaged with the device (e.g., received in the cavity), only a portion of the aerosol-forming article is received in the cavity. That is, a portion of the aerosol-forming article (not received in the cavity) may protrude from (i.e., extend beyond) the opening. This (protruding) portion of the aerosol-forming article may be a terminal (e.g., mouth) end of the aerosol-forming article, which may be received in a user's mouth for the purpose of inhaling aerosol formed by the device.

The device may comprise a power source or may be connectable to a power source (e.g., a power source separate to the device). The power source may be electrically connectable to the heater. In that respect, altering (e.g., toggling) the electrical connection of the power source to the heater may affect a state of the heater. For example, toggling the electrical connection of the power source to the heater may toggle the heater between an on state and an off state. The power source may be a power store. For example, the power source may be a battery or rechargeable battery (e.g., a lithium ion battery).

The device may comprise an input connection (e.g., a USB port, Micro USB port, USB-C port, etc.). The input connection may be configured for connection to an external source of electrical power, such as a mains electrical supply outlet. The input connection may, in some cases, be used as a substitute for an internal power source (e.g., battery or rechargeable battery). That is, the input connection may be electrically connectable to the heater (for providing power to the heater). Hence, in some forms, the input connection may form at least part of the power source of the device.

Where the power source comprises a rechargeable power source (such as a rechargeable battery), the input connection may be used to charge and recharge the power source.

The device may comprise a user interface (UI). In some embodiments the UI may include input means to receive operative commands from the user. The input means of the UI may allow the user to control at least one aspect of the operation of the device. In some embodiments the input means may comprise a power button to switch the device between an on state and an off state.

In some embodiments the UI may additionally or alternatively comprise output means to convey information to the user. In some embodiments the output means may comprise a light to indicate a condition of the device (and/or the aerosol-forming article) to the user. The condition of the device (and/or aerosol-forming article) indicated to the user may comprise a condition indicative of the operation of the heater. For example, the condition may comprise whether the heater is in an off state or an on state. In some embodiments, the UI unit may comprise at least one of a button, a display, a touchscreen, a switch, a light, and the like. For example, the output means may comprise one or more (e.g., two, three, four, etc.) light-emitting diodes ("LEDs") that may be located on the body of the device.

The device may further comprise a puff sensor (e.g., airflow sensor), which form part of the input means of the UI. The puff sensor may be configured to detect a user drawing on an end (i.e., a terminal (mouth) end) of the aerosol-forming article. The puff sensor may, for example, be a pressure sensor or a microphone. The puff sensor may be configured to produce a signal indicative of a puff state. The signal may be indicative of the user drawing (an aerosol from the aerosol-forming article) such that it is e.g., in the form of a binary signal. Alternatively or additionally, the signal may be indicative of a characteristic of the draw (e.g., a flow rate of the draw, length of time of the draw, etc).

The device may comprise a controller, or may be connectable to a controller that may be configured to control at least one function of the device. The controller may comprise a microcontroller that may e.g., be mounted on a printed circuit board (PCB). The controller may also comprise a memory, e.g., non-volatile memory. The memory may include instructions, which, when implemented, may cause the controller to perform certain tasks or steps of a method. Where the device comprises an input connection, the controller may be connected to the input connection.

The controller may be configured to control the operation of the heater (and e.g., the heating element). Thus, the controller may be configured to control vaporization of an aerosol forming part of an aerosol-forming article engaged with the device. The controller may be configured to control the voltage applied by power source to the heater. For example, the controller may be configured to toggle between applying a full output voltage (of the power source) to the heater and applying no voltage to the heater. Alternatively or additionally, the control unit may implement a more complex heater control protocol.

The device may further comprise a voltage regulator to regulate the output voltage supplied by the power source to form a regulated voltage. The regulated voltage may subsequently be applied to the heater.

In some embodiments, where the device comprises a UI, the controller may be operatively connected to one or more components of the UI. The controller may be configured to receive command signals from an input means of the UI. The controller may be configured to control the heater in response to the command signals. For example, the controller may be configured to receive "on" and "off" command signals from the UI and, in response, may control the heater so as to be in a corresponding on or off state.

The controller may be configured to send output signals to a component of the UI. The UI may be configured to convey information to a user, via an output means, in response to such output signals (received from the controller). For example, where the device comprises one or more LEDs, the LEDs may be operatively connected to the controller. Hence, the controller may configured to control the illumination of the LEDs (e.g., in response to an output signal). For example, the controller may be configured to control the illumination of the LEDs according to (e.g., an on or off) state of the heater.

Where the device comprises a sensor (e.g., a puff/airflow sensor), the controller may be operatively connected to the sensor. The controller may be configured to receive a signal from the sensor (e.g., indicative of a condition of the device and/or engaged aerosol-forming article). The controller may be configured to control the heater, or an aspect of the output means, based on the signal from the sensor.

The device may comprise a wireless interface configured to communicate wirelessly (e.g., via Bluetooth (e.g., a Bluetooth low-energy connection) or WiFi) with an external device. Similarly, the input connection may be configured for wired connection to an external device so as to provide communication between the device and the external device.

The external device may be a mobile device. For example, the external device may be a smart phone, tablet, smart watch, or smart car. An application (e.g., app) may be installed on the external device (e.g., mobile device). The application may facilitate communication between the device and the external device via the wired or wireless connection.

The wireless or wired interface may be configured to transfer signals between the external device and the controller of the device. In this respect, the controller may control an aspect of the device in response to a signal received from an external device. Alternatively or additionally, an external device may respond to a signal received from the device (e.g., from the controller of the device).

In a second aspect of the nineteenth mode, there is provided a system (e.g., a smoking substitute system) comprising a device according to the first aspect and an HNB consumable. The HNB consumable may comprise an aerosol-forming substrate at an upstream end of the HNB consumable. The HNB consumable may be in the form of a smoking substitute article, e.g., heated tobacco (HT) consumable (also known as a heat-not-burn (HNB) consumable).

As used herein, the terms "upstream" and "downstream" are intended to refer to the flow direction of the vapor/aerosol i.e., with the downstream end of the article/consumable being the mouth end or outlet where the aerosol exits the consumable for inhalation by the user. The upstream end of the article/consumable is the opposing end to the downstream end.

The aerosol-forming substrate is capable of being heated to release at least one volatile compound that can form an aerosol. The aerosol-forming substrate may be located at the upstream end of the article/consumable.

In order to generate an aerosol, the aerosol-forming substrate comprises at least one volatile compound that is intended to be vaporized/aerosolized and that may provide the user with a recreational and/or medicinal effect when inhaled. Suitable chemical and/or physiologically active volatile compounds include the group consisting of: nicotine, cocaine, caffeine, opiates and opioids, cathine and cathinone, kavalactones, mysticin, beta-carboline alkaloids, salvinorin A together with any combinations, functional equivalents to, and/or synthetic alternatives of the foregoing.

The aerosol-forming substrate may comprise plant material. The plant material may comprise least one plant material selected from the list including *Amaranthus dubius, Arctostaphylos uva-ursi* (Bearberry), *Argemone mexicana, Amica, Artemisia vulgaris*, Yellow Tees, *Galea zacatechichi, Canavalia maritima* (Baybean), *Cecropia mexicana* (Guamura), *Cestrum noctumum, Cynoglossum virginianum* (wild comfrey), *Cytisus scoparius, Damiana, Entada rheedii, Eschscholzia califomica* (California Poppy), *Fittonia albivenis, Hippobroma longiflora, Humulus japonica* (Japanese Hops), *Humulus lupulus* (Hops), *Lactuca virosa* (Lettuce Opium), *Laggera alata, Leonotis leonurus, Leonurus cardiaca* (Motherwort), *Leonurus sibiricus* (Honeyweed), *Lobelia cardinalis, Lobelia inflata* (Indian-tobacco), *Lobelia siphilitica, Nepeta cataria* (Catnip), *Nicotiana* species (Tobacco), *Nymphaea alba* (White Lily), *Nymphaea caerulea* (Blue Lily), Opium poppy, *Passiflora incamata* (Passionflower), *Pedicularis densiflora* (Indian Warrior), *Pedicularis groenlandica* (Elehant's Head), *Salvia divinorum, Salvia dorrii* (Tobacco Sage), Salvia species (Sage), *Scutellaria galericulata, Scutellaria lateriflora, Scutellaria nana, Scutellaria* species (Skullcap), *Sida acuta* (Wireweed), *Sida rhombifolia, Silene capensis, Syzygium aromaticum* (Clove), *Tagetes lucida* (Mexican Tarragon), *Tarchonanthus camphoratus, Tumera diffusa* (Damiana), *Verbascum* (Mullein), *Zamia latifolia* (Maconha Brava) together with any combinations, functional equivalents to, and/or synthetic alternatives of the foregoing.

The plant material may be tobacco. Any type of tobacco may be used. This includes, but is not limited to, flue-cured tobacco, burley tobacco, Maryland Tobacco, dark-air cured tobacco, oriental tobacco, dark-fired tobacco, perique tobacco and rustica tobacco. This also includes blends of the above mentioned tobaccos.

The tobacco may comprise one or more of leaf tobacco, stem tobacco, tobacco powder, tobacco dust, tobacco derivatives, expanded tobacco, homogenized tobacco, shredded tobacco, extruded tobacco, cut rag tobacco and/or reconstituted tobacco (e.g., slurry recon or paper recon).

The aerosol-forming substrate may comprise a gathered sheet of homogenized (e.g., paper/slurry recon) tobacco or gathered shreds/strips formed from such a sheet.

The aerosol-forming substrate may comprise one or more additives selected from humectants, flavorants, fillers, aqueous/non-aqueous solvents and binders.

The flavorant may be provided in solid or liquid form. It may include menthol, licorice, chocolate, fruit flavor (including e.g., citrus, cherry etc.), vanilla, spice (e.g., ginger, cinnamon) and tobacco flavor. The flavorant may be evenly dispersed throughout the aerosol-forming substrate or may be provided in isolated locations and/or varying concentrations throughout the aerosol-forming substrate.

The aerosol-forming substrate may be formed in a substantially cylindrical shape such that the article/consumable resembles a conventional cigarette. It may have a diameter of between 5 and 10 mm e.g., between 6 and 9 mm or 6 and 8 mm e.g., around 7 mm. It may have an axial length of between 10 and 15 mm e.g., between 11 and 14 mm such as around 12 or 13 mm.

The article/consumable may comprise at least one filter element. There may be a terminal filter element at the downstream/mouth end of the article/consumable.

The or at least one of the filter element(s) (e.g., the terminal filter element) may be comprised of cellulose acetate or polypropylene tow. The at least one filter element (e.g., the terminal filter element) may be comprised of activated charcoal. The at least one filter element (e.g., the terminal element) may be comprised of paper. The or each filter element may be at least partly (e.g., entirely) circumscribed with a plug wrap e.g., a paper plug wrap.

The terminal filter element (at the downstream end of the article/consumable) may be joined to the upstream elements forming the article/consumable by a circumscribing tipping layer e.g., a tipping paper layer. The tipping paper may have an axial length longer than the axial length of the terminal filter element such that the tipping paper completely circumscribes the terminal filter element plus the wrapping layer surrounding any adjacent upstream element.

In some embodiments, the article/consumable may comprise an aerosol-cooling element which is adapted to cool the aerosol generated from the aerosol-forming substrate (by heat exchange) before being inhaled by the user.

The article/consumable may comprise a spacer element that defines a space or cavity between the aerosol-forming substrate and the downstream end of the consumable. The spacer element may comprise a cardboard tube. The spacer element may be circumscribed by the (paper) wrapping layer.

According to a third aspect of the present disclosure, there is provided a method of using the system according to the system for smoking substitute device, the method comprising inserting the HNB consumable into the device; and heating the HNB consumable using the heater of the device.

In some embodiments the method may comprise inserting the HNB consumable into a cavity within a body of the device and penetrating the HNB consumable with the heating element of the device upon insertion of the HNB consumable.

The nineteenth mode of the disclosure includes the combination of the aspects and preferred features described except where such a combination is clearly impermissible or expressly avoided.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

Twentieth Mode of the Disclosure: A Smoking Substitute Device Having a Specially Shaped Heater Apparatus At its most general, the twentieth mode of the present disclosure relates to a smoking substitute device having a specially shaped heater apparatus.

According to a first aspect of the twentieth mode of the present disclosure, there is provided a heater apparatus for a heat not burn smoking substitute device, the heater apparatus comprising a rod including a heater element and having a substantially cylindrical shape and a tip component located at a distal end of the rod, wherein the tip component has a height and a width, and wherein the height of the tip component is larger than the width the tip component.

According to a second aspect of the twentieth mode of the present disclosure, there is provided a heat not burn smoking substitute device including such a heater apparatus.

By providing a heater apparatus comprising a tip component located where the height of the tip component is larger than the width the tip component, the heater apparatus may facilitate the insertion of a smoking substitute consumable into a smoking substitute device comprising a heater apparatus according to the present disclosure. Further hereto, upon insertion of the heater element into the consumable, in particular the rod with its tip component, the article may be penetrated, in particular at least partially penetrated into a filter element of the article, so that the heater element is arranged in contact with an aerosol forming part of the article.

In other words, the tip component may penetrate into the filter portion of a heat not burn consumable downstream of the tobacco section of the article. Therefore, the flow through the consumable may be improved, thereby potentially resulting in a better user experience when using the heat not burn device. Further, an at least partly penetrated filter may improve the properties in use of the heat not burn device, in particular improve properties related to a total particulate matter (tpm) level in the aerosol of the consumable in use received by a user. This, too, results in an improved user experience.

The tip may penetrate into the filter portion partly or completely. In particular, the heater with the tip component and at least part of the rod may penetrate the filter portion. In case the consumable comprises multiple successive or spaced apart filter portions, the tip component and or the rod pay penetrate one filter portion completely and may penetrate a further filter portion at least partly or also completely.

Optional features will now be set out. These are applicable singly or in any combination with any aspect.

Optionally, the tip component is conical in shape.

Advantageously, the height of the tip component is at least 1.05 times the width of the tip component, in particular at least 1.1 times the width of the tip component, further in particular at least 1.15 times the width of the tip component, further in particular at least 1.2 times the width of the tip component, further in particular at least 1.25 times the width of the tip component, further in particular at least 1.3 times the width of the tip component, further in particular at least 1.35 times the width of the tip component, further in particular at least 1.4 times the width of the tip component, further in particular at least 1.45 times the width of the tip component, further in particular at least 1.5 times the width of the tip component, further in particular larger than 1.5 times the width of the tip component.

Conveniently, the width of the tip component is between 0.1 mm and 5 mm, in particular between 0.5 mm and 4 mm, in particular between 0.75 mm and 3.5 mm, in particular between 1 mm and 3 mm, in particular between 1.5 mm and 2.5 mm, in particular substantially 2 mm; and wherein the height of the tip component is larger than 2 mm, in particular larger than 2.1 mm, in particular larger than 2.2 mm, in particular larger than 2.3 mm, in particular larger than 2.4 mm, in particular larger than 2.5 mm, in particular larger than 2.6 mm, in particular larger than 2.7 mm, in particular larger than 2.8 mm, in particular larger than 2.9 mm, in particular larger than 3 mm, in particular larger than 3.5 mm, in particular larger than 4 mm, in particular larger than 4.5 mm, in particular larger than 5 mm.

Optionally, the tip component is separate from the rod.

By providing a tip component separate from the rod, the tip component may be provided using a different material than the rod. E.g. the rod may be optimized for distribution of heat while the tip component may be optimized for insertion into the consumable. For example, the tip component may be made of a hard material, particularly harder than the rod, so to withstand forces occurring during insertion. The tip component may or may not be made of a material with particularly beneficial heat conductive properties. Providing the tip component separate from the rod may facilitate manufacture of the heater element in that the rod and the tip component may be manufactured separately, in particular employing manufacturing methods optimized for each of the elements, respectively.

Providing the tip component as a separate element may allow that the tip component is embodied a distinct component separate from the rod, which is provided and/or is attached to the rod during manufacture. In other words, the tip component and the rod may be manufactured independently from one another and may only subsequently, during final assembly of the heater element, be connected to one another, e.g., by soldering, or welding, in particular friction welding.

Advantageously, the rod is one of circular and oval in cross-section.

By providing a rod that is oval shaped may increase the surface, in particular the heated surface, that is in contact between the rod and a consumable, in particular tobacco material comprised in the aerosol forming substrate of a consumable. An increased surface contact may provide a preferred heat transfer from the heater element to the consumable.

Conveniently, the tip component is adapted for insertion into a consumable for a heat not burn smoking device.

Optionally, the heater element comprises a resistive heater track.

Advantageously, the resistive heater track is located on the rod.

The device may comprise an elongate body. An end of the elongate body may be configured for engagement with an aerosol-forming article. For example, the body may be configured for engagement with a heated tobacco (HT) consumable (or heat-not-burn (HNB) consumable). The terms "heated tobacco" and "heat-not-burn" are used interchangeably herein to describe a consumable that is of the type that is heated rather than combusted (or are used interchangeably to describe a device for use with such a consumable). The device may comprise a cavity that is configured for receipt of at least a portion of the consumable (i.e., for engagement with the consumable). The aerosol-forming article may be of the type that comprises an aerosol former (e.g., carried by an aerosol-forming substrate).

The device may comprise a heater for heating the aerosol-forming article. The heater may comprise a heating element, which may be in the form of a rod that extends from the body of the device. The heating element may extend from the end of the body that is configured for engagement with the aerosol-forming article.

The heater (and thus the heating element) may be rigidly mounted to the body. The heating element may be elongate so as to define a longitudinal axis and may, for example, have a transverse profile (i.e., transverse to a longitudinal axis of the heating element) that is substantially circular (i.e., the heating element may be generally cylindrical). Alternatively, the heating element may have a transverse profile that is rectangular (i.e., the heater may be a "blade heater"). The heating element may alternatively be in the shape of a tube (i.e., the heater may be a "tube heater"). The heating element may take other forms (e.g., the heating element may have an elliptical transverse profile). The shape and/or size (e.g., diameter) of the transverse profile of the heating element may be generally consistent for the entire length (or substantially the entire length) of the heating element.

The heating element may be between 15 mm and 25 mm long, e.g., between 18 mm and 20 mm long, e.g., around 19 mm long. The heating element may have a diameter of between 1.5 mm and 2.5 mm, e.g., a diameter between 2 mm and 2.3 mm, e.g., a diameter of around 2.15 mm.

The heating element may be formed of ceramic. The heating element may comprise a core (e.g., a ceramic core) comprising Al2O3. The core of the heating element may have a diameter of 1.8 mm to 2.1 mm, e.g., between 1.9 mm and 2 mm. The heating element may comprise an outer layer (e.g., an outer ceramic layer) comprising Al2O3. The thickness of the outer layer may be between 160 μm and 220 μm, e.g., between 170 μm and 190 μm, e.g., around 180 μm. The heating element may comprise a heating track, which may extend longitudinally along the heating element. The heating track may be sandwiched between the outer layer and the core of the heating element. The heating track may comprise tungsten and/or rhenium. The heating track may have a thickness of around 20 μm.

The heating element may be located in the cavity (of the device), and may extend (e.g., along a longitudinal axis) from an internal base of the cavity towards an opening of the cavity. The length of the heating element (i.e., along the longitudinal axis of the heater) may be less than the depth of the cavity. Hence, the heating element may extend for only a portion of the length of the cavity. That is, the heating element may not extend through (or beyond) the opening of the cavity.

The heating element may be configured for insertion into an aerosol-forming article (e.g., a HT consumable) when an aerosol-forming article is received in the cavity. In that respect, a distal end (i.e., distal from a base of the heating element where it is mounted to the device) of the heating element may comprise a tapered portion, which may facilitate insertion of the heating element into the aerosol-forming article. The heating element may fully penetrate an aerosol-forming article when the aerosol-forming article is received in the cavity. That is, the entire length, or substantially the entire length, of the heating element may be received in the aerosol-forming article.

The heating element may have a length that is less than, or substantially the same as, an axial length of an aerosol-forming substrate forming part of an aerosol-forming article (e.g., a HT consumable). Thus, when such an aerosol-forming article is engaged with the device, the heating element may only penetrate the aerosol-forming substrate, rather than other components of the aerosol-forming article. The heating element may penetrate the aerosol-forming substrate for substantially the entire axial length of the aerosol forming-substrate of the aerosol-forming article. Thus, heat may be transferred from (e.g., an outer circumferential surface of) the heating element to the surrounding aerosol-forming substrate, when penetrated by the heating element. That is, heat may be transferred radially outwardly (in the case of a cylindrical heating element) or e.g., radially inwardly (in the case of a tube heater).

Where the heater is a tube heater, the heating element of the tube heater may surround at least a portion of the cavity. When the portion of the aerosol-forming article is received in the cavity, the heating element may surround a portion of the aerosol-forming article (i.e., so as to heat that portion of the aerosol-forming article). In particular, the heating element may surround an aerosol forming substrate of the aerosol-forming article. That is, when an aerosol-forming article is engaged with the device, the aerosol forming substrate of the aerosol-forming article may be located adjacent an inner surface of the (tubular) heating element. When the heating element is activated, heat may be transferred radially inwardly from the inner surface of the heating element to heat the aerosol forming substrate.

The cavity may comprise a (e.g., circumferential) wall (or walls) and the (tubular) heating element may extend around at least a portion of the wall(s). In this way, the wall may be located between the inner surface of the heating element and an outer surface of the aerosol-forming article. The wall (or walls) of the cavity may be formed from a thermally conductive material (e.g., a metal) to allow heat conduction from the heating element to the aerosol-forming article. Thus, heat may be conducted from the heating element, through the cavity wall (or walls), to the aerosol-forming substrate of an aerosol-forming article received in the cavity.

In some embodiments the device may comprise a cap disposed at the end of the body that is configured for engagement with an aerosol-forming article. Where the device comprises a heater having a heating element, the cap may at least partially enclose the heating element. The cap may be moveable between an open position in which access is provided to the heating element, and a closed position in which the cap at least partially encloses the heating element. The cap may be slideably engaged with the body of the device, and may be slideable between the open and closed positions.

The cap may define at least a portion of the cavity of the device. That is, the cavity may be fully defined by the cap, or each of the cap and body may define a portion of the cavity. Where the cap fully defines the cavity, the cap may comprise an aperture for receipt of the heating element into the cavity (when the cap is in the closed position). The cap may comprise an opening to the cavity. The opening may be configured for receipt of at least a portion of an aerosol-forming article. That is, an aerosol-forming article may be inserted through the opening and into the cavity (so as to be engaged with the device).

The cap may be configured such that when an aerosol-forming article is engaged with the device (e.g., received in the cavity), only a portion of the aerosol-forming article is received in the cavity. That is, a portion of the aerosol-forming article (not received in the cavity) may protrude from (i.e., extend beyond) the opening. This (protruding) portion of the aerosol-forming article may be a terminal (e.g., mouth) end of the aerosol-forming article, which may be received in a user's mouth for the purpose of inhaling aerosol formed by the device.

The device may comprise a power source or may be connectable to a power source (e.g., a power source separate to the device). The power source may be electrically connectable to the heater. In that respect, altering (e.g., toggling) the electrical connection of the power source to the heater may affect a state of the heater. For example, toggling the electrical connection of the power source to the heater may toggle the heater between an on state and an off state. The power source may be a power store. For example, the power source may be a battery or rechargeable battery (e.g., a lithium ion battery).

The device may comprise an input connection (e.g., a USB port, Micro USB port, USB-C port, etc.). The input connection may be configured for connection to an external source of electrical power, such as a mains electrical supply outlet. The input connection may, in some cases, be used as a substitute for an internal power source (e.g., battery or rechargeable battery). That is, the input connection may be electrically connectable to the heater (for providing power to the heater). Hence, in some forms, the input connection may form at least part of the power source of the device.

Where the power source comprises a rechargeable power source (such as a rechargeable battery), the input connection may be used to charge and recharge the power source.

The device may comprise a user interface (UI). In some embodiments the UI may include input means to receive operative commands from the user. The input means of the UI may allow the user to control at least one aspect of the operation of the device. In some embodiments the input means may comprise a power button to switch the device between an on state and an off state.

In some embodiments the UI may additionally or alternatively comprise output means to convey information to the user. In some embodiments the output means may comprise a light to indicate a condition of the device (and/or the aerosol-forming article) to the user. The condition of the device (and/or aerosol-forming article) indicated to the user may comprise a condition indicative of the operation of the heater. For example, the condition may comprise whether the heater is in an off state or an on state. In some embodiments, the UI unit may comprise at least one of a button, a display, a touchscreen, a switch, a light, and the like. For example, the output means may comprise one or more (e.g., two, three, four, etc.) light-emitting diodes ("LEDs") that may be located on the body of the device.

The device may further comprise a puff sensor (e.g., airflow sensor), which form part of the input means of the UI. The puff sensor may be configured to detect a user drawing on an end (i.e., a terminal (mouth) end) of the aerosol-forming article. The puff sensor may, for example, be a pressure sensor or a microphone. The puff sensor may be configured to produce a signal indicative of a puff state. The signal may be indicative of the user drawing (an aerosol from the aerosol-forming article) such that it is e.g., in the form of a binary signal. Alternatively or additionally, the signal may be indicative of a characteristic of the draw (e.g., a flow rate of the draw, length of time of the draw, etc.).

The device may comprise a controller, or may be connectable to a controller that may be configured to control at least one function of the device. The controller may comprise a microcontroller that may e.g. be mounted on a printed circuit board (PCB). The controller may also comprise a memory, e.g., non-volatile memory. The memory may include instructions, which, when implemented, may cause the controller to perform certain tasks or steps of a method. Where the device comprises an input connection, the controller may be connected to the input connection.

The controller may be configured to control the operation of the heater (and e.g., the heating element). Thus, the controller may be configured to control vaporization of an aerosol forming part of an aerosol-forming article engaged with the device. The controller may be configured to control the voltage applied by power source to the heater. For example, the controller may be configured to toggle between applying a full output voltage (of the power source) to the heater and applying no voltage to the heater. Alternatively or additionally, the control unit may implement a more complex heater control protocol.

The device may further comprise a voltage regulator to regulate the output voltage supplied by the power source to form a regulated voltage. The regulated voltage may subsequently be applied to the heater.

In some embodiments, where the device comprises a UI, the controller may be operatively connected to one or more components of the UI. The controller may be configured to receive command signals from an input means of the UI. The controller may be configured to control the heater in response to the command signals. For example, the controller may be configured to receive "on" and "off" command signals from the UI and, in response, may control the heater so as to be in a corresponding on or off state.

The controller may be configured to send output signals to a component of the UI. The UI may be configured to convey information to a user, via an output means, in response to such output signals (received from the controller). For example, where the device comprises one or more LEDs, the LEDs may be operatively connected to the controller. Hence, the controller may configured to control the illumination of the LEDs (e.g., in response to an output signal). For example, the controller may be configured to control the illumination of the LEDs according to (e.g., an on or off) state of the heater.

Where the device comprises a sensor (e.g., a puff/airflow sensor), the controller may be operatively connected to the sensor. The controller may be configured to receive a signal from the sensor (e.g. indicative of a condition of the device and/or engaged aerosol-forming article). The controller may be configured to control the heater, or an aspect of the output means, based on the signal from the sensor.

The device may comprise a wireless interface configured to communicate wirelessly (e.g., via Bluetooth (e.g., a Bluetooth low-energy connection) or WiFi) with an external device. Similarly, the input connection may be configured for wired connection to an external device so as to provide communication between the device and the external device.

The external device may be a mobile device. For example, the external device may be a smart phone, tablet, smart watch, or smart car. An application (e.g., app) may be installed on the external device (e.g., mobile device). The application may facilitate communication between the device and the external device via the wired or wireless connection.

The wireless or wired interface may be configured to transfer signals between the external device and the controller of the device. In this respect, the controller may control an aspect of the device in response to a signal received from an external device. Alternatively or additionally, an external device may respond to a signal received from the device (e.g., from the controller of the device).

In a third aspect of the, there is provided a system (e.g., a smoking substitute system) comprising a device according to the second aspect and an aerosol-forming article. The aerosol-forming article may comprise an aerosol-forming substrate at an upstream end of the aerosol-forming article. The article may be in the form of a smoking substitute article, e.g., heated tobacco (HT) consumable (also known as a heat-not-burn (HNB) consumable). The article may in particular be adapted for insertion into the device, e.g., a heat not burn device. Upon insertion, the heater element, in particular the rod with its tip component, may penetrate at least part of the article so that the heater element is arranged in contact with an aerosol forming part of the article when inserted.

In other words, the tip component may penetrate into the filter portion of the consumable downstream of the tobacco section. Therefore, the flow through the consumable may be improved, resulting in a better user experience when using the heat not burn device. Further, an at least partly penetrated filter may improve the properties in use of the heat not burn device, in particular improve properties related to a total particulate matter level in the aerosol of the consumable in use received by a user. This, too, results in an improved user experience.

The tip may penetrate into the filter portion partly or completely. In particular, the heater with the tip component and at least part of the rod may penetrate the filter portion. In case the consumable comprises multiple successive or spaced apart filter portions, the tip component and or the rod pay penetrate one filter portion completely and may penetrate a further filter portion at least partly or also completely.

E.g. in case where the rod/the base of the tip component has the described diameter of between 0.1 mm and 5 mm, in particular between 0.5 mm and 4 mm, in particular between 0.75 mm and 3.5 mm, in particular between 1 mm and 3 mm, in particular between 1.5 mm and 2.5 mm, in particular substantially 2 mm, and the tip has a height of larger than 2 mm, in particular larger than 2.1 mm, in particular larger than 2.2 mm, in particular larger than 2.3 mm, in particular larger than 2.4 mm, in particular larger than 2.5 mm, in particular larger than 2.6 mm, in particular larger than 2.7 mm, in particular larger than 2.8 mm, in particular larger than 2.9 mm, in particular larger than 3 mm, in particular larger than 3.5 mm, in particular larger than 4 mm, in particular larger than 4.5 mm, in particular larger than 5 mm, the tip may penetrate at least one filter portion partly or completely. E.g. the tip component may penetrate the filter portion, either in depth into the filter portion or in diameter of the filter portion, to about 0.2 mm, in particular more than 0.2 mm, further in particular more than 0.3 mm, further in particular more than 0.35 mm, further in particular more than 0.4 mm, further in particular more than 0.5 mm, further in particular more than 0.6 mm, further in particular more than 0.6 mm, further in particular more than 0.8 mm, further in particular more than 0.8 mm, further in particular more than 1 mm, further in particular more than 1.1 mm, further in particular more than 1.2 mm, further in particular more than 1.3 mm, further in particular more than 1.4 mm, further in particular more than 1.5 mm, further in particular more than 1.6 mm, further in particular more than 1.7 mm, further in particular more than 1.8 mm, further in particular more than 1.9 mm, further in particular more than 2.0 mm, further in particular more than 2.1 mm, further in particular more than 2.2 mm, further in particular more than 2.3 mm, further in particular more than 2.4 mm, further in particular more than 2.5 mm, further in particular more than 2.6 mm, further in particular more than 2.7 mm, further in particular more than 2.8 mm, further in particular more than 2.9 mm, further in particular more than 3.0 mm, further in particular more than 3.2 mm, further in particular more than 3.4 mm, further in particular more than 3.6 mm, further in particular more than 3.8 mm, further in particular more than 4.0 mm, further in particular more than 4.2 mm, further in particular more than 4.4 mm, further in particular more than 4.6 mm, further in particular more than 4.8 mm, further in particular more than 5 mm. In case the tip component height is smaller than the penetration depth, this is to be understood that also the rod is at least partly penetrating into the at least one filter portion.

In particular where the consumable is about 7 mm in diameter, the tip component may penetrate the consumable to about a diameter of 2 mm and a depth of 2 mm or more, as described above.

As used herein, the terms "upstream" and "downstream" are intended to refer to the flow direction of the vapor/aerosol i.e., with the downstream end of the article/consumable being the mouth end or outlet where the aerosol exits the consumable for inhalation by the user. The upstream end of the article/consumable is the opposing end to the downstream end.

The aerosol-forming substrate is capable of being heated to release at least one volatile compound that can form an aerosol. The aerosol-forming substrate may be located at the upstream end of the article/consumable.

Optionally, the article comprises at least an aerosol forming substrate and a filter element, and, when inserted into the heat not burn device, the rod is arranged in the article and contacting at least the aerosol forming substrate of the article.

Advantageously, with the article inserted into the heat not burn device, the rod is arranged in the article and further contacting the filter element of the article, in particular at least partially penetrating the filter element.

In order to generate an aerosol, the aerosol-forming substrate comprises at least one volatile compound that is intended to be vaporized/aerosolized and that may provide the user with a recreational and/or medicinal effect when inhaled. Suitable chemical and/or physiologically active volatile compounds include the group consisting of: nicotine, cocaine, caffeine, opiates and opioids, cathine and cathinone, kavalactones, mysticin, beta-carboline alkaloids, salvinorin A together with any combinations, functional equivalents to, and/or synthetic alternatives of the foregoing.

The aerosol-forming substrate may comprise plant material. The plant material may comprise least one plant material selected from the list including *Amaranthus dubius, Arctostaphylos uva-ursi* (Bearberry), *Argemone mexicana, Amica, Artemisia vulgaris*, Yellow Tees, *Galea zacatechichi, Canavalia maritima* (Baybean), *Cecropia mexicana* (Guamura), *Cestrum noctumum, Cynoglossum virginianum* (wild comfrey), *Cytisus scoparius, Damiana, Entada rheedii, Eschscholzia califomica* (California Poppy), *Fittonia albivenis, Hippobroma longiflora, Humulus japonica* (Japanese Hops), *Humulus lupulus* (Hops), *Lactuca virosa* (Lettuce Opium), *Laggera alata, Leonotis leonurus, Leonurus cardiaca* (Motherwort), *Leonurus sibiricus* (Honeyweed), *Lobelia cardinalis, Lobelia inflata* (Indian-tobacco), *Lobelia siphilitica, Nepeta cataria* (Catnip), *Nicotiana* species (Tobacco), *Nymphaea alba* (White Lily), *Nymphaea caerulea* (Blue Lily), Opium poppy, *Passiflora incamata* (Passionflower), *Pedicularis densiflora* (Indian Warrior), *Pedicularis groenlandica* (Elehant's Head), *Salvia divinorum, Salvia dorrii* (Tobacco Sage), Salvia species (Sage), *Scutellaria galericulata, Scutellaria lateriflora, Scutellaria nana, Scutellaria* species (Skullcap), *Sida acuta* (Wireweed), *Sida rhombifolia, Silene capensis, Syzygium aromaticum* (Clove), *Tagetes lucida* (Mexican Tarragon), *Tarchonanthus camphoratus, Tumera diffusa* (Damiana), *Verbascum* (Mullein), *Zamia latifolia* (Maconha Brava) together with any combinations, functional equivalents to, and/or synthetic alternatives of the foregoing.

The plant material may be tobacco. Any type of tobacco may be used. This includes, but is not limited to, flue-cured tobacco, burley tobacco, Maryland Tobacco, dark-air cured tobacco, oriental tobacco, dark-fired tobacco, perique tobacco and rustica tobacco. This also includes blends of the above mentioned tobaccos.

The tobacco may comprise one or more of leaf tobacco, stem tobacco, tobacco powder, tobacco dust, tobacco derivatives, expanded tobacco, homogenized tobacco, shredded tobacco, extruded tobacco, cut rag tobacco and/or reconstituted tobacco (e.g., slurry recon or paper recon).

The aerosol-forming substrate may comprise a gathered sheet of homogenized (e.g., paper/slurry recon) tobacco or gathered shreds/strips formed from such a sheet.

The aerosol-forming substrate may comprise one or more additives selected from humectants, flavorants, fillers, aqueous/non-aqueous solvents and binders.

The flavorant may be provided in solid or liquid form. It may include menthol, licorice, chocolate, fruit flavor (including e.g., citrus, cherry etc.), vanilla, spice (e.g., ginger, cinnamon) and tobacco flavor. The flavorant may be evenly dispersed throughout the aerosol-forming substrate or may be provided in isolated locations and/or varying concentrations throughout the aerosol-forming substrate.

The aerosol-forming substrate may be formed in a substantially cylindrical shape such that the article/consumable resembles a conventional cigarette. It may have a diameter of between 5 and 10 mm e.g., between 6 and 9 mm or 6 and 8 mm e.g., around 7 mm. It may have an axial length of between 10 and 15 mm e.g., between 11 and 14 mm such as around 12 or 13 mm.

The article/consumable may comprise at least one filter element. There may be a terminal filter element at the downstream/mouth end of the article/consumable.

The or at least one of the filter element(s) (e.g., the terminal filter element) may be comprised of cellulose acetate or polypropylene tow. The at least one filter element (e.g., the terminal filter element) may be comprised of activated charcoal. The at least one filter element (e.g., the terminal element) may be comprised of paper. The or each filter element may be at least partly (e.g., entirely) circumscribed with a plug wrap e.g., a paper plug wrap.

The terminal filter element (at the downstream end of the article/consumable) may be joined to the upstream elements forming the article/consumable by a circumscribing tipping layer e.g., a tipping paper layer. The tipping paper may have an axial length longer than the axial length of the terminal filter element such that the tipping paper completely circumscribes the terminal filter element plus the wrapping layer surrounding any adjacent upstream element.

In some embodiments, the article/consumable may comprise an aerosol-cooling element which is adapted to cool the aerosol generated from the aerosol-forming substrate (by heat exchange) before being inhaled by the user.

The article/consumable may comprise a spacer element that defines a space or cavity between the aerosol-forming substrate and the downstream end of the consumable. The spacer element may comprise a cardboard tube. The spacer element may be circumscribed by the (paper) wrapping layer.

According to the fourth aspect of the twentieth mode of the present disclosure, there is provided a method of using the system according to the third aspect, the method comprising inserting the aerosol-forming article into the device; and heating the article using the heater of the device.

In some embodiments the method may comprise inserting the article into a cavity within a body of the device and penetrating the article with the heating element of the device upon insertion of the article.

According to a fourth aspect of the twentieth mode of the present disclosure, there is provided a method of using the present system, e.g., a smoking substitute system as described, the method comprising inserting the article into the device and heating the article using the heater apparatus of the device.

Optionally, the method comprises inserting the article into a cavity within a body of the device and penetrating the article with the rod upon insertion of the article, in particular at least partially penetrating the filter element of the article with the tip component and/or the rod.

The twentieth mode of the disclosure includes the combination of the aspects and preferred features described except where such a combination is clearly impermissible or expressly avoided.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

SUMMARY OF THE FIGURES

So that the disclosure may be understood, and so that further aspects and features thereof may be appreciated, embodiments [and experiments] illustrating the principles of the disclosure will now be discussed in further detail with reference to the accompanying figures, in which:

FIG. 49A is a schematic of a smoking substitute system;

FIG. 49B is a schematic of a variation of the smoking substitute system of FIG. 49A;

FIG. 50A is a front view of a first embodiment of a sixteenth mode of a smoking substitute system with the consumable engaged with the device;

FIG. 50B is a front view of the first embodiment of the smoking substitute system with the consumable disengaged from the device;

FIG. 50C is a section view of the consumable of the first embodiment of the smoking substitute system;

FIG. 50D is a detailed view of an end of the device of the first embodiment of the smoking substitute system;

FIG. 50E is a section view of the first embodiment of the substitute smoking system.

FIG. 51A is a schematic of a smoking substitute system;

FIG. 51B is a schematic of a variation of the smoking substitute system of FIG. 51A;

FIG. 52A is a front view of a first embodiment of a seventeenth mode of a smoking substitute system with the consumable engaged with the device;

FIG. 52B is a front view of the first embodiment of the smoking substitute system with the consumable disengaged from the device;

FIG. 52C is a section view of the consumable of the first embodiment of the smoking substitute system;

Figure 52B:
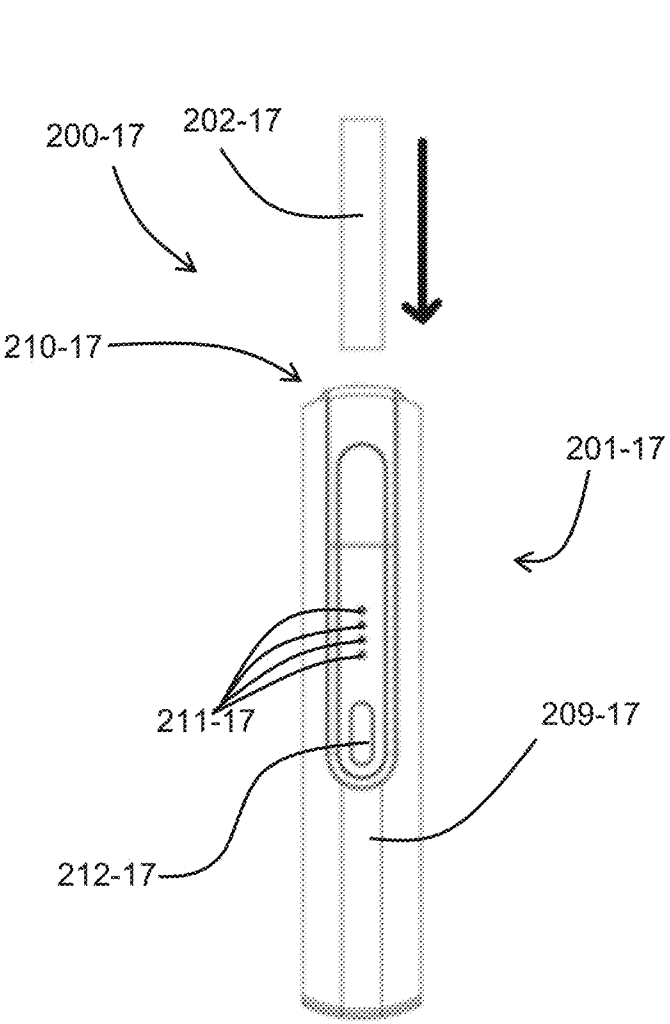
Figure 52A:
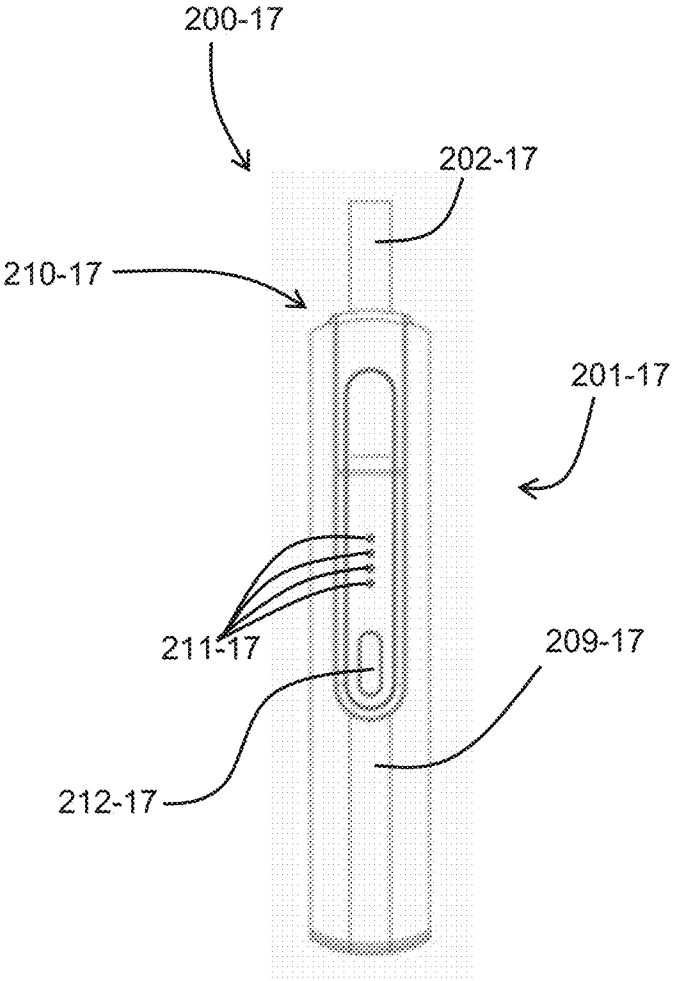
Figure 52C:
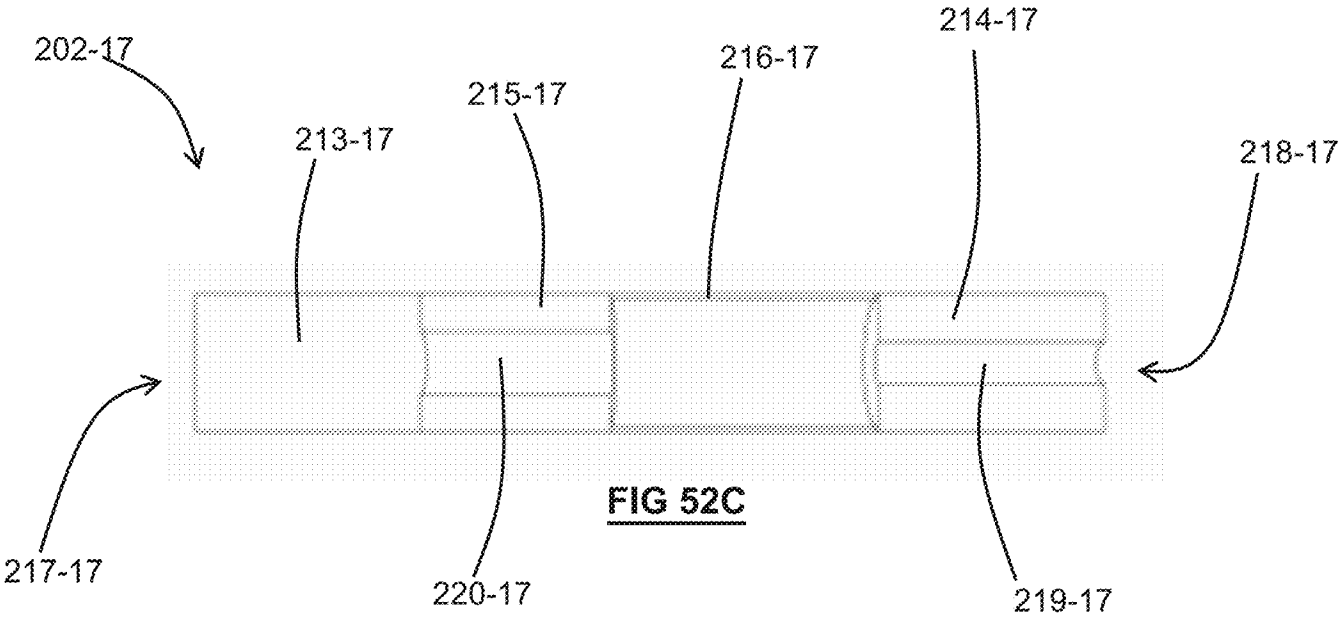
Figure 52E:
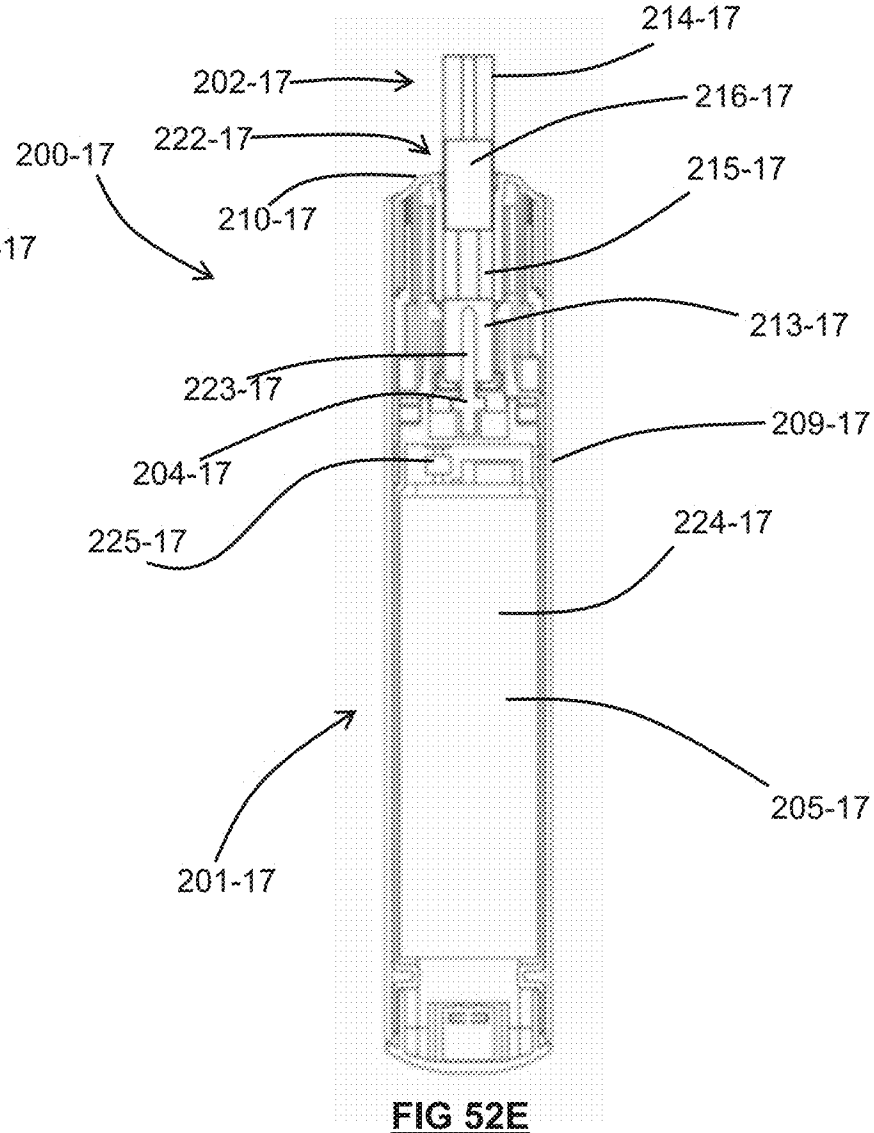
Figure 52D:
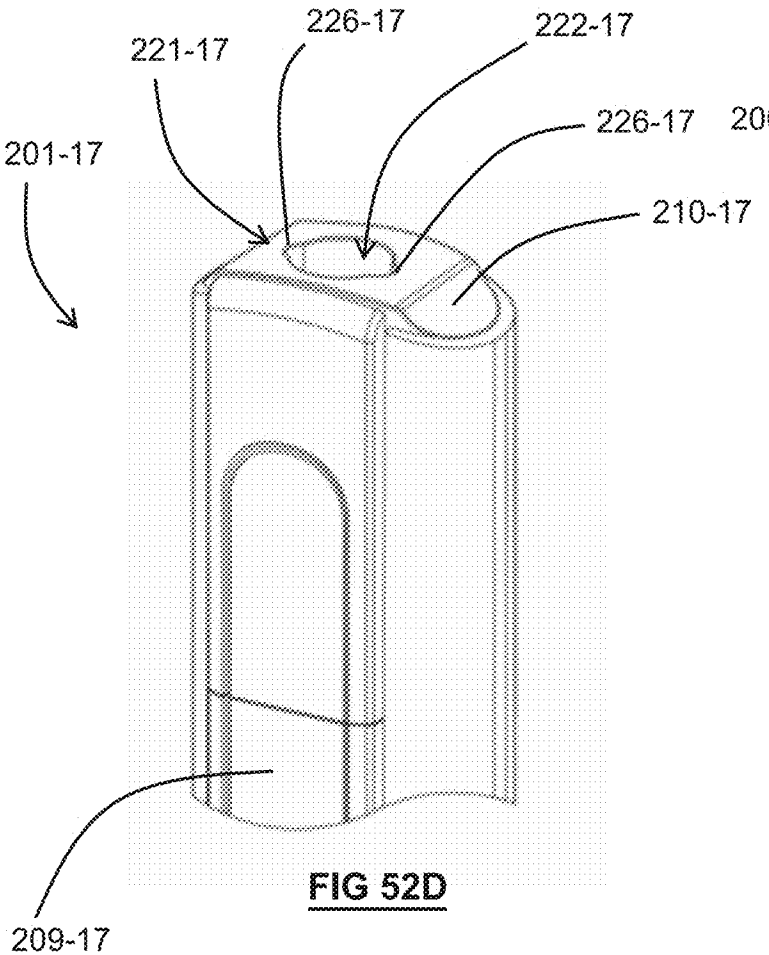
Figure 53:
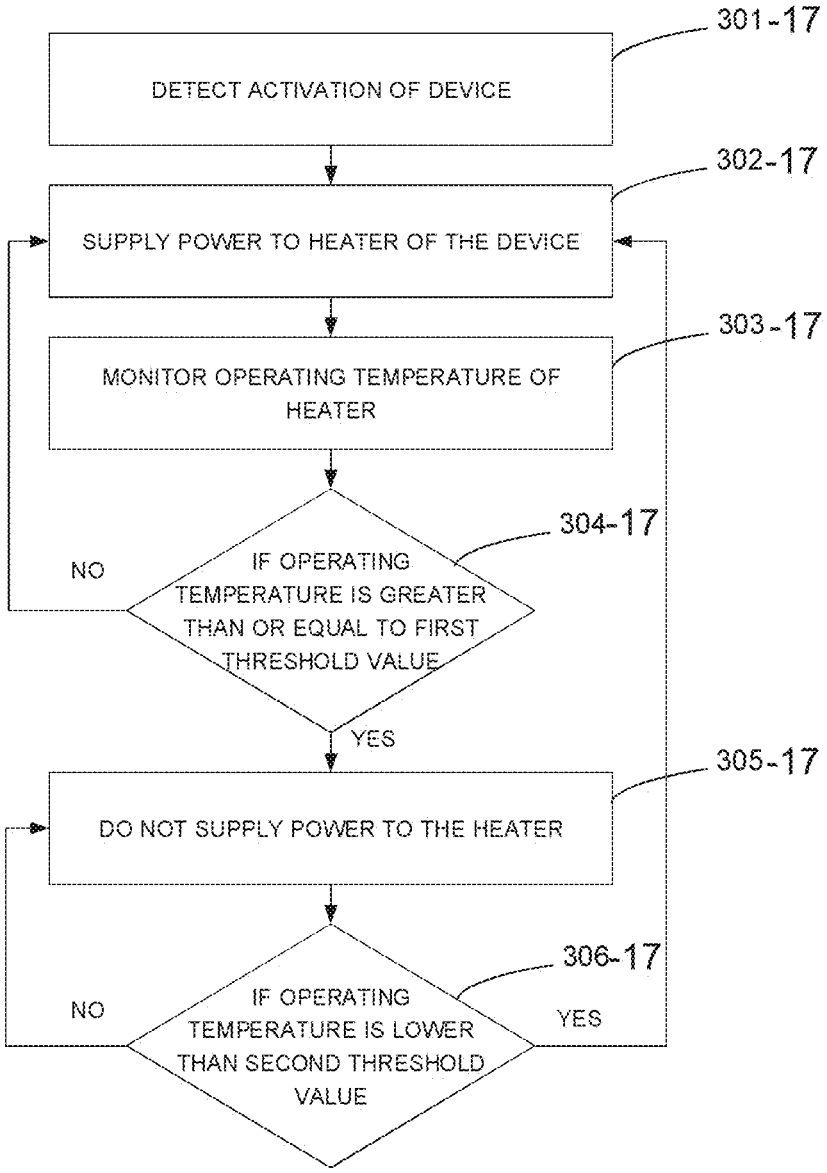

FIG. 52D is a detailed view of an end of the device of the first embodiment of the smoking substitute system;

FIG. 52E is a section view of the first embodiment of the substitute smoking system; and FIG. 53 is a flow chart showing steps of controlling power supply to the heater.

Figure 54A:
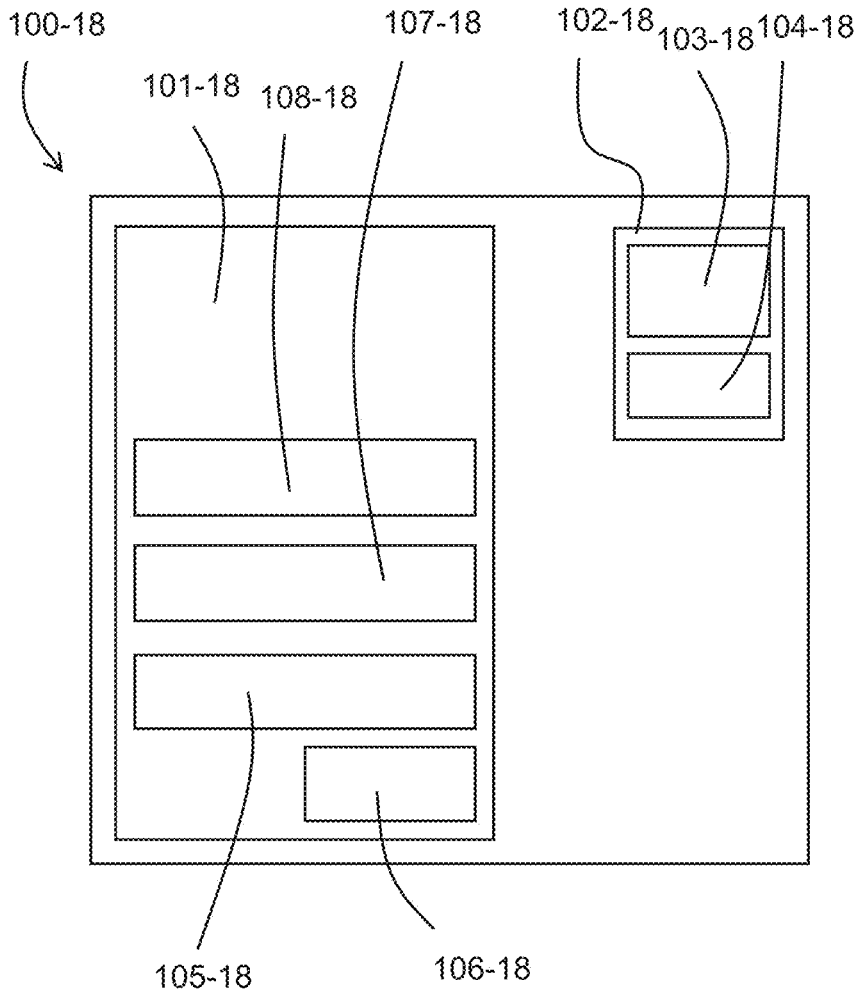
Figure 54B:
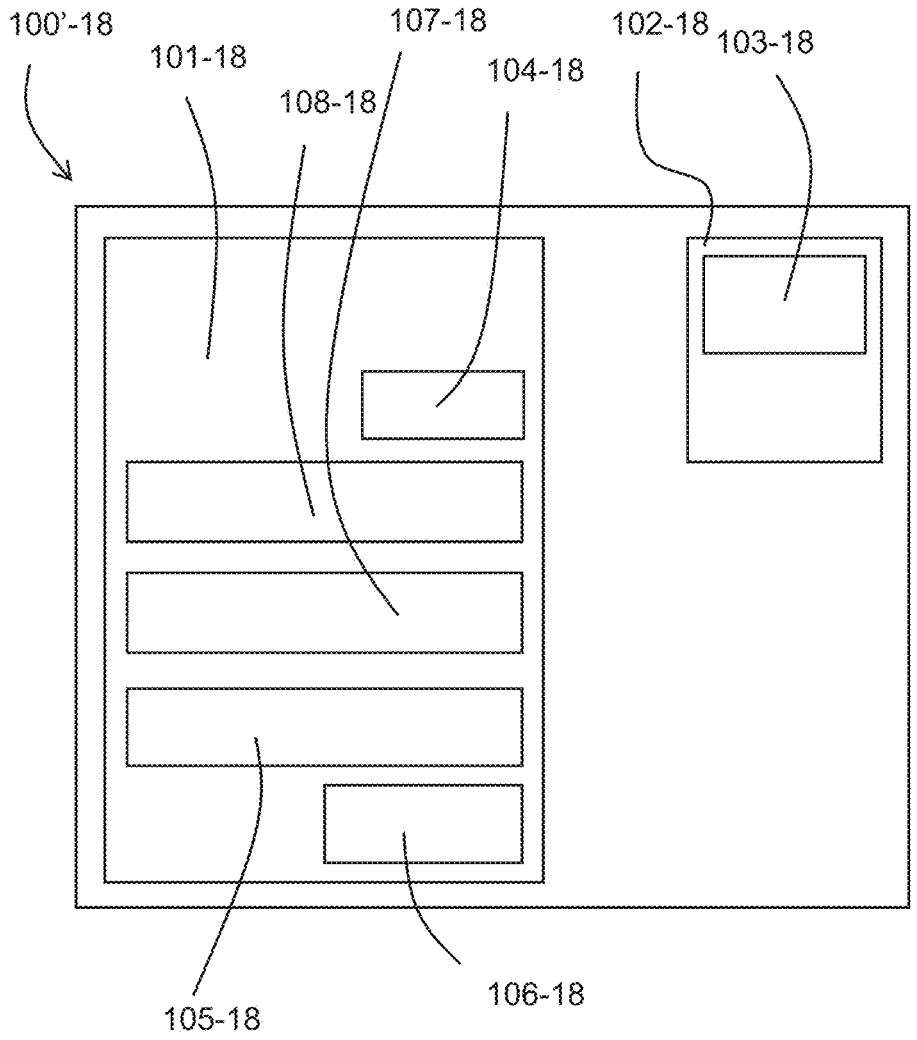
Figure 55A:
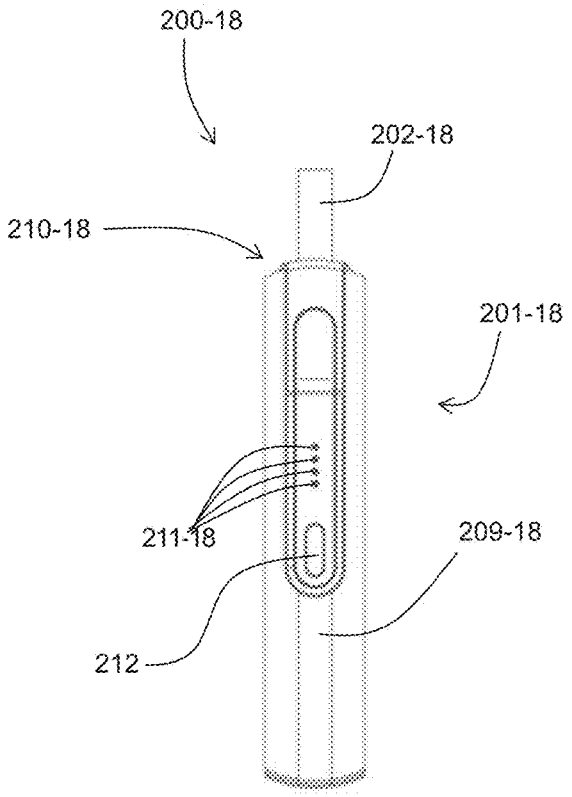
Figure 55B:
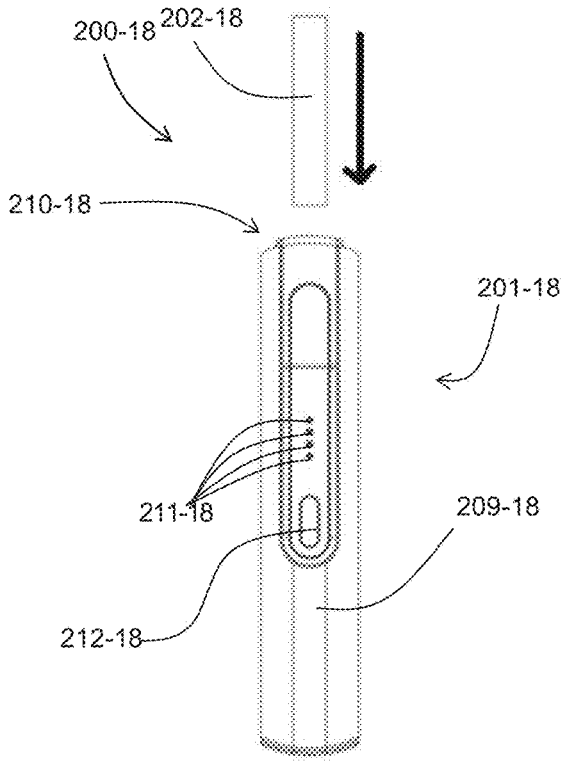
Figure 55C:
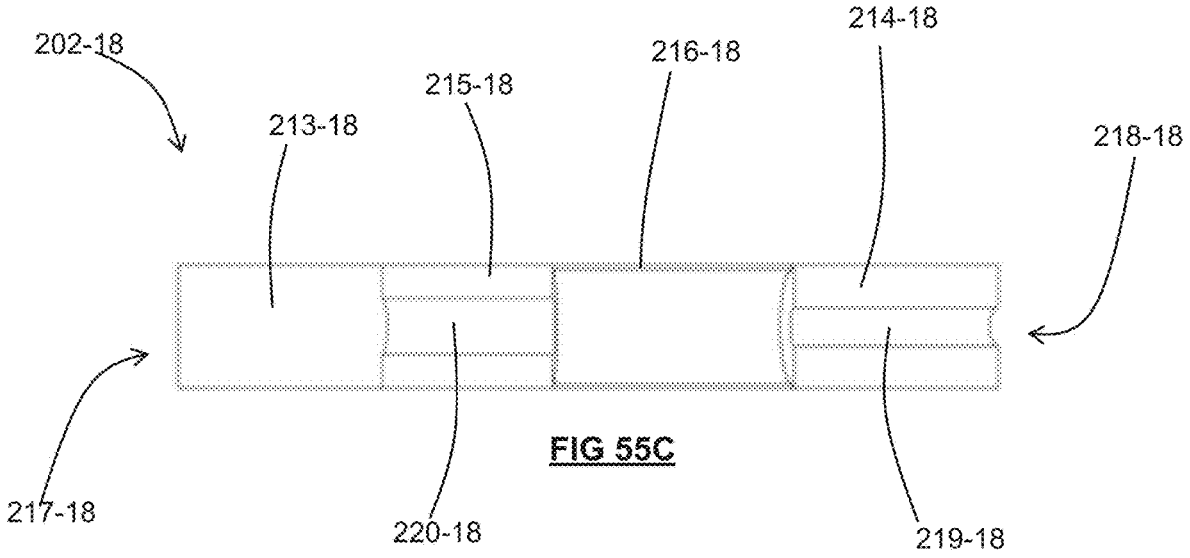
Figure 55D:
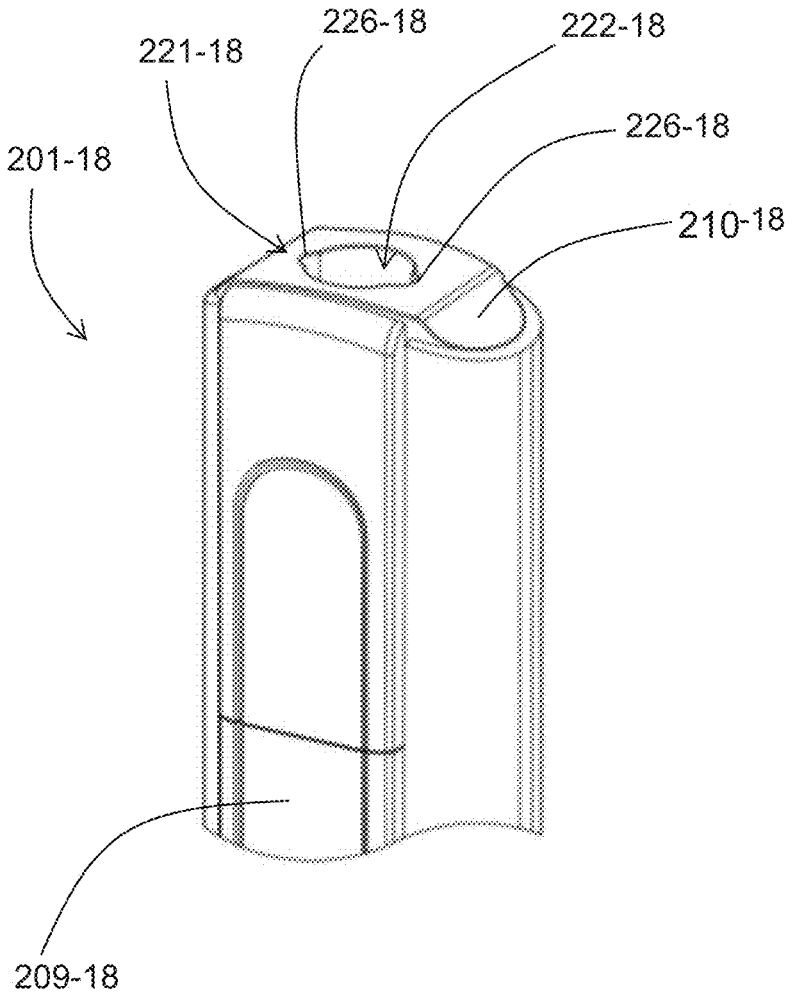
Figure 55E:
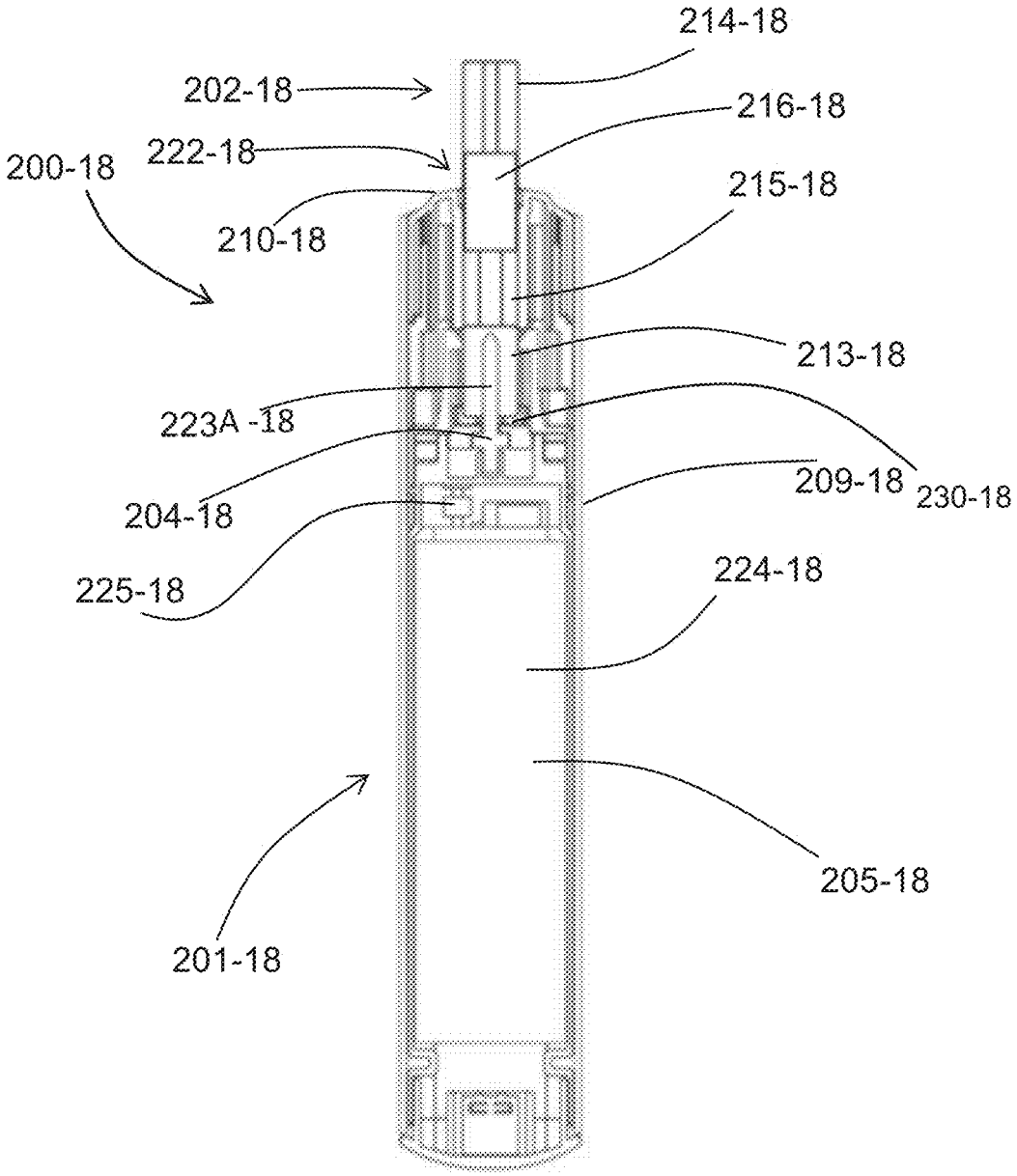
Figure 56:
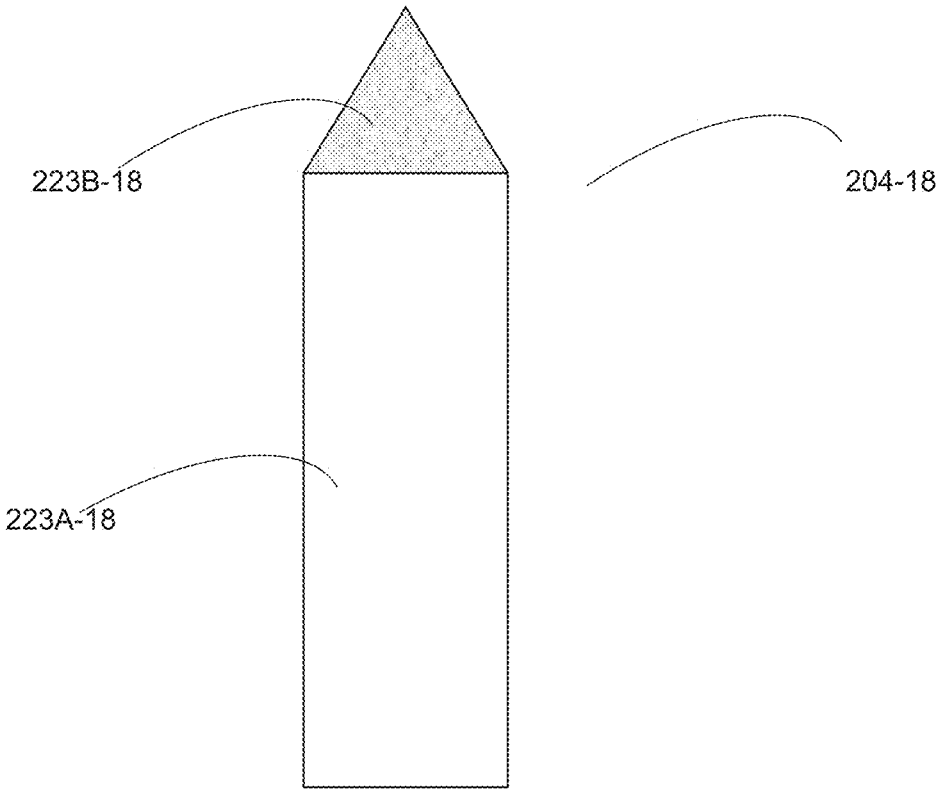

FIG. 54A is a schematic of a smoking substitute system;

FIG. 54B is a schematic of a variation of the smoking substitute system of FIG. 54A;

FIG. 55A is a front view of a first embodiment of an eighteenth mode of the smoking substitute system with the consumable engaged with the device;

FIG. 55B is a front view of the first embodiment of the smoking substitute system with the consumable disengaged from the device;

FIG. 55C is a section view of the consumable of the first embodiment of the smoking substitute system;

FIG. 55D is a detailed view of an end of the device of the first embodiment of the smoking substitute system;

FIG. 55E is a section view of the first embodiment of the substitute smoking system;

FIG. 56 illustrates a perspective view of the heater of the heat not burn device in accordance with an embodiment of the substitute smoking system.

Figure 57A:
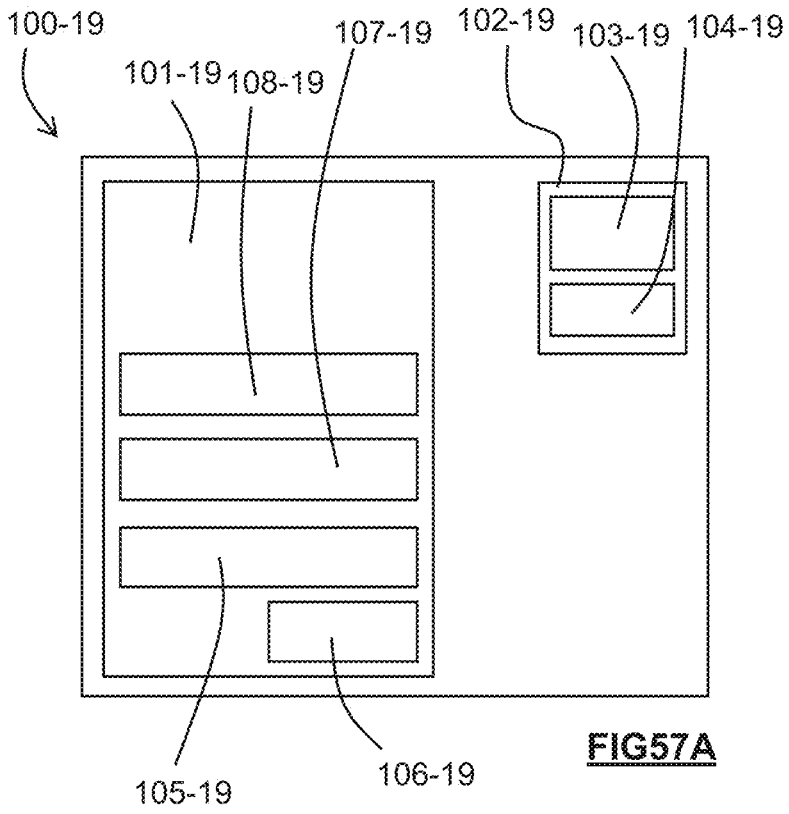
Figure 57B:
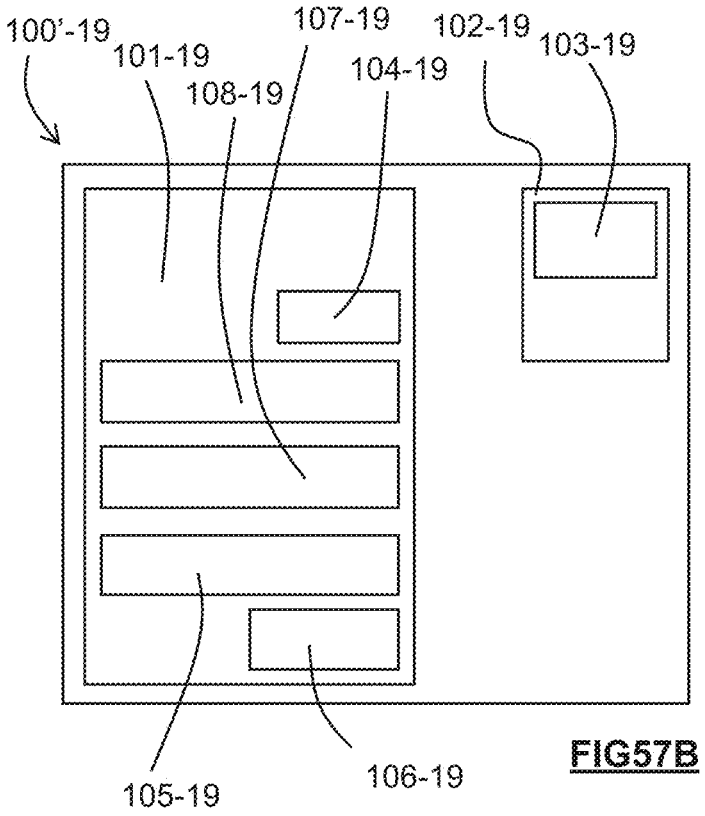
Figure 58A:
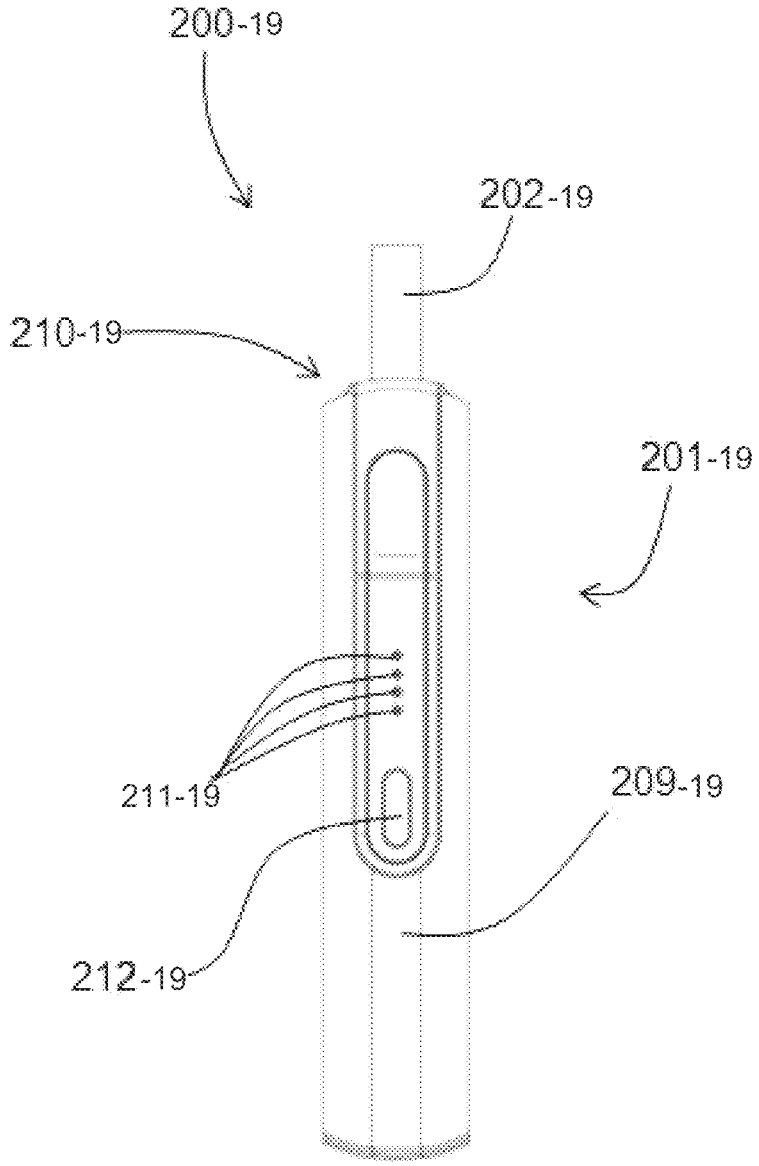
Figure 58B:
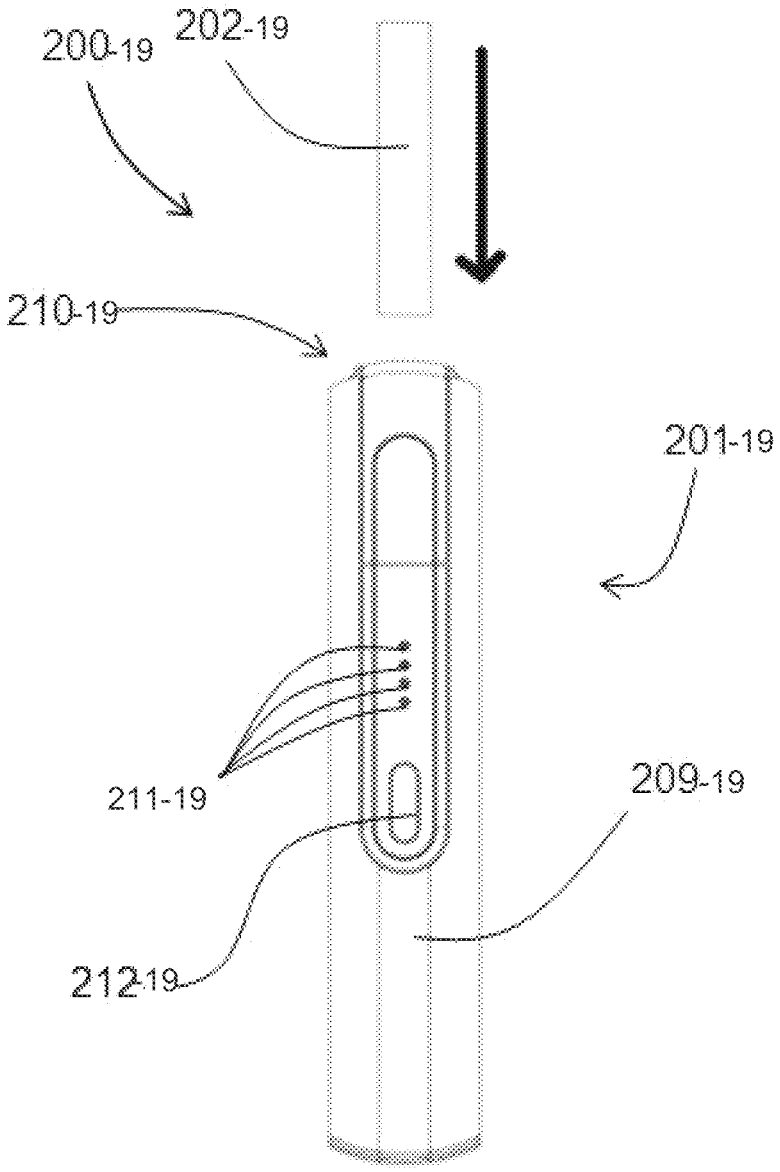
Figure 58C:
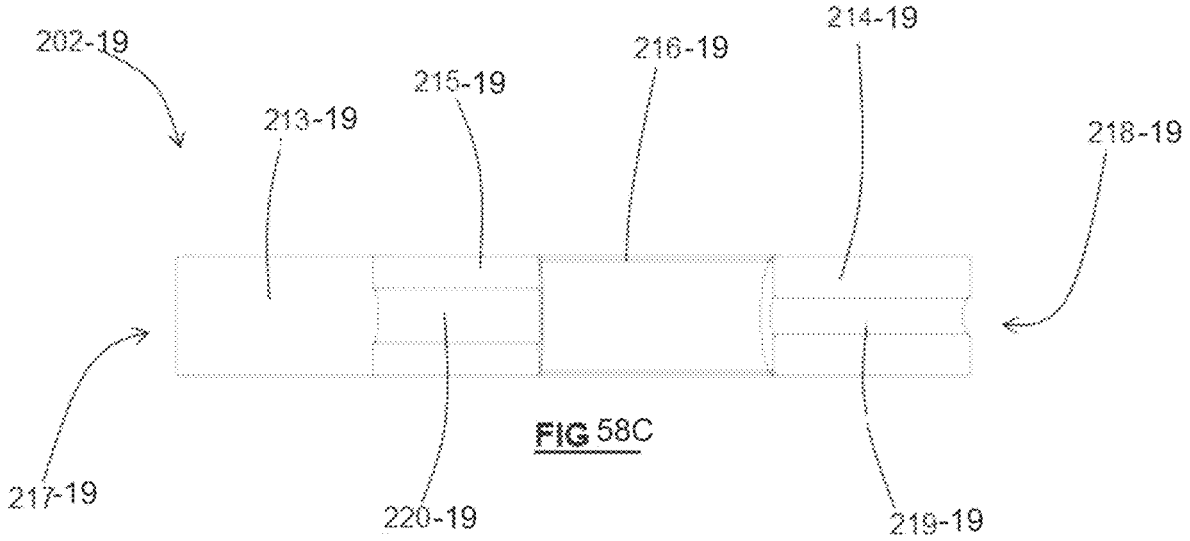
Figure 58D:
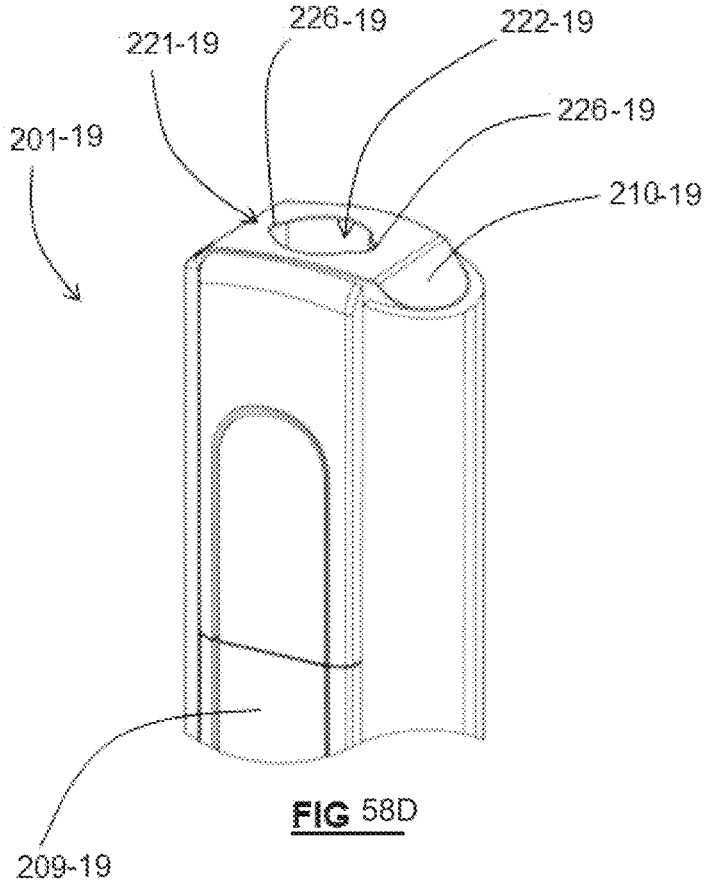
Figure 58E:
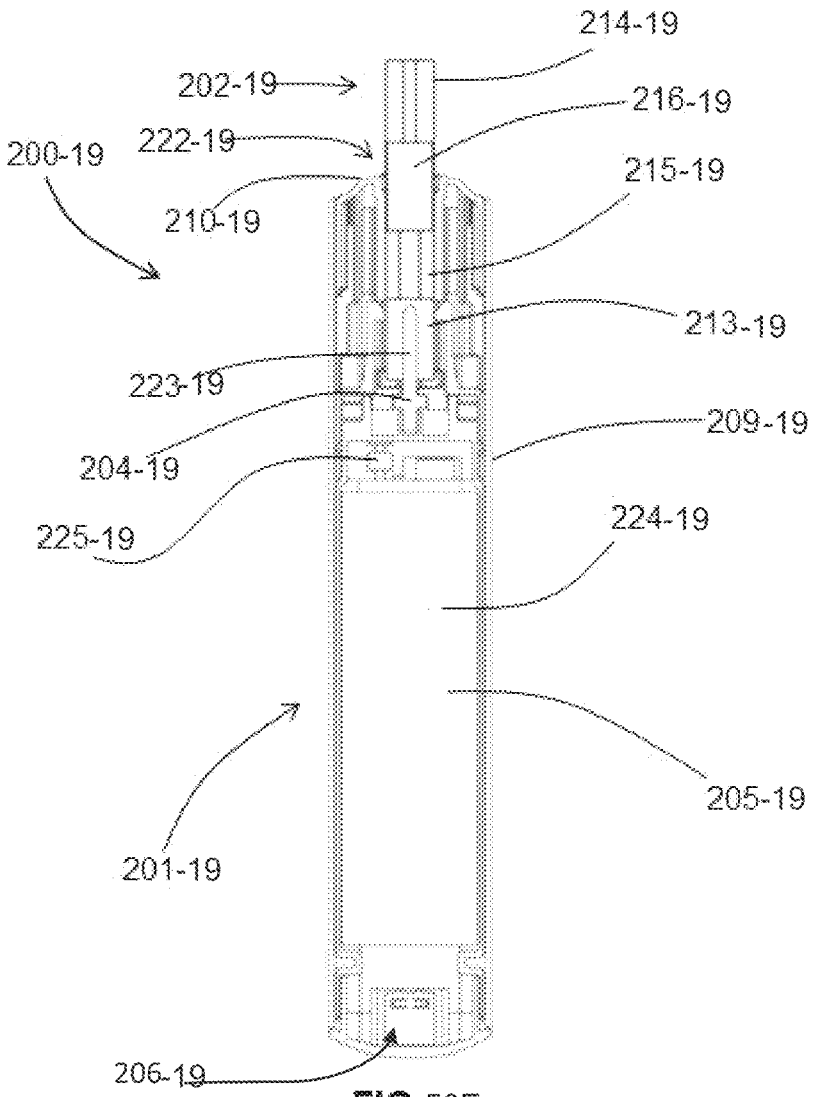
Figure 58F:
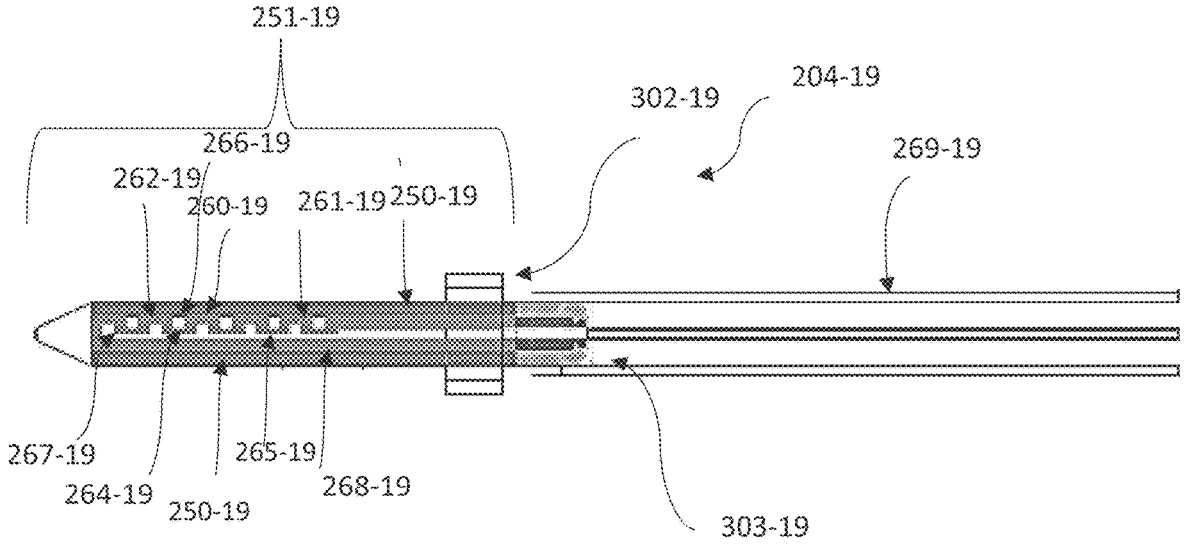

FIG. 57A is a schematic of a smoking substitute system;

FIG. 57B is a schematic of a variation of the smoking substitute system of FIG. 57A;

FIG. 58A is a front view of a first embodiment of a nineteenth mode of a smoking substitute system with the consumable engaged with the device;

FIG. 58B is a front view of the first embodiment of the smoking substitute system with the consumable disengaged from the device;

FIG. 58C is a section view of the consumable of the first embodiment of the smoking substitute system;

FIG. 58D is a detailed view of an end of the device of the first embodiment of the smoking substitute system;

FIG. 58E is a section view of the first embodiment of the smoking substitute system; and FIG. 58F is a sectional view of a heater of the smoking substitute system.

Figure 59A:
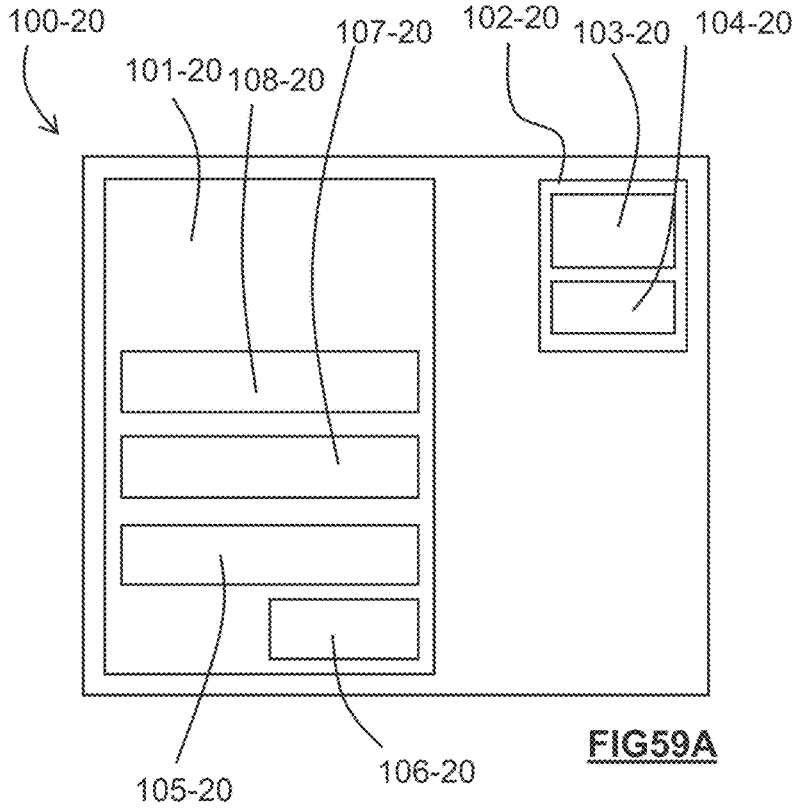
Figure 59B:
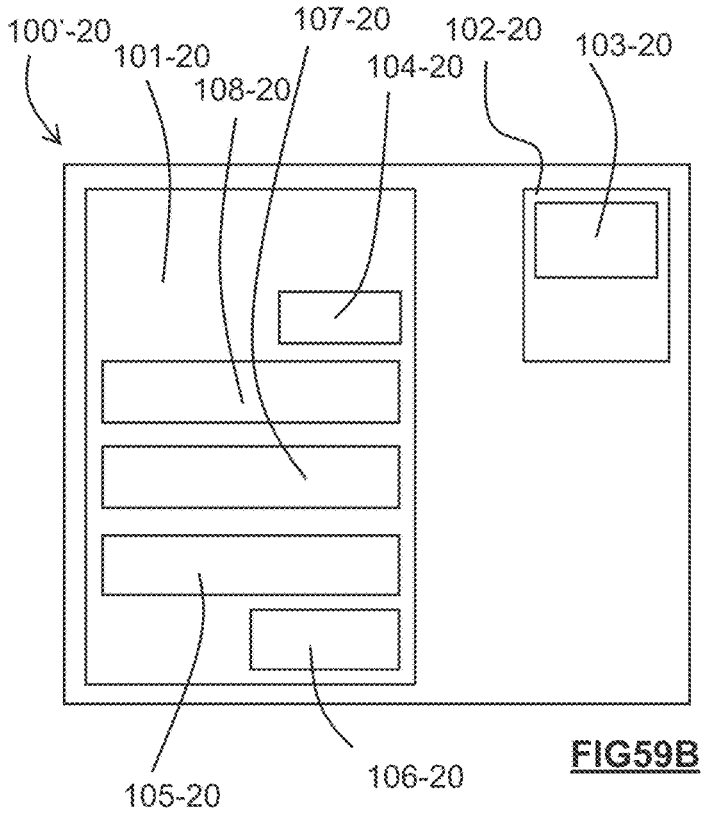
Figure 60A:
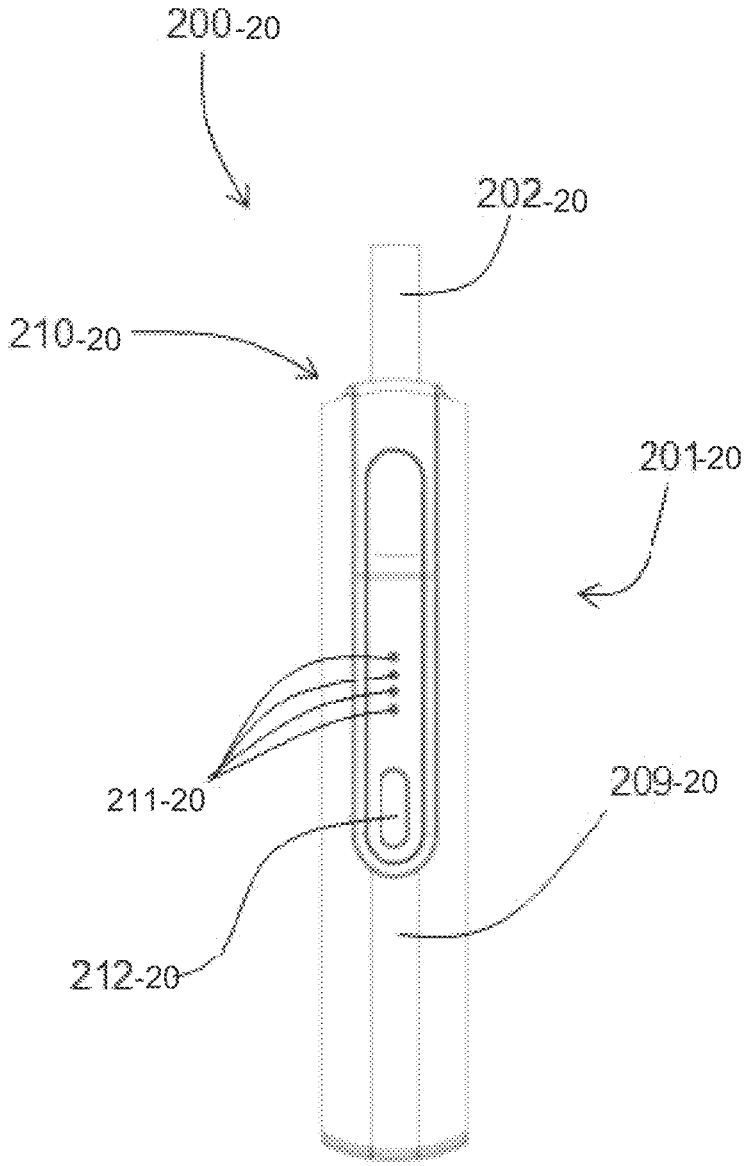
Figure 60B:
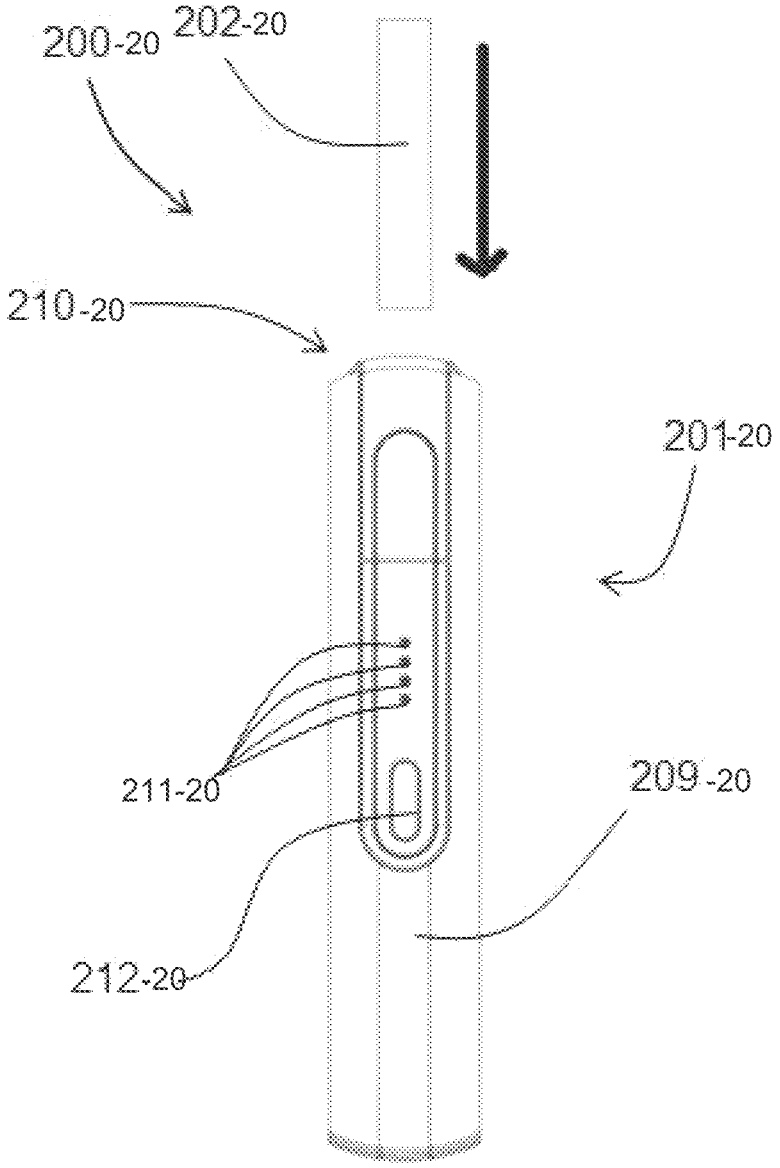
Figure 60C:
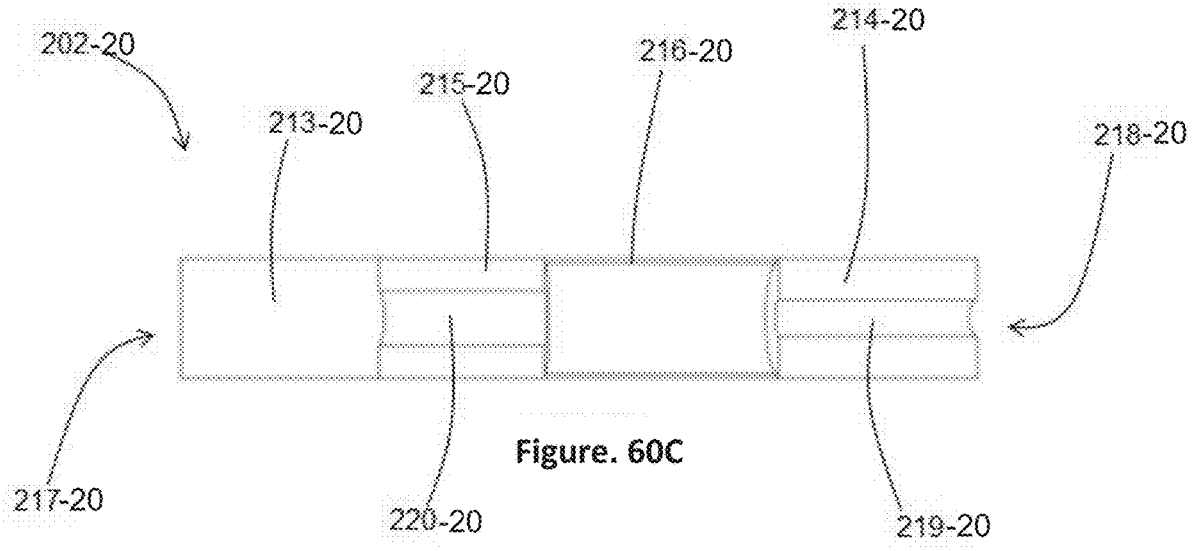
Figure 60D:
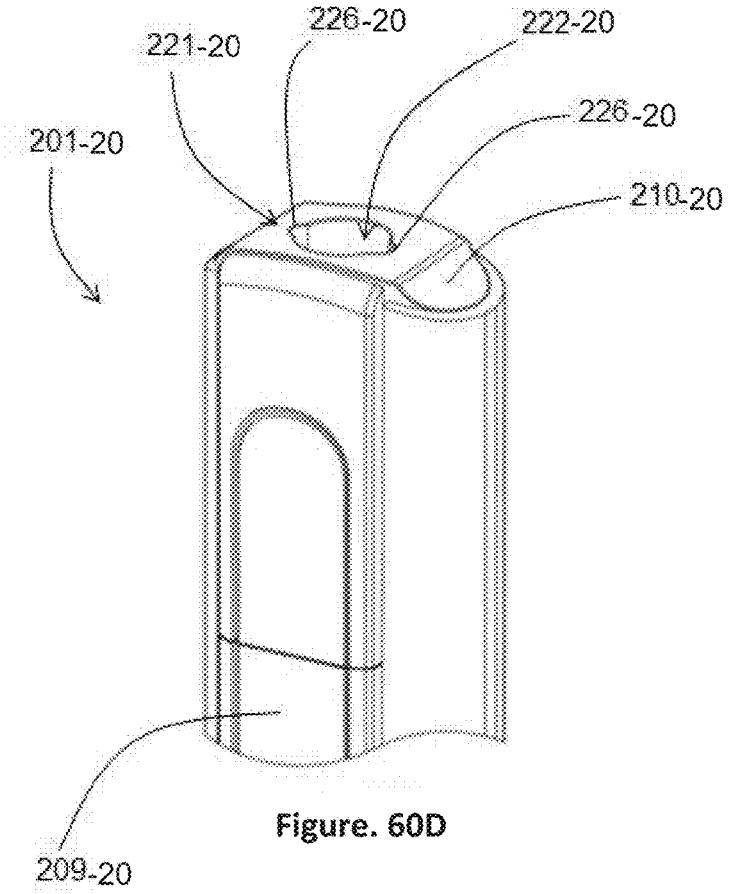
Figure 60E:
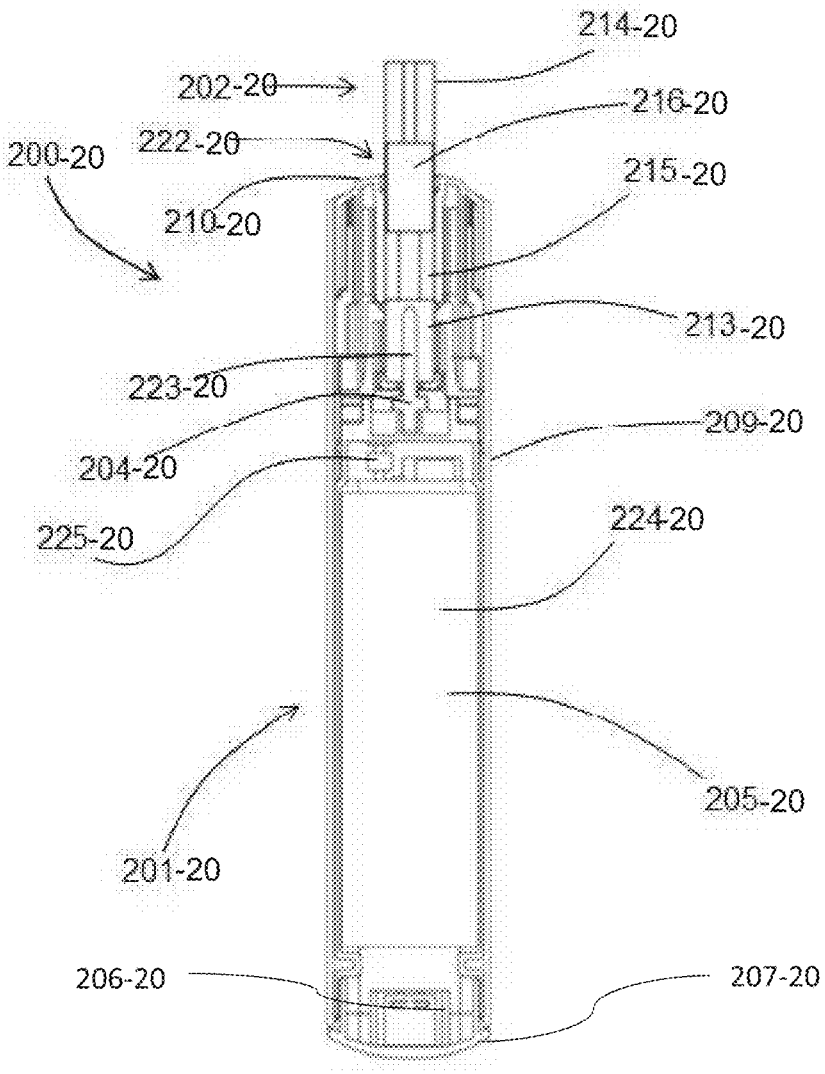
Figure 61:
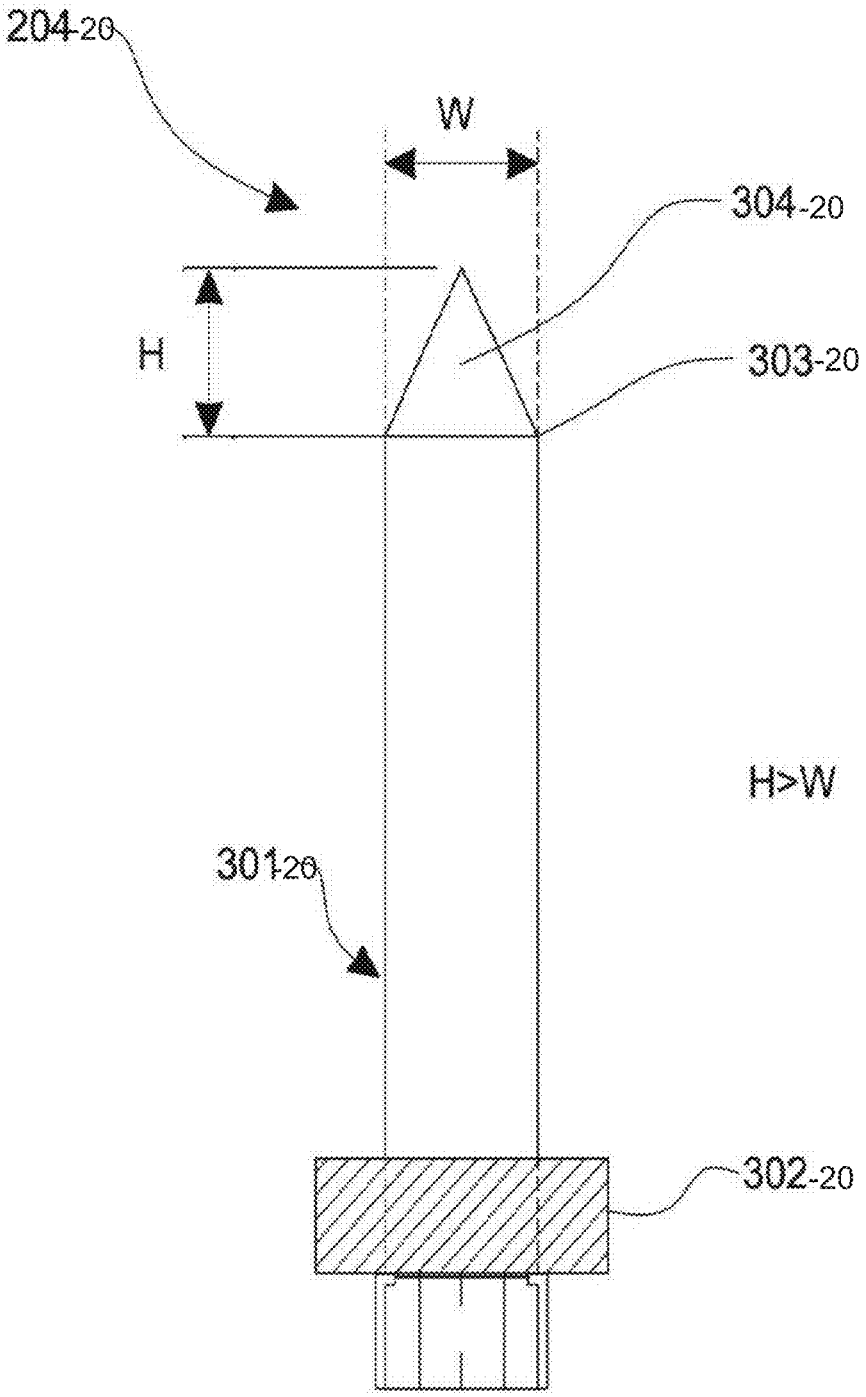

FIG. 59A is a schematic of a smoking substitute system;

FIG. 59B is a schematic of a variation of the smoking substitute system of FIG. 59A;

FIG. 60A is a front view of a first embodiment of a twentieth mode of a smoking substitute system with the consumable engaged with the device;

FIG. 60B is a front view of the first embodiment of the smoking substitute system with the consumable disengaged from the device;

FIG. 60C is a section view of the consumable of the first embodiment of the smoking substitute system;

FIG. 60D is a detailed view of an end of the device of the first embodiment of the smoking substitute system;

FIG. 60E is a section view of the first embodiment of the substitute smoking system;

FIG. 61 is a detailed view of a heater element of the first embodiment of the smoking substitute system.

DETAILED DESCRIPTION OF THE DISCLOSURE

Aspects and embodiments of the present disclosure will now be discussed with reference to the accompanying figures. Further aspects and embodiments will be apparent to those skilled in the art. All documents mentioned in this text are incorporated herein by reference.

First Mode of the Disclosure

Figure 1B:
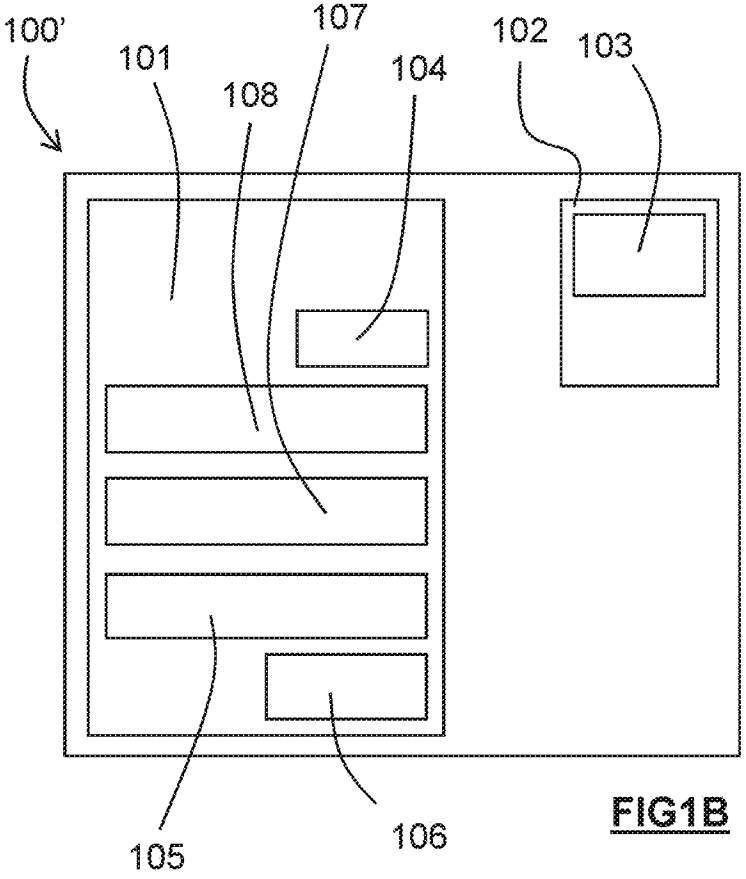
FIG. 1B is a schematic of a variation of the smoking substitute system of FIG. 1A.
Figure 1A:
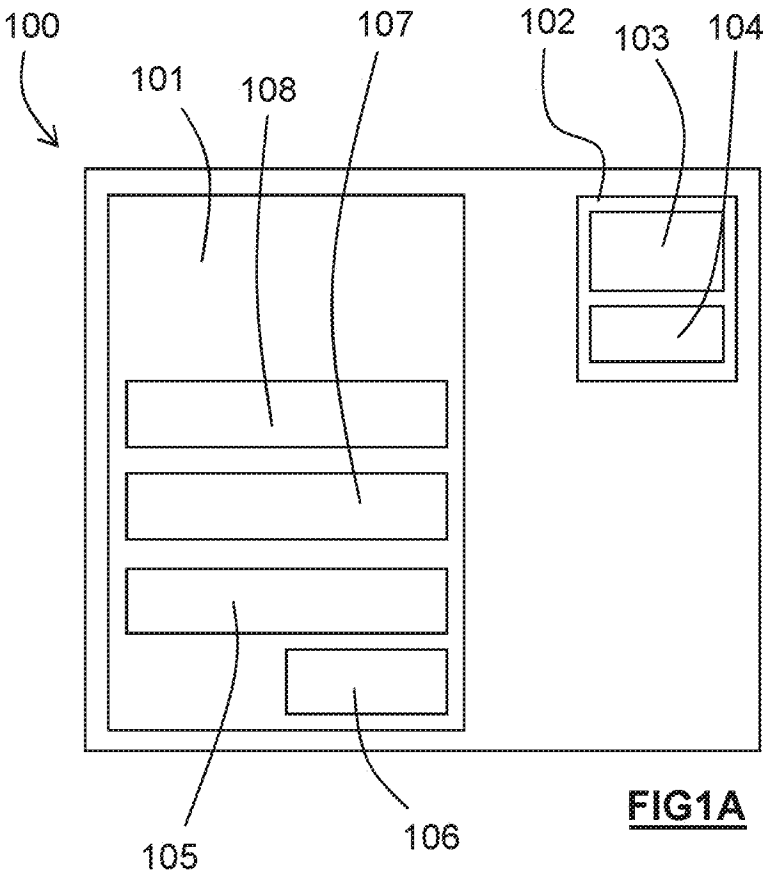
FIG. 1A is a schematic of a smoking substitute system.

FIG. 1A is a schematic providing a general overview of a smoking substitute system 100-6. The system 100-6 includes a substitute smoking device 101-6 and an aerosol-forming article in the form of a consumable 102-6, which comprises an aerosol former 103-6. The system is configured to vaporize the aerosol former by heating the aerosol former 103-6 (so as to form a vapor/aerosol for inhalation by a user).

In the illustrated system, the heater 104-6 forms part of the consumable 102-6 and is configured to heat the aerosol former 103-6. In this variation, the heater 104-6 is electrically connectable to a power source 105-6, for example, when the consumable 102-6 is engaged with the device 101-6. Heat from the heater 104-6 vaporizes the aerosol former 103-6 to produce a vapor. The vapor subsequently condenses to form an aerosol, which is ultimately inhaled by the user.

The power source 105-6 forms part of the device 101-6. In other embodiments the power source 105-6 may be external to (but connectable to) the device 101-6. The power source 105-6 is electrically connectable to the heater 104-6 such that it is able to supply power to the heater 104-6 (i.e., for the purpose of heating the aerosol former 103-6). Thus, control of the electrical connection of the power source 105-6 to the heater 104-6 provides control of the state of the heater 104-6. The power source 105-6 may be a power store, for example a battery or rechargeable battery (e.g., a lithium ion battery).

The system 100-6 further comprises an I/O module comprising a connector 106-6 (e.g., in the form of a USB port, Micro USB port, USB-C port, etc.). The connector 106-6 is configured for connection to an external source of electrical power, e.g., a mains electrical supply outlet. The connector 106-6 may be used in substitution for the power source 105-6. That is the connector 106-6 may be electrically connectable to the heater 104-6 so as to supply electricity to the heater 104-6. In such embodiments, the device may not include a power source, and the power source of the system may instead comprise the connector 106-6 and an external source of electrical power (to which the connector 106-6 provides electrical connection).

In some embodiments, the connector 106-6 may be used to charge and recharge the power source 105-6 where the power source 105-6 includes a rechargeable battery.

The system 100-6 also comprises a user interface (UI) 107. Although not shown, the UI 107-6 may include input means to receive commands from a user. The input means of the UI 107-6 allows the user to control at least one aspect of the operation of the system 100-6. The input means may, for example, be in the form of a button, touchscreen, switch, microphone, etc.

The UI 107-6 also comprises output means to convey information to the user. The output means may, for example, comprise lights (e.g., LEDs), a display screen, speaker, vibration generator, etc.

The system 100-6 further comprises a controller 108-6 that is configured to control at least one function of the device 101-6. In the illustrated embodiment, the controller 108-6 is a component of the device 101-6, but in other embodiments may be separate from (but connectable to) the device 101-6. The controller 108-6 is configured to control the operation of the heater 104-6 and, for example, may be configured to control the voltage applied from the power source 105-6 to the heater 104-6. The controller 108-6 may be configured to toggle the supply of power to the heater 104-6 between an on state, in which the full output voltage of the power source 105-6 is applied to the heater 104-6, and an off state, in which the no voltage is applied to the heater 104-6.

Although not shown, the system 100-6 may also comprise a voltage regulator to regulate the output voltage from the power source 105-6 to form a regulated voltage. The regulated voltage may then be applied to the heater 104-6.

In addition to being connected to the heater 104-6, the controller 108-6 is operatively connected to the UI 107-6. Thus, the controller 108-6 may receive an input signal from the input means of the UI 107-6.

Similarly, the controller 108-6 may transmit output signals to the UI 107-6. In response, the output means of the UI 107-6 may convey information, based on the output signals, to a user. The controller also comprises a memory 109-6, which is a non-volatile memory. The memory 109-6 includes instructions, which, when implemented, cause the controller to perform certain tasks or steps of a method.

FIG. 1B is a schematic showing a variation of the system 100-6 of FIG. 1A. In the system 100-6' of FIG. 1B, the heater 104-6 forms part of the device 101-6, rather than the consumable 102-6. In this variation, the heater 104-6 is electrically connected to the power source 105-6.

The systems 100-6, 100' of FIGS. 1A and 1B may be implemented as one of two broad categories of system, each in accordance with the present disclosure: a heated tobacco (HT) system or an e-cigarette system. A description of each category of system follows.

Figure 2B:
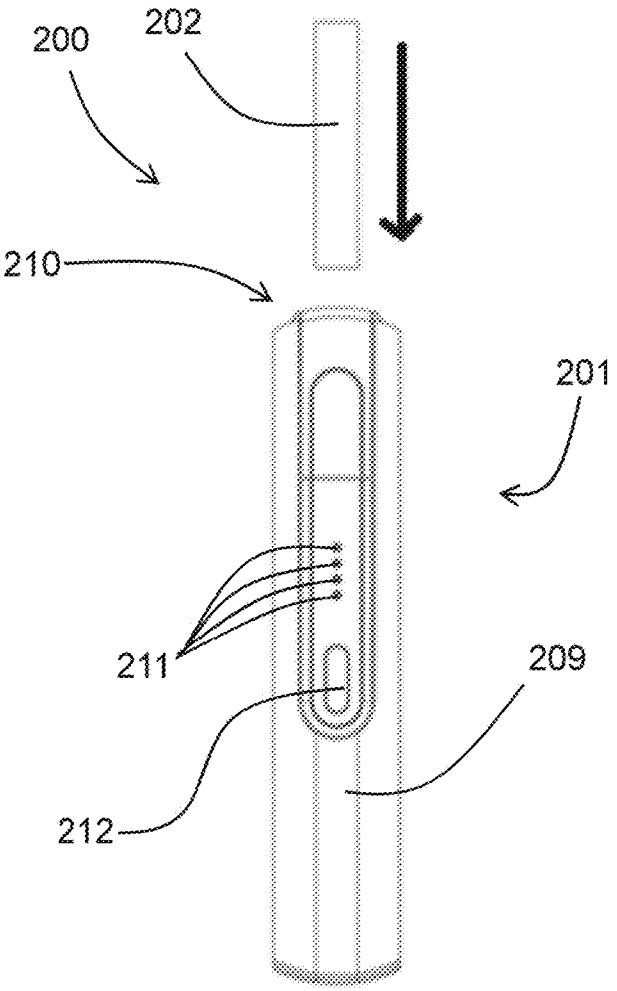
FIG. 2B is a front view of the first embodiment of the smoking substitute system with the consumable disengaged from the device.
Figure 2A:
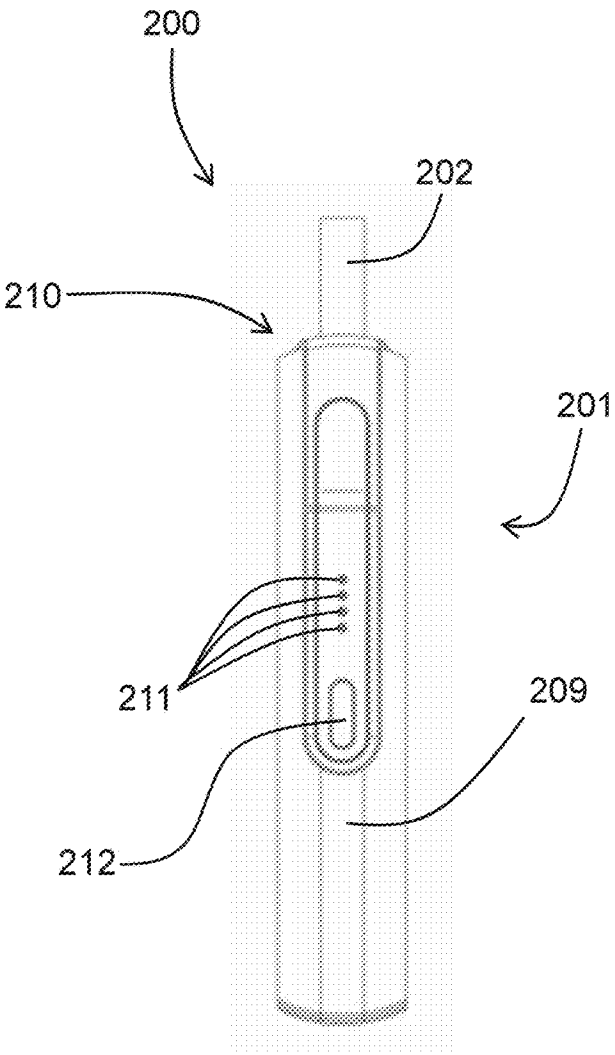
FIG. 2A is a front view of a first embodiment of a smoking substitute system in accordance with the first mode with the consumable engaged with the device.

FIGS. 2A and 2B illustrate a heated-tobacco (HT) smoking substitute system 200-6. The system 200-6 is an example of the systems 100-6, 100' described in relation to FIG. 1A or 1B. System 200-6

30 includes an HT device 201-6 and an HT consumable 202-6. The description of FIGS. 1A and 1B above is applicable to the system 200-6 of FIGS. 2A and 2B, and will thus not be repeated.

The device 201-6 and the consumable 202-6 are configured such that the consumable 202-6 can be engaged with the device 201-6. FIG. 2A shows the device 201-6 and the consumable 202-6 in an engaged state, whilst FIG. 2B shows the device 201-6 and the consumable 202-6 in a disengaged state.

The device 201-6 comprises a body 209-6 and cap 210-6. In use the cap 210-6 is engaged at an end of the body 209-6. Although not apparent from the figures, the cap 210-6 is moveable relative to the body 209-6. In particular, the cap 210-6 is slideable and can slide along a longitudinal axis of the body 209-6.

The device 201-6 comprises an output means (forming part of the UI of the device 201-6) in the form of a plurality of light-emitting diodes (LEDs) 211 arranged linearly along the longitudinal axis of the device 201-6 and on an outer surface of the body 209-6 of the device 201-6. A button 212-6 is also arranged on an outer surface of the body 209-6 of the device 201-6 and is axially spaced (i.e., along the longitudinal axis) from the plurality of LEDs 211-6.

Figure 2C:
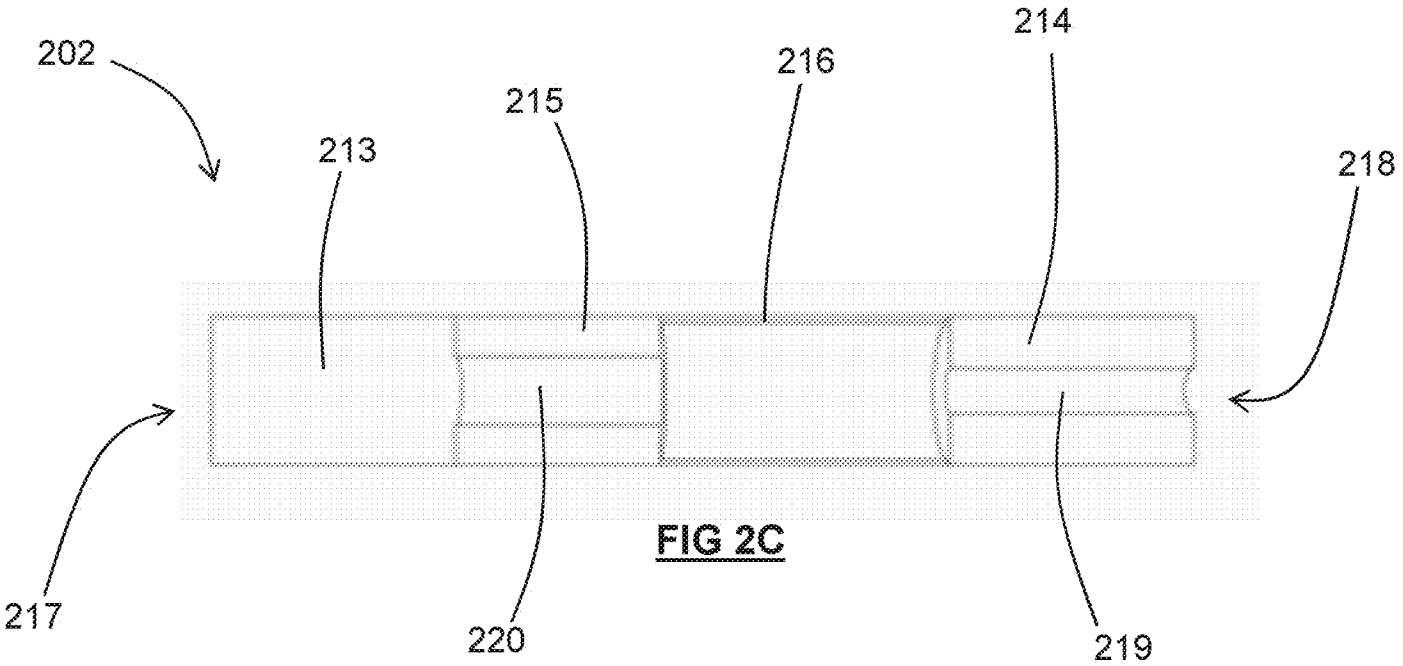
FIG. 2C is a section view of the consumable of the first embodiment of the smoking substitute system.

FIG. 2C show a detailed section view of the consumable of 202 of the system 200-6. The consumable 202-6 generally resembles a cigarette. In that respect, the consumable 202-6 has a generally cylindrical form with a diameter of 7 mm and an axial length of 70 mm. The consumable 202-6 comprises an aerosol forming substrate 213-6, a terminal filter element 214-6, an upstream filter element 215-6 and a spacer element 216-6. In other embodiments, the consumable may further comprise a cooling element. A cooling element may exchange heat with vapor that is formed by the aerosol-forming substrate 213-6 in order to cool the vapor so as to facilitate condensation of the vapor.

The aerosol-forming substrate 213-6 is substantially cylindrical and is located at an upstream end 217-6 of the consumable 202-6, and comprises the aerosol former of the system 200-6. In that respect, the aerosol forming substrate 213-6 is configured to be heated by the device 201-6 to release a vapor. The released vapor is subsequently entrained in an airflow flowing through the aerosol-forming substrate 213-6. The airflow is produced by the action of the user drawing on a downstream 218 (i.e., terminal or mouth) end of the consumable 202-6.

In the present embodiment, the aerosol forming substrate 213-6 comprises tobacco material that may, for example, include any suitable parts of the tobacco plant (e.g., leaves, stems, roots, bark, seeds and flowers). The tobacco may comprise one or more of leaf tobacco, stem tobacco, tobacco powder, tobacco dust, tobacco derivatives, expanded tobacco, homogenized tobacco, shredded tobacco, extruded tobacco, cut rag tobacco and/or reconstituted tobacco (e.g., slurry recon or paper recon). For example, the aerosol-forming substrate 213-6 may comprise a gathered sheet of homogenized (e.g., paper/slurry recon) tobacco or gathered shreds/strips formed from such a sheet.

In order to generate an aerosol, the aerosol forming substrate 213-6 comprises at least one volatile compound that is intended to be vaporized/aerosolized and that may provide the user with a recreational and/or medicinal effect when inhaled. The aerosol-forming substrate 213-6 may further comprise one or more additives. For example, such additives may be in the form of humectants (e.g., propylene glycol and/or vegetable glycerin), flavorants, fillers, aqueous/non-aqueous solvents and/or binders.

The terminal filter element 214-6 is also substantially cylindrical, and is located downstream of the aerosol forming substrate 213-6 at the downstream end 218-6 of the consumable 202-6. The terminal filter element 214-6 is in the form of a hollow bore filter element having a bore 219-6 (e.g., for airflow) formed there through. The diameter of the bore 219-6 is 2 mm. The terminal filter element 214-6 is formed of a porous (e.g., monoacetate) filter material. As set forth above, the downstream end 218-6 of the consumable 202-6 (i.e., where the terminal filter 214-6 is located) forms a mouthpiece portion of the consumable 202-6 upon which the user draws. Airflow is drawn from the upstream end 217-6, thorough the components of the consumable 202-6, and out of the downstream end 218-6. The airflow is driven by the user drawing on the downstream end 218-6 (i.e., the mouthpiece portion) of the consumable 202-6.

The upstream filter element 215-6 is located axially adjacent to the aerosol-forming substrate 213-6, between the aerosol-forming substrate 213-6 and the terminal filter element 214-6. Like the terminal filter 214-6, the upstream filter element 215-6 is in the form of a hollow bore filter element, such that it has a bore 220-6 extending axially there through. In this way, the upstream filter 215-6 may act as an airflow restrictor. The upstream filter element 215-6 is formed of a porous (e.g., monoacetate) filter material. The bore 220-6 of the upstream filter element 215-6 has a larger diameter (3 mm) than the terminal filter element 214-6.

The spacer 216-6 is in the form of a cardboard tube, which defines a cavity or chamber between the upstream filter element 215-6 and the terminal filter element 214-6. The spacer 216-6 acts to allow both cooling and mixing of the vapor/aerosol from the aerosol-forming substrate 213-6. The spacer has an external diameter of 7 mm and an axial length of 14 mm.

Although not apparent from the figure, the aerosol-forming substrate 213-6, upstream filter 215-6 and spacer 216-6 are circumscribed by a paper wrapping layer. The terminal filter 214-6 is circumscribed by a tipping layer that also circumscribes a portion of the paper wrapping layer (so as to connect the terminal filter 214-6 to the remaining components of the consumable 202-6). The upstream filter 215-6 and terminal filter 214-6 are circumscribed by further wrapping layers in the form of plug wraps.

Figure 2E:
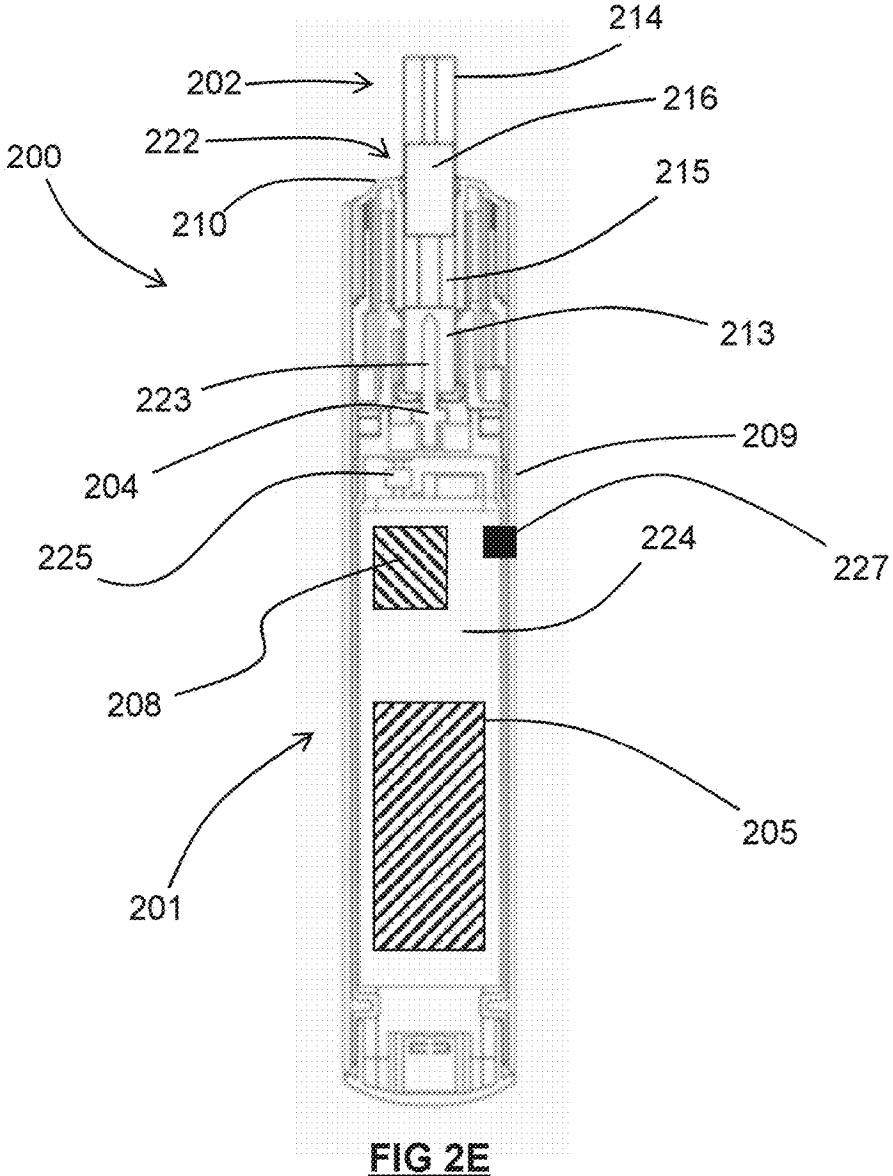
FIG. 2E is a section view of the first embodiment of the substitute smoking system.
Figure 2D:
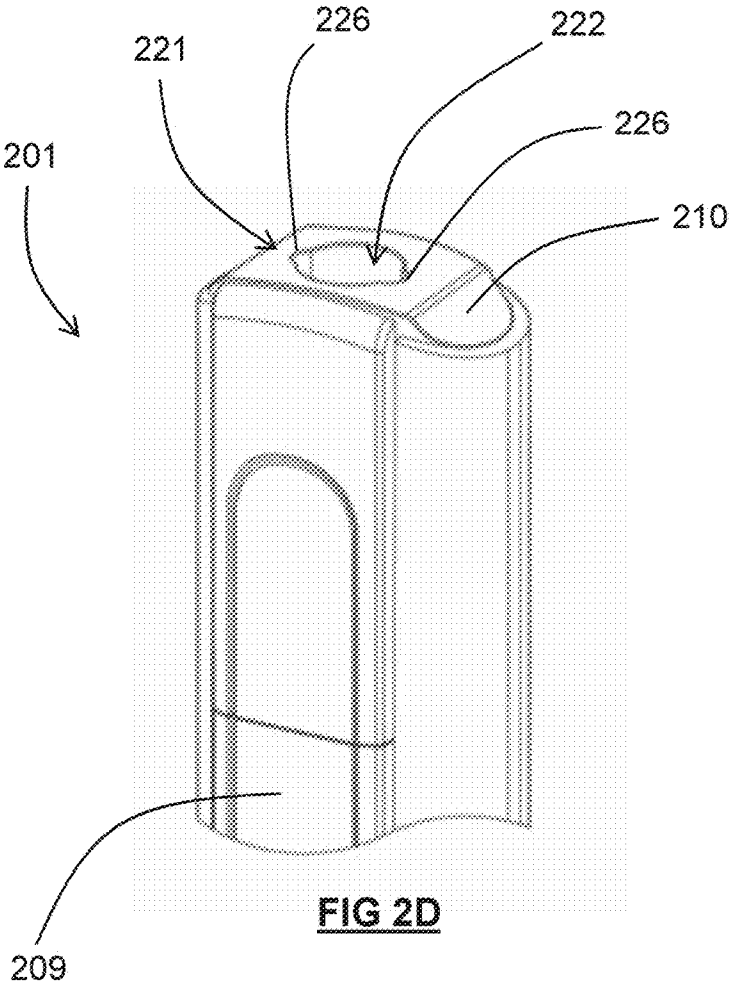
FIG. 2D is a detailed view of an end of the device of the first embodiment of the smoking substitute system.

Returning now to the device 201-6, FIG. 2D illustrates a detailed view of the end of the device 201-6 that is configured to engage with the consumable 202-6. The cap 210-6 of the device 201-6 includes an opening 221-6 to an internal cavity 222-6 (more apparent from FIG. 2D) defined by the cap 210-6. The opening 221-6 and the cavity 222-6 are formed so as to receive at least a portion of the consumable 202-6. During engagement of the consumable 202-6 with the device 201-6, a portion of the consumable 202-6 is received through the opening 221-6 and into the cavity 222-6. After engagement (see FIG. 2B), the downstream end 218-6 of the consumable 202-6 protrudes from the opening 221-6 and thus also protrudes from the device 201-6. The opening 221-6 includes laterally disposed notches 226-6. When a consumable 202-6 is received in the opening 221-6, these notches 226-6 remain open and could, for example, be used for retaining a cover in order to cover the end of the device 201-6.

FIG. 2E shows a cross section through a central longitudinal plane through the device 201-6. The device 201-6 is shown with the consumable 202-6 engaged therewith.

The device 201-6 comprises a heater 204-6 comprising heating element 223-6. The heater 204-6 forms part of the body 209-6 of the device 201-6 and is rigidly mounted to the body 209-6. In the illustrated embodiment, the heater 204-6 is a rod heater with a heating element 223-6 having a circular transverse profile. In other embodiments the heater may be in the form of a blade heater (e.g., heating element with a rectangular transverse profile) or a tube heater (e.g., heating element with a tubular form).

The heating element 223-6 of the heater 204-6 projects from an internal base of the cavity 222-6 along a longitudinal axis towards the opening 221-6. As is apparent from the figure, the length (i.e., along the longitudinal axis) of the heating element is less than a depth of the cavity 222-6. In this way, the heating element 223-6 does not protrude from or extend beyond the opening 221-6.

When the consumable 202-6 is received in the cavity 222-6 (as is shown in FIG. 2E), the heating element 223-6 penetrates the aerosol-forming substrate 213-6 of the consumable 202-6. In particular, the heating element 223-6 extends for nearly the entire axial length of the aerosol-forming substrate 213-6 when inserted therein. Thus, when the heater 204-6 is activated, heat is transferred radially from an outer circumferential surface the heating element 223-6 to the aerosol-forming substrate 213-6.

The device 201-6 further comprises an electronics cavity 224-6. A power source, in the form of a rechargeable battery 205-6 (a lithium ion battery), is located in electronics cavity 224-6.

The device 201-6 includes a connector (i.e., forming part of an IO module of the device 201-6) in the form of a USB port 206-6. The connector may alternatively be, for example, a micro-USB port or a USB-C port for examples. The USB port 206-6 may be used to recharge the rechargeable battery 205-6.

The device 201-6 includes a controller 208-6 located in the electronics cavity 224-6. The controller comprises a microcontroller mounted on a printed circuit board (PCB). The USB port 206-6 is also connected to the controller 208-6 (i.e., connected to the PCB and microcontroller).

The controller 208-6 is configured to control at least one function of the device 202-6. As will be described further below, the controller 208-6 is configured to control an aspect of the operation of the device 201-6 during the consumable operating cycle based on an exhaustion level of a consumable 202-6 engaged with the device 201-6. For example, the controller 208-6 is configured to control the operation of the heater 204-6. Such control of the operation of the heater 204-6 may be accomplished by the controller toggling the electrical connection of the rechargeable battery 205-6 to the heater 204-6. For example, the controller 208-6 is configured to control the heater 204-6 in response to a user depressing the button 212-6. Depressing the button 212-6 may cause the controller to allow a voltage (from the rechargeable battery 205-6) to be applied to the heater 204-6 (so as to cause the heating element 223-6 to be heated).

The heater 204-6 may be toggled using pulse width modulation. That is, the controller 208-6 is able to toggle the power supply according to a duty cycle. The controller 208-6 is be configured to control the power supply according to multiple power levels. Each power level is associated with a corresponding duty cycle. The duty cycle is proportional to the length of time the heater 204-6 is in an on (i.e., heating) condition within a predefined time period. In this embodiment, the controller 208-6 is configured to control the heater 204-6 in a "boost" mode and a "cruise" mode. The boost mode involves operating the heater 204-6 at a higher power level (and thus a higher duty cycle) than the cruise mode. Thus, the aspect of operation of the device 201-6 controlled by the controller 208-6 may include the power level of the supply of power to the heater 204-6. The boost and cruise modes may be selectable by a user (e.g., using the button 212-6). As will be described further below, the power level may also form one condition of the device that is used in determining the exhaustion of the consumable 202-6.

The controller is also configured to control the LEDs 211-6 in response to a (e.g., detected) condition of the device 201-6 or the consumable 202-6. For example, the controller may control the LEDs 211-6 to indicate whether the device 201-6 is in an on state or an off state (e.g., one or more of the LEDs 211-6 may be illuminated by the controller 208-6 when the device is in an "on" state).

The device 201-6 comprises a further input means (i.e., in addition to the button 212-6) in the form of a puff sensor 225-6. The puff sensor 225-6 is configured to detect a user drawing (i.e., inhaling) at the downstream end 218-6 of the consumable 202-6. The puff sensor 225-6 may, for example, be in the form of a pressure sensor, flow meter or a microphone. The puff sensor 225-6 is operatively connected to the controller 208-6 in the electronics cavity 224-6, such that a signal from the puff sensor 225-6, indicative of a puff state (i.e., drawing or not drawing), forms an input to the controller 208-6 (and can thus be responded to by the controller 208-6).

The puff sensor 225-6 provides one means for measuring the usage of the device 201-6 by a user, which in turn may be used to determine the exhaustion of the consumable 201 (i.e., during the consumable cycle). The puff sensor 225-6 is configured to measure whether a puff is occurring (i.e., a puff state) and the intensity of the puff (i.e., the magnitude of the airflow caused by the puff). Both of these characteristics may indicate e.g., a puff volume and can be used by the controller 208-6 to determine the exhaustion of the consumable 202-6. For example, the total puff time during the consumable cycle (up to the time of measurement) can be used as an indicator of the exhaustion. Similarly, the average airflow of the puffs may also be used to adjust this determination (i.e., higher average airflow may mean greater exhaustion of the consumable). Alternatively, each puff can be assigned an exhaustion value indicative of the exhaustion caused by that puff. That exhaustion value may be formed by combining the airflow during the puff and the length of the puff.

Although not shown, the device 201-6 comprises other sensors that are used in the determination of the exhaustion of the consumable 202-6. The device 201-6 comprises a temperature sensor formed into the heating element 223-6 which is in the form of a thermocouple comprising a track. The track extends along the heating element 223-6 in a serpentine manner. The temperature sensor transmits a signal to the controller 208-6 that is indicative of the temperature of the heating element 223-6 during operation. The controller 208-6 forms a heating profile based on this signal and uses this heating profile in the determination of the exhaustion level of the consumable 202-6. In general, higher temperatures (of the heating element 223-6) are likely to lead to faster exhaustion of the consumable 202-6.

The device 201-6 also comprises an external temperature sensor 227 that is configured to measure a temperature of the external environment (i.e., ambient temperature). In general higher ambient temperatures lead to faster exhaustion of the consumable 202-6. Thus, this information is also used to determine exhaustion level of the consumable 202-6.

As is briefly discussed above, the power level supplied to the heater 204-6 is also used to determine the exhaustion level of the consumable 202-6. Higher power levels generally lead to faster exhaustion of the heater 204-6.

In response to the determination of the exhaustion level, the controller 208-6 is configured to control an aspect of the operation of the device 201-6. In the present embodiment the controller 208-6 is configured to compare the (determined exhaustion level) with a maximum threshold exhaustion level associated with the point in time of the consumable cycle that the comparison is occurring. If the exhaustion exceeds the threshold, the controller 208-6 controls power supply to the heater 204-6 to be at a lower power level. This may ensure that the consumable 202-6 is not fully exhausted before the end of the consumable cycle. The controller 208-6 may perform this comparison at predetermined intervals during the consumable cycle. In other embodiments the controller 208-6 may perform the comparison after every detected puff.

The controller 208-6 is also configured to compare the exhaustion level with a minimum threshold exhaustion level. This comparison is made at a predetermined point in time in the consumable cycle, which is near the end of the consumable cycle. If the exhaustion level is below the minimum threshold level, this is indicative that the consumable may not be fully exhausted at the end of the cycle. In this case, the controller 208-6 transmits a signal to the LEDs 211-6 which causes the LEDs 211-6 to flash. This flashing indicates to a user that they have the option to add a predetermined extension time period to the consumable cycle. If the user depresses the button 212-6 for a period of two seconds when the LEDs 211-6 are flashing, the controller 202 extends the consumable cycle by the extension time period. That is, the controller 208-6 continues to permit the supply of power to the heater 204-6 for the extension time period (where it would otherwise prevent the supply of power).

In other embodiments the comparison with the minimum threshold exhaustion level may be performed in a similar manner to that described above with respect to the maximum threshold. That is, the comparison made be made at predetermined time intervals and the operation of the device (e.g., the power supply to the heater 204-6 or the predetermined time for the consumable cycle) may be adjusted accordingly. In this respect, the exhaustion rate of the consumable may be maintained within a desired range.

Other user output may be provided by the device 201-6 to indicate to the user the control of the aspect of the operation of the smoking substitute device 201-6. For example, the extension of duration of the consumable cycle and/or the shortening of the duration of the consumable cycle may be indicated. For example, the user output means may include a haptic feedback component (e.g., a vibration mechanism) to feedback to a user.

In other embodiments, the device 201-6 may also be configured to indicate the remaining time for completion of the present consumable/smoking cycle. The remaining time may be calculated based on the determined exhaustion level of the consumable 202-6. For example, a memory of the device 201-6 may store a predetermined (i.e., standard) consumable cycle time and the controller 208-6 may countdown this timer throughout the cycle. This time may then be adjusted by the controller 208-6 based on the determination of exhaustion level at a particular point in time.

Figure 3B:
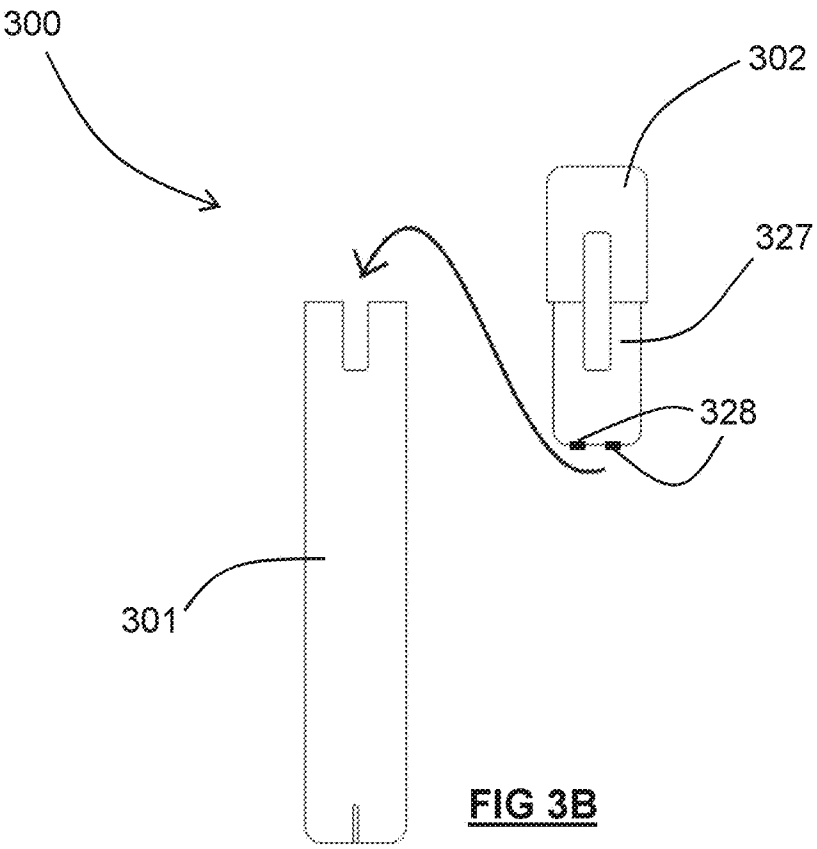
FIG. 3B is a front view of a second embodiment of the smoking substitute system with the consumable disengaged from the device.
Figure 3A:
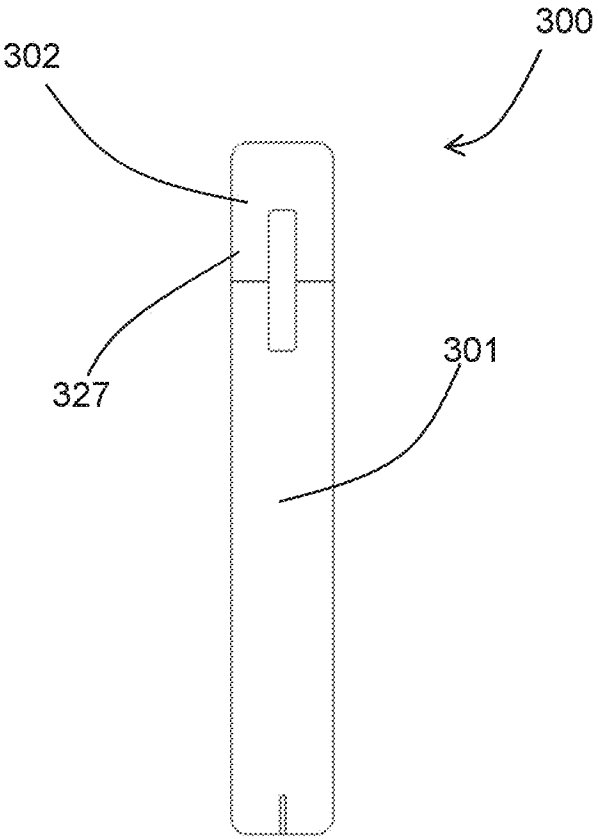
FIG. 3A is a front view of a second embodiment of the first mode of a smoking substitute system with the consumable engaged with the device.

FIGS. 3A and 3B illustrate an e-cigarette smoking substitute system 300. The system 300 is an example of the systems 100-6, 100' of FIGS. 1A and 1B and comprises an e-cigarette device 301-6 and an e-cigarette consumable 302. The description of FIGS. 1A and 1B above is applicable to the system of FIGS. 3A and 3B, and will not be repeated.

The device 301-6 and the consumable 302 are configured such that the consumable 302 can be engaged with the device 301-6. FIG. 3A shows the device 301-6 and the consumable 302 in an engaged state, whilst FIG. 3B shows the device 301-6 and the consumable 302 in a disengaged state. During engagement a portion of the consumable 302 is received in a cavity 322 of the device 301-6. The consumable 302 is retained in the device 301-6 via an interference fit (although in other embodiments, the device and consumable could be engaged by screwing one onto (or onto) the other, through a bayonet fitting, or by way of a snap engagement mechanism).

The consumable 302 includes a tank 327. The tank 327 defines a reservoir for the storage of an aerosol-former, which in this embodiment, is in the form of e-liquid.

In this present embodiment, the consumable 302 is a "single-use" consumable. That is, upon exhausting the e-liquid in the tank 327, the intention is that the user disposes of the whole consumable 302. In other embodiments, the e-liquid (i.e., aerosol former) may be the only part of the system that is truly "single-use". In such embodiments, the tank may be refillable with e-liquid or the e-liquid may be stored in a non-consumable component of the system. For example, the e-liquid may be stored in a tank located in the device or stored in another component that is itself not single-use (e.g., a refillable cartomizer).

In the illustrated system 300, a heater 304 is located in the consumable 302 and is configured to heat and vaporize the e-liquid (stored in the tank 327). Although not shown, the heater 304 comprises a porous wick and a resistive heating element. The porous wick conveys e-liquid from the tank 327 to the heating element. The heating element is a heating filament that is helically wound around a portion of the porous wick, such that when the heating element is heated (e.g., by the action of electrical current passing through the heating element), heat is transferred from the heating element to the e-liquid conveyed by the wick. This transfer of heat vaporizes the e-liquid and the resultant vapor is entrained in an airflow passing through the consumable 302 (i.e., driven by a user drawing on a downstream end 318 of the consumable 302). Between the vaporization point at the coil and the downstream end 318 (i.e., the mouth end), the vapor condenses into an aerosol, and is subsequently inhaled by the user.

Like the previously described embodiment, the device 301-6 comprises a power source in the form of a rechargeable battery (not shown) and a connector in the form of a USB port (not shown). The device 301-6 further comprises controller (also not shown). The rechargeable battery, connector and controller are similar (and operate in a similar manner) to the corresponding components of the embodiment described above with respect to FIG. 2A to 2E.

The consumable 302 includes a pair of heater electrical contacts 328 disposed on a device-facing end surface of the consumable 302. The heater electrical contacts 328 are electrically connected to the heater 304 in the consumable 302, such that a voltage applied across the heater electrical contacts 328 generally corresponds to a voltage applied across the resistive heating element of the heater 304.

When the consumable 302 is engaged with the device 301-6, the heater electrical contacts 328 are brought into electrical contact with corresponding device electrical contacts (not shown) on the device 301-6. The device electrical contacts are electrically connected (directly or indirectly) to the rechargeable battery. The controller may thus be configured to control the voltage applied across the device electrical contacts from the rechargeable battery. By controlling the voltage applied across the device electrical contacts, the voltage applied to the heater 304 is correspondingly controlled.

The device 301-6 includes an output means (forming part of the UI of the system 300) in the form of a single light-emitting diode ("LED") 311. The LED 311 is operatively connected to the controller, such that controller can control the illumination of the LED 311. The controller is configured to illuminate the LED when then the heater 304 is active.

The device 301-6 also includes an input means in the form of a puff sensor (not shown). The puff sensor is the same as that described above with respect to the embodiment shown in FIG. 2A to 2E.

It should be appreciated that the controller of this device 301-6 may operate in a similar manner to that described above. In this respect, the puff sensor may define a measurement means for measuring a usage of the device by a user during the consumable cycle. The controller may be a controller configured to determine an exhaustion level of the consumable during the consumable cycle based on the usage, and may further be configured to control an aspect of the operation of the smoking substitute device during the consumable operating cycle based on the exhaustion level.

Figure 4:
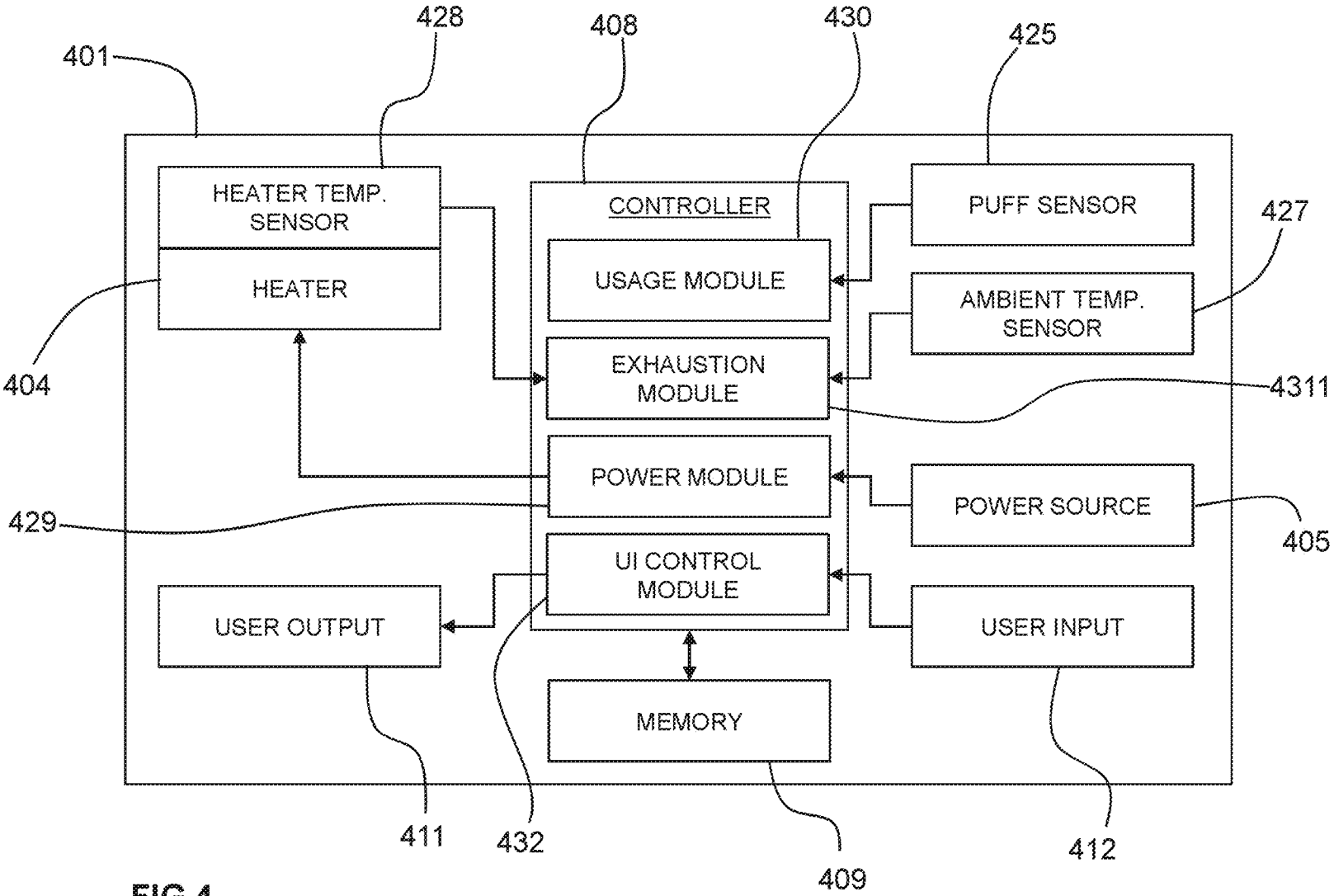
FIG. 4 is a schematic showing a third embodiment of the first mode of the smoking substitute system.

FIG. 4 is a schematic illustrating how the various components of a device 401 (which may be in the form of one of the devices 201, 301 described above) may be operatively connected. The device 401 comprises a controller 408-6 and a plurality of components connected to the controller 408-6. The controller 408-6 controls a heater 404-6 and a user output 411 of the device 401. The controller 408-6 also takes a number of inputs from a puff sensor 425, ambient temperature sensor 427 and a user input 412. Power is also supplied from a power source 405 to the heater 404-6 via a power module 429 of the controller 408-6, such that the power module 429 is able to control the power supply to the heater 404-6.

The controller 408-6 further comprises a usage 430, exhaustion 431 and UI control 432 modules. These modules 429, 430, 431, 432 of the controller 408-6 are able to communicate with one another and with a memory 409 that is also operatively connected to the controller 408-6 for storing information communicated from the controller 408-6.

In operation, the usage module 430 of the controller 408-6 is able to determine a usage of the device 401 based on signals received from the puff sensor 425. These signals are indicative of a puff state (i.e., whether a puff is occurring or not occurring). Using these signals, the usage module 430 is able to determine the length of each puff (i.e., in time), the intensity of the puff (i.e., the airflow) and the length of time of each pause between the puffs.

The usage of the device 401 is communicated from the usage module 430 to the exhaustion module 431, which is configured to determine the exhaustion of a consumable engaged with the device 401. The usage information only forms one part of this determination. The usage module 430 receives temperature information from a heater temperature sensor 428-6 and an ambient temperature sensor 427, which also factor into the determination of the exhaustion of the consumable. Additionally, the power module 429, which is configured to operate according to a plurality of different power levels, is configured to communicate information regarding the current power level to the exhaustion module 431. All of these signals are used by the exhaustion module 431. It should be appreciated that further information, or different information, may be used to make the assessment of the exhaustion level of the consumable. How the signals are used will depend on the type of consumable and device.

The power module 429, in response to the determination of exhaustion level may alter the power supplied to the heater 404-6. As is described above, this may depend on whether the exhaustion level is between predetermined maximum and minimum threshold levels. These predetermined threshold may be stored in the memory 409. The user output 411 may also be controlled (by the UI module 432) to indicate to a user that the operation of the device 401 has been adjusted.

The device 401 may provide the user the option of altering the operation of the device 401 if the exhaustion level is below a minimum threshold level. This may be provided via the user output 411 and the user may respond using the user input 412. In such cases, the controller 408-6 may extend a predetermined consumable cycle time so that the user can consume the consumable for an extended period of time.

Second Mode of the Disclosure

Figure 5:
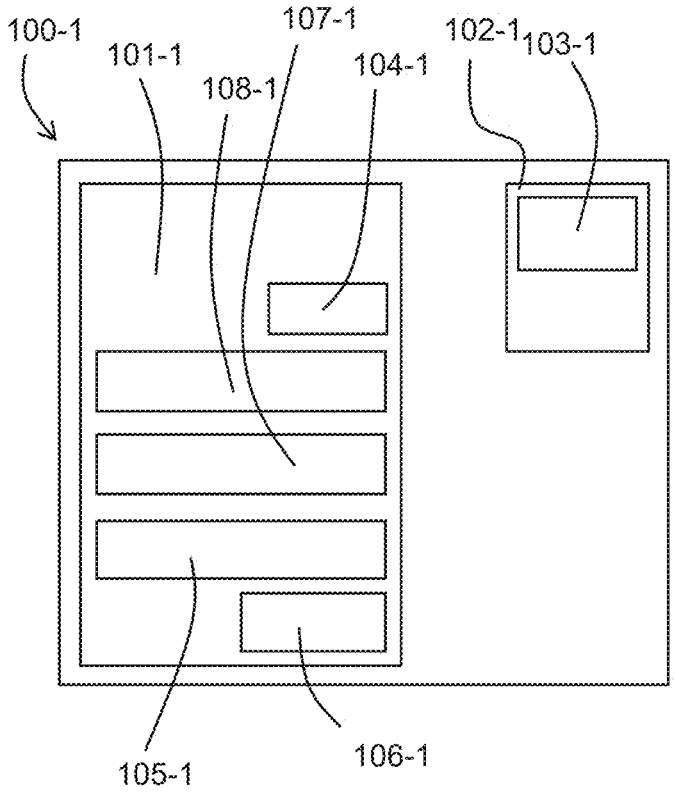
FIG. 5 is a schematic of a smoking substitute system.

FIG. 5 is a schematic providing a general overview of a smoking substitute system 100-6-1. The system 100-6-1 includes a substitute smoking device 101-6-1 and an aerosol-forming article in the form of a consumable 102-6-1, which comprises an aerosol former 103-6-1. The system is configured to vaporize the aerosol former by heating the aerosol former 103-6-1 (so as to form a vapor/aerosol for inhalation by a user).

The heater 104-6-1 forms part of the device 101-6-1 and is configured to heat the aerosol former 103-6-1 of the consumable 102-6-1. The heater 104-6-1 is electrically connected to a power source 105-6-1. Heat from the heater 104-6-1 vaporizes the aerosol former 103-6-1 to produce a vapor. The vapor subsequently condenses to form an aerosol, which is ultimately inhaled by the user.

The power source 105-6-1 may form part of the device 101-6-1 or may be external to (but connectable to) the device 101-6-1. The power source 105-6-1 is electrically connected to the heater 104-6-1 such that it is able to supply power to the heater 104-6-1 (i.e., for the purpose of heating the aerosol former 103-6-1). Thus, control of the electrical connection of the power source 105-6-1 to the heater 104-6-1 provides control of the state of the heater 104-6-1. The power source 105-6-1 may be a power store, for example a battery or rechargeable battery (e.g., a lithium ion battery).

The system 100-6-1 further comprises an I/O module comprising a connector 106-6-1 (e.g., in the form of a USB port, Micro USB port, USB-C port, etc.). The connector 106-6-1 is configured for connection to an external source of electrical power, e.g., a mains electrical supply outlet. The connector 106-6-1 may be used in substitution for the power source 105-6-1. That is the connector 106-6-1 may be electrically connectable to the heater 104-6-1 so as to supply electricity to the heater 104-6-1. In such embodiments, the device may not include a power source, and the power source of the system may instead comprise the connector 106-6-1 and an external source of electrical power (to which the connector 106-6-1 provides electrical connection).

In some embodiments, the connector 106-6-1 may be used to charge and recharge the power source 105-6-1 where the power source 105-6-1 includes a rechargeable battery.

The system 100-6-1 also comprises a user interface (UI) 107-1. Although not shown, the UI 107-6-1 may include input means to receive commands from a user. The input means of the UI 107-6-1 allows the user to control at least one aspect of the operation of the system 100-6-1. The input means may, for example, be in the form of a button, touchscreen, switch, microphone, etc.

The UI 107-6-1 also comprises output means to convey information to the user. The output means may, for example, comprise lights (e.g., LEDs), a display screen, speaker, vibration generator, etc.

The system 100-6-1 further comprises a controller 108-6-1 that is configured to control at least one function of the device 101-6-1. In the illustrated embodiment, the controller 108-6-1 is a component of the device 101-6-1, but in other embodiments may be separate from (but connectable to) the device 101-6-1. The controller 108-6-1 is configured to control the operation of the heater 104-6-1 and, for example, may be configured to control the voltage applied from the power source 105-6-1 to the heater 104-6-1. The controller 108-6-1 may be configured to toggle the supply of power to the heater 104-6-1 between an on state, in which the full output voltage of the power source 105-6-1 is applied to the heater 104-6-1, and an off state, in which the no voltage is applied to the heater 104-6-1.

Although not shown, the system 100-6-1 may also comprise a voltage regulator to regulate the output voltage from the power source 105-6-1 to form a regulated voltage. The regulated voltage may then be applied to the heater 104-6-1.

In addition to being connected to the heater 104-6-1, the controller 108-6-1 is operatively connected to the UI 107-6-1. Thus, the controller 108-6-1 may receive an input signal from the input means of the UI 107-6-1.

Similarly, the controller 108-6-1 may transmit output signals to the UI 107-6-1. In response, the output means of the UI 107-6-1 may convey information, based on the output signals, to a user. The controller 108-6-1 also comprises a memory, which is a non-volatile memory. The memory includes instructions, which, when implemented, cause the controller to perform certain tasks or steps of a method.

Figure 6A:
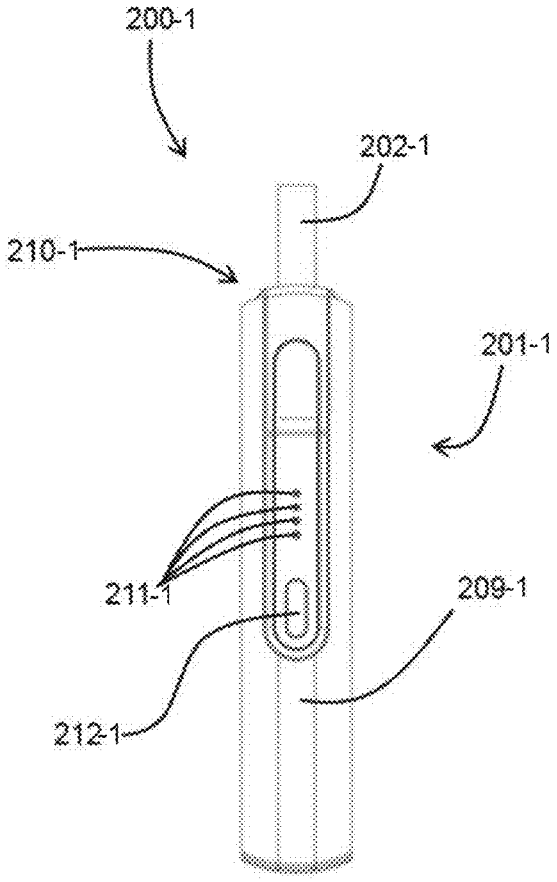
FIG. 6A is a front view of a first embodiment of a second mode of a smoking substitute system with the consumable engaged with the device.
Figure 6B:
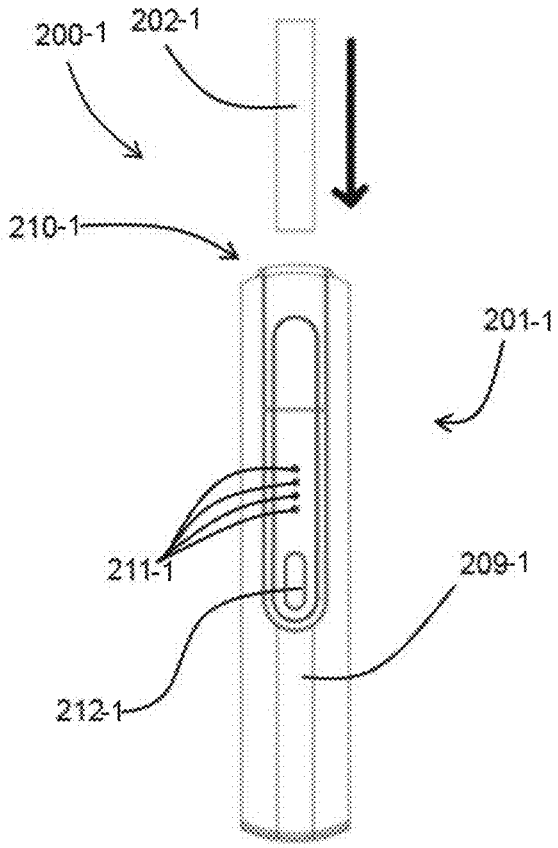
FIG. 6B is a front view of the first embodiment of the smoking substitute system with the consumable disengaged from the device.

FIG. 6A and FIG. 6B illustrate a smoking substitute system 200-6-1. The system 200-6-1 is an example of the system 100-6-1 described in relation to FIG. 5. The illustrated system 200-6-1 includes a device 201-6-1 and a consumable 202-6-1. As will be described further below, the device 201-6-1 is compatible with both heat-not- 15 burn consumables and e-cigarette consumables. In this case, the heat-not-burn consumables and e-cigarette consumables that are of similar shape may be used with the device 201-6-1. The description of FIG. 5 above is applicable to the system 200-6-1 of FIG. 6A and FIG. 6B, and will thus not be repeated.

The device 201-6-1 and the consumable 202-6-1 are configured such that the consumable 202-6-1 can be engaged with the device 201-6-1. FIG. 6A shows the device 201-6-1 and the consumable 202-6-1 in an engaged state, whilst FIG. 6B shows the device 201-6-1 and the consumable 202-6-1 in a disengaged state.

The device 201-6-1 comprises a body 209-6-1 and cap 210-6-1. In use the cap 210-6-1 is engaged at an end of the body 209-6-1. Although not apparent from the figures, the cap 210-6-1 is moveable relative to the body 209-6-1. In particular, the cap 210-6-1 is slideable and can slide along a longitudinal axis of the body 209-6-1. The cap 210-6-1 is configured for receipt of both heat-not-burn consumable and e-cigarette consumables. In other embodiments of the system, different caps may be fitted to the device depending on whether the device is to be used with a heat-not-burn consumable or an e-cigarette consumable.

The device 201-6-1 comprises an output means (forming part of the UI of the device 201-6-1) in the form of a plurality of light-emitting diodes (LEDs) 211 arranged linearly along the longitudinal axis of the device 201-6-1 and on an outer surface of the body 209-6-1 of the device 201-6-1. A button 212-6-1 is also arranged on an outer surface of the body 209-6-1 of the device 201-6-1 and is axially spaced (i.e., along the longitudinal axis) from the plurality of LEDs 211-6-1.

Figure 6C:
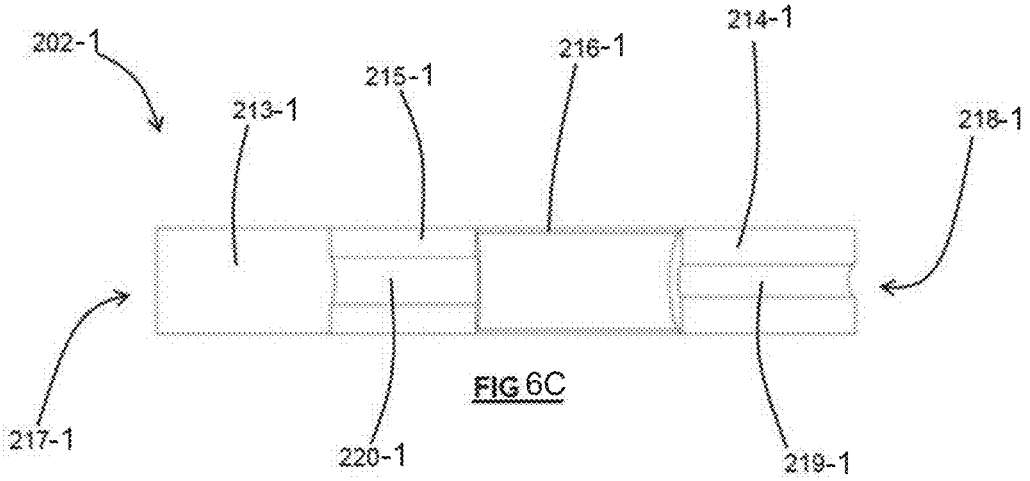
FIG. 6C is a section view of the consumable of the first embodiment of the smoking substitute system.

FIG. 6C shows a detailed section view of an exemplary heat-not-burn consumable of 202 of the system 200-6-1. The heat-not-burn consumable 202-6-1 generally resembles a cigarette. In that respect, the consumable 202-6-1 has a generally cylindrical form with a diameter of 7 mm and an axial length of 70 mm. The consumable 202-6-1 comprises an aerosol forming substrate 213-6-1, a terminal filter element 214-6, an upstream filter element 215-6 and a spacer element 216-6-1. In other embodiments, the consumable may further comprise a cooling element. A cooling element may exchange heat with vapor that is formed by the aerosol-forming substrate 213-6-1 in order to cool the vapor so as to facilitate condensation of the vapor.

The aerosol-forming substrate 213-6-1 is substantially cylindrical and is located at an upstream end 217-6-1 of the consumable 202-6-1, and comprises the aerosol former of the system 200-6-1. In that respect, the aerosol forming substrate 213-6-1 is configured to be heated by the device 201-6-1 to release a vapor. The released vapor is subsequently entrained in an airflow flowing through the aerosol-forming substrate 213-6-1. The airflow is produced by the action of the user drawing on a downstream 218 (i.e., terminal or mouth) end of the consumable 202-6-1.

In the present embodiment, the aerosol forming substrate 213-6-1 comprises tobacco material that may, for example, include any suitable parts of the tobacco plant (e.g., leaves, stems, roots, bark, seeds and flowers). The tobacco may comprise one or more of leaf tobacco, stem tobacco, tobacco powder, tobacco dust, tobacco derivatives, expanded tobacco, homogenized tobacco, shredded tobacco, extruded tobacco, cut rag tobacco and/or reconstituted tobacco (e.g., slurry recon or paper recon). For example, the aerosol-forming substrate 213-6-1 may comprise a gathered sheet of homogenized (e.g., paper/slurry recon) tobacco or gathered shreds/strips formed from such a sheet.

In order to generate an aerosol, the aerosol forming substrate 213-6-1 comprises at least one volatile compound that is intended to be vaporized/aerosolized and that may provide the user with a recreational and/or medicinal effect when inhaled. The aerosol-forming substrate 213-6-1 may further comprise one or more additives. For example, such additives may be in the form of humectants (e.g., propylene glycol and/or vegetable glycerin), flavorants, fillers, aqueous/non-aqueous solvents and/or binders.

The terminal filter element 214-6 is also substantially cylindrical, and is located downstream of the aerosol forming substrate 213-6-1 at the downstream end 218-6-1 of the consumable 202-6-1. The terminal filter element 214-6 is in the form of a hollow bore filter element having a bore 219-6-1 (e.g., for airflow) formed there through. The diameter of the bore 219-6-1 is 2 mm. The terminal filter element 214-6 is formed of a porous (e.g., monoacetate) filter material. As set forth above, the downstream end 218-6-1 of the consumable 202-6-1 (i.e., where the terminal filter 214-6-1 is located) forms a mouthpiece portion of the consumable 202-6-1 upon which the user draws. Airflow is drawn from the upstream end 217-6-1, thorough the components of the consumable 202-6-1, and out of the downstream end 218-6-1. The airflow is driven by the user drawing on the downstream end 218-6-1 (i.e., the mouthpiece portion) of the consumable 202-6-1.

The upstream filter element 215-6 is located axially adjacent to the aerosol-forming substrate 213-6-1, between the aerosol-forming substrate 213-6-1 and the terminal filter element 214-6-1. Like the terminal filter 214-6-1, the upstream filter element 215-6 is in the form of a hollow bore filter element, such that it has a bore 220-6-1 extending axially there through. In this way, the upstream filter 215-6-1 may act as an airflow restrictor. The upstream filter element 215-6 is formed of a porous (e.g., monoacetate) filter material. The bore 220-6-1 of the upstream filter element 215-6 has a larger diameter (3 mm) than the terminal filter element 214-6-1.

The spacer 216-6-1 is in the form of a cardboard tube, which defines a cavity or chamber between the upstream filter element 215-6 and the terminal filter element 214-6-1. The spacer 216-6-1 acts to allow both cooling and mixing of the vapor/aerosol from the aerosol-forming substrate 213-6-1. The spacer has an external diameter of 7 mm and an axial length of 14 mm.

Although not apparent from the figure, the aerosol-forming substrate 213-6-1, upstream filter 215-6-1 and spacer 216-6-1 are circumscribed by a paper wrapping layer. The terminal filter 214-6-1 is circumscribed by a tipping layer that also circumscribes a portion of the paper wrapping layer (so as to connect the terminal filter 214-6-1 to the remaining components of the consumable 202-6-1). The upstream filter 215-6-1 and terminal filter 214-6-1 are circumscribed by further wrapping layers in the form of plug wraps.

Figure 6D:
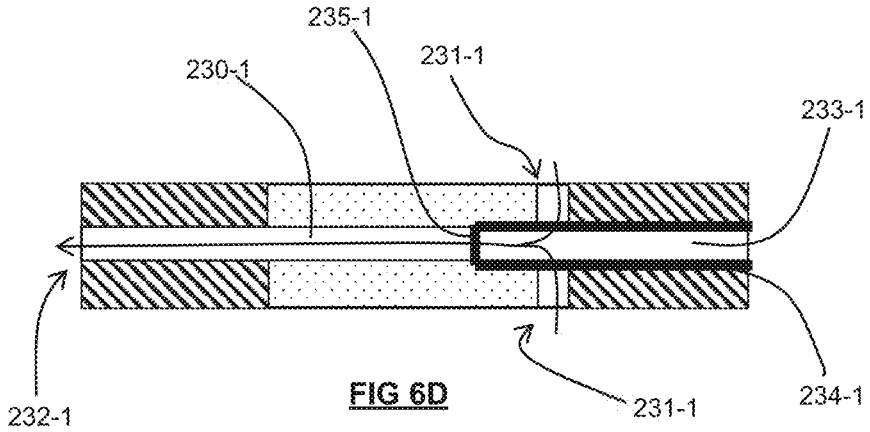
FIG. 6D is a section view of a further consumable of the first embodiment of the smoking substitute system.

FIG. 6D illustrates an exemplary e-cigarette consumable 202-6-1' for use with the device 201-6-1. As is apparent from the figure, the e-cigarette consumable 202-6-1' comprises a similar external form to the heat-not-burn consumable 202-6-1 described above. The e-cigarette consumable 202-6-1' comprises an aerosol-former in the form of a tank 213'-1 filled with e-liquid. This tank 213'-1 comprises a passage 230-1 extending longitudinally there through. This passage 230-1 is in fluid connection with inlets 231-1 and an outlet 232-1 of the consumable 202-6-1' such that air inhaled by a user at the outlet 232-1 is drawn through the passage 230-1 from the inlets 231-1 (as illustrated by arrow).

The consumable 202-6-1' further comprises a recess 233-1 for receipt of a heating element 223-6-1 of the device 201-6-1 (discussed further below). The recess 233-1 is lined with a heat transfer element 234-1 in the form of a metallic tube. The heat transfer element 234-1 is connected to a heating filament (not shown) that is wound about a porous wick 235-1, and comprises apertures there through (not shown) that allow air to pass from the inlets 231-1 to the passage 230-1. The porous wick 235-1 extends transversely across the passage 230-1 such that the ends of the porous wick 235-1 are submerged in e-liquid stored in the tank 213'-1 and a central portion of the wick 235-1 is exposed to air flowing through the passage 230-1. Thus, in operation, heat is transferred from the heating element 223-6-1 of the device to the porous wick 235-1 (via the heat transfer element 234-1). This causes e-liquid held in the porous wick 235-1 to vaporize, so as to be entrained in the air flowing through the passage 230-1. This vapor entrained in the air may subsequently cool so as to form an aerosol that is inhaled by the user.

Figure 6E:
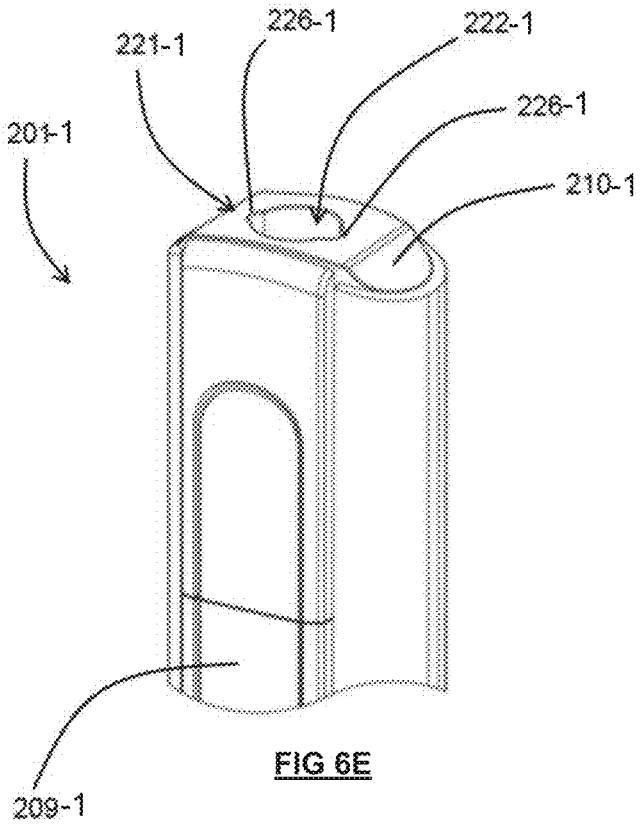
FIG. 6E is a detailed view of an end of the device of the first embodiment of the smoking substitute system.

Returning now to the device 201-6-1, FIG. 6E illustrates a detailed view of the end of the device 201-6-1 that is configured to engage with the consumable 202-6-1 (either in the form of an e-cigarette consumable 202-6-1' or in the form of a heat-not-burn consumable 202-6-1). The cap 210-6-1 of the device 201-6-1 includes an opening 221-6-1 to an internal cavity 222-6-1 (more apparent from FIG. 6D) defined by the cap 210-6-1. The opening 221-6-1 and the cavity 222-6-1 are formed so as to receive at least a portion of the consumable 202-6-1. During engagement of the consumable 202-6-1 with the device 201-6-1, a portion of the consumable 202-6-1 is received through the opening 221-6-1 and into the cavity 222-6-1. After engagement (see FIG. 6B), the downstream end 218-6-1 of the consumable 202-6-1 protrudes from the opening 221-6-1 and thus also protrudes from the device 201-6-1. The opening 221-6-1 includes laterally disposed notches 226-6-1. When a consumable 202-6-1 is received in the opening 221-6-1, these notches 226-6-1 remain open and could, for example, be used for retaining a cover in order to cover the end of the device 201-6-1.

Figure 6F:
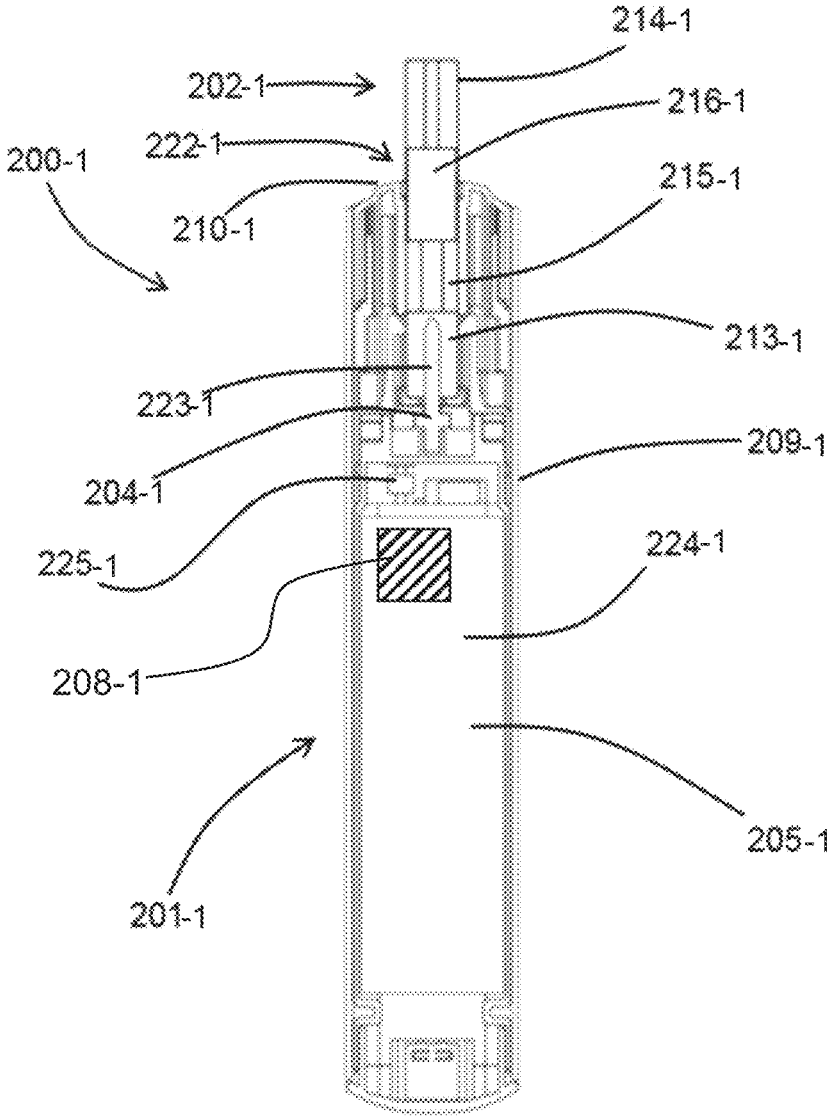
FIG. 6F is a section view of the first embodiment of the substitute smoking system.

FIG. 6F shows a cross section through a central longitudinal plane through the device 201-6-1. The device 201-6-1 is shown with a consumable 202-6-1 engaged therewith (in this case, a heat-not-burn consumable 202-6-1).

The device 201-6-1 comprises a heater 204-6-1 comprising heating element 223-6-1. The heater 204-6-1 forms part of the body 209-6-1 of the device 201-6-1 and is rigidly mounted to the body 209-6-1. In the illustrated embodiment, the heater 204-6-1 is a rod heater with a heating element 223-6-1 having a circular transverse profile. In other embodiments the heater may be in the form of a blade heater (e.g., heating element with a rectangular transverse profile) or a tube heater (e.g., heating element with a tubular form).

The heating element 223-6-1 of the heater 204-6-1 projects from an internal base of the cavity 222-6-1 along a longitudinal axis towards the opening 221-6-1. As is apparent from the figure, the length (i.e., along the longitudinal axis) of the heating element is less than a depth of the cavity 222-6-1. In this way, the heating element 223-6-1 does not protrude from or extend beyond the opening 221-6-1.

When the consumable 202-6-1 is received in the cavity 222-6-1 (as is shown in FIG. 6E), the heating element 223-6-1 penetrates the aerosol-forming substrate 213-6-1 of the consumable 202-6-1. In particular, the heating element 223-6-1 extends for nearly the entire axial length of the aerosol-forming substrate 213-6-1 when inserted therein. Thus, when the heater 204-6-1 is activated, heat is transferred radially from an outer circumferential surface the heating element 223-6-1 to the aerosol-forming substrate 213-6-1.

The device 201-6-1 further comprises an electronics cavity 224-6-1. A power source, in the form of a rechargeable battery 205-6-1 (a lithium ion battery), is located in electronics cavity 224-6-1.

The device 201-6-1 includes a connector (i.e., forming part of an IO module of the device 201-6-1) in the form of a USB port 206-6-1. The connector may alternatively be, for example, a micro-USB port or a USB-C port for examples. The USB port 206-6-1 may be used to recharge the rechargeable battery 205-6-1.

The device 201-6-1 includes a controller 208-6-1 located in the electronics cavity 224-6-1. The controller comprises a microcontroller mounted on a printed circuit board (PCB). The USB port 206-6-1 is also connected to the controller 208-6-1 (i.e., connected to the PCB and microcontroller).

As will be described further below, the controller 208-6-1 is configured to control at least one function of the device 202-6-1. For example, the controller 208-6-1 is configured to control the operation of the heater 204-6-1 (e.g., in first and second heating modes). Such control of the operation of the heater 204-6-1 may be accomplished by the controller toggling the electrical connection of the rechargeable battery 205-6-1 to the heater 204-6-1. For example, the controller 208-6-1 is configured to control the heater 204-6-1 in response to a user depressing the button 212-6-1. Depressing the button 212-6-1 may cause the controller to allow a voltage (from the rechargeable battery 205-6-1) to be applied to the heater 204-6-1 (so as to cause the heating element 223-6-1 to be heated).

The controller is also configured to control the LEDs 211-6-1 in response to (e.g., a detected) a condition of the device 201-6-1 or the consumable 202-6-1. For example, the controller may control the LEDs to indicate whether the device 201-6-1 is in an on state or an off state (e.g., one or more of the LEDs may be illuminated by the controller when the device is in an on state).

The device 201-6-1 comprises a further input means (i.e., in addition to the button 212-6-1) in the form of a puff sensor 225-6-1. The puff sensor 225-6-1 is configured to detect a user drawing (i.e., inhaling) at the downstream end 218-6-1 of the consumable 202-6-1. The puff sensor 225-6-1 may, for example, be in the form of a pressure sensor, flow meter or a microphone. The puff sensor 225-6-1 is operatively connected to the controller 208-6-1 in the electronics cavity 224-6-1, such that a signal from the puff sensor 225-6-1, indicative of a puff state (i.e., drawing or not drawing), forms an input to the controller 208-6-1 (and can thus be responded to by the controller 208-6-1).

Figure 7:
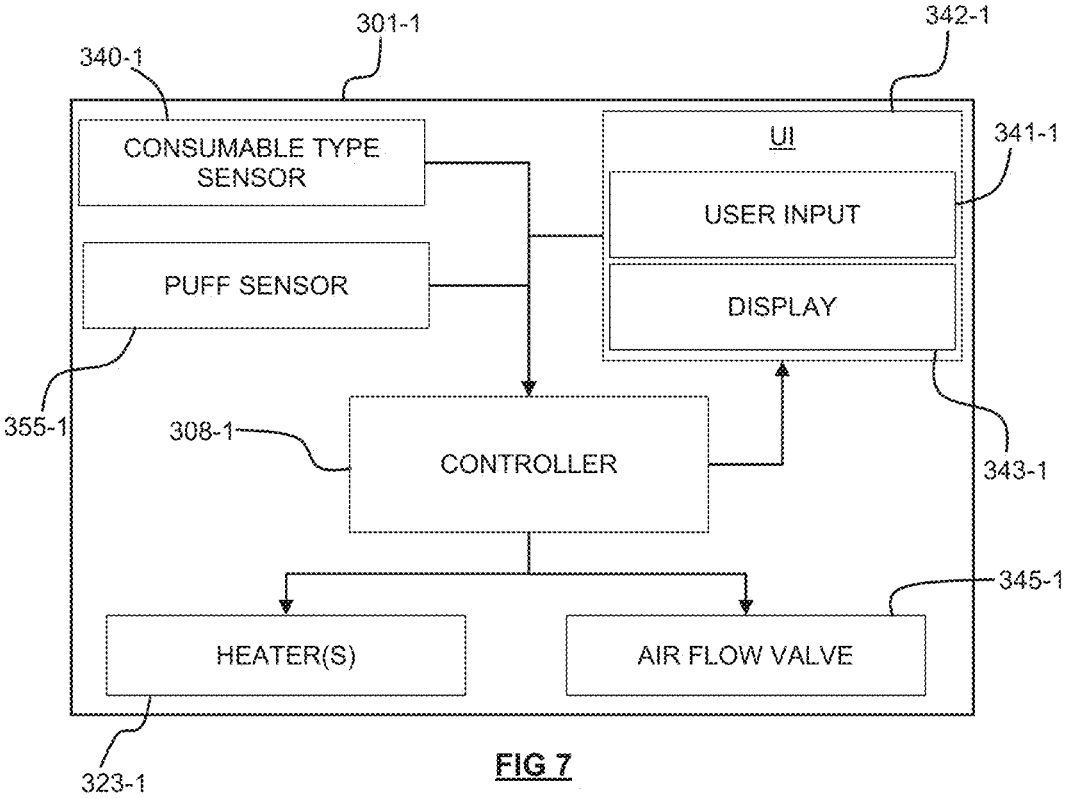
FIG. 7 is a schematic providing a general overview of a smoking substitute device.

FIG. 7 is a schematic depicting how the various components of a device 301-6-1 (i.e., such as the device 201-6-1 described above) may be operatively connected. The device 301-6-1 comprises a controller 308-1 that is able to control one or more heaters 323-1 of the device 301-6-1. In particular, the controller 308-1 is configured to control the heaters 323-1 according to one of two heating modes. A first of the heating modes is for heating a heat-not-burn consumable and a second of the heating modes is for heating an e-cigarette consumable. Thus, the device 301-6-1 is capable of operating with both types of consumable.

The controller 308-1 is configured to switch between these two modes both automatically and manually. To switch automatically, the controller 308-1 is connected to a consumable type sensor 340-1. This sensor 340-1 is able to detect the type of consumable (i.e., e-cigarette or heat-not-burn) that is engaged with the device 301-6-1. The sensor 340-1 may take a number of forms including, for example, a barcode scanner, RFID sensor, light detector, colour detector, mechanical switch/button. The sensor 340-1 provides a signal to the controller 308-1 that is indicative of the consumable type. The controller switches between the two heating modes based on this signal.

Manual switching may be provided by a user input 341-1 forming part of a UI 342-1 of the device 301-6-1. The user input 341-1 may be in the form of a button, switch or e.g., a touch screen. In this case, a user can select between the two heating modes, and a signal that is indicative of the selection is provided from the user input 341-1 to the controller. This may be used to override the automatic selection made by the controller, or may be used in the absence of an automatic selection.

The controller 308-1 is operatively connected to a display 343-1 of the device 301-6-1 and can therefore control the display 343-1 to indicate (to a user) the current heating mode. When in the first heating mode the controller 308-1 is configured to, on receipt of a "start" signal, activate the one or more heaters 323-1 for a predetermined period of time (e.g., 4 minutes). This "start" signal is received from the user input 341-1. At any point during the predetermined time period, if a "stop" signal is received from the user input 341-1, the controller 308-1 will deactivate the one or more heaters 323-1.

In the second heating mode, the controller 308-1 is configured to activate the one or more heaters 323-1 in response to a signal received from a puff sensor 355-1 of the device 301-6-1. The puff sensor 355-1 may, for example, be in the form of a pressure sensor or an acoustic sensor, and is configured to detect inhalation by a user (i.e., through a mouthpiece of the device or consumable). In this second mode, the one or more heaters 323-1 are only activated whilst an inhalation is detected.

The controller 308-1 is further operatively connected to an air flow valve 345-1 valve 345-1. This valve 345-1 controls airflow to a consumable engaged with the device 301-6-1. The controller 308-1 is configured to move this valve 345-1 to different positions (i.e., resulting in different air flows) in the first and second heating modes. In particular, the controller 308-1 is configured to control the valve 345-1 to allow a larger airflow in the second heating mode.

As should be appreciated, the control of the one or more heaters 323-1 is dependent on the nature of the one or more heaters 323-1. For example, where there are multiple heaters 323-1, different combinations of heaters 323-1 may be activated in the first and second heating modes. Further, the or each heater 323-1 may have a plurality of heating tracks and different combinations of heating tracks may be activated in the first and second heating modes.

Figure 8A:
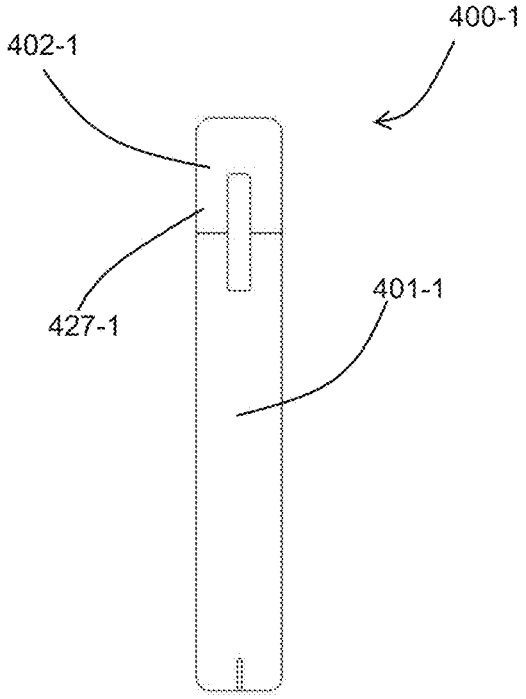
FIG. 8A is a front view of a second embodiment of the second mode of a smoking substitute system with the consumable engaged with the device.
Figure 8B:
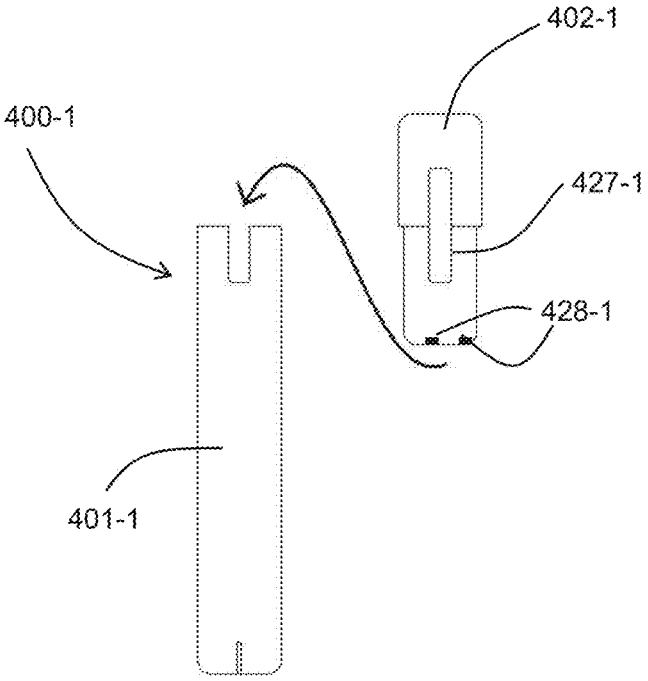
FIG. 8B is a front view of a second embodiment of the smoking substitute system with the consumable disengaged from the device.

FIG. 8A and FIG. 8B illustrate a further smoking substitute system 400-1. The system 300-1 is an example of the system 100-6-1 of FIG. 1 and comprises a device 401-1 that is compatible with e-cigarette and heat-not-burn consumables. In the present case, only the e-cigarette consumable 402-1 consumable 402-1 is illustrated and described. The description of FIG. 5 above is applicable to the system of FIG. 8A and FIG. 8B, and will not be repeated.

The device 401-1 and the consumable 402-1 are configured such that the consumable 402-1 can be engaged with the device 401-1. FIG. 8A shows the device 401-1 and the consumable 402-1 in an engaged state, whilst FIG. 8B shows the device 401-1 and the consumable 402-1 in a disengaged state. During engagement a portion of the consumable 402-1 is received in a cavity 422-1 of the device 401-1. The consumable 402-1 is retained in the device 401-1 via an interference fit (although in other embodiments, the device and consumable could be engaged by screwing one onto (or onto) the other, through a bayonet fitting, or by way of a snap engagement mechanism).

The e-cigarette consumable 402-1 consumable 402-1 includes a tank 427-1. The tank 427-1 defines a reservoir for the storage of an aerosol-former, which in this embodiment, is in the form of e-liquid.

In this present embodiment, the consumable 402-1 is a "single-use" consumable. That is, upon exhausting the e-liquid in the tank 427-1, the intention is that the user disposes of the whole consumable 402-1 consumable 402-1. In other embodiments, the e-liquid (i.e., aerosol former) may be the only part of the system that is truly "single-use". In such embodiments, the tank may be refillable with e-liquid or the e-liquid may be stored in a non-consumable component of the system. For example, the e-liquid may be stored in a tank located in the device or stored in another component that is itself not single-use (e.g., a refillable cartomizer).

In the illustrated system 400-1, a heat transfer element is located in the consumable 402-1 and is configured to heat and vaporize the e-liquid (stored in the tank 427-1). Although not shown, the heat transfer element provides heat to a porous wick via a resistive heating element. The porous wick conveyse-liquid from the tank 427-1 to the heating element. The heating element is a heating filament that is helically wound around a portion of the porous wick, such that when the heating element is heated, heat is transferred from the heating element to the e-liquid conveyed by the wick. This transfer of heat vaporizes the e-liquid and the resultant vapor is entrained in an airflow passing through the consumable 402-1 (i.e., driven by a user drawing on a downstream end 418-1 of the consumable 402-1). Between the vaporization point at the coil and the downstream end 418-1 (i.e., the mouth end), the vapor condenses into an aerosol, and is subsequently inhaled by the user.

Like the previously described embodiment, the device 401-1 comprises a power source in the form of a rechargeable battery (not shown) and a connector in the form of a USB port (not shown). The device 401-1 further comprises controller (also not shown). The rechargeable battery, connector and controller are similar (and operate in a similar manner) to the corresponding components of the embodiment described above with respect to FIG. 6A to FIG. 6F and FIG. 7.

The consumable 402-1 includes a pair of heater transfer contacts 428-1 disposed on a device-facing end surface of the consumable 402-1. The heater transfer contacts 428-1 form part of the heat transfer element, such that heat received from a heater of the device 401-1 (when the consumable is engaged with the device) is transferred to the heat transfer element via the heat transfer contacts 428-1.

The device 401-1 includes an output means (forming part of the UI of the system 400-1) in the form of a single light-emitting diode ("LED") 411. The LED 411-1 is operatively connected to the controller, such that controller can control the illumination of the LED 411-1. The controller is configured to illuminate the LED when then the heater 404-6-1 is active.

Third Mode of the Disclosure

Figure 9A:
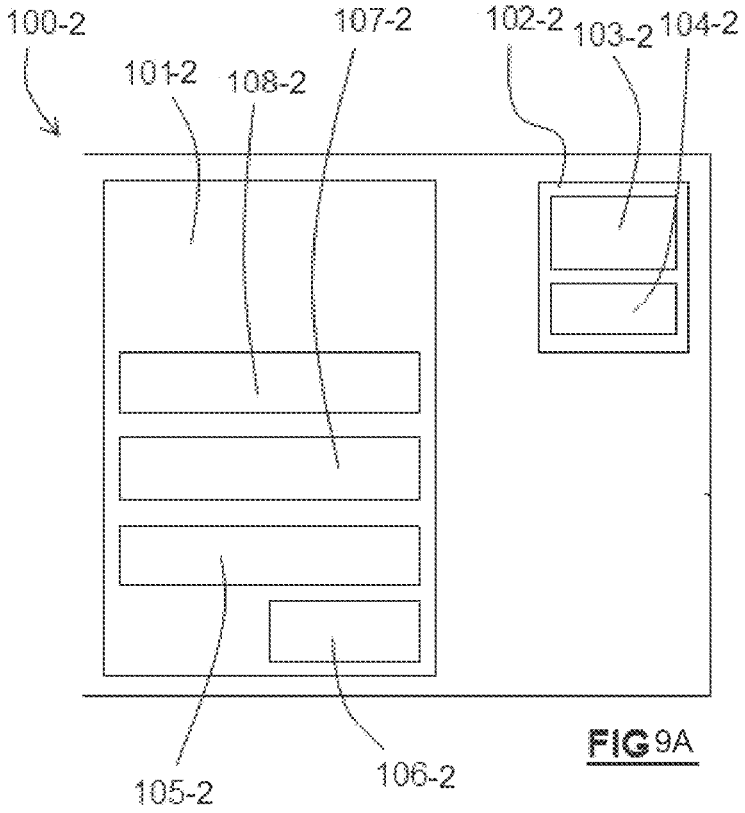
FIG. 9A is a schematic of a smoking substitute system.

FIG. 9A is a schematic providing a general overview of a smoking substitute system 100-6-2. The system 100-6-2 includes a substitute smoking device 101-6-2 and an aerosol-forming article in the form of a consumable 102-6-2, which comprises an aerosol former 103-6-2. The system is configured to vaporize the aerosol former by heating the aerosol former 103-6-2 (so as to form a vapor/aerosol for inhalation by a user).

In the illustrated system, the heater 104-6-2 forms part of the consumable 102-6-2 and is configured to heat the aerosol former 103-6-2. Heat from the heater 104-6-2 vaporizes the aerosol former 103-6-2 to produce a vapor.

30 The vapor subsequently condenses to form an aerosol, which is ultimately inhaled by the user.

The system 100-6-2 further comprises a power source 105-6-2 that forms part of the device 101-6-2. In other embodiments the power source 105-6-2 may be external to (but connectable to) the device 101-6-2. The power source 105-6-2 is electrically connectable to the heater 104-6-2 such that it is able to supply power to the heater 104-6-2 (i.e., for the purpose of heating the aerosol former 103-6-2). Thus, control of the electrical connection of the power source 105-6-2 to the heater 104-6-2 provides control of the state of the heater 104-6-2. The power source 105-6-2 may be a power store, for example a battery or rechargeable battery (e.g., a lithium ion battery).

The system 100-6-2 further comprises an I/O module comprising a connector 106-6-2 (e.g., in the form of a USB port, Micro USB port, USB-C port, etc.). The connector 106-6-2 is configured for connection to an external source of electrical power, e.g., a mains electrical supply outlet. The connector 106-6-2 may be used in substitution for the power source 105-6-2. That is the connector 106-6-2 may be electrically connectable to the heater 104-6-2 so as to supply electricity to the heater 104-6-2. In such embodiments, the device may not include a power source, and the power source of the system may instead comprise the connector 106-6-2 and an external source of electrical power (to which the connector 106-6-2 provides electrical connection).

In some embodiments, the connector 106-6-2 may be used to charge and recharge the power source 105-6-2 where the power source 104-2 includes a rechargeable battery.

The system 100-6-2 also comprises a user interface (UI) 107. Although not shown, the UI 107-6-2 may include input means to receive commands from a user. The input means of the UI 107-6-2 allows the user to control at least one aspect of the operation of the system 100-6-2. The input means may, for example, be in the form of a button, touchscreen, switch, microphone, etc.

The UI 107-6-2 also comprises output means to convey information to the user. The output means may, for example, comprise lights (e.g., LEDs), a display screen, speaker, vibration generator, etc.

The system 100-6-2 further comprises a controller 108-6-2 that is configured to control at least one function of the device 101-6-2. In the illustrated embodiment, the controller 108-6-2 is a component of the device 101-6-2, but in other embodiments may be separate from (but connectable to) the device 101-6-2. The controller 108-6-2 is configured to control the operation of the heater 104-6-2 and, for example, may be configured to control the voltage applied from the power source 105-6-2 to the heater 104-6-2. The controller 108-6-2 may be configured to toggle the supply of power to the heater 105-2 between an on state, in which the full output voltage of the power source 105-6-2 is applied to the heater 104-6-2, and an off state, in which the no voltage is applied to the heater 104-6-2.

Although not shown, the system 100-6-2 may also comprise a voltage regulator to regulate the output voltage from the power source 105-6-2 to form a regulated voltage. The regulated voltage may then be applied to the heater 104-6-2.

In addition to being connected to the heater 104-6-2, the controller 108-6-2 is operatively connected to the UI 107-6-2. Thus, the controller 108-6-2 may receive an input signal from the input means of the UI 107-6-2. Similarly, the controller 108-6-2 may transmit output signals to the UI 107-6-2. In response, the output means of the UI 107-6-2 may convey information, based on the output signals, to a user.

Figure 9B:
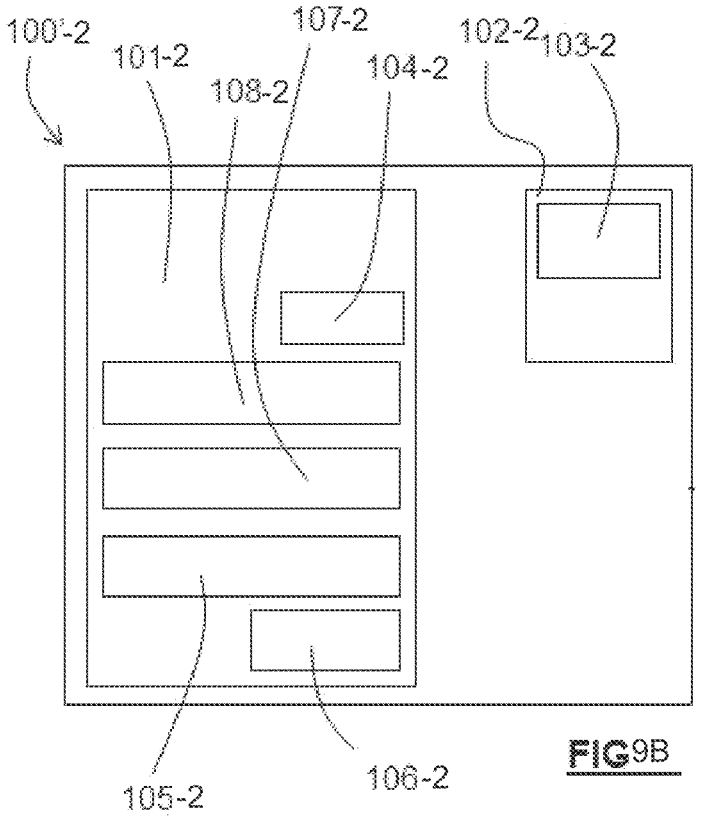
FIG. 9B is a schematic of a variation of the smoking substitute system of FIG. 9A.

FIG. 9B is a schematic showing a variation of the system 100-6-2 of FIG. 9A. In the system 100-6-2' of FIG. 9B, the heater 104-6-2 forms part of the consumable 102-6-2, rather than the device 101-6-2. In this variation, the heater 104-6-2 is electrically connectable to the power source 105-6-2, for example, when the consumable 102-6-2 is engaged with the device 101-6-2.

Figure 10A:
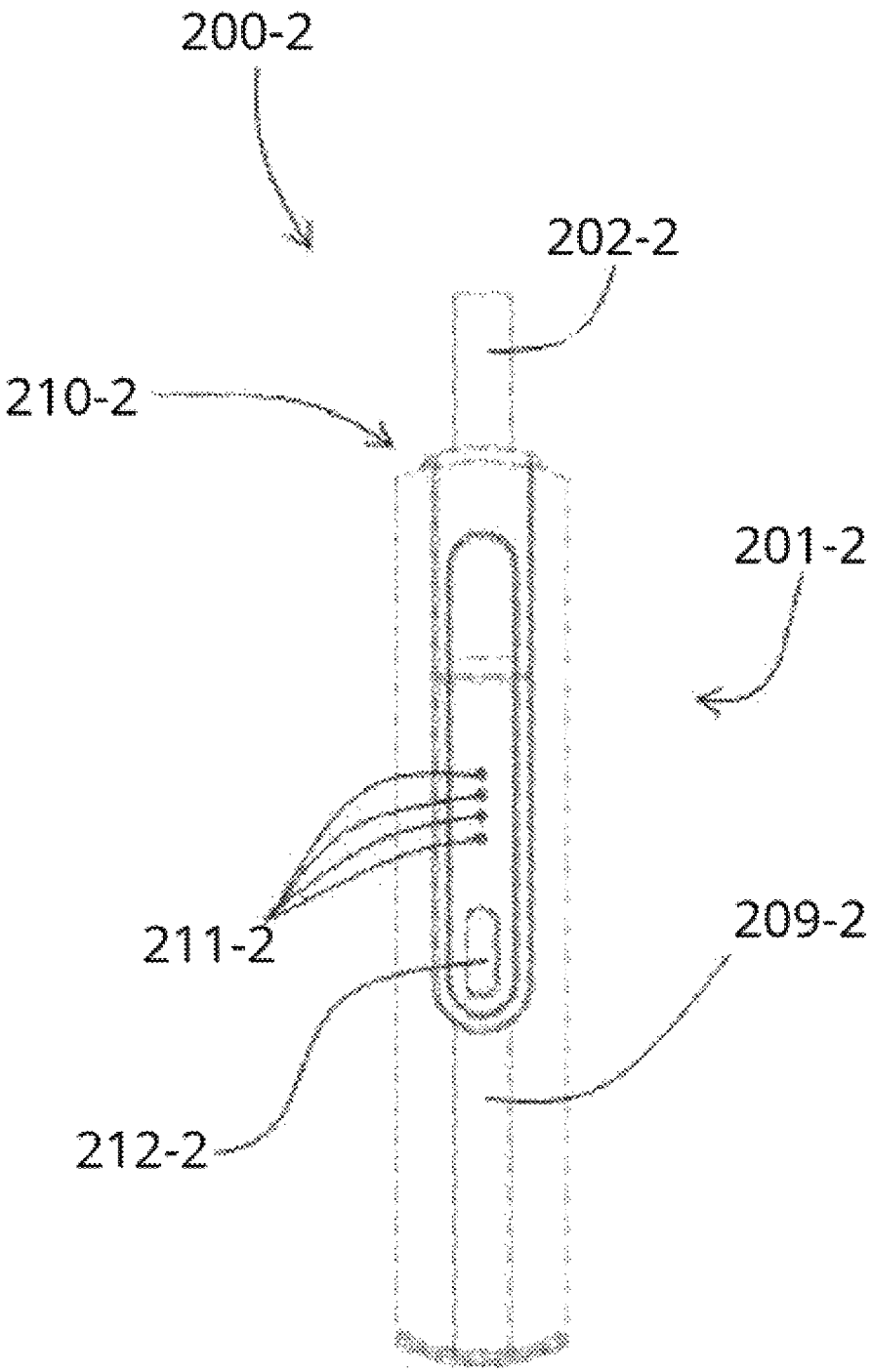
FIG. 10A is a front view of a first embodiment of the third mode of a smoking substitute system with the consumable engaged with the device.
Figure 10B:
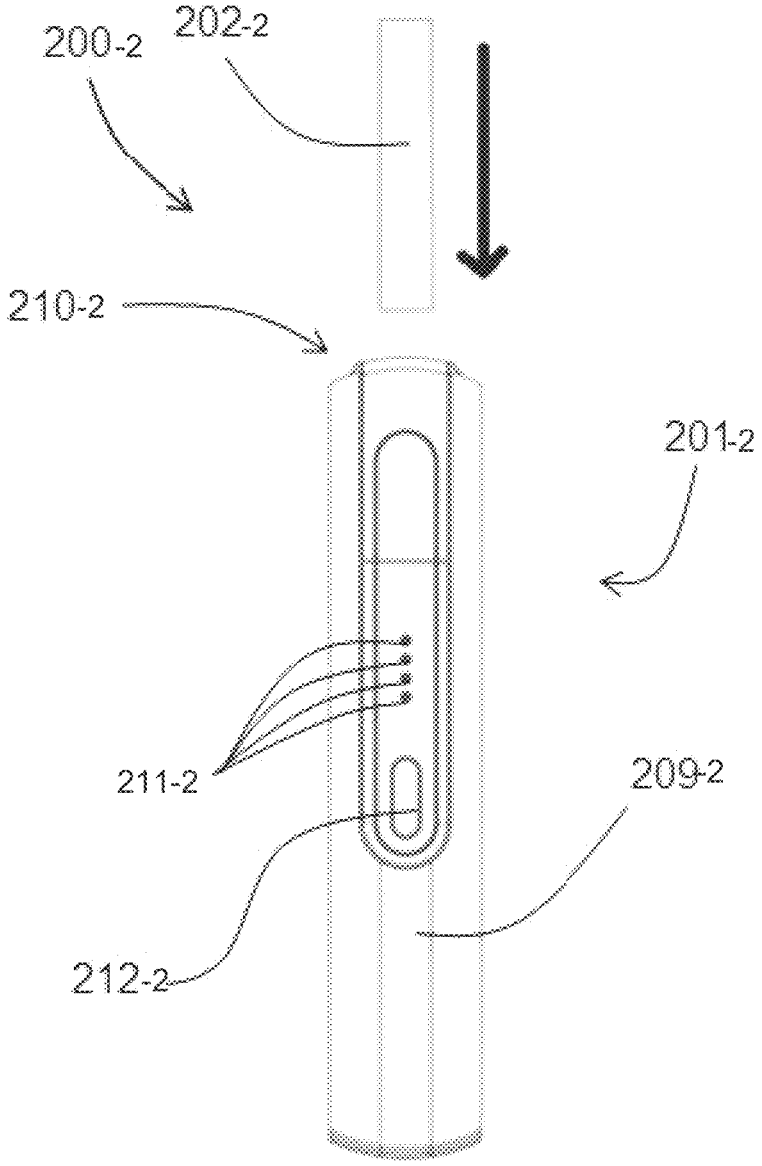
FIG. 10B is a front view of the first embodiment of the smoking substitute system with the consumable disengaged from the device.

FIG. 10A and FIG. 10B illustrate a heated-tobacco (HT) smoking substitute system 200-6-2. The system 200-6-2 is an example of the systems 100-6-2, 100' described in relation to FIG. 9A or FIG. 9B. System 200-6-2 includes an HT device 201-6-2 and an HT consumable 202-6-2. The description of FIG. 9A and FIG. 9B above is applicable to the system 200-6-2 of FIG. 10A and FIG. 10B, and will thus not be repeated.

The device 201-6-2 and the consumable 202-6-2 are configured such that the consumable 202-6-2 can be engaged with the device 201-6-2. FIG. 10A shows the device 201-6-2 and the consumable 202-6-2 in an engaged state, whilst FIG. 10B shows the device 201-6-2 and the consumable 202-6-2 in a disengaged state.

The device 201-6-2 comprises a body 209-6-2 and cap 210-6-2. In use the cap 209-2 is engaged at an end of the body 209-6-2. Although not apparent from the figures, the cap 210-6-2 is moveable relative to the body 209-6-2. In particular, the cap 210-6-2 is slideable and can slide along a longitudinal axis of the body 209-6-2.

The device 201-6-2 comprises an output means (forming part of the UI of the device 201-6-2) in the form of a plurality of light-emitting diodes (LEDs) 211 arranged linearly along the longitudinal axis of the device 201-6-2 and on an outer surface of the body 209-6-2 of the device 201-6-2. A button 212-6-2 is also arranged on an outer surface of the body 209-6-2 of the device 201-6-2 and is axially spaced (i.e., along the longitudinal axis) from the plurality of LEDs 211-6-2.

Figure 10C:
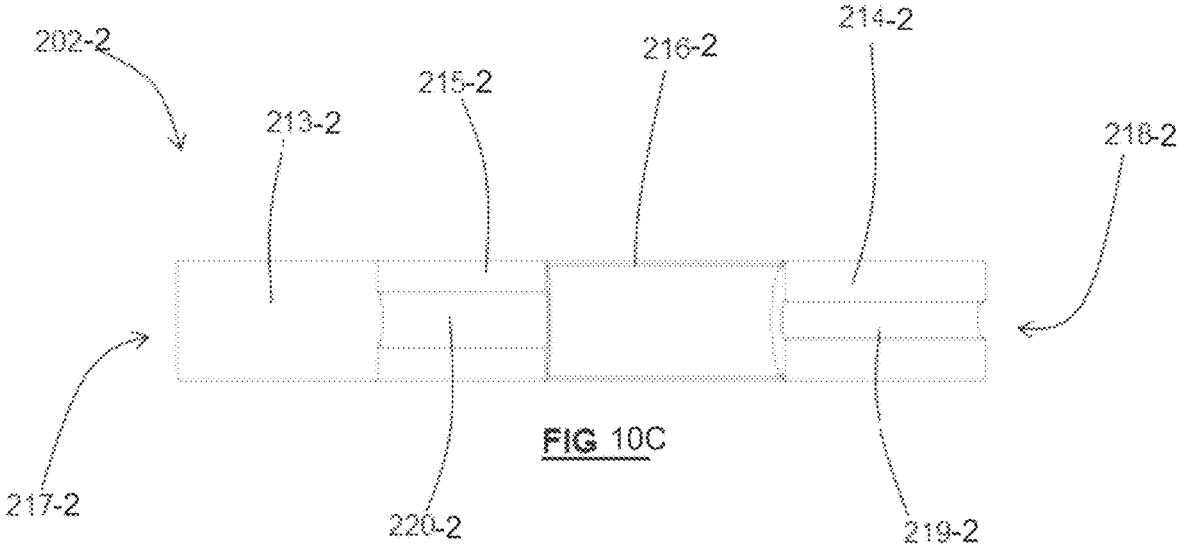
FIG. 10C is a section view of the consumable of the first embodiment of the smoking substitute system.

FIG. 10C show a detailed section view of the consumable of 202 of the system 200-6-2. The consumable 202-6-2 generally resembles a cigarette. In that respect, the consumable 202-6-2 has a generally cylindrical form with a diameter of 7 mm and an axial length of 70 mm. The consumable 202-6-2 comprises an aerosol forming substrate 213-6-2, a terminal filter element 214-6-2, an upstream filter element 215-6-2 and a spacer element 216-6-2. In other embodiments, the consumable may further comprise a cooling element. A cooling element may exchange heat with vapor that is formed by the aerosol-forming substrate 213-6-2 in order to cool the vapor so as to facilitate condensation of the vapor.

The aerosol-forming substrate 213-6-2 is substantially cylindrical and is located at an upstream end 217-6-2 of the consumable 202-6-2, and comprises the aerosol former of the system 200-6-2. In that respect, the aerosol forming substrate 213-6-2 is configured to be heated by the device 201-6-2 to release a vapor. The released vapor is subsequently entrained in an airflow flowing through the aerosol-forming substrate 213-6-2. The airflow is produced by the action of the user drawing on a downstream 218 (i.e., terminal or mouth end) of the consumable 202-6-2.

In the present embodiment, the aerosol forming substrate 213-6-2 comprises tobacco material that may, for example, include any suitable parts of the tobacco plant (e.g., leaves, stems, roots, bark, seeds and flowers). The tobacco may comprise one or more of leaf tobacco, stem tobacco, tobacco powder, tobacco dust, tobacco derivatives, expanded tobacco, homogenized tobacco, shredded tobacco, extruded tobacco, cut rag tobacco and/or reconstituted tobacco (e.g., slurry recon or paper recon). For example, the aerosol-forming substrate 213-6-2 may comprise a gathered sheet of homogenized (e.g., paper/slurry recon) tobacco or gathered shreds/strips formed from such a sheet.

In order to generate an aerosol, the aerosol forming substrate 213-6-2 comprises at least one volatile compound that is intended to be vaporized/aerosolized and that may provide the user with a recreational and/or medicinal effect when inhaled. The aerosol-forming substrate 213-6-2 may further comprise one or more additives. For example, such additives may be in the form of humectants (e.g., propylene glycol and/or vegetable glycerin), flavorants, fillers, aqueous/non-aqueous solvents and/or binders.

The terminal filter element 214-6-2 is also substantially cylindrical, and is located downstream of the aerosol forming substrate 213-6-2 at the downstream end 218-6-2 of the consumable 202-6-2. The terminal filter element 214-6-2 is in the form of a hollow bore filter element having a bore 219-6-2 (e.g., for airflow) formed there through. The diameter of the bore 219-6-2 is 2 mm. The terminal filter element 214-6-2 is formed of a porous (e.g., monoacetate) filter material. As set forth above, the downstream end 218-6-2 of the consumable 202-6-2 (i.e., where the terminal filter 214-6-2 is located) forms a mouthpiece portion of the consumable 202-6-2 upon which the user draws. Airflow is drawn from the upstream end 217-6-2, thorough the components of the consumable 202-6-2, and out of the downstream end 218-6-2. The airflow is driven by the user drawing on the downstream end 218-6-2 (i.e., the mouthpiece portion) of the consumable 202-6-2.

The upstream filter element 215-6-2 is located axially adjacent to the aerosol-forming substrate 213-6-2, between the aerosol-forming substrate 213-6-2 and the terminal filter element 214-6-2. Like the terminal filter 214-6-2, the upstream filter element 215-6-2 is in the form of a hollow bore filter element, such that it has a bore 220-6-2 extending axially there through. In this way, the upstream filter 215-6-2 may act as an airflow restrictor. The upstream filter element 215-6-2 is formed of a porous (e.g., monoacetate) filter material. The bore 220-6-2 of the upstream filter element 214 has a larger diameter (3 mm) than the terminal filter element 214-6-2.

The spacer 216-6-2 is in the form of a cardboard tube, which defines a cavity or chamber between the upstream filter element 215-6-2 and the terminal filter element 214-6-2. The spacer 216-6-2 acts to allow both cooling and mixing of the vapor/aerosol from the aerosol-forming substrate 213-6-2. The spacer has an external diameter of 7 mm and an axial length of 14 mm.

Although not apparent from the figure, the aerosol-forming substrate 213-6-2, upstream filter 215-6-2 and spacer 216-6-2 are circumscribed by a paper wrapping layer. The terminal filter 214-6-2 is circumscribed by a tipping layer that also circumscribes a portion of the paper wrapping layer (so as to connect the terminal filter 214-6-2 to the remaining components of the consumable 202-6-2). The upstream filter 215-6-2 and terminal filter 214-6-2 are circumscribed by further wrapping layers in the form of plug wraps.

Figure 10D:
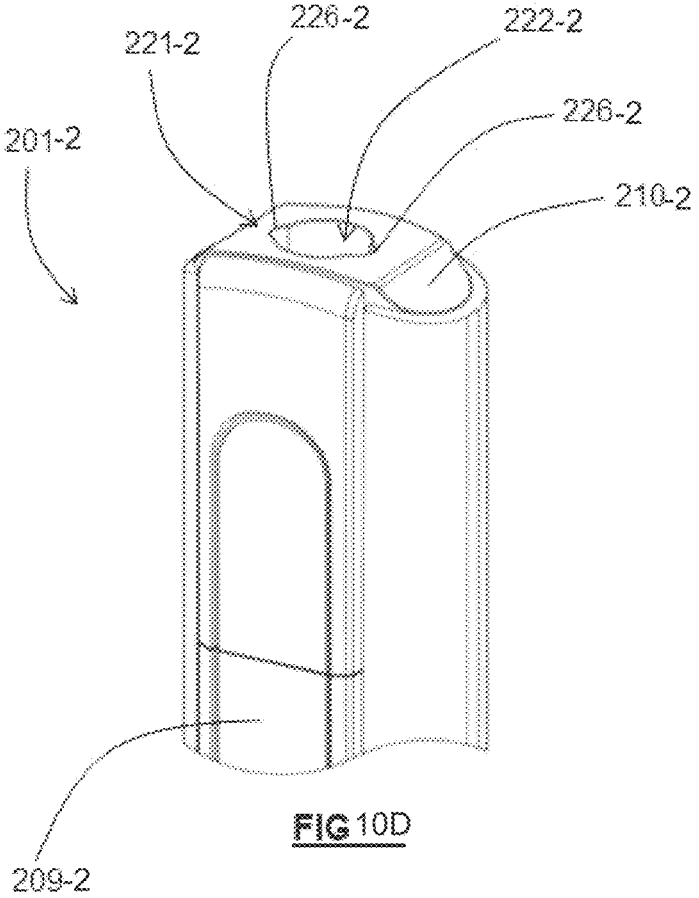
FIG. 10D is a detailed view of an end of the device of the first embodiment of the smoking substitute system.

Returning now to the device 201-6-2, FIG. 10D illustrates a detailed view of the end of the device 201-6-2 that is configured to engage with the consumable 202-6-2. The cap 210-6-2 of the device 201-6-2 includes an opening 221-6-2 to an internal cavity 222-6-2 (more apparent from FIG. 10D) defined by the cap 210-6-2. The opening 221-6-2 and the cavity 222-6-2 are formed so as to receive at least a portion of the consumable 202-6-2. During engagement of the consumable 202-6-2 with the device 201-6-2, a portion of the consumable 202-6-2 is received through the opening 221-6-2 and into the cavity 222-6-2. After engagement (see FIG. 10B), the downstream end 218-6-2 of the consumable 202-6-2 protrudes from the opening 221-6-2 and thus also protrudes from the device 201-6-2. The opening 221-6-2 includes laterally disposed notches 226-6-2. When a consumable 202-6-2 is received in the opening 221-6-2, these notches 226-6-2 remain open and could, for example, be used for retaining a cover in order to cover the end of the device 201-6-2.

Figure 10E:
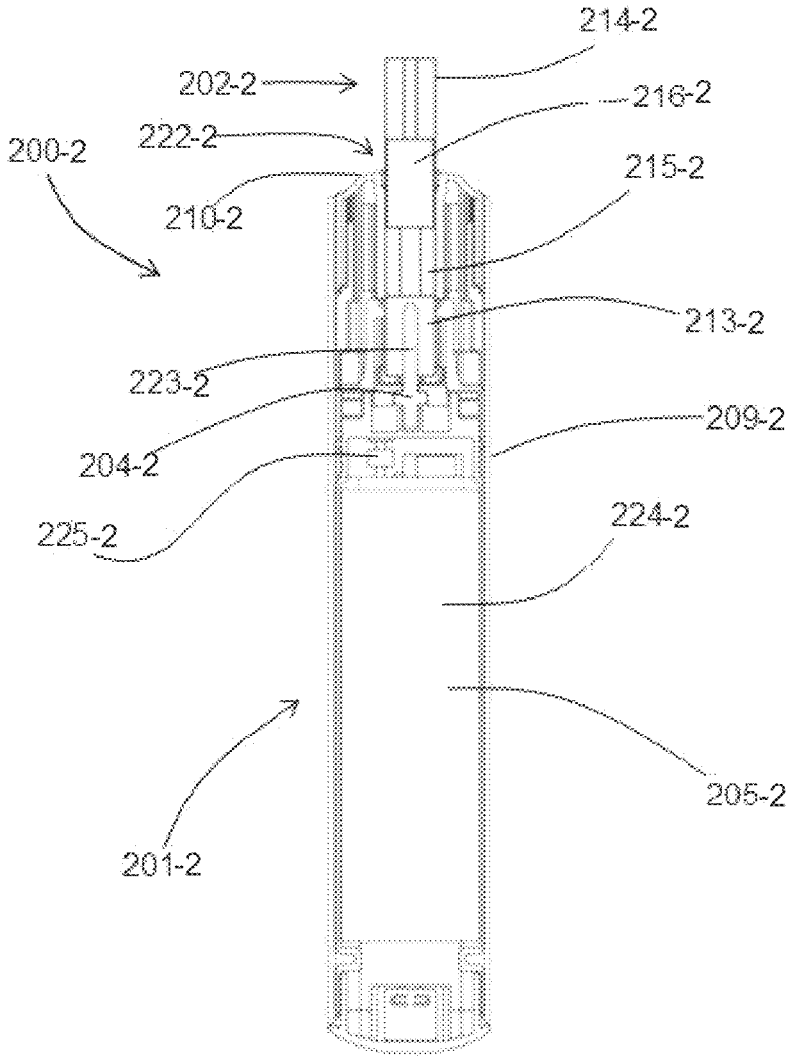
FIG. 10E is a section view of the first embodiment of the substitute smoking system.

FIG. 10E shows a cross section through a central longitudinal plane through the device 201-6-2. The device 201-6-2 is shown with the consumable 202-6-2 engaged therewith.

The device 201-6-2 comprises a heater 204-6-2 comprising heating element 223-6-2. The heater 204-6-2 is insertable into the aerosol-forming article. The heater 204-6-2 forms part of the body 209-6-2 of the device 201-6-2 and is rigidly mounted to the body 209-6-2. In the illustrated embodiment, the heater 204-6-2 is a rod heater with a heating element 223-6-2 having a circular transverse profile.

In other embodiments the heater may be in the form of a blade heater (e.g., heating element with a rectangular transverse profile) or a tube heater (e.g., heating element with a tubular form).

The heating element 223-6-2 of the heater 204-6-2 projects from an internal base of the cavity 222-6-2 along a longitudinal axis towards the opening 221-6-2. As is apparent from the figure, the length (i.e., along the longitudinal axis) of the heating element is less than a depth of the cavity 222-6-2. In this way, the heating element 223-6-2 does not protrude from or extend beyond the opening 221-6-2.

When the consumable 202-6-2 is received in the cavity 222-6-2 (as is shown in FIG. 10E), the heating element 223-6-2 penetrates the aerosol-forming substrate 213-6-2 of the consumable 202-6-2. In particular, the heating element 223-6-2 extends for nearly the entire axial length of the aerosol-forming substrate 213-6-2 when inserted therein. Thus, when the heater 204-6-2 is activated, heat is transferred radially from an outer circumferential surface the heating element 223-6-2 to the aerosol-forming substrate 213-6-2.

The device 202-6-2 further comprises an electronics cavity 224-6-2. A power source, in the form of a rechargeable battery 205-6-2 (a lithium ion battery), is located in electronics cavity 224-6-2.

The device 202-6-2 includes a connector (i.e., forming part of an IO module of the device 201-6-2) in the form of a USB port 206-6-2. The connector may alternatively be, for example, a micro-USB port or a USB-C port for examples. The USB port 206-6-2 may be used to recharge the rechargeable battery 205-6-2.

The device 202-6-2 includes a controller (not shown) located in the electronics cavity 224-6-2. The controller comprises a microcontroller mounted on a printed circuit board (PCB). The USB port 206-6-2 is also connected to the controller 208-6-2 (i.e., connected to the PCB and microcontroller).

The controller 208-6-2 is configured to control at least one function of the device 202-6-2. For example, the controller 208-6-2 is configured to control the operation of the heater 204-6-2. Such control of the operation of the heater 204-6-2 may be accomplished by the controller toggling the electrical connection of the rechargeable battery 205-6-2 to the heater 204-6-2. For example, the controller 208-6-2 is configured to control the heater 204-6-2 in response to a user depressing the button 212-6-2. Depressing the button 212-6-2 may cause the controller to allow a voltage (from the rechargeable battery 205-6-2) to be applied to the heater 204-6-2 (so as to cause the heating element 223-6-2 to be heated).

Figure 11:
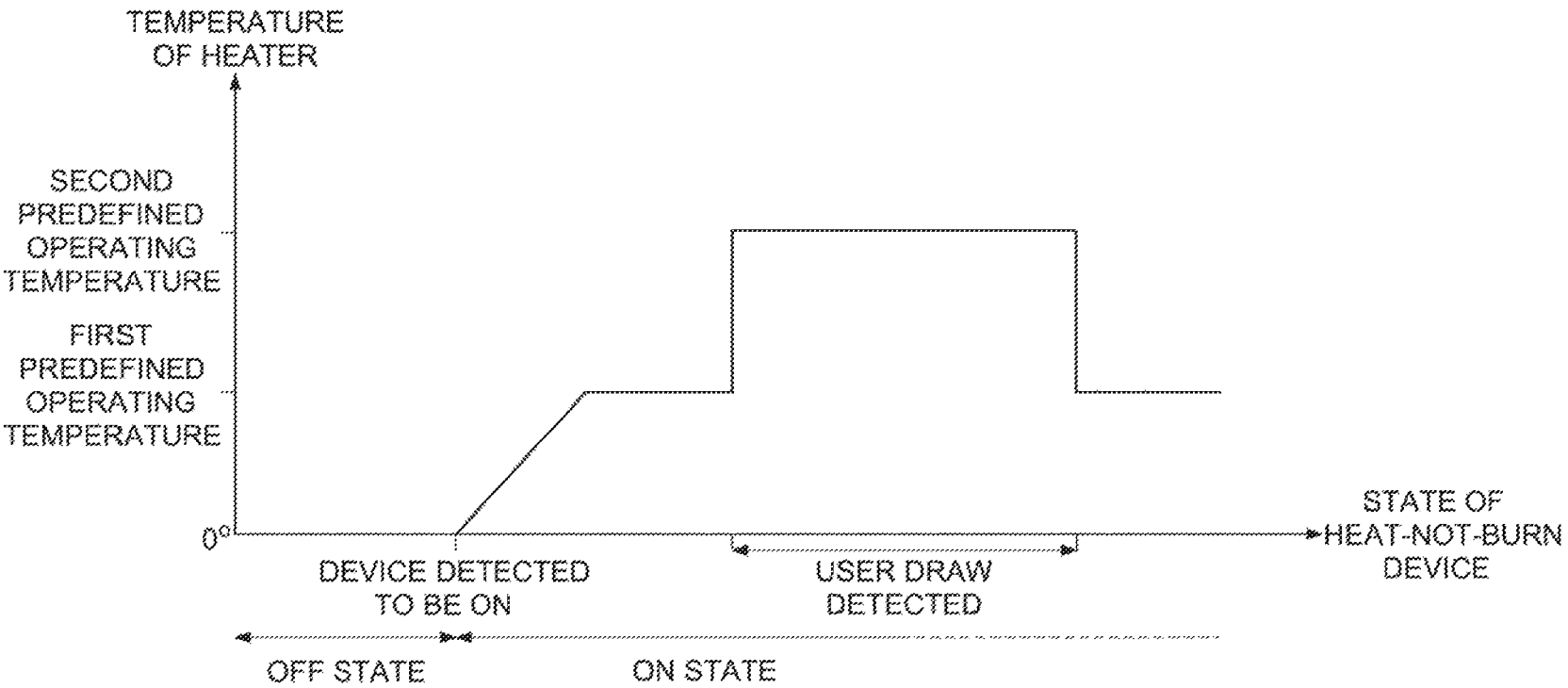
FIG. 11 is a graph illustrating controlling of operation of the heater of the device.

In some embodiments, the controller is configured to operate the heater 204-6-2 such that the heater 204-6-2 is heated to a first predefined target operating temperature when the device 202-6-2 is switched ON and when the user is not puffing on the consumable (the off-puff period). Further, the controller is configured to operate the heater 204-6-2 such that the heater 204-6-2 is heated to a second predefined target operating temperature when a user draw is detected. The first predefined operating temperature is lower than the second predefined operating temperature. FIG. 11 shows a graph illustrating controlling of operation of the heater 204-6-2 of the device 202-6-2. The Y-axis of the graph indicates operating temperature of the heater 204-6-2. The Xx-axis of the graph indicates state of the device 202-6-2 with time. The state of the device 202-6-2 may be ON-state or OFF-state. The state of the device 202-6-2 may be ON-state when the device 202-6-2 is switched ON and the state of the device 202-6-2 may be OFF-state when the device 202-6-2 is switched OFF. The controller may be configured to operate the heater 204-6-2 at the first predefined target operating temperature or at the second predefined target operating temperature as shown in the graph, depending on puff state (on-puff or off-puff). When the device is in the OFF state no power is supplied to the heater, and consequently the heater is at the environmental temperature (e.g., room temperature). When the device 202-6-2 is detected to be in ON-state, or switched to an ON state, the heater 204-6-2 may be controlled to be heated up to the first predefined target operating temperature. In some embodiments, when the device 202-6-2 is detected to be in ON-state, the temperature of the heater 204-6-2 may be gradually increased up to the first predefined target operating temperature. In some embodiments, when the device 202-6-2 is detected to be in ON-state, the temperature of the heater 204-6-2 may be directly increased to the first predefined target operating temperature.

In some embodiments, the first predefined target operating temperature may be selected to be below vapor-forming temperature for at least one component of the aerosol forming article. The aerosol-forming temperature may be a temperature at which the aerosol-forming article may be heated but may not form aerosol. For example, the first predefined operating temperature may be between 150 and 280 degrees Celsius; more particularly, between 150 and 190 Celsius, and more particularly substantially 170 degree Celsius.

During ON-state of the device 202-6-2, when a user draw is detected, the controller may control the heater 204-6-2 to heat to the second predefined target operating temperature as shown in FIG. 11. In some embodiments, the second predefined target operating temperature may be selected to be above for at least one component of the aerosol forming article. That is, at the second predefined operating temperature, the aerosol-forming article may be heated enough to form an aerosol for inhalation by the user. For example, the second predefined operating temperature may be between 280 and 360 degrees Celsius, more particularly between 300 and 250 degrees Celsius; more particularly, substantially 350° C. The heater 204-6-2 may be maintained at the second predefined operating temperature until the user draw is no longer detected by the device 202-6-2. Upon detecting that the user is not drawing, the target operating temperature may be decreased to the first predefined target operating temperature from the second predefined target operating temperature. The controller may then again power the heater to the first target operating temperature until the device is switched OFF (whereupon power is ceased and the temperature falls to environmental temperature) or until another user puff is detected (whereupon the device controls power supplied to the heater to maintain it at to the second target operating temperature again).

In some embodiments, the controller may be configured to control the power source to control the operation of the heater 204-6-2. An amount of electrical power supplied for heating the heater 204-6-2 may be varied to vary the temperature of the heater 204-6-2.

In some embodiments, the controller may be operatively connected to a wireless communication module of the device (e.g., a Bluetooth module). A user compute device (e.g., mobile phone) may be wirelessly connected to the wireless communication module and thus to the device 202-6-2. The controller may be configured to communicate information associated with the operation of the heater 204-6-2 to the user compute device. In some embodiments the information may include, but is not limited to, at least one of temperature of the heater 204-6-2, state of the device 202-6-2, detection of user puff, status of aerosol formation in the device 202-6-2, user consumption, by way of examples only. One or more other information, relating operation of the heater 204-6-2, may be communicated to the user device, by the controller.

The controller is also configured to control the LEDs 211-6-2 in response to (e.g., a detected) a condition of the device 201-6-2 or the consumable 202-6-2. For example, the controller may control the LEDs to indicate whether the device 201-6-2 is in an on state or an off state (e.g., one or more of the LEDs may be illuminated by the controller when the device is in an on state). In some embodiments, the controller is configured to illuminate one or more of the LEDs 211-6-2 when a puff is detected by the controller.

The device 202-6-2 comprises a further input means (i.e., in addition to the button 212-6-2) in the form of a puff sensor 225-6-2. The puff sensor 225-6-2 is configured to detect a user drawing (i.e., inhaling) at the downstream end 218-6-2 of the consumable 202-6-2. The puff sensor 225-6-2 may, for example, be in the form of a pressure sensor, flow meter or a microphone. The puff sensor 225-6-2 is operatively connected to the controller 208-6-2 in the electronics cavity 224-6-2, such that a signal from the puff sensor 225-6-2, indicative of a puff state (i.e., drawing or not drawing), forms an input to the controller 208-6-2 (and can thus be responded to by the controller 208-6-2).

Figure 12:
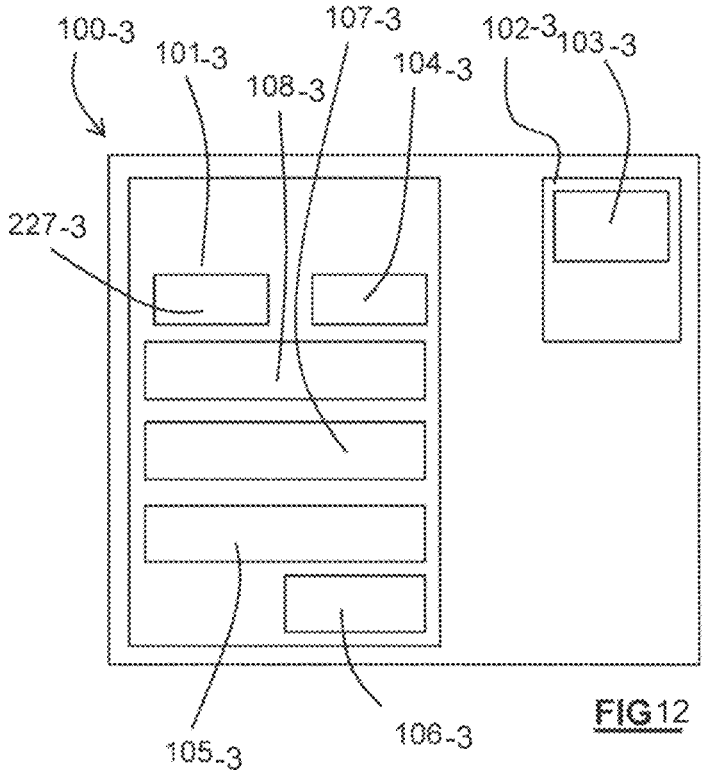
FIG. 12 is a schematic of a smoking substitute system.

Fourth Mode of the Disclosure FIG. 12 is a schematic providing a general overview of a smoking substitute system 100-6-3. The system 100-6-3 includes a substitute smoking device 101-6-3 and an aerosol-forming article in the form of a consumable 102-6-3, which comprises an aerosol former 103-6-3. The system is configured to vaporize the aerosol former by heating the aerosol former 103-6-3 (so as to form a vapor/aerosol for inhalation by a user).

In the illustrated system, the heater 104-6-3 forms part of the consumable 102-6-3 and is configured to heat the aerosol former 103-6-3. In this variation, the heater 104-6-3 is electrically connectable to the power source 105-6-3, for example, when the consumable 102-6-3 is engaged with the device 101-6-3. Heat from the heater 104-6-3 vaporizes the aerosol former 103-6-3 to produce a vapor. The vapor subsequently condenses to form an aerosol, which is ultimately inhaled by the user.

The system 100-6-3 further comprises a power source 105-6-3 that forms part of the device 101-6-3. In other embodiments the power source 105-6-3 may be external to (but connectable to) the device 101-6-3. The power source 105-6-3 is electrically connectable to the heater 104-6-3 such that it is able to supply power to the heater 104-6-3 (i.e., for the purpose of heating the aerosol former 103-6-3). Thus, control of the electrical connection of the power source 105-6-3 to the heater 104-6-3 provides control of the state of the heater 104-6-3. The power source 105-6-3 may be a power store, for example a battery or rechargeable battery (e.g., a lithium ion battery).

The system 100-6-3 further comprises an I/O module comprising a connector 106-6-3 (e.g., in the form of a USB port, Micro USB port, USB-C port, etc.). The connector 106-6-3 is configured for connection to an external source of electrical power, e.g., a mains electrical supply outlet. The connector 106-6-3 may be used in substitution for the power source 105-6-3. That is the connector 106-6-3 may be electrically connectable to the heater 104-6-3 so as to supply electricity to the heater 104-6-3. In such embodiments, the device may not include a power source, and the power source of the system may instead comprise the connector 106-6-3 and an external source of electrical power (to which the connector 106-6-3 provides electrical connection).

In some embodiments, the connector 106-6-3 may be used to charge and recharge the power source 105-6-3 where the power source 105-6-3 includes a rechargeable battery.

The system 100-6-3 also comprises a user interface (UI) 107. Although not shown, the UI 107-6-3 may include input means to receive commands from a user. The input means of the UI 107-6-3 allows the user to control at least one aspect of the operation of the system 100-6-3. The input means may, for example, be in the form of a button, touchscreen, switch, microphone, etc.

The UI 107-6-3 also comprises output means to convey information to the user. The output means may, for example, comprise lights (e.g., LEDs), a display screen, speaker, vibration generator, etc.

The system 100-6-3 further comprises a controller 108-6-3 that is configured to control at least one function of the device 101-6-3. In the illustrated embodiment, the controller 108-6-3 is a component of the device 101-6-3, but in other embodiments may be separate from (but connectable to) the device 101-6-3. The controller 108-6-3 is configured to control the operation of the heater 104-6-3 and, for example, may be configured to control the voltage applied from the power source 105-6-3 to the heater 104-6-3. The controller 108-6-3 may be configured to toggle the supply of power to the heater 104-6-3 between an on state, in which the full output voltage of the power source 105-6-3 is applied to the heater 104-6-3, and an off state, in which the no voltage is applied to the heater 104-6-3.

Although not shown, the system 100-6-3 may also comprise a voltage regulator to regulate the output voltage from the power source 105-6-3 to form a regulated voltage. The regulated voltage may then be applied to the heater 104-6-3.

In addition to being connected to the heater 104-6-3, the controller 108-6-3 is operatively connected to the UI 107-6-3. Thus, the controller 108-6-3 may receive an input signal from the input means of the UI 107-6-3. Similarly 20 the controller 108-6-3 may transmit output signals to the UI 107-6-3. In response, the output means of the UI 107-6-3 may convey information, based on the output signals, to a user. The controller also comprises a memory 109-6-3, which is a non-volatile memory. The memory 109-6-3 includes instructions, which, when implemented, cause the controller to perform certain tasks or steps of a method.

Figure 13B:
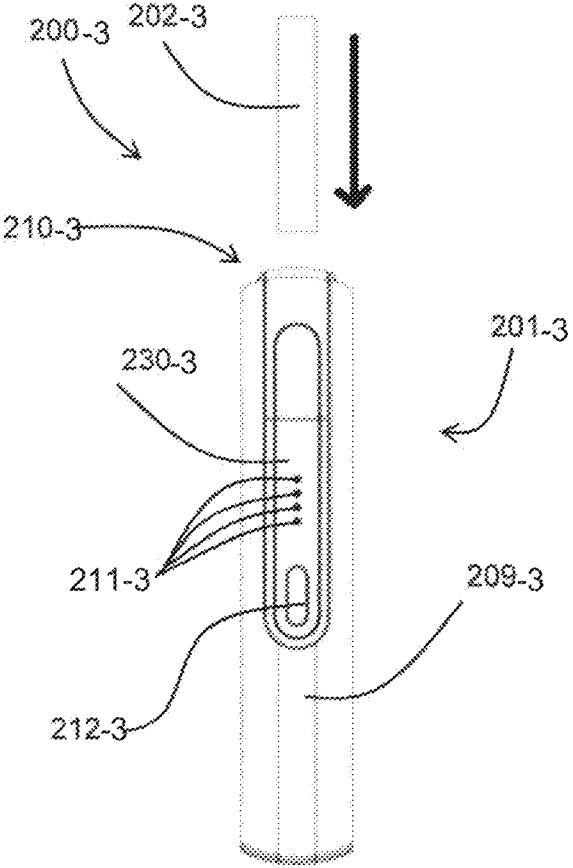
FIG. 13B is a front view of the first embodiment of the smoking substitute system with the consumable disengaged from the device.
Figure 13A:
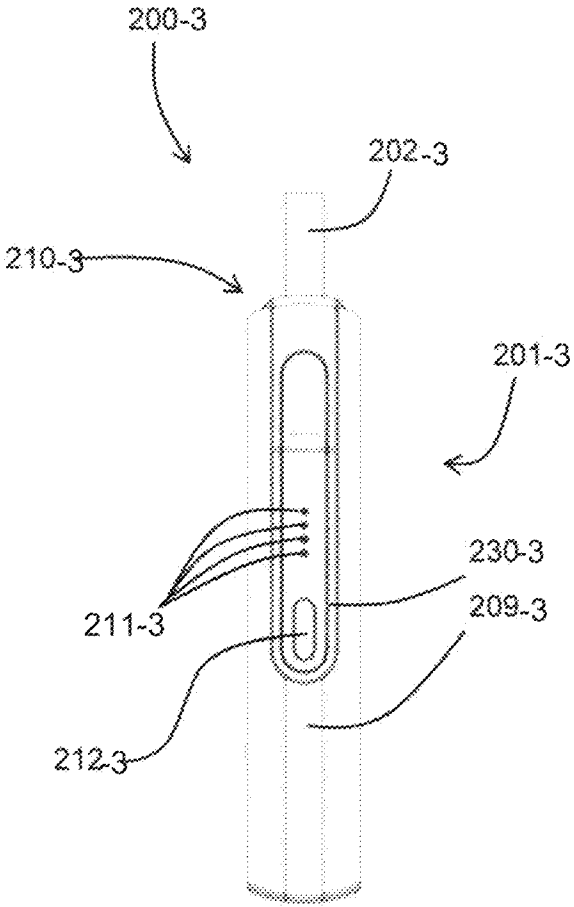
FIG. 13A is a front view of a first embodiment of a fourth mode of a smoking substitute system with the consumable engaged with the device.

FIG. 13A and FIG. 13B illustrate a heated-tobacco (HT) smoking substitute system 200-6-3. The system 200-6-3 is an example of the systems 100-6-3 described in relation to FIG. 1. System 200-6-3 includes an HT device 201-6-3 and an HT consumable 202-6-3. The description of FIG. 1 above is applicable to the system 200-6-3 of FIG. 13A and FIG. 13B, and will thus not be repeated.

The device 201-6-3 and the consumable 202-6-3 are configured such that the consumable 202-6-3 can be engaged with the device 201-6-3. FIG. 13A shows the device 201-6-3 and the consumable 202-6-3 in an engaged state, whilst FIG. 13B shows the device 201-6-3 and the consumable 202-6-3 in a disengaged state.

The device 201-6-3 comprises a body 209-6-3 and cap 210-6-3. In use the cap 210-6-3 is engaged at an end of the body 209-6-3. Although not apparent from the figures, the cap 210-6-3 is moveable relative to the body 209-6-3. In particular, the cap 210-6-3 is slideable and can slide along a longitudinal axis of the body 209-6-3.

The device 201-6-3 comprises an output means (forming part of the UI of the device 201-6-3) in the form of a plurality of light-emitting diodes (LEDs) 211 arranged linearly along the longitudinal axis of the device 201-6-3 and on an outer surface of the body 209-6-3 of the device 201-6-3. A button 212-6-3 is also arranged on an outer surface of the body 209-6-3 of the device 201-6-3 and is axially spaced (i.e., along the longitudinal axis) from the plurality of LEDs 211-6-3.

Figure 13C:
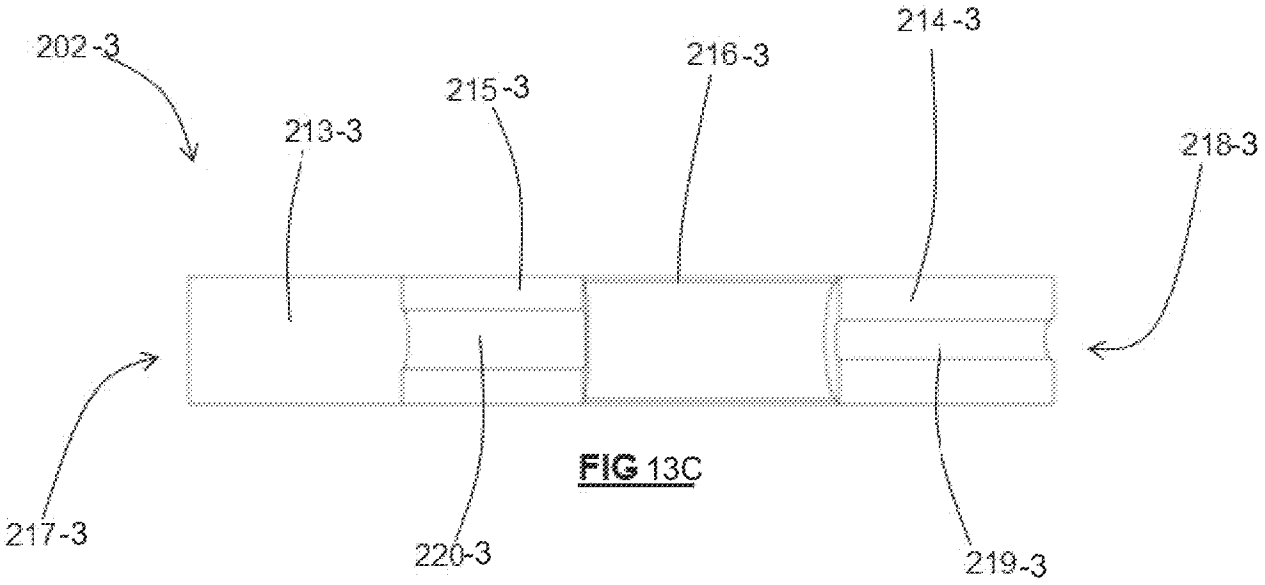
FIG. 13C is a section view of the consumable of the first embodiment of the smoking substitute system.

FIG. 13C show a detailed section view of the consumable of 202 of the system 200-6-3. The consumable 202-6-3 generally resembles a cigarette. In that respect, the consumable 202-6-3 has a generally cylindrical form with a diameter of 7 mm and an axial length of 70 mm. The consumable 202-6-3 comprises an aerosol forming substrate 213-6-3, a terminal filter element 214-6-3, an upstream filter element 215-6-3 and a spacer element 216-6. In other embodiments, the consumable may further comprise a cooling element. A cooling element may exchange heat with vapor that is formed by the aerosol-forming substrate 213-6-3 in order to cool the vapor so as to facilitate condensation of the vapor.

The aerosol-forming substrate 213-6-3 is substantially cylindrical and is located at an upstream end 217-6-3 of the consumable 202-6-3, and comprises the aerosol former of the system 200-6-3. In that respect, the aerosol forming substrate 213-6-3 is configured to be heated by the device 201-6-3 to release a vapor. The released vapor is subsequently entrained in an airflow flowing through the aerosol-forming substrate 213-6-3. The airflow is produced by the action of the user drawing on a downstream 218 (i.e., terminal or mouth) end of the consumable 202-6-3.

In the present embodiment, the aerosol forming substrate 213-6-3 comprises tobacco material that may, for example, include any suitable parts of the tobacco plant (e.g., leaves, stems, roots, bark, seeds and flowers). The tobacco may comprise one or more of leaf tobacco, stem tobacco, tobacco powder, tobacco dust, tobacco derivatives, expanded tobacco, homogenized tobacco, shredded tobacco, extruded tobacco, cut rag tobacco and/or reconstituted tobacco (e.g., slurry recon or paper recon). For example, the aerosol-forming substrate 213-6-3 may comprise a gathered sheet of homogenized (e.g., paper/slurry recon) tobacco or gathered shreds/strips formed from such a sheet.

In order to generate an aerosol, the aerosol forming substrate 213-6-3 comprises at least one volatile compound that is intended to be vaporized/aerosolized and that may provide the user with a recreational and/or medicinal effect when inhaled. The aerosol-forming substrate 213-6-3 may further comprise one or more additives. For example, such additives may be in the form of humectants (e.g., propylene glycol and/or vegetable glycerin), flavorants, fillers, aqueous/non-aqueous solvents and/or binders.

The terminal filter element 214-6-3 is also substantially cylindrical, and is located downstream of the aerosol forming substrate 213-6-3 at the downstream end 218-6-3 of the consumable 202-6-3. The terminal filter element 214-6-3 is in the form of a hollow bore filter element having a bore 219-6-3 (e.g., for airflow) formed there through. The diameter of the bore 219-6-3 is 2 mm. The terminal filter element 214-6-3 is formed of a porous (e.g., monoacetate) filter material. As set forth above, the downstream end 218-6-3 of the consumable 202-6-3 (i.e., where the terminal filter 214-6-3 is located) forms a mouthpiece portion of the consumable 202-6-3 upon which the user draws. Airflow is drawn from the upstream end 217-6-3, thorough the components of the consumable 202-6-3, and out of the downstream end 218-6-3. The airflow is driven by the user drawing on the downstream end 218-6-3 (i.e., the mouthpiece portion) of the consumable 202-6-3.

The upstream filter element 215-6-3 is located axially adjacent to the aerosol-forming substrate 213-6-3, between the aerosol-forming substrate 213-6-3 and the terminal filter element 214-6-3. Like the terminal filter 214-6-3, the upstream filter element 215-6-3 is in the form of a hollow bore filter element, such that it has a bore 220-6-3 extending axially there through. In this way, the upstream filter 215-6-3 may act as an airflow restrictor. The upstream filter element 215-6-3 is formed of a porous (e.g., monoacetate) filter material. The bore 220-6-3 of the upstream filter element 215-6-3 has a larger diameter (3 mm) than the terminal filter element 214-6-3.

The spacer 216-6-3 is in the form of a cardboard tube, which defines a cavity or chamber between the upstream filter element 215-6-3 and the terminal filter element 214-6-3. The spacer 216-6-3 acts to allow both cooling and mixing of the vapor/aerosol from the aerosol-forming substrate 213-6-3. The spacer has an external diameter of 7 mm and an axial length of 14 mm.

Although not apparent from the figure, the aerosol-forming substrate 213-6-3, upstream filter 215-6-3 and spacer 216-6-3 are circumscribed by a paper wrapping layer. The terminal filter 214-6-3 is circumscribed by a tipping layer that also circumscribes a portion of the paper wrapping layer (so as to connect the terminal filter 214-6-3 to the remaining components of the consumable 202-6-3). The upstream filter 215-6-3 and terminal filter 214-6-3 are circumscribed by further wrapping layers in the form of plug wraps.

Figure 13E:
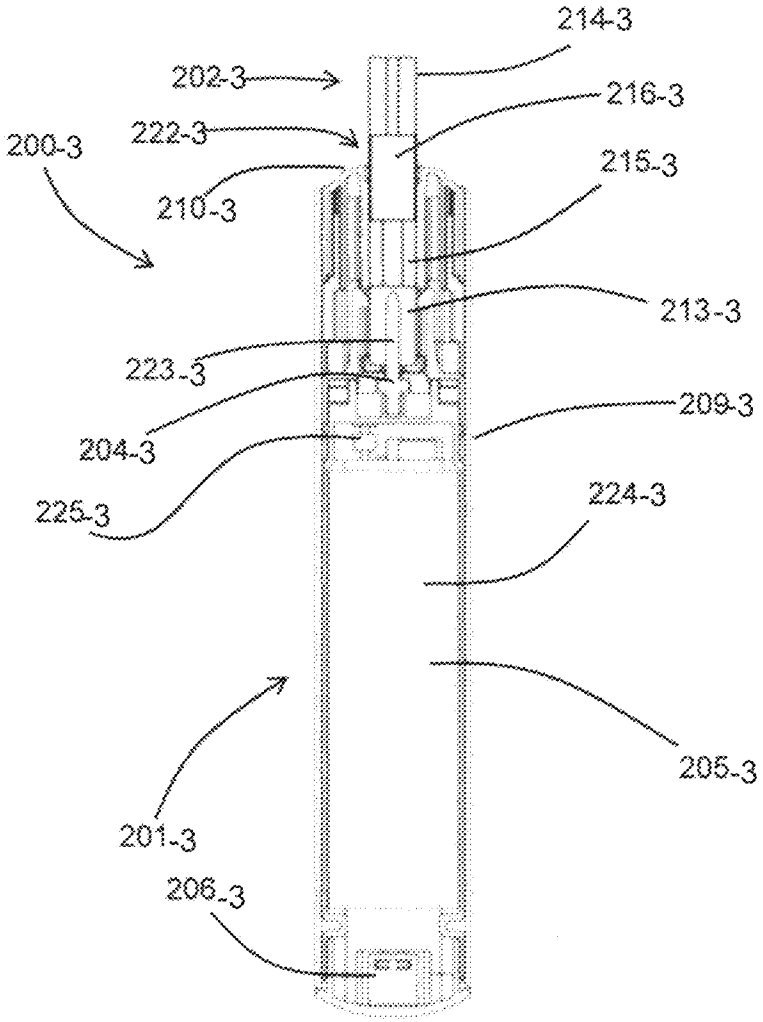
FIG. 13E is a section view of the first embodiment of the substitute smoking system.
Figure 13D:
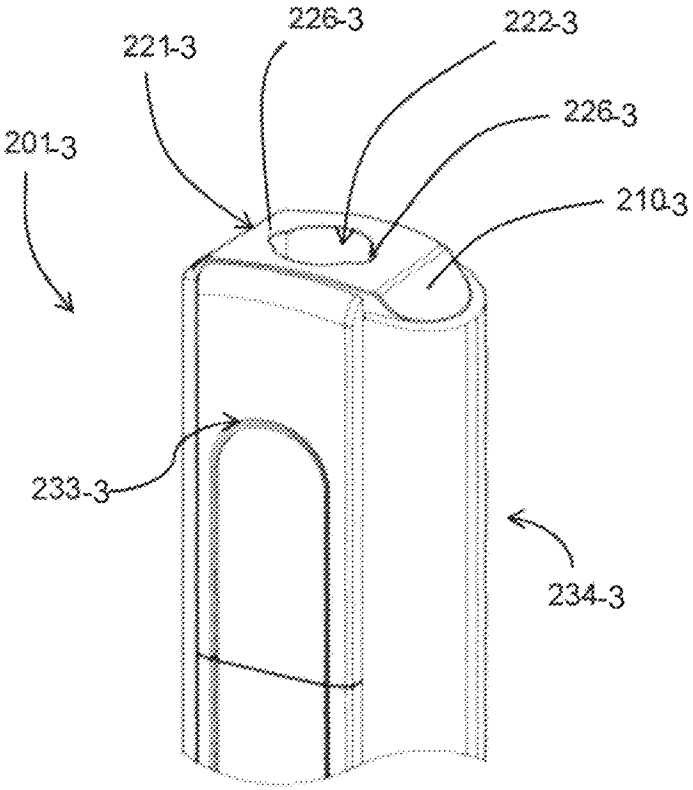
FIG. 13D is a detailed view of an end of the device of the first embodiment of the smoking substitute system.

Returning now to the device 201-6-3, FIG. 13D illustrates a detailed view of the end of the device 201-6-3 that is configured to engage with the consumable 202-6-3. The cap 210-6-3 of the device 201-6-3 includes an opening 221-6-3 to an internal cavity 222-6-3 (more apparent from FIG. 13D) defined by the cap 210-6-3. The opening 221-6-3 and the cavity 222-6-3 are formed so as to receive at least a portion of the consumable 202-6-3.

20 During engagement of the consumable 202-6-3 with the device 201-6-3, a portion of the consumable 202-6-3 is received through the opening 221-6-3 and into the cavity 222-6-3. After engagement (see FIG. 13B), the downstream end 218-6-3 of the consumable 202-6-3 protrudes from the opening 221-6-3 and thus also protrudes from the device 201-6-3. The opening 221-6-3 includes laterally disposed notches 226-6-3. When a consumable 202-6-3 is received in the opening 221-6-3, these notches 226-6-3 remain open and could, for example, be used for retaining a cover in order to cover the end of the device 201-6-3.

FIG. 13E shows a cross section through a central longitudinal plane through the device 201-6-3. The device 201-6-3 is shown with the consumable 202-6-3 engaged therewith.

The device 201-6-3 comprises a heater 204-6-3 comprising heating element 223-6-3. The heater 204-6-3 forms part of the body 209-6-3 of the device 201-6-3 and is rigidly mounted to the body 209-6-3. In the illustrated embodiment 30 the heater 204-6-3 is a rod heater with a heating element 223-6-3 having a circular transverse profile. In other embodiments the heater may be in the form of a blade heater (e.g., heating element with a rectangular transverse profile) or a tube heater (e.g., heating element with a tubular form).

The heating element 223-6-3 of the heater 204-6-3 projects from an internal base of the cavity 222-6-3 along a longitudinal axis towards the opening 221-6-3. As is apparent from the figure, the length (i.e., along the longitudinal axis) of the heating element is less than a depth of the cavity 222-6-3. In this way, the heating element 223-6-3 does not protrude from or extend beyond the opening 221-6-3.

When the consumable 202-6-3 is received in the cavity 222-6-3 (as is shown in FIG. 13E), the heating element 223-6-3 penetrates the aerosol-forming substrate 213-6-3 of the consumable 202-6-3. In particular, the heating element 223-6-3 extends for nearly the entire axial length of the aerosol-forming substrate 213-6-3 when inserted therein. Thus, when the heater 204-6-3 is activated, heat is transferred radially from an outer circumferential surface the heating element 223-6-3 to the aerosol-forming substrate 213-6-3.

Figure 14:
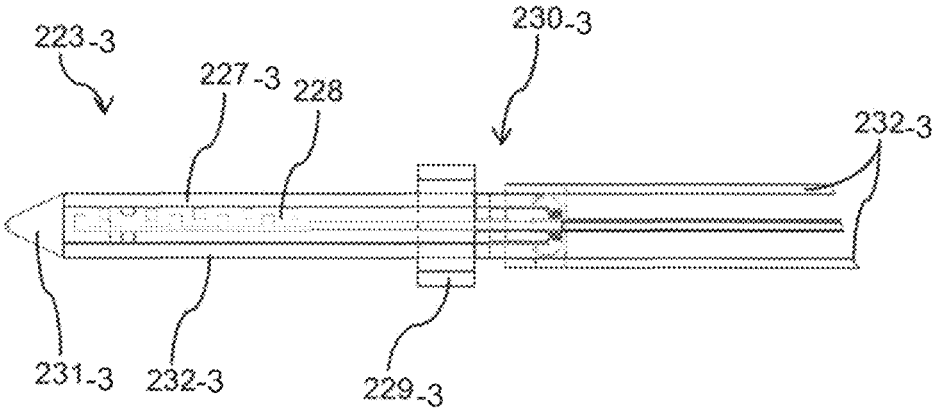
FIG. 14 is a schematic of a heater in accordance with an embodiment.

The heating element 223-6-3 may be formed of ceramic. As illustrated in FIG. 14, the heating element 223-6-3 may comprise an outer layer 232-3 (e.g., an outer ceramic layer) comprising Al2O3. The heating element 223-6-3 may comprise a heating track 227-3, which may extend longitudinally along the heating element 223-6-3 to form a heating portion of the heater 204-6-3. The heating track 227-3 may comprise tungsten and/or rhenium. The heating track 227-3 may have a thickness of around 20 μm. As shown in FIG. 14, the heating element 223-6-3 may include a track layer 228-3 on which the heating track 227-3 is formed. The track layer 228-3 may be a temperature measurement track. Further, a set of connection terminals may be provided on the heating element for connection with an electrical circuit of the device 201-6-3.

The heater 204-6-3 may further include a mount 229-3 at a proximal end 230-3 of the heating element 223-6-3.

The mount 229-3 may facilitate mounting of the heating element 223-6-3 in the device 201-6-3. The mount 229-3 may be formed of any suitable material, e.g., zirconia.

The heater 204-6-3 has a coating formed of silica. The coating may form outer surface of at least a portion of the heater 204-6-3. The coating of silica may provide for a non-stick outer surface of the heater 204-6-3. The coating may prevent or minimize residue deposition on the outer surface. The coating may be formed by a dipping process. For example, the coating may be formed by low temperature dipping process. The coating may form a glaze layer on the outer layer 232-3 of the heater 204-6-3. A portion of the rod of the heating element 223-6-3 may be dipped into silica to form the coating. The mount 229-3 may be formed on a portion of the coating. Alternatively, the mound may be coated as well.

The coating may cover at least a portion of the rod of the heating element 223-6-3. The rod may have a tapered distal tip 231-3 to facilitate penetration of the aerosol forming substrate by the heater 204-6-3. The tapered distal tip 231-3 may be conical in shape and/or may be attached with the heating element 223-6-3. The tapered distal tip 231-3 may be formed of any suitable material, e.g., zirconia. In addition to the portion of the rod, the coating may also cover the tapered distal tip 231-3 of the rod.

The coating may have thickness of 5-30 μm. In an embodiment, the thickness of the coating may be 5-15 μm. In an embodiment, the thickness of the coating may be substantially 10 μm. The word 'substantially' herein is used to include variation of 10-25% of in the value as indicated. In an embodiment, the thickness of the coating may be greater than a maximum surface deviation of the rod. In an embodiment, the thickness of the coating may be greater than an arithmetic average roughness of the rod. Yet in an embodiment, the thickness of the coating may be greater than a root mean square roughness of the rod.

The device 201-6-3 further comprises an electronics cavity 224-6-3. A power source, in the form of a rechargeable battery 205-6-3 (a lithium ion battery), is located in electronics cavity 224-6-3.

The device 201-6-3 includes a connector (i.e., forming part of an IO module of the device 201-6-3) in the form of a USB port 206-6-3. The connector may alternatively be, for example, a micro-USB port or a USB-C port for examples. The USB port 206-6-3 may be used to recharge the rechargeable battery 205-6-3.

The device 201-6-3 includes a controller (not shown) located in the electronics cavity 224-6-3. The controller comprises a microcontroller mounted on a printed circuit board (PCB). The USB port 206-6-3 is also connected to the controller 208-6-3 (i.e., connected to the PCB and microcontroller).

The controller 208-6-3 is configured to control at least one function of the device 202-6-3. For example, the controller 208-6-3 is configured to control the operation of the heater 204-6-3. Such control of the operation of the heater 204-6-3 may be accomplished by the controller toggling the electrical connection of the rechargeable battery 205-6-3 to the heater 204-6-3. For example, the controller 208-6-3 is configured to control the heater 204-6-3 in response to a user depressing the button 212-6-3. Depressing the button 212-6-3 may cause the controller to allow a voltage (from the rechargeable battery 205-6-3) to be applied to the heater 204-6-3 (so as to cause the heating element 223-6-3 to be heated).

The controller is also configured to control the LEDs 211-6-3 in response to (e.g., a detected) a condition of the device 201-6-3 or the consumable 202-6-3. For example, the controller may control the LEDs to indicate whether the device 201-6-3 is in an on state or an off state (e.g., one or more of the LEDs may be illuminated by the controller when the device is in an on state).

The device 201-6-3 comprises a further input means (i.e., in addition to the button 212-6-3) in the form of a puff sensor 225-6-3. The puff sensor 225-6-3 is configured to detect a user drawing (i.e., inhaling) at the downstream end 218-6-3 of the consumable 202-6-3. The puff sensor 225-6-3 may, for example, be in the form of a pressure sensor, flow meter or a microphone. The puff sensor 225-6-3 is operatively connected to the controller 208-6-3 in the electronics cavity 224-6-3, such that a signal from the puff sensor 225-6-3, indicative of a puff state (i.e., drawing or not drawing), forms an input to the controller 208-6-3 (and can thus be responded to by the controller 208-6-3).

Figure 15A:
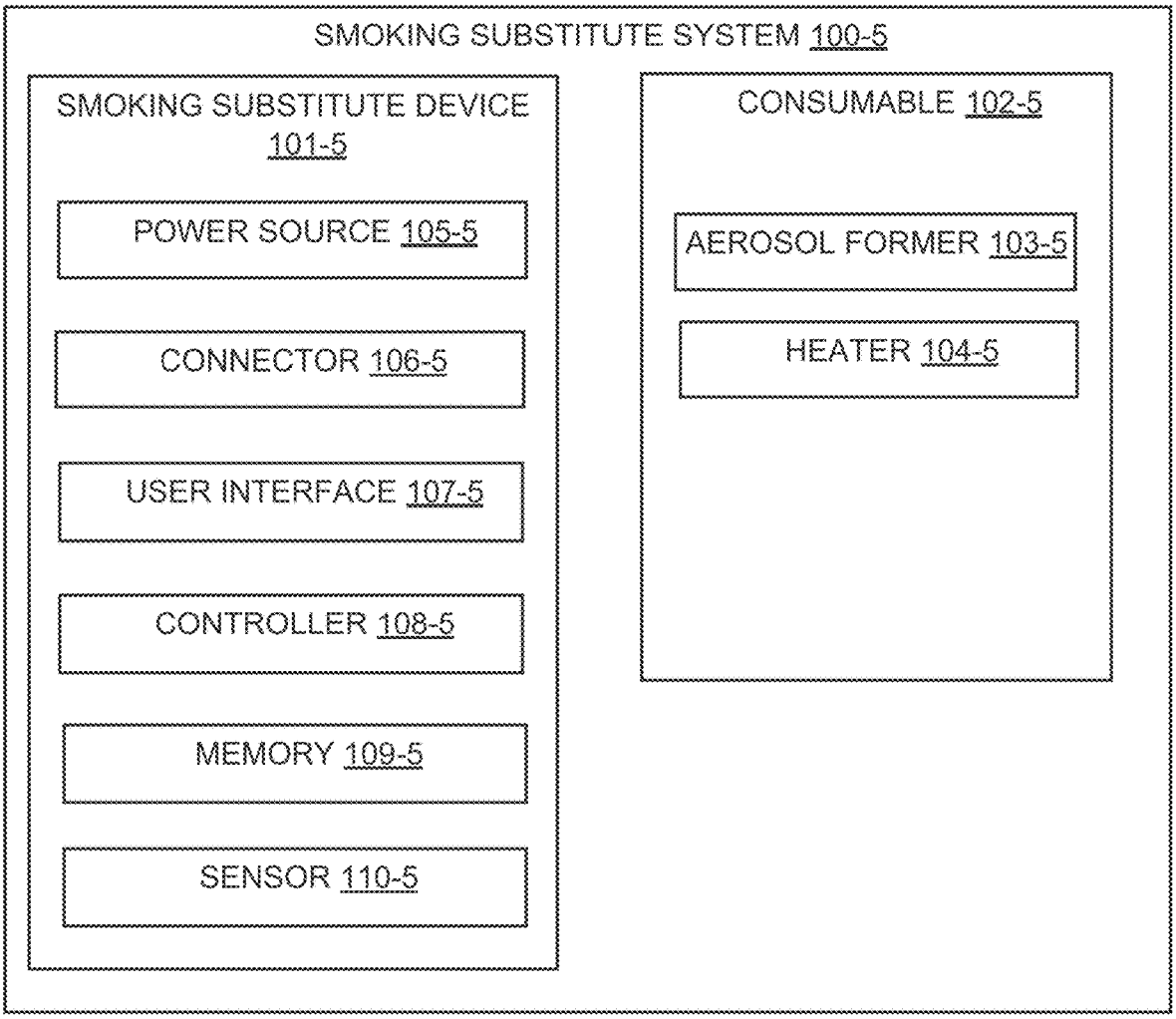
FIG. 15A is a schematic of a smoking substitute system.

Fifth Mode of the Disclosure FIG. 15A is a schematic providing a general overview of a smoking substitute system 100-6-4. The system 100-6-4 includes a substitute smoking device 101-6-4 and an aerosol-forming article in the form of a consumable 102-6-4, which comprises an aerosol former 103-6-4. The system is configured to vaporize the aerosol former by heating the aerosol former 103-6-4 (so as to form a vapor/aerosol for inhalation by a user).

In the illustrated system, the heater 104-6-4 forms part of the consumable 102-6-4 and is configured to heat the aerosol former 103-6-4. In this variation, the heater 104-6-4 is electrically connectable to the power source 105-6-4, for example, when the consumable 102-6-4 is engaged with the device 101-6-4. Heat from the heater 104-6-4 vaporizes the aerosol former 103-6-4 to produce a vapor. The vapor subsequently condenses to form an aerosol, which is ultimately inhaled by the user. In some embodiments, the heater 104-6-4 is configured to operate in two operating modes. In particular, the heater 104-6-4 is configured to operate at a first temperature in a first heating mode and at a second temperature at a second heating mode, wherein the second temperature is higher than the first temperature. In the illustrated embodiment, the heater is configured to operate at a first temperature of 315° C., and at a second temperature at 345° C.

The system 100-6-4 further comprises a power source 105-6-4 that forms part of the device 101-6-4. In other embodiments the power source 105-6-4 may be external to (but connectable to) the device 101-6-4. The power source 105-6-4 is electrically connectable to the heater 104-6-4 such that it is able to supply power to the heater 104-6-4 (i.e., for the purpose of heating the aerosol former 103-6-4). Thus, control of the electrical connection of the power source 105-6-4 to the heater 104-6-4 provides control of the state of the heater 104-6-4. The power source 105-6-4 may be a power store, for example a battery or rechargeable battery (e.g., a lithium ion battery).

The system 100-6-4 further comprises an I/O module comprising a connector 106-6-4 (e.g., in the form of a USB port, Micro USB port, USB-C port, etc.). The connector 106-6-4 is configured for connection to an external source of electrical power, e.g., a mains electrical supply outlet. The connector 106-6-4 may be used in substitution for the power source 105-6-4. That is the connector 106-6-4 may be electrically connectable to the heater 104-6-4 so as to supply electricity to the heater 104-6-4. In such embodiments, the device may not include a power source, and the power source of the system may instead comprise the connector 106-6-4 and an external source of electrical power (to which the connector 106-6-4 provides electrical connection).

In some embodiments, the connector 106-6-4 may be used to charge and recharge the power source 105-6-4 where the power source 105-6-4 includes a rechargeable battery.

The system 100-6-4 also comprises a user interface (UI) 107. Although not shown, the UI 107-6-4 may include input means to receive commands from a user. The input means of the UI 107-6-4 allows the user to control at least one aspect of the operation of the system 100-6-4. The input means may, for example, be in the form of a button, touchscreen, switch, microphone, etc.

The UI 107-6-4 also comprises output means to convey information to the user. The output means may, for example, comprise lights (e.g., LEDs), a display screen, speaker, vibration generator, etc.

The system 100-6-4 further comprises a controller 108-6-4 and a memory 109-6-4 operatively coupled to the controller 108-6-4 that is configured to control at least one function of the device 101-6-4. In the illustrated embodiment, the controller 108-6-4 is a component of the device 101-6-4, but in other embodiments may be separate from (but connectable to) the device 101-6-4. The controller 108-6-4 is configured to sense the ambient temperature and in response disable the second heating mode if the ambient temperature exceeds a predetermined threshold temperature. In one aspect, the predetermined threshold temperature is previously determined and stored in the memory 109-6-4 of the device 101-6-4. The controller 108-6-4 is configured to control the operation of the heater 104-6-4 and, for example, may be configured to control the voltage applied from the power source 105-6-4 to the heater 104-6-4. The controller 108-6-4 may be configured to toggle the supply of power to the heater 104-6-4 between an on state, in which the full output voltage of the power source 105-6-4 is applied to the heater 104-6-4, and an off state, in which the no voltage is applied to the heater 104-6-4. In the illustrated embodiment, the predetermined threshold, or threshold temperature is 40° C.

Although not shown, the system 100-6-4 may also comprise a voltage regulator to regulate the output voltage from the power source 105-6-4 to form a regulated voltage. The regulated voltage may then be applied to the heater 104-6-4.

In addition to being connected to the heater 104-6-4, the controller 108-6-4 is operatively connected to the UI 107-6-4. Thus, the controller 108-6-4 may receive an input signal from the input means of the UI 107-6-4. Similarly, the controller 108-6-4 may transmit output signals to the UI 107-6-4. In response, the output means of the UI 107-6-4 may convey information, based on the output signals, to a user. The controller also comprises a memory 109-6-4, which is a non-volatile memory. The memory 109-6-4 includes instructions, which, when implemented, cause the controller to perform certain tasks or steps of a method.

Further, the system may also comprise a sensor 110-4 coupled with the controller 108-6-4 within the heat-not-burn device 101-6-4. The sensor 110-4 may be a temperature sensor mounted inside the device and configured to measure the ambient temperature of air external to the device 101-6-4. In addition, the sensor 110-4 may be configured to continuously monitor the ambient temperature and send the measured ambient temperature to the controller 108-6-4 so that the controller 108-6-4 is able to determine whether the second heating mode needs to be disabled or not.

Figure 15B:
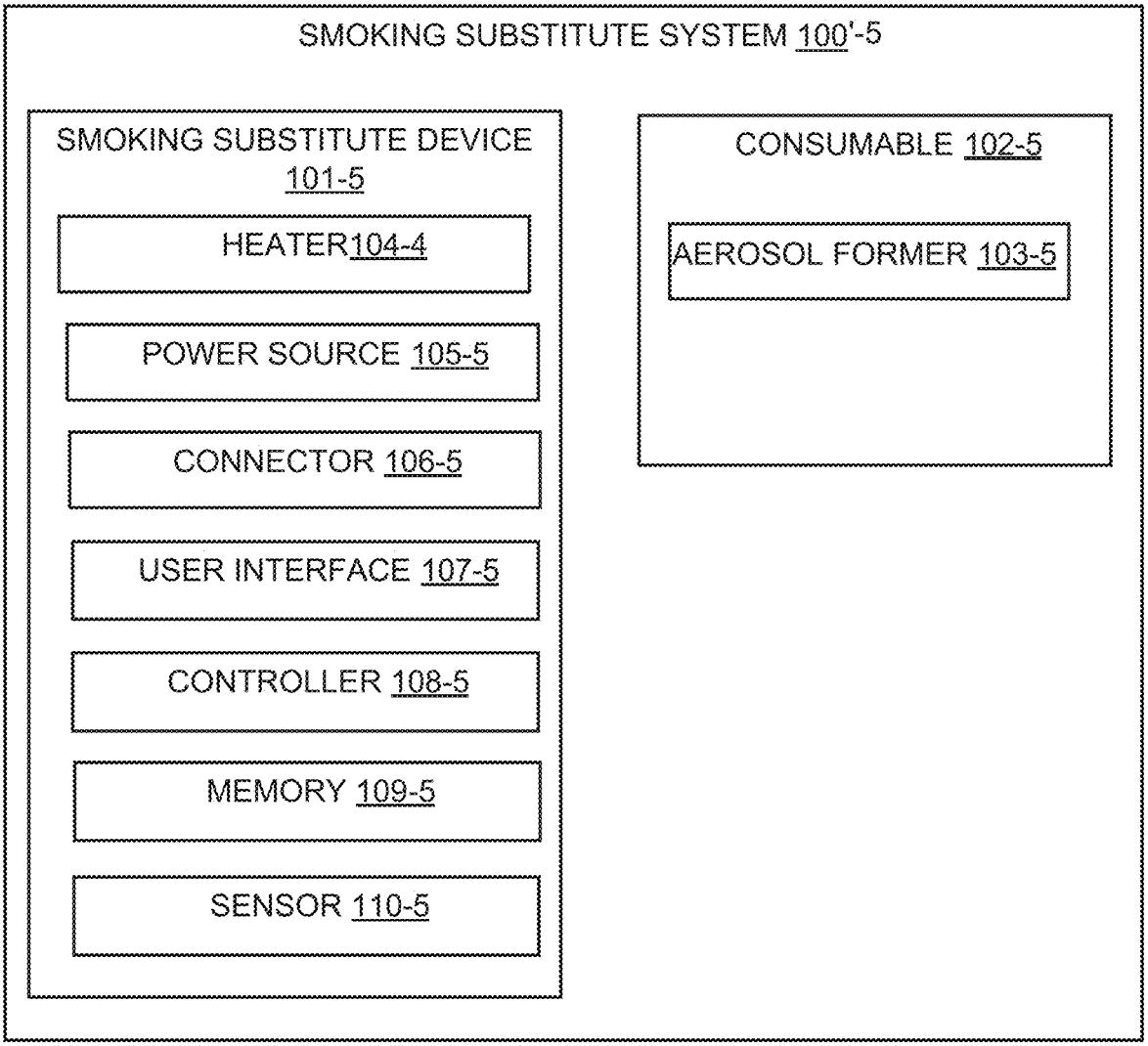
FIG. 15B is a schematic of a variation of the smoking substitute system of FIG. 15A.

FIG. 15B is a schematic showing a variation of the system 100-6-4 of FIG. 15A. In the system 100-6-4' oo FIG. 15B, the heater 104-6-4 forms part of the device 101-6-4, rather than the consumable 102-6-4. In this variation, the heater 104-6-4 is electrically connected to the power source 105-6-4.

Figure 16A:
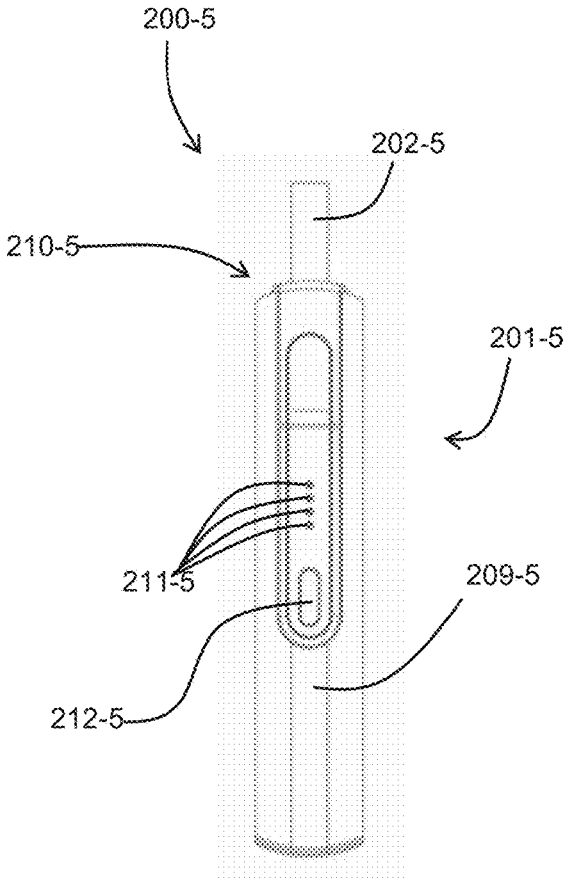
FIG. 16A is a front view of a first embodiment of the fifth mode of a smoking substitute system with the consumable engaged with the device.
Figure 16B:
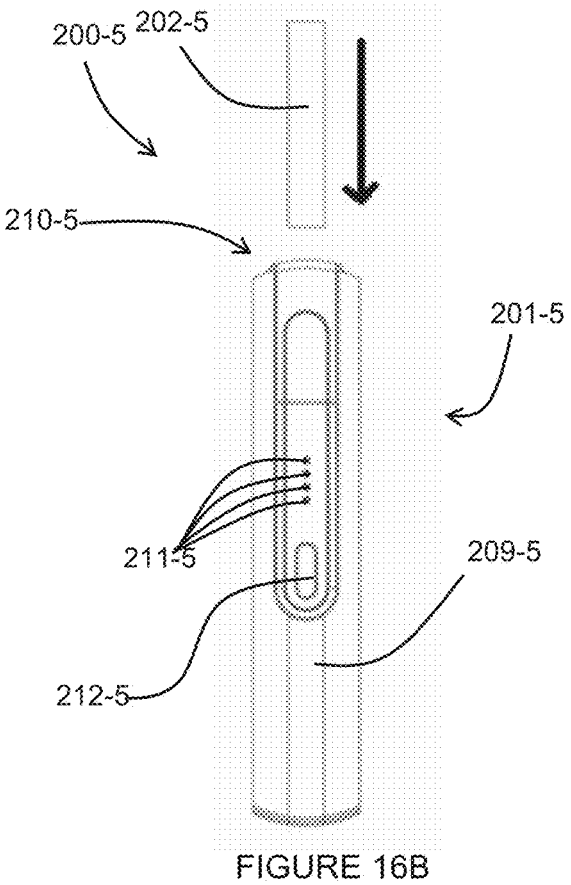
FIG. 16B is a front view of the first embodiment of the smoking substitute system with the consumable disengaged from the device.

FIG. 16A and FIG. 16B illustrate a heated-tobacco (HT) smoking substitute system 200-6-4. The system 200-6-4 is an example of the systems 100-6-4, 100' described in relation to FIG. 15A or FIG. 15B. System 200-6-4 includes an HT device 201-6-4, which may be configured to disable the second heating mode when the measured ambient temperature exceeds a predetermined threshold temperature, and an HT consumable 202-6-4. The description of FIG. 15A and FIG. 15B above is applicable to the system 200-6-4 of FIG. 16A and FIG. 16B, and will thus not be repeated.

The device 201-6-4 and the consumable 202-6-4 are configured such that the consumable 202-6-4 can be engaged with the device 201-6-4. FIG. 16A shows the device 201-6-4 and the consumable 202-6-4 in an engaged state, whilst FIG. 16B shows the device 201-6-4 and the consumable 202-6-4 in a disengaged state.

The device 201-6-4 comprises a body 209-6-4 and cap 210-6-4. In use the cap 210-6-4 is engaged at an end of the body 209-6-4. Although not apparent from the figures, the cap 210-6-4 is moveable relative to the body 209-6-4. In particular, the cap 210-6-4 is slideable and can slide along a longitudinal axis of the body 209-6-4.

The device 201-6-4 comprises an output means (forming part of the UI of the device 201-6-4) in the form of a plurality of light-emitting diodes (LEDs) 211 arranged linearly along the longitudinal axis of the device 201-6-4 and on an outer surface of the body 209-6-4 of the device 201-6-4. A button 212-6-4 is also arranged on an outer surface of the body 209-6-4 of the device 201-6-4 and is axially spaced (i.e., along the longitudinal axis) from the plurality of LEDs 211-6-4.

Figure 16C:
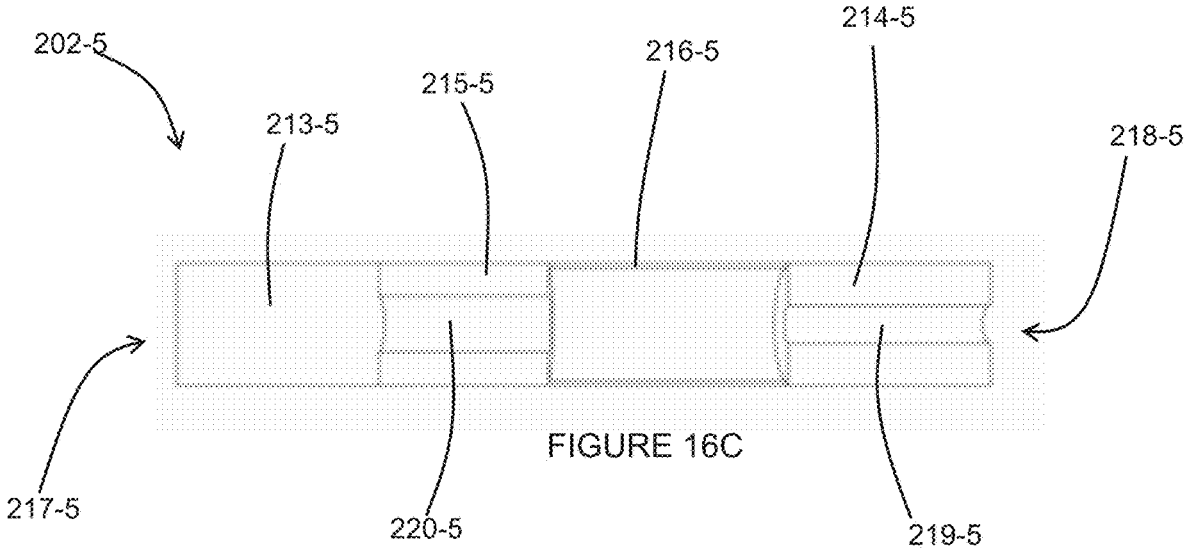
FIG. 16C is a section view of the consumable of the first embodiment of the smoking substitute system.

FIG. 16C show a detailed section view of the consumable of 202 of the system 200-6-4. The consumable 202-6-4 generally resembles a cigarette. In that respect, the consumable 202-6-4 has a generally cylindrical form with a diameter of 7 mm and an axial length of 70 mm. The consumable 202-6-4 comprises an aerosol forming substrate 213-6-4, a terminal filter element 214-6-4, an upstream filter element

215-6-4 and a spacer element 216-6-4. In other embodiments, the consumable may further comprise a cooling element. A cooling element may exchange heat with vapor that is formed by the aerosol-forming substrate 213-6-4 in order to cool the vapor so as to facilitate condensation of the vapor.

The aerosol-forming substrate 213-6-4 is substantially cylindrical and is located at an upstream end 217-6-4 of the consumable 202-6-4, and comprises the aerosol former of the system 200-6-4. In that respect, the aerosol forming substrate 213-6-4 is configured to be heated by the device 201-6-4 to release a vapor. The released vapor is subsequently entrained in an airflow flowing through the aerosol-forming substrate 213-6-4. The airflow is produced by the action of the user drawing on a downstream 218 (i.e., terminal or mouth) end of the consumable 202-6-4.

In the present embodiment, the aerosol forming substrate 213-6-4 comprises tobacco material that may, for example, include any suitable parts of the tobacco plant (e.g., leaves, stems, roots, bark, seeds and flowers). The tobacco may comprise one or more of leaf tobacco, stem tobacco, tobacco powder, tobacco dust, tobacco derivatives, expanded tobacco, homogenized tobacco, shredded tobacco, extruded tobacco, cut rag tobacco and/or reconstituted tobacco (e.g., slurry recon or paper recon). For example, the aerosol-forming substrate 213-6-4 may comprise a gathered sheet of homogenized (e.g., paper/slurry recon) tobacco or gathered shreds/strips formed from such a sheet.

In order to generate an aerosol, the aerosol forming substrate 213-6-4 comprises at least one volatile compound that is intended to be vaporized/aerosolized and that may provide the user with a recreational and/or medicinal effect when inhaled. The aerosol-forming substrate 213-6-4 may further comprise one or more additives. For example, such additives may be in the form of humectants (e.g., propylene glycol and/or vegetable glycerin), flavorants, fillers, aqueous/non-aqueous solvents and/or binders.

The terminal filter element 214-6-4 is also substantially cylindrical, and is located downstream of the aerosol forming substrate 213-6-4 at the downstream end 218-6-4 of the consumable 202-6-4. The terminal filter element 214-6-4 is in the form of a hollow bore filter element having a bore 219-6-4 (e.g., for airflow) formed there through. The diameter of the bore 219-6-4 is 2 mm. The terminal filter element 214-6-4 is formed of a porous (e.g., monoacetate) filter material. As set forth above, the downstream end 218-6-4 of the consumable 202-6-4 (i.e., where the terminal filter 214-6-4 is located) forms a mouthpiece portion of the consumable 202-6-4 upon which the user draws. Airflow is drawn from the upstream end 217-6-4, thorough the components of the consumable 202-6-4, and out of the downstream end 218-6-4. The airflow is driven by the user drawing on the downstream end 218-6-4 (i.e., the mouthpiece portion) of the consumable 202-6-4.

The upstream filter element 215-6-4 is located axially adjacent to the aerosol-forming substrate 213-6-4, between the aerosol-forming substrate 213-6-4 and the terminal filter element 214-6-4. Like the terminal filter 214-6-4 35 the upstream filter element 215-6-4 is in the form of a hollow bore filter element, such that it has a bore 220-6-4 extending axially there through. In this way, the upstream filter 215-6-4 may act as an airflow restrictor. The upstream filter element 215-6-4 is formed of a porous (e.g., monoacetate) filter material. The bore 220-6-4 of the upstream filter element 215-6-4 has a larger diameter (3 mm) than the terminal filter element 214-6-4.

The spacer 216-6-4 is in the form of a cardboard tube, which defines a cavity or chamber between the upstream filter element 215-6-4 and the terminal filter element 214-6-4. The spacer 216-6-4 acts to allow both cooling and mixing of the vapor/aerosol from the aerosol-forming substrate 213-6-4. The spacer has an external diameter of 7 mm and an axial length of 14 mm.

Although not apparent from the figure, the aerosol-forming substrate 213-6-4, upstream filter 215-6-4 and spacer 216-6-4 are circumscribed by a paper wrapping layer. The terminal filter 214-6-4 is circumscribed by a tipping layer that also circumscribes a portion of the paper wrapping layer (so as to connect the terminal filter 214-6-4 to the remaining components of the consumable 202-6-4). The upstream filter 215-6-4 and terminal filter 214-6-4 are circumscribed by further wrapping layers in the form of plug wraps.

Figure 16D:
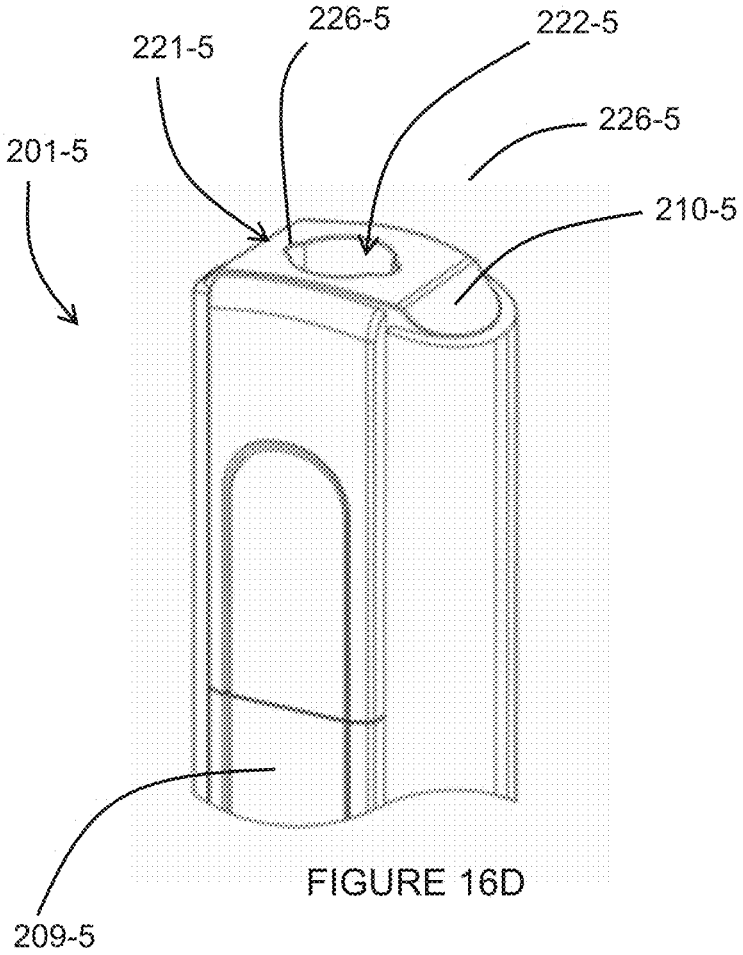
FIG. 16D is a detailed view of an end of the device of the first embodiment of the smoking substitute system.

Returning now to the device 201-6-4, FIG. 16D illustrates a detailed view of the end of the device 201-6-4 that is configured to engage with the consumable 202-6-4. The cap 210-6-4 of the device 201-6-4 includes an opening 221-6-4 to an internal cavity 222-6-4 (more apparent from FIG. 16D) defined by the cap 210-6-4. The opening 221-6-4 and the cavity 222-6-4 are formed so as to receive at least a portion of the consumable 202-6-4. During engagement of the consumable 202-6-4 with the device 201-6-4, a portion of the consumable 202-6-4 is received through the opening 221-6-4 and into the cavity 222-6-4. After engagement (see FIG. 16B), the downstream end 218-6-4 of the consumable 202-6-4 protrudes from the opening 221-6-4 and thus also protrudes from the device 201-6-4. The opening 221-6-4 includes laterally disposed notches 226-6-4. When a consumable 202-6-4 is received in the opening 221-6-4, these notches 226-6-4 remain open and could, for example, be used for retaining a cover in order to cover the end of the device 201-6-4.

Figure 16E:
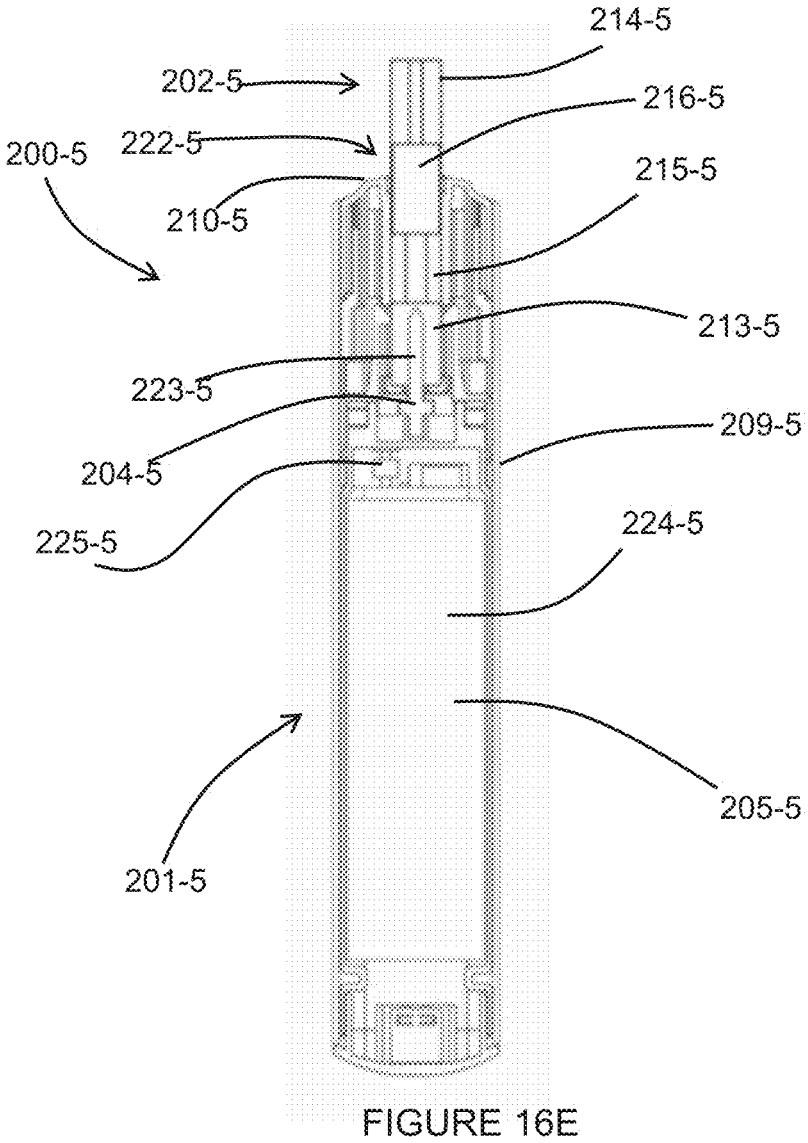
FIG. 16E is a section view of the first embodiment of the substitute smoking system.

FIG. 16E shows a cross section through a central longitudinal plane through the device 201-6-4. The device 201-6-4 is shown with the consumable 202-6-4 engaged therewith.

The device 201-6-4 comprises a heater 204-6-4 comprising heating element 223-6-4. The heater 204-6-4 forms part of the body 209-6-4 of the device 201-6-4 and is rigidly mounted to the body 209-6-4. In the illustrated embodiment, the heater 204-6-4 is a rod heater with a heating element 223-6-4 having a circular transverse profile. In other embodiments the heater may be in the form of a blade heater (e.g., heating element with a rectangular transverse profile) or a tube heater (e.g., heating element with a tubular form).

The heating element 223-6-4 of the heater 204-6-4 projects from an internal base of the cavity 222-6-4 along a longitudinal axis towards the opening 221-6-4. As is apparent from the figure, the length (i.e., along the longitudinal axis) of the heating element is less than a depth of the cavity 222-6-4. In this way, the heating element 223-6-4 does not protrude from or extend beyond the opening 221-6-4.

When the consumable 202-6-4 is received in the cavity 222-6-4 (as is shown in FIG. 16E), the heating element 223-6-4 penetrates the aerosol-forming substrate 213-6-4 of the consumable 202-6-4. In particular, the heating element 223-6-4 extends for nearly the entire axial length of the aerosol-forming substrate 213-6-4 when inserted therein. Thus, when the heater 204-6-4 is activated, heat is transferred radially from an outer circumferential surface the heating element 223-6-4 to the aerosol-forming substrate 213-6-4.

The device 201-6-4 further comprises an electronics cavity 224-6-4. A power source, in the form of a rechargeable battery 205-6-4 (a lithium ion battery), is located in electronics cavity 224-6-4.

The device 201-6-4 includes a connector (i.e., forming part of an IO module of the device 201-6-4) in the form of a USB port 206-6-4. The connector may alternatively be, for example, a micro-USB port or a USB-C port for examples. The USB port 206-6-4 may be used to recharge the rechargeable battery 205-6-4.

The device 201-6-4 includes a controller (not shown) located in the electronics cavity 224-6-4. The controller comprises a microcontroller mounted on a printed circuit board (PCB). The USB port 206-6-4 is also connected to the controller 208-6-4 (i.e., connected to the PCB and microcontroller).

The controller 208-6-4 is configured to control at least one function of the device 202-6-4. For example, the controller 208-6-4 is configured to control the operation of the heater 204-6-4. Such control of the operation of the heater 204-6-4 may be accomplished by the controller toggling the electrical connection of the rechargeable battery 205-6-4 to the heater 204-6-4. For example, the controller 208-6-4 is configured to control the heater 204-6-4 in response to a user depressing the button 212-6-4. Depressing the button 212-6-4 may cause the controller to allow a voltage (from the rechargeable battery 205-6-4) to be applied to the heater 204-6-4 (so as to cause the heating element 223-6-4 to be heated).

In one aspect, the controller 208-6-4 is configured to control the operating modes of the heater 204-6-4. Operating modes of the heater 204-6-4, may be for example, a first heating mode and a second heating mode. The controller 208-6-4 is configured to disable the second heating mode by comparing measured ambient temperature with the predetermined threshold temperature. Precisely, the controller 208-6-4 is configured to receive the measured ambient temperature of the device 201-6-4, from the sensor 110-4 and thereby disables the second heating mode when the measured ambient temperature is determined to have exceeded the predetermined threshold temperature. The heater 204-6-4 of the device 201-6-4 operates at a first temperature in a first heating mode and at a second temperature in a second heating mode. In one example, the second temperature may be higher than the first temperature i.e., the first mode may be defined as a normal operating mode where the consumable 202-6-4 is heated at a steady temperature and the second mode may be defined as a boost heating mode where the consumable 202-6-4 is heated up more quickly when the heater is operating at a higher temperature. In the illustrated embodiment, the heater is configured to operate at a first temperature of 315° C., and at a second temperature at 345° C. The predetermined threshold, or predetermined threshold temperature, is 40° C.

The controller 208-6-4 is configured to constantly receive input, in the form of measured ambient temperature, from the sensor 110-4 and disable the second heating mode when the ambient temperature is determined to have exceeded a predetermined threshold. Such determination is performed using the memory 109-6-4 which stores a predetermined threshold temperature, and when the measured ambient temperature exceeds said predetermined threshold temperature the second heating mode is to be disabled. In particular, the predetermined threshold temperature stored in the memory 109-6-4 defines a cut off, and when the measured temperature exceed said predetermined threshold temperature the consumable shall not be heated.

In one aspect, the device 201-6-4 receives a user input, via the user interface, to switch the device 201-6-4, more specifically the heater 204-6-4, from operating in the first heating mode to the second heating mode, the controller 208-6-4 compares the detected ambient temperature with the predetermined threshold temperature that is stored in the memory 109-6-4 and accordingly the controller 208-6-4 may or may not switch from the first heating mode to the second heating mode. For example, if the measured ambient temperature is determined to have exceeded the predetermined threshold temperature, the controller 208-6-4 does not permit the heater form switching to operate in the second heating mode and therefore heating resumes in the first heating mode. On the other hand, if the ambient temperature is determined to be below the predetermined threshold temperature, then the controller 208-6-4 permits the device 201-6-4, e.g., the heater 204-6-4, to operate in the second heating mode.

In the illustrative aspect, when the heater is already operating in the second heating mode, upon determining the measured ambient temperature has exceeded the predetermined threshold, the controller 208-6-4 is configured to disable the second heating mode by switching the operation of the heater 204-6-4 from the second heating mode to the first heating mode, i.e., by operating the device at the first temperature instead of second temperature. In other embodiments, instead of switching the operation heater to a lower temperature, e.g., the first temperature, the controller may cease heating altogether. This allows the heater and consumable to cool down faster.

The controller is also configured to control the LEDs 211-6-4 in response to (e.g., a detected) a condition of the device 201-6-4 or the consumable 202-6-4. For example, the controller may control the LEDs to indicate whether the device 201-6-4 is in an on state or an off state (e.g., one or more of the LEDs may be illuminated by the controller when the device is in an on state). In addition, the controller 208-6-4 may control the LEDs to indicate that the second mode is disabled when the measured ambient temperature is determined to have exceeded the pre-determined threshold temperature. The device 201-6-4 additionally includes other output means such as haptic sensor, audio sensors etc. to provide haptic/audio feedback to the user indicating the second mode has been disabled.

The device 201-6-4 comprises a further input means (i.e., in addition to the button 212-6-4) in the form of a puff sensor 225-6-4. The puff sensor 225-6-4 is configured to detect a user drawing (i.e., inhaling) at the downstream end 218-6-4 of the consumable 202-6-4. The puff sensor 225-6-4 may, for example, be in the form of a pressure sensor, flow meter or a microphone. The puff sensor 225-6-4 is operatively connected to the controller 208-6-4 in the electronics cavity 224-6-4, such that a signal from the puff sensor 225-6-4, indicative of a puff state (i.e., drawing or not drawing), forms an input to the controller 208-6-4 (and can thus be responded to by the controller 208-6-4).

Figure 17:
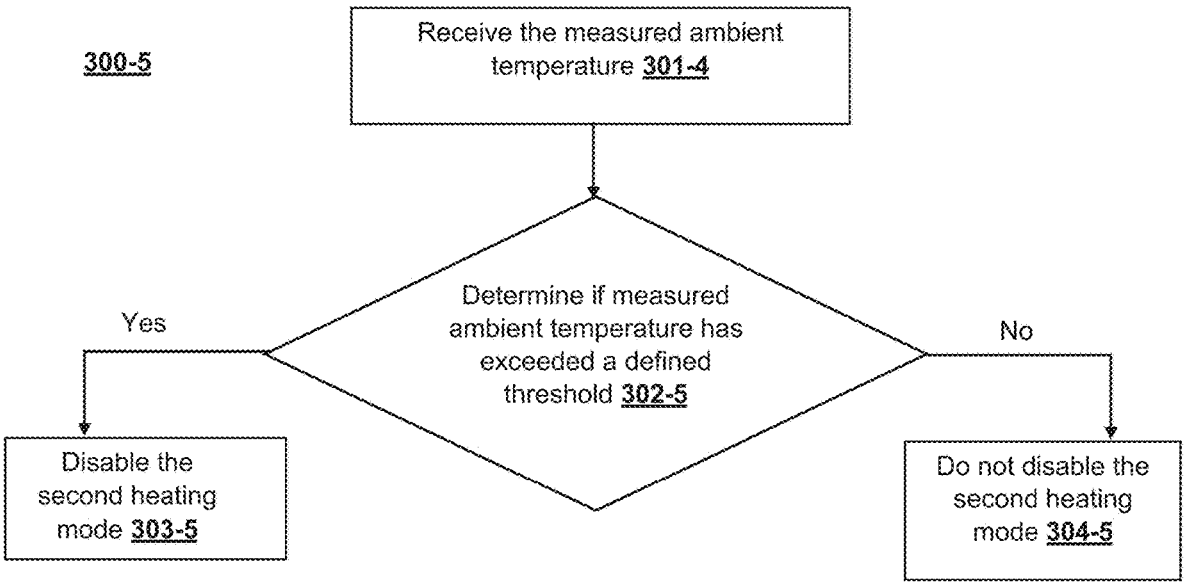
FIG. 17 is a flowchart illustrating a method for operating the system.

FIG. 17 illustrates a flowchart of a method for disabling second heating mode when the detected ambient temperature is determined to have exceeded the predetermined threshold temperature.

As illustrated in FIG. 17, the method 300-4 includes one or more blocks implemented by the controller 208-6-4 of the device 201-6-4. The method 300-4 may be described in general context of controller executable instructions. Generally, controller executable instructions may include routines, programs, objects, components, data structures, procedures, modules, and functions, which perform particular functions or implement particular abstract data types.

The order in which the method 300-4 is described is not intended to be construed as a limitation, and any number of the described method blocks can be combined in any order to implement the method 300-4.

Additionally, individual blocks may be deleted from the method 300-4 without departing from the scope of the subject matter described herein. Furthermore, the method 300-4 can be implemented in any suitable hardware, software, firmware, or combination thereof.

At block 301-4, the controller 208-6-4 receives a measured ambient temperature from the temperature sensor 110-4. It is to be noted that though the step of receiving a user input for changing the device from first heating mode to the second heating mode is not explicitly shown but it may be preceded before the step 301-4. At block 302-4, the controller compares the measured ambient with the predetermined threshold temperature stored in memory 109-6-4 and base thereon determine if the measured ambient temperature has exceeded the threshold temperature. In particular, when the controller 208-6-4 receive a user request for switching the device 201-6-4 from the first heating mode to the second heating mode, the controller 208-6-4 compares the measured ambient temperature, received at that particular moment from the sensor 110-4, with the predetermined threshold temperature and accordingly takes the decision as discussed in blocks 303-4 and 304.

At block 303-4, the controller 208-6-4 moves along "YES" path to disable the second heating mode or in other words to prevent enabling the second heating mode, i.e., when the determined ambient temperature is found exceeding the predetermined threshold stored in the memory 109-6-4. In addition, the controller 208-6-4 indicates the user that the second mode is not available, e.g., disabled, through various output means. Precisely, the controller 208-6-4 may be coupled with output means configured for generating one of haptic feedback, audio and visual feedback to indicate a user that the controller 208-6-4 has disabled the second heating mode.

At block 304-4, the controller 208-6-4 moves along "NO" path and do not disable the second heating mode, e.g., to enable or continue to enable the second heating mode, as the measured ambient temperature is not found exceeding the predetermined threshold.

The flowchart of the method does not explicitly disclose that, in one exemplary embodiment, the controller 208-6-4 is configured for disabling the second heating mode by switching the operation of the heater from the second heating mode to the first heating mode. Further, the flowchart also does not explicitly disclose that the first heating mode and the second heating mode, however it is to be acknowledged that the first mode may be a normal mode where the consumable 202-6-4 is heated at a steady temperature and the second mode may be a boost mode where the consumable 202-6-4 is heated quickly at a higher temperature.

Figure 18:
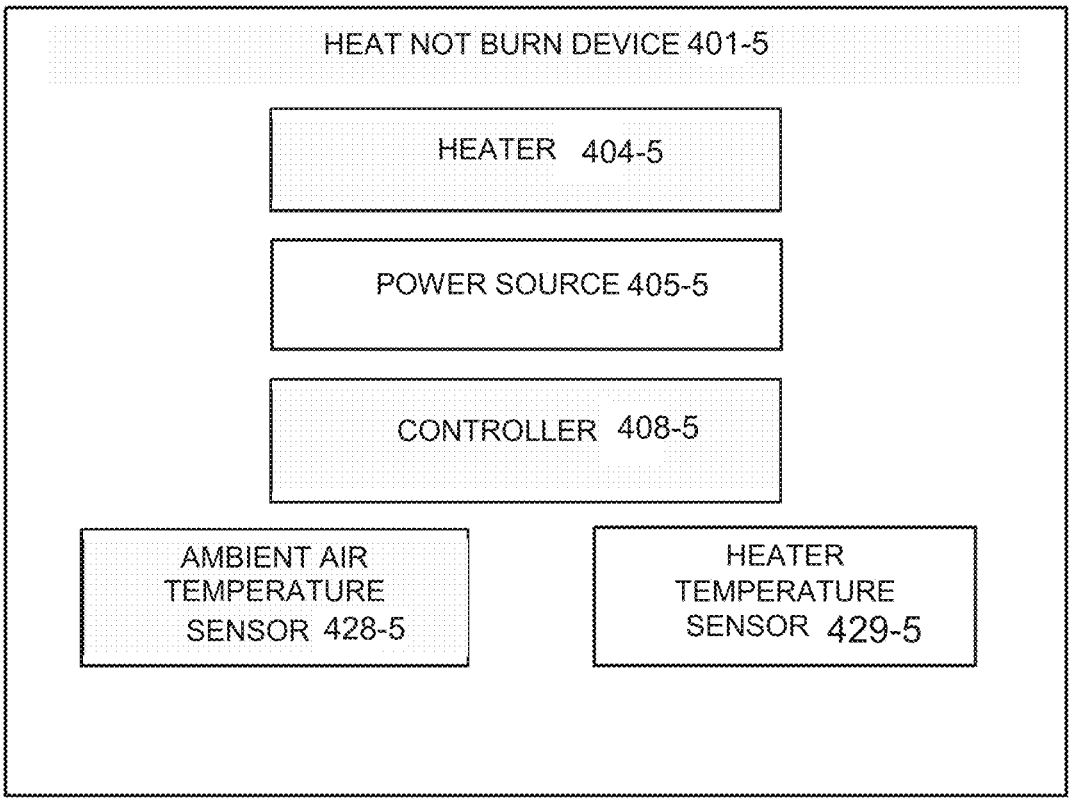
FIG. 18 illustrates a block diagram of a heat not burn device according to an embodiment of the fifth mode of the smoking substitute system.

The device 201-6-4 may comprise one or more temperature sensors (as shown in FIG. 18). An ambient temperature sensor 428-6-4 is used to measure the ambient or environmental temperature of the device 401-4 (that is, the temperature in the vicinity of the device). In some embodiments, the ambient sensor is located to measure the temperature of an airflow entering in the device. In such embodiments, the ambient temperature sensor 428-6-4 is located upstream of the heater. In some embodiments, the ambient temperature sensor 428-6-4 is located upstream of the location at which the airflow enters the consumable. In some embodiments in flowing air is passed through the ambient temperature sensor 428-6-4 during inhalation.

After passing the ambient temperature sensor 428-6-4 the ambient temperature sensor, air passes through the consumable. In some embodiments, the ambient temperature sensor 428-6-4 is part of the controller 208-6-4.

Vapor is generated when the aerosol forming substrate is heated. The airflow drawn through the consumable is ultimately from an ambient air source. If the ambient air temperature is too high, the vapor temperature may be uncomfortably high for a user and may be unsuitable for inhalation. In contrast, if the ambient temperature is too low, the performance of the device may be impaired (e.g., by a lowered vapor production). This may diminish the user experience in cold environments. By using the ambient temperature sensor it is possible to regulate the temperature of the vapor that enters the user's mouth. The vapor temperature can be regulated by controlling the temperature of the heater 404-6-4 in dependence on the ambient temperature measurement from the ambient temperature sensor 428-6-4.

The ambient air temperature is measured using the ambient temperature sensor. The controller 408-6-4 receives the signal indicative of ambient air temperature (the ambient temperature measurement). Based on the ambient temperature measurement, the controller 408-6-4 controls an amount of power supplied to the heater to attain optimum heating of the heater 404-6-4 and improved vapor temperature and user experience. In some embodiments, the power supplied to the heater is reduced if the ambient temperature is high. In some embodiments, the power supplied to the heater is reduced if the ambient temperature is above a high temp threshold. Similarly, if the ambient air temperature is low, then the controller 408-6-4 may increase the power supplied to the heater to attain optimum heating temperature. In some embodiments, the power supplied to the heater is increased if the ambient temperature is below a low temp threshold. The controller 408-6-4 may be periodically monitoring ambient temperature, and adjusting the power supplied to the heater 404-6-4 during a consumable cycle. Alternatively, the controller may measure the ambient temperature once at the commencement of a consumable cycle and set the power supplied to the heater during that consumable cycle in dependence on the one ambient temperature measurement.

In some embodiments, the device also includes a heater temperature sensor for measuring a present operating temperature of the heater. The heater temperature sensor may be a separate component of the heater (e.g., a thermocouple) or the temperature sensor may implemented using a resistive heating track of the heater (e.g., by comparing a measured resistance of the heater to a model of how the resistance of the heater track changes with temperature to calculate a heater temperature).

A power supplied to the heater may depend on the ambient temperature measurement and a measurement of the heater. In some embodiments, the power supplied to the heater may depend on a comparison of the two temperature measures, for example a difference between the two temperature measurements.

In further embodiment, the heater temperature sensor measures the temperature of the heater and provides a signal to the controller 408-6-4.

In some embodiments, the amount of power supplied to the heater is controlled by the controller by changing a duty cycle of pulse width modulated power supply.

In another embodiment, the controller 408-6-4 may disable at least one operating mode of the device in response to an ambient temperature measurement. In some embodiments, the device implements two operating modes: a first operating mode during which the heater is maintained at a lower operating temperature and a second operating mode during which the heater is maintained at a higher operating temperature. The lower operating temperature may be between 260 and 320 degrees Celsius. The higher operating temperature may be between 320 and 380 degrees Celsius.

If the ambient temperature is above a mid-temp threshold, then the high temperature mode may be disabled. The mid-temp threshold may be 35 degrees Celsius. If the ambient temperature is above a high-temp threshold, then both the high temperature mode and the low temperature mode may be disabled. The high-temp threshold may be 50 degrees Celsius. This may improve user safety.

In some embodiments the user may be able to select the operating mode of the device. If one or both of the modes is disabled because of the ambient temperature, the controller may be configured to indicate to the user that the disabled mode is unavailable for use, for example using a user interface components (e.g., LEDs or haptic feedback).

As the controller 408-6-4 controls the power supply to the heater, this improves saving battery power.

The device 401-4 also includes an input means in the form of a puff sensor (not shown). The puff sensor is the same as that described above with respect to the embodiment shown in FIG. 15A to FIG. 15E.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilized for realizing the disclosure in diverse forms thereof.

Figure 19A:
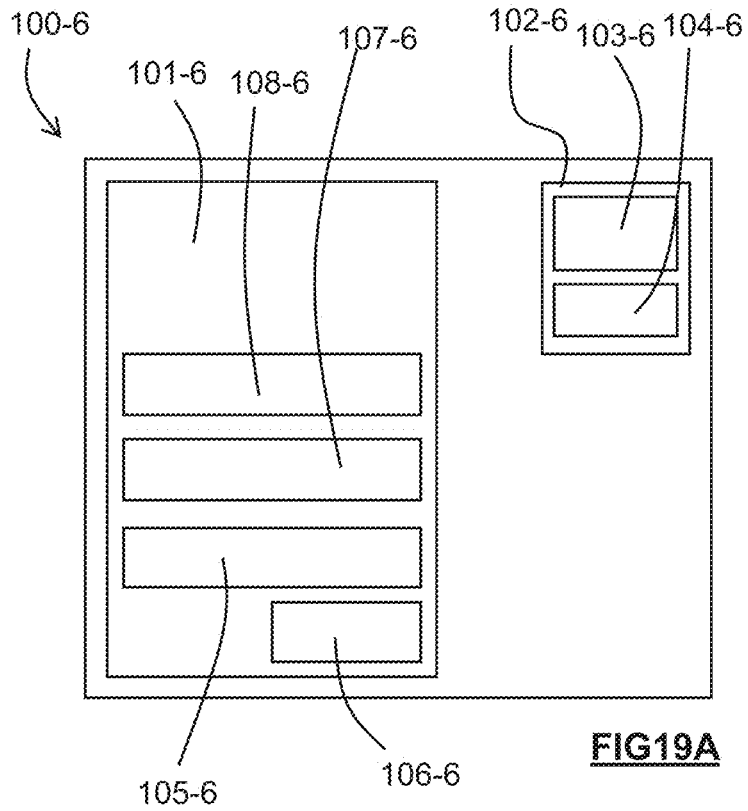
FIG. 19A is a schematic of a heat not burn system.

Sixth Mode of the Disclosure FIG. 19A is a schematic providing a general overview of a heat not burn system 100-6-5. The system 100-6-5 includes a substitute smoking device 101-6-5 and an aerosol-forming article in the form of a consumable 102-6-5, which comprises an aerosol former 103-6-5. The system is configured to vaporize the aerosol former by heating the aerosol former 103-6-5 (so as to form a vapor/aerosol for inhalation by a user).

In the illustrated system, the heater 104-6-5 forms part of the consumable 102-6-5 and is configured to heat the aerosol former 103-6-5. In this variation, the heater 104-6-5 is electrically connectable to the power source 105-6-5, for example, when the consumable 102-6-5 is engaged with the device 101-6-5. Heat from the heater 104-6-5 vaporizes the aerosol former 103-6-5 to produce a vapor. The vapor subsequently condenses to form an aerosol, which is ultimately inhaled by the user.

The system 100-6-5 further comprises a power source 105-6-5 that forms part of the device 101-6-5. In other embodiments the power source 105-6-5 may be external to (but connectable to) the device 101-6-5. The power source 105-6-5 is electrically connectable to the heater 104-6-5 such that it is able to supply power to the heater 104-6-5 (i.e., for the purpose of heating the aerosol former 103-6-5). Thus, control of the electrical connection of the power source 105-6-5 to the heater 104-6-5 provides control of the state of the heater 104-6-5. The power source 105-6-5 may be a power store, for example a battery or rechargeable battery (e.g., a lithium ion battery).

The system 100-6-5 further comprises an I/O module comprising a connector 106-6-5 (e.g., in the form of a USB port, Micro USB port, USB-C port, etc.). The connector 106-6-5 is configured for connection to an external source of electrical power, e.g., a mains electrical supply outlet. The connector 106-6-5 may be used in substitution for the power source 105-6-5. That is the connector 106-6-5 may be electrically connectable to the heater 104-6-5 so as to supply electricity to the heater 104-6-5. In such embodiments, the device may not include a power source, and the power source of the system may instead comprise the connector 106-6-5 and an external source of electrical power (to which the connector 106-6-5 provides electrical connection).

In some embodiments, the connector 106-6-5 may be used to charge and recharge the power source 105-6-5 where the power source 105-6-5 includes a rechargeable battery.

The system 100-6-5 also comprises a user interface (UI) 107. Although not shown, the UI 107-6-5 may include input means to receive commands from a user. The input means of the UI 107-6-5 allows the user to control at least one aspect of the operation of the system 100-6-5. The input means may, for example, be in the form of a button, touchscreen, switch, microphone, etc.

The UI 107-6-5 also comprises output means to convey information to the user. The output means may, for example, comprise lights (e.g., LEDs), a display screen, speaker, vibration generator, etc.

The system 100-6-5 further comprises a controller 108-6-5 that is configured to control at least one function of the device 101-6-5. In the illustrated embodiment, the controller 108-6-5 is a component of the device 101-6-5, but in other embodiments may be separate from (but connectable to) the device 101-6-5. The controller 108-6-5 is configured to control the operation of the heater 104-6-5 and, for example, may be configured to control the voltage applied from the power source 105-6-5 to the heater 104-6-5. The controller 108-6-5 may be configured to toggle the supply of power to the heater 104-6-5 between an on state, in which the full output voltage of the power source 105-6-5 is applied to the heater 104-6-5, and an off state, in which the no voltage is applied to the heater 104-6-5.

Although not shown, the system 100-6-5 may also comprise a voltage regulator to regulate the output voltage from the power source 105-6-5 to form a regulated voltage. The regulated voltage may then be applied to the heater 104-6-5.

In addition to being connected to the heater 104-6-5, the controller 108-6-5 is operatively connected to the UI 107-6-5. Thus, the controller 108-6-5 may receive an input signal from the input means of the UI 107-6-5. Similarly, the controller 108-6-5 may transmit output signals to the UI 107-6-5. In response, the output means of the UI 107-6-5 may convey information, based on the output signals, to a user. The controller also comprises a memory 109-6-5, which is a non-volatile memory. The memory 109-6-5 includes instructions, which, when implemented, cause the controller to perform certain tasks or steps of a method.

Figure 19B:
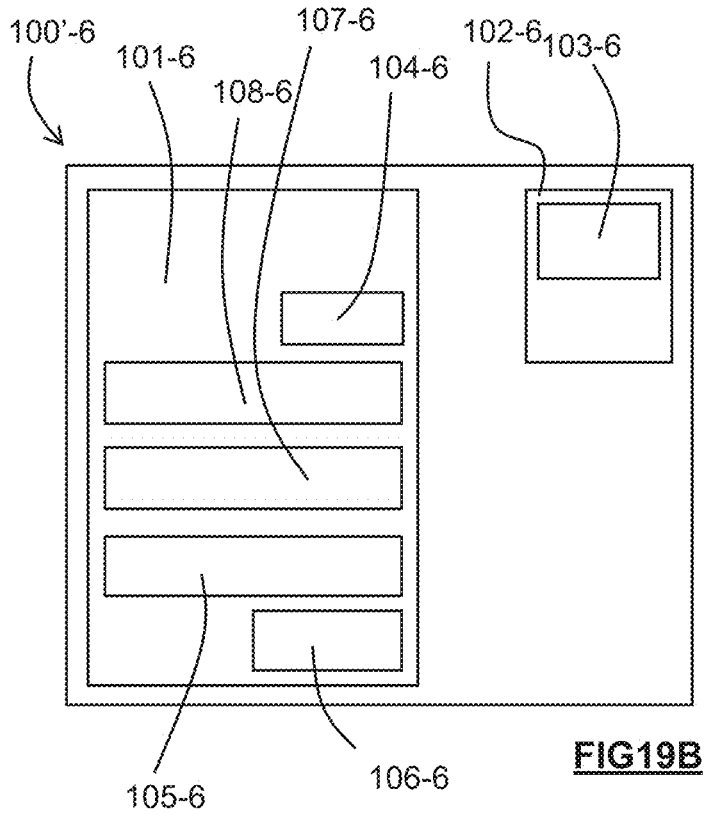
FIG. 19B is a schematic of a variation of the heat not burn system of FIG. 19A.

FIG. 19B is a schematic showing a variation of the system 100-6-5 of FIG. 19A. In the system 100-6-5' of FIG. 19B, the heater 104-6-5 forms part of the device 101-6-5, rather than the consumable 102-6-5. In this variation, the heater 104-6-5 is electrically connected to the power source 105-6-5.

Figure 20A:
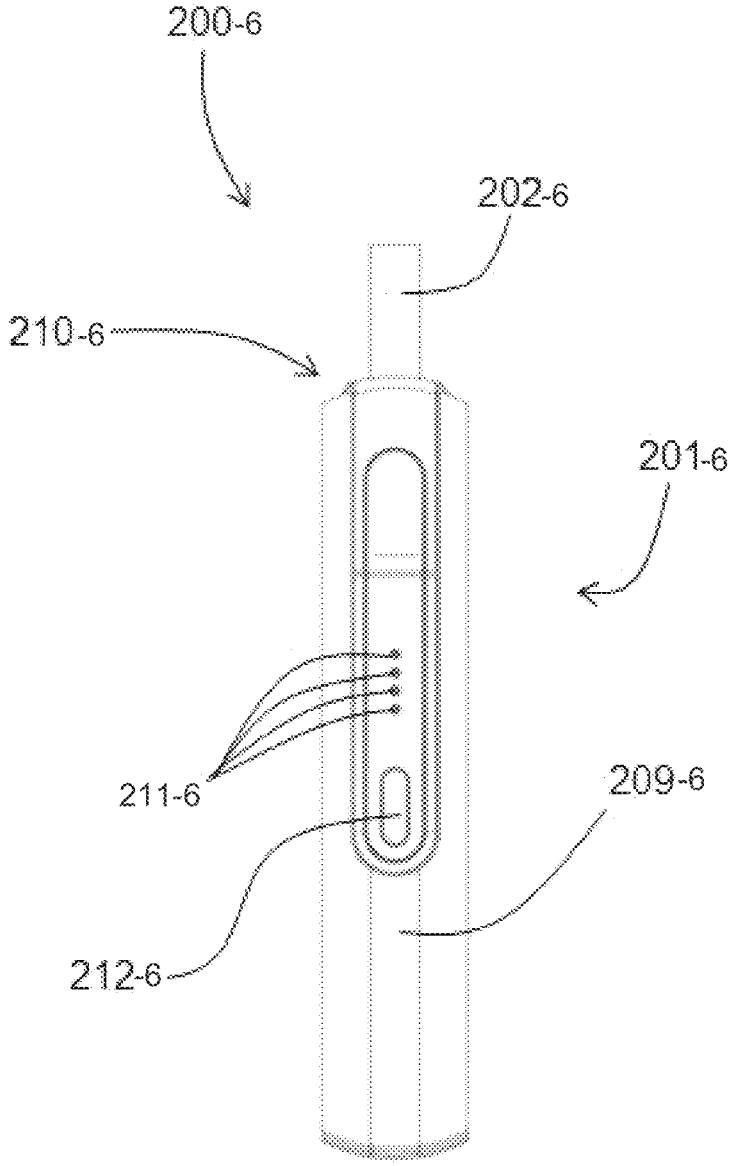
FIG. 20A is a front view of a first embodiment of a sixth mode of a heat not burn system with the consumable engaged with the device.
Figure 20B:
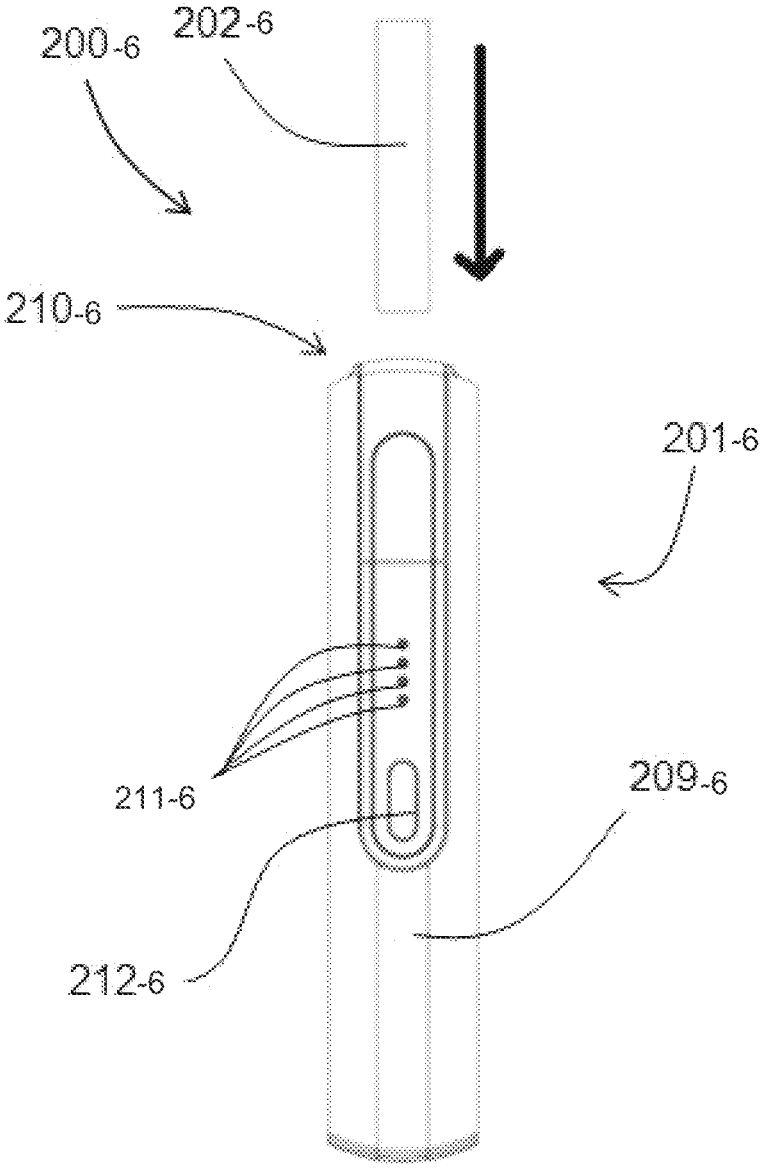
FIG. 20B is a front view of the first embodiment of the heat not burn system with the consumable disengaged from the device.

FIG. 20A and FIG. 20B illustrate a heated-tobacco (HT) heat not burn system 200-6-5. The system 200-6-5 is an example of the systems 100-6-5, 100' described in relation to FIG. 19A or FIG. 19B. System 200-6-5 includes an HT device 201-6-5 and an HT consumable 202-6-5. The description of FIG. 19A and FIG. 19B above is applicable to the system 200-6-5 of FIG. 20A and FIG. 20B, and will thus not be repeated.

The device 201-6-5 and the consumable 202-6-5 are configured such that the consumable 202-6-5 can be engaged with the device 201-6-5. FIG. 20A shows the device 201-6-5 and the consumable 202-6-5 in an engaged state, whilst FIG. 20B shows the device 201-6-5 and the consumable 202-6-5 in a disengaged state.

The device 201-6-5 comprises a body 209-6-5 and cap 210-6-5. In use the cap 210-6-5 is engaged at an end of the body 209-6-5. Although not apparent from the figures, the cap 210-6-5 is moveable relative to the body 209-6-5. In particular, the cap 210-6-5 is slideable and can slide along a longitudinal axis of the body 209-6-5.

The device 201-6-5 comprises an output means (forming part of the UI of the device 201-6-5) in the form of a plurality of light-emitting diodes (LEDs) 211 arranged linearly along the longitudinal axis of the device 201-6-5 and on an outer surface of the body 209-6-5 of the device 201-6-5. A button 212-6-5 is also arranged on an outer surface of the body 209-6-5 of the device 201-6-5 and is axially spaced (i.e., along the longitudinal axis) from the plurality of LEDs 211-6-5.

Figure 20C:
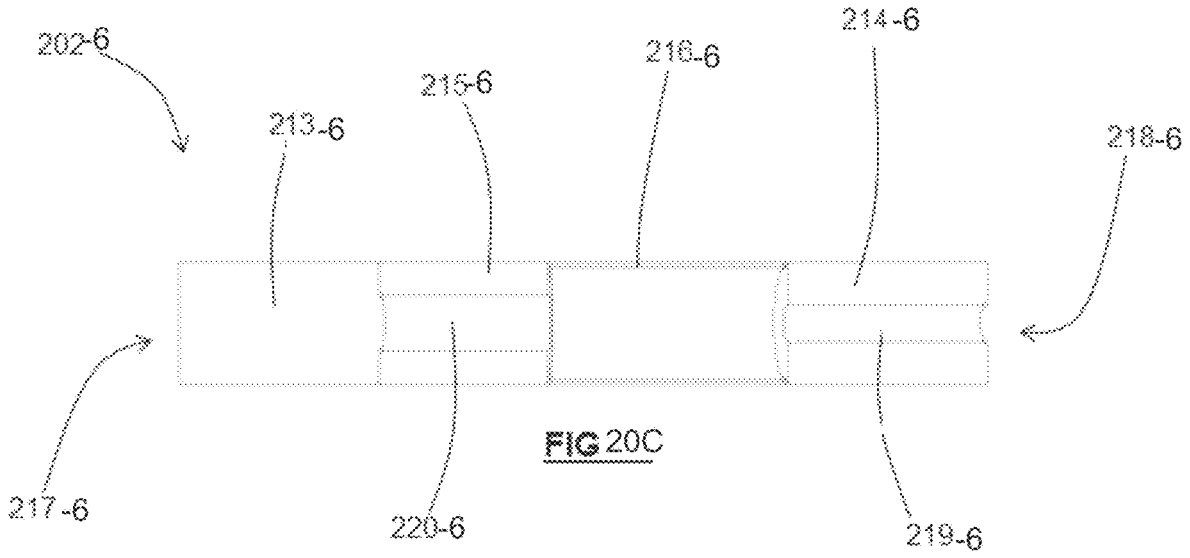
FIG. 20C is a section view of the consumable of the first embodiment of the heat not burn system.

FIG. 20C show a detailed section view of the consumable of 202 of the system 200-6-5. The consumable 202-6-5 generally resembles a cigarette. In that respect, the consumable 202-6-5 has a generally cylindrical form with a diameter of 7 mm and an axial length of 70 mm. The consumable 202-6-5 comprises an aerosol forming substrate 213-6-5, a terminal filter element 214-6-5, an upstream filter element 215-6-5 and a spacer element 216-6-5. In other embodiments, the consumable may further comprise a cooling element. A cooling element may exchange heat with vapor that is formed by the aerosol-forming substrate 213-6-5 in order to cool the vapor so as to facilitate condensation of the vapor.

The aerosol-forming substrate 213-6-5 is substantially cylindrical and is located at an upstream end 217-6-5 of the consumable 202-6-5, and comprises the aerosol former of the system 200-6-5. In that respect, the aerosol forming substrate 213-6-5 is configured to be heated by the device 201-6-5 to release a vapor. The released vapor is subsequently entrained in an airflow flowing through the aerosol-forming substrate 213-6-5. The airflow is produced by the action of the user drawing on a downstream 218 (i.e., terminal or mouth) end of the consumable 202-6-5.

In the present embodiment, the aerosol forming substrate 213-6-5 comprises tobacco material that may, for example, include any suitable parts of the tobacco plant (e.g., leaves, stems, roots, bark, seeds and flowers). The tobacco may comprise one or more of leaf tobacco, stem tobacco, tobacco powder 35 tobacco dust, tobacco derivatives, expanded tobacco, homogenized tobacco, shredded tobacco, extruded tobacco, cut rag tobacco and/or reconstituted tobacco (e.g., slurry recon or paper recon). For example, the aerosol-forming substrate 213-6-5 may comprise a gathered sheet of homogenized (e.g., paper/slurry recon) tobacco or gathered shreds/strips formed from such a sheet.

In order to generate an aerosol, the aerosol forming substrate 213-6-5 comprises at least one volatile compound that is intended to be vaporized/aerosolized and that may provide the user with a recreational and/or medicinal effect when inhaled. The aerosol-forming substrate 213-6-5 may further comprise one or more additives. For example, such additives may be in the form of humectants (e.g., propylene glycol and/or vegetable glycerin), flavorants, fillers, aqueous/non-aqueous solvents and/or binders.

The terminal filter element 214-6-5 is also substantially cylindrical, and is located downstream of the aerosol forming substrate 213-6-5 at the downstream end 218-6-5 of the consumable 202-6-5. The terminal filter element 214-6-5 is in the form of a hollow bore filter element having a bore 219-6-5 (e.g., for airflow) formed there through. The diameter of the bore 219-6-5 is 2 mm. The terminal filter element 214-6-5 is formed of a porous (e.g., monoacetate) filter material. As set forth above, the downstream end 218-6-5 of the consumable 202-6-5 (i.e., where the terminal filter 214-6-5 is located) forms a mouthpiece portion of the consumable 202-6-5 upon which the user draws. Airflow is drawn from the upstream end 217-6-5, thorough the components of the consumable 202-6-5, and out of the downstream end 218-6-5. The airflow is driven by the user drawing on the downstream end 218-6-5 (i.e., the mouthpiece portion) of the consumable 202-6-5.

The upstream filter element 215-6-5 is located axially adjacent to the aerosol-forming substrate 213-6-5, between the aerosol-forming substrate 213-6-5 and the terminal filter element 214-6-5. Like the terminal filter 214-6-5, the upstream filter element 215-6-5 is in the form of a hollow bore filter element, such that it has a bore 220-6-5 extending axially there through. In this way, the upstream filter 215-6-5 may act as an airflow restrictor. The upstream filter element 215-6-5 is formed of a porous (e.g., monoacetate) filter material. The bore 220-6-5 of the upstream filter element 215-6-5 has a larger diameter (3 mm) than the terminal filter element 214-6-5.

The spacer 216-6-5 is in the form of a cardboard tube, which defines a cavity or chamber between the upstream filter element 215-6-5 and the terminal filter element 214-6-5. The spacer 216-6-5 acts to allow both cooling and mixing of the vapor/aerosol from the aerosol-forming substrate 213-6-5. The spacer has an external diameter of 7 mm and an axial length of 14 mm.

Although not apparent from the figure, the aerosol-forming substrate 213-6-5, upstream filter 215-6-5 and spacer 216-6-5 are circumscribed by a paper wrapping layer. The terminal filter 214-6-5 is circumscribed by a tipping layer that also circumscribes a portion of the paper wrapping layer (so as to connect the terminal filter 214-6-5 to the remaining components of the consumable 202-6-5). The upstream filter 215-6-5 and terminal filter 214-6-5 are circumscribed by further wrapping layers in the form of plug wraps.

Figure 20D:
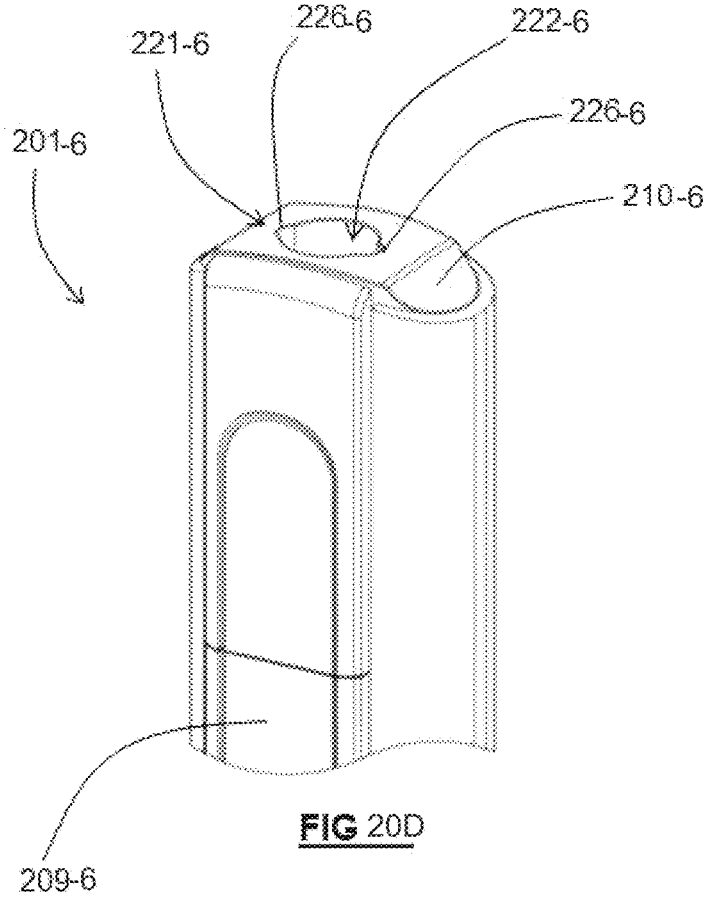
FIG. 20D is a detailed view of an end of the device of the first embodiment of the heat not burn system.

Returning now to the device 201-6-5, FIG. 20D illustrates a detailed view of the end of the device 201-6-5 that is configured to engage with the consumable 202-6-5. The cap 210-6-5 of the device 201-6-5 includes an opening 221-6-5 to an internal cavity 222-6-5 (more apparent from FIG. 20D) defined by the cap 210-6-5. The opening 221-6-5 and the cavity 222-6-5 are formed so as to receive at least a portion of the consumable 202-6-5. During engagement of the consumable 202-6-5 with the device 201-6-5, a portion of the consumable 202-6-5 is received through the opening 221-6-5 and into the cavity 222-6-5. After engagement (see FIG. 20B), the downstream end 218-6-5 of the consumable 202-6-5 protrudes from the opening 221-6-5 and thus also protrudes from the device 201-6-5. The opening 221-6-5 includes laterally disposed notches 226-6-5. When a consumable 202-6-5 is received in the opening 221-6-5, these notches 226-6-5 remain open and could, for example, be used for retaining a cover in order to cover the end of the device 201-6-5.

Figure 20E:
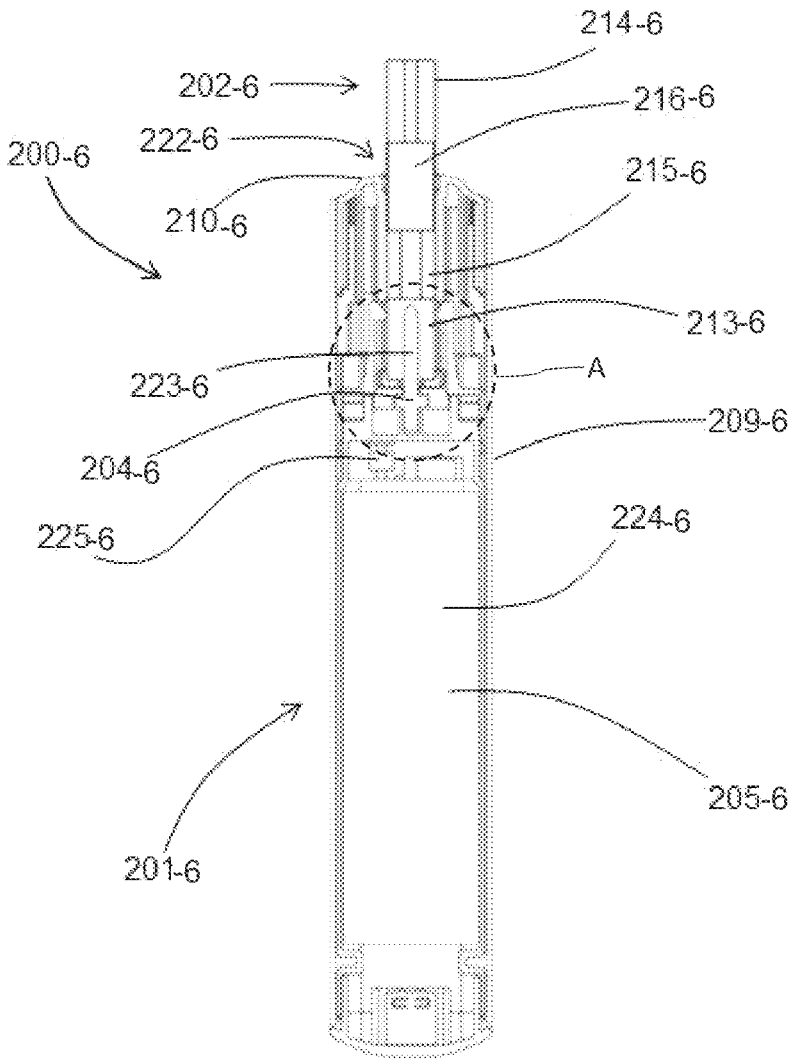
FIG. 20E is a section view of the first embodiment of the substitute smoking system.

FIG. 20E shows a cross section through a central longitudinal plane through the device 201-6-5. The device 201-6-5 is shown with the consumable 202-6-5 engaged therewith.

The device 201-6-5 comprises a heater 204-6-5 comprising heating element 223-6-5. The heater 204-6-5 forms part of the body 209-6-5 of the device 201-6-5 and is rigidly mounted to the body 209-6-5. In the illustrated embodiment, the heater 204-6-5 is a rod heater with a heating element 223-6-5 having a circular transverse profile. In other embodiments the heater may be in the form of a blade heater (e.g., heating element with a rectangular transverse profile) or a tube heater (e.g., heating element with a tubular form).

The heating element 223-6-5 of the heater 204-6-5 projects from an internal base of the cavity 222-6-5 along a longitudinal axis towards the opening 221-6-5. As is apparent from the figure, the length (i.e., along the longitudinal axis) of the heating element is less than a depth of the cavity 222-6-5. In this way, the heating element 223-6-5 does not protrude from or extend beyond the opening 221-6-5.

When the consumable 202-6-5 is received in the cavity 222-6-5 (as is shown in FIG. 20E), the heating element 223-6-5 penetrates the aerosol-forming substrate 213-6-5 of the consumable 202-6-5. In particular, the heating element 223-6-5 extends for nearly the entire axial length of the aerosol-forming substrate 213-6-5 when inserted therein. Thus, when the heater 204-6-5 is activated, heat is transferred radially from an outer circumferential surface the heating element 223-6-5 to the aerosol-forming substrate 213-6-5.

The device 201-6-5 further comprises an electronics cavity 224-6-5. A power source, in the form of a rechargeable battery 205-6-5 (a lithium ion battery), is located in electronics cavity 224-6-5.

The device 201-6-5 includes a connector (i.e., forming part of an IO module of the device 201-6-5) in the form of a USB port 206-6-5. The connector may alternatively be, for example, a micro-USB port or a USB-C port for examples. The USB port 206-6-5 may be used to recharge the rechargeable battery 205-6-5.

The device 201-6-5 includes a controller (not shown) located in the electronics cavity 224-6-5. The controller comprises a microcontroller mounted on a printed circuit board (PCB). The USB port 206-6-5 is also connected to the controller 208-6-5 (i.e., connected to the PCB and microcontroller).

The controller 208-6-5 is configured to control at least one function of the device 201-6-5. For example, the controller 208-6-5 is configured to control the operation of the heater 204-6-5. Such control of the operation of the heater 204-6-5 may be accomplished by the controller toggling the electrical connection of the rechargeable battery 205-6-5 to the heater 204-6-5. For example, the controller 208-6-5 is configured to control the heater 204-6-5 in response to a user depressing the button 212-6-5. Depressing the button 212-6-5 may cause the controller to allow a voltage (from the rechargeable battery 205-6-5) to be applied to the heater 204-6-5 (so as to cause the heating element 223-6-5 to be heated).

The controller is also configured to control the LEDs 211-6-5 in response to (e.g., a detected) a condition of the device 201-6-5 or the consumable 202-6-5. For example, the controller may control the LEDs to indicate whether the device 201-6-5 is in an on state or an off state (e.g., one or more of the LEDs may be illuminated by the controller when the device is in an on state).

The device 201-6-5 comprises a further input means (i.e., in addition to the button 212-6-5) in the form of a puff sensor 225-6-5. The puff sensor 225-6-5 is configured to detect a user drawing (i.e., inhaling) at the downstream end 218-6-5 of the consumable 202-6-5. The puff sensor 225-6-5 may, for example, be in the form of a pressure sensor, flow meter or a microphone. The puff sensor 225-6-5 is operatively connected to the controller 208-6-5 in the electronics cavity 224-6-5, such that a signal from the puff sensor 225-6-5, indicative of a puff state (i.e., drawing or not drawing), forms an input to the controller 208-6-5 (and can thus be responded to by the controller 208-6-5).

Figure 21A:
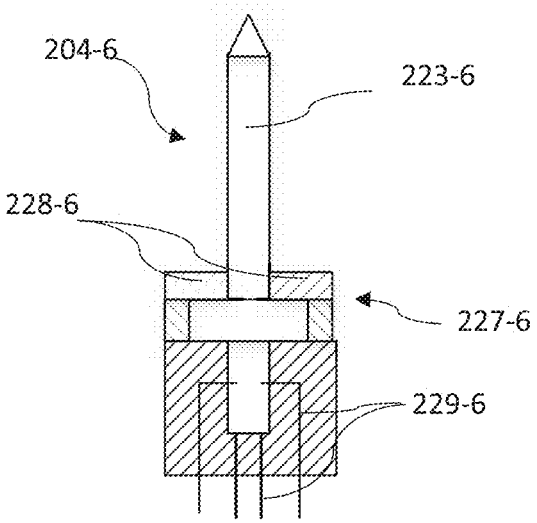
FIG. 21A is a magnified view of portion A of FIG. 20E, showing locking mechanism in a locked position.

Referring to FIG. 21A, which illustrates a magnified view of portion A of FIG. 20E. The device 201-6-5 and the heater apparatus 204-5 may be configured with a locking mechanism 227-5. The locking mechanism 227-5 may be configured to removably retain the heater 204-6-5, in engagement with the device 201-6-5. Further 15 upon engagement of the heater 204-6-5 with the device 201-6-5, at least a pair electrical contacts 229-5 of the heater 204-6-5 may engage with corresponding electrical contacts (not shown) of the device 201-6-5. As an example, the electric contacts 229-5 of the device 201-6-5 may be biased by a suitable biasing means. In an embodiment, the biasing means may include a spring. The spring-loaded electric contacts of the device 201-6-5 may undergo compression upon contact of the electric contacts 229-5 of the heater apparatus 204-5, and establish electric connection between the heater 204-6-5 and the device 201-6-5. Further, the electrical contacts 229-5 of the device 201-6-5 may be directly or indirectly connected to the power source 205-5 (seen in FIG. 20E) i.e., the rechargeable battery, to facilitate voltage supply to the heater 204-6-5.

Further, referring to FIG. 21A, the locking mechanism 227-5 may comprise at least a pair of retaining elements 228-5, which may be configured to retain the heater 204-6-5 upon engagement with the device 201-6-5.

Figure 21B:
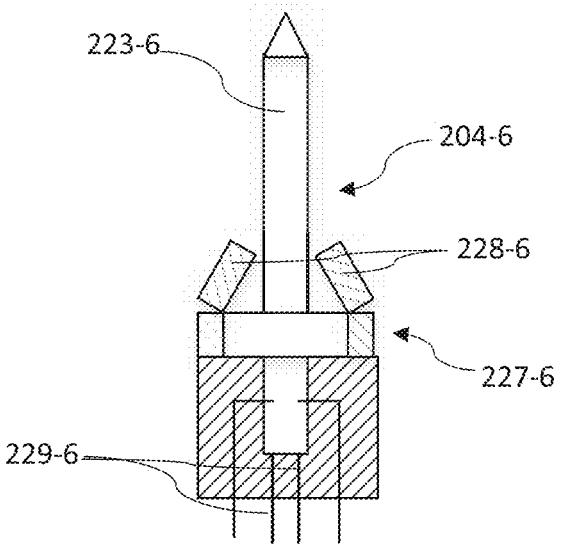
FIG. 21B is a magnified view of portion A of FIG. 20E, showing the locking mechanism in an unlocked position.

25 As apparent from FIG. 21B, the at least a pair of retaining elements 228-5 may be configured to pivot about a point, which may facilitate unlocking the locking mechanism 227-5 and thus, facilitates disengagement of the heater 204-6-5 from the device 201-6-5. Although, not apparent from the figures, the locking mechanism 227-5 may be operated by actuation means to move the retaining elements 228-5 between the locking position and the un-locking position. In an embodiment, the actuation means may be electrically operated or spring-loaded actuation means.

In some embodiments, the heater 204-6-5 may be provided with a temperature sensing component (not shown). The temperature sensing component may comprise a pair of temperature sensing contacts (not shown), which may engage with the corresponding contacts (not shown) of the temperature measurement device 201-6-5. The temperature sensing component and the temperature measuring device 201-6-5, may be adapted to monitor the temperature of the heater 204-6-5. In an embodiment, the temperature measuring contacts may be spring loaded contacts.

In some embodiments, the temperature sensing component and the temperature measuring device 201-6-5 may be operatively connected to the controller (not shown). The controller may receive a signal indicative of the temperature of the heater 204-6-5, in particular below a threshold value. As an example, the threshold temperature may be about 40 degrees to 60 degrees, preferably 50 degrees.

In some embodiments, the device 201-6-5 may comprise a voltage sensing unit (not shown) to monitor supply of voltage to the heater 204-6-5 and a cooling period of the heater 204-6-5 i.e., a threshold time period after off state of the heater 204-6-5. The sensing unit may be operatively connected to the controller. The controller may receive a signal indicative of the cooling period, in particular above the threshold value. As an example, the threshold cooling time period may be about 20 seconds to 100 seconds, preferably 45 seconds to 90 seconds, after off state of the heater 204-6-5.

Now referring to FIG. 21B, the temperature sensing component of the temperature measurement device 201-6-5 may provide a signal, indicative of the temperature of the heater 204-6-5 being below the threshold value, and the sensing unit may provide a signal, indicative of the cooling time period being above the threshold value may form an input signal to the controller. These corresponding signals, for man input signal to the controller. Based on the input signal, the controller may facilitate in unlocking the locking mechanism 227-5 i.e., the pair of retaining elements 228-5 may pivot about a point and may displace away from the heater 204-6-5. Thus, unlocking the locking mechanism 227-5 may facilitate in disengagement of the heater 204-6-5 from the device 201-6-5. This feature may facilitate in replacing the heater 204-6-5, without the need of replacing the entire device 201-6-5, due to malfunction of the heater 204-6-5. The locking mechanism 227-5 also prevents dislodging of the heater apparatus 204-5 in a hot condition, and thereby preventing potential injury to the user or damage to the device 201-6-5. Further, the feature of dislodging the heater apparatus 204-5 from the device 201-6-5, may facilitate in effective cleaning of the heater 204-6-5, which may facilitate in effective heat dissipation by the heater 204-6-5.

In some embodiments, the locking mechanism 227-5 may include spring loaded retaining elements or slidable retaining elements, which may displace, to allow disengagement of the heater 204-6-5 from the device 201-6-5.

In some embodiments, the device 201-6-5 may be configured with a system (not shown) to determine the engagement of the heater 204-6-5 with the device 201-6-5. Further, the device 201-6-5 may be configured with a calibrating system, which may be adapted to calibrate the heater 204-6-5, upon engagement of the heater 204-6-5 with the device 210-5. In some embodiments, the calibration routine may include measuring of ambient temperature. As an example, the ambient temperature may be measured by an ambient temperature sensor. In some embodiments, the ambient temperature sensor may be positioned within the microcontroller. Further, the calibration routine may include measurement of the resistance of the heating track and the temperature sensing track. This may facilitate in achieving optimum operational parameters of the heating apparatus 204-5 and thus the calibration routine may ensure effective operation of the heater apparatus 204-5 when the HNB consumable 202-6-5 (shown in FIG. 20A) is inserted therein. In some embodiments, the heater apparatus 204-5 may include air flow channels (not shown), to facilitate flow of air onto the heating apparatus 204-5, which may facilitate in effective aerosol generation by the consumable 202-6-5 and total particulate matter (TPM) output of the aerosol.

Figure 22A:
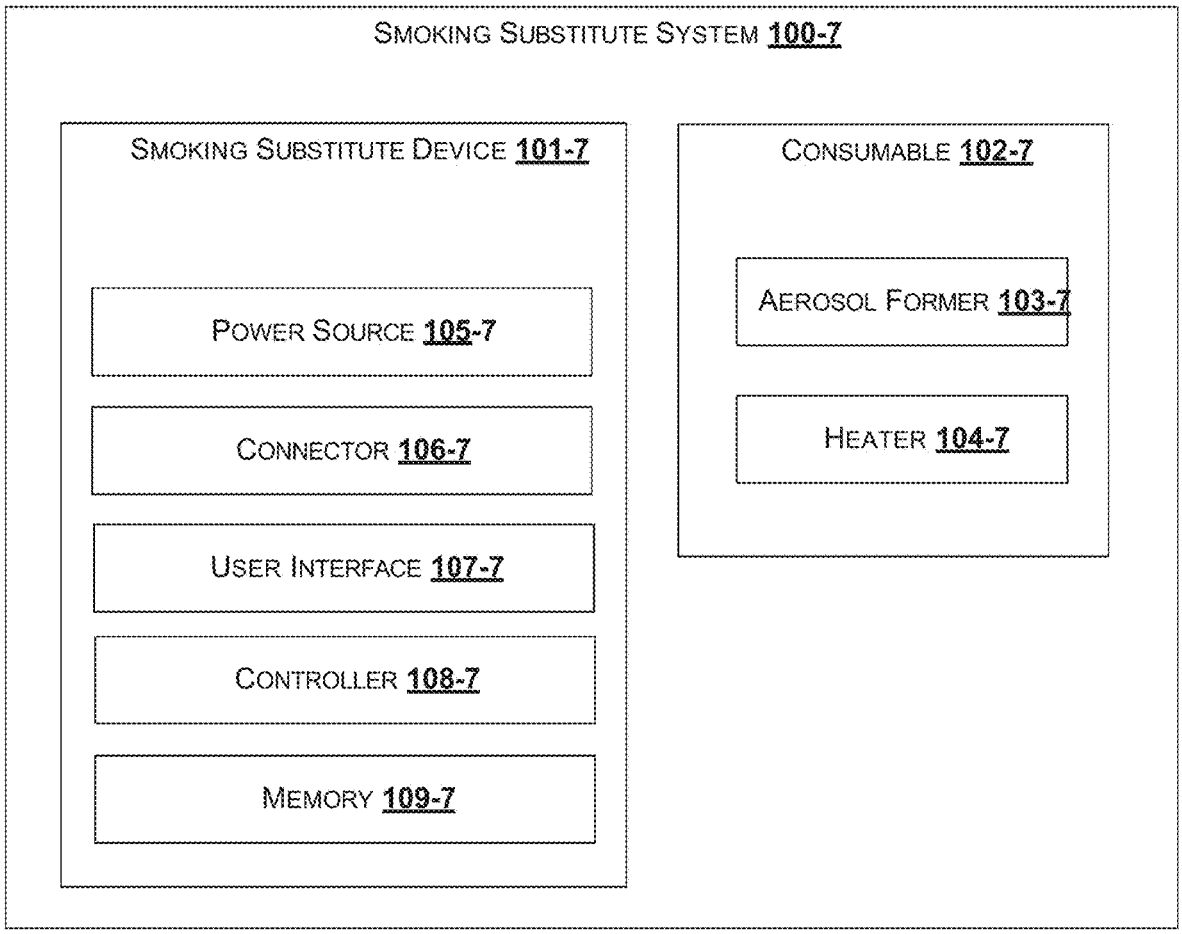
FIG. 22A is a schematic of a smoking substitute system.

Seventh Mode of the Disclosure FIG. 22A is a schematic providing a general overview of a smoking substitute system 100-6. The system 100-6 includes a substitute smoking device 101-6 and an aerosol-forming article in the form of a consumable 102-6, which comprises an aerosol former 103-6. The system is configured to vaporize the aerosol former by heating the aerosol former 103-6 (so as to form a vapor/aerosol for inhalation by a user).

In the illustrated system, the heater 104-6 forms part of the consumable 102-6 and is configured to heat the aerosol former 103-6. In this variation, the heater 104-6 is electrically connectable to the power source 105-6, for example, when the consumable 102-6 is engaged with the device 101-6. Heat from the heater 104-6 vaporizes the aerosol former 103-6 to produce a vapor. The vapor subsequently condenses to form an aerosol, which is ultimately inhaled by the user.

The system 100-6 further comprises a power source 105-6 that forms part of the device 101-6. In other embodiments the power source 105-6 may be external to (but connectable to) the device 101-6. The power source 105-6 is electrically connectable to the heater 104-6 such that it is able to supply power to the heater 104-6 (i.e., for the purpose of heating the aerosol former 103-6). Thus, control of the electrical connection of the power source 105-6 to the heater 104-6 provides control of the state of the heater 104-6. The power source 105-6 may be a power store, for example a battery or rechargeable battery (e.g., a lithium ion battery).

The system 100-6 further comprises an I/O module comprising a connector 106-6 (e.g., in the form of a USB port, Micro USB port, USB-C port, etc.). The connector 106-6 is configured for connection to an external source of electrical power, e.g., a mains electrical supply outlet. The connector 106-6 may be used in substitution for the power source 105-6. That is the connector 106-6 may be electrically connectable to the heater 104-6 so as to supply electricity to the heater 104-6. In such embodiments, the device may not include a power source, and the power source of the system may instead comprise the connector 106-6 and an external source of electrical power (to which the connector 106-6 provides electrical connection).

In some embodiments, the connector 106-6 may be used to charge and recharge the power source 105-6 where the power source 105-6 includes a rechargeable battery.

The system 100-6 also comprises a user interface (UI) 107. Although not shown, the UI 107-6 may include input means to receive commands from a user. The input means of the UI 107-6 allows the user to control at least one aspect of the operation of the system 100-6. The input means may, for example, be in the form of a button, touchscreen, switch, microphone, etc.

The UI 107-6 also comprises output means to convey information to the user. The output means may, for example, comprise lights (e.g., LEDs), a display screen, speaker, vibration generator, etc.

The system 100-6 further comprises a controller 108-6 that is configured to control at least one function of the device 101-6. In the illustrated embodiment, the controller 108-6 is a component of the device 101-6, but in other embodiments may be separate from (but connectable to) the device 101-6. The controller 108-6 is configured to control the operation of the heater 104-6 and, for example, may be configured to control the voltage applied from the power source 105-6 to the heater 104-6. The controller 108-6 may be configured to toggle the supply of power to the heater 104-6 between an on state, in which the full output voltage of the power source 105-6 is applied to the heater 104-6, and an off state, in which the no voltage is applied to the heater 104-6.

Although not shown, the system 100-6 may also comprise a voltage regulator to regulate the output voltage from the power source 105-6 to form a regulated voltage. The regulated voltage may then be applied to the heater 104-6.

In addition to being connected to the heater 104-6, the controller 108-6 is operatively connected to the UI 107-6.

Thus, the controller 108-6 may receive an input signal from the input means of the UI 107-6. Similarly, the controller 108-6 may transmit output signals to the UI 107-6. In response, the output means of the UI 107-6 may convey information, based on the output signals, to a user. The controller also comprises a memory 109-6, which is a non-volatile memory. The memory 109-6 includes instructions, which, when implemented, cause the controller to perform certain tasks or steps of a method.

Figure 22B:
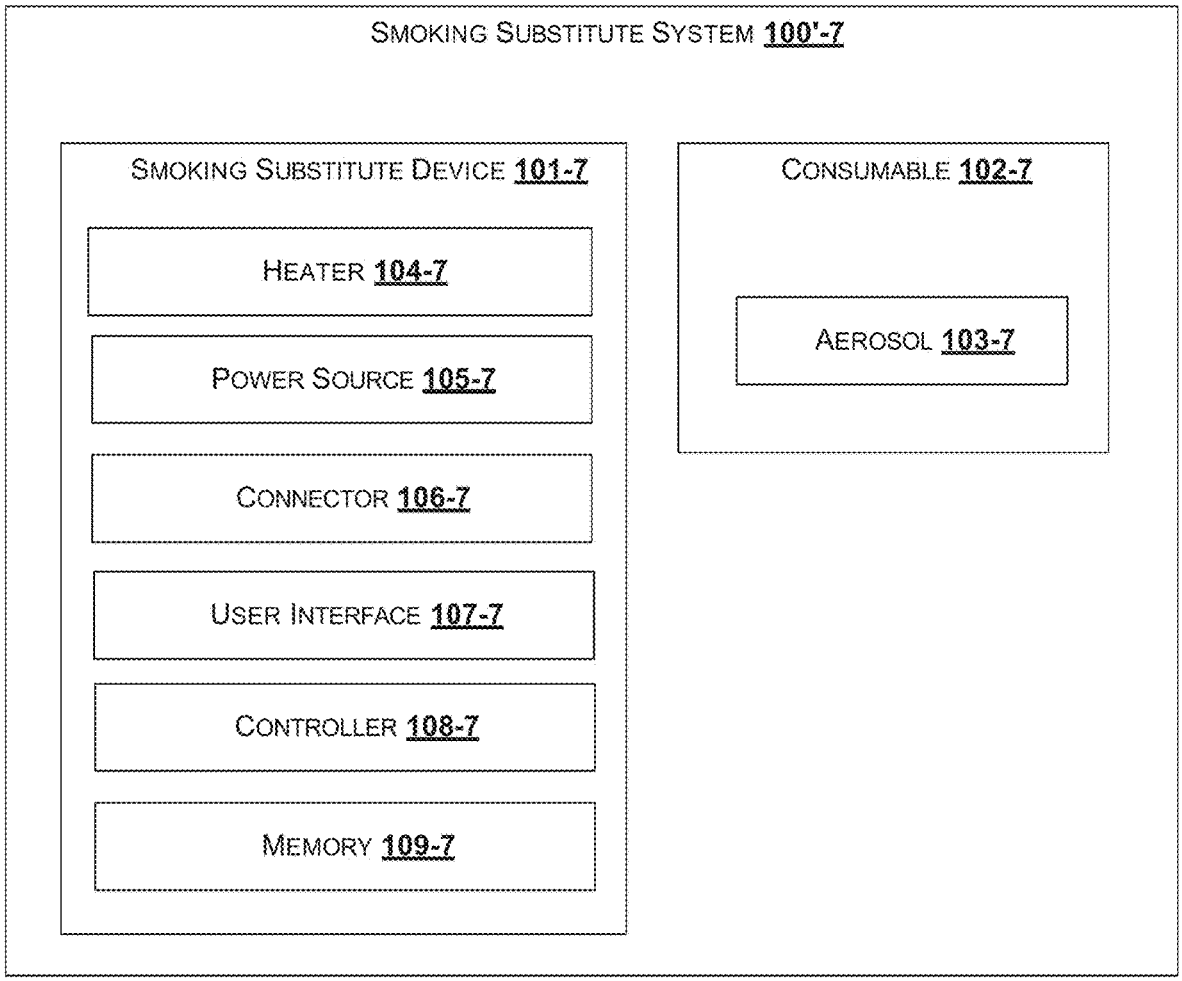
FIG. 22B is a schematic of a variation of the smoking substitute system of FIG. 22A.

FIG. 22B is a schematic showing a variation of the system 100-6 of FIG. 22A. In the system 100-6' of FIG. 22B, the heater 104-6 forms part of the device 101-6, rather than the consumable 102-6. In this variation, the heater 104-6 is electrically connected to the power source 105-6.

Figure 23A:
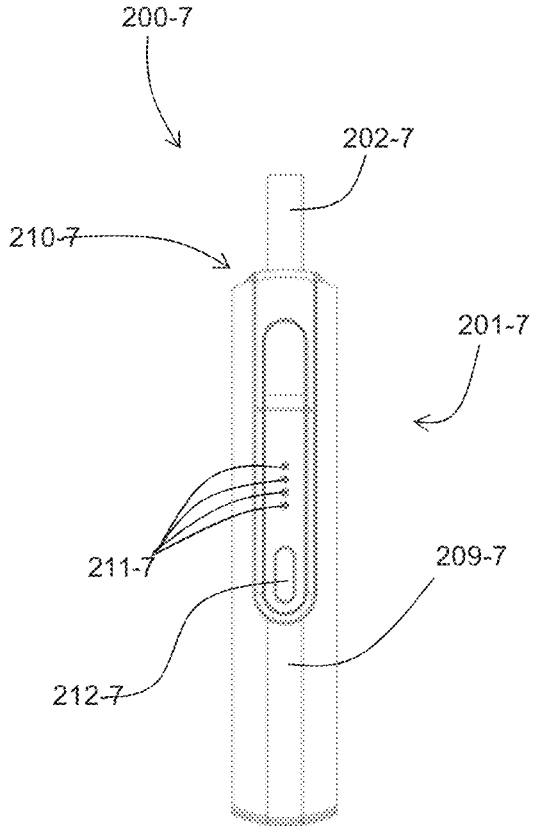
FIG. 23A is a front view of a first embodiment of a seventh mode of a smoking substitute system with the consumable engaged with the device.
Figure 23B:
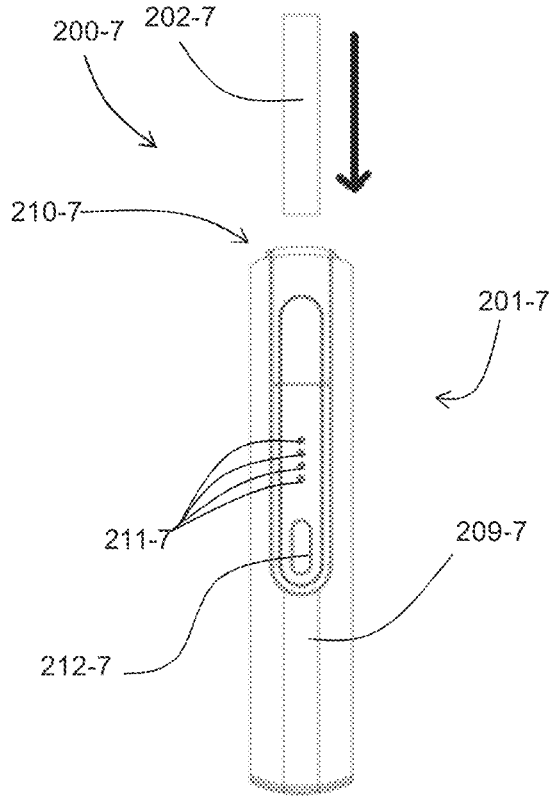
FIG. 23B is a front view of the first embodiment of the smoking substitute system with the consumable disengaged from the device.

FIG. 23A and FIG. 23B illustrate a heated-tobacco (HT) smoking substitute system 200-6. The system 200-6 is an example of the systems 100-6, 100' described in relation to FIG. 22A or FIG. 22B. System 200-6 includes an HT device 201-6 and an HT consumable 202-6. The description of FIG. 22A and FIG. 22B above is applicable to the system 200-6 of FIG. 23A and FIG. 23B, and will thus not be repeated.

The device 201-6 and the consumable 202-6 are configured such that the consumable 202-6 can be engaged with the device 201-6. FIG. 23A shows the device 201-6 and the consumable 202-6 in an engaged state, whilst FIG. 23B shows the device 201-6 and the consumable 202-6 in a disengaged state.

The device 201-6 comprises a body 209-6 and cap 210-6. In use the cap 210-6 is engaged at an end of the body 209-6. The cap 210-6 is moveable relative to the body 209-6, as best seen in FIG. 23F and FIG. 23G. In particular, the cap 210-6 is slideable and can slide along a longitudinal axis of the body 209-6. The cap 210-6 is movable between an engaged position and a disengaged position. FIG. 23F is a front view of the device 201-6 with the cap 210-6 in an engaged position. FIG. 23G is a front perspective view of the device 201-6 with the cap 210-6 in a disengaged position.

The engaged position may be achieved by locking the cap 210-6 to the body of the device 201-6. In the engaged position, the cap 210-6 is configured to conceal the heating element 223-6. The disengaged position is achieved by lifting the cap 210-6 for a predefined distance from the body of the device 201-6. The disengaged position represents the end of the travel of the cap and the cap is not intended to be removed from the device. In the disengaged position, the cap 210-6 is configured to expose the heating element 223-6 at least partially as shown in FIG. 23G via an aperture defined between the cap 210-6 and the body 209-6 when the cap is in the disengaged position. In the disengaged position, the heating element 223-6 may be exposed to provide for inspection and cleaning of the heating element 223-6, e.g., to remove tobacco debris.

In an embodiment, the cap 210-6 is biased into the engaged position shown in FIG. 23F by one or more magnets associated with the cap 210-6 and the device 201-6. The user pushes the cap 210-6 against the bias of the magnets to move the cap into the disengaged position shown in FIG. 23G. When the user moves the cap slightly away from the disengaged position, the one or more magnets cause the cap 210-6 to snap back to get into the engaged position shown in FIG. 23F.

The device 201-6 comprises an output means (forming part of the UI of the device 201-6) in the form of a plurality of light-emitting diodes (LEDs) 211 arranged linearly along the longitudinal axis of the device 201-6 and on an outer surface of the body 209-6 of the device 201-6. A button 212-6 is also arranged on an outer surface of the body 209-6 of the device 201-6 and is axially spaced (i.e., along the longitudinal axis) from the plurality of LEDs 211-6.

Figure 23C:
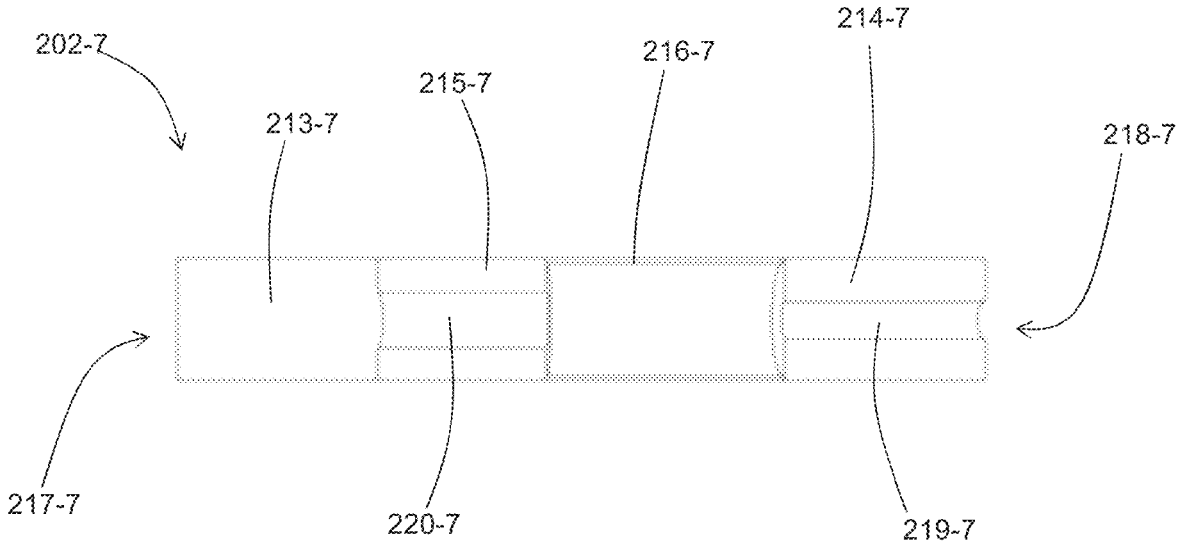
FIG. 23C is a section view of the consumable of the first embodiment of the smoking substitute system.

FIG. 23C show a detailed section view of the consumable of 202 of the system 200-6. The consumable 202-6 generally resembles a cigarette. In that respect, the consumable 202-6 has a generally cylindrical form with a diameter of 7 mm and an axial length of 70 mm. The consumable 202-6 comprises an aerosol forming substrate 213-6, a terminal filter element 214-6, an upstream filter element 215-6 and a spacer element 216-6. In other embodiments, the consumable may further comprise a cooling element. A cooling element may exchange heat with vapor that is formed by the aerosol-forming substrate 213-6 in order to cool the vapor so as to facilitate condensation of the vapor.

The aerosol-forming substrate 213-6 is substantially cylindrical and is located at an upstream end 217-6 of the consumable 202-6, and comprises the aerosol former of the system 200-6. In that respect, the aerosol forming substrate 213-6 is configured to be heated by the device 201-6 to release a vapor. The released vapor is subsequently entrained in an airflow flowing through the aerosol-forming substrate 213-6. The airflow is produced by the action of the user drawing on a downstream 218 (i.e., terminal or mouth) end of the consumable 202-6.

In the present embodiment, the aerosol forming substrate 213-6 comprises tobacco material that may, for example, include any suitable parts of the tobacco plant (e.g., leaves, stems, roots, bark, seeds and flowers). The tobacco may comprise one or more of leaf tobacco, stem tobacco, tobacco powder, tobacco dust, tobacco derivatives, expanded tobacco, homogenized tobacco, shredded tobacco, extruded tobacco, cut rag tobacco and/or reconstituted tobacco (e.g., slurry recon or paper recon). For example, the aerosol-forming substrate 213-6 may comprise a gathered sheet of homogenized (e.g., paper/slurry recon) tobacco or gathered shreds/strips formed from such a sheet.

In order to generate an aerosol, the aerosol forming substrate 213-6 comprises at least one volatile compound that is intended to be vaporized/aerosolized and that may provide the user with a recreational and/or medicinal effect when inhaled. The aerosol-forming substrate 213-6 may further comprise one or more additives. For example, such additives may be in the form of humectants (e.g., propylene glycol and/or vegetable glycerin), flavorants, fillers, aqueous/non-aqueous solvents and/or binders.

The terminal filter element 214-6 is also substantially cylindrical, and is located downstream of the aerosol forming substrate 213-6 at the downstream end 218-6 of the consumable 202-6. The terminal filter element 214-6 is in the form of a hollow bore filter element having a bore 219-6 (e.g., for airflow) formed there through. The diameter of the bore 219-6 is 2 mm. The terminal filter element 214-6 is formed of a porous (e.g., monoacetate) filter material. As set forth above, the downstream end 218-6 of the consumable 202-6 (i.e., where the terminal filter 214-6 is located) forms a mouthpiece portion of the consumable 202-6 upon which the user draws. Airflow is drawn from the upstream end 217-6, thorough the components of the consumable 202-6, and out of the downstream end 218-6. The airflow is driven by the user drawing on the downstream end 218-6 (i.e., the mouthpiece portion) of the consumable 202-6.

The upstream filter element 215-6 is located axially adjacent to the aerosol-forming substrate 213-6, between the aerosol-forming substrate 213-6 and the terminal filter element 214-6. Like the terminal filter 214-6, the upstream filter element 215-6 is in the form of a hollow bore filter element, such that it has a bore 220-6 extending axially there through. In this way, the upstream filter 215-6 may act as an airflow restrictor. The upstream filter element 215-6 is formed of a porous (e.g., monoacetate) filter material. The bore 220-6 of the upstream filter element 215-6 has a larger diameter (3 mm) than the terminal filter element 214-6.

The spacer 216-6 is in the form of a cardboard tube, which defines a cavity or chamber between the upstream filter element 215-6 and the terminal filter element 214-6. The spacer 216-6 acts to allow both cooling and mixing of the vapor/aerosol from the aerosol-forming substrate 213-6. The spacer has an external diameter of 7 mm and an axial length of 14 mm.

Although not apparent from the figure, the aerosol-forming substrate 213-6, upstream filter 215-6 and spacer 216-6 are circumscribed by a paper wrapping layer. The terminal filter 214-6 is circumscribed by a tipping layer that also circumscribes a portion of the paper wrapping layer (so as to connect the terminal filter 214-6 to the remaining components of the consumable 202-6). The upstream filter 215-6 and terminal filter 214-6 are circumscribed by further wrapping layers in the form of plug wraps.

Figure 23D:
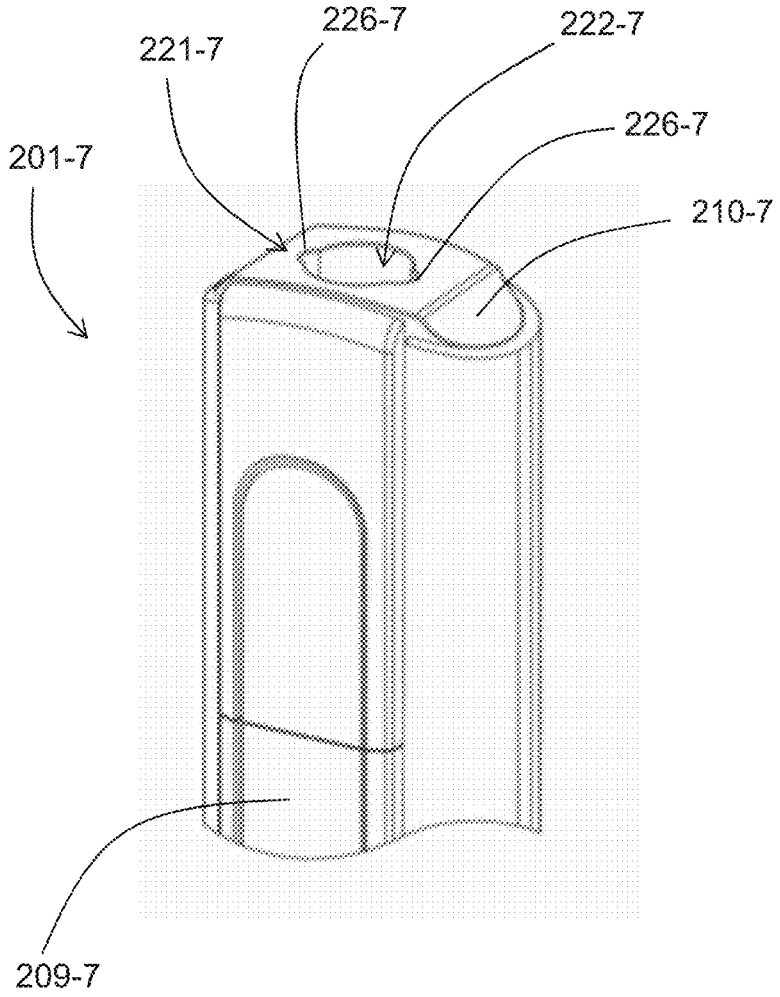
FIG. 23D is a detailed view of an end of the device of the first embodiment of the smoking substitute system.

Returning now to the device 201-6, FIG. 23D illustrates a detailed view of the end of the device 201-6 that is configured to engage with the consumable 202-6. The cap 210-6 of the device 201-6 includes an opening 221-6 to an internal cavity 222-6 (more apparent from FIG. 23D) defined by the cap 210-6. The opening 221-6 and the cavity 222-6 are formed so as to receive at least a portion of the consumable 202-6. During engagement of the consumable 202-6 with the device 201-6, a portion of the consumable 202-6 is received through the opening 221-6 and into the cavity 222-6. After engagement (see FIG. 23B), the downstream end 218-6 of the consumable 202-6 protrudes from the opening 221-6 and thus also protrudes from the device 201-6. The opening 221-6 includes laterally disposed notches 226-6. When a consumable 202-6 is received in the opening 221-6, these notches 226-6 remain open and could, for example, be used for retaining a cover in order to cover the end of the device 201-6.

Figure 23E:
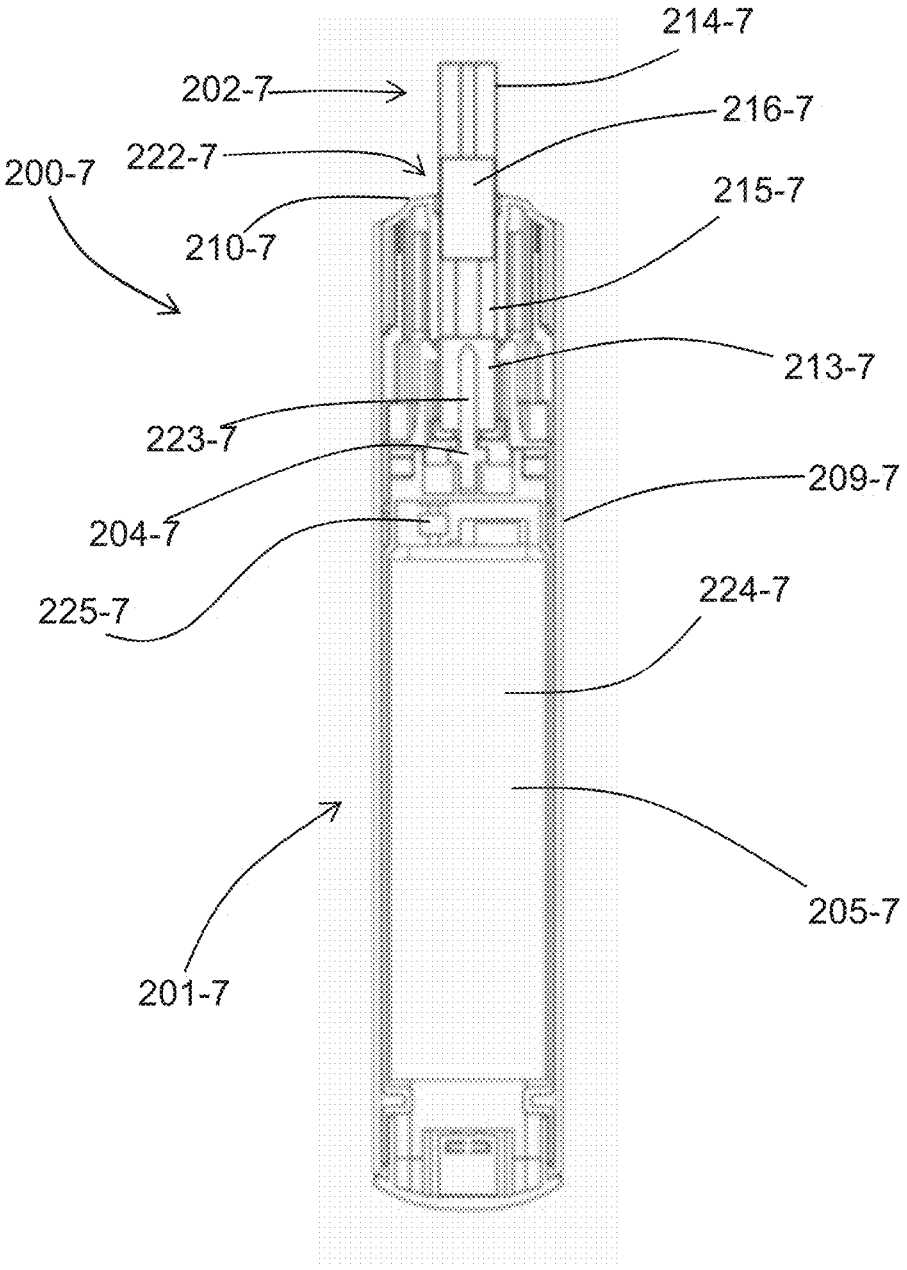
FIG. 23E is a section view of the first embodiment of the substitute smoking system.
Figure 23G:
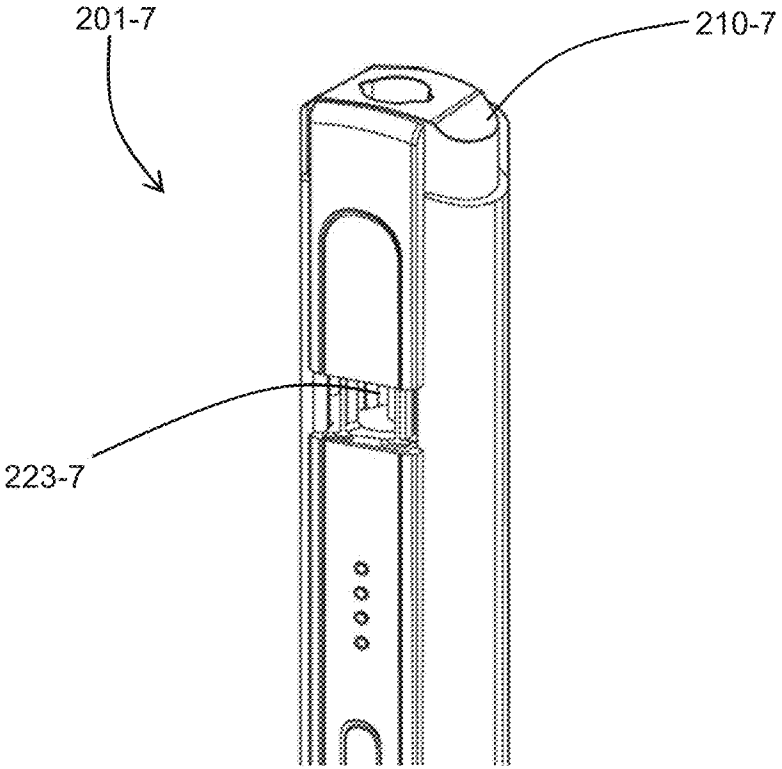
FIG. 23G is a front perspective view of the device with the cap in a disengaged position.
Figure 23F:
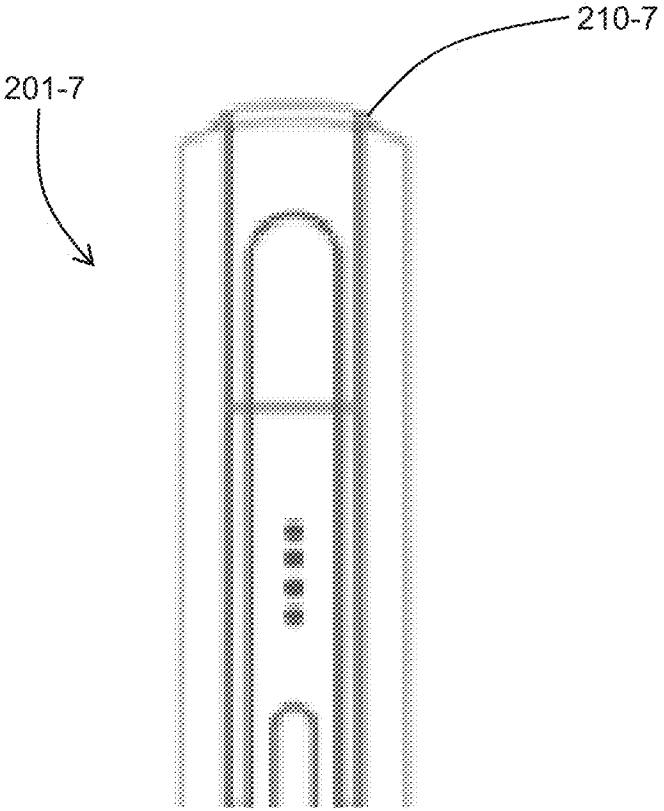
FIG. 23F is a front view of the device with cap in an engaged position.

FIG. 23E shows a cross section through a central longitudinal plane through the device 201-6. The device 201-6 is shown with the consumable 202-6 engaged therewith.

The device 201-6 comprises a heater 204-6 comprising heating element 223-6. The heater 204-6 forms part of the body 209-6 of the device 201-6 and is rigidly mounted to the body 209-6. In the illustrated embodiment, the heater 204-6 is a rod heater with a heating element 223-6 having a circular transverse profile. In other embodiments the heater may be in the form of a blade heater (e.g., heating element with a rectangular transverse profile) or a tube heater (e.g., heating element with a tubular form).

The heating element 223-6 of the heater 204-6 projects from an internal base of the cavity 222-6 along a longitudinal axis towards the opening 221-6. As is apparent from the figure, the length (i.e., along the longitudinal axis) of the heating element is less than a depth of the cavity 222-6. In this way, the heating element 223-6 does not protrude from or extend beyond the opening 221-6.

When the consumable 202-6 is received in the cavity 222-6 (as is shown in FIG. 23E), the heating element 223-6 penetrates the aerosol-forming substrate 213-6 of the consumable 202-6. In particular, the heating element 223-6 extends for nearly the entire axial length of the aerosol-forming substrate 213-6 when inserted therein. Thus, when the heater 204-6 is activated, heat is transferred radially from an outer circumferential surface the heating element 223-6 to the aerosol-forming substrate 213-6.

The device 201-6 further comprises an electronics cavity 224-6. A power source, in the form of a rechargeable battery 205-6 (a lithium ion battery), is located in electronics cavity 224-6.

The device 201-6 includes a connector (i.e., forming part of an IO module of the device 201-6) in the form of a USB port 206-6. The connector may alternatively be, for example, a micro-USB port or a USB-C port for examples. The USB port 206-6 may be used to recharge the rechargeable battery 205-6.

The device 201-6 includes a controller (not shown) located in the electronics cavity 224-6. The controller comprises a microcontroller mounted on a printed circuit board (PCB). The USB port 206-6 is also connected to the controller 208-6 (i.e., connected to the PCB and microcontroller).

The controller 208-6 is configured to control at least one function of the device 202-6. For example, the controller 208-6 is configured to control the operation of the heater 204-6. Such control of the operation of the heater 204-6 may be accomplished by the controller toggling the electrical connection of the rechargeable battery 205-6 to the heater 204-6. For example, the controller 208-6 is configured to control the heater 204-6 in response to a user depressing the button 212-6. Depressing the button 212-6 may cause the controller to allow a voltage (from the rechargeable battery 205-6) to be applied to the heater 204-6 (so as to cause the heating element 223-6 to be heated).

The controller is also configured to control the LEDs 211-6 in response to (e.g., a detected) a condition of the device 201-6 or the consumable 202-6. For example, the controller may control the LEDs to indicate whether the device 201-6 is in an on state or an off state (e.g., one or more of the LEDs may be illuminated by the controller when the device is in an on state).

In an embodiment, the device 201-6 includes a proximity sensor (not shown) which detects the proximity of the cap 210-6 to the body 209-6 of the device. The controller 208-6 is configured to receive a signal from the proximity sensor and determine based on that signal whether the cap 210-6 is engaged (as shown in FIG. 23F) or disengaged (as shown in FIG. 23G) with the device.

In a particular embodiment the proximity sensor is a Hall effect sensor.

In some embodiments, the controller may be configured to control the power supply to the heating element 223-6, based on the position of the cap 210-6. In some embodiments, the device 201-6 may include a Hall effect sensor which may be configured to measure magnetic field associated with one or more magnets within the device 201-6. Output of the Hall effect sensor may be received by the controller for controlling said power supply to the heating element 223-6.

When the cap 210-6 is in the engaged position, the magnetic field may be greater or may increase and when the cap 210-6 is in the disengaged position, the magnetic field may be lower or may decrease. The controller receives a signal indicating the magnetic field measured by the Hall effect sensor and compares the magnetic field with a threshold value to detect the position of the cap as in one of the engaged position and disengaged position.

If the controller determines that the magnetic field is greater than the threshold value, the controller may determine the cap 210-6 to be in the engaged position and enable supply of power from the power source to the heating element 223-6. If the controller determines that the magnetic field is lesser than the threshold value, the controller may determine the cap 210-6 to be in the disengaged position and disable the power supply from the power source to the heating element 223-6. By which, heating of the heating element 223-6, when the heating element 223-6 is exposed may be avoided.

In some embodiments, the Hall effect sensor may be configured to function as a switch to enable and disable power supply to the heating element 223-6, based on the magnetic field measurement.

The device 201-6 comprises a further input means (i.e., in addition to the button 212-6) in the form of a puff sensor 225-6. The puff sensor 225-6 is configured to detect a user drawing (i.e., inhaling) at the downstream end 218-6 of the consumable 202-6. The puff sensor 225-6 may, for example, be in the form of a pressure sensor, flow meter or a microphone. The puff sensor 225-6 is operatively connected to the controller 208-6 in the electronics cavity 224-6, such that a signal from the puff sensor 225-6, indicative of a puff state (i.e., drawing or not drawing), forms an input to the controller 208-6 (and can thus be responded to by the controller 208-6).

By the proposed device and method, undesired heating of the heating element 223-6 may be eliminated. Also, user may be provisioned to use the device 201-6 safely.

Figure 24:
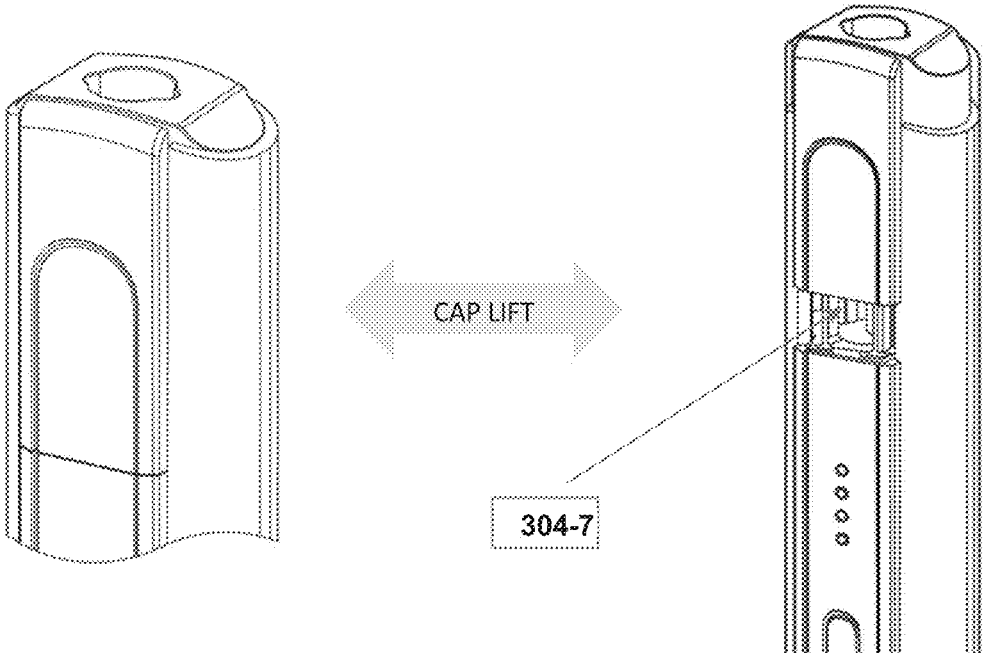
FIG. 24 illustrates exemplary functionality of the device according to first embodiment of the smoking substitute device.
Figure 25:
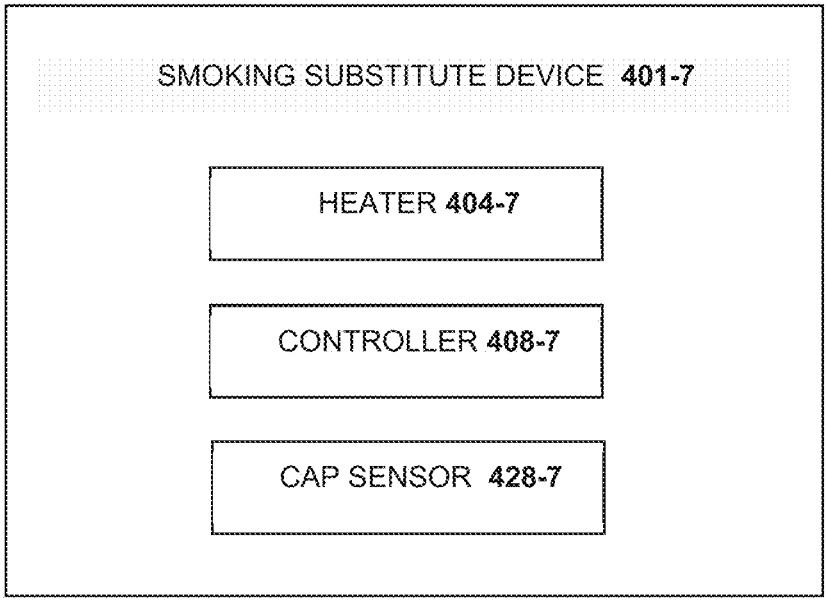
FIG. 25 illustrates a block diagram of a smoking substitute device according to an embodiment of the seventh mode of the smoking substitute system.

FIG. 24 shows movement of cap from a closed position to open (or "lifted") position. Further, FIG. 25 shows the block diagram of a device which has heater 404-6 connected to the controller 408-6, wherein the Controller can control the power supplied to the heater. Further, cap sensor 428-6 is connected to the controller 408-6 to indicate movement in the cap. When the cap is moved or lifted up to the open position, the heater element 304-6 is partially exposed. The cap sensor 428-6 detects the movement of the cap and generate a signal indicative of movement of the cap. The controller 408-6 receives the signal and reduces or switches off of the power supplied to the heater so as to avoid heating of the heater when the cap is lifted or removed. This may provide a device with improved safety since heating of the heater is reduced or cut when the cap is lifted or removed. In addition, turning off the heater when exposed will also prevent hot tobacco coming out. In one example, the cap sensor 428-6 may be a hall effect sensor. In some embodiments, the cap includes a detected component for the cap sensor to detect. For example, the cap may include a magnet or may be a magnetic cap. Movement of the magnet or magnetic cap is detected by the cap sensor. In another embodiment, the sensor 428-6 can detect the closed position of the cap and signal the controller 408-6 to supply power to the heater 404-6. In some embodiments, the device housing includes a magnet of opposite polarity to the magnet in the cap. The cap magnet and housing magnet interact with one another to provide resistance to movement of the cap. In some embodiments, the hall effect sensor is configured to detect the polarity of the magnet in the cap.

The device 301-6 also includes an input means in the form of a puff sensor (not shown). The puff sensor is the same as that described above with respect to the embodiment shown in FIG. 23A to FIG. 23E.

Figure 26A:
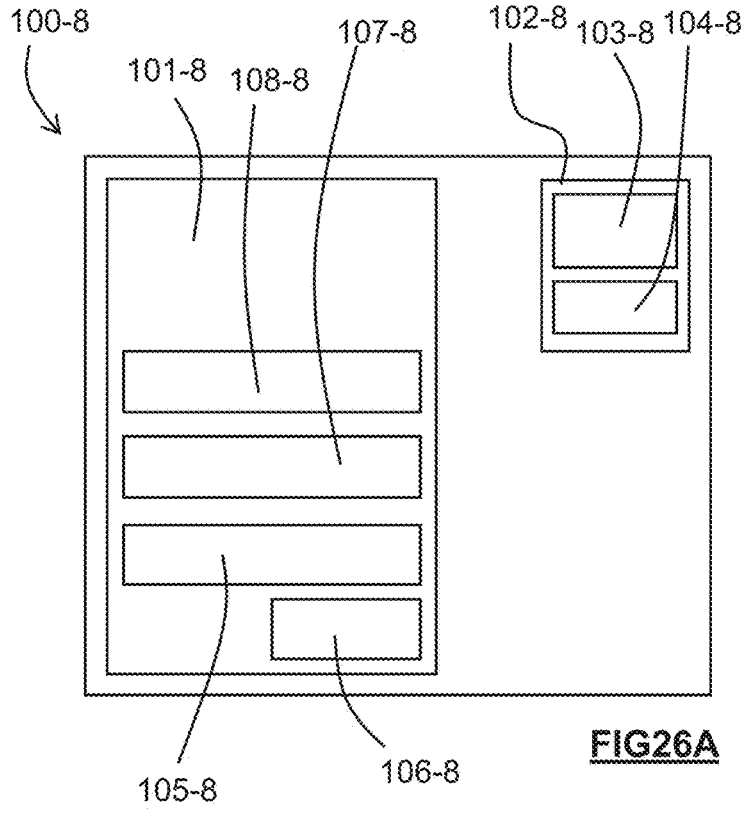
FIG. 26A is a schematic of a smoking substitute system.

Eighth Mode of the Disclosure FIG. 26A is a schematic providing a general overview of a smoking substitute system 100-7. The system 100-7 includes a substitute smoking device 101-7 and an aerosol-forming article in the form of a consumable 102-7, which comprises an aerosol former 103-7. The system is configured to vaporize the aerosol former by heating the aerosol former 103-7 (so as to form a vapor/aerosol for inhalation by a user).

In the illustrated system, the heater 104-7 forms part of the consumable 102-7 and is configured to heat the aerosol former 103-7. In this variation, the heater 104-7 is electrically connectable to the power source 105-7, for example, when the consumable 102-7 is engaged with the device 101-7. Heat from the heater 104-7 vaporizes the aerosol former 103-7 to produce a vapor. The vapor subsequently condenses to form an aerosol, which is ultimately inhaled by the user.

The system 100-7 further comprises a power source 105-7 that forms part of the device 101-7. In other embodiments the power source 105-7 may be external to (but connectable to) the device 101-7. The power source 105-7 is electrically connectable to the heater 104-7 such that it is able to supply power to the heater 104-7 (i.e., for the purpose of heating the aerosol former 103-7). Thus, control of the electrical connection of the power source 105-7 to the heater 104-7 provides control of the state of the heater 104-7. The power source 105-7 may be a power store, for example a battery or rechargeable battery (e.g., a lithium ion battery).

The system 100-7 further comprises an I/O module comprising a connector 106-7 (e.g., in the form of a USB port, Micro USB port, USB-C port, etc.). The connector 106-7 is configured for connection to an external source of electrical power, e.g., a mains electrical supply outlet. The connector 106-7 may be used in substitution for the power source 105-7. That is the connector 106-7 may be electrically connectable to the heater 104-7 so as to supply electricity to the heater 104-7. In such embodiments, the device may not include a power source, and the power source of the system may instead comprise the connector 106-7 and an external source of electrical power (to which the connector 106-7 provides electrical connection).

In some embodiments, the connector 106-7 may be used to charge and recharge the power source 105-7 where the power source 105-7 includes a rechargeable battery.

The system 100-7 also comprises a user interface (UI) 107. Although not shown, the UI 107-7 may include input means to receive commands from a user. The input means of the UI 107-7 allows the user to control at least one aspect of the operation of the system 100-7. The input means may, for example, be in the form of a button, touchscreen, switch, microphone, etc.

The UI 107-7 also comprises output means to convey information to the user. The output means may, for example, comprise lights (e.g., LEDs), a display screen, speaker, vibration generator, etc.

The system 100-7 further comprises a controller 108-7 that is configured to control at least one function of the device 101-7. In the illustrated embodiment, the controller 108-7 is a component of the device 101-7, but in other embodiments may be separate from (but connectable to) the device 101-7. The controller 108-7 is configured to control the operation of the heater 104-7 and, for example, may be configured to control the voltage applied from the power source 105-7 to the heater 104-7. The controller 108-7 may be configured to toggle the supply of power to the heater 104-7 between an on state, in which the full output voltage of the power source 105-7 is applied to the heater 104-7, and an off state, in which the no voltage is applied to the heater 104-7.

Although not shown, the system 100-7 may also comprise a voltage regulator to regulate the output voltage from the power source 105-7 to form a regulated voltage. The regulated voltage may then be applied to the heater 104-7.

In addition to being connected to the heater 104-7, the controller 108-7 is operatively connected to the UI 107-7.

Thus, the controller 108-7 may receive an input signal from the input means of the UI 107-7. Similarly, the controller 108-7 may transmit output signals to the UI 107-7. In response, the output means of the UI 107-7 may convey information, based on the output signals, to a user. The controller also comprises a memory 109-7, which is a non-volatile memory. The memory 109-7 includes instructions, which, when implemented, cause the controller to perform certain tasks or steps of a method.

Figure 26B:
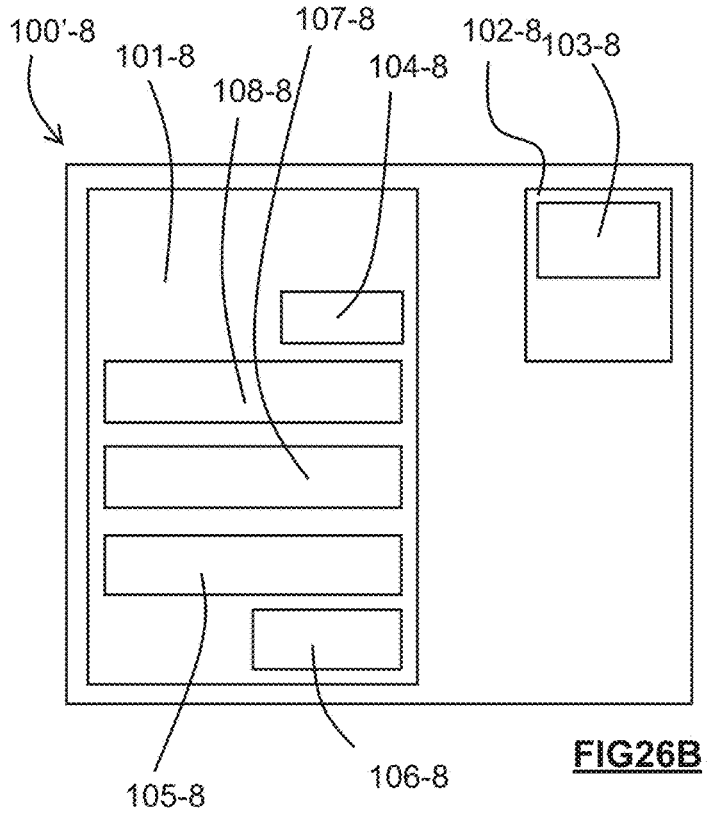
FIG. 26B is a schematic of a variation of the smoking substitute system of FIG. 26A.

FIG. 26B is a schematic showing a variation of the system 100-7 of FIG. 26A. In the system 100-7' of FIG. 26B, the heater 104-7 forms part of the device 101-7, rather than the consumable 102-7. In this variation, the heater 104-7 is electrically connected to the power source 105-7.

The systems 100-7, 100' of FIG. 26A and FIG. 26B may be implemented as a heated tobacco (HT) system.

Figure 27A:
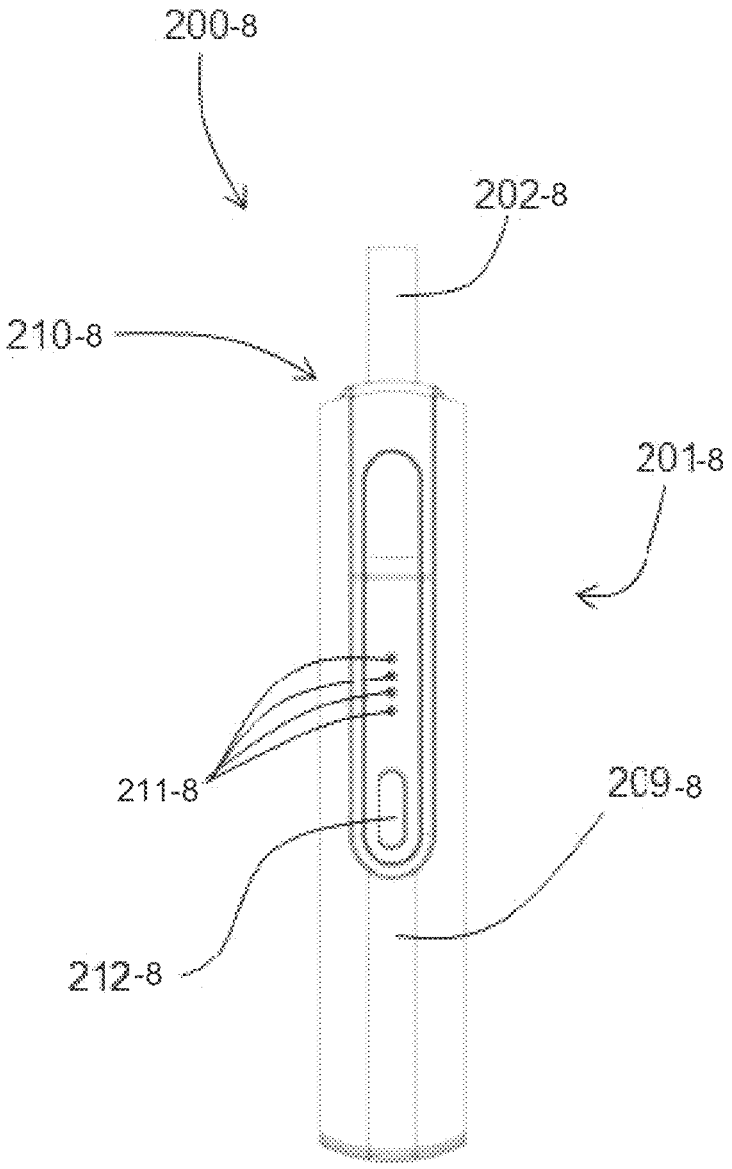
FIG. 27A is a front view of a first embodiment of a smoking substitute system with the consumable engaged with the device.
Figure 27B:
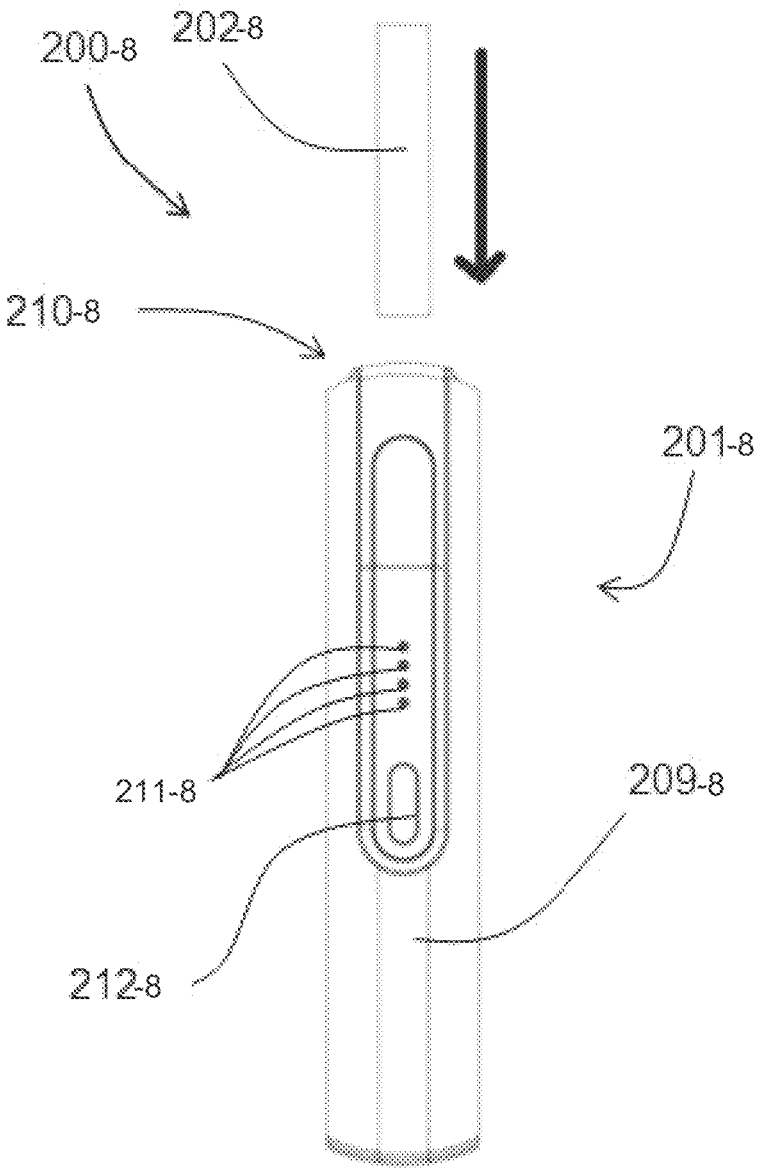
FIG. 27B is a front view of the first embodiment of the smoking substitute system with the consumable disengaged from the device.

FIG. 27A and FIG. 27B illustrate a heated-tobacco (HT) smoking substitute system 200-7. The system 200-7 is an example of the systems 100-7, 100' described in relation to FIG. 26A or FIG. 26B. System 200-7 includes an HT device 201-7 and an HT consumable 202-7. The description of FIG. 26A and FIG. 26B above is applicable to the system 200-7 of FIG. 27A and FIG. 27B, and will thus not be repeated.

The device 201-7 and the consumable 202-7 are configured such that the consumable 202-7 can be engaged with the device 201-7. FIG. 27A shows the device 201-7 and the consumable 202-7 in an engaged state, whilst FIG. 27B shows the device 201-7 and the consumable 202-7 in a disengaged state.

The device 201-7 comprises a body 209-7 and cap 210-7. In use the cap 210-7 is engaged at an end of the body 209-7. Although not apparent from the figures, the cap 210-7 is moveable relative to the body 209-7. In particular, the cap 210-7 is slideable and can slide along a longitudinal axis of the body 209-7.

The device 201-7 comprises an output means (forming part of the UI of the device 201-7) in the form of a plurality of light-emitting diodes (LEDs) 211 arranged linearly along the longitudinal axis of the device 201-7 and on an outer surface of the body 209-7 of the device 201-7. A button 212-7 is also arranged on an outer surface of the body 209-7 of the device 201-7 and is axially spaced (i.e., along the longitudinal axis) from the plurality of LEDs 211-7.

Figure 27C:
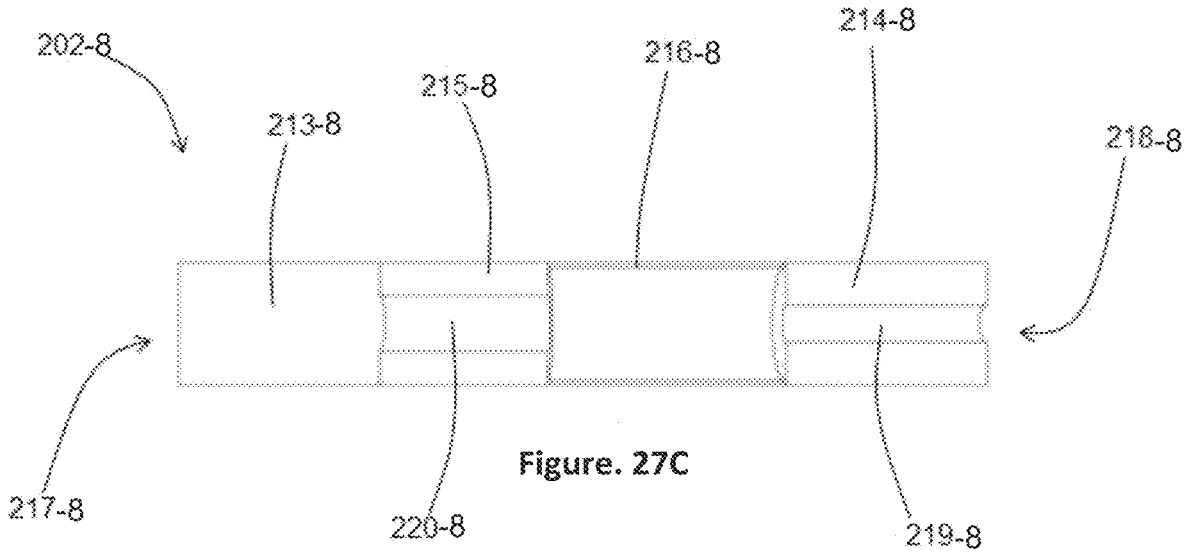
FIG. 27C is a section view of the consumable of the first embodiment of the smoking substitute system.

FIG. 27C show a detailed section view of the consumable of 202 of the system 200-7. The consumable 202-7 generally resembles a cigarette. In that respect, the consumable 202-7 has a generally cylindrical form with a diameter of 7 mm and an axial length of 70 mm. The consumable 202-7 comprises an aerosol forming substrate 213-7, a terminal filter element 214-7, an upstream filter element 215-7 and a spacer element 216-7. In other embodiments, the consumable may further comprise a cooling element. A cooling element may exchange heat with vapor that is formed by the aerosol-forming substrate 213-7 in order to cool the vapor so as to facilitate condensation of the vapor.

The aerosol-forming substrate 213-7 is substantially cylindrical and is located at an upstream end 217-7 of the consumable 202-7, and comprises the aerosol former of the system 200-7. In that respect, the aerosol forming substrate 213-7 is configured to be heated by the device 201-7 to release a vapor. The released vapor is subsequently entrained in an airflow flowing through the aerosol-forming substrate 213-7. The airflow is produced by the action of the user drawing on a downstream 218 (i.e., terminal or mouth) end of the consumable 202-7.

In the present embodiment, the aerosol forming substrate 213-7 comprises tobacco material that may, for example, include any suitable parts of the tobacco plant (e.g., leaves, stems, roots, bark, seeds and flowers). The tobacco may comprise one or more of leaf tobacco, stem tobacco, tobacco powder, tobacco dust, tobacco derivatives, expanded tobacco, homogenized tobacco, shredded tobacco, extruded tobacco, cut rag tobacco and/or reconstituted tobacco (e.g., slurry recon or paper recon). For example, the aerosol-forming substrate 213-7 may comprise a gathered sheet of homogenized (e.g., paper/slurry recon) tobacco or gathered shreds/strips formed from such a sheet.

In order to generate an aerosol, the aerosol forming substrate 213-7 comprises at least one volatile compound that is intended to be vaporized/aerosolized and that may provide the user with a recreational and/or medicinal effect when inhaled. The aerosol-forming substrate 213-7 may further comprise one or more additives. For example, such additives may be in the form of humectants (e.g., propylene glycol and/or vegetable glycerin), flavorants, fillers, aqueous/non-aqueous solvents and/or binders.

The terminal filter element 214-7 is also substantially cylindrical, and is located downstream of the aerosol forming substrate 213-7 at the downstream end 218-7 of the consumable 202-7. The terminal filter element 214-7 is in the form of a hollow bore filter element having a bore 219-7 (e.g., for airflow) formed there through. The diameter of the bore 219-7 is 2 mm. The terminal filter element 214-7 is formed of a porous (e.g., monoacetate) filter material. As set forth above, the downstream end 218-7 of the consumable 202-7 (i.e., where the terminal filter 214-7 is located) forms a mouthpiece portion of the consumable 202-7 upon which the user draws. Airflow is drawn from the upstream end 217-7, thorough the components of the consumable 202-7, and out of the downstream end 218-7. The airflow is driven by the user drawing on the downstream end 218-7 (i.e., the mouthpiece portion) of the consumable 202-7.

The upstream filter element 215-7 is located axially adjacent to the aerosol-forming substrate 213-7, between the aerosol-forming substrate 213-7 and the terminal filter element 214-7. Like the terminal filter 214-7, the upstream filter element 215-7 is in the form of a hollow bore filter element, such that it has a bore 220-7 extending axially there through. In this way, the upstream filter 215-7 may act as an airflow restrictor. The upstream filter element 215-7 is formed of a porous (e.g., monoacetate) filter material. The bore 220-7 of the upstream filter element 215-7 has a larger diameter (3 mm) than the terminal filter element 214-7.

The spacer 216-7 is in the form of a cardboard tube, which defines a cavity or chamber between the upstream filter element 215-7 and the terminal filter element 214-7. The spacer 216-7 acts to allow both cooling and mixing of the vapor/aerosol from the aerosol-forming substrate 213-7. The spacer has an external diameter of 7 mm and an axial length of 14 mm.

Although not apparent from the figure, the aerosol-forming substrate 213-7, upstream filter 215-7 and spacer 216-7 are circumscribed by a paper wrapping layer. The terminal filter 214-7 is circumscribed by a tipping layer that also circumscribes a portion of the paper wrapping layer (so as to connect the terminal filter 214-7 to the remaining components of the consumable 202-7). The upstream filter 215-7 and terminal filter 214-7 are circumscribed by further wrapping layers in the form of plug wraps.

Figure 27D:
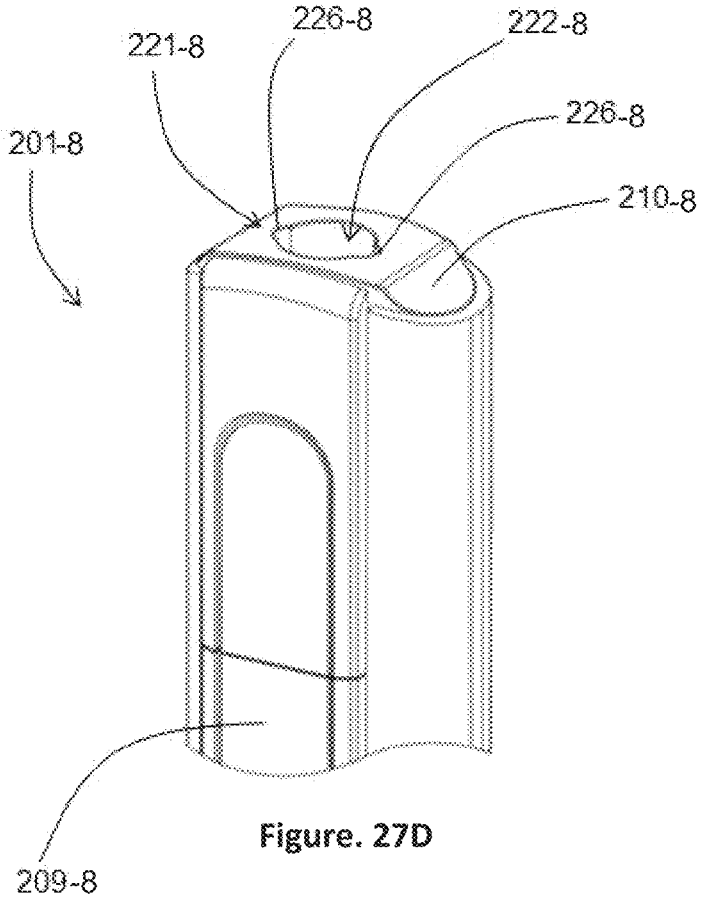
FIG. 27D is a detailed view of an end of the device of the first embodiment of the smoking substitute system.

Returning now to the device 201-7, FIG. 27D illustrates a detailed view of the end of the device 201-7 that is configured to engage with the consumable 202-7. The cap 210-7 of the device 201-7 includes an opening 221-7 to an internal cavity 222-7 (more apparent from FIG. 27D)

defined by the cap 210-7. The opening 221-7 and the cavity 222-7 are formed so as to receive at least a portion of the consumable 202-7.

5 During engagement of the consumable 202-7 with the device 201-7, a portion of the consumable 202-7 is received through the opening 221-7 and into the cavity 222-7. After engagement (see FIG. 27B), the downstream end 218-7 of the consumable 202-7 protrudes from the opening 221-7 and thus also protrudes from the device 201-7. The opening 221-7 includes laterally disposed notches 226-7. When a consumable 202-7 is received in the opening 221-7, these notches 226-7 remain open and could, for example, be used for retaining a cover in order to cover the end of the device 201-7.

Figure 27E:
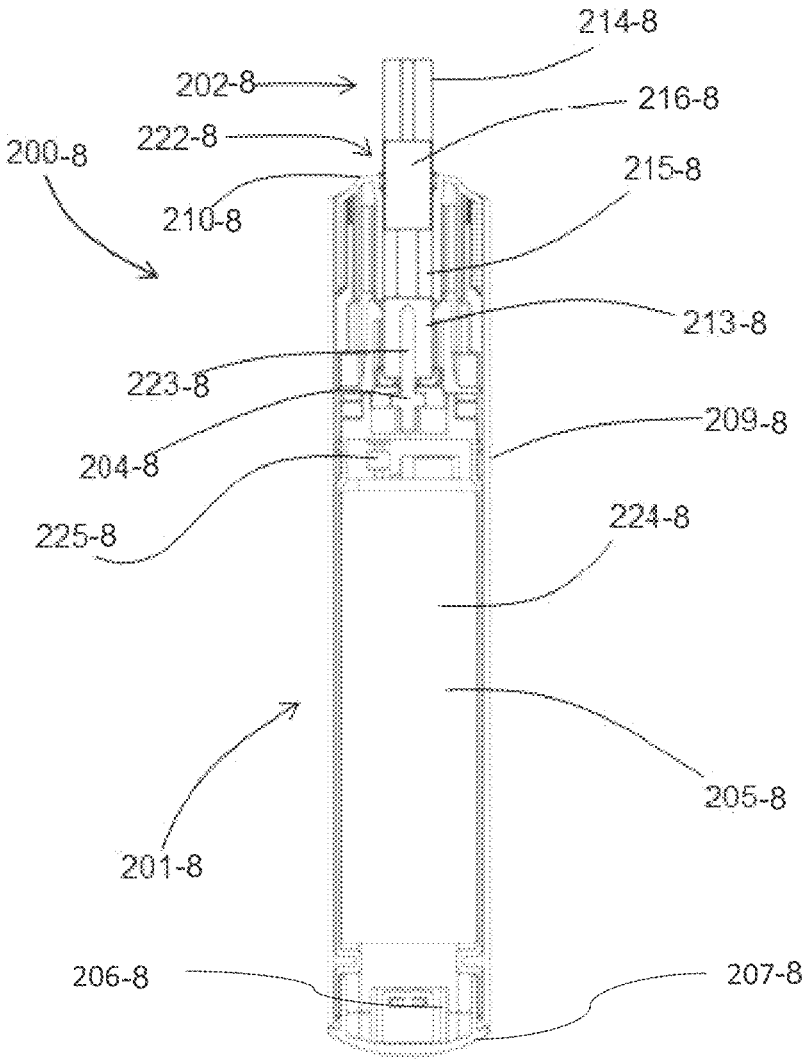
FIG. 27E is a section view of the first embodiment of the substitute smoking system.

FIG. 27E shows a cross section through a central longitudinal plane through the device 201-7. The device 201-7 is shown with the consumable 202-7 engaged therewith.

The device 201-7 comprises a heater apparatus 204-7 comprising heating element 223-7 also referred as heater element. The heater apparatus 204-7 forms part of the body 209-7 of the device 201-7 and is rigidly mounted to the body 209-7. In the illustrated embodiment, the heater apparatus 204-7 is a rod heater with a heating element 223-7 having a substantially circular transverse profile. In other embodiments the heater may be in the form of a tube heater (e.g., heating element with a tubular form).

The heating element 223-7 of the heater 204-7 projects from an internal base of the cavity 222-7 along a longitudinal axis towards the opening 221-7. As is apparent from the figure, the length (i.e., along the longitudinal axis) of the heating element is less than a depth of the cavity 222-7. In this way, the heating element 223-7 does not protrude from or extend beyond the opening 221-7.

Figure 28:
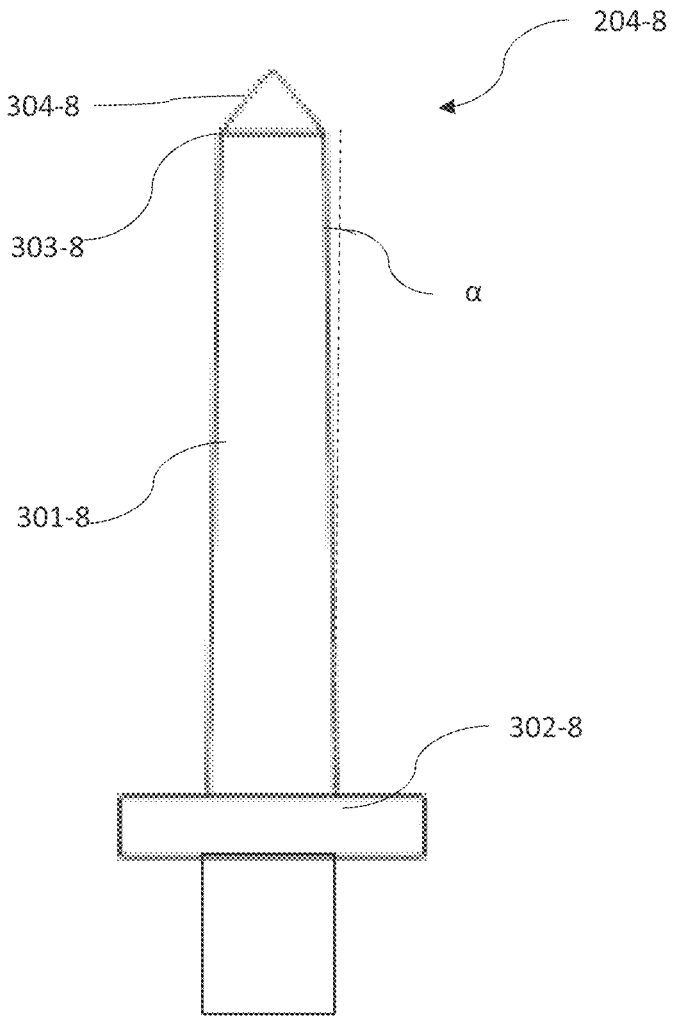
FIG. 28 is a front view of a heater apparatus for heat not burn smoking device.

Referring now to FIG. 28 which illustrates a heater apparatus 204-7 for a heat not burn smoking device. The heater apparatus 204-7 may be a rod heater which includes a rod and a heater element 223-7 located on the rod 301-7. The rod 301-7 may be of a circular cross section and includes a base 302-7 and distal end 303-7. Base portion 302-7 or base of the rod 301-7 may be fixedly or removably positioned inside the body 209-7 [as shown in FIG. 2E] of the heat not burn device 201-7. In an embodiment, the base 302-7 of the rod 301-7 may be positioned in a slot defined in the body 209-7 of the heat not burn smoking device 201-7. As an example, the base 302-7 of the rod 301-7 may have a diameter of about 1.5 to about 3 mm. As shown in FIG. 3 the rod 301-7 may be of a frusto-conical in shape. The rod of frusto-conical in shape may be formed by defining a draft angle $\alpha$ between the base 302-7 of the rod 301-7 and the distal end 302-7 of the rod 301-7. This configuration of the base of the rod 301-7 defines the tapered transverse cross section of the rod 301-7. The term 'transverse cross section' may be defined by a cross section taken along a transverse plane which is along the length of the rod 301-7. In an embodiment, the draft angle $\alpha$ between the base 302-7 of the rod 301-7 and the distal end 302-7 of the rod 301-7 may be about 0.5 to about 10 degrees. Preferably, the draft angle $\alpha$ may be optionally between 2 and 4 degrees. The configuration of the rod 301-7 with the tapered transverse cross section allows the HNB consumable to be removed more freely, due to the dimension of the rod 301-7 being smaller at the distal end 303-7 than the dimension of the rod 301-7 at the base 302-7 of the rod 301-7.

Referring further to FIG. 3, the heater apparatus 204-7 includes a tip component 304-7 located at the distal end 303-7 of the rod 301-7. As shown in FIG. 28, the tip component 304-7 is a conical shaped body and the distal end 303-7 of the rod 301-7 forms a base of the tip component 304-7. In an embodiment, the cone angle of the tip component 304-7 is about 10 degrees to about 80 degrees. Preferably, cone angle of the tip component 304-7 may be between 20 and 70 degrees, more preferably between 30 and 60 degrees, optionally between 40 and 50 degrees. The configuration of conical shape of the tip component 304-7 helps in penetration of the HNB consumable 202-7 onto the heater apparatus 204-7 without much efforts by the user. Also, the conical shape of the tip component 304-7 may allow the HNB consumable 202-7 to be removed more freely. The conical tip portion 304-7 is in particular separate from the tapered base of the rod 301-7. In other words, the heater apparatus 204-7 comprises a first region 301-7, which is tapered in shape, and a second region 304-7, which has a shape distinct from the tapered shape, e.g., a conical shape.

Although not apparent from the figures, heater element 223-7 includes a resistive heater track. The resistive heater track may be located on the rod 301-7. The resistive heater track comprises a first portion with a first resistivity and a second portion with a second resistivity. In an embodiment, the first resistivity is higher than the second resistivity. Alternatively, the resistive heater track comprises a first portion with a first resistance and a second portion with a second resistance. In an embodiment of such a configuration, the first resistance is higher than the second resistance. Further, a first portion is located adjacent the base 302-7 of the rod 301-7 and the second portion is located adjacent to the distal end 302-7 of the rod 301-7.

When the consumable 202-7 is received in the cavity 222-7 (as is shown in FIG. 27E), the heating element 223-7 penetrates the aerosol-forming substrate 213-7 of the consumable 202-7. In particular, the heating element 223-7 extends for nearly the entire axial length of the aerosol-forming substrate 213-7 when inserted therein. Thus, when the heater 204-7 is activated, heat is transferred radially from an outer circumferential surface the heating element 223-7 to the aerosol-forming substrate 213-7.

The device 201-7 further comprises an electronics cavity 224-7. A power source, in the form of are chargeable battery 205-7 (a lithium ion battery), is located in electronics cavity 224-7.

The device 201-7 includes a connector also called as a first electrical terminal 206-7 (i.e., forming part of an IO module of the device 201-7) in the form of a USB port 206-7. The connector may alternatively be, for example, a micro-USB port or a USB-C port for examples. The USB port 206-7 may be used to recharge the rechargeable battery 205-7.

The device 201-7 includes a controller (not shown) located in the electronics cavity 224-7. The controller comprises a microcontroller mounted on a printed circuit board (PCB). The USB port 206-7 is also connected to the controller 208-7 (i.e., connected to the PCB and microcontroller).

The controller 208-7 is configured to control at least one function of the device 201-7. For example, the controller 208-7 is configured to control the operation of the heater 204-7. Such control of the operation of the heater 204-7 may be accomplished by the controller toggling the electrical connection of the rechargeable battery 205-7 to the heater 204-7. For example, the controller 208-7 is configured to control the heater 204-7 in response to a user depressing the button 212-7. Depressing the button 212-7 may cause the controller to allow a voltage (from the rechargeable battery 205-7) to be applied to the heater 204-7 (so as to cause the heating element 223-7 to be heated).

The controller is also configured to control the LEDs 211-7 in response to (e.g., a detected) a condition of the device 201-7 or the consumable 202-7. For example, the controller may control the LEDs to indicate whether the device 201-7 is in an on state or an off state (e.g., one or more of the LEDs may be illuminated by the controller when the device is in an on state).

The device 201-7 comprises a further input means (i.e., in addition to the button 212-7) in the form of a puff sensor 225-7. The puff sensor 225-7 is configured to detect a user drawing (i.e., inhaling) at the downstream end 218-7 of the consumable 202-7. The puff sensor 225-7 may, for example, be in the form of a pressure sensor, flow meter or a microphone. The puff sensor 225-7 is operatively connected to the controller 208-7 in the electronics cavity 224-7, such that a signal from the puff sensor 225-7, indicative of a puff state (i.e., drawing or not drawing), forms an input to the controller 208-7 (and can thus be responded to by the controller 208-7).

Figure 29A:
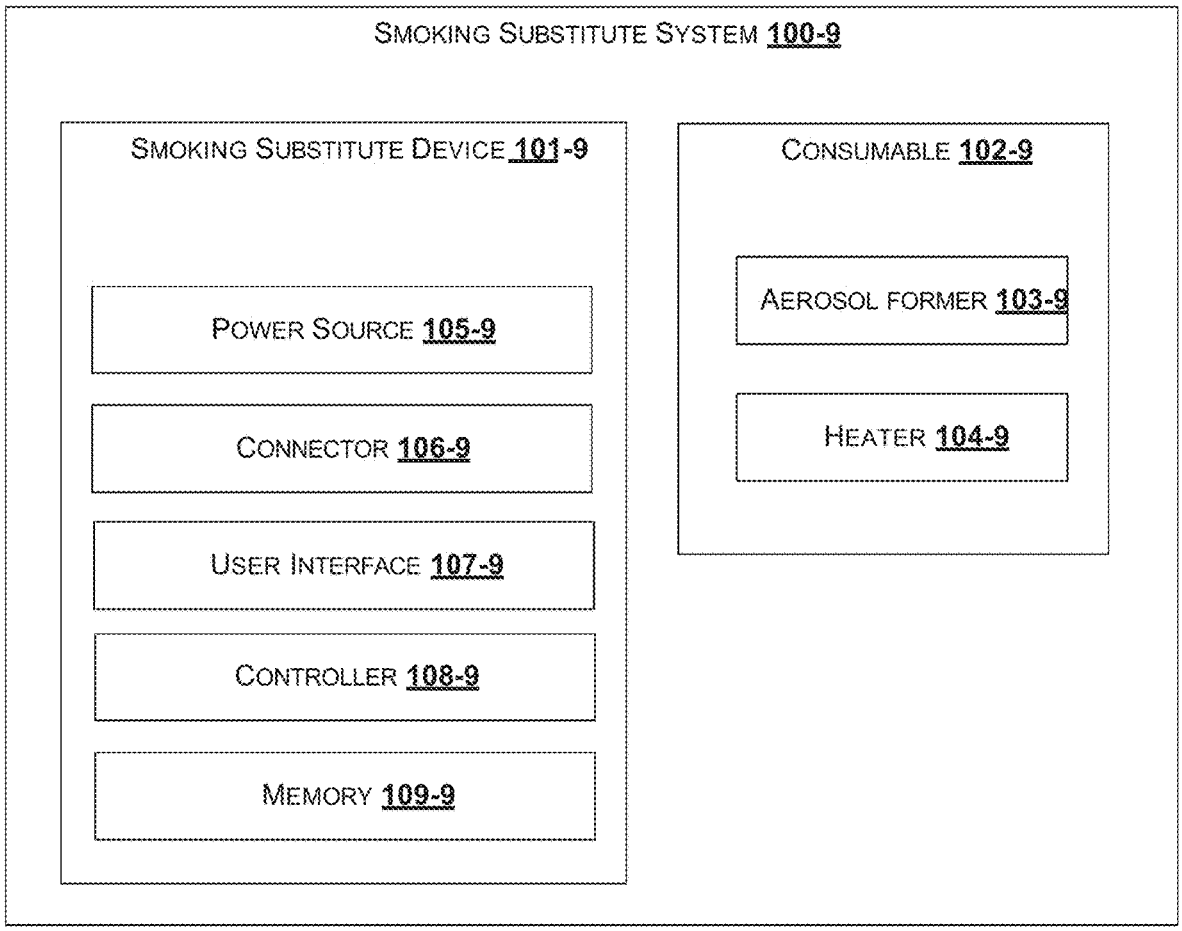
FIG. 29A is a schematic of a smoking substitute system.

Ninth Mode of the Disclosure FIG. 29A is a schematic providing a general overview of a smoking substitute system 100-8. The system 100-8 includes a substitute smoking device 101-8 and an aerosol-forming article in the form of a consumable 102-8, which comprises an aerosol former 103-8. The system is configured to vaporize the aerosol former by heating the aerosol former 103-8 (so as to form a vapor/aerosol for inhalation by a user).

In the illustrated system, the heater 104-8 forms part of the consumable 102-8 and is configured to heat the aerosol former 103-8. In this variation, the heater 104-8 is electrically connectable to the power source 105-8, for example, when the consumable 102-8 is engaged with the device 101-8. Heat from the heater 104-8 vaporizes the aerosol former 103-8 to produce a vapor. The vapor subsequently condenses to form an aerosol, which is ultimately inhaled by the user.

The system 100-8 further comprises a power source 105-8 that forms part of the device 101-8. In other embodiments the power source 105-8 may be external to (but connectable to) the device 101-8. The power source 105-8 is electrically connectable to the heater 104-8 such that it is able to supply power to the heater 104-8 (i.e., for the purpose of heating the aerosol former 103-8). Thus, control of the electrical connection of the power source 105-8 to the heater 104-8 provides control of the state of the heater 104-8. The power source 105-8 may be a power store, for example a battery or rechargeable battery (e.g., a lithium ion battery).

The system 100-8 further comprises an I/O module comprising a connector 106-8 (e.g., in the form of a USB port, Micro USB port, USB-C port, etc.). The connector 106-8 is configured for connection to an external source of electrical power, e.g., a mains electrical supply outlet. The connector 106-8 may be used in substitution for the power source 105-8. That is the connector 106-8 may be electrically connectable to the heater 104-8 so as to supply electricity to the heater 104-8. In such embodiments, the device may not include a power source, and the power source of the system may instead comprise the connector 106-8 and an external source of electrical power (to which the connector 106-8 provides electrical connection).

In some embodiments, the connector 106-8 may be used to charge and recharge the power source 105-8 where the power source 105-8 includes a rechargeable battery.

The system 100-8 also comprises a user interface (UI) 107. Although not shown, the UI 107-8 may include input means to receive commands from a user. The input means of the UI 107-8 allows the user to control at least one aspect of the operation of the system 100-8. The input means may, for example, be in the form of a button, touchscreen, switch, microphone, motion sensor, etc.

The UI 107-8 also comprises output means to convey information to the user. The output means may, for example, comprise lights (e.g., LEDs), a display screen, speaker, vibration generator, etc.

The system 100-8 further comprises a controller 108-8 that is configured to control at least one function of the device 101-8. In the illustrated embodiment, the controller 108-8 is a component of the device 101-8, but in other embodiments may be separate from (but connectable to) the device 101-8. The controller 108-8 is configured to control the operation of the heater 104-8 and, for example, may be configured to control the voltage applied from the power source 105-8 to the heater 104-8. The controller 108-8 may be configured to toggle the supply of power to the heater 104-8 between an on state, in which the full output voltage of the power source 105-8 is applied to the heater 104-8, and an off state, in which the no voltage is applied to the heater 104-8.

Although not shown, the system 100-8 may also comprise a voltage regulator to regulate the output voltage from the power source 105-8 to form a regulated voltage. The regulated voltage may then be applied to the heater 104-8.

In addition to being connected to the heater 104-8, the controller 108-8 is operatively connected to the UI 107-8. Thus, the controller 108-8 may receive an input signal from the input means of the UI 107-8. Similarly, the controller 108-8 may transmit output signals to the UI 107-8. In response, the output means of the UI 107-8 may convey information, based on the output signals, to a user. The controller also comprises a memory 109-8, which is a non-volatile memory. The memory 109-8 includes instructions, which, when implemented, cause the controller to perform certain tasks or steps of a method.

Figure 29B:
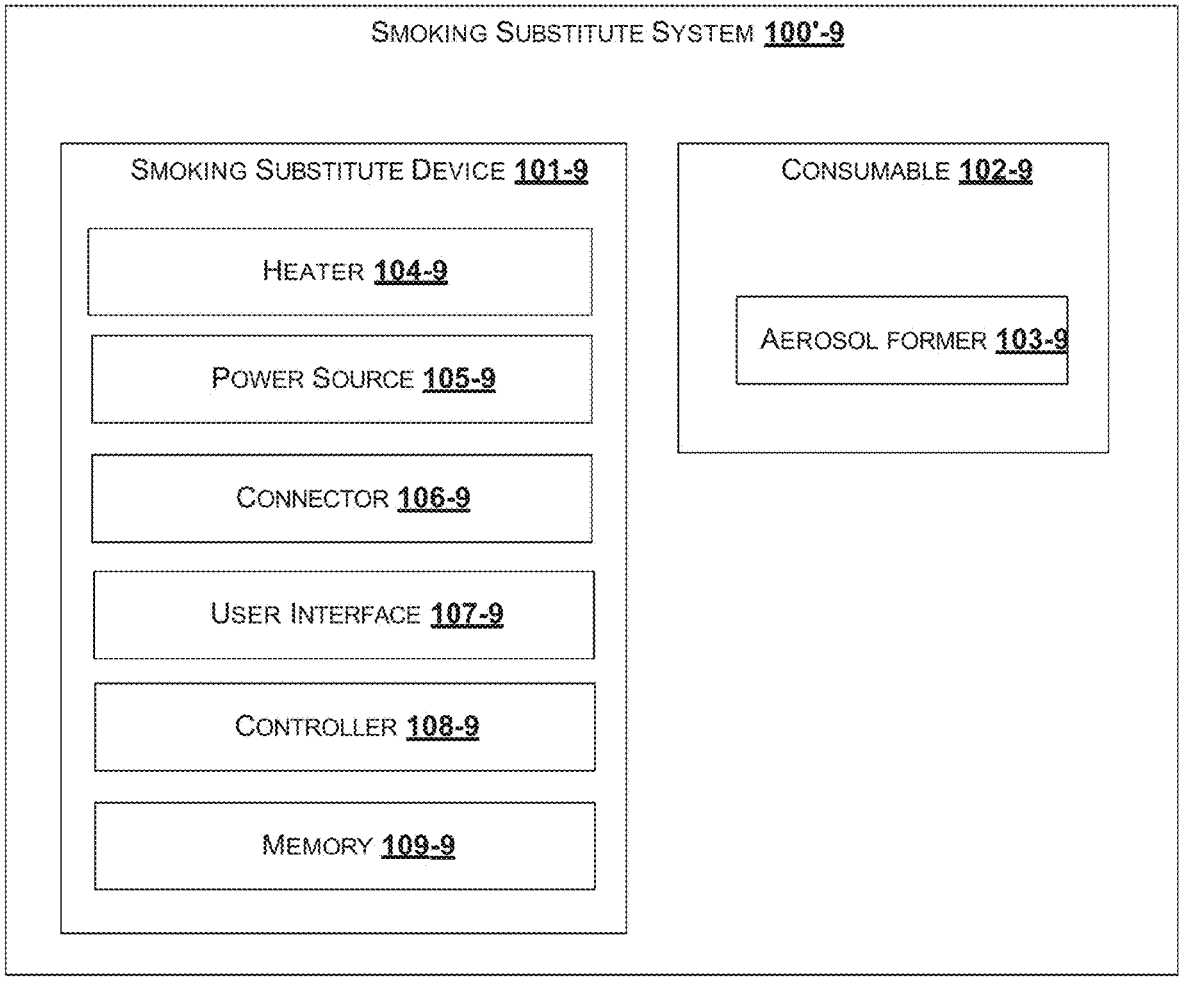
FIG. 29B is a schematic of a variation of the smoking substitute system of FIG. 29A.

FIG. 29B is a schematic showing a variation of the system 100-8 of FIG. 29A. In the system 100-8' of FIG. 29B, the heater 104-8 forms part of the device 101-8, rather than the consumable 102-8. In this variation, the heater 104-8 is electrically connected to the power source 105-8.

Figure 30A:
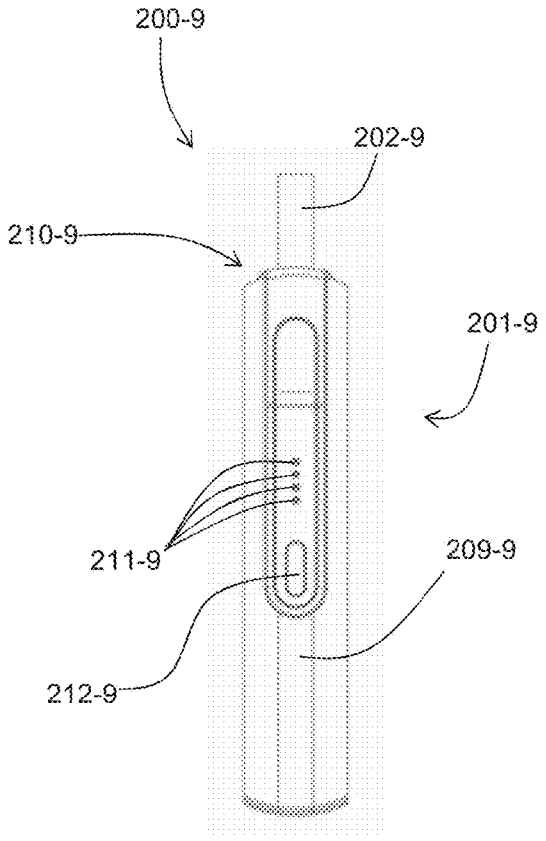
FIG. 30A is a front view of a first embodiment of a ninth mode of a smoking substitute system with the consumable engaged with the device.
Figure 30B:
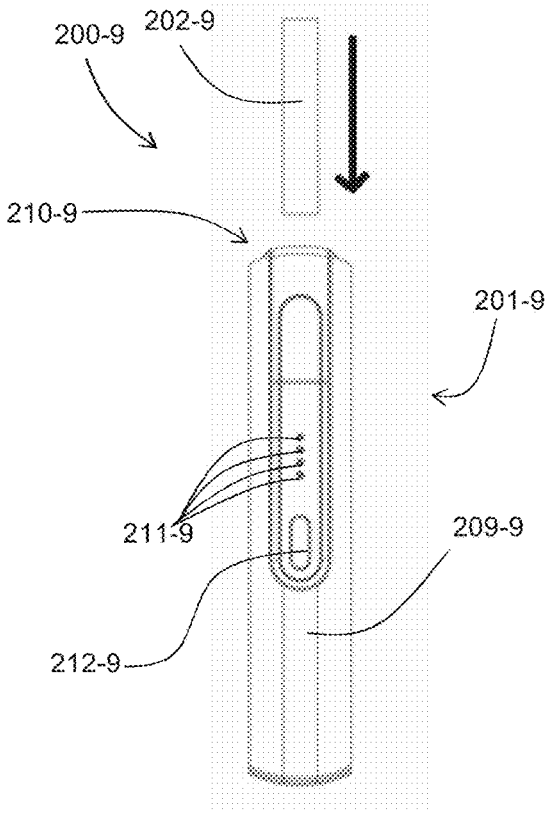
FIG. 30B is a front view of the first embodiment of the smoking substitute system with the consumable disengaged from the device.

FIG. 30A and FIG. 30B illustrate a heated-tobacco (HT) smoking substitute system 200-8. The system 200-8 is an example of the systems 100-8, 100' described in relation to FIG. 29A or FIG. 29B. System 200-8 includes an HT device 201-8 and an HT consumable 202-8. The description of FIG. 29A and FIG. 29B above is applicable to the system 200-8 of FIG. 30A and FIG. 30B, and will thus not be repeated.

The device 201-8 and the consumable 202-8 are configured such that the consumable 202-8 can be engaged with the device 201-8. FIG. 30A shows the device 201-8 and the consumable 202-8 in an engaged state, whilst FIG. 30B shows the device 201-8 and the consumable 202-8 in a disengaged state.

The device 201-8 comprises a body 209-8 and cap 210-8. In use the cap 210-8 is engaged at an end of the body 209-8. Although not apparent from the figures, the cap 210-8 is moveable relative to the body 209-8. In particular, the cap 210-8 is slideable and can slide along a longitudinal axis of the body 209-8.

The device 201-8 comprises an output means (forming part of the UI of the device 201-8) in the form of a plurality of light-emitting diodes (LEDs) 211 arranged linearly along the longitudinal axis of the device 201-8 and on an outer surface of the body 209-8 of the device 201-8. A button 212-8 is also arranged on an outer surface of the body 209-8 of the device 201-8 and is axially spaced (i.e., along the longitudinal axis) from the plurality of LEDs 211-8.

Figure 30C:
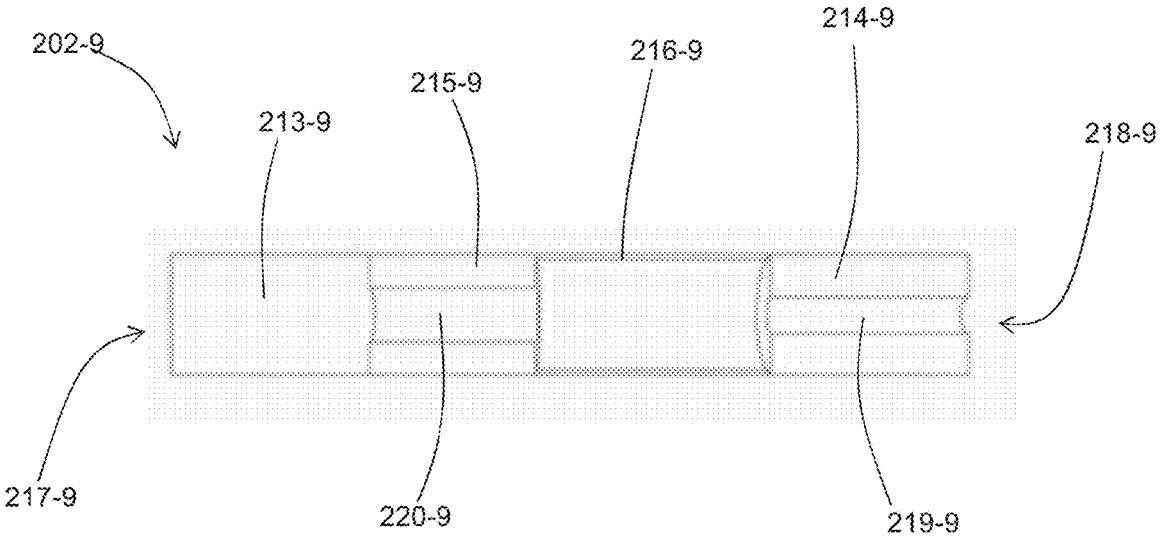
FIG. 30C is a section view of the consumable of the first embodiment of the smoking substitute system.

FIG. 30C shows a detailed section view of the consumable of 202 of the system 200-8. The consumable 202-8 generally resembles a cigarette. In that respect, the consumable 202-8 has a generally cylindrical form with a diameter of 7 mm and an axial length of 70 mm. The consumable 202-8 comprises an aerosol forming substrate 213-8, a terminal filter element 214-8, an upstream filter element 215-8 and a spacer element 216-8. In other embodiments, the consumable may further comprise a cooling element. A cooling element may exchange heat with vapor that is formed by the aerosol-forming substrate 213-8 in order to cool the vapor so as to facilitate condensation of the vapor.

The aerosol-forming substrate 213-8 is substantially cylindrical and is located at an upstream end 217-8 of the consumable 202-8, and comprises the aerosol former of the system 200-8. In that respect, the aerosol forming substrate 213-8 is configured to be heated by the device 201-8 to release a vapor. The released vapor is subsequently entrained in an airflow flowing through the aerosol-forming substrate 213-8. The airflow is produced by the action of the user drawing on a downstream 218 (i.e., terminal or mouth) end of the consumable 202-8.

In the present embodiment, the aerosol forming substrate 213-8 comprises tobacco material that may, for example, include any suitable parts of the tobacco plant (e.g., leaves, stems, roots, bark, seeds and flowers). The tobacco may comprise one or more of leaf tobacco, stem tobacco, tobacco powder, tobacco dust, tobacco derivatives, expanded tobacco, homogenized tobacco, shredded tobacco, extruded tobacco, cut rag tobacco and/or reconstituted tobacco (e.g., slurry recon or paper recon). For example, the aerosol-forming substrate 213-8 may comprise a gathered sheet of homogenized (e.g., paper/slurry recon) tobacco or gathered shreds/strips formed from such a sheet.

In order to generate an aerosol, the aerosol forming substrate 213-8 comprises at least one volatile compound that is intended to be vaporized/aerosolized and that may provide the user with a recreational and/or medicinal effect when inhaled. The aerosol-forming substrate 213-8 may further comprise one or more additives. For example, such additives may be in the form of humectants (e.g., propylene glycol and/or vegetable glycerin), flavorants, fillers, aqueous/non-aqueous solvents and/or binders.

The terminal filter element 214-8 is also substantially cylindrical, and is located downstream of the aerosol forming substrate 213-8 at the downstream end 218-8 of the consumable 202-8. The terminal filter element 214-8 is in the form of a hollow bore filter element having a bore 219-8 (e.g., for airflow) formed there through. The diameter of the bore 219-8 is 2 mm. The terminal filter element 214-8 is formed of a porous (e.g., monoacetate) filter material. As set forth above, the downstream end 218-8 of the consumable 202-8 (i.e., where the terminal filter 214-8 is located) forms a mouthpiece portion of the consumable 202-8 upon which the user draws. Airflow is drawn from the upstream end 217-8, thorough the components of the consumable 202-8, and out of the downstream end 218-8. The airflow is driven by the user drawing on the downstream end 218-8 (i.e., the mouthpiece portion) of the consumable 202-8.

The upstream filter element 215-8 is located axially adjacent to the aerosol-forming substrate 213-8, between the aerosol-forming substrate 213-8 and the terminal filter element 214-8. Like the terminal filter 214-8, the upstream filter element 215-8 is in the form of a hollow bore filter element, such that it has a bore 220-8 extending axially there through. In this way, the upstream filter 215-8 may act as an airflow restrictor. The upstream filter element 215-8 is formed of a porous (e.g., monoacetate) filter material. The bore 220-8 of the upstream filter element 215-8 has a larger diameter (3 mm) than the terminal filter element 214-8.

The spacer 216-8 is in the form of a cardboard tube, which defines a cavity or chamber between the upstream filter element 215-8 and the terminal filter element 214-8. The spacer 216-8 acts to allow both cooling and mixing of the vapor/aerosol from the aerosol-forming substrate 213-8. The spacer has an external diameter of 7 mm and an axial length of 14 mm.

Although not apparent from the figure, the aerosol-forming substrate 213-8, upstream filter 215-8 and spacer 216-8 are circumscribed by a paper wrapping layer. The terminal filter 214-8 is circumscribed by a tipping layer that also circumscribes a portion of the paper wrapping layer (so as to connect the terminal filter 214-8 to the remaining components of the consumable 202-8). The upstream filter 215-8 and terminal filter 214-8 are circumscribed by further wrapping layers in the form of plug wraps.

Figure 30D:
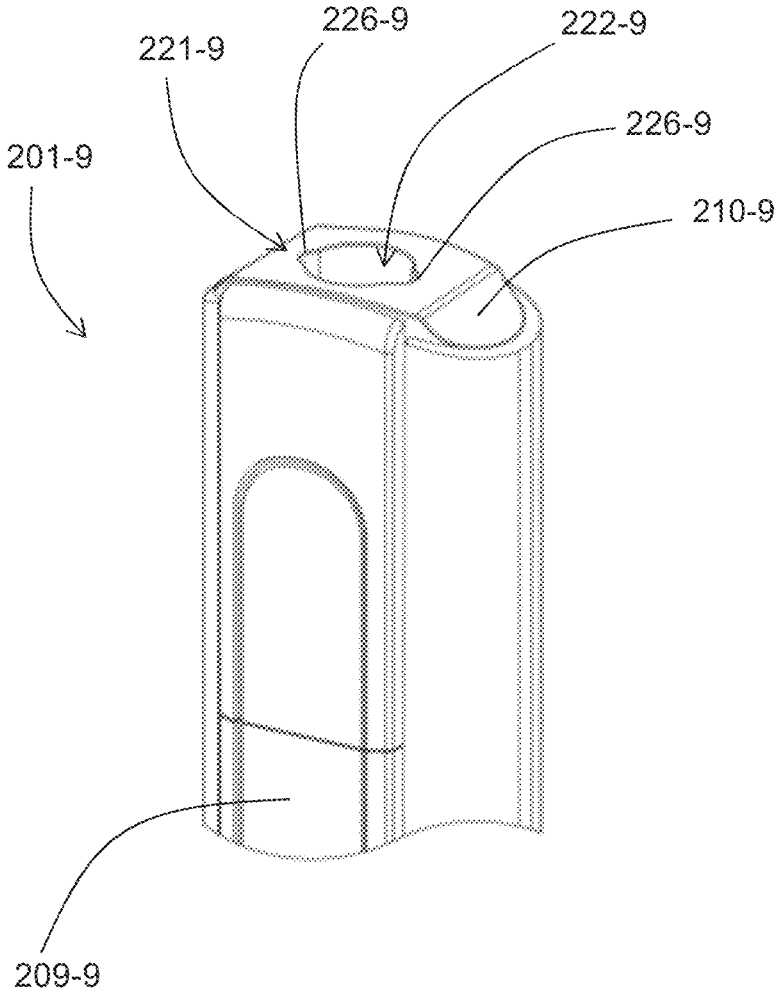
FIG. 30D is a detailed view of an end of the device of the first embodiment of the smoking substitute system.

Returning now to the device 201-8, FIG. 30D illustrates a detailed view of the end of the device 201-8 that is configured to engage with the consumable 202-8. The cap 210-8 of the device 201-8 includes an opening 221-8 to an internal cavity 222-8 (more apparent from FIG. 30D) defined by the cap 210-8. The opening 221-8 and the cavity 222-8 are formed so as to receive at least a portion of the consumable 202-8. During engagement of the consumable 202-8 with the device 201-8, a portion of the consumable 202-8 is received through the opening 221-8 and into the cavity 222-8. After engagement (see FIG. 30B), the downstream end 218-8 of the consumable 202-8 protrudes from the opening 221-8 and thus also protrudes from the device 201-8. The opening 221-8 includes laterally disposed notches 226-8. When a consumable 202-8 is received in the opening 221-8, these notches 226-8 remain open and could, for example, be used for retaining a cover in order to cover the end of the device 201-8.

Figure 30E:
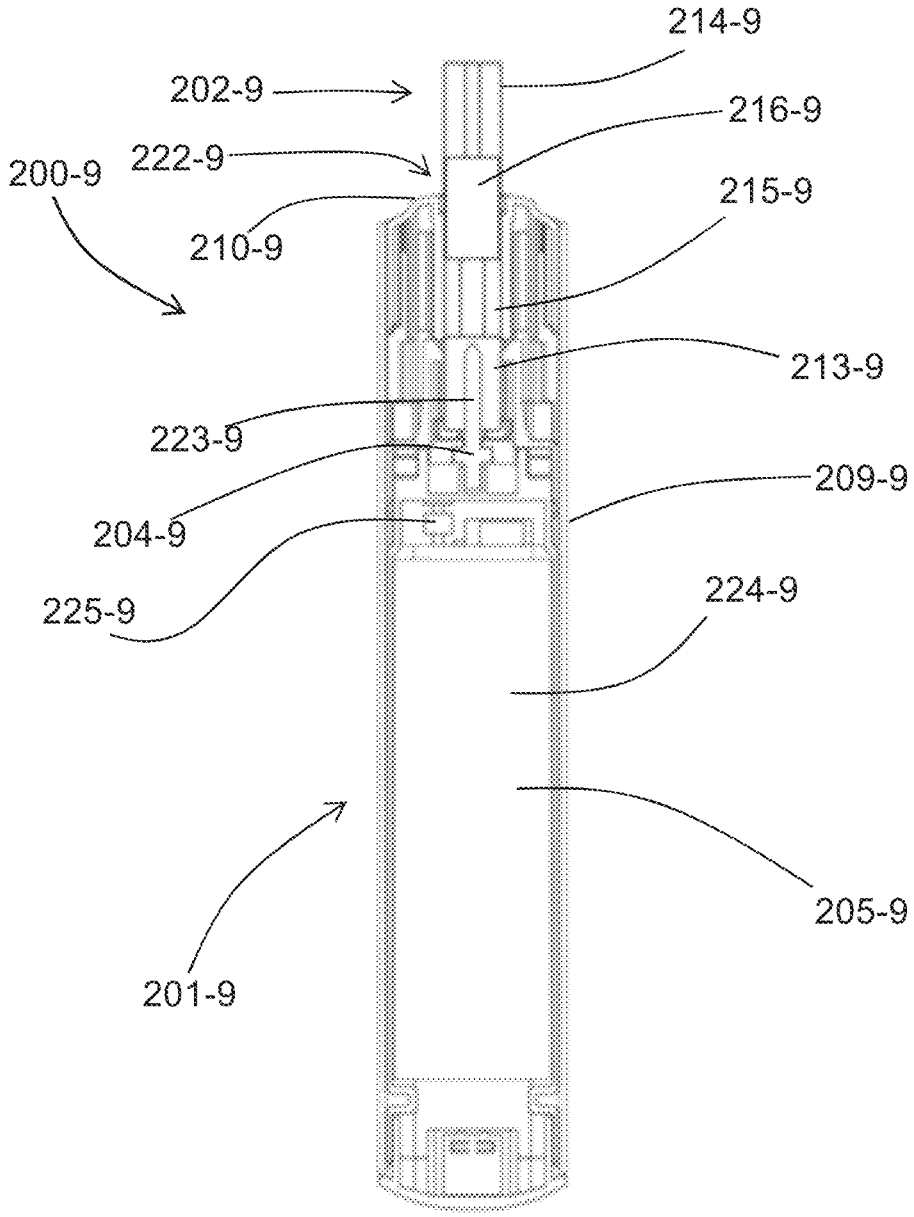
FIG. 30E is a section view of the first embodiment of the substitute smoking system.

FIG. 30E shows a cross section through a central longitudinal plane through the device 201-8. The device 201-8 is shown with the consumable 202-8 engaged therewith.

The device 201-8 comprises a heater 204-8 comprising heating element 223-8. The heater 204-8 forms part of the body 209-8 of the device 201-8 and is rigidly mounted to the body 209-8. In the illustrated embodiment, the heater 204-8 is a rod heater with a heating element 223-8 having a circular transverse profile. In other embodiments the heater may be in the form of a blade heater (e.g., heating element with a rectangular transverse profile) or a tube heater (e.g., heating element with a tubular form).

The heating element 223-8 of the heater 204-8 projects from an internal base of the cavity 222-8 along a longitudinal axis towards the opening 221-8. As is apparent from the figure, the length (i.e., along the longitudinal axis) of the heating element is less than a depth of the cavity 222-8. In this way, the heating element 223-8 does not protrude from or extend beyond the opening 221-8.

When the consumable 202-8 is received in the cavity 222-8 (as is shown in FIG. 30E), the heating element 223-8 penetrates the aerosol-forming substrate 213-8 of the consumable 202-8. In particular, the heating element 223-8 extends for nearly the entire axial length of the aerosol-forming substrate 213-8 when inserted therein. Thus, when the heater 204-8 is activated, heat is transferred radially from an outer circumferential surface the heating element 223-8 to the aerosol-forming substrate 213-8.

Alternatively, the heater 204-8 is movably mounted to the body 209-8. The heater can be moved longitudinally such that longitudinal position of the heating element 223-8 can be varied thereby controlling the exposure of the consumable portion to the heating element.

The device 201-8 further comprises an electronics cavity 224-8. A power source, in the form of a rechargeable battery 205-8 (a lithium ion battery), is located in electronics cavity 224-8.

The device 201-8 includes a connector (i.e., forming part of an IO module of the device 201-8) in the form of a USB port 206-8. The connector may alternatively be, for example, a micro-USB port or a USB-C port for examples. The USB port 206-8 may be used to recharge the rechargeable battery 205-8.

The device 201-8 includes a controller (not shown) located in the electronics cavity 224-8. The controller comprises a microcontroller mounted on a printed circuit board (PCB). The USB port 206-8 is also connected to the controller 208-8 (i.e., connected to the PCB and microcontroller).

The controller 208-8 is configured to control at least one function of the device 202-8. For example, the controller 208-8 is configured to control the operation of the heater 204-8. Such control of the operation of the heater 204-8 may be accomplished by the controller toggling the electrical connection of the rechargeable battery 205-8 to the heater 204-8. For example, the controller 208-8 is configured to control the heater 204-8 in response to a user depressing the button 212-8. Depressing the button 212-8 may cause the controller to allow a voltage (from the rechargeable battery 205-8) to be applied to the heater 204-8 (so as to cause the heating element 223-8 to be heated).

The controller is also configured to control the LEDs 211-8 in response to (e.g., a detected) a condition of the device 201-8 or the consumable 202-8. For example, the controller may control the LEDs to indicate whether the device 201-8 is in an on state or an off state (e.g., one or more of the LEDs may be illuminated by the controller when the device is in an on state).

The device 201-8 comprises a further input means (i.e., in addition to the button 212-8) in the form of a puff sensor 225-8. The puff sensor 225-8 is configured to detect a user drawing (i.e., inhaling) at the downstream end 218-8 of the consumable 202-8. The puff sensor 225-8 may, for example, be in the form of a pressure sensor, flow meter or a microphone. The puff sensor 225-8 is operatively connected to the controller 208-8 in the electronics cavity 224-8, such that a signal from the puff sensor 225-8, indicative of a puff state (i.e., drawing or not drawing), forms an input to the controller 208-8 (and can thus be responded to by the controller 208-8).

Figure 31:
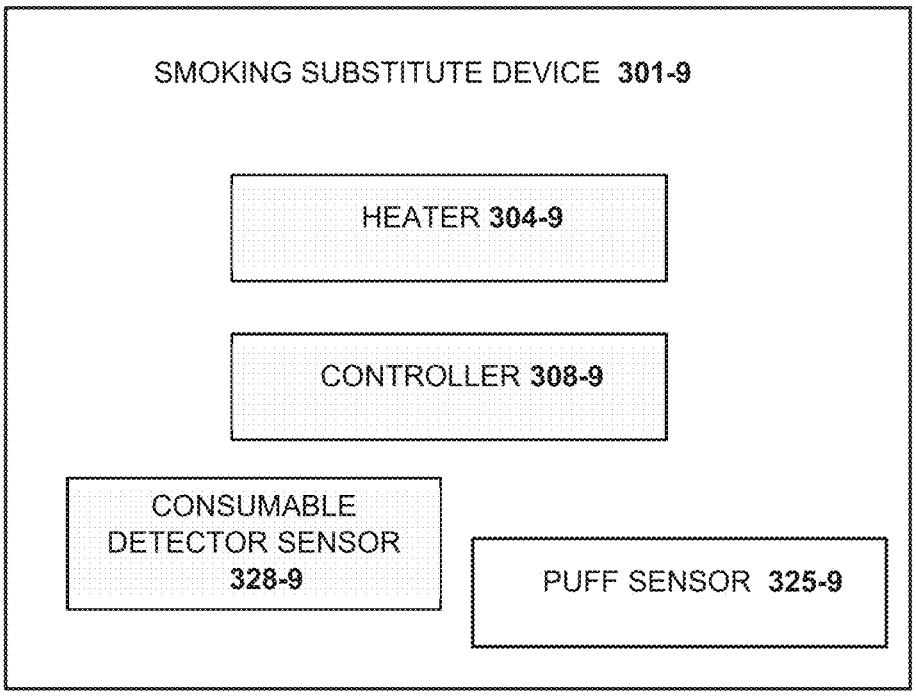
FIG. 31 is a block diagram of an embodiment of a heated tobacco device.

FIG. 31 shows a block diagram of the heated tobacco device 301-8.

The device 301-8 comprises a heater 304-8 comprising a heating element.

The device 301-8 includes a consumable detector sensor 328-8 and a puff sensor 325-8. A signal from the puff sensor may be used to actuate a change of mode from a first mode to a second mode, or second mode to first mode, after detecting a predetermined puff signal from the user. In some embodiments, the predetermined puff signal may be a user puff exceeding a puff duration threshold, for example. In some embodiments, the puff sensor 325-8 may give a signal to the controller 308-8 for changing the mode from first to second or from second to first after detecting a predetermined duration of puff.

The consumable detector sensor 328-8 is configured to detect various types of consumable or of tobacco. The consumable detector sensor 328-8 may detect the level of nicotine content present in the tobacco. The consumable detector sensor 328-8, may, for example, detect chemicals or molecules to identify the tobacco and/or the level of nicotine content. The consumable detector sensor 328-8 may be a bio-sensor which, in use, is in contact with the consumable and identify type of tobacco or nicotine level. The consumable detector sensor 328-8 may be an aerosol sensor which detects the chemicals present in the aerosol from the consumable to detect the type of tobacco and/or nicotine level. The consumable detector sensor 328-8 is operatively coupled to the controller 308-8. The consumable detector sensor 328-8 may signal the controller 308-8 indicating the type of tobacco present in the consumable 202-8. The signal from the consumable detector sensor 328-8 forms an input to the controller 308-8, based on which the controller 308-8 selects an operating mode.

The controller 308-8 is configured to operate the heater of the device 202-8 according to at least two user-selectable operating modes. The two user-selectable operating modes are a first and second mode.

The first may be considered a normal or standard mode. In the first mode, a first amount of nicotine is delivered to the user. The second mode may be considered a "boost" or "intense" mode. In the second mode, as second amount of nicotine is delivered to the user. The second amount is greater than the first amount. In other words, the device delivers more nicotine to the user when operating in the second mode than in the first mode.

There a number of operating mode mechanisms to achieve the difference in nicotine delivery amounts between operating modes. Some of those mechanisms are exemplified here. However, the skilled person will appreciate that other mechanisms are possible.

In some embodiments, the duration of the consumable cycle is higher in the second mode as compared to the first mode. In other words, the heater is maintained at operating temperature for a longer period in the second mode than in the first mode. The device is thus able to deliver a greater amount of nicotine in the second mode than in the first mode. For example, operating the heater in the second mode for 5 mins instead of 4 mins in the first mode. This permits the user to have an 'intense' consumable cycle during which more nicotine is delivered. The consumable cycle is the period in which a single consumable is heated for use by the user.

In some embodiments, in the second mode, the controller 308-8 is configured to operate the heater at a higher temperature than in in the first mode. A higher temperature may lead to a higher nicotine output for each puff taken by the user. The nicotine is thus delivered at higher rate in the second mode than in the first mode. The controller 308-8 may be configured to increase the temperature of the heater 304-8 by controlling power supply to the heater.

The second mode can be selected by the user using a user interface of the device. The user interface may include at least one of: a button, a touch screen, a motion sensor, or a voice recognition means. Any of these components may be used to select or change the operating mode of the device. In embodiments including a motion sensor, the device may be configured to change operating mode is response to detecting a predetermined motion of the device performed by the user.

In some embodiments, the device has a default mode, where the default mode is one of the first or second operating modes. The device will operate according to the default mode unless and until the user changes the mode (for example, using a user interface of the device). In some embodiments, the device is configured to allow the user to change the default mode. In some embodiments, the device is configured to select the default mode based on historic use of the device.

In an alternative proposal configured to adjust the visibility of vapor formed from the aerosol forming substrate, the controller 208-8 is configured to operate the heater of the device 201-8 according to at least two alternative modes. The modes may be user selectable modes. The two user operating modes are a first and second mode. In the first mode the controller 208-8 is configured to control heating of the heater 204-8 within a predetermined range. In an embodiment the predetermined range is 140 to 170° C. In this mode, the visibility of the vapor generated is lower. Additionally, the controller 208-8 is configured to deliver mainly the nicotine and flavor in the aerosol/vapor generated from the aerosol forming substrate 202-8 in the first mode, within minimal or no visibility of the aerosol. The second mode is a normal/standard mode, wherein the visibility of the vapor generated from the aerosol forming substrate 202-8 is higher as compared to the first mode. In the second mode, the controller configured to maintain the temperature of the heater more than 170° C. (for example at about 200° C.). The controller 208-8 is configured to operate the device either in a first mode or second mode throughout the entire consumable cycle. The operating temperature for the first mode can vary depending on the type of aerosol forming substrate 202-8 chosen.

The controller 208-8 is configured to alter the airflow through the device for changing the pressure drop across the consumable, and ultimately the amount of vapor produced. Altering the airflow creates a pressure drop in the device. The pressure drop has a correlation with the visibility of the vapor formed. Accordingly, low pressure drop gives a visible vapor and as the pressure drop increases, the visibility of the vapor reduces. Accordingly, to operate the device in the first mode, the controller 208-8 adjusts air flow to create a higher pressure drop. Additionally, the device includes a mechanism to control the airflow rate entering the device. Alternatively, the device can control the opening of an inlet port (not shown in figure) of the device to change the pressure drop of the airflow into the device. Similarly, the opening of the airflow passages formed in the device can be altered to change the pressure drop through the device.

The controller 208-8 may also be configured to move the heater 204-8 relative to the aerosol forming substrate 202-8 so as to change the amount of contact between the heater and the substrate according to the mode selected. The amount of contact of the heater in first mode is lesser than in the second mode. That is, in the first mode, the amount of exposure of the aerosol forming substrate to the heater is less as compared to the exposure of the aerosol forming substrate to the heater in the second mode. The exposure of the aerosol forming substrate 202-8 to the heater can alter the visibility of the vapor. The reduced exposure of the aerosol forming substrate 202-8 in the first mode will result in a reduced amount of heat passed to the aerosol forming substrate 202-8. Accordingly, the controller 202-8 may move the heater 204-8 relative to the aerosol forming substrate 202-8 portion to change the amount of contact between heater 204-8 and the aerosol forming substrate 202-8. Alternatively, the controller can vary the length of the cavity 222-8 for inserting/holding the aerosol forming substrate/consumable 202-8 and keep the heater fixed to change the amount of contact between heater and the aerosol forming substrate 202-8.

Figure 32B:
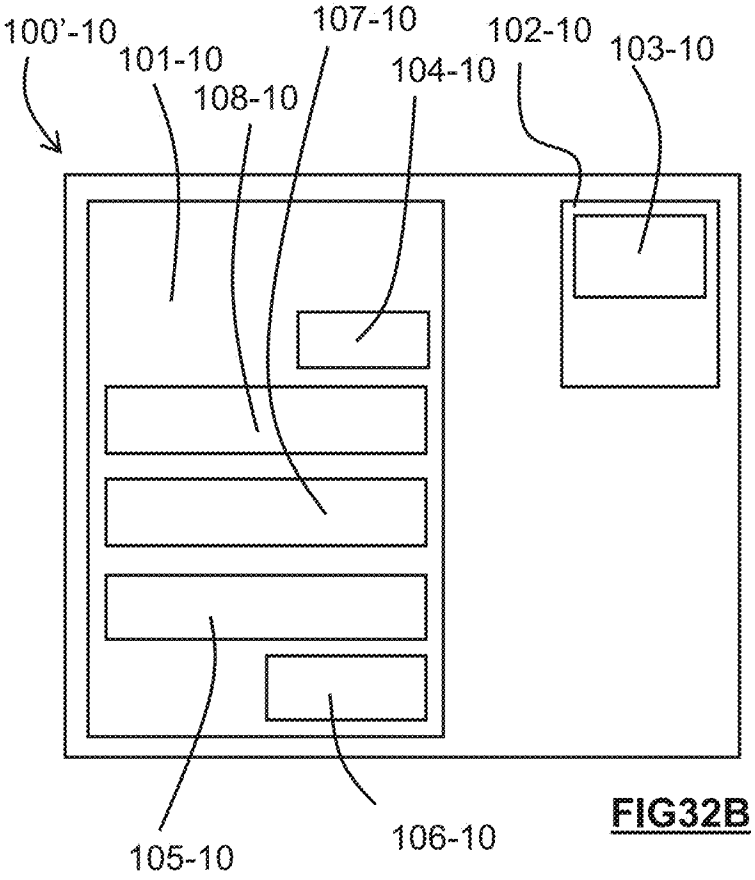
FIG. 32B is a schematic of a variation of the smoking substitute system of FIG. 32A.
Figure 32A:
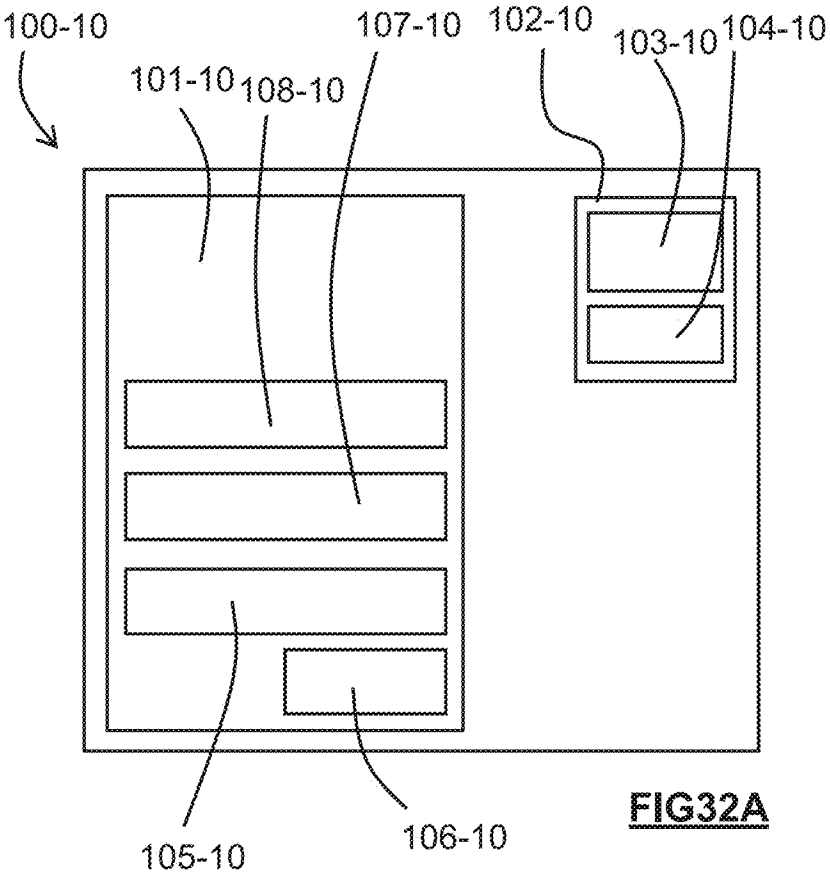
FIG. 32A is a schematic of a smoking substitute system.

Tenth Mode of the Disclosure FIG. 32A is a schematic providing a general overview of a smoking substitute system 100-9. The system 100-9 includes a substitute smoking device 101-9 and an aerosol-forming article in the form of a consumable 102-9, which comprises an aerosol former 103-9. The system is configured to vaporize the aerosol former by heating the aerosol former 103-9 (so as to form a vapor/aerosol for inhalation by a user).

In the illustrated system, the heater 104-9 forms part of the consumable 102-9 and is configured to heat the aerosol former 103-9. In this variation, the heater 104-9 is electrically connectable to the power source 105-9, for example, when the consumable 102-9 is engaged with the device 101-9. Heat from the heater 104-9 vaporizes the aerosol former 103-9 to produce a vapor. The vapor subsequently condenses to form an aerosol, which is ultimately inhaled by the user.

The system 100-9 further comprises a power source 105-9 that forms part of the device 101-9. In other embodiments the power source 105-9 may be external to (but connectable to) the device 101-9. The power source 105-9 is electrically connectable to the heater 104-9 such that it is able to supply power to the heater 104-9 (i.e., for the purpose of heating the aerosol former 103-9). Thus, control of the electrical connection of the power source 105-9 to the heater 104-9 provides control of the state of the heater 104-9. The power source 105-9 may be a power store, for example a battery or rechargeable battery (e.g., a lithium ion battery).

The system 100-9 further comprises an I/O module comprising a connector 106-9 (e.g., in the form of a USB port, Micro USB port, USB-C port, etc.). The connector 106-9 is configured for connection to an external source of electrical power, e.g., a mains electrical supply outlet. The connector 106-9 may be used in substitution for the power source 105-9. That is the connector 106-9 may be electrically connectable to the heater 104-9 so as to supply electricity to the heater 104-9. In such embodiments, the device may not includes power source, and the power source of the system may instead comprise the connector 106-9 and an external source of electrical power (to which the connector 106-9 provides electrical connection).

In some embodiments, the connector 106-9 may be used to charge and recharge the power source 105-9 where the power source 105-9 includes a rechargeable battery.

The system 100-9 also comprises a user interface (UI) 107. Although not shown, the UI 107-9 may include input means to receive commands from a user. The input means of the UI 107-9 allows the user to control at least one aspect of the operation of the system 100-9. The input means may, for example, be in the form of a button, touchscreen, switch, microphone, etc.

The UI 107-9 also comprises output means to convey information to the user. The output means may, for example, comprise lights (e.g., LEDs), a display screen, speaker, vibration generator, etc.

The system 100-9 further comprises a controller 108-9 that is configured to control at least one function of the device 101-9. In the illustrated embodiment, the controller 108-9 is a component of the device 101-9, but in other embodiments may be separate from (but connectable to) the device 101-9. The controller 108-9 is configured to control the operation of the heater 104-9 and, for example, may be configured to control the voltage applied from the power source 105-9 to the heater 104-9. The controller 108-9 may be configured to toggle the supply of power to the heater 104-9 between an on state, in which the full output voltage of the power source 105-9 is applied to the heater 104-9, and an off state, in which the no voltage is applied to the heater 104-9.

Although not shown, the system 100-9 may also comprise a voltage regulator to regulate the output voltage from the power source 105-9 to form a regulated voltage. The regulated voltage may then be applied to the heater 104-9.

In addition to being connected to the heater 104-9, the controller 108-9 is operatively connected to the UI 107-9. Thus, the controller 108-9 may receive an input signal from the input means of the UI 107-9. Similarly, the controller 108-9 may transmit output signals to the UI 107-9. In response, the output means of the UI 107-9 may convey information, based on the output signals, to a user. The controller also comprises a memory 109, which is a non-volatile memory. The memory 109 includes instructions, which, when implemented, cause the controller to perform certain tasks or steps of a method.

FIG. 32B is a schematic showing a variation of the system 100-9 of FIG. 32A. In the system 100-9' of FIG. 32B, the heater 104-9 forms part of the device 101-9, rather than the consumable 102-9. In this variation, the heater 104-9 is electrically connected to the power source 105-9.

Figure 33B:
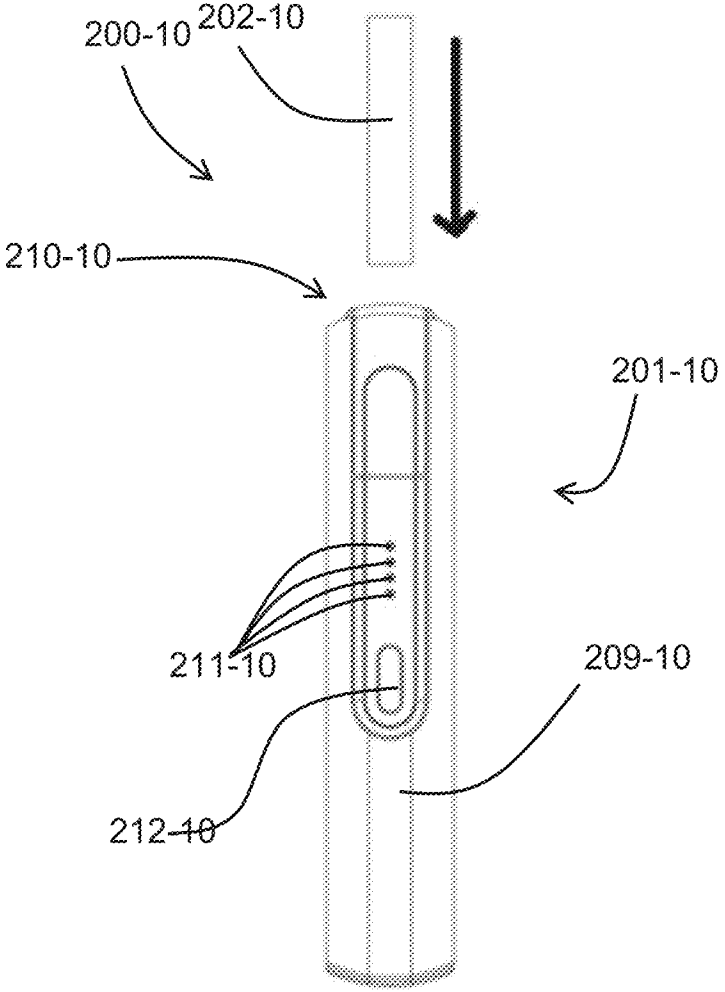
FIG. 33B is a front view of the first embodiment of the smoking substitute system with the consumable disengaged from the device.
Figure 33A:
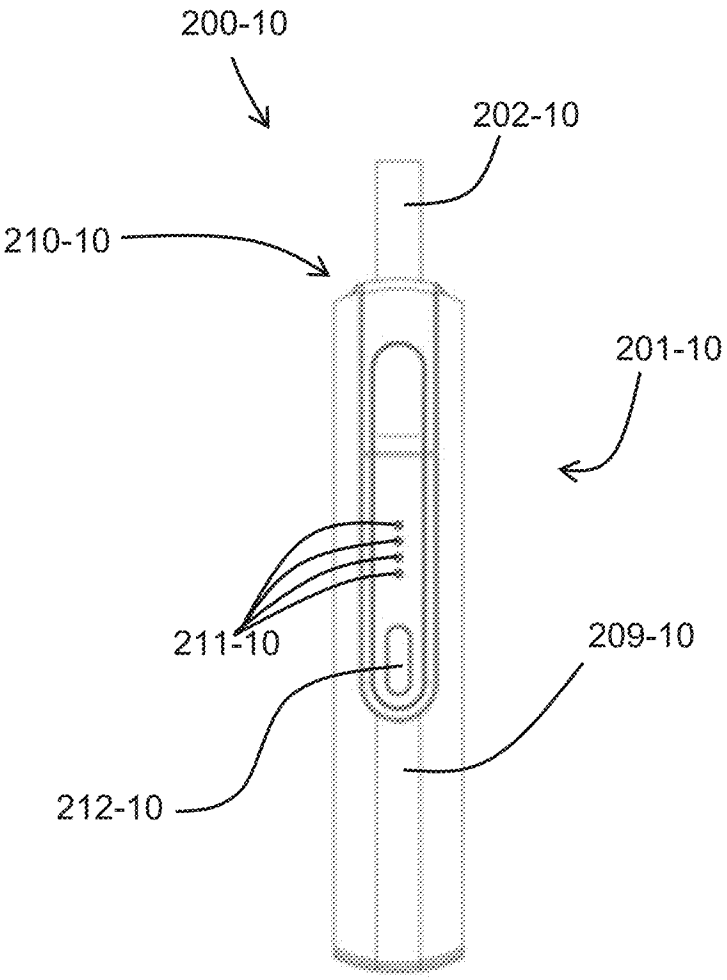
FIG. 33A is a front view of a first embodiment of a tenth mode of a smoking substitute system with the consumable engaged with the device.

FIG. 33A and FIG. 33B illustrate a heated-tobacco (HT) smoking substitute system 200-9. The system 200-9 is an example of the systems 100-9, 100' described in relation to FIG. 32A or FIG. 32B. System 200-9 includes an HT device 201-9 and an HT consumable 202-9. The description of FIG. 32A and FIG. 32B above is applicable to the system 200-9 of FIG. 33A and FIG. 33B, and will thus not be repeated.

The device 201-9 and the consumable 202-9 are configured such that the consumable 202-9 can be engaged with the device 201-9. FIG. 33A shows the device 201-9 and the consumable 202-9 in an engaged state, whilst FIG. 33B shows the device 201-9 and the consumable 202-9 in a disengaged state.

The device 201-9 comprises a body 209-9 and cap 210-9. In use the cap 210-9 is engaged at an end of the body 209-9. Although not apparent from the figures, the cap 210-9 is moveable relative to the body 209-9. In particular, the cap 210-9 is slideable and can slide along a longitudinal axis of the body 209-9.

The device 201-9 comprises an output means (forming part of the UI of the device 201-9) in the form of a plurality of light-emitting diodes (LEDs) 211 arranged linearly along the longitudinal axis of the device 201-9 and on an outer surface of the body 209-9 of the device 201-9. A button 212-9 is also arranged on an outer surface of the body 209-9 of the device 201-9 and is axially spaced (i.e., along the longitudinal axis) from the plurality of LEDs 211-9.

Figure 33C:
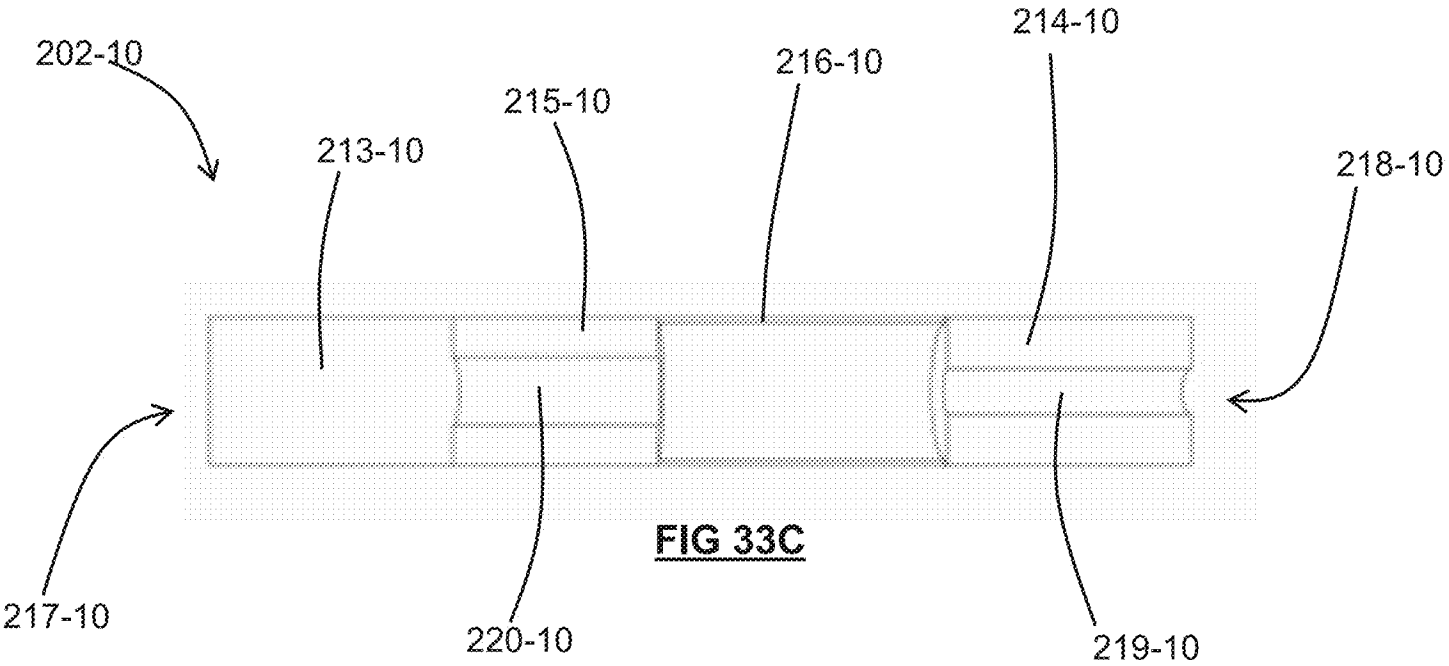
FIG. 33C is a section view of the consumable of the first embodiment of the smoking substitute system.

FIG. 33C show a detailed section view of the consumable of 202 of the system 200-9. The consumable 202-9 generally resembles a cigarette. In that respect, the consumable 202-9 has a generally cylindrical form with a diameter of 7 mm and an axial length of 70 mm. The consumable 202-9 comprises an aerosol forming substrate 213-9, a terminal filter element 214-9, an upstream filter element 215-9 and a spacer element 216-9. In other embodiments, the consumable may further comprise a cooling element. A cooling element may exchange heat with vapor that is formed by the aerosol-forming substrate 213-9 in order to cool the vapor so as to facilitate condensation of the vapor.

The aerosol-forming substrate 213-9 is substantially cylindrical and is located at an upstream end 217-9 of the consumable 202-9, and comprises the aerosol former of the system 200-9. In that respect, the aerosol forming substrate 213-9 is configured to be heated by the device 201-9 to release a vapor. The released vapor is subsequently entrained in an airflow flowing through the aerosol-forming substrate 213-9. The airflow is produced by the action of the user drawing on a downstream 218 (i.e., terminal or mouth) end of the consumable 202-9.

In the present embodiment, the aerosol forming substrate 213-9 comprises tobacco material that may, for example, include any suitable parts of the tobacco plant (e.g., leaves, stems, roots, bark, seeds and flowers). The tobacco may comprise one or more of leaf tobacco, stem tobacco, tobacco powder, tobacco dust, tobacco derivatives, expanded tobacco, homogenized tobacco, shredded tobacco, extruded tobacco, cut rag tobacco and/or reconstituted tobacco (e.g., slurry recon or paper recon). For example, the aerosol-forming substrate 213-9 may comprise a gathered sheet of homogenized (e.g. paper/slurry recon) tobacco or gathered shreds/strips formed from such a sheet.

In order to generate an aerosol, the aerosol forming substrate 213-9 comprises at least one volatile compound that is intended to be vaporized/aerosolized and that may provide the user with a recreational and/or medicinal effect when inhaled. The aerosol-forming substrate 213-9 may further comprise one or more additives. For example, such additives may be in the form of humectants (e.g., propylene glycol and/or vegetable glycerin), flavorants, fillers, aqueous/non-aqueous solvents and/or binders.

The terminal filter element 214-9 is also substantially cylindrical, and is located downstream of the aerosol forming substrate 213-9 at the downstream end 218-9 of the consumable 202-9. The terminal filter element 214-9 is in the form of a hollow bore filter element having a bore 219-9 (e.g., for airflow) formed there through. The diameter of the bore 219-9 is 2 mm. The terminal filter element 214-9 is formed of a porous (e.g., monoacetate) filter material. As set forth above, the downstream end 218-9 of the consumable 202-9 (i.e., where the terminal filter 214-9 is located) forms a mouthpiece portion of the consumable 202-9 upon which the user draws. Airflow is drawn from the upstream end 217-9, thorough the components of the consumable 202-9, and out of the downstream end 218-9. The airflow is driven by the user drawing on the downstream end 218-9 (i.e., the mouthpiece portion) of the consumable 202-9.

The upstream filter element 215-9 is located axially adjacent to the aerosol-forming substrate 213-9, between the aerosol-forming substrate 213-9 and the terminal filter element 214-9. Like the terminal filter 214-9 the upstream filter element 215-9 is in the form of a hollow bore filter element, such that it has a bore 220-9 extending axially there through. In this way, the upstream filter 215-9 may act as an airflow restrictor. The upstream filter element 215-9 is formed of a porous (e.g., monoacetate) filter material. The bore 220-9 of the upstream filter element 215-9 has a larger diameter (3 mm) than the terminal filter element 214-9.

The spacer 216-9 is in the form of a cardboard tube, which defines a cavity or chamber between the upstream filter element 215-9 and the terminal filter element 214-9. The spacer 216-9 acts to allow both cooling and mixing of the vapor/aerosol from the aerosol-forming substrate 213-9. The spacer has an external diameter of 7 mm and an axial length of 14 mm.

Although not apparent from the figure, the aerosol-forming substrate 213-9, upstream filter 215-9 and spacer 216-9 are circumscribed by a paper wrapping layer. The terminal filter 214-9 is circumscribed by a tipping layer that also circumscribes a portion of the paper wrapping layer (so as to connect the terminal filter 214-9 to the remaining components of the consumable 202-9). The upstream filter 215-9 and terminal filter 214-9 are circumscribed by further wrapping layers in the form of plug wraps.

Figure 33E:
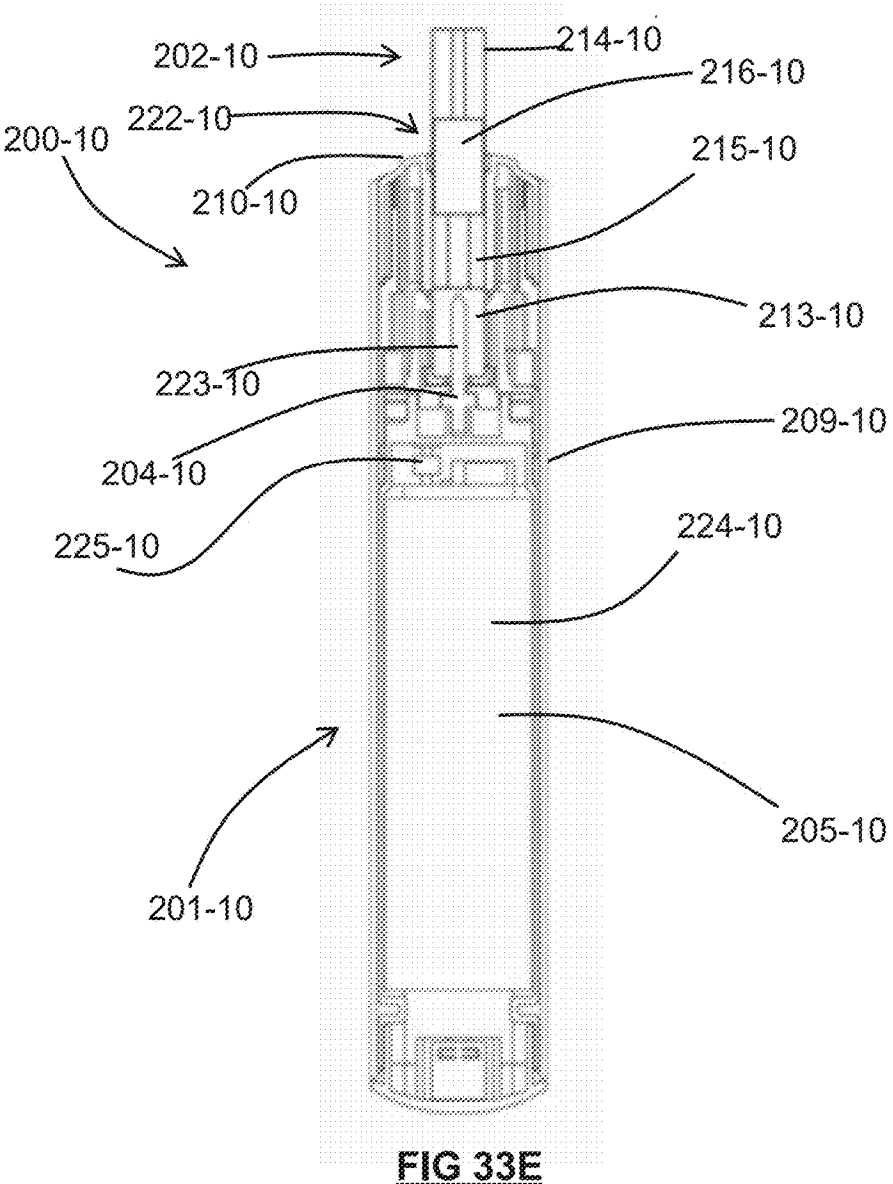
FIG. 33E is a section view of the first embodiment of the substitute smoking system.
Figure 33D:
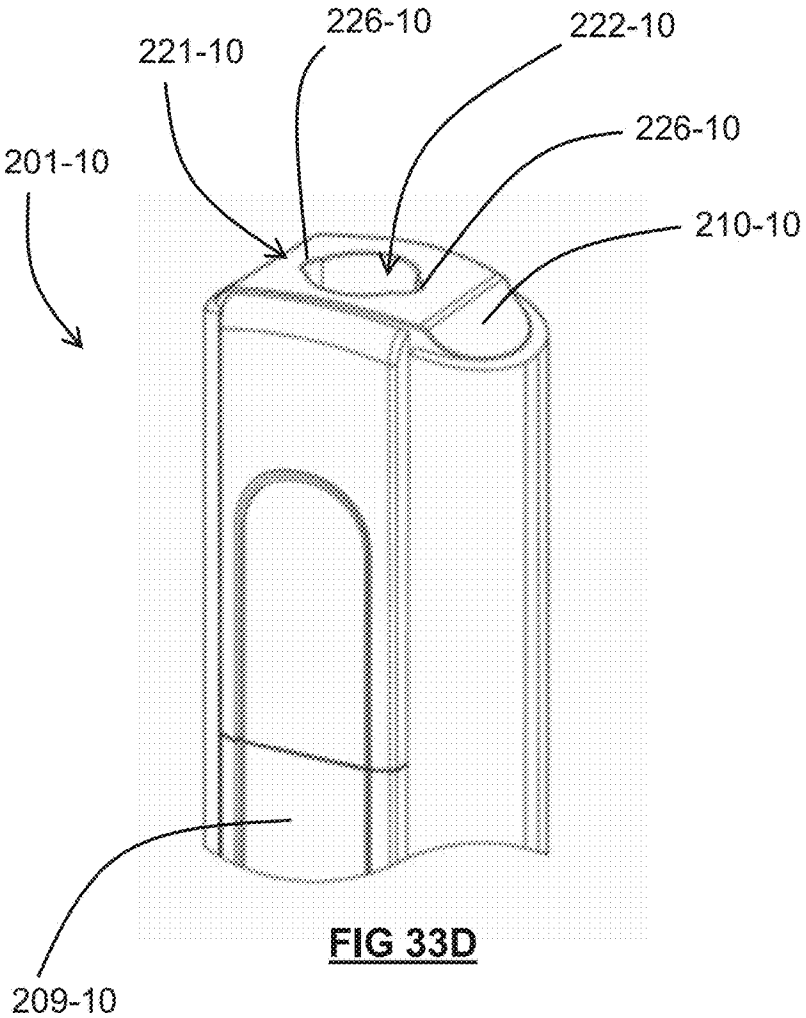
FIG. 33D is a detailed view of an end of the device of the first embodiment of the smoking substitute system.

Returning now to the device 201-9, FIG. 33D illustrates a detailed view of the end of the device 201-9 that is configured to engage with the consumable 202-9. The cap 210-9 of the device 201-9 includes an opening 221-9 to an internal cavity 222-9 (more apparent from FIG. 33D) defined by the cap 210-9. The opening 221-9 and the cavity 222-9 are formed so as to receive at least a portion of the consumable 202-9. During engagement of the consumable 202-9 with the device 201-9, a portion of the consumable 202-9 is received through the opening 221-9 and into the cavity 222-9. After engagement (see FIG. 33B), the downstream end 218-9 of the consumable 202-9 protrudes from the opening 221-9 and thus also protrudes from the device 201-9. The opening 221-9 includes laterally disposed notches 226-9. When a consumable 202-9 is received in the opening 221-9, these notches 226-9 remain open and could, for example, be used for retaining a cover in order to cover the end of the device 201-9.

FIG. 33E shows a cross section through a central longitudinal plane through the device 201-9. The device 201-9 is shown with the consumable 202-9 engaged therewith.

The device 201-9 comprises a heater 204-9 comprising heating element 223-9. The heater 204-9 forms part of the body 209-9 of the device 201-9 and is rigidly mounted to the body 209-9. In the illustrated embodiment 5 the heater 204-9 is a rod heater with a heating element 223-9 having a circular transverse profile. In other embodiments the heater may be in the form of a blade heater (e.g., heating element with a rectangular transverse profile) or a tube heater (e.g., heating element with a tubular form).

The heating element 223-9 of the heater 204-9 projects from an internal base of the cavity 222-9 along a longitudinal axis towards the opening 221-9. As is apparent from the figure, the length (i.e., along the longitudinal axis) of the heating element is less than a depth of the cavity 222-9. In this way, the heating element 223-9 does not protrude from or extend beyond the opening 221-9.

When the consumable 202-9 is received in the cavity 222-9 (as is shown in FIG. 33E), the heating element 223-9 penetrates the aerosol-forming substrate 213-9 of the consumable 202-9. In particular, the heating element 223-9 extends for nearly the entire axial length of the aerosol-forming substrate 213-9 when inserted therein. Thus, when the heater 204-9 is activated, heat is transferred radially from an outer circumferential surface the heating element 223-9 to the aerosol-forming substrate 213-9. Upon activation of the device 201-9, the heating element 223-9 may be supplied with power to increase the temperature of the consumable 202-9 from room temperature to target temperature. This is a heat up phase. The target temperature is the temperature of the consumable 202-9 at which the aerosol may be produced and at which the user puffs on the consumable.

The heating element 223-9 may heat up too fast if a single high power is provided to reach the target temperature. For example, an outer region of the consumable 202-9, away from the heating element 223-9, may remain cool, while inner region of the consumable 202-9, nearer to the heating element 223-9, may be heated to the target temperature. By the time the outer region heated to reach the target temperature, the inner region may be burnt. This may lead to user experiencing burnt taste in first inhale of the aerosol.

To avoid experiencing the burnt taste, the heating element 223-9 may be heated from room temperature to the target temperature using two power levels. This ensures enough time for thermal transfer from parts of the consumable 202-9 proximal the heating element 223-9 to parts of the consumable distal from heating element. This may provide for a more even heating of the aerosol forming substrate.

The device 201-9 further comprises an electronics cavity 224-9. A power source, in the form of a rechargeable battery 205-9 (a lithium ion battery), is located in electronics cavity 224-9.

The device 201-9 includes a connector (i.e., forming part of an IO module of the device 201-9) in the form of a USB port 206-9. The connector may alternatively be, for example, a micro-USB port or a USB-C port for examples. The USB port 206-9 may be used to recharge the rechargeable battery 205-9.

The device 201-9 includes a controller (not shown) located in the electronics cavity 224-9. The controller comprises a microcontroller mounted on a printed circuit board (PCB). The USB port 206-9 is also connected to the controller 208-9 (i.e., connected to the PCB and microcontroller).

The controller 208-9 is configured to control at least one function of the device 202-9. For example, the controller 208-9 is configured to control the operation of the heater 204-9. Such control of the operation of the heater 204-9 may be accomplished by the controller toggling the electrical connection of the rechargeable battery 205-9 to the heater 204-9. For example, the controller 208-9 is configured to control the heater 204-9 in response to a user depressing the button 212-9. Depressing the button 212-9 may cause the controller to allow a voltage (from the rechargeable battery 205-9) to be applied to the heater 204-9 (so as to cause the heating element 223-9 to be heated).

The controller is configured to control the power source, to supply power to the heating element. The controller may be configured to control supply of power with at least two power levels for heating the heating element 223-9 from ambient temperature to target temperature. A first power level may be supplied to a heating element 223-9 of the device 201-9, upon activation of the device 201-9, for a first period. The controller monitors the duration of the first power level supply. Upon completion of the first period, the controller supplies the second power level to the heating element 223-9, for a second period. The first power level is greater than the second power level.

Figure 34:
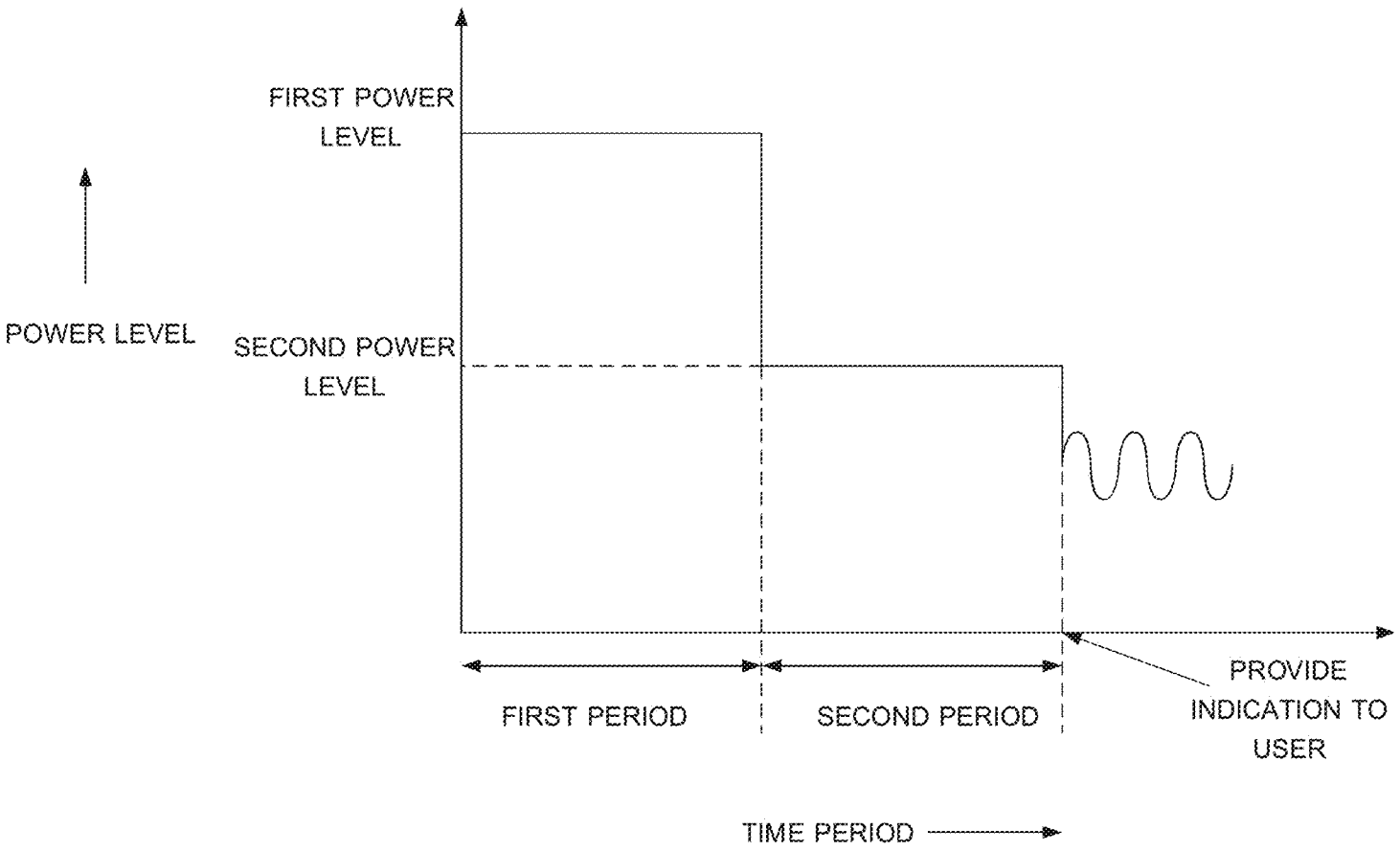
FIG. 34 is a graphical representation of different power levels supplied to the heater at different period and providing user indication.

FIG. 34 is a graph showing controlling of power supply to the heating element 223-9, upon activation of the device 201-9. In some embodiments, the first period is different from the second period. In some embodiments, the second period is subsequent to the first period. In some embodiments, one or more of: the first power level, the second power level, the first period, and the second period may be predefined.

In some embodiments, the device may implement one or more intermediate power supply periods between the first period and the second period. Each intermediate power supply period has a respective intermediate power level. The intermediate power levels of the intermediate power periods may decrease step-wise between the first power level and the second power level. Each intermediate power period has a respective duration (or period). The durations of any intermediate power periods may be equal or they may be different from one another.

Consider for example, the target temperature to reach is 300 degrees Celsius. The first power level and the second power level may be relatively predefined. Also, the first period and the second period may be relatively predefined.

For example, the first power level may be predefined such that the consumable is heated at a first power for 10 seconds, and subsequently at a second lower power for 15 seconds, so achieve the target temperature of 300 degrees Celsius. The first period may be predefined, while the second period may not be predefined. For example, the second period may depend on the time it takes for a measured temperature of the heater to reach the target temp (which may depend on environmental conditions for example). By heating in the two-step manner, the target temperature may be achieved in both the inner region and the outer region of the consumable 202-9, without over heating the inner region.

Upon, completion of the second period, the device 201-9 may indicate the completion of the pre-heat phase to the user. In some embodiments, the device 201-9 may include an indication unit to indicate the completion to the user. In some embodiments, the indication may include a notification that the device 201-9 is ready to use. The output means associated with the device 201-9, may be used for the indication. In some embodiments, the indication may be provided via a display screen associated with the device 201-9. In some embodiments, the indication may be provided via illumination of an LED associated with the device 201-9. In some embodiments, the device 201-9 may be configured to vibrate to indicate that the device 201-9 is ready to use. One or more other means, known to a person skilled in the art, may be implemented in the device 201-9 as the indication unit, to provide the indication to the user. The controller is also configured to control the LEDs 211-9 in response to (e.g., a detected) a condition of the device 201-9 or the consumable 202-9. For example, the controller may control the LEDs to indicate whether the device 201-9 is in an on state or an off state (e.g., one or more of the LEDs may be illuminated by the controller when the device is in an on state).

The device 201-9 comprises a further input means (i.e., in addition to the button 212-9) in the form of a puff sensor 225-9. The puff sensor 225-9 is configured to detect a user drawing (i.e., inhaling) at the downstream end 218-9 of the consumable 202-9. The puff sensor 225-9 may, for example, be in the form of a pressure sensor, flow meter or a microphone. The puff sensor 225-9 is operatively connected to the controller 208-9 in the electronics cavity 224-9, such that a signal from the puff sensor 225-9, indicative of a puff state (i.e., drawing or not drawing), forms an input to the controller 208-9 (and can thus be responded to by the controller 208-9).

Figure 35A:
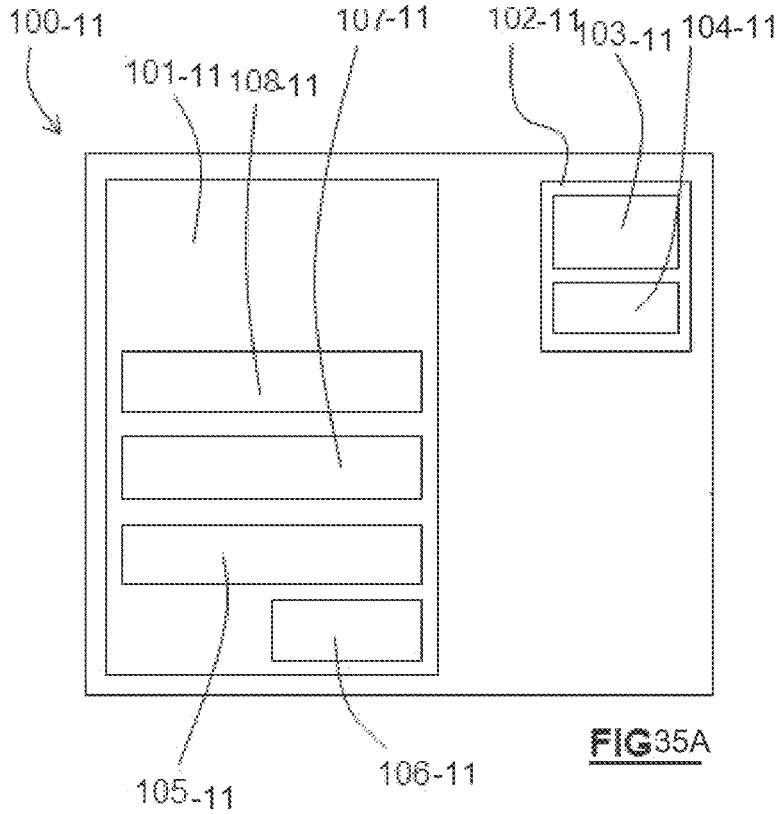
FIG. 35A is a schematic of a smoking substitute system.

Eleventh Mode of the Disclosure FIG. 35A is a schematic providing a general overview of a smoking substitute system 100-10. The system 100-10 includes a substitute smoking device 101-10 and an aerosol-forming article in the form of a consumable 102-10, which comprises an aerosol former 103-10. The system is configured to vaporize the aerosol former by heating the aerosol former 103-10 (so as to form a vapor/aerosol for inhalation by a user).

In the illustrated system, the heater 104-10 forms part of the consumable 102-10 and is configured to heat the aerosol former 103-10. Heat from the heater 104-10 vaporizes the aerosol former 103-10 to produce a vapor. The vapor subsequently condenses to form an aerosol, which is ultimately inhaled by the user.

The system 100-10 further comprises a power source 105-10 that forms part of the device 101-10. In other embodiments the power source 105-10 may be external to (but connectable to) the device 101-10. The power source 105-10 is electrically connectable to the heater 104-10 such that it is able to supply power to the heater 104-10 (i.e., for the purpose of heating the aerosol former 103-10). Thus, control of the electrical connection of the power source 105-10 to the heater 104-10 provides control of the state of the heater 104-10. The power source 105-10 may be a power store, for example a battery or rechargeable battery (e.g., a lithium ion battery).

The system 100-10 further comprises an I/O module comprising a connector 106-10 (e.g., in the form of a USB port, Micro USB port, USB-C port, etc.). The connector 106-10 is configured for connection to an external source of electrical power, e.g., a mains electrical supply outlet. The connector 106-10 may be used in substitution for the power source 105-10. That is the connector 106-10 may be electrically connectable to the heater 104-10 so as to supply electricity to the heater 104-10. In such embodiments, the device may not include a power source, and the power source of the system may instead comprise the connector 106-10 and an external source of electrical power (to which the connector 106-10 provides electrical connection).

In some embodiments, the connector 106-10 may be used to charge and recharge the power source 105-10 where the power source 104-10 includes a rechargeable battery.

The system 100-10 also comprises a user interface (UI) 107. Although not shown, the UI 107-10 may include input means to receive commands from a user. The input means of the UI 107-10 allows the user to control at least one aspect of the operation of the system 100-10. The input means may, for example, be in the form of a button, touchscreen, switch, microphone, etc.

The UI 107-10 also comprises output means to convey information to the user. The output means may, for example, comprise lights (e.g., LEDs), a display screen, speaker, vibration generator, etc.

The system 100-10 further comprises a controller 108-10 that is configured to control at least one function of the device 101-10. In the illustrated embodiment, the controller 108-10 is a component of the device 101-10, but in other embodiments may be separate from (but connectable to) the device 101-10. The controller 108-10 is configured to control the operation of the heater 104-10 and, for example, may be configured to control the voltage applied from the power source 105-10 to the heater 104-10. The controller 108-10 may be configured to toggle the supply of power to the heater 105-10 between an on state, in which the full output voltage of the power source 105-10 is applied to the heater 104-10, and an off state, in which the no voltage is applied to the heater 104-10.

Although not shown, the system 100-10 may also comprise a voltage regulator to regulate the output voltage from the power source 105-10 to form a regulated voltage. The regulated voltage may then be applied to the heater 104-10.

In addition to being connected to the heater 104-10, the controller 108-10 is operatively connected to the UI 107-10. Thus, the controller 108-10 may receive an input signal from the input means of the UI 107-10. Similarly, the controller 108-10 may transmit output signals to the UI 107-10. In response, the output means of the UI 107-10 may convey information, based on the output signals, to a user.

Figure 35B:
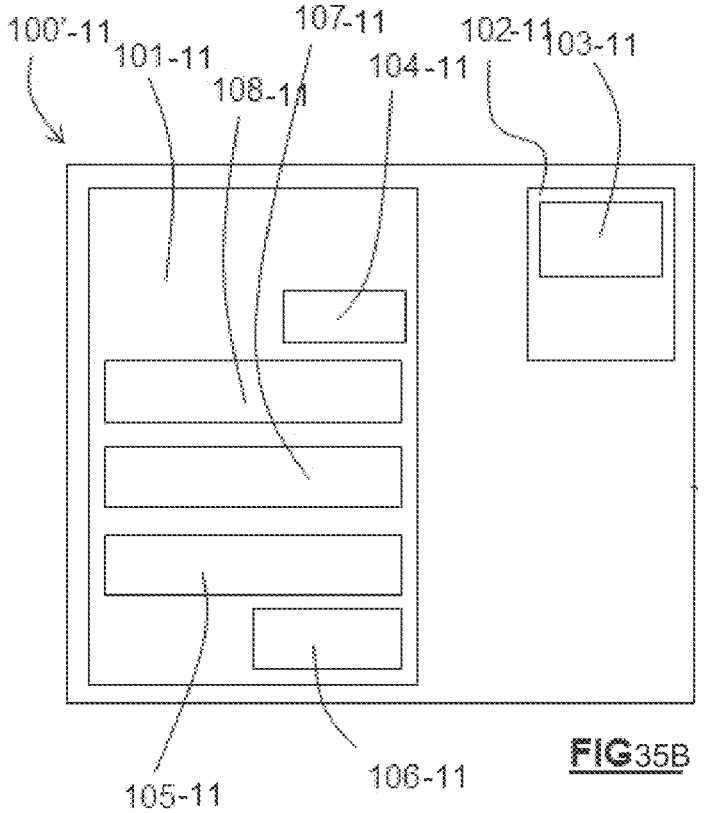
FIG. 35B is a schematic of a variation of the smoking substitute system of FIG. 35A.

FIG. 35B is a schematic showing a variation of the system 100-10 of FIG. 35A. In the system 100-10' of FIG. 35B, the heater 104-10 forms part of the consumable 102-10, rather than the device 101-10. In this variation the heater 104-10 is electrically connectable to the power source 105-10, for example, when the consumable 102-10 is engaged with the device 101-10.

The systems 100-10, 100' of FIG. 35A and FIG. 35B may be implemented as one of two broad categories of system, each in accordance with the present disclosure: a heated tobacco (HT) system or an e-cigarette system. A description of each category of system follows.

Figure 36A:
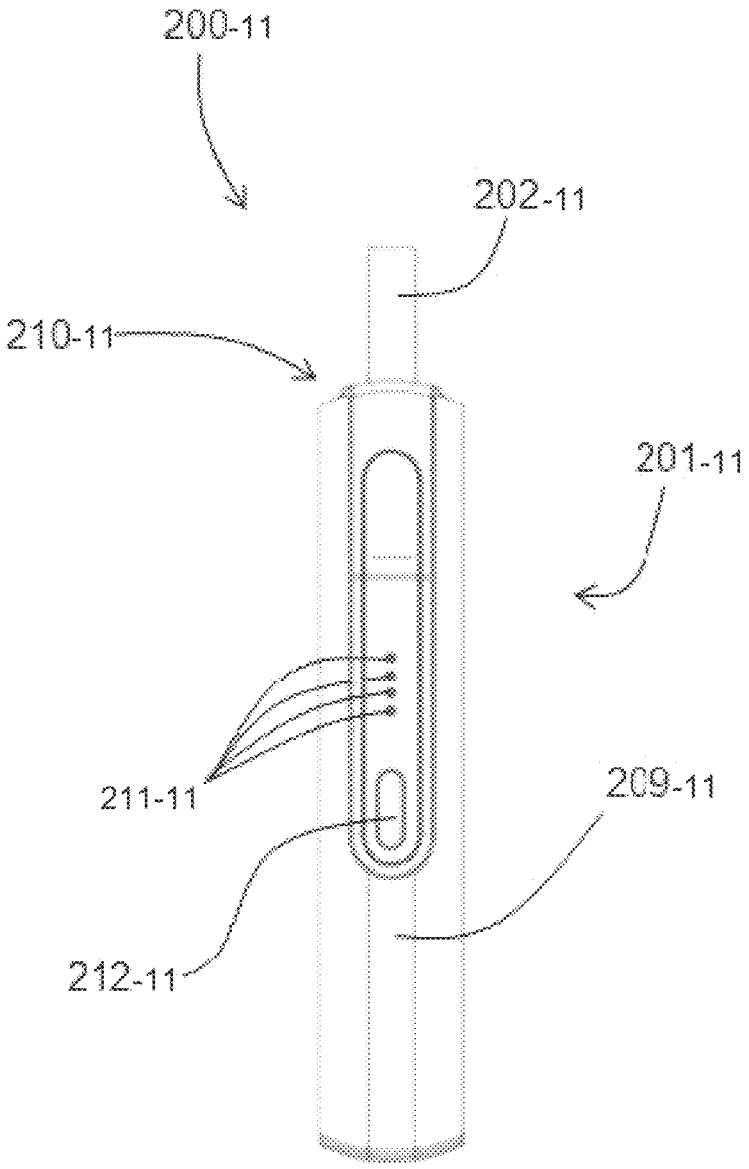
FIG. 36A is a front view of a first embodiment of an eleventh mode of a smoking substitute system with the consumable engaged with the device.
Figure 36B:
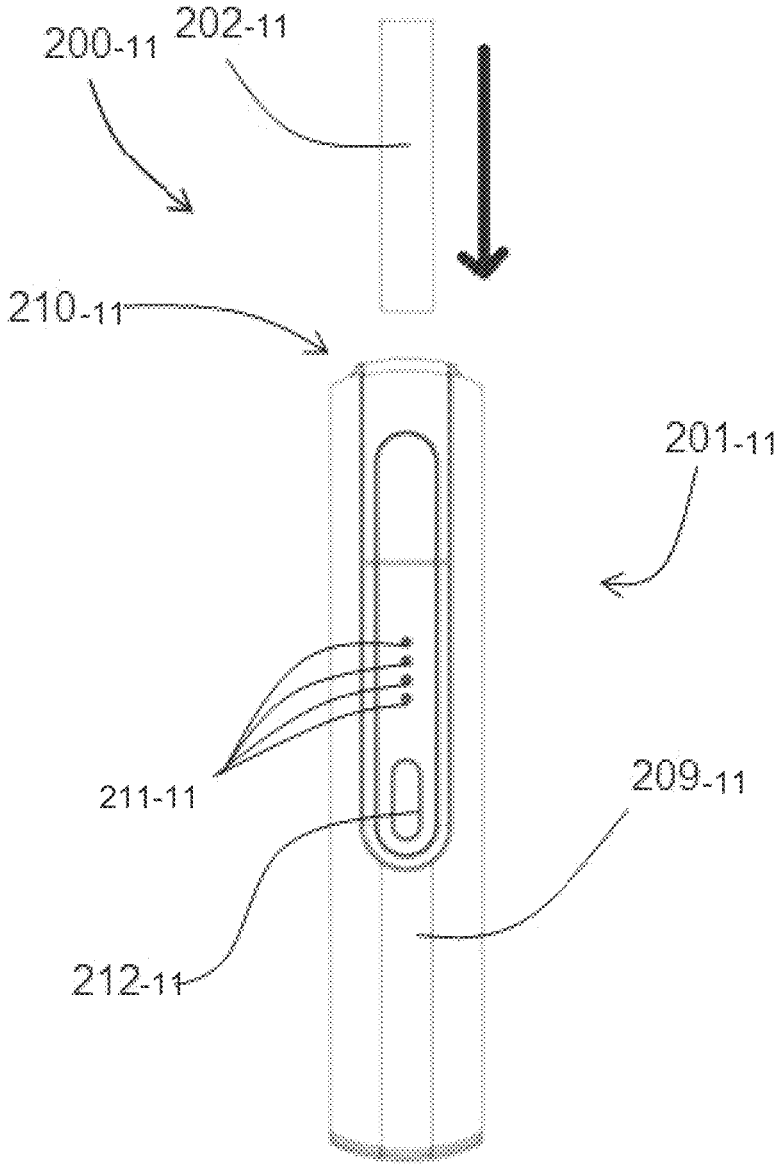
FIG. 36B is a front view of the first embodiment of the smoking substitute system with the consumable disengaged from the device.

FIG. 36A and FIG. 36B illustrate a heated-tobacco (HT) smoking substitute system 200-10. The system 200-10 is an example of the systems 100-10, 100' described in relation to FIG. 35A or FIG. 35B. System 200-10 includes an HT device 201-10 and an HT consumable 202-10. The description of FIG. 35A and FIG. 35B above is applicable to the system 200-10 of FIG. 36A and FIG. 36B, and will thus not be repeated.

The device 201-10 and the consumable 202-10 are configured such that the consumable 202-10 can be engaged with the device 201-10. FIG. 36A shows the device 201-10 and the consumable 202-10 in an engaged state, whilst FIG. 36B shows the device 201-10 and the consumable 202-10 in a disengaged state.

The device 201-10 comprises a body 209-10 and cap 210-10. In use the cap 209-10 is engaged at an end of the body 209-10. Although not apparent from the figures, the cap 210-10 is moveable relative to the body 209-10. In particular, the cap 210-10 is slideable and can slide along a longitudinal axis of the body 209-10.

The device 201-10 comprises an output means (forming part of the UI of the device 201-10) in the form of a plurality of light-emitting diodes (LEDs) 211 arranged linearly along the longitudinal axis of the device 201-10 and on an outer surface of the body 209-10 of the device 201-10. A button 212-10 is also arranged on an outer surface of the body 209-10 of the device 201-10 and is axially spaced (i.e., along the longitudinal axis) from the plurality of LEDs 211-10.

Figure 36C:
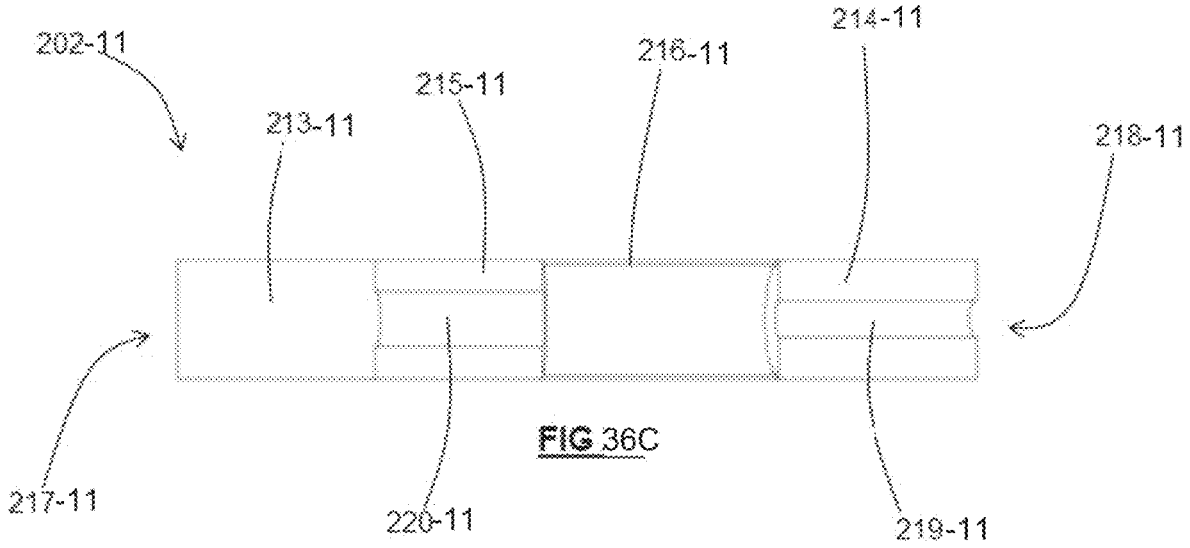
FIG. 36C is a section view of the consumable of the first embodiment of the smoking substitute system.

FIG. 36C shows a detailed section view of the consumable of 202 of the system 200-10. The consumable 202-10 generally resembles a cigarette. In that respect, the consumable 202-10 has a generally cylindrical form with a diameter of 7 mm and an axial length of 70 mm. The consumable 202-10 comprises an aerosol forming substrate 213-10, a terminal filter element 214-10, an upstream filter element 215-10 and a spacer element 216-10. In other embodiments, the consumable may further comprise a cooling element. A cooling element may exchange heat with vapor that is formed by the aerosol-forming substrate 213-10 in order to cool the vapor so as to facilitate condensation of the vapor.

The aerosol-forming substrate 213-10 is substantially cylindrical and is located at an upstream end 217-10 of the consumable 202-10, and comprises the aerosol former of the system 200-10. In that respect, the aerosol forming substrate 213-10 is configured to be heated by the device 201-10 to release a vapor. The released vapor is subsequently entrained in an airflow flowing through the aerosol-forming substrate 213-10. The airflow is produced by the action of the user drawing on a downstream 218 (i.e., terminal or mouth end) of the consumable 202-10.

In the present embodiment, the aerosol forming substrate 213-10 comprises tobacco material that may, for example, include any suitable parts of the tobacco plant (e.g., leaves, stems, roots, bark, seeds and flowers). The tobacco may comprise one or more of leaf tobacco, stem tobacco, tobacco powder tobacco dust, tobacco derivatives, expanded tobacco, homogenized tobacco, shredded tobacco, extruded tobacco, cut rag tobacco and/or reconstituted tobacco (e.g., slurry recon or paper recon). For example, the aerosol-forming substrate 213-10 may comprise a gathered sheet of homogenized (e.g., paper/slurry recon) tobacco or gathered shreds/strips formed from such a sheet.

In order to generate an aerosol, the aerosol forming substrate 213-10 comprises at least one volatile compound that is intended to be vaporized/aerosolized and that may provide the user with a recreational and/or medicinal effect when inhaled. The aerosol-forming substrate 213-10 may further comprise one or more additives. For example, such additives may be in the form of humectants (e.g., propylene glycol and/or vegetable glycerin), flavorants, fillers, aqueous/non-aqueous solvents and/or binders.

The terminal filter element 214-10 is also substantially cylindrical, and is located downstream of the aerosol forming substrate 213-10 at the downstream end 218-10 of the consumable 202-10. The terminal filter element 214-10 is in the form of a hollow bore filter element having a bore 219-10 (e.g., for airflow) formed there through. The diameter of the bore 219-10 is 2 mm. The terminal filter element 214-10 is formed of a porous (e.g., monoacetate) filter material. As set forth above, the downstream end 218-10 of the consumable 202-10 (i.e., where the terminal filter 214-10 is located) forms a mouthpiece portion of the consumable 202-10 upon which the user draws. Airflow is drawn from the upstream end 217-10, thorough the components of the consumable 202-10, and out of the downstream end 218-10. The airflow is driven by the user drawing on the downstream end 218-10 (i.e., the mouthpiece portion) of the consumable 202-10.

The upstream filter element 215-10 is located axially adjacent to the aerosol-forming substrate 213-10, between the aerosol-forming substrate 213-10 and the terminal filter element 214-10. Like the terminal filter 214-10, the upstream filter element 215-10 is in the form of a hollow bore filter element, such that it has a bore 220-10 extending axially there through. In this way, the upstream filter 215-10 may act as an airflow restrictor. The upstream filter element 215-10 is formed of a porous (e.g., monoacetate) filter material. The bore 220-10 of the upstream filter element 214 has a larger diameter (3 mm) than the terminal filter element 214-10.

The spacer 216-10 is in the form of a cardboard tube, which defines a cavity or chamber between the upstream filter element 215-10 and the terminal filter element 214-10. The spacer 216-10 acts to allow both cooling and mixing of the vapor/aerosol from the aerosol-forming substrate 213-10. The spacer has an external diameter of 7 mm and an axial length of 14 mm.

Although not apparent from the figure, the aerosol-forming substrate 213-10, upstream filter 215-10 and spacer 216-10 are circumscribed by a paper wrapping layer. The terminal filter 214-10 is circumscribed by a tipping layer that also circumscribes a portion of the paper wrapping layer (so as to connect the terminal filter 214-10 to the remaining components of the consumable 202-10). The upstream filter 215-10 and terminal filter 214-10 are circumscribed by further wrapping layers in the form of plug wraps.

Figure 36D:
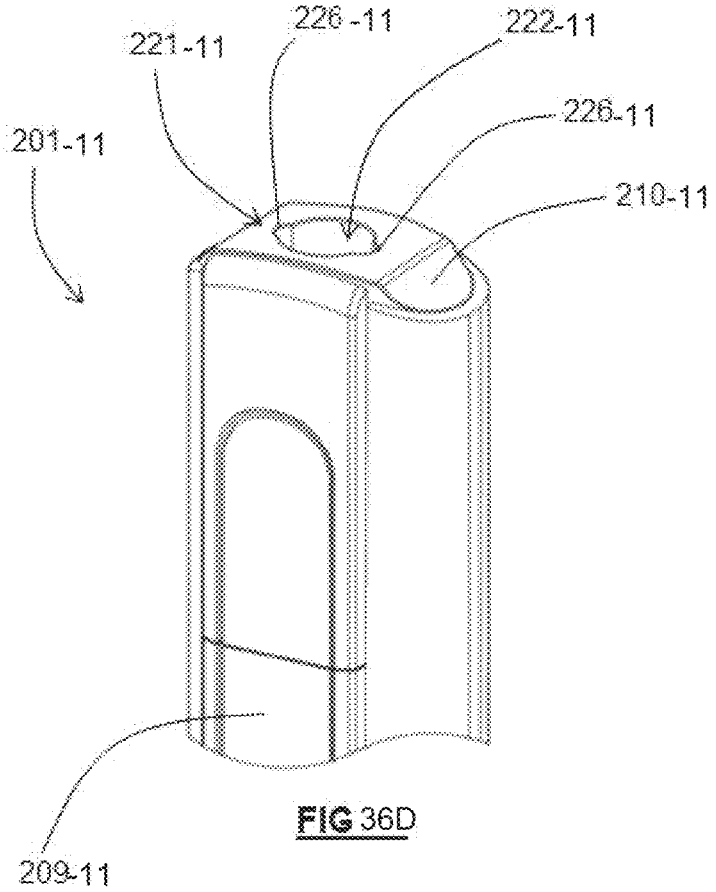
FIG. 36D is a detailed view of an end of the device of the first embodiment of the smoking substitute system.

Returning now to the device 201-10, FIG. 36D illustrates a detailed view of the end of the device 201-10 that is configured to engage with the consumable 202-10. The cap 210-10 of the device 201-10 includes an opening 221-10 to an internal cavity 222-10 (more apparent from FIG. 36D) defined by the cap 210-10. The opening 221-10 and the cavity 222-10 are formed so as to receive at least a portion of the consumable 202-10.

During engagement of the consumable 202-10 with the device 201-10, a portion of the consumable 202-10 is received through the opening 221-10 and into the cavity 222-10. After engagement (see FIG. 36B), the downstream end 218-10 of the consumable 202-10 protrudes from the opening 221-10 and thus also protrudes from the device 201-10. The opening 221-10 includes laterally disposed notches 226-10. When a consumable 202-10 is received in the opening 221-10, these notches 226-10 remain open and could, for example, be used for retaining a cover in order to cover the end of the device 201-10.

Figure 36E:
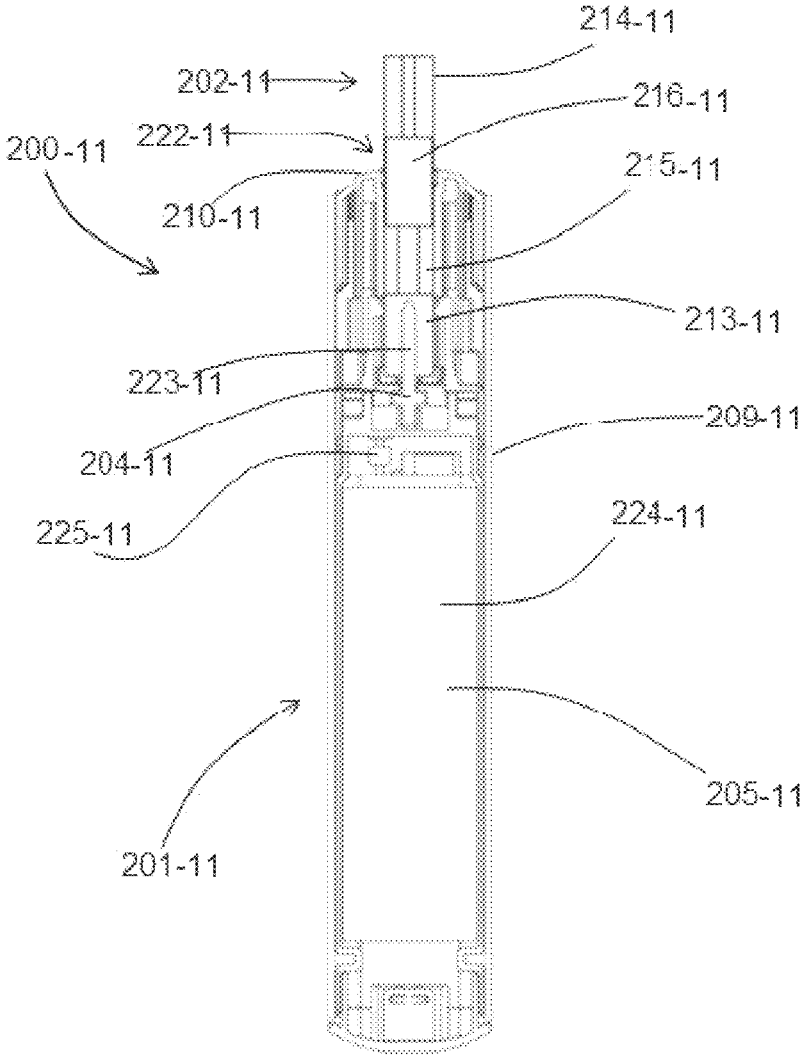
FIG. 36E is a section view of the first embodiment of the substitute smoking system.

FIG. 36E shows a cross section through a central longitudinal plane through the device 201-10. The device 201-10 is shown with the consumable 202-10 engaged therewith.

The device 201-10 comprises a heater 204-10 comprising heating element 223-10. The heater 204-10 forms part of the body 209-10 of the device 201-10 and is rigidly mounted to the body 209-10. In the illustrated embodiment, the heater 204-10 is a rod heater with a heating element 223-10 having a circular transverse profile. In other embodiments the heater may be in the form of a blade heater (e.g., heating element with a rectangular transverse profile) or a tube heater (e.g., heating element with a tubular form).

The heating element 223-10 of the heater 204-10 projects from an internal base of the cavity 222-10 along a longitudinal axis towards the opening 221-10. As is apparent from the figure, the length (i.e., along the longitudinal axis) of the heating element is less than a depth of the cavity 222-10. In this way, the heating element 223-10 does not protrude from or extend beyond the opening 221-10.

When the consumable 202-10 is received in the cavity 222-10 (as is shown in FIG. 36E), the heating element 223-10 penetrates the aerosol-forming substrate 213-10 of the consumable 202-10. In particular, the heating element 223-10 extends for nearly the entire axial length of the aerosol-forming substrate 213-10 when inserted therein. Thus, when the heater 204-10 is activated, heat is transferred radially from an outer circumferential surface the heating element 223-10 to the aerosol-forming substrate 213-10.

The device 201-10 further comprises an electronics cavity 224-10. A power source, in the form of are chargeable battery 205-10 (a lithium ion battery), is located in electronics cavity 224-10.

The device 201-10 includes a connector (i.e., forming part of an IO module of the device 201-10) in the form of a USB port 206-10. The connector may alternatively be, for example, a micro-USB port or a USB-C port for examples. The USB port 206-10 may be used to recharge the rechargeable battery 205-10.

The device 201-10 includes a controller (not shown) located in the electronics cavity 224-10. The controller comprises a microcontroller mounted on a printed circuit board (PCB). The USB port 206-10 is also connected to the controller 208-10 (i.e., connected to the PCB and microcontroller).

The controller 208-10 is configured to control at least one function of the device 201-10. For example, the controller 208-10 is configured to control the operation of the heater 204-10. Such control of the operation of the heater 204-10 may be accomplished by the controller toggling the electrical connection of the rechargeable battery 205-10 to the heater 204-10. For example, the controller 208-10 is configured to control the heater 204-10 in response to a user depressing the button 212-10. Depressing the button 212-10 may cause the controller to allow a voltage (from the rechargeable battery 205-10) to be applied to the heater 204-10 (so as to cause the heating element 223-10 to be heated).

The controller is also configured to control the LEDs 211-10 in response to (e.g., a detected) a condition of the device 201-10 or the consumable 202-10. For example, the controller may control the LEDs to indicate whether the device 201-10 is in an on state or an off state (e.g., one or more of the LEDs may be illuminated by the controller when the device is in an on state).

The device 201-10 comprises a further input means (i.e., in addition to the button 212-10) in the form of a puff measurement means. In some embodiments the puff measurement means is a puff sensor 225-10. The puff sensor 225-10 is configured to detect a user drawing (i.e., inhaling) at the downstream end 218-10 of the consumable 202-10. The puff sensor 225-10 may, for example, be in the form of a pressure sensor, flow meter or a microphone. The puff sensor 225-10 is operatively connected to the controller 208-10 in the electronics cavity 224-10, such that a signal from the puff sensor 225-10, indicative of a puff state (i.e., drawing or not drawing), forms an input to the controller 208-10 (and can thus be responded to by the controller 208-10).

In some embodiments, the puff sensor 225-10 may be configured to measure a puff duration associated with a user puff action. In some embodiments, the puff sensor measures a puff duration when the device is in an activated ON state. During the ON period of the device 201-10 the heater of the device is heated to a baseline operating temperature (e.g., a baseline target temperature of between 250 and 350 degrees Celsius). The ON period is the period at which the device 201-10 is switched ON by the user and the heater is activated. The user puff action is act of the user drawing at the downstream end 218-10 of the consumable 202-10. The puff sensor 225-10 may be configured to determine the puff duration by tracking inhaling of the user. For example, start and end of the inhalation may be detected and timed to measure the puff duration. The timing may be performed by the controller or by the puff sensor 225-10.

In some embodiments an input from the puff sensor 225-10 to the controller may be the puff duration. The controller may use the puff duration to change the baseline operating temperature of the heating element 223-10 of the device 201-10. In some embodiments, the controller may be configured to control the power source of the device 201-10 to control the operating temperature of the heating element 223-10.

In some embodiments, the controller may compare the puff duration with a predefined threshold value. For example, the predefined threshold value may be 2 seconds. In some embodiments, the predefined threshold is an average puff duration of the user. For example, if the puff duration measured for a user puff action exceeds the threshold of 2 seconds, the controller determines the puff duration to be greater than the predefined threshold value, i.e., the user is drawing the consumable for a longer duration than the threshold duration. The act of drawing air through the consumable and adjacent the heater may cause cooling of the heater and the consumable. Without the change in temperature of the present disclosure, Total Particulate Matter (TPM) of the device 201-10 may decrease and impair the smoking experience of the user.

In some embodiments, when the puff duration is measured to be greater than the predefined threshold value, the controller may be configured to increase the operating temperature of the heating element 223-10. The operating temperature is increased either during the puff being measured, or during a subsequent puff. By increasing the operating temperature, and counteracting the cooling effect of a long puff, the TPM of the device 201-10 may be increased, providing an improved smoking experience to the user. Also, the device 201-10 may be configured to adaptively heat the heating element 223-10, aiding in an intuitive and smart smoking device.

In some embodiments, the controller may increase the operating temperature to a predefined elevated temperature above the baseline operating temperature. For example, baseline operating temperature may be 250 degrees Celsius and the predefined elevated temperature may be 280 degrees Celsius. When in the puff duration is detected to be greater than the predefined threshold value, the controller may increase the operating temperature of the heating element 223-10 from 250 to 28° degrees Celsius. The predefined temperature may be selected to be any temperature at which the consumable 202-10 is heated to form aerosol, without burning the consumable 202-10. The controller may be configured to increase the operating temperature until the user puff action ends. By which, undesired heating of the heating element 223-10 may be eliminated. In some embodiments, the puff sensor 225-10 may be configured to detect the end of the puff action.

In some embodiments, the controller is configured to change the operating back to the baseline temperature at the completion of the user puff.

In some embodiments, the controller may be configured to gradually increase the operating temperature of the heating element 223-10 until the user puff action ends. The operating temperature is increased to a limit such that the consumable 202-10 is not burnt but is only heated to form the aerosol. By this, even with the increase of the temperature, the consumable 202-10 is made sure to be not burnt in the device.

Figure 37A:
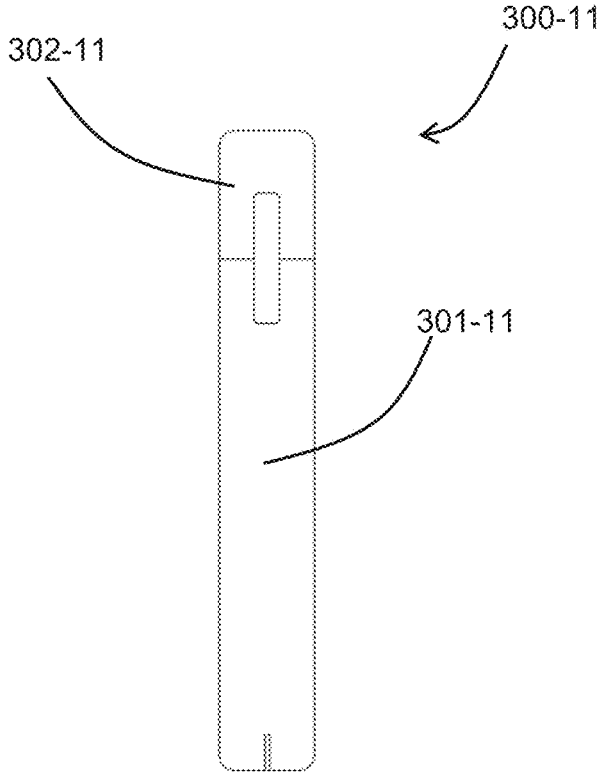
FIG. 37A is a front view of a second embodiment of a smoking substitute system with the consumable engaged with the device.
Figure 37B:
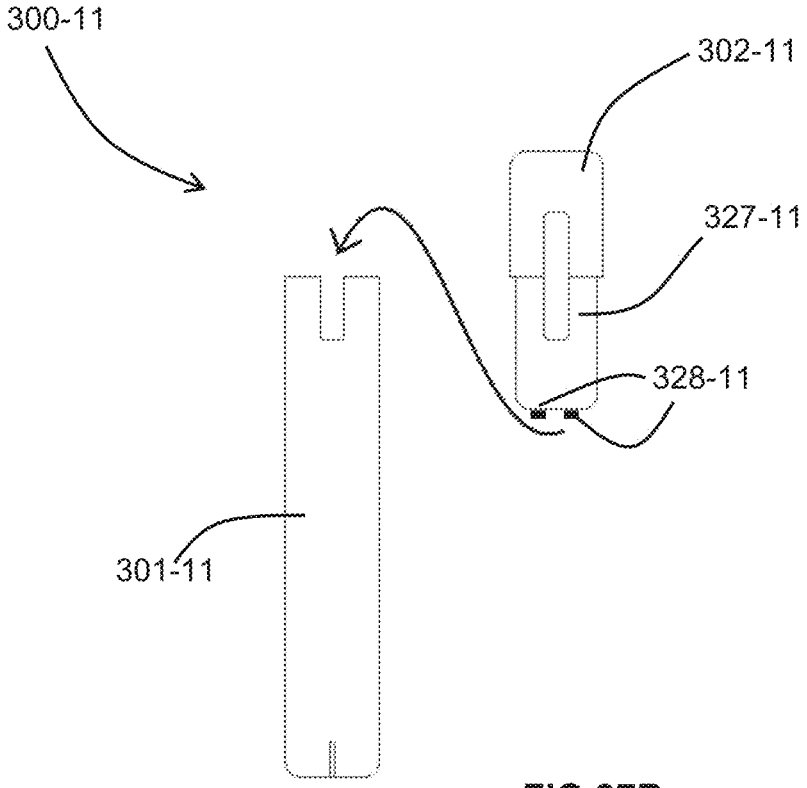
FIG. 37B is a front view of a second embodiment of the smoking substitute system with the consumable disengaged from the device.

FIG. 37A and FIG. 37B illustrate an e-cigarette smoking substitute system 300-10. The system 300-10 is an example of the systems 100-10, 100' of FIG. 35A and FIG. 35B and comprises an e-cigarette device 301-10 and an e-cigarette consumable 302-10. The description of FIG. 35A and FIG. 35B above is applicable to the system of FIG. 37A and FIG. 37B, and will not be repeated.

The device 301-10 and the consumable 302-10 are configured such that the consumable 302-10 can be engaged with the device 301-10. FIG. 37A shows the device 301-10 and the consumable 302-10 in an engaged state, whilst FIG. 37B shows the device 301-10 and the consumable 302-10 in a disengaged state. During engagement a portion of the consumable 302-10 is received in a cavity 322-10 of the device 301-10. The consumable 302-10 is retained in the device 301-10 via an interference fit (although in other embodiments, the device and consumable could be engaged by screwing one onto (or onto) the other, through a bayonet fitting, or by way of a snap engagement mechanism).

The consumable 302-10 includes a tank 327-10. The tank 327-10 defines a reservoir for the storage of an aerosol-former, which in this embodiment, is in the form of e-liquid.

In this present embodiment, the consumable 302-10 is a "single-use" consumable. That is, upon exhausting the e-liquid in the tank 327-10, the intention is that the user disposes of the whole consumable 302-10. In other embodiments, the e-liquid (i.e., aerosol former) may be the only part of the system that is truly "single-use". In such embodiments, the tank may be refillable with e-liquid or the e-liquid may be stored in a non-consumable component of the system. For example, the e-liquid may be stored in a tank located in the device or stored in another component that is itself not single-use (e.g., a refillable cartomizer).

In the illustrated system 300-10, a heater 304-10 is located in the consumable 302-10 and is configured to heat and vaporize the e-liquid (stored in the tank 327-10). Although not shown, the heater 304-10 comprises a porous wick and a resistive heating element. The porous wick conveys e-liquid from the tank 327-10 to the heating element. The heating element is a heating filament that is helically wound around a portion of the porous wick, such that when the heating element is heated (e.g., by the action of electrical current passing through the heating element), heat is transferred from the heating element to the e-liquid conveyed by the wick. This transfer of heat vaporizes the e-liquid and the resultant vapor is entrained in an airflow passing through the consumable 302-10 (i.e., driven by a user drawing on a downstream end 318-10 of the consumable 302-10). Between the vaporization point at the coil and the downstream end 318-10 (i.e., the mouth end), the vapor condenses into an aerosol, and is subsequently inhaled by the user.

Like the previously described embodiment, the device 301-10 comprises a power source in the form of a rechargeable battery (not shown) and a connector in the form of a USB port (not shown). The device 302-10 further comprises controller (also not shown). The rechargeable battery, connector and controller are similar (and operate in a similar manner) to the corresponding components of the embodiment described above with respect to FIG. 35A to FIG. 35E.

The consumable 302-10 includes a pair of heater electrical contacts 328-10 disposed on a device-facing end surface of the consumable 302-10. The heater electrical contacts 328-10 are electrically connected to the heater 304-10 in the consumable 302-10, such that a voltage applied across the heater electrical contacts 302-10 generally corresponds to a voltage applied across the resistive heating element of the heater 304-10.

When the consumable 302-10 is engaged with the device 301-10, the heater electrical contacts 328-10 are brought into electrical contact with corresponding device electrical contacts (not shown) on the device 301-10. The device electrical contacts are electrically connected (directly or indirectly) to the rechargeable battery. The controller may thus be configured to control the voltage applied across the device electrical contacts from the rechargeable battery. By controlling the voltage applied across the device electrical contacts, the voltage applied to the heater 304-10 is correspondingly controlled.

The device 302-10 includes an output means (forming part of the UI of the system 300-10) in the form of a single light-emitting diode ("LED") 311. The LED 311-10 is operatively connected to the controller, such that controller can control the illumination of the LED 311-10. The controller is configured to illuminate the LED when then the heater 304-10 is active.

The device 301-10 also includes an input means in the form of a puff sensor (not shown). The puff sensor is the same as that described above with respect to the embodiment shown in FIG. 36A to FIG. 36E.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilized for realizing the disclosure in diverse forms thereof.

Figure 38A:
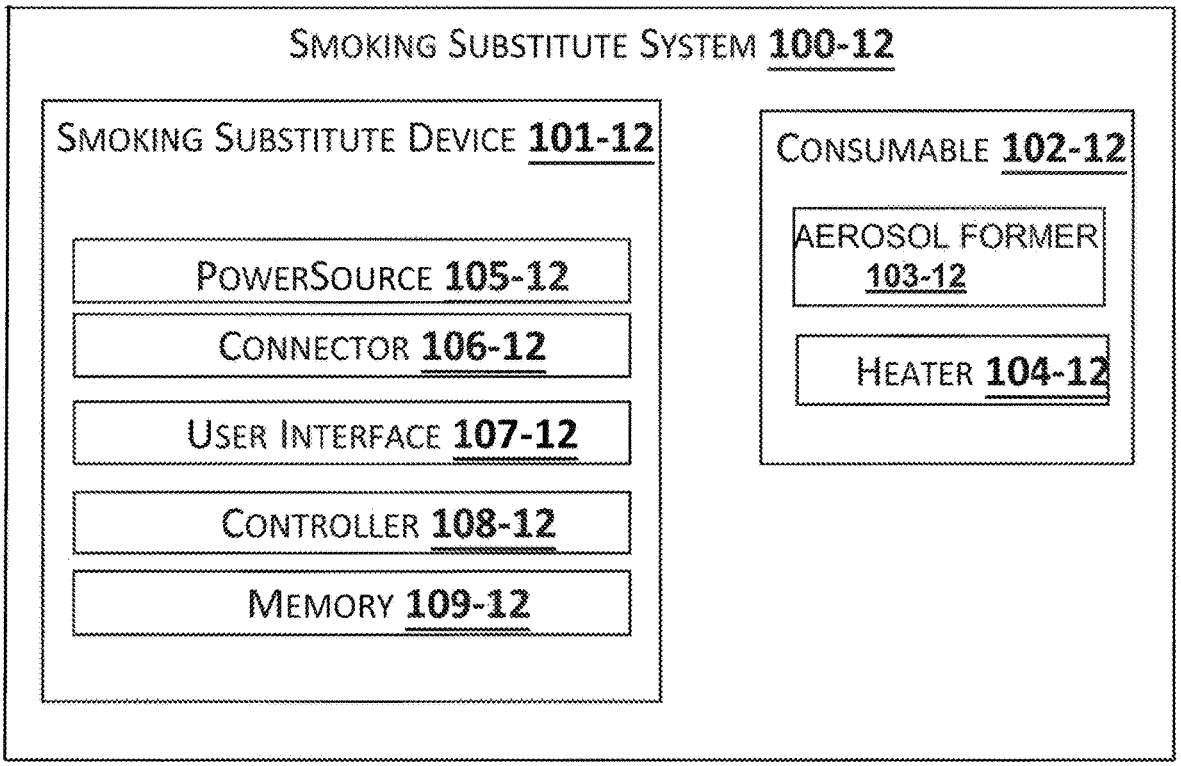
FIG. 38A is a schematic of a smoking substitute system.

Twelfth Mode of the Disclosure FIG. 38A is a schematic providing a general overview of a smoking substitute system 100-11. The system 100-11 includes a substitute smoking device 101-11 and an aerosol-forming article in the form of a consumable 102-11, which comprises an aerosol former 103-11. The system is configured to vaporize the aerosol former by heating the aerosol former 103-11 (so as to form a vapor/aerosol for inhalation by a user).

In the illustrated system, the heater 104-11 forms part of the consumable 102-11 and is configured to heat the aerosol former 103-11. In this variation, the heater 104-11 is electrically connectable to the power source 105-11, for example, when the consumable 102-11 is engaged with the device 101-11. Heat from the heater 104-11 vaporizes the aerosol former 103-11 to produce a vapor. The vapor subsequently condenses to form an aerosol, which is ultimately inhaled by the user.

The system 100-11 further comprises a power source 105-11 that forms part of the device 101-11. In other embodiments the power source 105-11 may be external to (but connectable to) the device 101-11. The power source 105-11 is electrically connectable to the heater 104-11 such that it is able to supply power to the heater 104-11 (i.e., for the purpose of heating the aerosol former 103-11). Thus, control of the electrical connection of the power source 105-11 to the heater 104-11 provides control of the state of the heater 104-11. The power source 105-11 may be a power store, for example a battery or rechargeable battery (e.g., a lithium ion battery).

The system 100-11 further comprises an I/O module comprising a connector 106-11 (e.g., in the form of a USB port, Micro USB port, USB-C port, etc.). The connector 106-11 is configured for connection to an external source of electrical power, e.g., a mains electrical supply outlet. The connector 106-11 may be used in substitution for the power source 105-11. That is the connector 106-11 may be electrically connectable to the heater 104-11 so as to supply electricity to the heater 104-11. In such embodiments, the device may not include a power source, and the power source of the system may instead comprise the connector 106-11 and an external source of electrical power (to which the connector 106-11 provides electrical connection).

In some embodiments, the connector 106-11 may be used to charge and recharge the power source 105-11 where the power source 105-11 includes a rechargeable battery.

The system 100-11 also comprises a user interface (UI) 107. Although not shown, the UI 107-11 may include input means to receive commands from a user. The input means of the UI 107-11 allows the user to control at least one aspect of the operation of the system 100-11. The input means may, for example, be in the form of a button, touchscreen, switch, microphone, motion sensor, etc.

The UI 107-11 also comprises output means to convey information to the user. The output means may, for example, comprise lights (e.g., LEDs), a display screen, speaker, vibration generator, etc.

The system 100-11 further comprises a controller 108-11 that is configured to control at least one function of the device 101-11. In the illustrated embodiment, the controller 108-11 is a component of the device 101-11, but in other embodiments may be separate from (but connectable to) the device 101-11. The controller 108-11 is configured to control the operation of the heater 104-11 and, for example, may be configured to control the voltage applied from the power source 105-11 to the heater 104-11. The controller 108-11 may be configured to toggle the supply of power to the heater 104-11 between an on state, in which the full output voltage of the power source 105-11 is applied to the heater 104-11, and an off state, in which the no voltage is applied to the heater 104-11.

Although not shown, the system 100-11 may also comprise a voltage regulator to regulate the output voltage from the power source 105-11 to form a regulated voltage. The regulated voltage may then be applied to the heater 104-11.

In addition to being connected to the heater 104-11, the controller 108-11 is operatively connected to the UI 107-11. Thus, the controller 108-11 may receive an input signal from the input means of the UI 107-11. Similarly, the controller 108-11 may transmit output signals to the UI 107-11. In response, the output means of the UI 107-11 may convey information, based on the output signals, to a user. The controller also comprises a memory 109-11, which is a non-volatile memory. The memory 109-11 includes instructions, which, when implemented, cause the controller to perform certain tasks or steps of a method.

Figure 38B:
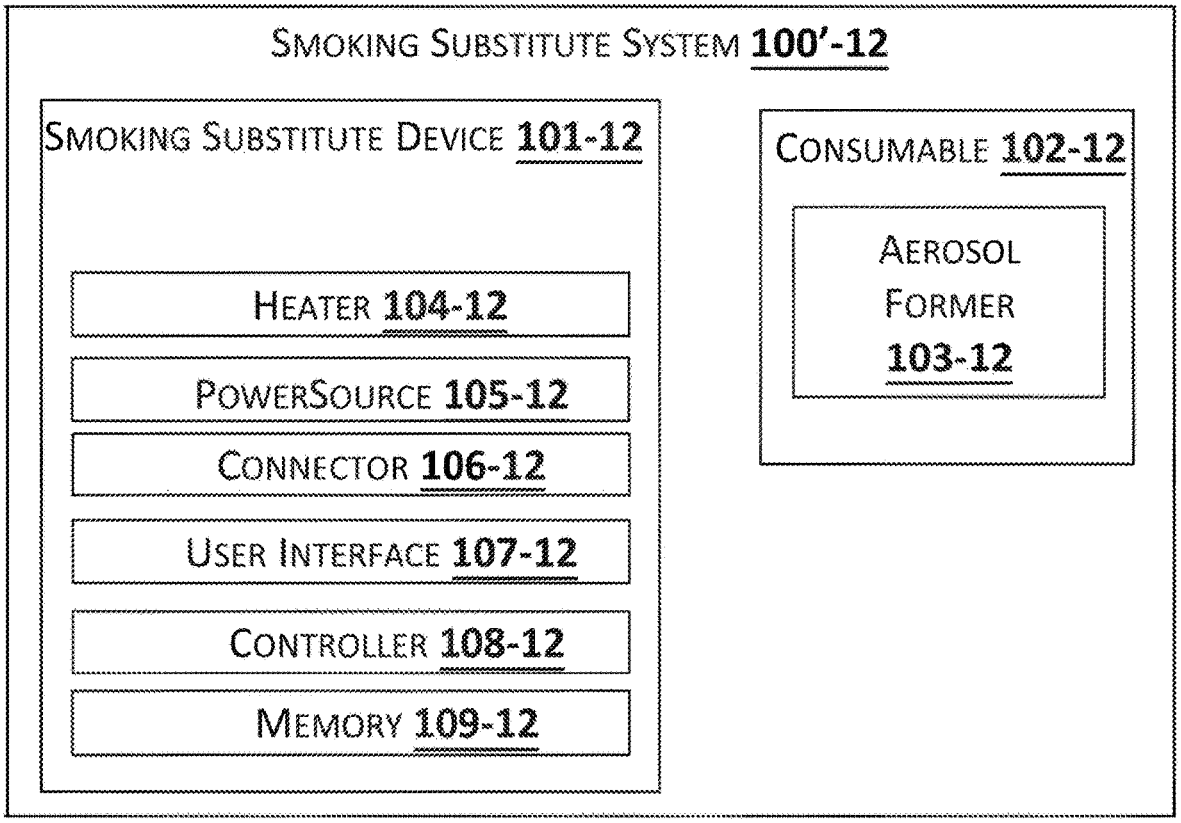
FIG. 38B is a schematic of a variation of the smoking substitute system of FIG. 38A.

FIG. 38B is a schematic showing a variation of the system 100-11 of FIG. 38A. In the system 100-11' of FIG. 38B, the heater 104-11 forms part of the device 101-11, rather than the consumable 102-11. In this variation, the heater 104-11 is electrically connected to the power source 105-11.

Figure 39B:
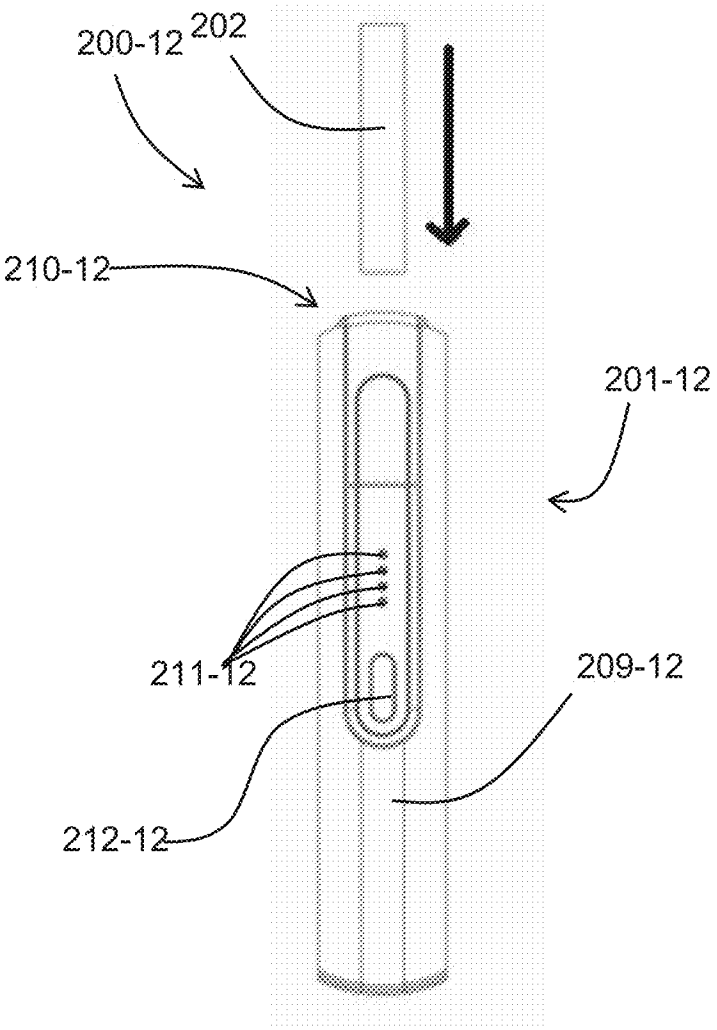
FIG. 39B is a front view of the first embodiment of the smoking substitute system with the consumable disengaged from the device.
Figure 39A:
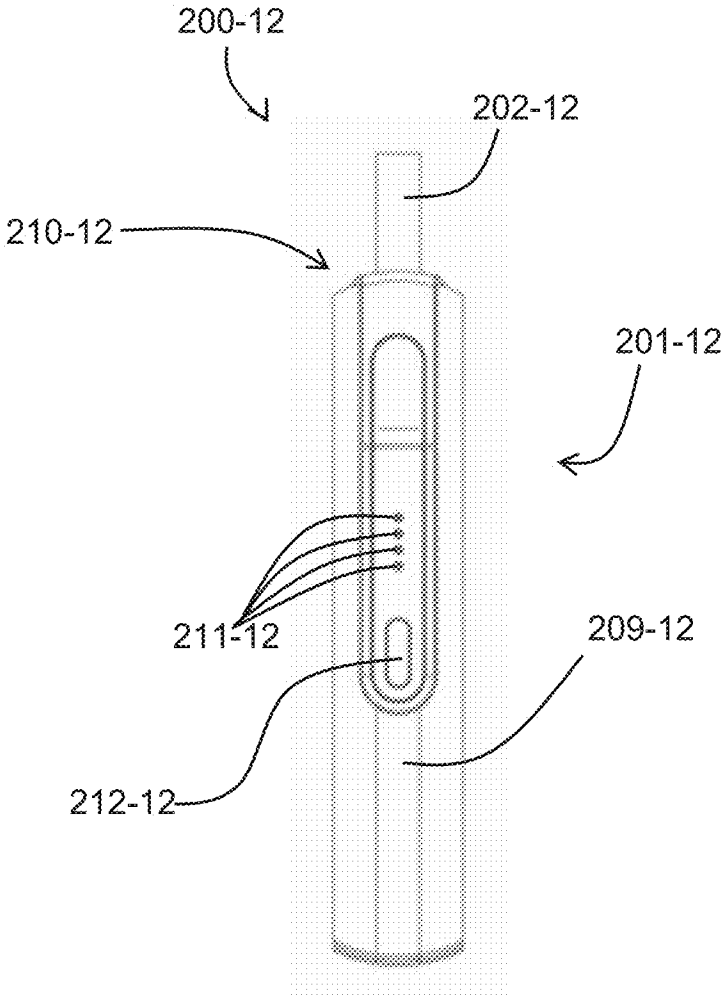
FIG. 39A is a front view of a first embodiment of a twelfth mode of a smoking substitute system with the consumable engaged with the device.

FIG. 39A and FIG. 39B illustrate a heated-tobacco (HT) smoking substitute system 200-11. The system 200-11 is an example of the systems 100-11, 100' described in relation to FIG. 38A or FIG. 38B. System 200-11 includes an HT device 201-11 and an HT consumable 202-11. The description of FIG. 38A and FIG. 38B above is applicable to the system 200-11 of FIG. 39A and FIG. 39B, and will thus not be repeated.

The device 201-11 and the consumable 202-11 are configured such that the consumable 202-11 can be engaged with the device 201-11. FIG. 39A shows the device 201-11 and the consumable 202-11 in an engaged state, whilst FIG. 39B shows the device 201-11 and the consumable 202-11 in a disengaged state.

The device 201-11 comprises a body 209-11 and cap 210-11. In use the cap 210-11 is engaged at an end of the body 209-11. Although not apparent from the figures, the cap 210-11 is moveable relative to the body 209-11. In particular, the cap 210-11 is slideable and can slide along a longitudinal axis of the body 209-11.

The device 201-11 comprises an output means (forming part of the UI of the device 201-11) in the form of a plurality of light-emitting diodes (LEDs) 211 arranged linearly along the longitudinal axis of the device 201-11 and on an outer surface of the body 209-11 of the device 201-11. A button 212-11 is also arranged on an outer surface of the body 209-11 of the device 201-11 and is axially spaced (i.e., along the longitudinal axis) from the plurality of LEDs 211-11.

Figure 39C:
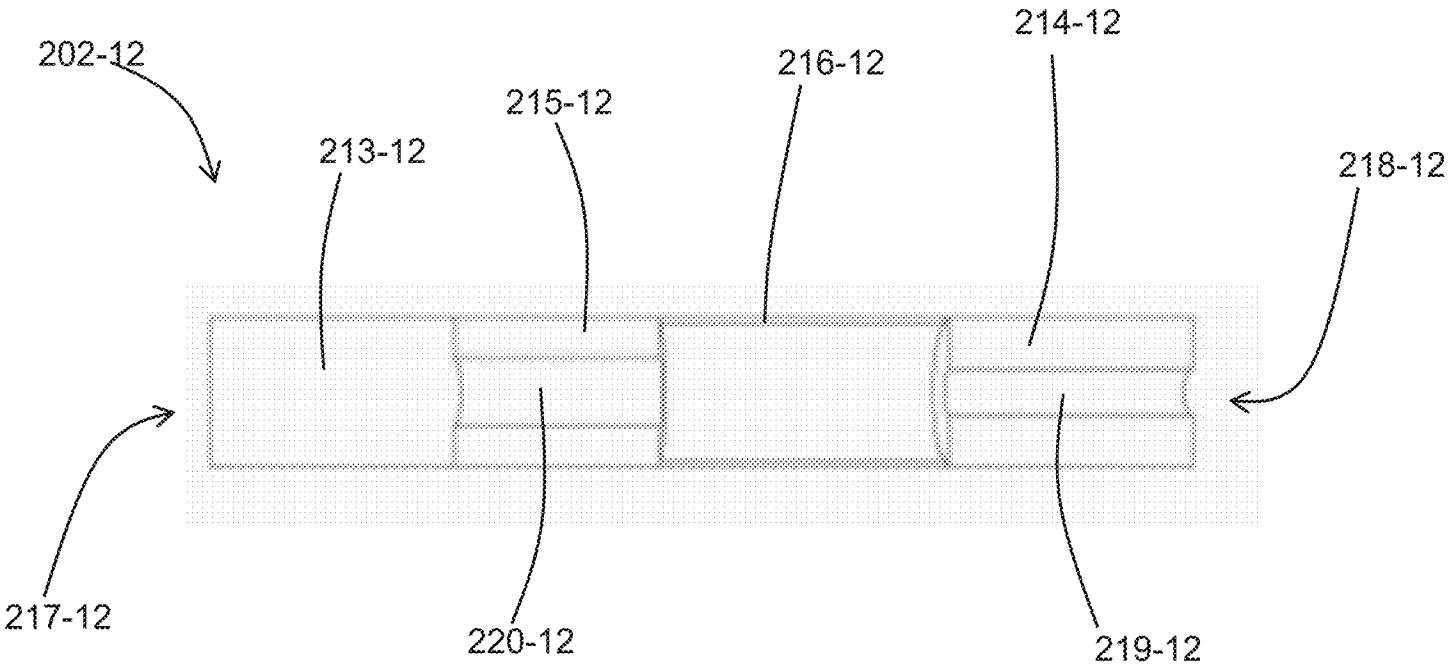
FIG. 39C is a section view of the consumable of the first embodiment of the smoking substitute system.

FIG. 39C show a detailed section view of the consumable of 202 of the system 200-11. The consumable 202-11 generally resembles a cigarette. In that respect, the consumable 202-11 has a generally cylindrical form with a diameter of 7 mm and an axial length of 70 mm. The consumable 202-11 comprises an aerosol forming substrate 213-11, a terminal filter element 214-11, an upstream filter element 215-11 and a spacer element 216-11. In other embodiments, the consumable may further comprise a cooling element. A cooling element may exchange heat with vapor that is formed by the aerosol-forming substrate 213-11 in order to cool the vapor so as to facilitate condensation of the vapor.

The aerosol-forming substrate 213-11 is substantially cylindrical and is located at an upstream end 217-11 of the consumable 202-11, and comprises the aerosol former of the system 200-11. In that respect, the aerosol forming substrate 213-11 is configured to be heated by the device 201-11 to release a vapor. The released vapor is subsequently entrained in an airflow flowing through the aerosol-forming substrate

213-11. The airflow is produced by the action of the user drawing on a downstream 218 (i.e., terminal or mouth) end of the consumable 202-11.

In the present embodiment, the aerosol forming substrate 213-11 comprises tobacco material that may, for example, include any suitable parts of the tobacco plant (e.g., leaves, stems, roots, bark, seeds and flowers). The tobacco may comprise one or more of leaf tobacco, stem tobacco, tobacco powder, tobacco dust, tobacco derivatives, expanded tobacco, homogenized tobacco, shredded tobacco, extruded tobacco, cut rag tobacco and/or reconstituted tobacco (e.g., slurry recon or paper recon). For example, the aerosol-forming substrate 213-11 may comprise a gathered sheet of homogenized (e.g., paper/slurry recon) tobacco or gathered shreds/strips formed from such a sheet.

In order to generate an aerosol, the aerosol forming substrate 213-11 comprises at least one volatile compound that is intended to be vaporized/aerosolized and that may provide the user with a recreational and/or medicinal effect when inhaled. The aerosol-forming substrate 213-11 may further comprise one or more additives. For example, such additives may be in the form of humectants (e.g., propylene glycol and/or vegetable glycerin), flavorants, fillers, aqueous/non-aqueous solvents and/or binders.

The terminal filter element 214-11 is also substantially cylindrical, and is located downstream of the aerosol forming substrate 213-11 at the downstream end 218-11 of the consumable 202-11. The terminal filter element 214-11 is in the form of a hollow bore filter element having a bore 219-11 (e.g., for airflow) formed there through. The diameter of the bore 219-11 is 2 mm. The terminal filter element 214-11 is formed of a porous (e.g., monoacetate) filter material. As set forth above, the downstream end 218-11 of the consumable 202-11 (i.e., where the terminal filter 214-11 is located) forms a mouthpiece portion of the consumable 202-11 upon which the user draws. Airflow is drawn from the upstream end 217-11, thorough the components of the consumable 202-11, and out of the downstream end 218-11. The airflow is driven by the user drawing on the downstream end 218-11 (i.e., the mouthpiece portion) of the consumable 202-11.

The upstream filter element 215-11 is located axially adjacent to the aerosol-forming substrate 213-11, between the aerosol-forming substrate 213-11 and the terminal filter element 214-11. Like the terminal filter 214-11, the upstream filter element 215-11 is in the form of a hollow bore filter element, such that it has a bore 220-11 extending axially there through. In this way, the upstream filter 215-11 may act as an airflow restrictor. The upstream filter element 215-11 is formed of a porous (e.g., monoacetate) filter material. The bore 220-11 of the upstream filter element 215-11 has a larger diameter (3 mm) than the terminal filter element 214-11.

The spacer 216-11 is in the form of a cardboard tube, which defines a cavity or chamber between the upstream filter element 215-11 and the terminal filter element 214-11. The spacer 216-11 acts to allow both cooling and mixing of the vapor/aerosol from the aerosol-forming substrate 213-11. The spacer has an external diameter of 7 mm and an axial length of 14 mm.

Although not apparent from the figure, the aerosol-forming substrate 213-11, upstream filter 215-11 and spacer 216-11 are circumscribed by a paper wrapping layer. The terminal filter 214-11 is circumscribed by a tipping layer that also circumscribes a portion of the paper wrapping layer (so as to connect the terminal filter 214-11 to the remaining components of the consumable 202-11). The upstream filter 215-11 and terminal filter 214-11 are circumscribed by further wrapping layers in the form of plug wraps.

Figure 39E:
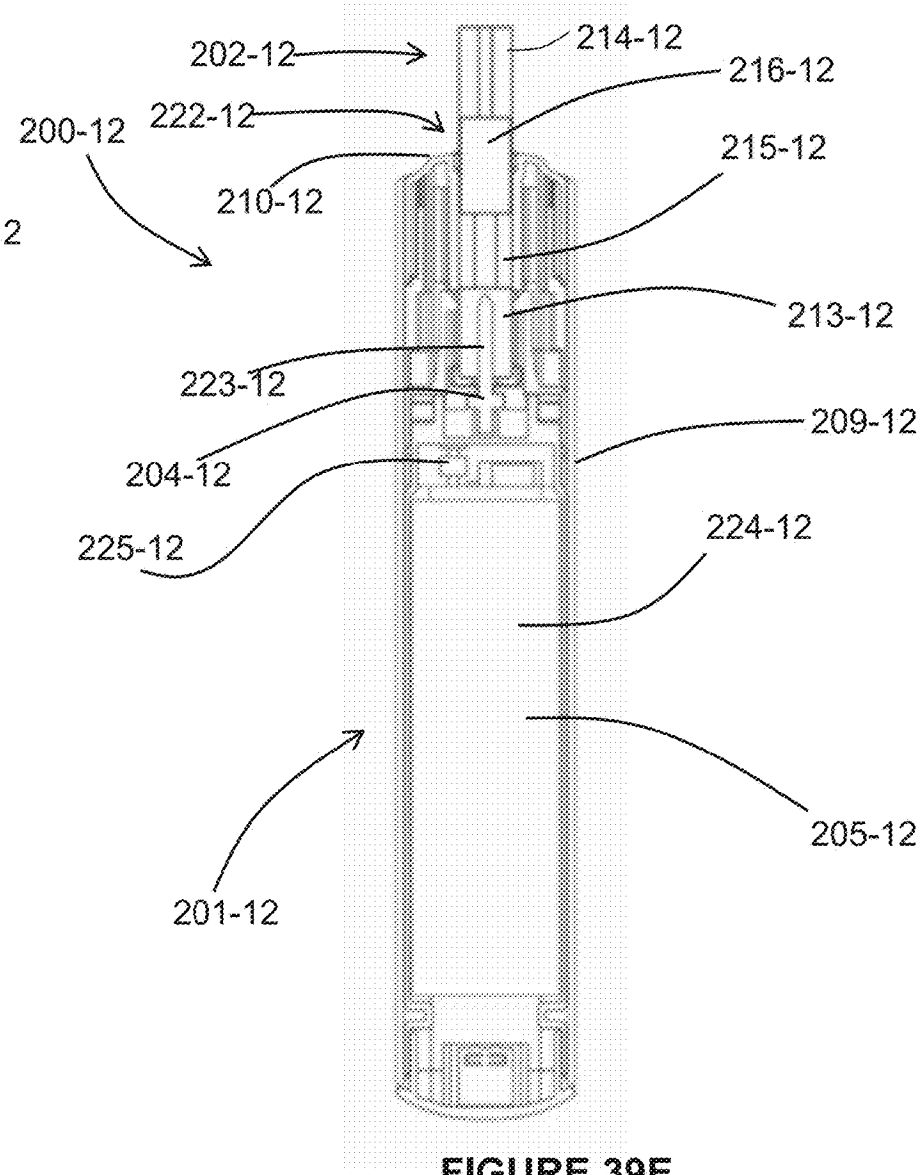
FIG. 39E is a section view of the first embodiment of the substitute smoking system.
Figure 39D:
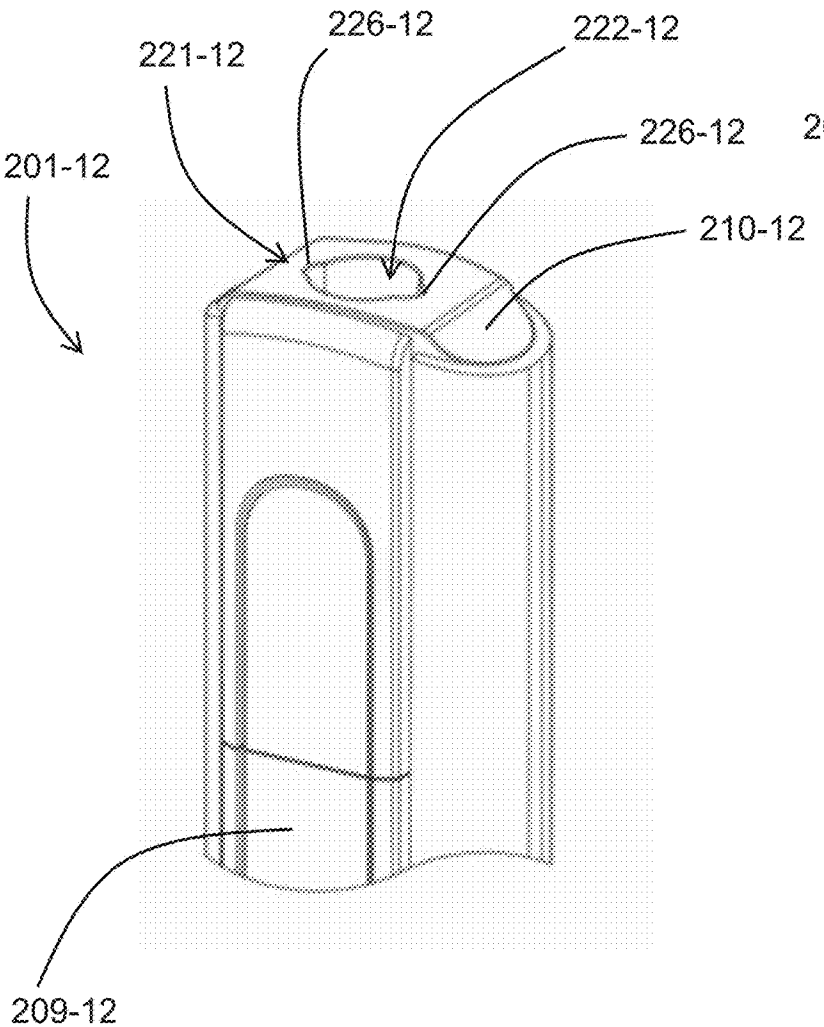
FIG. 39D is a detailed view of an end of the device of the first embodiment of the smoking substitute system.

Returning now to the device 201-11, FIG. 39D illustrates a detailed view of the end of the device 201-11 that is configured to engage with the consumable 202-11. The cap 210-11 of the device 201-11 includes an opening 221-11 to an internal cavity 222-11 (more apparent from FIG. 39D) defined by the cap 210-11. The opening 221-11 and the cavity 222-11 are formed so as to receive at least a portion of the consumable 202-11. During engagement of the consumable 202-11 with the device 201-11, a portion of the consumable 202-11 is received through the opening 221-11 and into the cavity 222-11. After engagement (see FIG. 39B), the downstream end 218-11 of the consumable 202-11 protrudes from the opening 221-11 and thus also protrudes from the device 201-11. The opening 221-11 includes laterally disposed notches 226-11. When a consumable 202-11 is received in the opening 221-11, these notches 226-11 remain open and could, for example, be used for retaining a cover in order to cover the end of the device 201-11.

FIG. 39E shows a cross section through a central longitudinal plane through the device 201-11. The device 201-11 is shown with the consumable 202-11 engaged therewith.

The device 201-11 comprises a heater 204-11 comprising heating element 223-11. The heater 204-11 forms part of the body 209-11 of the device 201-11 and is rigidly mounted to the body 209-11. In the illustrated embodiment, the heater 204-11 is a rod heater with a heating element 223-11 having a circular transverse profile. In other embodiments the heater may be in the form of a blade heater (e.g., heating element with a rectangular transverse profile) or a tube heater (e.g., heating element with a tubular form).

The heating element 223-11 of the heater 204-11 projects from an internal base of the cavity 222-11 along a longitudinal axis towards the opening 221-11. As is apparent from the figure, the length (i.e., along the longitudinal axis) of the heating element is less than a depth of the cavity 222-11. In this way, the heating element 223-11 does not protrude from or extend beyond the opening 221-11.

When the consumable 202-11 is received in the cavity 222-11 (as is shown in FIG. 39E), the heating element 223-11 penetrates the aerosol-forming substrate 213-11 of the consumable 202-11. In particular, the heating element 223-11 extends for nearly the entire axial length of the aerosol-forming substrate 213-11 when inserted therein. Thus, when the heater 204-11 is activated, heat is transferred radially from an outer circumferential surface the heating element 223-11 to the aerosol-forming substrate 213-11.

The device 201-11 further comprises an electronics cavity 224-11. A power source, in the form of a rechargeable battery 205-11 (a lithium ion battery), is located in electronics cavity 224-11.

The device 201-11 includes a connector (i.e., forming part of an IO module of the device 201-11) in the form of a USB port 206-11. The connector may alternatively be, for example, a micro-USB port or a USB-C port for examples. The USB port 206-11 may be used to recharge the rechargeable battery 205-11.

The device 201-11 includes a controller (not shown) located in the electronics cavity 224-11. The controller comprises a microcontroller mounted on a printed circuit board (PCB). The USB port 206-11 is also connected to the controller (i.e., connected to the PCB and microcontroller).

The controller is configured to control at least one function of the device 202-11. For example, the controller is configured to control the operation of the heater 204-11. Such control of the operation of the heater 204-11 may be accomplished by the controller toggling the electrical connection of the rechargeable battery 205-11 to the heater 204-11. For example, the controller is configured to control the heater 204-11 in response to a user depressing the button 212-11. Depressing the button 212-11 may cause the controller to allow a voltage (from the rechargeable battery 205-11) to be applied to the heater 204-11 (so as to cause the heating element 223-11 to be heated).

The controller is also configured to control the LEDs 211-11 in response to (e.g., a detected) a condition of the device 201-11 or the consumable 202-11. For example, the controller may control the LEDs to indicate whether the device 201-11 is in an on state or an off state (e.g., one or more of the LEDs may be illuminated by the controller when the device is in an on state).

The device 201-11 comprises a further input means (i.e., in addition to the button 212-11) in the form of a puff sensor 225-11. The puff sensor 225-11 is configured to detect a user drawing (i.e., inhaling) at the downstream end 218-11 of the consumable 202-11. The puff sensor 225-11 may, for example, be in the form of a pressure sensor, flow meter or a microphone. The puff sensor 225-11 is operatively connected to the controller 208-11 in the electronics cavity 224-11, such that a signal from the puff sensor 225-11, indicative of a puff state (i.e., drawing or not drawing), forms an input to the controller 208-11 (and can thus be responded to by the controller 208-11).

The controller 108-11 is configured to heating the rod heater 204-11 or the heating element 223-11 to a predetermined threshold temperature, as exemplified in FIG. 3. Once the rod heater reaches the predetermined threshold temperature, power supply to the rod heater 204-11 is terminated. If the temperature of the rod heater 204-11 decreases below the threshold temperature, then the controller restart heating the rod heater 204-11 again to attain the predetermined threshold temperature. Alternatively, the controller may heat the heating rod continuously to maintain the temperature of the rod heater 204-11 to a predetermined threshold temperature. The predetermined threshold temperature may also be referred as pre-set temperature or threshold temperature, which is an operating temperature of the rod heater 204-11. In one example, the operating temperature of the rod heater 204-11 is between 250 degrees Celsius and 400 degrees Celsius.

The controller 108-11 provides power supply to heat the rod heater 204-11 to a desired operating temperature. In one aspect, the controller 108-11 supplies a first predetermined amount of power to heat the rod heater 204-11 to achieve the predetermined threshold temperature. The power required to heat the rod heater 204-11 to the predetermined threshold temperature is defined as first power level. Further, the controller 108-11 supplies a second predetermined amount of power to the rod heater 204-11 for maintaining the temperature of the rod heater 204-11 at the same predetermined threshold temperature. The second predetermined amount of power may be defined as second power level. Additionally, if the temperature of the rod heater 204-11 reduces below the predetermined threshold temperature, then, the second power level may be supplied to heat the rod heater 204-11 to maintain the predetermined threshold temperature. The controller is configured to control the first and second power level provided to the heater 204-11 so as to maintain the operating temperature of the heater 204-11.

The controller 108-11 is further configured to supply the first and the second power level by way of pulse width modulation to the heater 204-11. The first power level is supplied with a pulse width modulation having a predetermined duty cycle, which may be referred to as first duty cycle. Accordingly, the controller applies the first duty cycle to heat the rod heater 204-11 to reach the predetermined threshold temperature. The first duty cycle may be for example 60% of the pulse width modulation duty cycle. Further, in order to maintain the temperature of the rod heater 204-11 to the predetermined threshold temperature, a second predetermined duty cycle may be applied, which can be referred to as second duty cycle. The second duty cycle may be for example 30% or 40% of the pulse width modulation duty cycle.

As an example, a first power level is supplied to the heater for first duty cycle, wherein the first duty cycle is 60-70%, to achieve the pre-set temperature resulting in a first output power and no power is supplied to the remaining 30-40% duty cycle so as to maintain the pre-set temperature level. If the operating temperature falls below the pre-set temperature value, then a second power level is supplied to the heater for 40% of second duty cycle to maintain the pre-set temperature.

In this regard, the Controller 108-11 is configured to apply energy with a first duty cycle to heat the rod heater 204-11 to the desired operating temperature and apply energy with a second duty cycle either to maintain the temperature at the operating temperature or to increase the temperature of the heater 204-11 to the reach operating temperature, if there is a dip in the temperature. Optionally, the second duty cycle to maintain the temperature at the threshold level may vary from the second duty cycle required to increase the temperature to the threshold level after detecting the dip.

Controlling the power level implies that the power is supplied corresponding to the amount of the duty cycle. The first duty cycle means that the power is applied using current from a battery (power source) whereby the current is applied corresponding to the percentage of the first duty cycle. For example, applying 60% of the first duty cycle means that current is supplied for the 60% of a given periodic switching and the power is not applied for the remaining 40-11%. Similarly, applying 30-11 or 40% of the second duty cycle means that current is supplied for the 30 or 40% of a given periodic switching and the power is not applied for the remaining 70-11 or 60% respectively.

Figure 40:
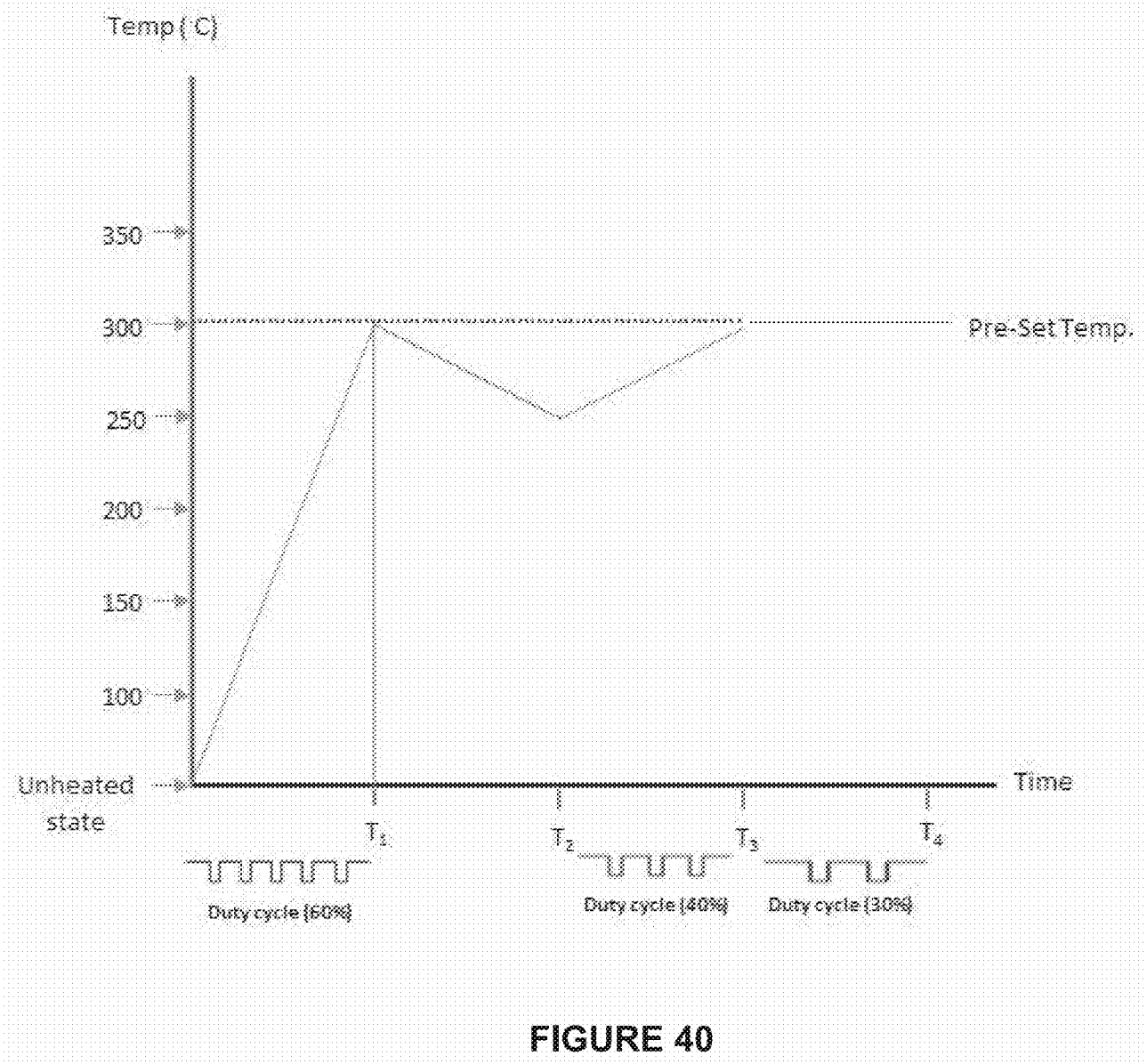
FIG. 40 is a graphical representation illustrating heating functionality of the heat not burn device in accordance with some embodiments of the present disclosure.

FIG. 40 illustrates the functioning of the device though a graphical representation according to an aspect of the present disclosure. Initially, for example T0 (not shown), the temperature of the rod heater 204-11 is in unheated state. For example, the rod heater 204-11 is at ambient temperature. The controller 108-11 supplies the first power level for period of time, according to first duty cycle of the pulse width modulation, from T0 to T1 is for example—60% duty cycle, the temperature rises from zero to a desired temperature (pre-set temperature) for example 300 degree Celsius. For example, if the power is not supplied from T1-T2, then the temperature starts to dip below the threshold temperature. However, after detecting the dip in the temperature, the controller can provide a second power level to heat the rod heater 204-11 to the threshold temperature. The power supplied can be, for example, 40% duty cycle. In T3 the temperature reaches the desired threshold temperature. The controller 108-11 may be configured to maintain the temperature at the threshold level for predetermined period of time, accordingly the controller 108-11 may supply a power level of 30% duty cycle for the predetermined period of time. By this, the controller 108-11 may ensure supply of exact amount of heat required for operating the device during a consumable cycle. Also, this can provide constant heat thought the consumable cycle for ensuring persistent user experience.

The duty cycle required from T2-T3 and T3-T4 can be the same or different depending on the target temperature. Further, the first power level may be greater than the second power level. Accordingly, the first duty cycle may be greater than the second duty cycle.

The device is configured to calibrate the first and second duty cycles. Further, the device is configured to calibrate heating and operating periods so that the correct amount of heat is delivered to the heater 204-11 to arrive at the operating temperature. The correct amount of heat is then delivered to the heater to maintain the heater at the operating temperature. The calibration is such that the temperature of the heater 204-11 does not need to be measured to adjust the time periods and duty cycles, as they can be fixed in the device post-calibration.

The calibration of these values may be performed on a device-by-device (or batch-by-batch) basis at the end of a production line during a calibration routine. The calibration routine may be performed with a consumable engaged with the device so that thermal behavior of the device will match that experienced by an end-user.

Figure 41A:
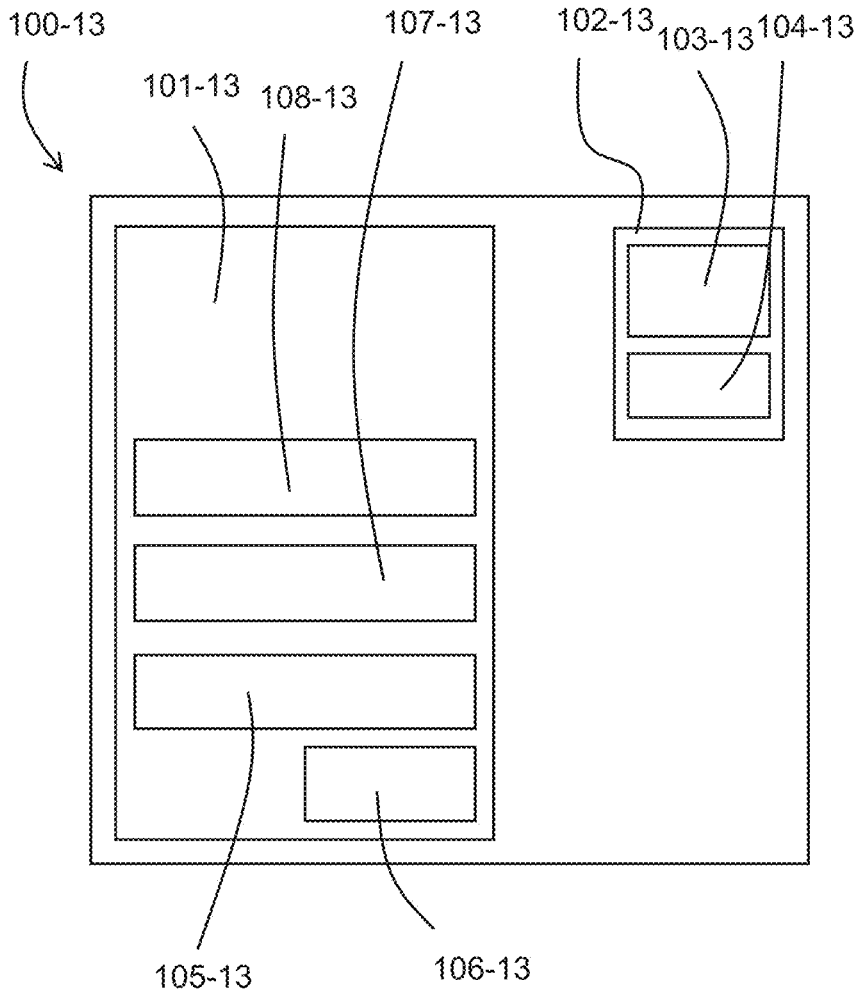
FIG. 41A is a schematic of a smoking substitute system.

Thirteenth Mode of the Disclosure FIG. 41A is a schematic providing a general overview of a smoking substitute system 100-12. The system 100-12 includes a substitute smoking device 101-12 and an aerosol-forming article in the form of a consumable 102-12, which comprises an aerosol former 103-12. The system is configured to vaporize the aerosol former by heating the aerosol former 103-12 (so as to form a vapor/aerosol for inhalation by a user).

In the illustrated system, the heater 104-12 forms part of the consumable 102-12 and is configured to heat the aerosol former 103-12. In this variation, the heater 104-12 is electrically connectable to the power source 105-12, for example, when the consumable 102-12 is engaged with the device 101-12. Heat from the heater 104-12 vaporizes the aerosol former 103-12 to produce a vapor. The vapor subsequently condenses to form an aerosol, which is ultimately inhaled by the user.

The system 100-12 further comprises a power source 105-12 that forms part of the device 101-12. In other embodiments the power source 105-12 may be external to (but connectable to) the device 101-12. The power source 105-12 is electrically connectable to the heater 104-12 such that it is able to supply power to the heater 104-12 (i.e., for the purpose of heating the aerosol former 103-12). Thus, control of the electrical connection of the power source 105-12 to the heater 104-12 provides control of the state of the heater 104-12. The power source 105-12 may be a power store, for example a battery or rechargeable battery (e.g., a lithium ion battery).

The system 100-12 further comprises an I/O module comprising a connector 106-12 (e.g., in the form of a USB port, Micro USB port, USB-C port, etc.). The connector 106-12 is configured for connection to an external source of electrical power, e.g., a mains electrical supply outlet. The connector 106-12 may be used in substitution for the power source 105-12. That is the connector 106-12 may be electrically connectable to the heater 104-12 so as to supply electricity to the heater 104-12. In such embodiments, the device may not include a power source, and the power source of the system may instead comprise the connector 106-12 and an external source of electrical power (to which the connector 106-12 provides electrical connection).

In some embodiments, the connector 106-12 may be used to charge and recharge the power source 105-12 where the power source 105-12 includes a rechargeable battery.

The system 100-12 also comprises a user interface (UI) 107. Although not shown, the UI 107-12 may include input means to receive commands from a user. The input means of the UI 107-12 allows the user to control at least one aspect of the operation of the system 100-12. The input means may, for example, be in the form of a button, touchscreen, switch, microphone, etc.

The UI 107-12 also comprises output means to convey information to the user. The output means may, for example, comprise lights (e.g., LEDs), a display screen, speaker, vibration generator, etc.

The system 100-12 further comprises a controller 108-12 that is configured to control at least one function of the device 101-12. In the illustrated embodiment, the controller 108-12 is a component of the device 101-12, but in other embodiments may be separate from (but connectable to) the device 101-12. The controller 108-12 is configured to control the operation of the heater 104-12 and, for example, may be configured to control the voltage applied from the power source 105-12 to the heater 104-12. The controller 108-12 may be configured to toggle the supply of power to the heater 104-12 between an on state, in which the full output voltage of the power source 105-12 is applied to the heater 104-12, and an off state, in which the no voltage is applied to the heater 104-12.

Although not shown, the system 100-12 may also comprise a voltage regulator to regulate the output voltage from the power source 105-12 to form a regulated voltage. The regulated voltage may then be applied to the heater 104-12.

In addition to being connected to the heater 104-12, the controller 108-12 is operatively connected to the UI 107-12. Thus, the controller 108-12 may receive an input signal from the input means of the UI 107-12. Similarly, the controller 108-12 may transmit output signals to the UI 107-12. In response, the output means of the UI 107-12 may convey information, based on the output signals, to a user. The controller also comprises a memory 109-12, which is a non-volatile memory. The memory 109-12 includes instructions, which, when implemented, cause the controller to perform certain tasks or steps of a method.

Figure 41B:
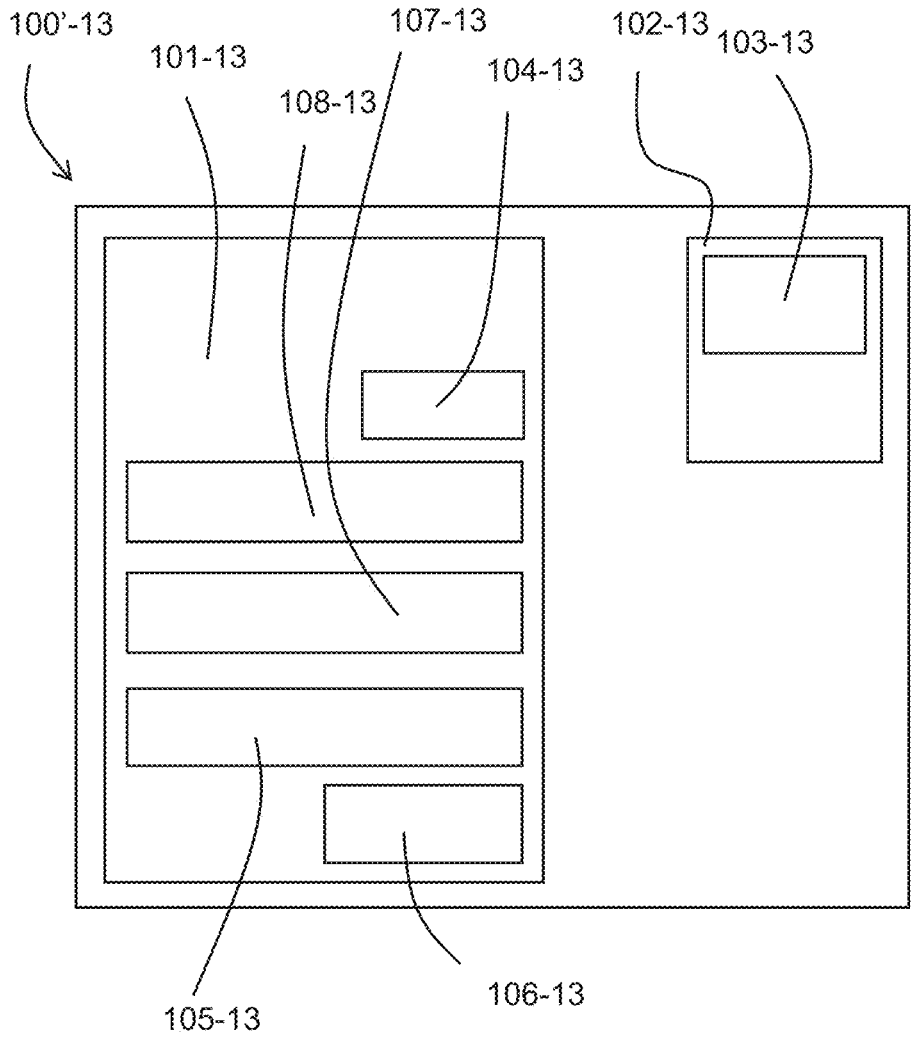
FIG. 41B is a schematic of a variation of the smoking substitute system of FIG. 41A.

FIG. 41B is a schematic showing a variation of the system 100-12 of FIG. 41A. In the system 100-12' of FIG. 41B, the heater 104-12 forms part of the device 101-12, rather than the consumable 102-12. In this variation, the heater 104-12 is electrically connected to the power source 105-12.

Figure 42A:
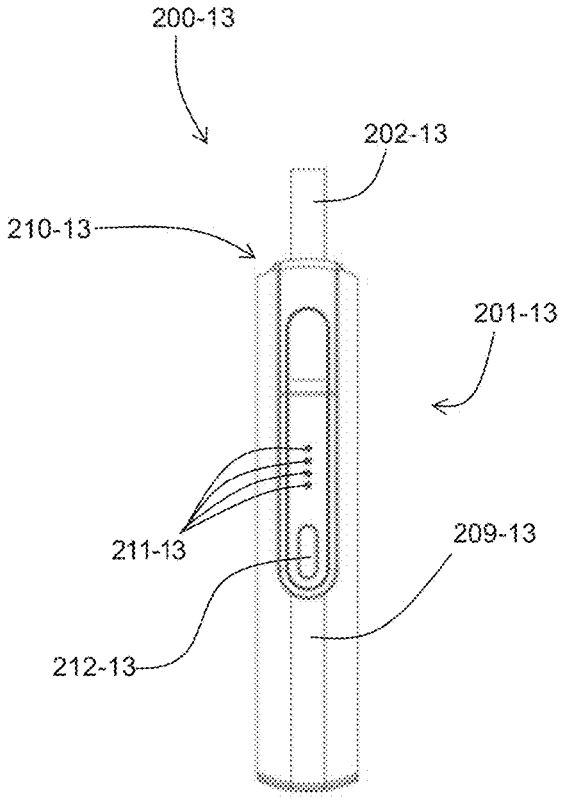
FIG. 42A is a front view of a first embodiment of a thirteenth mode of a smoking substitute system with the consumable engaged with the device.
Figure 42B:
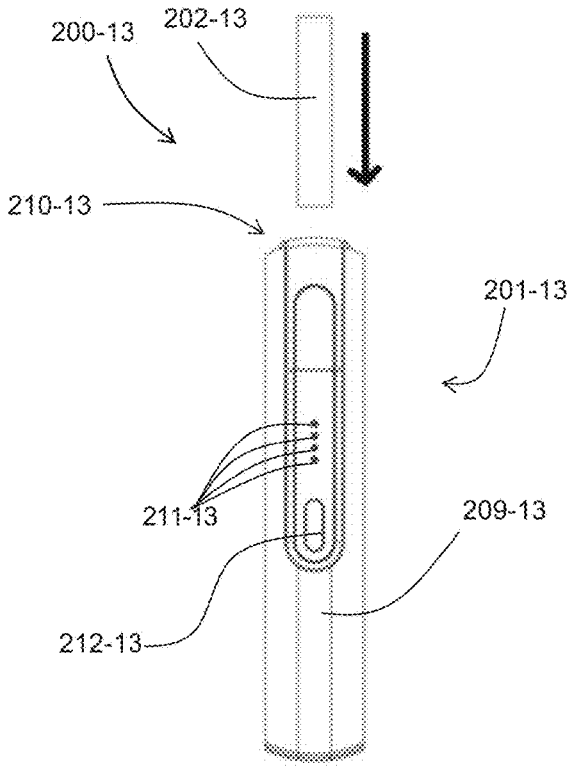
FIG. 42B is a front view of the first embodiment of the smoking substitute system with the consumable disengaged from the device.

FIG. 42A and FIG. 42B illustrate a heated-tobacco (HT) smoking substitute system 200-12. The system 200-12 is an example of the systems 100-12, 100' described in relation to FIG. 41A or FIG. 41B. System 200-12 includes an HT device 201-12 and an HT consumable 202-12. The description of FIG. 41A and FIG. 41B above is applicable to the system 200-12 of FIG. 42A and FIG. 42B, and will thus not be repeated.

The device 201-12 and the consumable 202-12 are configured such that the consumable 202-12 can be engaged with the device 201-12. FIG. 42A shows the device 201-12 and the consumable 202-12 in an engaged state, whilst FIG. 42B shows the device 201-12 and the consumable 202-12 in a disengaged state.

The device 201-12 comprises a body 209-12 and cap 210-12. In use the cap 210-12 is engaged at an end of the body 209-12. Although not apparent from the figures, the cap 210-12 is moveable relative to the body 209-12. In particular, the cap 210-12 is slideable and can slide along a longitudinal axis of the body 209-12.

The device 201-12 comprises an output means (forming part of the UI of the device 201-12) in the form of a plurality of light-emitting diodes (LEDs) 211 arranged linearly along the longitudinal axis of the device 201-12 and on an outer surface of the body 209-12 of the device 201-12. A button 212-12 is also arranged on an outer surface of the body 209-12 of the device 201-12 and is axially spaced (i.e., along the longitudinal axis) from the plurality of LEDs 211-12.

Figure 42C:
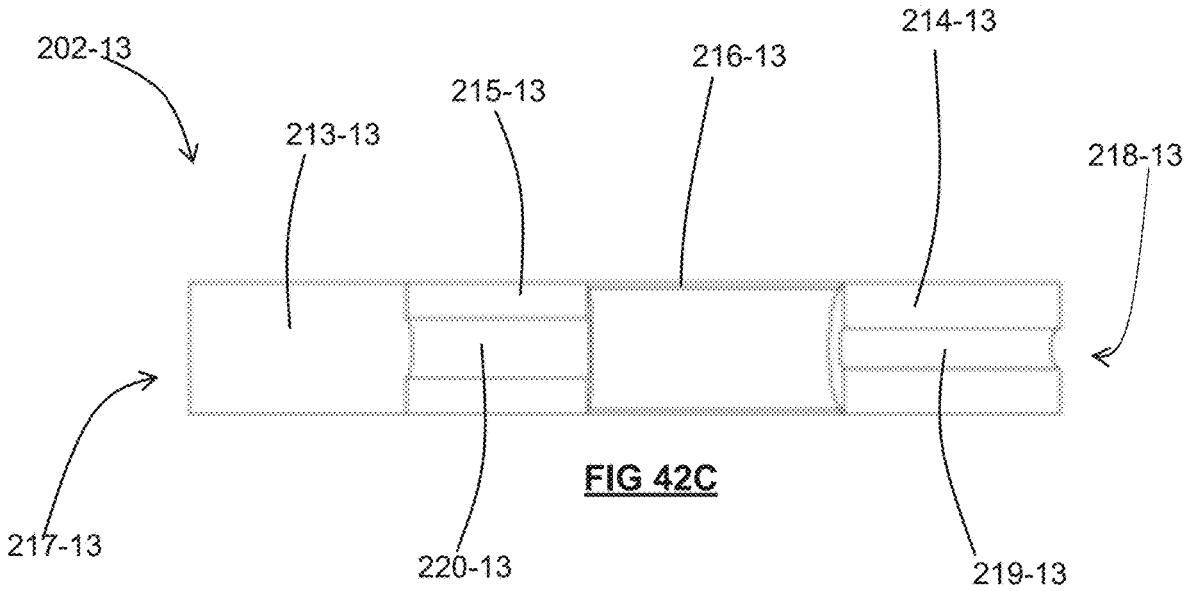
FIG. 42C is a section view of the consumable of the first embodiment of the smoking substitute system.

FIG. 42C show a detailed section view of the consumable of 202 of the system 200-12. The consumable 202-12 generally resembles a cigarette. In that respect, the consumable 202-12 has a generally cylindrical form with a diameter of 7 mm and an axial length of 70 mm. The consumable 202-12 comprises an aerosol forming substrate 213-12, a terminal filter element 214-12, an upstream filter element 215-12 and a spacer element 216-12. In other embodiments, the consumable may further comprise a cooling element. A cooling element may exchange heat with vapor that is formed by the aerosol-forming substrate 213-12 in order to cool the vapor so as to facilitate condensation of the vapor.

The aerosol-forming substrate 213-12 is substantially cylindrical and is located at an upstream end 217-12 of the consumable 202-12, and comprises the aerosol former of the system 200-12. In that respect, the aerosol forming substrate 213-12 is configured to be heated by the device 201-12 to release a vapor. The released vapor is subsequently entrained in an airflow flowing through the aerosol-forming substrate 213-12. The airflow is produced by the action of the user drawing on a downstream 218 (i.e., terminal or mouth) end of the consumable 202-12.

In the present embodiment, the aerosol forming substrate 213-12 comprises tobacco material that may, for example, include any suitable parts of the tobacco plant (e.g., leaves, stems, roots, bark, seeds and flowers). The tobacco may comprise one or more of leaf tobacco, stem tobacco, tobacco powder, tobacco dust, tobacco derivatives, expanded tobacco, homogenized tobacco, shredded tobacco, extruded tobacco, cut rag tobacco and/or reconstituted tobacco (e.g., slurry recon or paper recon). For example, the aerosol-forming substrate 213-12 may comprise a gathered sheet of homogenized (e.g. paper/slurry recon) tobacco or gathered shreds/strips formed from such a sheet.

In order to generate an aerosol, the aerosol forming substrate 213-12 comprises at least one volatile compound that is intended to be vaporized/aerosolized and that may provide the user with a recreational and/or medicinal effect when inhaled. The aerosol-forming substrate 213-12 may further comprise one or more additives. For example, such additives may be in the form of humectants (e.g., propylene glycol and/or vegetable glycerin), flavorants, fillers, aqueous/non-aqueous solvents and/or binders.

The terminal filter element 214-12 is also substantially cylindrical and is located downstream of the aerosol forming substrate 213-12 at the downstream end 218-12 of the consumable 202-12. The terminal filter element 214-12 is in the form of a hollow bore filter element having a bore 219-12 (e.g., for airflow) formed there through. The diameter of the bore 219-12 is 2 mm. The terminal filter element 214-12 is formed of a porous (e.g., monoacetate) filter material. As set forth above, the downstream end 218-12 of the consumable 202-12 (i.e., where the terminal filter 214-12 is located) forms a mouthpiece portion of the consumable 202-12 upon which the user draws. Airflow is drawn from the upstream end 217-12, thorough the components of the consumable 202-12, and out of the downstream end 218-12. The airflow is driven by the user drawing on the downstream end 218-12 (i.e., the mouthpiece portion) of the consumable 202-12.

The upstream filter element 215-12 is located axially adjacent to the aerosol-forming substrate 213-12, between the aerosol-forming substrate 213-12 and the terminal filter element 214-12. Like the terminal filter 214-12, the upstream filter element 215-12 is in the form of a hollow bore filter element, such that it has a bore 220-12 extending axially there through. In this way, the upstream filter 215-12 may act as an airflow restrictor. The upstream filter element 215-12 is formed of a porous (e.g., monoacetate) filter material. The bore 220-12 of the upstream filter element 215-12 has a larger diameter (3 mm) than the terminal filter element 214-12.

The spacer 216-12 is in the form of a cardboard tube, which defines a cavity or chamber between the upstream filter element 215-12 and the terminal filter element 214-12. The spacer 216-12 acts to allow both cooling and mixing of the vapor/aerosol from the aerosol-forming substrate 213-12. The spacer has an external diameter of 7 mm and an axial length of 14 mm.

Although not apparent from the figure, the aerosol-forming substrate 213-12, upstream filter 215-12 and spacer 216-12 are circumscribed by a paper wrapping layer. The terminal filter 214-12 is circumscribed by a tipping layer that also circumscribes a portion of the paper wrapping layer (so as to connect the terminal filter 214-12 to the remaining components of the consumable 202-12). The upstream filter 215-12 and terminal filter 214-12 are circumscribed by further wrapping layers in the form of plug wraps.

Figure 42D:
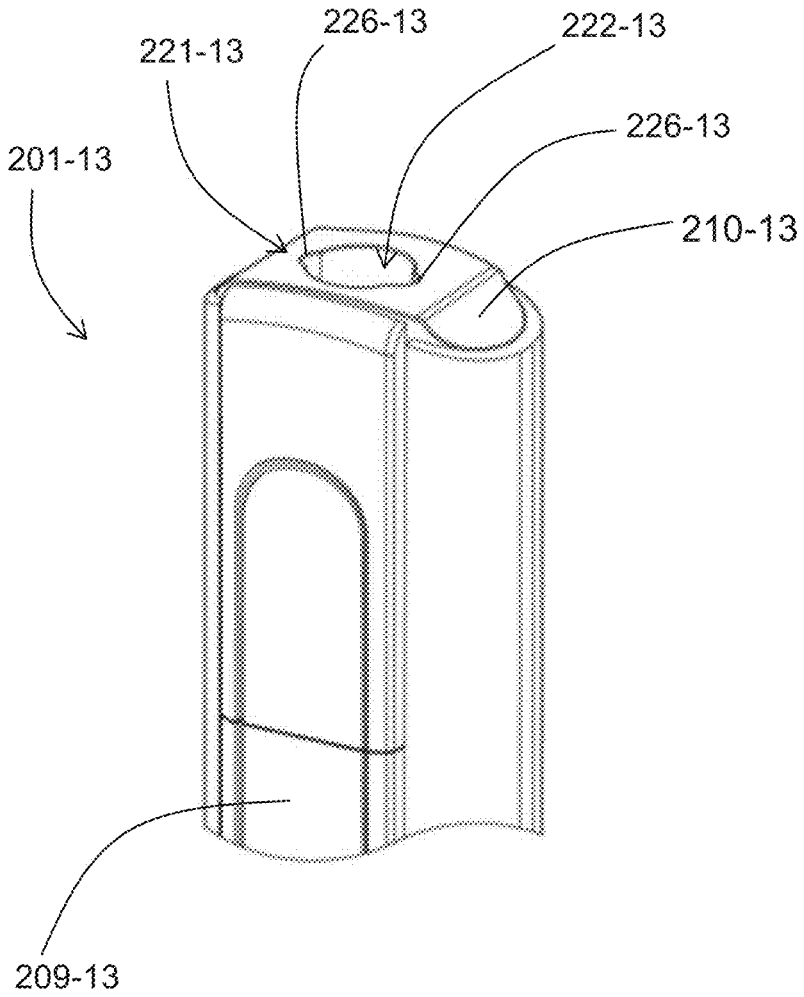
FIG. 42D is a detailed view of an end of the device of the first embodiment of the smoking substitute system.

Returning now to the device 201-12, FIG. 42D illustrates a detailed view of the end of the device 201-12 that is configured to engage with the consumable 202-12. The cap 210-12 of the device 201-12 includes an opening 221-12 to an internal cavity 222-12 (more apparent from FIG. 42D) defined by the cap 210-12. The opening 221-12 and the cavity 222-12 are formed so as to receive at least a portion of the consumable 202-12. During engagement of the consumable 202-12 with the device 201-12, a portion of the consumable 202-12 is received through the opening 221-12 and into the cavity 222-12. After engagement (see FIG. 42B), the downstream end 218-12 of the consumable 202-12 protrudes from the opening 221-12 and thus also protrudes from the device 201-12. The opening 221-12 includes laterally disposed notches 226-12. When a consumable 202-12 is received in the opening 221-12, these notches 226-12 remain open and could, for example, be used for retaining a cover in order to cover the end of the device 201-12.

Figure 42E:
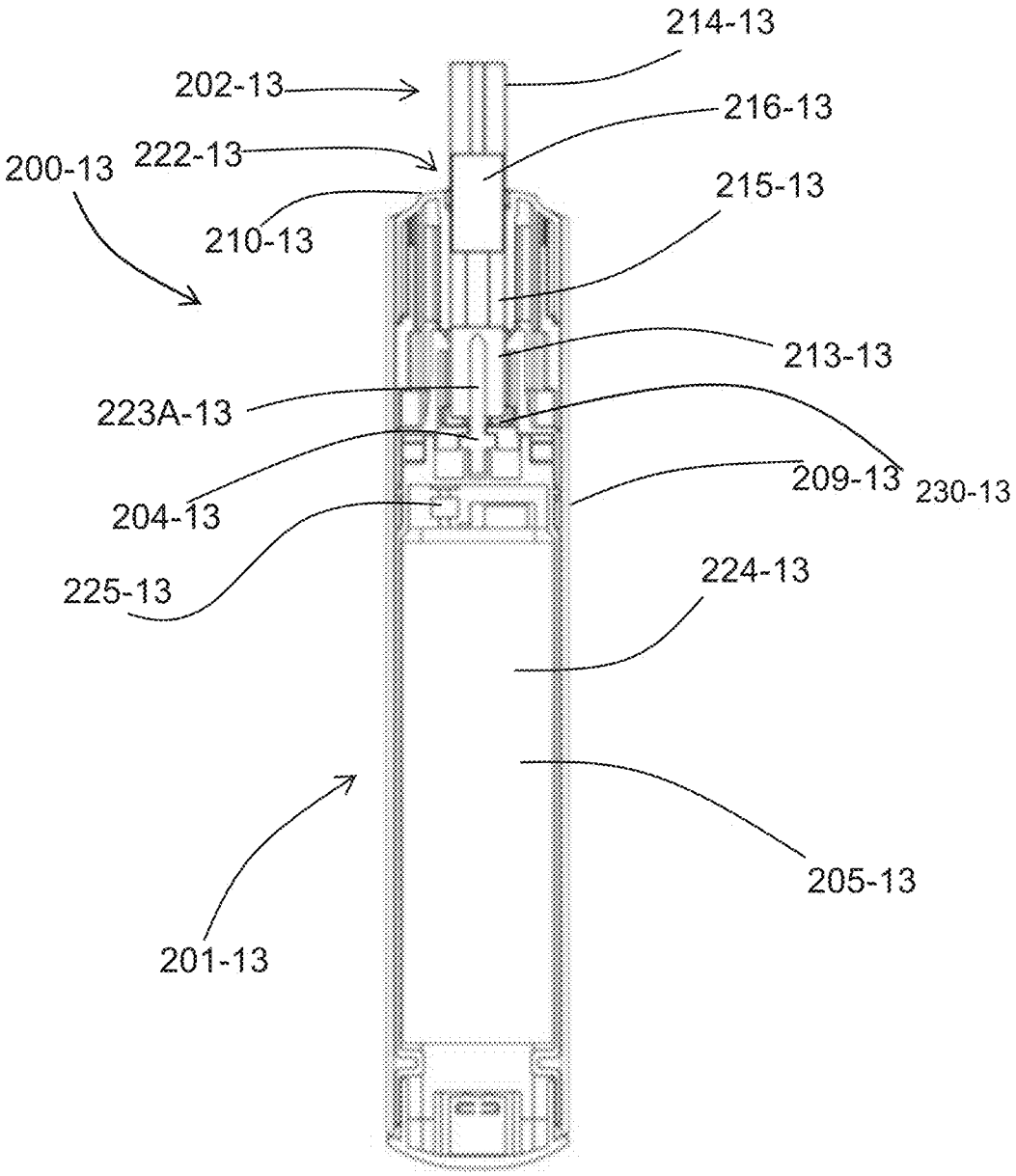
FIG. 42E is a section view of the first embodiment of the substitute smoking system.

FIG. 42E shows a cross section through a central longitudinal plane through the device 201-12. The device 201-12 is shown with the consumable 202-12 engaged therewith.

The device 201-12 comprises a heater 204-12 comprising heating element 223-12. The heater 204-12 forms part of the body 209-12 of the device 201-12 and is rigidly mounted to the body 209-12. In the illustrated embodiment, the heater 204-12 is a rod heater with a heating element 223-12 having a circular transverse profile. In other embodiments the heater may be in the form of a blade heater (e.g., heating element with a rectangular transverse profile) or a tube heater (e.g., heating element with a tubular form).

The heating element 223-12 of the heater 204-12 projects from an internal base of the cavity 222-12 along a longitudinal axis towards the opening 221-12. As is apparent from the figure, the length (i.e., along the longitudinal axis) of the heating element is less than a depth of the cavity 222-12. In this way, the heating element 223-12 does not protrude from or extend beyond the opening 221-12.

When the consumable 202-12 is received in the cavity 222-12 (as is shown in FIG. 42E), the heating element 223-12 penetrates the aerosol-forming substrate 213-12 of the consumable 202-12. In particular, the heating element 223-12 extends for nearly the entire axial length of the aerosol-forming substrate 213-12 when inserted therein. Thus, when the heater 204-12 is activated, heat is transferred radially from an outer circumferential surface the heating element 223-12 to the aerosol-forming substrate 213-12.

Figure 43:
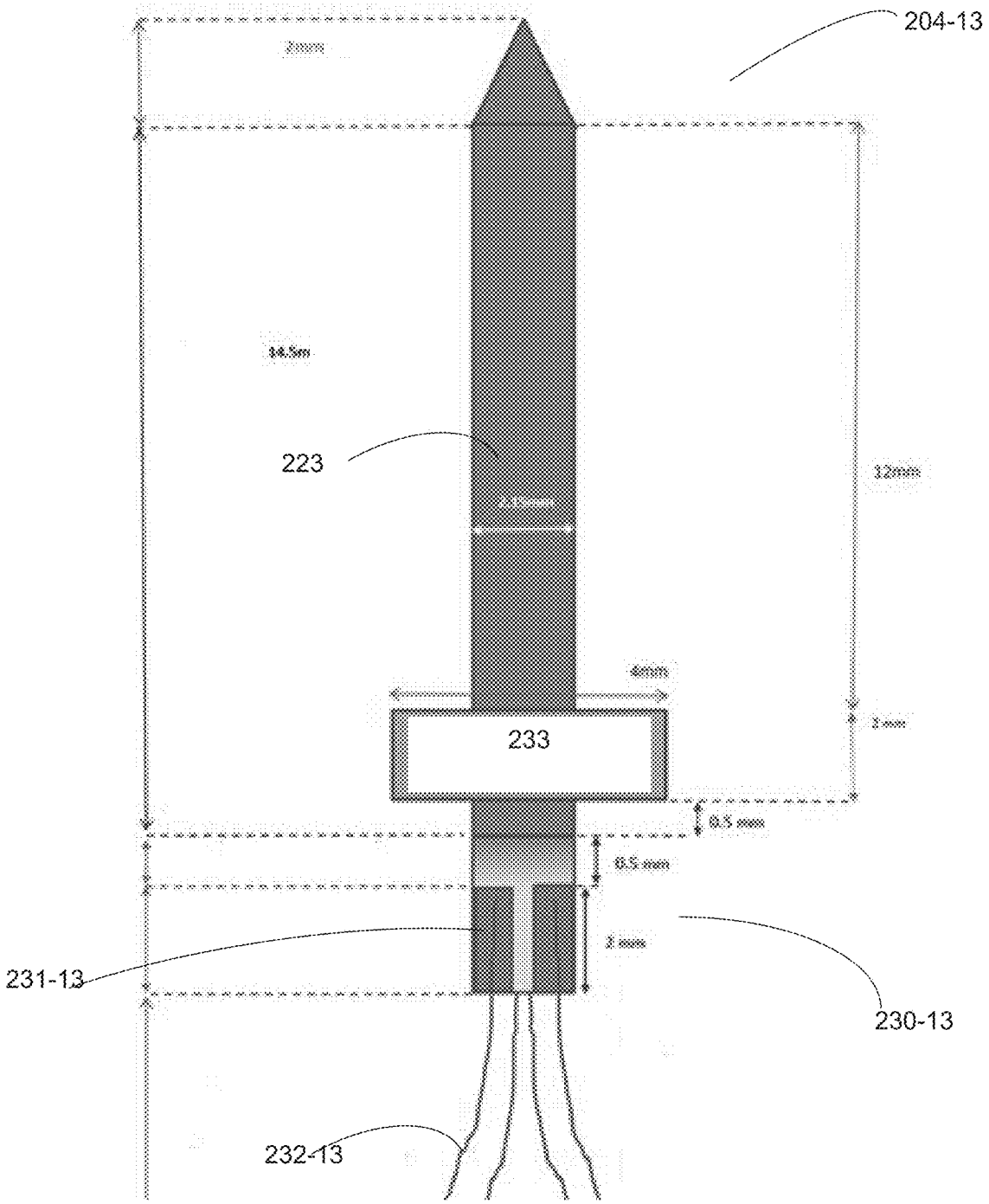
FIG. 43 illustrates a perspective view of the heater of the heat not burn device in accordance with an embodiment of the substitute smoking system.

In an embodiment, as shown in FIG. 43, the heating element 223-12 of the heater 204-12 has a substantially longitudinal configuration. The longitudinal heating element 223-12 includes a resistive heating track formed thereon. The heating track may be configured with a power source of the device 201-12 to supply heat to the aerosol forming substrate 213-12 of the consumable 202-12. The heating element 223-12 has a proximal end and a distal end. The heater 204-12 is mounted to the device 201-12 in the vicinity of the internal base of the cavity 222-12 at the proximal end. The heating track may be connected to the power source at a contact location 230-12 formed at the proximal end of the heating element 223-12 through connecting means.

10 The contact location 230-12 comprises connection means such as, but not limited to, connecting pads 231-12 connected to the power source through electrical wires 232-12. In a non-limiting embodiment, the connection zone extends up to a length of 2 mm of the heating element 223-12 from the base. The heating element 223-12 further includes a tapered tip or a conical tip for penetrating the consumable 202-12 when received in the cavity 222-12. The tapered tip 223B-12 is located at the distal end of the heating element 223-12. The heating element 223-12 is formed from a heater material having a first thermal conductivity. In one aspect, the heating element has a width of 2.15 mm.

The heater 204-12 further includes a mount 233-12 that surrounds at least a portion of the heating element 223-12 and the heating track in the vicinity of the proximal end of the heating element 223-12. The mount 233-12 is formed from a mount material having a second thermal conductivity, with the second thermal conductivity being at least 3 times lower than the first thermal conductivity. In a preferred embodiment, the second thermal conductivity is 6 times lower than the first thermal conductivity. In a more preferred embodiment, the second thermal conductivity is 10 times lower than the first thermal conductivity. The heater material may be alumina and the mount material may be zirconia. Zirconia material used can be 10 times less heat conductive than Alumina, thereby more heat is imparted and kept in the region where it is needed with less losses in heat. This in turn leads to more efficient heating and lower power consumption. Generally, the region where heat is needed the most is a portion defined along a length of the heating element 223-12 between the mount 233-12 and the conical tip. In a non-limiting embodiment, the said portion is 12 mm in length and the conical tip has a height of 2 mm. The resistivity of the heating track is substantially uniform along the said portion of the longitudinal heating element 223-12 and the tip.

In a non-limiting embodiment, the mount 233-12 extends longitudinally along the heating element 223-12 by a distance between 1 and 4 mm. In a preferred embodiment, a buffer region of 0.5 mm to 1 mm may be defined between the connection zone and the mount 233-12. The mount 233-12 may have a width more than the width of the heating element 223-12. In a preferred embodiment, the mount 233-12 has a width of 4 mm and a length of 2 mm along a longitudinal axis of the heating element 223-12. In one aspect, the mount 233-12 comprises a passage through which the heating element 223-12 extends such that the contact location 230-12 is on an opposite side of the mount 233-12 with respect to the heating portion of the heater 204-12.

In a preferred embodiment, the mount 233-12 is connected to the device. The mount 233-12 may be bonded to the device 201-12 through mechanical means.

Detailed description: Power source of HT device The device 201-12 further comprises an electronics cavity 224-12. A power source, in the form of a rechargeable battery 205-12 (a lithium ion battery), is located in electronics cavity 224-12.

The device 201-12 includes a connector (i.e., forming part of an IO module of the device 201-12) in the form of a USB port 206-12. The connector may alternatively be, for example, a micro-USB port or a USB-C port for examples. The USB port 206-12 may be used to recharge the rechargeable battery 205-12.

The device 201-12 includes a controller (not shown) located in the electronics cavity 224-12. The controller comprises a microcontroller mounted on a printed circuit board (PCB). The USB port 206-12 is also connected to the controller 208-12 (i.e., connected to the PCB and microcontroller).

The controller 208-12 is configured to control at least one function of the device 202-12. For example, the controller 208-12 is configured to control the operation of the heater 204-12. Such control of the operation of the heater 204-12 may be accomplished by the controller toggling the electrical connection of the rechargeable battery 205-12 to the heater 204-12. For example, the controller 208-12 is configured to control the heater 204-12 in response to a user depressing the button 212-12. Depressing the button 212-12 may cause the controller to allow a voltage (from the rechargeable battery 205-12) to be applied to the heater 204-12 (so as to cause the heating element 223-12 to be heated).

The controller is also configured to control the LEDs 211-12 in response to (e.g., a detected) a condition of the device 201-12 or the consumable 202-12. For example, the controller may control the LEDs to indicate whether the device 201-12 is in an on state or an off state (e.g., one or more of the LEDs may be illuminated by the controller when the device is in an on state).

The device 201-12 comprises a further input means (i.e., in addition to the button 212-12) in the form of a puff sensor 225-12. The puff sensor 225-12 is configured to detect a user drawing (i.e., inhaling) at the downstream end 218-12 of the consumable 202-12. The puff sensor 225-12 may, for example, be in the form of a pressure sensor, flow meter or a microphone. The puff sensor 225-12 is operatively connected to the controller 208-12 in the electronics cavity 224-12, such that a signal from the puff sensor 225-12, indicative of a puff state (i.e., drawing or not drawing), forms an input to the controller 208-12 (and can thus be responded to by the controller 208-12).

Figure 44A:
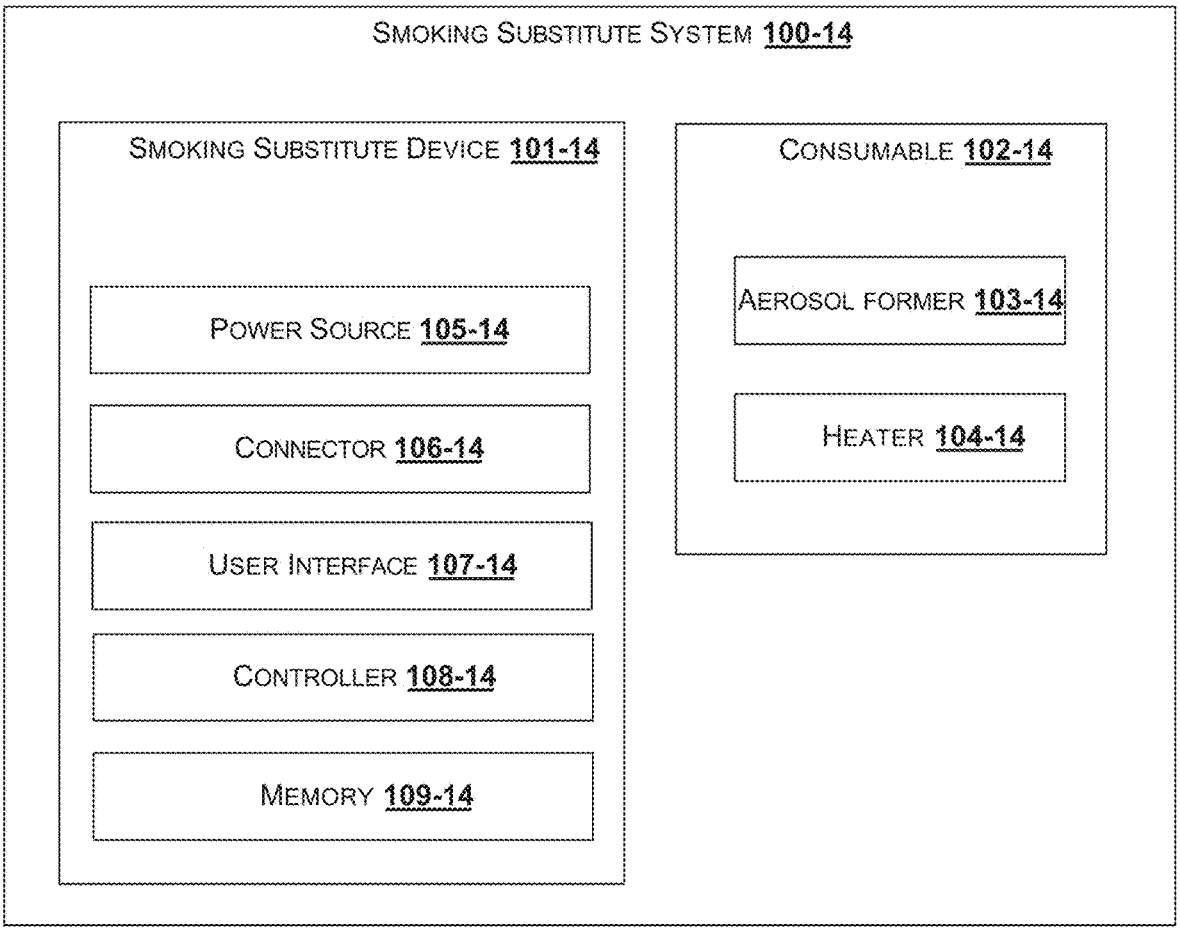
FIG. 44A is a schematic of a smoking substitute system.

Fourteenth Mode of the Disclosure FIG. 44A is a schematic providing a general overview of a smoking substitute system 100-13. The system 100-13 includes a substitute smoking device 101-13 and an aerosol-forming article in the form of a consumable 102-13, which comprises an aerosol former 103-13. The system is configured to vaporize the aerosol former by heating the aerosol former 103-13 (so as to form a vapor/aerosol for inhalation by a user).

In the illustrated system, the heater 104-13 forms part of the consumable 102-13 and is configured to heat the aerosol former 103-13. In this variation, the heater 104-13 is electrically connectable to the power source 105-13, for example, when the consumable 102-13 is engaged with the device 101-13. Heat from the heater 104-13 vaporizes the aerosol former 103-13 to produce a vapor. The vapor subsequently condenses to form an aerosol, which is ultimately inhaled by the user.

The system 100-13 further comprises a power source 105-13 that forms part of the device 101-13. In other embodiments the power source 105-13 may be external to (but connectable to) the device 101-13. The power source 105-13 is electrically connectable to the heater 104-13 such that it is able to supply power to the heater 104-13 (i.e., for the purpose of heating the aerosol former 103-13). Thus, control of the electrical connection of the power source 105-13 to the heater 104-13 provides control of the state of the heater 104-13. The power source 105-13 may be a power store, for example a battery or rechargeable battery (e.g., a lithium ion battery).

The system 100-13 further comprises an I/O module comprising a connector 106-13 (e.g., in the form of a USB port, Micro USB port, USB-C port, etc.). The connector 106-13 is configured for connection to an external source of electrical power, e.g., a mains electrical supply outlet. The connector 106-13 may be used in substitution for the power source 105-13. That is the connector 106-13 may be electrically connectable to the heater 104-13 so as to supply electricity to the heater 104-13. In such embodiments, the device may not include a power source, and the power source of the system may instead comprise the connector 106-13 and an external source of electrical power (to which the connector 106-13 provides electrical connection).

In some embodiments, the connector 106-13 may be used to charge and recharge the power source 105-13 where the power source 105-13 includes a rechargeable battery.

The system 100-13 also comprises a user interface (UI) 107. Although not shown, the UI 107-13 may include input means to receive commands from a user. The input means of the UI 107-13 allows the user to control at least one aspect of the operation of the system 100-13. The input means may, for example, be in the form of a button, touchscreen, switch, microphone, motion sensor, etc.

The UI 107-13 also comprises output means to convey information to the user. The output means may, for example, comprise lights (e.g., LEDs), a display screen, speaker, vibration generator, etc.

The system 100-13 further comprises a controller 108-13 that is configured to control at least one function of the device 101-13. In the illustrated embodiment, the controller 108-13 is a component of the device 101-13, but in other embodiments may be separate from (but connectable to) the device 101-13. The controller 108-13 is configured to control the operation of the heater 104-13 and, for example, may be configured to control the voltage applied from the power source 105-13 to the heater 104-13. The controller 108-13 may be configured to toggle the supply of power to the heater 104-13 between an on state, in which the full output voltage of the power source 105-13 is applied to the heater 104-13, and an off state, in which the no voltage is applied to the heater 104-13.

Although not shown, the system 100-13 may also comprise a voltage regulator to regulate the output voltage from the power source 105-13 to form a regulated voltage. The regulated voltage may then be applied to the heater 104-13.

In addition to being connected to the heater 104-13, the controller 108-13 is operatively connected to the UI 107-13. Thus, the controller 108-13 may receive an input signal from the input means of the UI 107-13. Similarly, the controller 108-13 may transmit output signals to the UI 107-13. In response, the output means of the UI 107-13 may convey information, based on the output signals, to a user. The controller also comprises a memory 109-13, which is a non-volatile memory. The memory 109-13 includes instructions, which, when implemented, cause the controller to perform certain tasks or steps of a method.

Figure 44B:
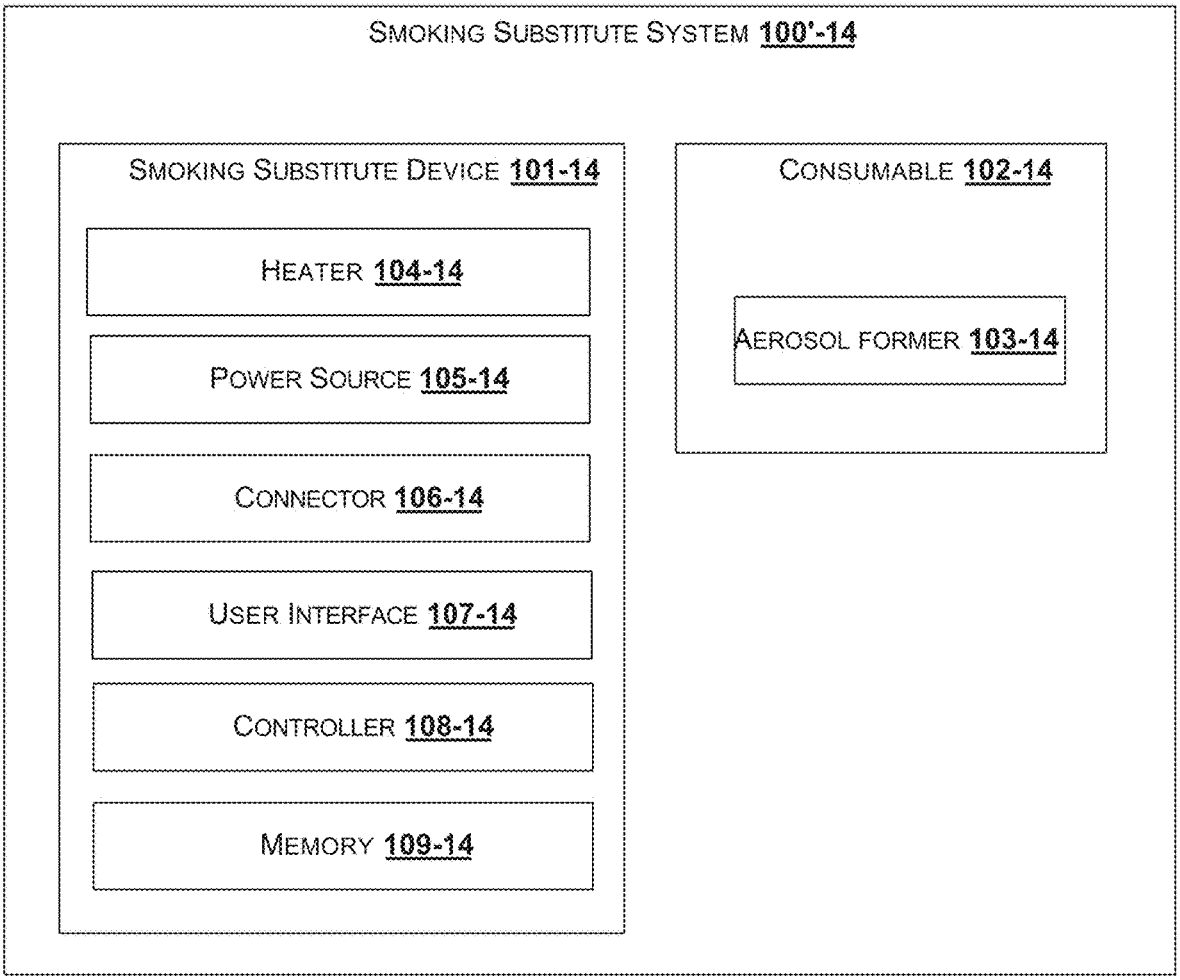
FIG. 44B is a schematic of a variation of the smoking substitute system of FIG. 44A.

FIG. 44B is a schematic showing a variation of the system 100-13 of FIG. 44A. In the system 100-13' of FIG. 44B, the heater 104-13 forms part of the device 101-13, rather than the consumable 102-13. In this variation, the heater 104-13 is electrically connected to the power source 105-13.

Figure 45A:
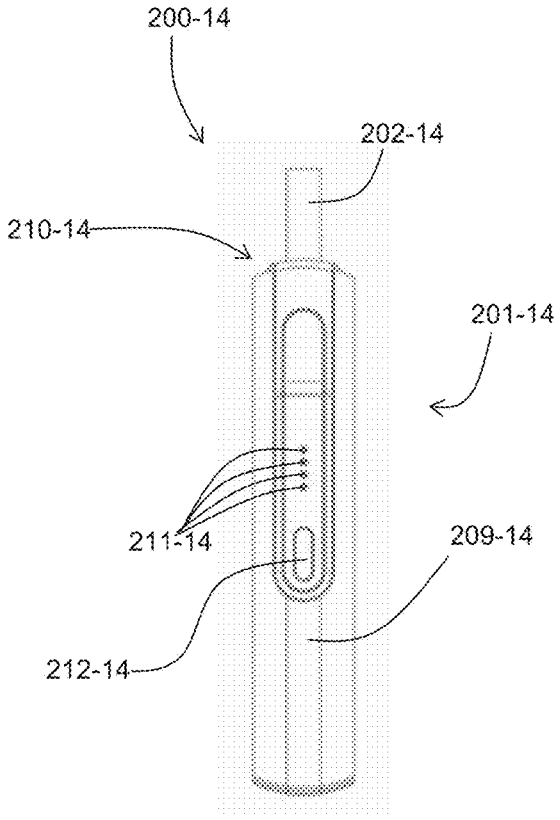
FIG. 45A is a front view of a first embodiment of a fourteenth mode of a smoking substitute system with the consumable engaged with the device.
Figure 45B:
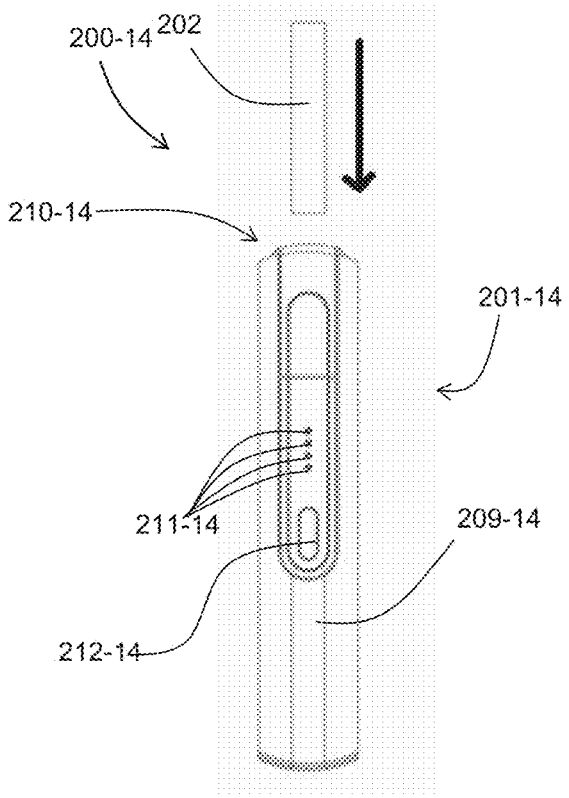
FIG. 45B is a front view of the first embodiment of the smoking substitute system with the consumable disengaged from the device.

FIG. 45A and FIG. 45B illustrate a heated-tobacco (HT) smoking substitute system 200-13. The system 200-13 is an example of the systems 100-13, 100' described in relation to FIG. 44A or FIG. 44B. System 200-13 includes an HT device 201-13 and an HT consumable 202-13. The description of FIG. 44A and FIG. 44B above is applicable to the system 200-13 of FIG. 45A and FIG. 45B, and will thus not be repeated.

The device 201-13 and the consumable 202-13 are configured such that the consumable 202-13 can be engaged with the device 201-13. FIG. 45A shows the device 201-13 and the consumable 202-13 in an engaged state, whilst FIG. 45B shows the device 201-13 and the consumable 202-13 in a disengaged state.

The device 201-13 comprises a body 209-13 and cap 210-13. In use the cap 210-13 is engaged at an end of the body 209-13. Although not apparent from the figures, the cap 210-13 is moveable relative to the body 209-13. In particular, the cap 210-13 is slideable and can slide along a longitudinal axis of the body 209-13.

The device 201-13 comprises an output means (forming part of the UI of the device 201-13) in the form of a plurality of light-emitting diodes (LEDs) 211 arranged linearly along the longitudinal axis of the device 201-13 and on an outer surface of the body 209-13 of the device 201-13. A button 212-13 is also arranged on an outer surface of the body 209-13 of the device 201-13 and is axially spaced (i.e., along the longitudinal axis) from the plurality of LEDs 211-13.

Figure 45C:
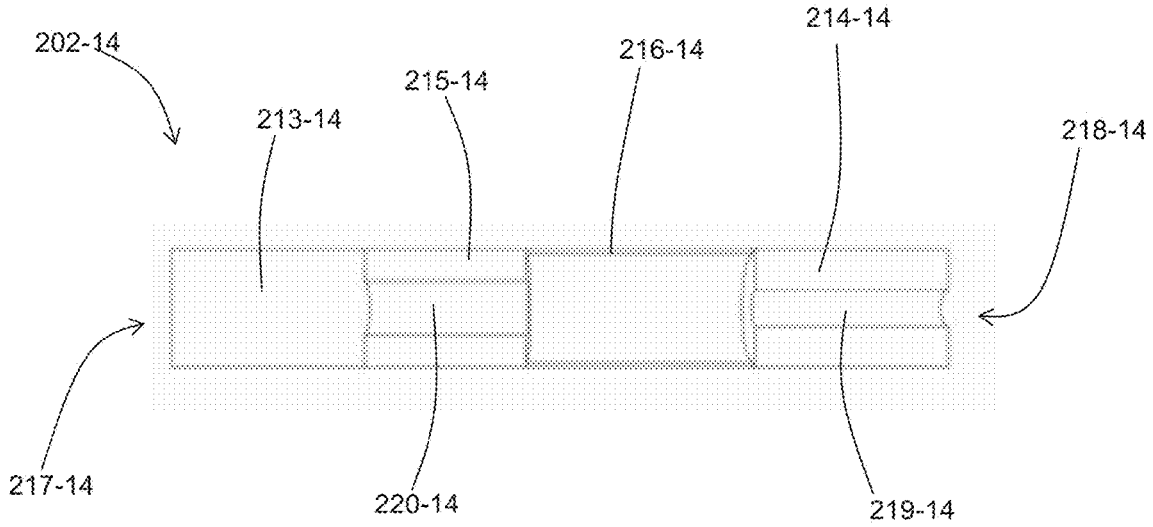
FIG. 45C is a section view of the consumable of the first embodiment of the smoking substitute system.

FIG. 45C show a detailed section view of the consumable of 202 of the system 200-13. The consumable 202-13 generally resembles a cigarette. In that respect, the consumable 202-13 has a generally cylindrical form with a diameter of 7 mm and an axial length of 70 mm. The consumable 202-13 comprises an aerosol forming substrate 213-13, a terminal filter element 214-13, an upstream filter element 215-13 and a spacer element 216-13. In other embodiments, the consumable may further comprise a cooling element. A cooling element may exchange heat with vapor that is formed by the aerosol-forming substrate 213-13 in order to cool the vapor so as to facilitate condensation of the vapor.

The aerosol-forming substrate 213-13 is substantially cylindrical and is located at an upstream end 217-13 of the consumable 202-13, and comprises the aerosol former of the system 200-13. In that respect, the aerosol forming substrate 213-13 is configured to be heated by the device 201-13 to release a vapor. The released vapor is subsequently entrained in an airflow flowing through the aerosol-forming substrate 213-13. The airflow is produced by the action of the user drawing on a downstream 218 (i.e., terminal or mouth) end of the consumable 202-13.

In the present embodiment, the aerosol forming substrate 213-13 comprises tobacco material that may, for example, include any suitable parts of the tobacco plant (e.g., leaves, stems, roots, bark, seeds and flowers). The tobacco may comprise one or more of leaf tobacco, stem tobacco, tobacco powder, tobacco dust, tobacco derivatives, expanded tobacco, homogenized tobacco, shredded tobacco, extruded tobacco, cut rag tobacco and/or reconstituted tobacco (e.g., slurry recon or paper recon). For example, the aerosol-forming substrate 213-13 may comprise a gathered sheet of homogenized (e.g. paper/slurry recon) tobacco or gathered shreds/strips formed from such a sheet.

In order to generate an aerosol, the aerosol forming substrate 213-13 comprises at least one volatile compound that is intended to be vaporized/aerosolized and that may provide the user with a recreational and/or medicinal effect when inhaled. The aerosol-forming substrate 213-13 may further comprise one or more additives. For example, such additives may be in the form of humectants (e.g., propylene glycol and/or vegetable glycerin), flavorants, fillers, aqueous/non-aqueous solvents and/or binders.

The terminal filter element 214-13 is also substantially cylindrical, and is located downstream of the aerosol forming substrate 213-13 at the downstream end 218-13 of the consumable 202-13. The terminal filter element 214-13 is in the form of a hollow bore filter element having a bore 219-13 (e.g., for airflow) formed there through. The diameter of the bore 219-13 is 2 mm. The terminal filter element 214-13 is formed of a porous (e.g., monoacetate) filter material. As set forth above, the downstream end 218-13 of the consumable 202-13 (i.e., where the terminal filter 214-13 is located) forms a mouthpiece portion of the consumable 202-13 upon which the user draws. Airflow is drawn from the upstream end 217-13, thorough the components of the consumable 202-13, and out of the downstream end 218-13. The airflow is driven by the user drawing on the downstream end 218-13 (i.e., the mouthpiece portion) of the consumable 202-13.

The upstream filter element 215-13 is located axially adjacent to the aerosol-forming substrate 213-13, between the aerosol-forming substrate 213-13 and the terminal filter element 214-13. Like the terminal filter 214-13, the upstream filter element 215-13 is in the form of a hollow bore filter element, such that it has a bore 220-13 extending axially there through. In this way, the upstream filter 215-13 may act as an airflow restrictor. The upstream filter element 215-13 is formed of a porous (e.g., monoacetate) filter material. The bore 220-13 of the upstream filter element 215-13 has a larger diameter (3 mm) than the terminal filter element 214-13.

The spacer 216-13 is in the form of a cardboard tube, which defines a cavity or chamber between the upstream filter element 215-13 and the terminal filter element 214-13. The spacer 216-13 acts to allow both cooling and mixing of the vapor/aerosol from the aerosol-forming substrate 213-13. The spacer has an external diameter of 7 mm and an axial length of 14 mm.

Although not apparent from the figure, the aerosol-forming substrate 213-13, upstream filter 215-13 and spacer 216-13 are circumscribed by a paper wrapping layer. The terminal filter 214-13 is circumscribed by a tipping layer that also circumscribes a portion of the paper wrapping layer (so as to connect the terminal filter 214-13 to the remaining components of the consumable 202-13). The upstream filter 215-13 and terminal filter 214-13 are circumscribed by further wrapping layers in the form of plug wraps.

Figure 45D:
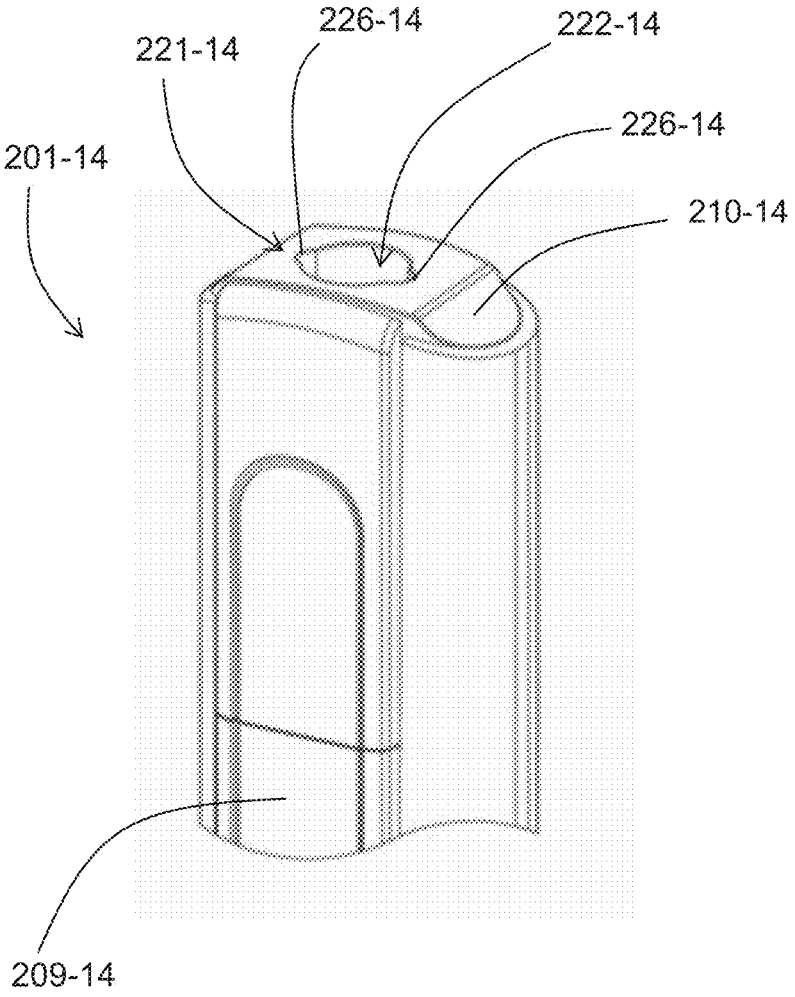
FIG. 45D is a detailed view of an end of the device of the first embodiment of the smoking substitute system.

Returning now to the device 201-13, FIG. 45D illustrates a detailed view of the end of the device 201-13 that is configured to engage with the consumable 202-13. The cap 210-13 of the device 201-13 includes an opening 221-13 to an internal cavity 222-13 (more apparent from FIG. 45D) defined by the cap 210-13. The opening 221-13 and the cavity 222-13 are formed so as to receive at least a portion of the consumable 202-13. During engagement of the consumable 202-13 with the device 201-13, a portion of the consumable 202-13 is received through the opening 221-13 and into the cavity 222-13. After engagement (see FIG. 45B), the downstream end 218-13 of the consumable 202-13 protrudes from the opening 221-13 and thus also protrudes from the device 201-13. The opening 221-13 includes laterally disposed notches 226-13. When a consumable 202-13 is received in the opening 221-13, these notches 226-13 remain open and could, for example, be used for retaining a cover in order to cover the end of the device 201-13.

Figure 45E:
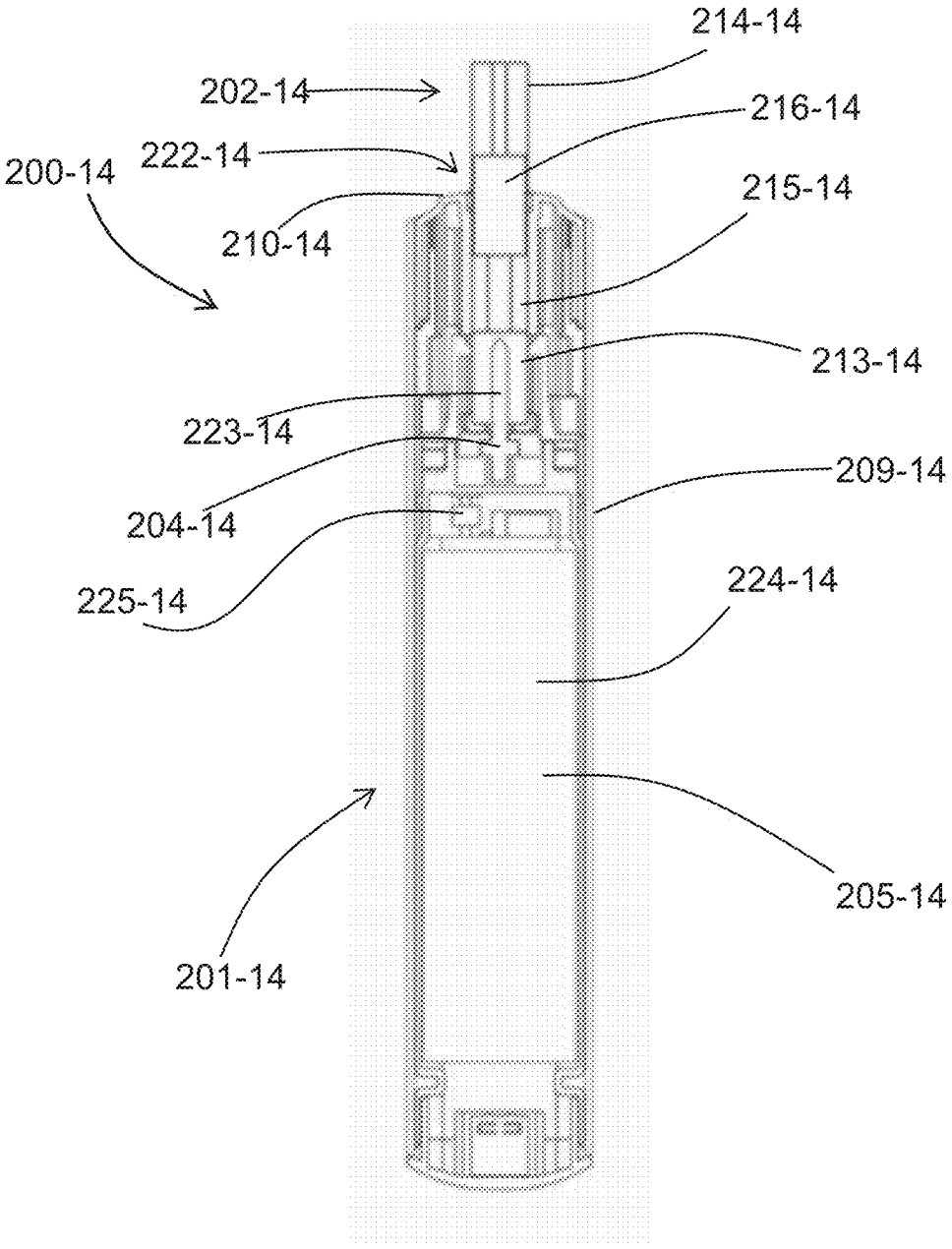
FIG. 45E is a section view of the first embodiment of the substitute smoking system.

FIG. 45E shows a cross section through a central longitudinal plane through the device 201-13. The device 201-13 is shown with the consumable 202-13 engaged therewith.

The device 201-13 comprises a heater 204-13 comprising heating element 223-13. The heater 204-13 forms part of the body 209-13 of the device 201-13 and is rigidly mounted to the body 209-13. In the illustrated embodiment the heater 204-13 is a rod heater with a heating element 223-13 having a circular transverse profile. In other embodiments the heater may be in the form of a blade heater (e.g., heating element with a rectangular transverse profile) or a tube heater (e.g., heating element with a tubular form).

The heating element 223-13 of the heater 204-13 projects from an internal base of the cavity 222-13 along a longitudinal axis towards the opening 221-13. As is apparent from the figure, the length (i.e., along the longitudinal axis) of the heating element is less than a depth of the cavity 222-13. In this way, the heating element 223-13 does not protrude from or extend beyond the opening 221-13.

When the consumable 202-13 is received in the cavity 222-13 (as is shown in FIG. 45E), the heating element 223-13 penetrates the aerosol-forming substrate 213-13 of the consumable 202-13. In particular, the heating element 223-13 extends for nearly the entire axial length of the aerosol-forming substrate 213-13 when inserted therein. Thus, when the heater 204-13 is activated, heat is transferred radially from an outer circumferential surface the heating element 223-13 to the aerosol-forming substrate 213-13.

The device 201-13 further comprises an electronics cavity 224-13. A power source, in the form of a rechargeable battery 205-13 (a lithium ion battery), is located in electronics cavity 224-13.

The device 201-13 includes a connector (i.e., forming part of an IO module of the device 201-13) in the form of a USB port 206-13. The connector may alternatively be, for example, a micro-USB port or a USB-C port for examples. The USB port 206-13 may be used to recharge the rechargeable battery 205-13.

The device 201-13 includes a controller (not shown) located in the electronics cavity 224-13. The controller comprises a microcontroller mounted on a printed circuit board (PCB). The USB port 206-13 is also connected to the controller (i.e., connected to the PCB and microcontroller).

The controller is configured to control at least one function of the device 202-13. For example, the controller is configured to control the operation of the heater 204-13. Such control of the operation of the heater 204-13 may be accomplished by the controller toggling the electrical connection of the rechargeable battery 205-13 to the heater 204-13. For example, the controller is configured to control the heater 204-13 in response to a user depressing the button 212-13. Depressing the button 212-13 may cause the controller to allow a voltage (from the rechargeable battery 205-13) to be applied to the heater 204-13 (so as to cause the heating element 223-13 to be heated).

The controller is also configured to control the LEDs 211-13 in response to (e.g., a detected) a condition of the device 201-13 or the consumable 202-13. For example, the controller may control the LEDs to indicate whether the device 201-13 is in an on state or an off state (e.g., one or more of the LEDs may be illuminated by the controller when the device is in an on state).

The device 201-13 comprises a further input means (i.e., in addition to the button 212-13) in the form of a puff sensor 225-13. The puff sensor 225-13 is configured to detect a user drawing (i.e., inhaling) at the downstream end 218-13 of the consumable 202-13. The puff sensor 225-13 may, for example, be in the form of a pressure sensor, flow meter or a microphone. The puff sensor 225-13 is operatively connected to the controller 208-13 in the electronics cavity 224-13, such that a signal from the puff sensor 225-13, indicative of a puff state (i.e., drawing or not drawing), forms an input to the controller 208-13 (and can thus be responded to by the controller 208-13).

As described with reference to FIG. 44A and FIG. 44B, the controller 108-13 is configured to selectively control the heating of the heater 104-13 to reach a target temperature. The target temperature may be interchangeably referred to as operating temperature or desired temperature or threshold temperature. The heating takes place when the controller 108-13 provides power supply to the heater 104-13. The controller 104-13 may be configured to control the supply of power to the heater 104-13 based on various factors. The factors may be time and target temperature. Precisely, the controller 108-13 may be programmed to raise the heater 104-13 to the target temperature in a predetermined time.

In one of the embodiments, it is desired to enhance the user experience by heating the consumable in phases. The phase can refer to step up or delay in heating the tobacco. Specifically, heating the consumable 102-13, for example tobacco, to a desired temperature instantly or at least very rapidly may not give a pleasant user experience. If the tobacco is heated to a desired temperature rapidly, then there is a possibility of tobacco getting burnt or reaching a near burnt state or charred state, giving an unpleasant experience while smoking the consumable 102-13. Hence, it may be preferred to heat the consumable 102-13 in a phased manner, in the initial phase of time and gradually increase and heat the consumable 102-13 to reach the target temperature.

In order to gradually heat the tobacco, the heater 104-13 has to be controlled respectively. In this regard, the controller 108-13 may be pre-programmed or set with the conditions/factor for operating the device 101-13 during a consumable cycle. According to an embodiment, the temperature can be raised gradually to one or more intermediate level and further to the target temperature level. For example, the temperature may be raised to a first intermediate temperature level in a first predetermined time, and subsequently, further raised to a second intermediate temperature level in a second predetermined time. Furthermore, the temperature can be raised from the second intermediate temperature level to a third temperature level, which may be the target temperature, in a third predetermined time. As per the above example, for raising the temperature to first, second and third level or more, the power supply provided to the heater 104-13 has to be accordingly controlled by the controller 108-13. As per the above example, raising the temperature to the first and second intermediate temperature level may be referred to as pause temperature. Further, the first and second predetermined time may be referred to as pause period.

Alternatively, the pause temperature may be, for example, the temperature at which the heater 104-13 is maintained for a predetermined period of time before raising the temperature further, for example to the second or third temperature level. Accordingly, the pause period may be referred as to a predetermined time period during which the temperature may be maintained before raising further. The pause period occurs after a predetermined period from the commencement of the initial heating phase. If the temperature is raised to first or second temperature and maintained for a first or second pause period, then, the heating is delayed reaching the target temperature.

The controller 108-13 may be configured to include more than one pause periods, wherein each pause period may have a different pause temperature. Accordingly, the raising of the temperature is stepped up and delayed for heating the consumable to the target temperature. The pause period may be calculated based on the present voltage of the power supply. Similarly, the pause temperature may be calculated based on the present voltage of the power supply. Additionally, a first power level may be supplied before the first pause period. The first power level may be different from a second power level supplied immediately after the first pause period. Optionally, the first power level supplied immediately before the pause period may be substantially equal to the second power level supplied immediately after the pause period.

Figure 46:
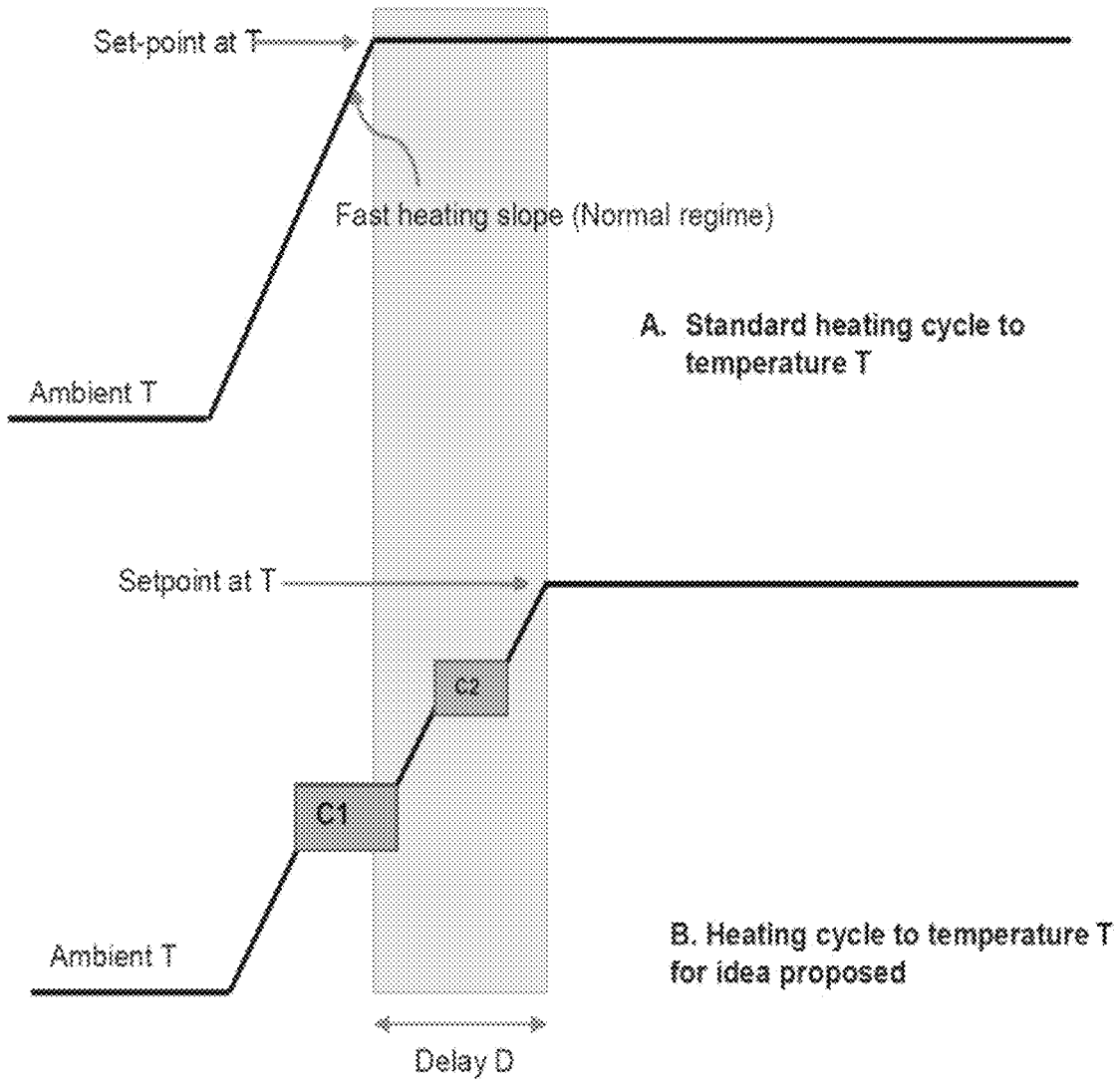
FIG. 46 is a graphical representation illustrating functioning of the heat not burn device in accordance with some embodiments of the fourteenth mode of the present disclosure.

FIG. 46 shows a graphical representation of the operation according to an embodiment of the present disclosure in comparison to the existing heating technique. Graph A and B respectively demonstrates a comparison with respect to A and B heating cycles for a standard (prior) system and for a system according an embodiment of the present disclosure respectively.

In heating cycle B, for example, two regions are selected for controlling the rising of the temperature/heat in the consumable, which is represented as C1 and C2. In contrast, in cycle A, the normal heating cycle has the same heating speed, as opposed cycle B (between and outside C1 and C2).

Cycle A is normal as the overall system will maintain similar heating control dynamics and inertia in getting to and reacting to temperature increase (time constant, dead time). In Cycle B, region C1 and C2 (and CN (if more than two regions)), are not necessarily similar. This is because when at an intermediate temperature the overall system reacts more quickly to heat input. Region CN, each may include, either a total shut-off of power or a throttled power. The time length is also different from each other and can be changed and predetermined.

From heating cycle B, it is illustrated that a delay D is inherently introduced. The technique according to the present method leads to a slowing off the heating cycle to achieve the target temperature. However, it is to be appreciated that the delay may not be significant if the number of pause periods (may be referred to as throttle regions) are reduced. Further, the heater element/rod used may have a high performance with respect to heating. The heater may reach 350 degree Celsius within 5 seconds. Hence, the delays which are introduced for gently heating the tobacco, will not impact significantly adversely on the waiting time to reach the desired temperature. Additionally, many of the "throttle" region introduced will be for example for a shorter period of time, which may last only for few seconds and therefore impacting little on the heating performance.

Optionally, the throttle region may also include a certain (reduced) amount of heating thus making any delays shorter and acceptable overall. For instance, time taken by a heater for raising to a target temperature may be, for example, 15 seconds. It is clear that the throttle regions introduced will impact marginally on the speed for getting to the target temperature. Further, it is to be considered that the consumable operates over many minutes making these delays manageable. Alternatively, the throttle regions may be introduced to ensure that the heating is matched to the inertial performance of the device for ensuring that the consumable produces the best performance and best user experience.

Alternatively (not depicted) the actual heating slope(s) may be increased, e.g., by providing sufficient (additional) energy to the heater, e.g., to, at least partly, compensate for the times CN, so that the overall heating period may stay substantially the same. So the pause periods for relaxing the tobacco material may be overcompensated with excess heating periods, still resulting in a more acceptable heating of the tobacco material as perceived by a user.

In an embodiment, the pause period/delay period may be between one of 0.1 to 30 seconds, or between 1 and 10 seconds, or between 2 and 7 seconds, or between 3 and 4 seconds.

The controller 108-13 may also be configured to implement more than one pause period before the temperature reaches 30% of the temperature difference between ambient and target temperature, above ambient temperature. Optionally, the pause temperature may be greater than 30% of the temperature difference between ambient and target temperature, or above ambient temperature; or optionally 50%, or optionally, 70%, or optionally 85%.

The controller 108-13 is also configured to control the heating according to the embodiment, by setting delay periods and custom temperature levels along the heating cycle during the heating of tobacco. The heating of temperature can be for example from ambient temperature or other temperatures. The controller with either controlled speed of heating or creating one or more intermediate steps, can cut off the heating, throttled, or reduced prior to reaching a given temperature set-point. The predetermined heating cycle (which may be referred to as a "custom heating cycle") is either implemented using default configuration within the device which can be selected by the user or produced by the user(s) themselves through configuration using a remote device, for example, mobile, computer etc.

The above methodology can be implemented in a firmware, software, or hardware. It is also retro-fittable and can be introduced in a current consumable cycle. It can be an add-on or embedded seamlessly within the normal working regimes of the device.

The controller 108-13 is further capable of controlling heating of the tobacco such that the heating is spread evenly through the useful region of the consumable tobacco. By reducing or cutting off the heating once or more, during the period leading to convergence to pre-set temperature or temperatures, the consumable reaches a state of equilibrium in temperature whereby the tobacco is not thermally "shocked", charred, or singed, or led to exhibit burn or near burn states. By introducing one or more steps whereby the tobacco is heated to temperature with the heat being imparted to the consumable more gently, this results in the whole or part of the consumable reaching the desired temperature or temperatures while exhibiting little or none of the charring, or singeing, or burns, and thermal shock.

In an optional embodiment, a testing unit (not shown) may be provided to determine optimum pause temperature and pause time period for giving optimum user experience. Several scenarios with a variety of heating cycles may be determined using the testing unit. These cycles may for example differ in size and type of step or power control, while the device goes towards target temperature.

Figure 47A:
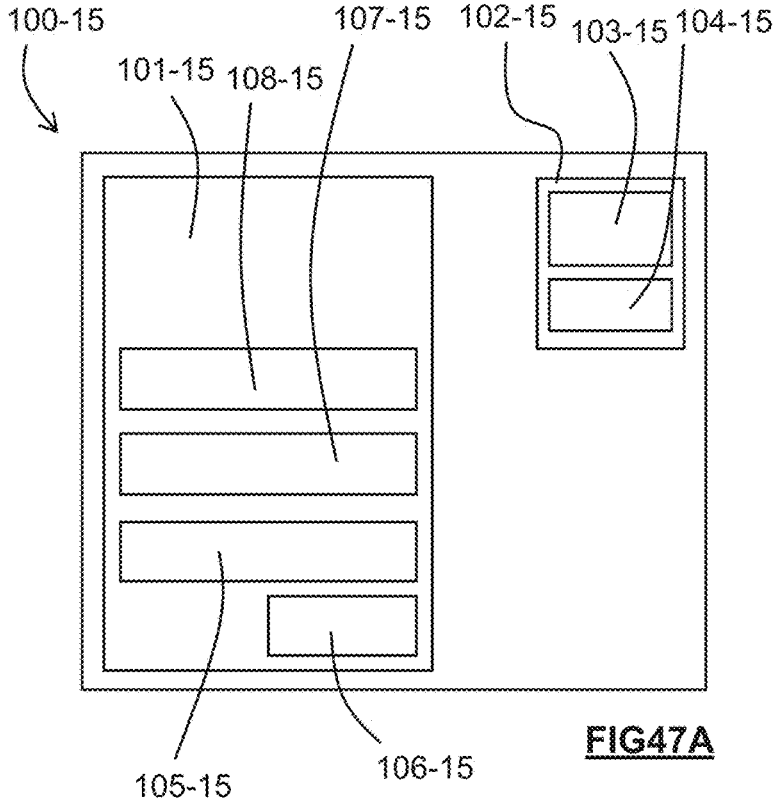
FIG. 47A is a schematic of a smoking substitute system.

Fifteenth Mode of the Disclosure FIG. 47A is a schematic providing a general overview of a smoking substitute system 100-14. The system 100-14 includes a substitute smoking device 101-14 and an aerosol-forming article in the form of a consumable 102-14, which comprises an aerosol former 103-14. The system is configured to vaporize the aerosol former by heating the aerosol former 103-14 (so as to form a vapor/aerosol for inhalation by a user).

In the illustrated system, the heater 104-14 forms part of the consumable 102-14 and is configured to heat the aerosol former 103-14. Heat from the heater 104-14 vaporizes the aerosol former 103-14 to produce a vapor. The vapor subsequently condenses to form an aerosol, which is ultimately inhaled by the user.

The system 100-14 further comprises a power source 105-14 that forms part of the device 101-14. In other embodiments the power source 105-14 may be external to (but connectable to) the device 101-14. The power source 105-14 is electrically connectable to the heater 104-14 such that it is able to supply power to the heater 104-14 (i.e., for the purpose of heating the aerosol former 103-14). Thus, control of the electrical connection of the power source 105-14 to the heater 104-14 provides control of the state of the heater 104-14. The power source 105-14 may be a power store, for example a battery or rechargeable battery (e.g., a lithium ion battery).

The system 100-14 further comprises an I/O module comprising a connector 106-14 (e.g., in the form of a USB port, Micro USB port, USB-C port, etc.). The connector 106-14 is configured for connection to an external source of electrical power, e.g., a mains electrical supply outlet. The connector 106-14 may be used in substitution for the power source 105-14. That is the connector 106-14 may be electrically connectable to the heater 104-14 so as to supply electricity to the heater 104-14. In such embodiments, the device may not include a power source, and the power source of the system may instead comprise the connector 106-14 and an external source of electrical power (to which the connector 106-14 provides electrical connection).

In some embodiments, the connector 106-14 may be used to charge and recharge the power source 105-14 where the power source 104-14 includes a rechargeable battery.

The system 100-14 also comprises a user interface (UI) 107. Although not shown, the UI 107-14 may include input means to receive commands from a user. The input means of the UI 107-14 allows the user to control at least one aspect of the operation of the system 100-14. The input means may, for example, be in the form of a button, touchscreen, switch, microphone, etc.

The UI 107-14 also comprises output means to convey information to the user. The output means may, for example, comprise lights (e.g., LEDs), a display screen, speaker, vibration generator, etc.

The system 100-14 further comprises a controller 108-14 that is configured to control at least one function of the device 101-14. In the illustrated embodiment, the controller 108-14 is a component of the device 101-14, but in other embodiments may be separate from (but connectable to) the device 101-14. The controller 108-14 is configured to control the operation of the heater 104-14 and, for example, may be configured to control the voltage applied from the power source 105-14 to the heater 104-14. The controller 108-14 may be configured to toggle the supply of power to the heater 105-14 between an on state, in which the full output voltage of the power source 105-14 is applied to the heater 104-14, and an off state, in which the no voltage is applied to the heater 104-14.

Although not shown, the system 100-14 may also comprise a voltage regulator to regulate the output voltage from the power source 105-14 to form a regulated voltage. The regulated voltage may then be applied to the heater 104-14.

In addition to being connected to the heater 104-14, the controller 108-14 is operatively connected to the UI 107-14. Thus, the controller 108-14 may receive an input signal from the input means of the UI 107-14. Similarly, the controller 108-14 may transmit output signals to the UI 107-14. In response, the output means of the UI 107-14 may convey information, based on the output signals, to a user.

Figure 47B:
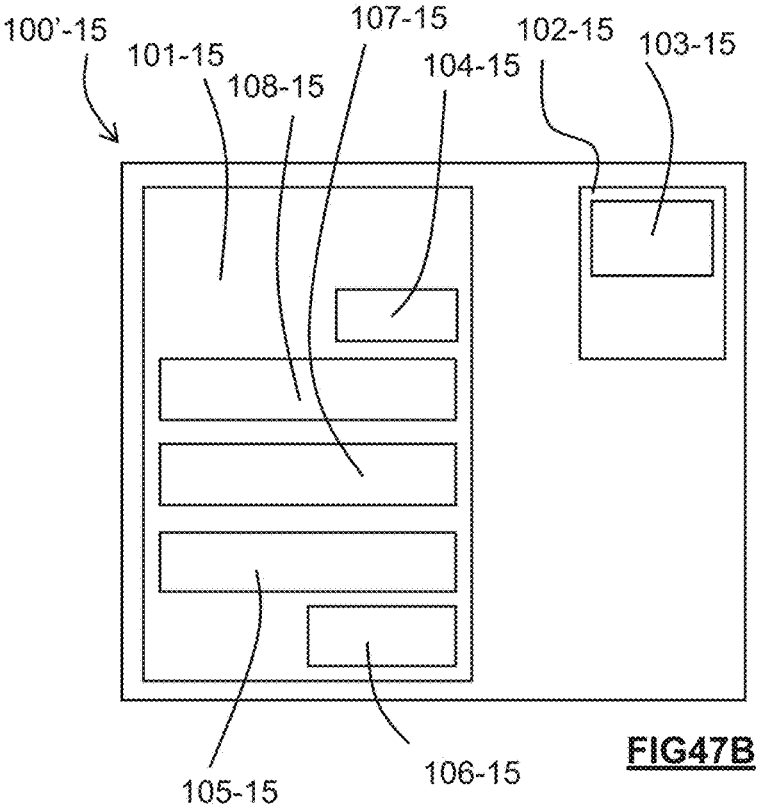
FIG. 47B is a schematic of a variation of the smoking substitute system of FIG. 47A.

FIG. 47B is a schematic showing a variation of the system 100-14 of FIG. 47A. In the system 100-14' of FIG. 47B, the heater 104-14 forms part of the consumable 102-14, rather than the device 101-14. In this variation, the heater 104-14 is electrically connectable to the power source 105-14, for example, when the consumable 102-14 is engaged with the device 101-14.

Figure 48A:
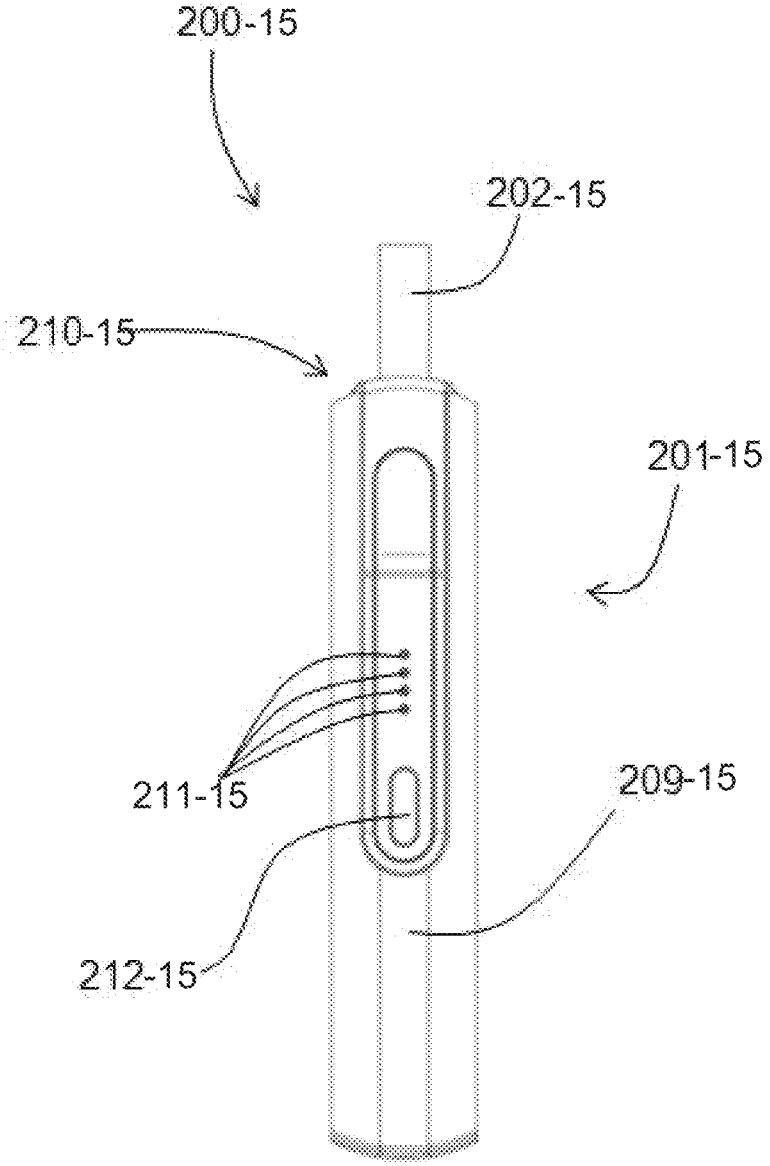
FIG. 48A is a front view of a first embodiment of a fifteenth mode of a smoking substitute system with the consumable engaged with the device.
Figure 48B:
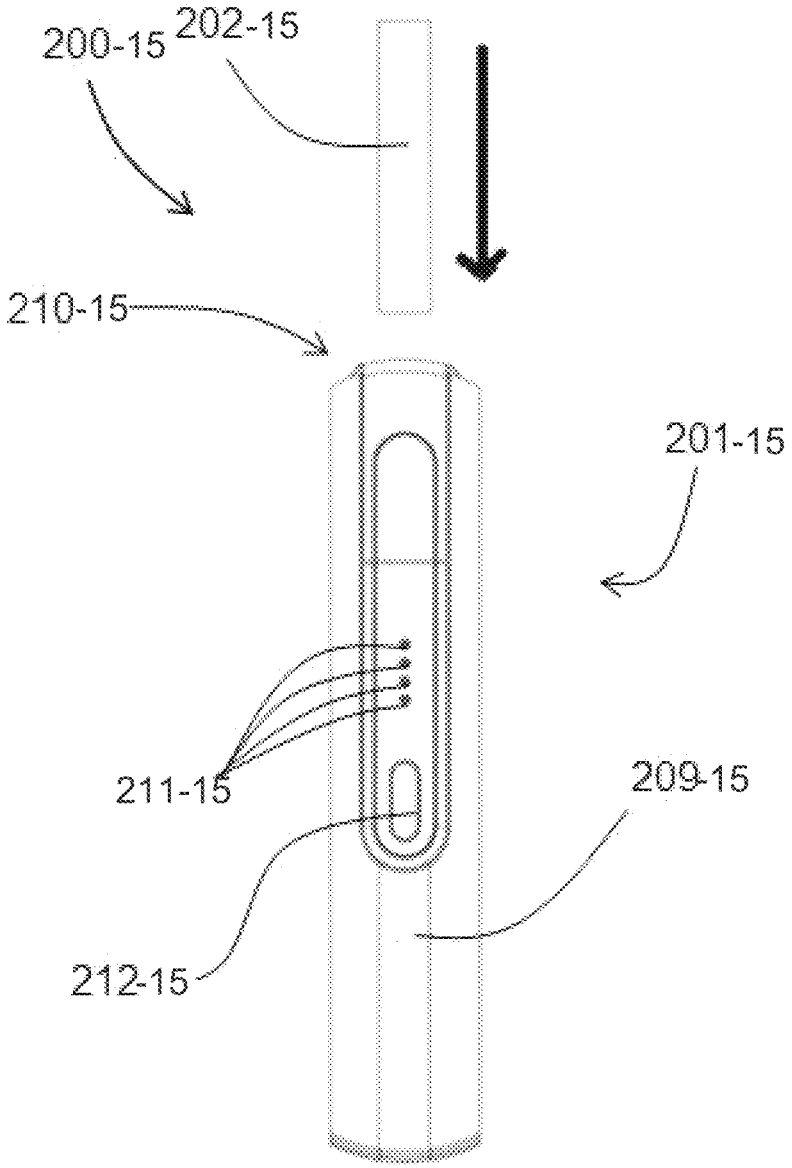
FIG. 48B is a front view of the first embodiment of the smoking substitute system with the consumable disengaged from the device.

FIG. 48A and FIG. 48B illustrate a heated-tobacco (HT) smoking substitute system 200-14. The system 200-14 is an example of the systems 100-14, 100' described in relation to FIG. 47A or FIG. 47B. System 200-14 includes an HT device 201-14 and an HT consumable 202-14. The description of FIG. 47A and FIG. 47B above is applicable to the system 200-14 of FIG. 48A and FIG. 48B, and will thus not be repeated.

The device 201-14 and the consumable 202-14 are configured such that the consumable 202-14 can be engaged with the device 201-14. FIG. 48A shows the device 201-14 and the consumable 202-14 in an engaged state, whilst FIG. 48B shows the device 201-14 and the consumable 202-14 in a disengaged state.

The device 201-14 comprises a body 209-14 and cap 210-14. In use the cap 209-14 is engaged at an end of the body 209-14. Although not apparent from the figures, the cap 210-14 is moveable relative to the body 209-14. In particular, the cap 210-14 is slideable and can slide along a longitudinal axis of the body 209-14.

The device 201-14 comprises an output means (forming part of the UI of the device 201-14) in the form of a plurality of light-emitting diodes (LEDs) 211 arranged linearly along the longitudinal axis of the device 201-14 and on an outer surface of the body 209-14 of the device 201-14. A button 212-14 is also arranged on an outer surface of the body 209-14 of the device 201-14 and is axially spaced (i.e., along the longitudinal axis) from the plurality of LEDs 211-14.

Figure 48C:
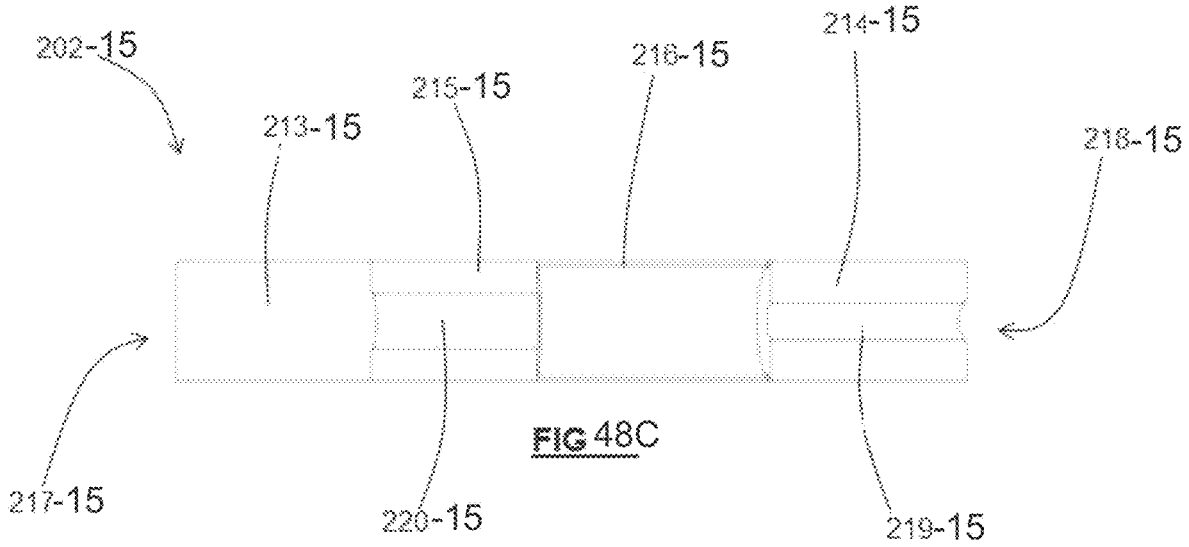
FIG. 48C is a section view of the consumable of the first embodiment of the smoking substitute system.

FIG. 48C show a detailed section view of the consumable of 202 of the system 200-14. The consumable 202-14 generally resembles a cigarette. In that respect, the consumable 202-14 has a generally cylindrical form with a diameter of 7 mm and an axial length of 70 mm. The consumable 202-14 comprises an aerosol forming substrate 213-14, a terminal filter element 214-14, an upstream filter element 215-14 and a spacer element 216-14. In other embodiments, the consumable may further comprise a cooling element. A cooling element may exchange heat with vapor that is formed by the aerosol-forming substrate 213-14 in order to cool the vapor so as to facilitate condensation of the vapor.

The aerosol-forming substrate 213-14 is substantially cylindrical and is located at an upstream end 217-14 of the consumable 202-14, and comprises the aerosol former of the system 200-14. In that respect, the aerosol forming substrate 213-14 is configured to be heated by the device 201-14 to release a vapor. The released vapor is subsequently entrained in an airflow flowing through the aerosol-forming substrate 213-14. The airflow is produced by the action of the user drawing on a downstream 218 (i.e., terminal or mouth end) of the consumable 202-14.

In the present embodiment, the aerosol forming substrate 213-14 comprises tobacco material that may, for example, include any suitable parts of the tobacco plant (e.g., leaves, stems, roots, bark, seeds and flowers). The tobacco may comprise one or more of leaf tobacco, stem tobacco, tobacco powder, tobacco dust, tobacco derivatives, expanded tobacco, homogenized tobacco, shredded tobacco 213-15 extruded tobacco, cut rag tobacco and/or reconstituted tobacco (e.g., slurry recon or paper recon). For example, the aerosol-forming substrate 213-14 may comprise a gathered sheet of homogenized (e.g., paper/slurry recon) tobacco or gathered shreds/strips formed from such a sheet.

In order to generate an aerosol, the aerosol forming substrate 213-14 comprises at least one volatile compound that is intended to be vaporized/aerosolized and that may provide the user with a recreational and/or medicinal effect when inhaled. The aerosol-forming substrate 213-14 may further comprise one or more additives. For example, such additives may be in the form of humectants (e.g., propylene glycol and/or vegetable glycerin), flavorants, fillers, aqueous/non-aqueous solvents and/or binders.

The terminal filter element 214-14 is also substantially cylindrical, and is located downstream of the aerosol forming substrate 213-14 at the downstream end 218-14 of the consumable 202-14. The terminal filter element 214-14 is in the form of a hollow bore filter element having a bore 219-14 (e.g., for airflow) formed there through. The diameter of the bore 219-14 is 2 mm. The terminal filter element 214-14 is formed of a porous (e.g., monoacetate) filter material. As set forth above, the downstream end 218-14 of the consumable 202-14 (i.e., where the terminal filter 214-14 is located) forms a mouthpiece portion of the consumable 202-14 upon which the user draws. Airflow is drawn from the upstream end 217-14, thorough the components of the consumable 202-14, and out of the downstream end 218-14. The airflow is driven by the user drawing on the downstream end 218-14 (i.e., the mouthpiece portion) of the consumable 202-14.

The upstream filter element 215-14 is located axially adjacent to the aerosol-forming substrate 213-14, between the aerosol-forming substrate 213-14 and the terminal filter element 214-14. Like the terminal filter 214-14, the upstream filter element 215-14 is in the form of a hollow bore filter element, such that it has a bore 220-14 extending axially there through. In this way, the upstream filter 215-14 may act as an airflow restrictor. The upstream filter element 215-14 is formed of a porous (e.g., monoacetate) filter material. The bore 220-14 of the upstream filter element 214 has a larger diameter (3 mm) than the terminal filter element 214-14.

The spacer 216-14 is in the form of a cardboard tube, which defines a cavity or chamber between the upstream filter element 215-14 and the terminal filter element 214-14. The spacer 216-14 acts to allow both cooling and mixing of the vapor/aerosol from the aerosol-forming substrate 213-14. The spacer has an external diameter of 7 mm and an axial length of 14 mm.

Although not apparent from the figure, the aerosol-forming substrate 213-14, upstream filter 215-14 and spacer 216-14 are circumscribed by a paper wrapping layer. The terminal filter 214-14 is circumscribed by a tipping layer that also circumscribes a portion of the paper wrapping layer (so as to connect the terminal filter 214-14 to the remaining components of the consumable 202-14). The upstream filter 215-14 and terminal filter 214-14 are circumscribed by further wrapping layers in the form of plug wraps.

Figure 48D:
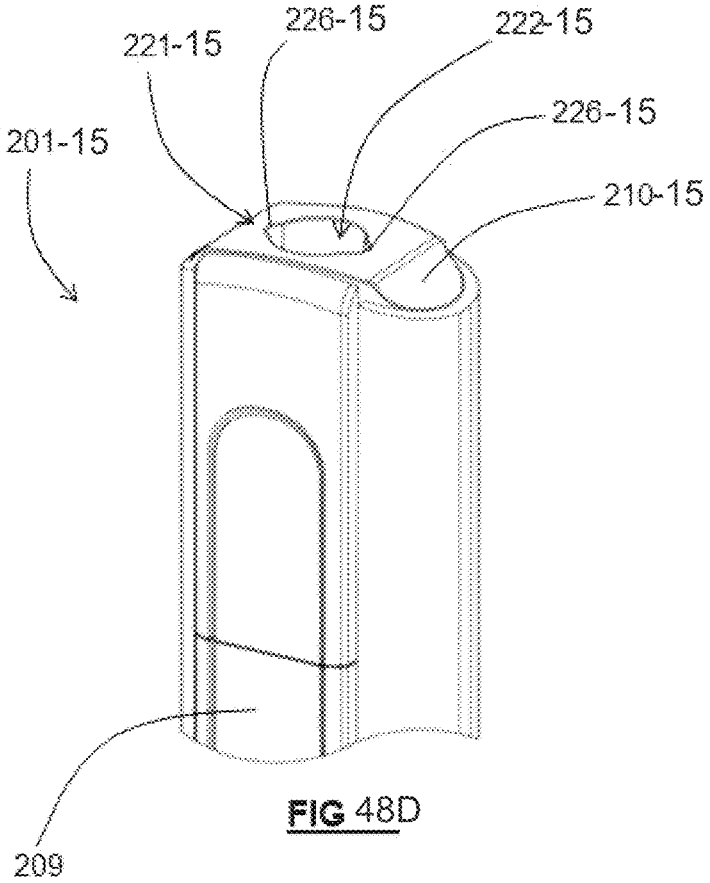
FIG. 48D is a detailed view of an end of the device of the first embodiment of the smoking substitute system.

Returning now to the device 201-14, FIG. 48D illustrates a detailed view of the end of the device 201-14 that is configured to engage with the consumable 202-14. The cap 210-14 of the device 201-14 includes an opening 221-14 to an internal cavity 222-14 (more apparent from FIG. 48D) defined by the cap 210-14. The opening 221-14 and the cavity 222-14 are formed so as to receive at least a portion of the consumable 202-14. During engagement of the consumable 202-14 with the device 201-14, a portion of the consumable 202-14 is received through the opening 221-14 and into the cavity 222-14. After engagement (see FIG. 48B), the downstream end 218-14 of the consumable 202-14 protrudes from the opening 221-14 and thus protrudes also from the device 201-14. The opening 221-14 includes laterally disposed notches 226-14. When a consumable 202-14 is received in the opening 221-14, these notches 226-14 remain open and could, for example, be used for retaining a cover to cover the end of the device 201-14.

Figure 48E:
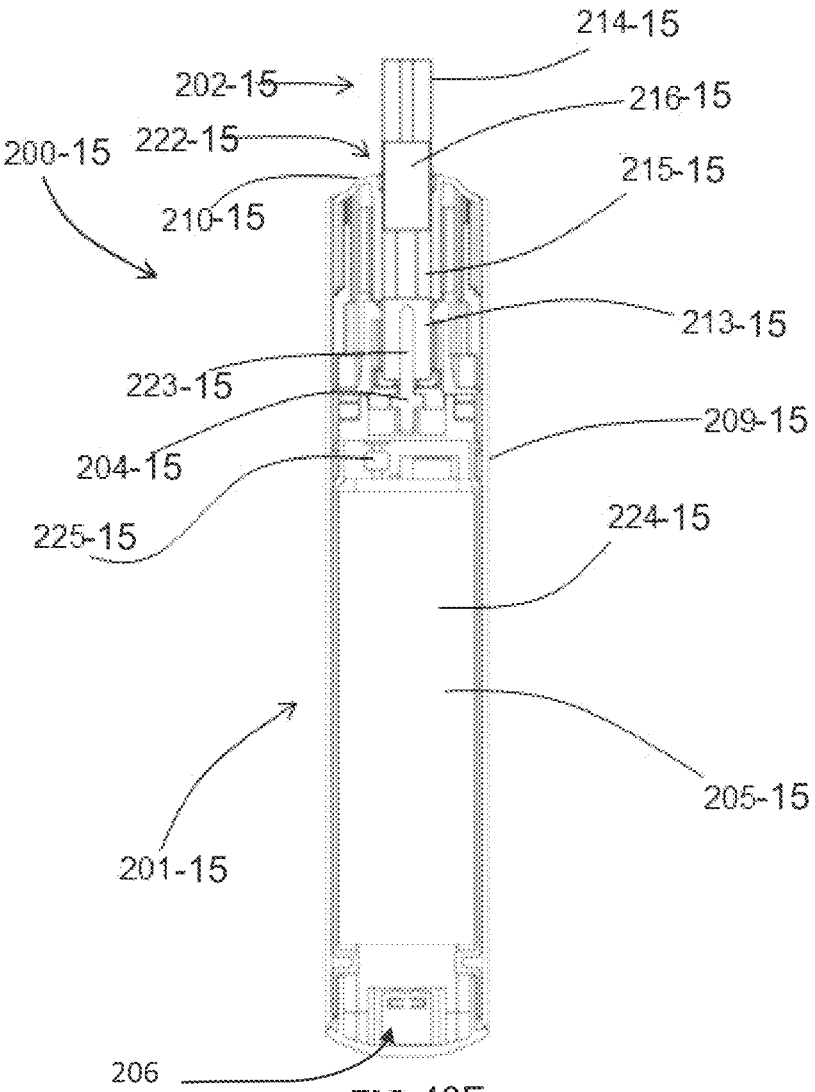
FIG. 48E is a section view of the first embodiment of the smoking substitute system.
Figure 48F:
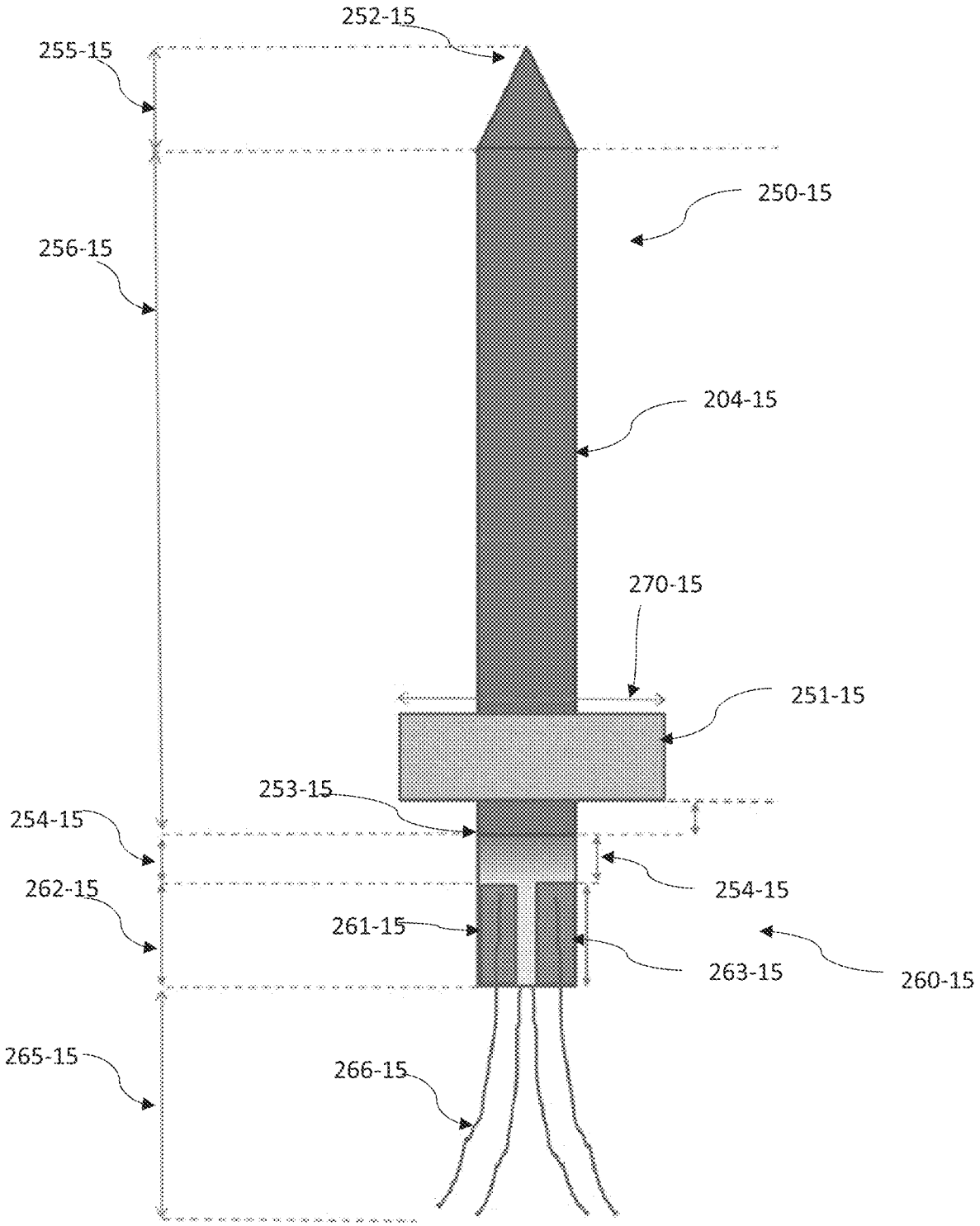
FIG. 48F is a front view of a heater of the smoking substitute system.

FIG. 48E shows a cross section through a central longitudinal plane through the device 201-14. The device 201-14 is shown with the consumable 202-14 engaged therewith.

The device 201-14 comprises a longitudinal heater 204-14 comprising heating element 223-14. The longitudinal heater 204-14 forms part of the body 209-14 of the device 201-14 and is rigidly mounted to the body 209-14. In the illustrated embodiment, the longitudinal heater 204-14 is a rod heater with a heating element 223-14 having a circular transverse profile. In other embodiments the heater may be in the form of a blade heater (e.g., heating element with a rectangular transverse profile) or a tube heater (e.g., heating element with a tubular form).

The heating element 223-14 of the heater 204-14 projects from an internal base of the cavity 222-14 along a longitudinal axis towards the opening 221-14. As is apparent from the FIG. 48E, the length (i.e., along the longitudinal axis) of the heating element is less than a depth of the cavity 222-14. In this way, the heating element 223-14 does not protrude from or extend beyond the opening 221-14.

When the consumable 202-14 is received in the cavity 222-14 (as is shown in FIG. 48E), the heating element 223-14 penetrates the aerosol-forming substrate 213-14 of the consumable 202-14. In particular, the heating element 223-14 extends for nearly the entire axial length of the aerosol-forming substrate 213-14 when inserted therein. Thus, when the heater 204-14 is activated, heat is transferred radially from an outer circumferential surface the heating element 223-14 to the aerosol-forming substrate 213-14.

Referring to FIG. 2F, the longitudinal heater 204-14 includes a heating track such that the heating track includes a first portion 250-14 and a second portion 260-14. The first heating portion 250-14 may be configured to be resistively heated to a first operating temperature when power is supplied to the heater 204-14. Further, the second heating portion 260-14 is configured to supply power to the first portion 250-14 such that the operating temperature of the first portion 250-14 is greater than an opening temperature of the second portion. In an embodiment, the first portion 250-14 may extend to a length of 12 mm from a mount 251-14. In an embodiment, the first portion 250-14 may extend to a length ranging about 8 mm to 20 mm from the mount 251-14. Preferably, the first portion 250-14 may extend to a length of 10 mm to 18 mm from a mount 251-14. The first portion 250-14 may be defined by a first end 252-14 (may be a tip portion) and second end 253-14 (may be the base). In certain embodiment, the tip portion may be a part of the first portion. The first end of the heater 204-14 may include an insertion cone extending to a length of at least 2 mm at the first end 252-14 of the heater 204-14. Further, the second portion 260-14 extends longitudinally below the first portion 250-14 along the longitudinal axis of the device 201-14. The second portion 260-14 may extend to a length of 2.5 mm to 3 mm from the second end 253-14 of the first portion 250-14. Further, the heater 204-14 may be made of Alumina.

The heater 204-14 further includes a mount 251-14 attached to the device 201-14 [shown in FIG. 2E] such that the mount 251-14 is in contact with the first portion 250-14 of the heater 204-14 and located within the first portion 250-14 of the heater 204-14. In an embodiment, the mount 251-14 may be located at least 0.5 mm from an end of the first portion 250-14, such that the mount 251-14 may be located at least 0.5 mm above the second end 253-14 of the first portion 250-14. The mount 251-14 may be disposed between first portion 250-14 and the second portion 260-14. In respect of this, the operating temperature of the first portion 250-14 may be high with respect to the second portion 260-14 of the heater 204-14. The mount may be square in shape when viewed from the top and may be dimensioned with 4 mm. Further, the mount may be made of the zirconia material.

The heater 204-14 further includes a pair of heater electrodes 261-14 (also referred as heater track electrodes), connected to the heating track at the second portion 260-14. The heater track may be disposed within the heater (i.e., tube heater) which may extend along a longitudinal length of the heater 204-14. The heater track may be made of Rhodium (Rh) and Tungsten (Wr). The heater track may have temperature coefficient of resistance of 1000 (TCR 1000) for heating. In an embodiment, the heater track electrodes are connected at least 0.5 mm from the first portion 250-14. In respect of this, the heater track electrodes 261-14 are connected at least 0.5 mm below the second end 253-14 of the first portion 250-14. The heater track electrodes 261-14 are connected to heater track (not shown in figures) along a heater connection length 262-14 of greater than 1 mm. Preferably, the heater track electrodes 261-14 may be connected to a heater track (not shown in figures) along a heater connection length 262-14 of greater than 1.5 mm. More preferably, the heater track electrodes 261-14 may be connected to heater track (not shown in figures) along a heater connection length 262-14 of greater than 2 mm. Further, four heater electrodes may be configured on the second portion 260-14 through metallic wires 266-14 wires 266-14. The wires may be 20 mm long from the bottom of the heater 204-14. Furthermore, the wires 266-14 may have diameter of 0.5 mm and may be made of Nickel.

In respect of the above, a region which is 0.5 mm below the second end 253-14 of the first portion 250-14 and until the second portion 260-14 may be a buffer region 254-14 of the heating zone 256-14. In an embodiment, the second portion may include a connection zone 262-14 and a wire zone 265-14. The connection zone 262-14 may extend to a length of at least 2 mm.

The heater 204-14 includes a temperature sensor track (not shown in figures). The heater 204-14 may further include a pair of sensor track electrodes 263-14 connected to the temperature sensor track. Further, the sensor track electrodes 263-14 are connected to the temperature sensor track at the second portion 260-14. The sensor track may be located within the heater 204-14. The sensor track may be disposed within the heater 204-14 (i.e., tube heater) which may extend along a longitudinal length of the heater 204-14. The sensor track may be made of Tungsten (Wr) having a temperature coefficient of resistance of 4000 (TCR 4000) for temperature sensing. Further, the sensor track electrodes 263-14 are connected to the temperature sensor track along a sensor connection length of greater than 1 mm. Preferably, the sensor track electrodes 263-14 may be connected to the temperature sensor track along the sensor connection length of greater than 1.5 mm. More preferably, the sensor track electrodes 263-14 may be connected to the temperature sensor track along the sensor connection length of greater than 2 mm. In in an illustrative configuration, four sensor track electrodes may be configured in the second portion 260-14 through metallic wires 266-14 wires 266-14 that connects to the power source. The wires may be 20 mm long from the bottom of the heater 204-14. Furthermore, the wires 266-14 may have diameter of 0.5 mm and may be made of Nickel.

Further, the heater track electrodes 261-14 may have larger cross section area than the temperature sensor track. In respect of this, each heater track electrode 261 has a larger diameter than a diameter of each sensor track electrode 263-14. In an embodiment, the heater track may have a diameter of 0.4 mm and the temperature senor track may have a diameter of 0.3 mm.

In another aspect the first portion 250-14 may be heating zone 256-14 of the heater 204-14. The heating zone 256-14 may have one type of material used throughout for heating or for temperature sensing within the heater 204-14. The connection zone 262-14 may include the heater track electrodes 261-14 and the sensor track electrodes 263-14 attached circumferentially to the heater 204-14. The wire zone 265-14 may include plurality of wires 266-14 to connect the heater to the power source to supply power to the second portion 260-14 of the heater 204-14 for heating the first portion 250-14 of the heater 204-14. Further this geometry allows coverage for a wider area of heating while many regions are enclosed using a material with a low heat conductivity than the material of heater (Alumina).

The longitudinal heating element 204-14 is configured to penetrate the tobacco portion of the consumable engaged with the device. Further, the heater 204-14 may be rod shaped located centrally in the device.

The device 202-14 further comprises an electronics cavity 224-14. A power source, in the form of a rechargeable battery 205-14 (a lithium ion battery), is located in electronics cavity 224-14.

The device 202-14 includes a connector (i.e., forming part of an IO module of the device 201-14) in the form of a USB port 206-14. The connector may alternatively be, for example, a micro-USB port or a USB-C port for examples. The USB port 206-14 may be used to recharge the rechargeable battery 205-14.

The device 202-14 includes a controller (not shown) located in the electronics cavity 224-14. The controller comprises a microcontroller mounted on a printed circuit board (PCB). The USB port 206-14 is also connected to the controller 208-14 (i.e., connected to the PCB and microcontroller).

The controller 208-14 is configured to control at least one function of the device 202-14. For example, the controller 208-14 is configured to control the operation of the heater 204-14. Such control of the operation of the heater 204-14 may be accomplished by the controller toggling the electrical connection of the rechargeable battery 205-14 to the heater 204-14. For example, the controller 208-14 is configured to control the heater 204-14 in response to a user depressing the button 212-14. Depressing the button 212-14 may cause the controller to allow a voltage (from the rechargeable battery 205-14) to be applied to the heater 204-14 (so as to cause the heating element 223-14 to be heated).

The controller is also configured to control the LEDs 211-14 in response to (e.g., a detected) a condition of the device 201-14 or the consumable 202-14. For example, the controller may control the LEDs to indicate whether the device 201-14 is in an on state or an off state (e.g., one or more of the LEDs may be illuminated by the controller when the device is in an on state).

The device 202-14 comprises a further input means (i.e., in addition to the button 212-14) in the form of a puff sensor 225-14. The puff sensor 225-14 is configured to detect a user drawing (i.e., inhaling) at the downstream end 218-14 of the consumable 202-14. The puff sensor 225-14 may, for example, be in the form of a pressure sensor, flow meter or a microphone. The puff sensor 225-14 is operatively connected to the controller 208-14 in the electronics cavity 224-14, such that a signal from the puff sensor 225-14, indicative of a puff state (i.e., drawing or not drawing), forms an input to the controller 208-14 (and can thus be responded to by the controller 208-14).

Figure 49A:
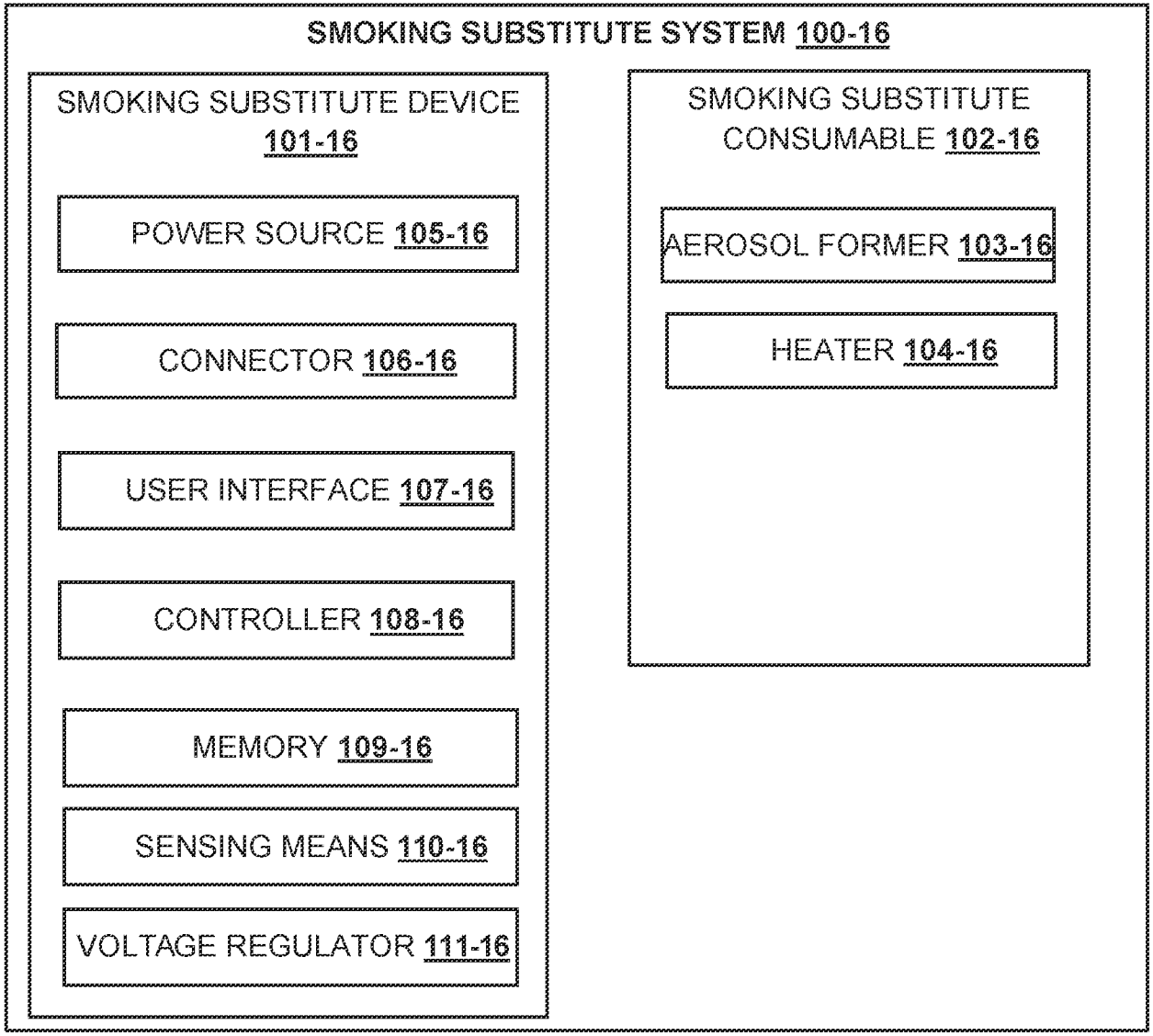

Sixteenth Mode of the Disclosure FIG. 49A is a schematic providing a general overview of a smoking substitute system 100-15. The system 100-15 includes a substitute smoking device 101-15 and an aerosol-forming article in the form of a consumable 102-15, which comprises an aerosol former 103-15. The system is configured to vaporize the aerosol former by heating the aerosol former 103-15 (so as to form a vapor/aerosol for inhalation by a user).

In the illustrated system, the heater 104-15 forms part of the consumable 102-15 and is configured to heat the aerosol former 103-15. Heat from the heater 104-15 vaporizes the aerosol former 103-15 to produce a vapor. The vapor subsequently condenses to form an aerosol, which is ultimately inhaled by the user.

The system 100-15 further comprises a power source 105-15 that forms part of the device 101-15. In other embodiments the power source 105-15 may be external to (but connectable to) the device 101-15. The power source 105-15 is electrically connectable to the heater 104-15 such that the power source 105-15 is able to supply power to the heater 104-15 (i.e., for the purpose of heating the aerosol former 103-15). Thus, control of the electrical connection of the power source 105-15 to the heater 104-15 provides control of the state of the heater 104-15. The power source 105-15 may be a power store, for example a battery or rechargeable battery (e.g., a lithium ion battery).

The system 100-15 further comprises an I/O module comprising a connector 106-15 (e.g., in the form of a USB port, Micro USB port, USB-C port, etc.). The connector 106-15 is configured for connection to an external source of electrical power, e.g., a mains electrical supply outlet. The connector 106-15 may be used in substitution for the power source 105-15. That is the connector 106-15 may be electrically connectable to the heater 104-15 so as to supply electricity to the heater 104-15. In such embodiments, the device may not include a power source, and the power source of the system may instead comprise the connector 106-15 and an external source of electrical power (to which the connector 106-15 provides electrical connection).

In some embodiments, the connector 106-15 may be used to charge and recharge the power source 105-15 where the power source 104-15 includes a rechargeable battery.

The system 100-15 also comprises a user interface (UI) 107. Although not shown, the UI 107-15 may include input means to receive commands from a user. The input means of the UI 107-15 allows the user to control at least one aspect of the operation of the system 100-15. The input means may, for example, be in the form of a button, touchscreen, switch, microphone, etc.

The UI 107-15 also comprises output means to convey information to the user. The output means may, for example, comprise lights (e.g., LEDs), a display screen, speaker, vibration generator, etc.

The system 100-15 further comprises a controller 108-15 and a memory 109-15 operatively coupled to the controller 108-15. that is configured to control at least one function of the device 101-15. In the illustrated embodiment, the controller 108-15 is a component of the device 101-15, but in other embodiments may be separate from (but connectable to) the device 101-15. The controller 108-15 is configured to perform at least one function for the device during a cyclic operating routine. The controller 108-15 is further configured to control the operation of the heater 104-15 and, for example, may be configured to control the voltage applied from the power source 105-15 to the heater 104-15. The controller 108-15 may be configured to toggle the supply of power to the heater 105-15 between an on state, in which the full output voltage of the power source 105-15 is applied to the heater 104-15, and an off state, in which the no voltage is applied to the heater 104-15.

Although not shown, the system 100-15 may also comprise a voltage regulator to regulate the output voltage from the power source 105-15 to form a regulated voltage. The regulated voltage may then be applied to the heater 104-15.

In addition to being connected to the heater 104-15, the controller 108-15 is operatively connected to the UI 107-15. Thus, the controller 108-15 may receive an input signal from the input means of the UI 107-15. Similarly, the controller 108-15 may transmit output signals to the UI 107-15. In response, the output means of the UI 107-15 may convey information, based on the output signals, to a user.

Further, the system 100-15 may comprise a sensing means 110-15 coupled with the controller 108-15 within the device 101-15. The sensing means 110-15 may include a puff sensor mounted inside the device 101-15 and configured to detect a user puff. The controller may count the number of number of puffs during a consumable cycle. The sensor 110-15 may include a heater temperature sensor configured to measure a heater temperature of the heater. The sensing means 110-15 may include an ambient temperature sensor configured to measure ambient temperature. The sensing means 110-15 may include a cap movement sensor configured to detect one of removal and lift of a cap from the device 101-15. The cap movement sensor may be a hall effect sensor.

Figure 49B:
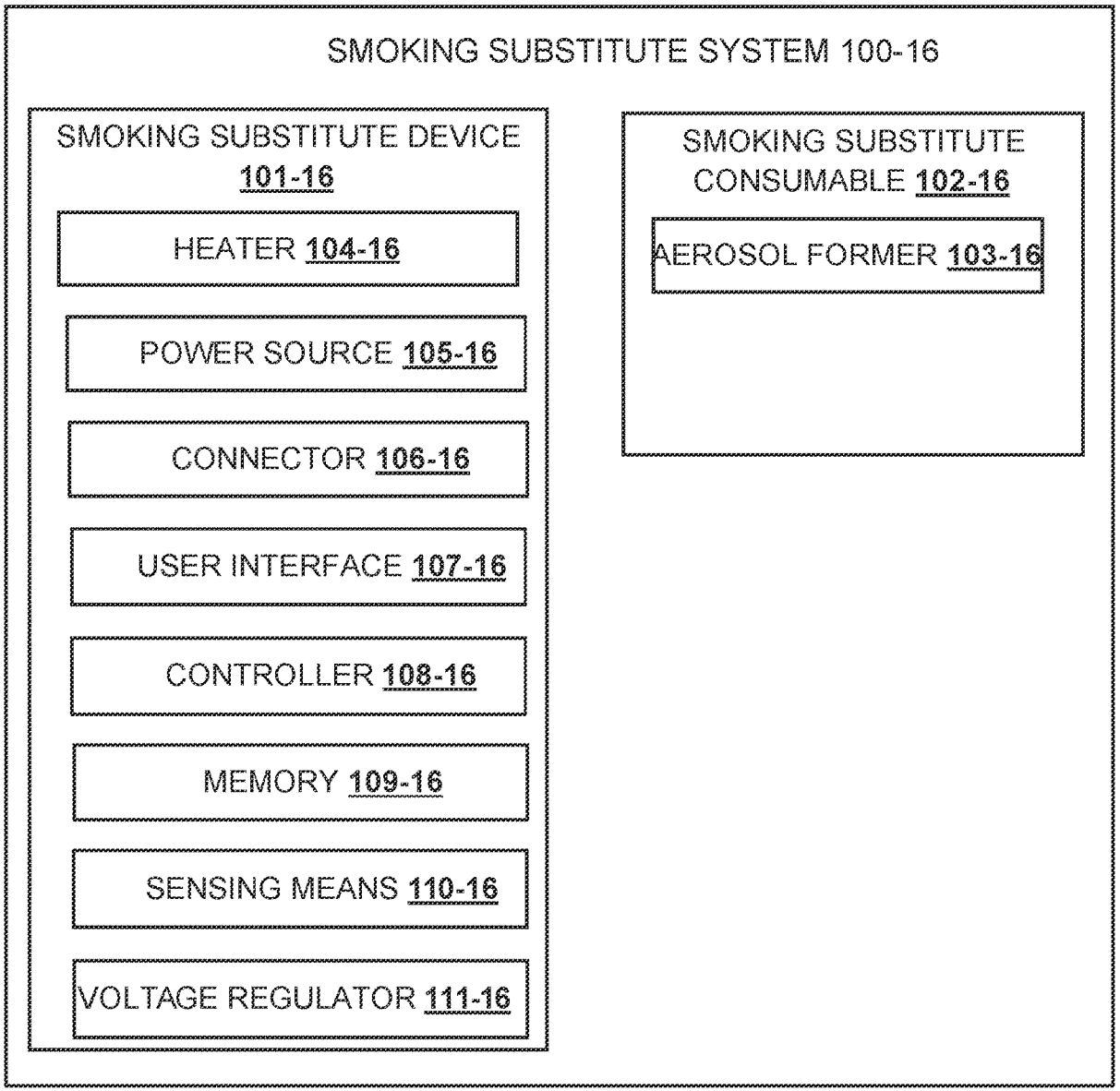

FIG. 49B is a schematic showing a variation of the system 100-15 of FIG. 49A. In the system 100-15' of FIG. 49B, the heater 104-15 forms part of the consumable 102-15, rather than the device 101-15. In this variation, the heater 104-15 is electrically connectable to the power source 105-15, for example, when the consumable 102-15 is engaged with the device 101-15.

Figure 50B:
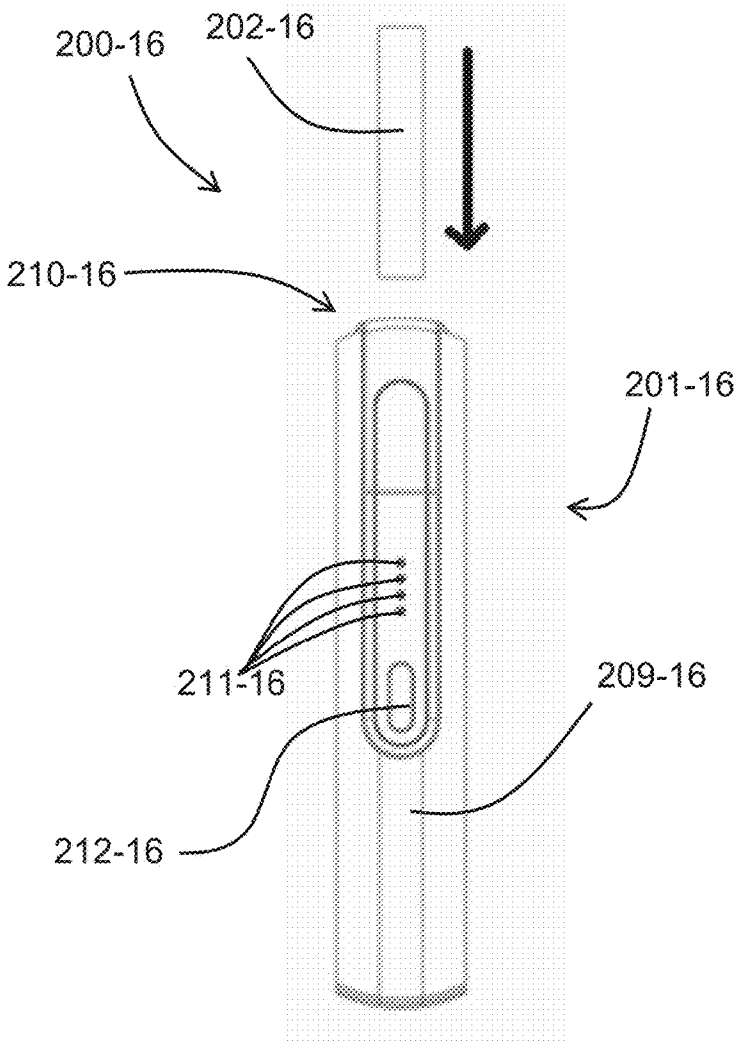
Figure 50A:
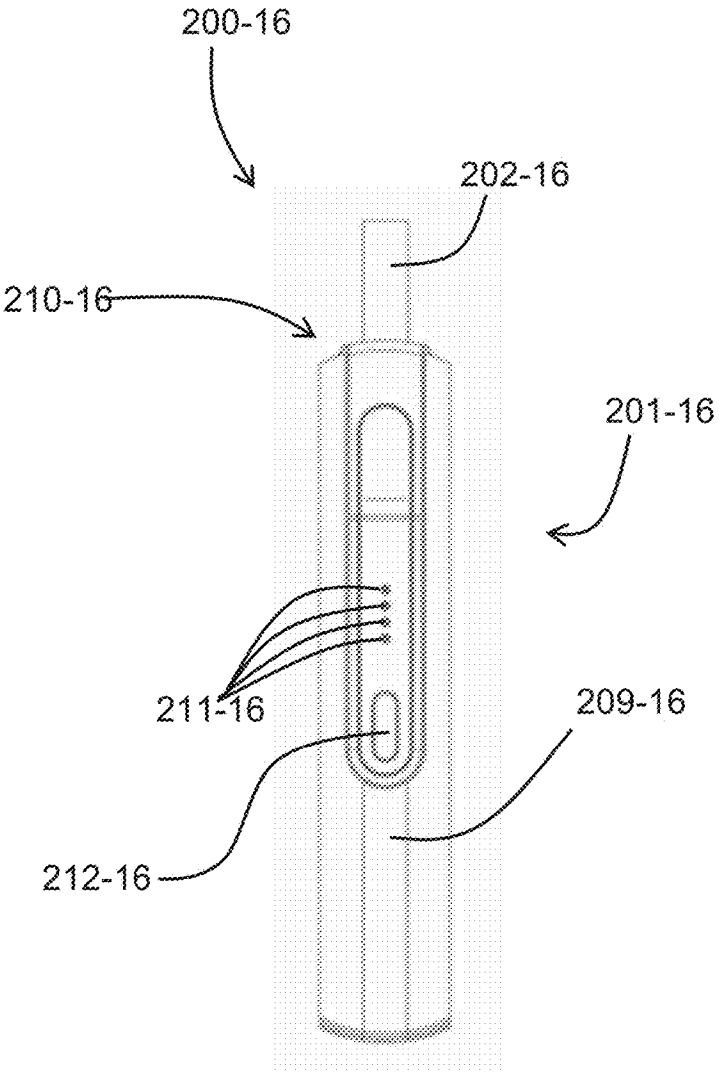

FIG. 50A and FIG. 50B illustrate a heated-tobacco (HT) smoking substitute system 200-15. The system 200-15 is an example of the systems 100-15, 100' described in relation to FIG. 49A or FIG. 49B. System 200-15 includes an HT device 201-15 and an HT consumable 202-15. The description of FIG. 49A and FIG. 49B above is applicable to the system 200-15 of FIG. 50A and FIG. 50B, and will thus not be repeated.

The device 201-15 and the consumable 202-15 are configured such that the consumable 202-15 can be engaged with the device 201-15. FIG. 50A shows the device 201-15 and the consumable 202-15 in an engaged state, whilst FIG. 50B shows the device 201-15 and the consumable 202-15 in a disengaged state.

The device 201-15 comprises a body 209-15 and cap 210-15. In use the cap 209-15 is engaged at an end of the body 209-15. Although not apparent from the figures, the cap 210-15 is moveable relative to the body 209-15. In particular, the cap 210-15 is slideable and can slide along a longitudinal axis of the body 209-15.

The device 201-15 comprises an output means (forming part of the UI of the device 201-15) in the form of a plurality of light-emitting diodes (LEDs) 211 arranged linearly along the longitudinal axis of the device 201-15 and on an outer surface of the body 209-15 of the device 201-15. A button 212-15 is also arranged on an outer surface of the body 209-15 of the device 201-15 and is axially spaced (i.e., along the longitudinal axis) from the plurality of LEDs 211-15.

Figure 50C:
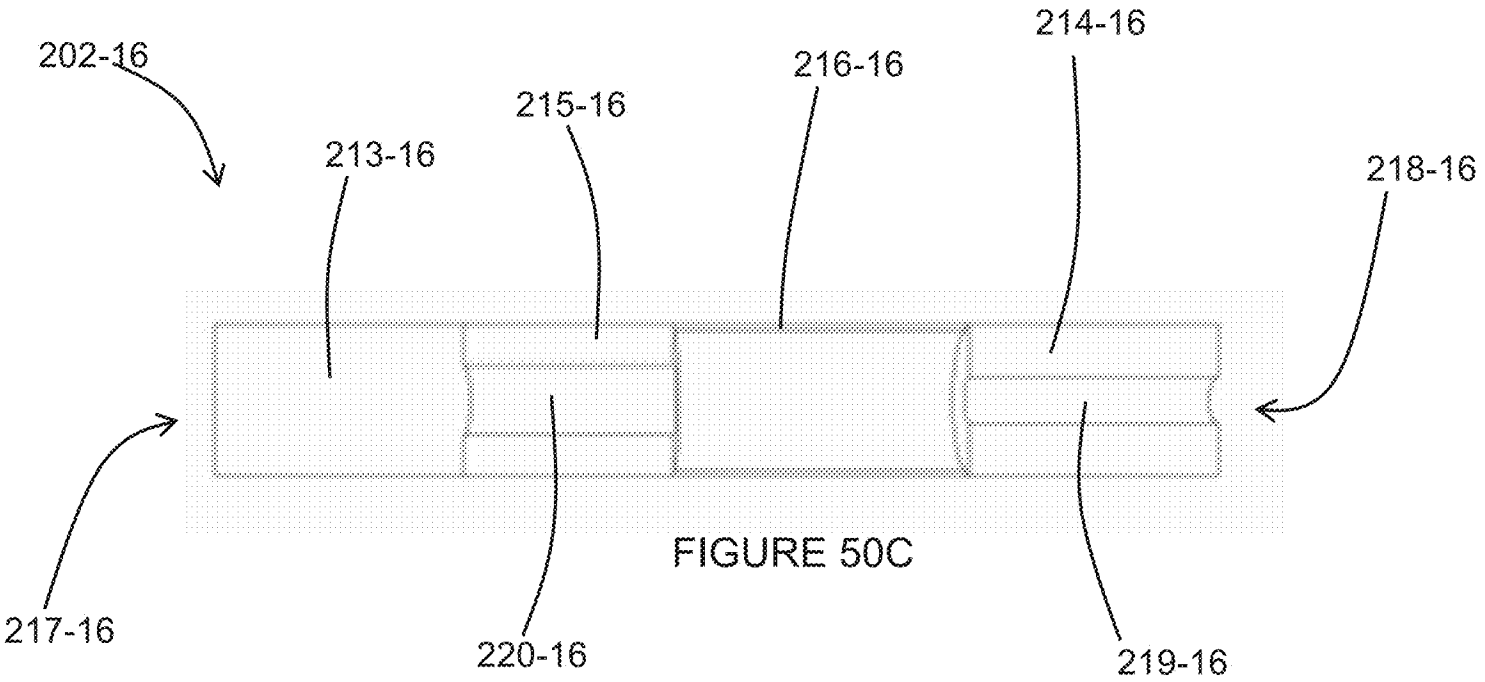

FIG. 50C show a detailed section view of the consumable of 202 of the system 200-15. The consumable 202-15 generally resembles a cigarette. In that respect, the consumable 202-15 has a generally cylindrical form with a diameter of 7 mm and an axial length of 70 mm. The consumable 202-15 comprises an aerosol forming substrate 213-15, a terminal filter element 214-15, an upstream filter element 215-15 and a spacer element 216-15. In other embodiments, the consumable may further comprise a cooling element. A cooling element may exchange heat with vapor that is formed by the aerosol-forming substrate 213-15 in order to cool the vapor so as to facilitate condensation of the vapor.

The aerosol-forming substrate 213-15 is substantially cylindrical and is located at an upstream end 217-15 of the consumable 202-15, and comprises the aerosol former of the system 200-15. In that respect, the aerosol forming substrate 213-15 is configured to be heated by the device 201-15 to release a vapor. The released vapor is subsequently entrained in an airflow flowing through the aerosol-forming substrate 213-15. The airflow is produced by the action of the user drawing on a downstream 218 (i.e., terminal or mouth end) of the consumable 202-15.

In the present embodiment, the aerosol forming substrate 213-15 comprises tobacco material that may, for example, include any suitable parts of the tobacco plant (e.g., leaves, stems, roots, bark, seeds and flowers). The tobacco may comprise one or more of leaf tobacco, stem tobacco, tobacco powder, tobacco dust, tobacco derivatives, expanded tobacco, homogenized tobacco, shredded tobacco, extruded tobacco, cut rag tobacco and/or reconstituted tobacco (e.g., slurry recon or paper recon). For example, the aerosol-forming substrate 213-15 may comprise a gathered Sheet of homogenized (e.g. paper/slurry recon) tobacco or gathered shreds/strips formed from such a sheet.

In order to generate an aerosol, the aerosol forming substrate 213-15 comprises at least one volatile compound that is intended to be vaporized/aerosolized and that may provide the user with a recreational and/or medicinal effect when inhaled. The aerosol-forming substrate 213-15 may further comprise one or more additives. For example, such additives may be in the form of humectants (e.g., propylene glycol and/or vegetable glycerin), flavorants, fillers, aqueous/non-aqueous solvents and/or binders.

The terminal filter element 214-15 is also substantially cylindrical, and is located downstream of the aerosol forming substrate 213-15 at the downstream end 218-15 of the consumable 202-15. The terminal filter element 214-15 is in the form of a hollow bore filter element having a bore 219-15 (e.g., for airflow) formed there through. The diameter of the bore 219-15 is 2 mm. The terminal filter element 214-15 is formed of a porous (e.g., monoacetate) filter material. As set forth above, the downstream end 218-15 of the consumable 202-15 (i.e., where the terminal filter 214-15 is located) forms a mouthpiece portion of the consumable 202-15 upon which the user draws. Airflow is drawn from the upstream end 217-15, thorough the components of the consumable 202-15, and out of the downstream end 218-15. The airflow is driven by the user drawing on the downstream end 218-15 (i.e., the mouthpiece portion) of the consumable 202-15.

The upstream filter element 215-15 is located axially adjacent to the aerosol-forming substrate 213-15, between the aerosol-forming substrate 213-15 and the terminal filter element 214-15. Like the terminal filter 214-15 the upstream filter element 215-15 is in the form of a hollow bore filter element, such that it has a bore 220-15 extending axially there through. In this way, the upstream filter 215-15 may act as an airflow restrictor. The upstream filter element 215-15 is formed of a porous (e.g., monoacetate) filter material. The bore 220-15 of the upstream filter element 214 has a larger diameter (3 mm) than the terminal filter element 214-15.

The spacer 216-15 is in the form of a cardboard tube, which defines a cavity or chamber between the upstream filter element 215-15 and the terminal filter element 214-15. The spacer 216-15 acts to allow both cooling and mixing of the vapor/aerosol from the aerosol-forming substrate 213-15. The spacer has an external diameter of 7 mm and an axial length of 14 mm.

Although not apparent from the figure, the aerosol-forming substrate 213-15, upstream filter 215-15 and spacer 216-15 are circumscribed by a paper wrapping layer. The terminal filter 214-15 is circumscribed by a tipping layer that also circumscribes a portion of the paper wrapping layer (so as to connect the terminal filter 214-15 to the remaining components of the consumable 202-15). The upstream filter 215-15 and terminal filter 214-15 are circumscribed by further wrapping layers in the form of plug wraps.

Figure 50D:
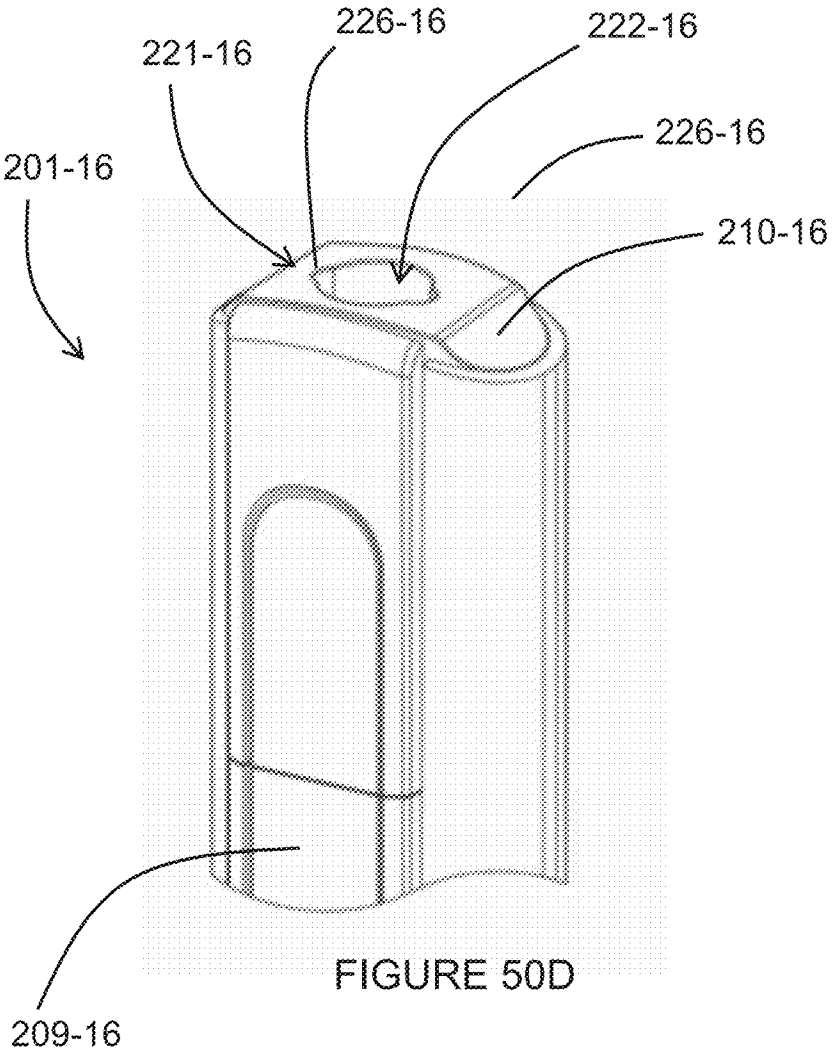

Returning now to the device 201-15, FIG. 50D illustrates a detailed view of the end of the device 201-15 that is configured to engage with the consumable 202-15. The cap 210-15 of the device 201-15 includes an opening 221-15 to an internal cavity 222-15 (more apparent from FIG. 50D) defined by the cap 210-15. The opening 221-15 and the cavity 222-15 are formed so as to receive at least a portion of the consumable 202-15. During engagement of the consumable 202-15 with the device 201-15, a portion of the consumable 202-15 is received through the opening 221-15 and into the cavity 222-15. After engagement (see FIG. 50B), the downstream end 218-15 of the consumable 202-15 protrudes from the opening 221-15 and thus also protrudes from the device 201-15. The opening 221-15 includes laterally disposed notches 226=15. When a consumable 202-15 is received in the opening 221-15, these notches 226=15 remain open and could, for example, be used for retaining a cover in order to cover the end of the device 201-15.

Figure 50E:
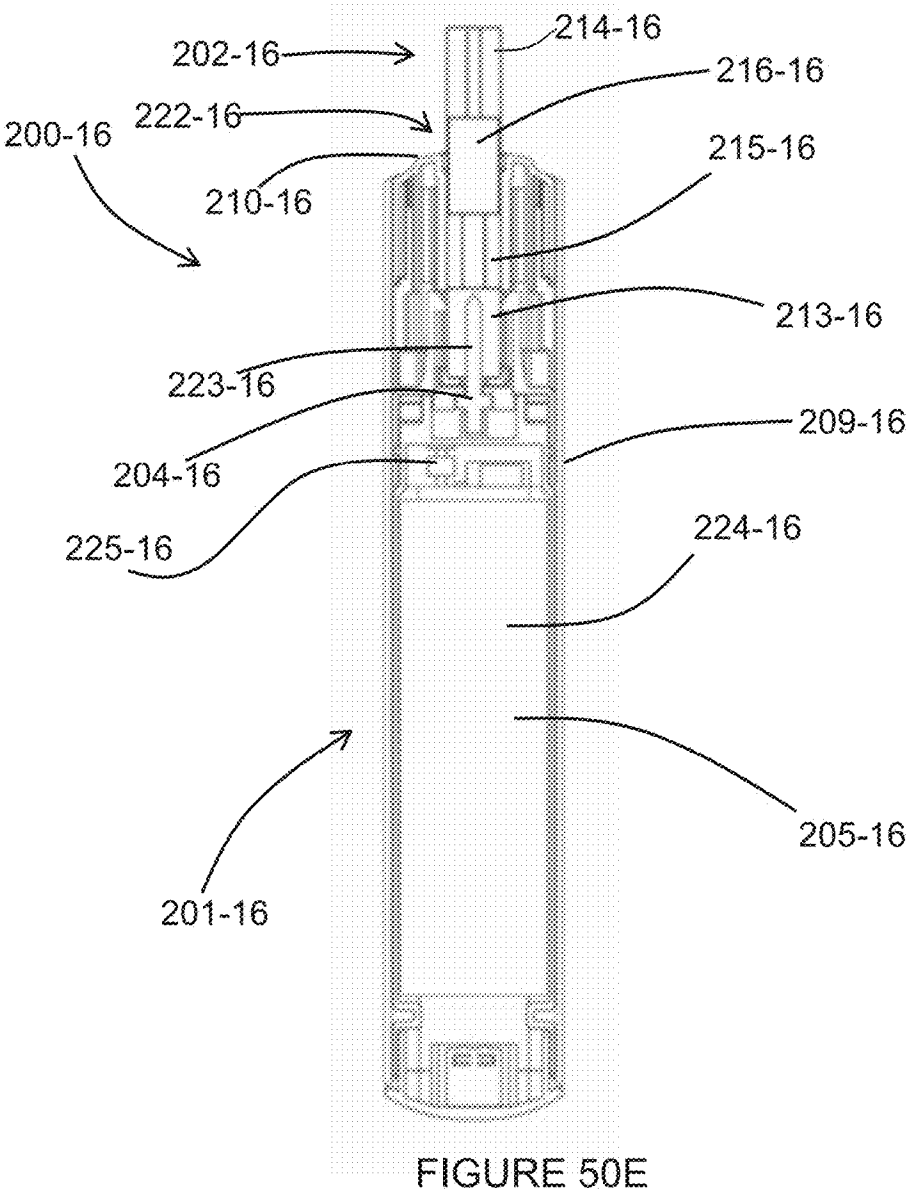

FIG. 50E shows a cross section through a central longitudinal plane through the device 201-15. The device 201-15 is shown with the consumable 202-15 engaged therewith.

The device 201-15 comprises a heater 204-15 comprising heating element 223-15. The heater 204-15 forms part of the body 209-15 of the device 201-15 and is rigidly mounted to the body 209-15. In the illustrated embodiment, the heater 204-15 is a rod heater with a heating element 223-15 having a circular transverse profile. In other embodiments the heater may be in the form of a blade heater (e.g., heating element with a rectangular transverse profile) or a tube heater (e.g., heating element with a tubular form).

The heating element 223-15 of the heater 204-15 projects from an internal base of the cavity 222-15 along a longitudinal axis towards the opening 221-15. As is apparent from the figure, the length (i.e., along the longitudinal axis) of the heating element is less than a depth of the cavity 222-15. In this way, the heating element 223-15 does not protrude from or extend beyond the opening 221-15.

When the consumable 202-15 is received in the cavity 222-15 (as is shown in FIG. 50E), the heating element 223-15 penetrates the aerosol-forming substrate 213-15 of the consumable 202-15. In particular, the heating element 223-15 extends for nearly the entire axial length of the aerosol-forming substrate 213-15 when inserted therein. Thus, when the heater 204-15 is activated, heat is transferred radially from an outer circumferential surface the heating element 223-15 to the aerosol-forming substrate 213-15.

The device 201-15 further comprises an electronics cavity 224-15. A power source, in the form of a rechargeable battery 205-15 (a lithium ion battery), is located in electronics cavity 224-15.

The device 201-15 includes a connector (i.e., forming part of an IO module of the device 201-15) in the form of a USB port 206-15. The connector may alternatively be, for example, a micro-USB port or a USB-C port for examples. The USB port 206-15 may be used to recharge the rechargeable battery 205-15.

The device 201-15 includes a controller (not shown) located in the electronics cavity 224-15. The controller comprises a microcontroller mounted on a printed circuit board (PCB). The USB port 206-15 is also connected to the controller 208-15 (i.e., connected to the PCB and microcontroller).

The controller 208-15 is configured to control at least one function of the device 202-15. For example, the controller 208-15 is configured to control the operation of the heater 204-15. Such control of the operation of the heater 204-15 may be accomplished by the controller toggling the electrical connection of the rechargeable battery 205-15 to the heater 204-15. For example, the controller 208-15 is configured to control the heater 204-15 in response to a user depressing the button 212-15. Depressing the button 212-15 may cause the controller to allow a voltage (from the rechargeable battery 205-15) to be applied to the heater 204-15 (so as to cause the heating element 223-15 to be heated).

The controller 208-15 is configured with a cyclic operating routine having a period between an upper period boundary and lower period boundary.

The upper period boundary may be selected from any one of 500 milliseconds ("ms"), 450 ms, 400 35 ms, 350 ms, 300 ms, 250 ms, 200 ms, 150 ms, 100 ms, 50 ms. The lower period boundary may be selected from any one of 10 ms, 20 ms, 30 ms, 40 ms, 50 ms. Where consistent with the selected upper period boundary, the lower period boundary may alternatively be selected from 100 ms, 150 ms, 200 ms, 250 ms, 300 ms, 350 ms, 400 ms, 450 ms. By way of examples, the period may be between 150 ms and 400 ms, or; the period may be between 20 ms and 50 ms. In some embodiments, the period is between 10 ms and 500 ms.

The cyclic operating routine repeats once every period. In one example, the controller 208-15 may be configured to run a single cycle of cyclic operating routine or multiple cycles of the cyclic operating routine. During each cycle of the cyclic operating routine, the controller 208-15 is configured to perform at least one function, among a number of functions, for the device 201-15. By performing at least one function during the cyclic operating routine, the controller 208-15 may ensure enhanced safety of the device 201-15. In particular, the relatively long period of an operating routine of the present disclosure may provide a balance between user experience, speed of operation, and computational stability of the controller 208-15.

A number of potential functions performed during the cyclic operating routine are described below.

In some embodiments, the functions performed by the controller 208-15 during the cyclic operating routine may comprise measuring the temperature of the heater 204-15 during the cyclic operating routine. The controller 208-15 may be configured to measure the temperature of the heater 204-15 once each period of the cyclic operating routine. Further, to measure the temperature of the heater 204-15, a sensor 110-15 heater temperature sensor 110-15-15 may be used by the controller 208-15. Upon receiving the measured temperature for the heater 204-15, the controller 208-15 may compare it to a predetermined threshold temperature. The value of threshold temperature may be pre-stored in the memory of the device 201-15. In response to said comparison, the controller 208-15 may be configured to control the operation of the heater 204-15. In particular, the power supplied to the heater 204-15 may be controlled. For example, if the temperature of the heater 204-15 is above the threshold, the power supplied to the heater 204-15 may be reduced or prevented entirely. For this, the controller 208-15 may be configured to send a signal to power source 106-15, indicating that the power supply to the heater 204-15 must be reduced. Using this function, the heater 204-15 may be controlled to be substantially maintained at an operating temperature.

In some embodiments, the controller 208-15 may be configured to regulate the voltage supply to the heater 204-15. The controller 208-15 may work in conjunction with the voltage regulator 111-15 to regulate the voltage supply to the heater 204-15. In an embodiment, if the controller 208-15 detects that the voltage supply to the heater 204-15 needs to be regulated, i.e., increased or decreased, the controller 208-15 sends a corresponding signal to the voltage regulator 111-15. In some embodiments, the controller 208-15 only updates an on or off state of the supply of power to the heater once per operating cycle.

In some embodiments, the functions performed by the controller 208-15 during each period of the cyclic operating routine may comprise measuring an output voltage of a power supply of the device. The power supplied to the heater 204-15 may be controlled by the controller based on the measured output voltage of the power supply. In particular, the duty cycle of pulse width modulated power supply to the heater may be increased as the output voltage of the power supply decreases to maintain a constant delivery of power to the heater.

In some embodiments, the functions performed by the controller 208-15 during each period of the cyclic operating routine may comprise measuring an ambient temperature for the device using the sensor 110-15 ambient temperature sensor 110-15-15. In such an embodiment, the sensor 110-15 ambient temperature sensor 110-15-15 may be a temperature sensor placed inside the device 201-15 configured to measure the ambient temperature. Based on the ambient temperature, the controller 208-15 may be configured to control various operations of the device 201-15. In one example, the controller 208-15 may be configured to disable the heater 204-15 in response to detecting an ambient temperature above a high ambient temperature threshold (e.g., 55 degrees Celsius). In another example, the controller 208-15 may be configured to deactivate one of a plurality of operating modes (for example, disable a mode in which the heater 204-15 would be heated to a higher operating temperature).

In some embodiments, the functions performed by the controller 208-15 during each period of cyclic operating routine includes detecting the status of a puff sensor. In such embodiments, the sensor 110-15 may be a puff sensor placed inside the cavity 222-15 of the device 201-15 configured to measure puffs taken by the user. The puff sensor 110-15 may further be configured to increment a puff counter (not shown) with each puff. Said puff counter helps the controller 208-15 in tracking the number of puffs inhaled and number of puffs remaining in the session. Based on said information the controller 208-15 may be configured to control one or more important operations of the device 201-15 and provide useful indication to the user. For example, based on the puff count, the controller 208-15 may be configured to determine the amount of consumable left in the session. The controller 208-15 may be configured to alert the user as to how much time is left before the consumable is exhausted.

In some embodiments, the functions performed by the controller 208-15 during each period of cyclic operating routine include detecting the position of the cap 210-15 within the device 201-15. Precisely, the controller 208-15 may be configured to detect the removal or lifting of the cap 210-15 from the device 201-15. For this, the controller 208-15 may be configured to use the sensor 210-15. In such embodiment, the sensor 110-15 may be a hall-effect sensor placed inside the cavity 222-15 of the device 201-15 configured to detect the change in pressure difference created, within the cavity 222-15, due to one of insertion and removal of the cap 210-15.

In some embodiments, the functions performed by the controller 208-15 during each period of cyclic operating routine include detecting a current state of the device. Current state may include for example, operational state, standby state, off state, error state. Precisely, the controller 208-15 may be configured to detect the removal or lifting of the cap 210-15 from the device 201-15. For this, the controller 208-15 may be configured to use the sensor 210-15. In such embodiment, the sensor 110-15 may be a hall-effect sensor placed inside the cavity 222-15 of the device 201-15 configured to detect the change in pressure difference created, within the cavity 222-15, due to one of insertion and removal of the cap 210-15.

The device 201-15 may further include an output means (not shown) connected to the controller 208-15. In one embodiment, the output means may form a part of the UI 107-15. The output means may include at least one plurality of LEDs, a haptic sensor, a microphone or any other similar means that may be configured to provide at least one of audio, visual and haptic feedback, indicating the status update of the device 201-15, to the user. In some embodiments, the functions performed by the controller 208-15 during each period of cyclic operating routine include updating the output status of the output means to indicate information to the user. In some embodiments, a charge level is determined once per operating cycle and the output means updated to reflect the charge level.

The device 201-15 may further include an input means (not shown) connected to the controller 208-15. In one embodiment, the input means may form a part of the UI 107-15. The input means may include a button. In some embodiments, the functions performed by the controller 208-15 during each period of cyclic operating routine include making a determination of whether the user has made an input command to the input means. During the cycle the controller 208-15 may react to a detected user input command if one is determined to have taken place. The user input command may include a predefined sequence of button presses. The predefined sequence of button presses may include a predefined frequency, duration or pattern of button presses.

The controller 208-15 is also configured to control the LEDs 211-15 in response to (e.g., a detected) a condition of the device 201-15 or the consumable 202-15. For example, the controller may control the LEDs to indicate whether the device 201-15 is in an on state or an off state (e.g., one or more of the LEDs may be illuminated by the controller when the device is in an on state).

The device 202-15 comprises a plurality of input means (i.e., in addition to the button 212-15) in the form of the puff sensor 225, audio sensor, motion sensor etc. Said other input means may be configured to receive user input in the corresponding manner. Further, similar to output means, the input means may also form a part of UI 107-15. As discussed, the puff sensor 225 is configured to detect a user drawing (i.e., inhaling) at the downstream end 218-15 of the consumable 202-15. The puff sensor 225 may, for example, be in the form of a pressure sensor, flow meter or a microphone. The puff sensor 225 is operatively connected to the controller 208-15 in the electronics cavity 224-15, such that a signal from the puff sensor 225, indicative of a puff state (i.e., drawing or not drawing), forms an input to the controller 208-15 (and can thus be responded to by the controller 208-15). Seventeenth Mode of the Disclosure FIG. 51A is a schematic providing a general overview of a smoking substitute system 100-16. The system 100-16 includes a substitute smoking device 101-16 and an aerosol-forming article in the form of a consumable 102-16, which comprises an aerosol former 103-16. The system is configured to vaporize the aerosol former by heating the aerosol former 103-16 (so as to form a vapor/aerosol for inhalation by a user).

In the illustrated system, the heater 104-16 forms part of the consumable 102-16 and is configured to heat the aerosol former 103-16. In this variation, the heater 104-16 is electrically connectable to the power source 105-16, for example, when the consumable 102-16 is engaged with the device 101-16. Heat from the heater 104-16 vaporizes the aerosol former 103-16 to produce a vapor. The vapor subsequently condenses to form an aerosol, which is ultimately inhaled by the user.

The system 100-16 further comprises a power source 105-16 that forms part of the device 101-16. In other embodiments the power source 105-16 may be external to (but connectable to) the device 101-16. The power source 105-16 is electrically connectable to the heater 104-16 such that it is able to supply power to the heater 104-16 (i.e., for the purpose of heating the aerosol former 103-16). Thus, control of the electrical connection of the power source 105-16 to the heater 104-16 provides control of the state of the heater 104-16. The power source 105-16 may be a power store, for example a battery or rechargeable battery (e.g., a lithium ion battery).

The system 100-16 further comprises an I/O module comprising a connector 106-16 (e.g., in the form of a USB port, Micro USB port, USB-C port, etc.). The connector 106-16 is configured for connection to an external source of electrical power, e.g., a mains electrical supply outlet. The connector 106-16 may be used in substitution for the power source 105-16. That is the connector 106-16 may be electrically connectable to the heater 104-16 so as to supply electricity to the heater 104-16. In such embodiments, the device may not include a power source, and the power source of the system may instead comprise the connector 106-16 and an external source of electrical power (to which the connector 106-16 provides electrical connection).

In some embodiments, the connector 106-16 may be used to charge and recharge the power source 105-16 where the power source 105-16 includes a rechargeable battery.

The system 100-16 also comprises a user interface (UI) 107. Although not shown, the UI 107-16 may include input means to receive commands from a user. The input means of the UI 107-16 allows the user to control at least one aspect of the operation of the system 100-16. The input means may, for example, be in the form of a button, touchscreen, switch, microphone, etc.

The UI 107-16 also comprises output means to convey information to the user. The output means may, for example, comprise lights (e.g., LEDs), a display screen, speaker, vibration generator, etc.

The system 100-16 further comprises a controller 108-16 that is configured to control at least one function of the device 101-16. In the illustrated embodiment, the controller 108-16 is a component of the device 101-16, but in other embodiments may be separate from (but connectable to) the device 101-16. The controller 108-16 is configured to control the operation of the heater 104-16 and, for example, may be configured to control the voltage applied from the power source 105-16 to the heater 104-16. The controller 108-16 may be configured to toggle the supply of power to the heater 104-16 between an on state, in which the full output voltage of the power source 105-16 is applied to the heater 104-16, and an off state, in which the no voltage is applied to the heater 104-16.

Although not shown, the system 100-16 may also comprise a voltage regulator to regulate the output voltage from the power source 105-16 to form a regulated voltage. The regulated voltage may then be applied to the heater 104-16.

In addition to being connected to the heater 104-16, the controller 108-16 is operatively connected to the UI 107-16. Thus, the controller 108-16 may receive an input signal from the input means of the UI 107-16. Similarly, the controller 108-16 may transmit output signals to the UI 107-16. In response, the output means of the UI 107-16 may convey information, based on the output signals, to a user. The controller also comprises a memory 109-16, which is a non-volatile memory. The memory 109-16 includes instructions, which, when implemented, cause the controller to perform certain tasks or steps of a method.

Figure 51B:
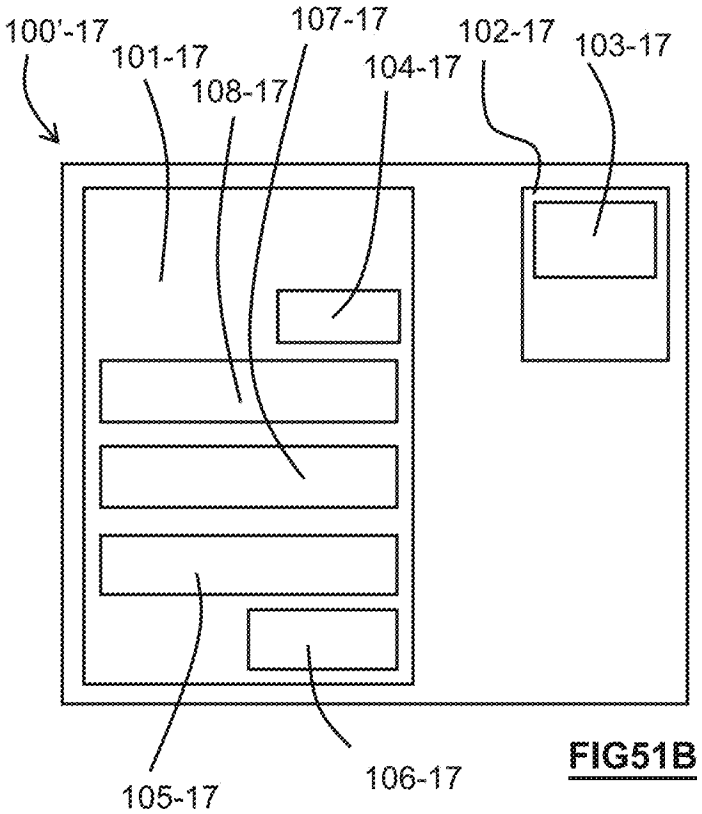
Figure 51A:
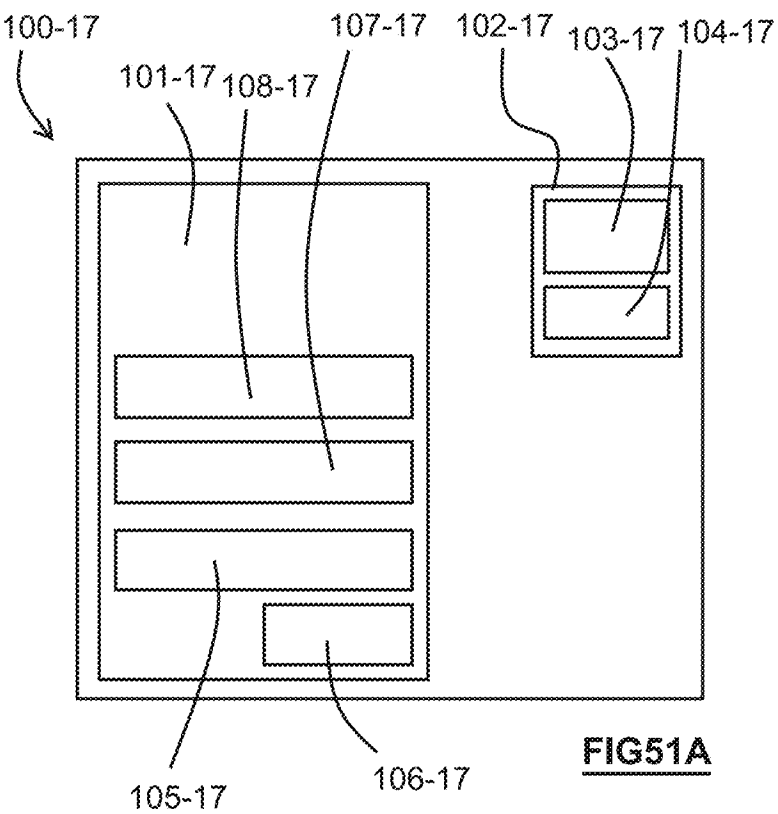

FIG. 51B is a schematic showing a variation of the system 100-16 of FIG. 51A. In the system 100-16' of FIG. 51B, the heater 104-16 forms part of the device 101-16, rather than the consumable 102-16. In this variation, the heater 104-16 is electrically connected to the power source 105-16.

FIG. 52A and FIG. 52B illustrate a heated-tobacco (HT) smoking substitute system 200-16. The system 200-16 is an example of the systems 100-16, 100' described in relation to FIG. 51A or FIG. 51B. System 200-16 includes an HT device 201-16 and an HT consumable 202-16. The description of FIG. 51A and FIG. 51B above is applicable to the system 200-16 of FIG. 52A and FIG. 52B, and will thus not be repeated.

The device 201-16 and the consumable 202-16 are configured such that the consumable 202-16 can be engaged with the device 201-16. FIG. 52A shows the device 201-16 and the consumable 202-16 in an engaged state, whilst FIG. 52B shows the device 201-16 and the consumable 202-16 in a disengaged state.

The device 201-16 comprises a body 209-16 and cap 210-16. In use the cap 210-16 is engaged at an end of the body 209-16. Although not apparent from the figures, the cap 210-16 is moveable relative to the body 209-16. In particular, the cap 210-16 is slideable and can slide along a longitudinal axis of the body 209-16.

The device 201-16 comprises an output means (forming part of the UI of the device 201-16) in the form of a plurality of light-emitting diodes (LEDs) 211 arranged linearly along the longitudinal axis of the device 201-16 and on an outer surface of the body 209-16 of the device 201-16. A button 212-16 is also arranged on an outer surface of the body 209-16 of the device 201-16 and is axially spaced (i.e., along the longitudinal axis) from the plurality of LEDs 211-16.

FIG. 52C show a detailed section view of the consumable of 202 of the system 200-16. The consumable 202-16 generally resembles a cigarette. In that respect, the consumable 202-16 has a generally cylindrical form with a diameter of 7 mm and an axial length of 70 mm. The consumable 202-16 comprises an aerosol forming substrate 213-16, a terminal filter element 214-16, an upstream filter element 215-16 and a spacer element 216-16. In other embodiments, the consumable may further comprise a cooling element. A cooling element may exchange heat with vapor that is formed by the aerosol-forming substrate 213-16 in order to cool the vapor so as to facilitate condensation of the vapor.

The aerosol-forming substrate 213-16 is substantially cylindrical and is located at an upstream end 217-16 of the consumable 202-16, and comprises the aerosol former of the system 200-16. In that respect, the aerosol forming substrate 213-16 is configured to be heated by the device 201-16 to release a vapor. The released vapor is subsequently entrained in an airflow flowing through the aerosol-forming substrate 213-16. The airflow is produced by the action of the user drawing on a downstream 218 (i.e., terminal or mouth) end of the consumable 202-16.

In the present embodiment, the aerosol forming substrate 213-16 comprises tobacco material that may, for example, include any suitable parts of the tobacco plant (e.g., leaves, stems, roots, bark, seeds and flowers). The tobacco may comprise one or more of leaf tobacco, stem tobacco, tobacco powder, tobacco dust, tobacco derivatives, expanded tobacco, homogenized tobacco, shredded tobacco, extruded tobacco, cut rag tobacco and/or reconstituted tobacco (e.g., slurry recon or paper recon). For example, the aerosol-forming substrate 213-16 may comprise a gathered sheet of homogenized (e.g., paper/slurry recon) tobacco or gathered shreds/strips formed from such a sheet.

In order to generate an aerosol, the aerosol forming substrate 213-16 comprises at least one volatile compound that is intended to be vaporized/aerosolized and that may provide the user with a recreational and/or medicinal effect when inhaled. The aerosol-forming substrate 213-16 may further comprise one or more additives. For example, such additives may be in the form of humectants (e.g., propylene glycol and/or vegetable glycerin), flavorants, fillers, aqueous/non-aqueous solvents and/or binders.

The terminal filter element 214-16 is also substantially cylindrical, and is located downstream of the aerosol forming substrate 213-16 at the downstream end 218-16 of the consumable 202-16. The terminal filter element 214-16 is in the form of a hollow bore filter element having a bore 219-16 (e.g., for airflow) formed there through. The diameter of the bore 219-16 is 2 mm. The terminal filter element 214-16 is formed of a porous (e.g., monoacetate) filter material. As set forth above, the downstream end 218-16 of the consumable 202-16 (i.e., where the terminal filter 214-16 is located) forms a mouthpiece portion of the consumable 202-16 upon which the user draws. Airflow is drawn from the upstream end 217-16, thorough the components of the consumable 202-16, and out of the downstream end 218-16. The airflow is driven by the user drawing on the downstream end 218-16 (i.e., the mouthpiece portion) of the consumable 202-16.

The upstream filter element 215-16 is located axially adjacent to the aerosol-forming substrate 213-16, between the aerosol-forming substrate 213-16 and the terminal filter element 214-16. Like the terminal filter 214-16, the upstream filter element 215-16 is in the form of a hollow bore filter element, such that it has a bore 220-16 extending axially there through. In this way, the upstream filter 215-16 may act as an airflow restrictor. The upstream filter element 215-16 is formed of a porous (e.g., monoacetate) filter material. The bore 220-16 of the upstream filter element 215-16 has a larger diameter (3 mm) than the terminal filter element 214-16.

The spacer 216-16 is in the form of a cardboard tube, which defines a cavity or chamber between the upstream filter element 215-16 and the terminal filter element 214-16. The spacer 216-16 acts to allow both cooling and mixing of the vapor/aerosol from the aerosol-forming substrate 213-16. The spacer has an external diameter of 7 mm and an axial length of 14 mm.

Although not apparent from the figure, the aerosol-forming substrate 213-16, upstream filter 215-16 and spacer 216-16 are circumscribed by a paper wrapping layer. The terminal filter 214-16 is circumscribed by a tipping layer that also circumscribes a portion of the paper wrapping layer (so as to connect the terminal filter 214-16 to the remaining components of the consumable 202-16). The upstream filter 215-16 and terminal filter 214-16 are circumscribed by further wrapping layers in the form of plug wraps.

Returning now to the device 201-16, FIG. 52D illustrates a detailed view of the end of the device 201-16 that is configured to engage with the consumable 202-16. The cap 210-16 of the device 201-16 includes an opening 221-16 to an internal cavity 222-16 (more apparent from FIG. 52D) defined by the cap 210-16. The opening 221-16 and the cavity 222-16 are formed so as to receive at least a portion of the consumable 202-16. During engagement of the consumable 202-16 with the device 201-16, a portion of the consumable 202-16 is received through the opening 221-16 and into the cavity 222-16. After engagement (see FIG. 52B), the downstream end 218-16 of the consumable 202-16 protrudes from the opening 221-16 and thus also protrudes from the device 201-16. The opening 221-16 includes laterally disposed notches 226-16. When a consumable 202-16 is received in the opening 221-16, these notches 226-16 remain open and could, for example, be used for retaining a cover in order to cover the end of the device 201-16.

FIG. 52E shows a cross section through a central longitudinal plane through the device 201-16. The device 201-16 is shown with the consumable 202-16 engaged therewith.

The device 201-16 comprises a heater 204-16 comprising heating element 223-16. The heater 204-16 forms part of the body 209-16 of the device 201-16 and is rigidly mounted to the body 209-16. In the illustrated embodiment, the heater 204-16 is a rod heater with a heating element 223-16 having a circular transverse profile. In other embodiments the heater may be in the form of a blade heater (e.g., heating element with a rectangular transverse profile) or a tube heater (e.g., heating element with a tubular form).

The heating element 223-16 of the heater 204-16 projects from an internal base of the cavity 222-16 along a longitudinal axis towards the opening 221-16. As is apparent from the figure, the length (i.e., along the longitudinal axis) of the heating element is less than a depth of the cavity 222-16. In this way, the heating element 223-16 does not protrude from or extend beyond the opening 221-16.

When the consumable 202-16 is received in the cavity 222-16 (as is shown in FIG. 52E), the heating element 223-16 penetrates the aerosol-forming substrate 213-16 of the consumable 202-16. In particular, the heating element 223-16 extends for nearly the entire axial length of the aerosol-forming substrate 213-16 when inserted therein. Thus, when the heater 204-16 is activated, heat is transferred radially from an outer circumferential surface the heating element 223-16 to the aerosol-forming substrate 213-16.

In some embodiments, the device may comprise a temperature sensor (not shown in the figure) coupled with the heater 204-16 and controller of the device 201-16. The temperature sensor may be configured to sense an operating temperature of the heater 204-16 and transmit the measured operating temperature value to the controller.

The device 201-16 further comprises an electronics cavity 224-16. A power source, in the form of a rechargeable battery 205-16 (a lithium ion battery), is located in electronics cavity 224-16.

The device 201-16 includes a connector (i.e., forming part of an IO module of the device 201-16) in the form of a USB port 206-16. The connector may alternatively be, for example, a micro-USB port or a USB-C port for examples. The USB port 206-16 may be used to recharge the rechargeable battery 205-16.

The device 201-16 includes a controller (not shown) located in the electronics cavity 224-16. The controller comprises a microcontroller mounted on a printed circuit board (PCB). The USB port 206-16 is also connected to the controller 208-16 (i.e., connected to the PCB and microcontroller).

The controller 208-16 is configured to control at least one function of the device 202-16. For example, the controller 208-16 is configured to control the operation of the heater 204-16. Such control of the operation of the heater 204-16 may be accomplished by the controller toggling the electrical connection of the rechargeable battery 205-16 to the heater 204-16. For example, the controller 208-16 is configured to control the heater 204-16 in response to a user depressing the button 212-16. Depressing the button 212-16 may cause the controller to allow a voltage (from the rechargeable battery 205-16) to be applied to the heater 204-16 (so as to cause the heating element 223-16 to be heated).

The controller is also configured to control the LEDs 211-16 in response to (e.g., a detected) a condition of the device 201-16 or the consumable 202-16. For example, the controller may control the LEDs to indicate whether the device 201-16 is in an on state or an off state (e.g., one or more of the LEDs may be illuminated by the controller when the device is in an on state).

In some embodiments, the controller may be configured to control supply of power to the heater based on the operating temperature of the heater measured by the temperature sensor. In some embodiments, the controller is configured to compare the operating temperature with threshold values.

FIG. 53 is a flow chart showing steps of controlling power supply to the heater 204-16.

At block 301-16, activation of the device 201-16 may be detected. The controller of the device 201-16 may be configured to detect the activation of the device 201-16.

At block 302-16, upon detection of activation of the device 201-16, the power source may be configured to supply power to the heater 204-16, for heating the consumable 202-16.

At block 303-16, when the power is supplied to the heater 204-16, the operating temperature of the heater 204-16 may be monitored. The temperature sensor may be configured to measure the operating temperature of the heater 204-16.

At block 304-16, the controller may be configured to compare the operating temperature with the first threshold value. The controller may be configured to check whether the operating temperature is greater than or equal to the first threshold value. If the controller determines that the operating temperature is greater than or equal to the first threshold value, the controller performs the step at block 305-16. If the controller determines that the operating temperature is not greater than or equal to the first threshold value, then the controller performs steps of block 302-16 to supply power to the heater 204-16 of the device 201-16 continuously.

At block 305-16, when the operating temperature is greater than or equal to the first threshold value, the controller may be configured to stop the supply of the power to the heater 204-16. The operating temperature of the heater continues to be monitored.

At block 306-16, the controller compares the operating temperature with the second threshold value. The controller may be configured to check if the operating temperature is lower than the second threshold value. If the controller determines that the operating temperature is lower than the second threshold value, step from block 302-16 may be repeated to supply power to the heater 204-16 of the device 201-16 continuously. If the controller determines that the operating temperature is not lower than the second threshold value, steps from block 305-16 may be repeated to terminate/stop supplying the power to the heater 204-16.

The second threshold value is lower than the first threshold value. In some embodiments, the first threshold value and the second threshold value may be predefined. The second threshold value may be lower than the first threshold value by an amount ranging between 0.2 degrees Celsius and 15 degrees Celsius.

In some embodiments, the second threshold value may be selected based on frequency of measurement of the operating temperature of the heater 204-16. In some embodiments, the second threshold value may be selected based on time constant and/or dead time of the device. The time constant is maximum possible rate of increase of the temperature of the heater 204-16. The dead time is a reaction time of the device 201-16 to an impulse of heat.

In some embodiments, the second threshold value may be selected based on ambient temperature of the device 201-16 as measured by an ambient temperature sensing means. The ambient temperature sensing means may include an ambient temperature sensor. The ambient temperature sensor may be part of the controller.

In some embodiments, the first threshold value may be a target operating temperature of the heater.

The device 201-16 comprises a further input means (i.e., in addition to the button 212-16) in the form of a puff sensor 225-16. The puff sensor 225-16 is configured to detect a user drawing (i.e., inhaling) at the downstream end 218-16 of the consumable 202-16. The puff sensor 225-16 may, for example, be in the form of a pressure sensor, flow meter or a microphone. The puff sensor 225-16 is operatively connected to the controller 208-16 in the electronics cavity 224-16, such that a signal from the puff sensor 225-16, indicative of a puff state (i.e., drawing or not drawing), forms an input to the controller 208-16 (and can thus be responded to by the controller 208-16).

Eighteenth Mode of the Disclosure FIG. 54A is a schematic providing a general overview of a smoking substitute system 100-17. The system 100-17 includes a substitute smoking device 101-17 and an aerosol-forming article in the form of a consumable 102-17, which comprises an aerosol former 103-17. The system is configured to vaporize the aerosol former by heating the aerosol former 103-17 (so as to form a vapor/aerosol for inhalation by a user).

In the illustrated system, the heater 104-17 forms part of the consumable 102-17 and is configured to heat the aerosol former 103-17. In this variation, the heater 104-17 is electrically connectable to the power source 105-17, for example, when the consumable 102-17 is engaged with the device 101-17. Heat from the heater 104-17 vaporizes the aerosol former 103-17 to produce a vapor. The vapor subsequently condenses to form an aerosol, which is ultimately inhaled by the user.

The system 100-17 further comprises a power source 105-17 that forms part of the device 101-17. In other embodiments the power source 105-17 may be external to (but connectable to) the device 101-17. The power source 105-17 is electrically connectable to the heater 104-17 such that it is able to supply power to the heater 104-17 (i.e., for the purpose of heating the aerosol former 103-17). Thus, control of the electrical connection of the power source 105-17 to the heater 104-17 provides control of the state of the heater 104-17. The power source 105-17 may be a power store, for example a battery or rechargeable battery (e.g., a lithium ion battery).

The system 100-17 further comprises an I/O module comprising a connector 106-17 (e.g., in the form of a USB port, Micro USB port, USB-C port, etc.). The connector 106-17 is configured for connection to an external source of electrical power, e.g., a mains electrical supply outlet. The connector 106-17 may be used in substitution for the power source 105-17. That is the connector 106-17 may be electrically connectable to the heater 104-17 so as to supply electricity to the heater 104-17. In such embodiments, the device may not include a power source, and the power source of the system may instead comprise the connector 106-17 and an external source of electrical power (to which the connector 106-17 provides electrical connection).

In some embodiments, the connector 106-17 may be used to charge and recharge the power source 105-17 where the power source 105-17 includes a rechargeable battery.

The system 100-17 also comprises a user interface (UI) 107. Although not shown, the UI 107-17 may include input means to receive commands from a user. The input means of the UI 107-17 allows the user to control at least one aspect of the operation of the system 100-17. The input means may, for example, be in the form of a button, touchscreen, switch, microphone, etc.

The UI 107-17 also comprises output means to convey information to the user. The output means may, for example, comprise lights (e.g., LEDs), a display screen, speaker, vibration generator, etc.

The system 100-17 further comprises a controller 108-17 that is configured to control at least one function of the device 101-17. In the illustrated embodiment, the controller 108-17 is a component of the device 101-17, but in other embodiments may be separate from (but connectable to) the device 101-17. The controller 108-17 is configured to control the operation of the heater 104-17 and, for example, may be configured to control the voltage applied from the power source 105-17 to the heater 104-17. The controller 108-17 may be configured to toggle the supply of power to the heater 104-17 between an on state, in which the full output voltage of the power source 105-17 is applied to the heater 104-17, and an off state, in which the no voltage is applied to the heater 104-17.

Although not shown, the system 100-17 may also comprise a voltage regulator to regulate the output voltage from the power source 105-17 to form a regulated voltage. The regulated voltage may then be applied to the heater 104-17.

In addition to being connected to the heater 104-17, the controller 108-17 is operatively connected to the UI 107-17. Thus, the controller 108-17 may receive an input signal from the input means of the UI 107-17. Similarly, the controller 108-17 may transmit output signals to the UI 107-17. In response, the output means of the UI 107-17 may convey information, based on the output signals, to a user. The controller also comprises a memory 109-17, which is a non-volatile memory. The memory 109-17 includes instructions, which, when implemented, cause the controller to perform certain tasks or steps of a method.

FIG. 54B is a schematic showing a variation of the system 100-17 of FIG. 54A. In the system 100-17' of FIG. 54B, the heater 104-17 forms part of the device 101-17, rather than the consumable 102-17. In this variation, the heater 104-17 is electrically connected to the power source 105-17.

FIG. 55A and FIG. 55B illustrate a heated-tobacco (HT) smoking substitute system 200-17. The system 200-17 is an example of the systems 100-17, 100' described in relation to FIG. 54A or FIG. 54B. System 200-17 includes an HT device 201-17 and an HT consumable 202-17. The description of FIG. 54A and FIG. 54B above is applicable to the system 200-17 of FIG. 55A and FIG. 55B, and will thus not be repeated.

The device 201-17 and the consumable 202-17 are configured such that the consumable 202-17 can be engaged with the device 201-17. FIG. 55A shows the device 201-17 and the consumable 202-17 in an engaged state, whilst FIG. 55B shows the device 201-17 and the consumable 202-17 in a disengaged state.

The device 201-17 comprises a body 209-17 and cap 210-17. In use the cap 210-17 is engaged at an end of the body 209-17. Although not apparent from the figures, the cap 210-17 is moveable relative to the body 209-17. In particular, the cap 210-17 is slideable and can slide along a longitudinal axis of the body 209-17.

The device 201-17 comprises an output means (forming part of the UI of the device 201-17) in the form of a plurality of light-emitting diodes (LEDs) 211 arranged linearly along the longitudinal axis of the device 201-17 and on an outer surface of the body 209-17 of the device 201-17. A button 212-17 is also arranged on an outer surface of the body 209-17 of the device 201-17 and is axially spaced (i.e., along the longitudinal axis) from the plurality of LEDs 211-17.

FIG. 55C show a detailed section view of the consumable of 202 of the system 200-17. The consumable 202-17 generally resembles a cigarette. In that respect, the consumable 202-17 has a generally cylindrical form with a diameter of 7 mm and an axial length of 70 mm. The consumable 202-17 comprises an aerosol forming substrate 213-17, a terminal filter element 214-17, an upstream filter element 215-17 and a spacer element 216-17. In other embodiments, the consumable may further comprise a cooling element. A cooling element may exchange heat with vapor that is formed by the aerosol-forming substrate 213-17 in order to cool the vapor so as to facilitate condensation of the vapor.

The aerosol-forming substrate 213-17 is substantially cylindrical and is located at an upstream end 217-17 of the consumable 202-17, and comprises the aerosol former of the system 200-17. In that respect, the aerosol forming substrate 213-17 is configured to be heated by the device 201-17 to release a vapor. The released vapor is subsequently entrained in an airflow flowing through the aerosol-forming substrate 213-17. The airflow is produced by the action of the user drawing on a downstream 218 (i.e., terminal or mouth) end of the consumable 202-17.

In the present embodiment, the aerosol forming substrate 213-17 comprises tobacco material that may, for example, include any suitable parts of the tobacco plant (e.g., leaves, stems, roots, bark, seeds and flowers). The tobacco may comprise one or more of leaf tobacco, stem tobacco, tobacco powder, tobacco dust, tobacco derivatives, expanded tobacco, homogenized tobacco, shredded tobacco extruded tobacco, cut rag tobacco and/or reconstituted tobacco (e.g., slurry recon or paper recon). For example, the aerosol-forming substrate 213-17 may comprise a gathered sheet of homogenized (e.g., paper/slurry recon) tobacco or gathered shreds/strips formed from such a sheet.

In order to generate an aerosol, the aerosol forming substrate 213-17 comprises at least one volatile compound that is intended to be vaporized/aerosolized and that may provide the user with a recreational and/or medicinal effect when inhaled. The aerosol-forming substrate 213-17 may further comprise one or more additives. For example, such additives may be in the form of humectants (e.g., propylene glycol and/or vegetable glycerin), flavorants, fillers, aqueous/non-aqueous solvents and/or binders.

The terminal filter element 214-17 is also substantially cylindrical and is located downstream of the aerosol forming substrate 213-17 at the downstream end 218-17 of the consumable 202-17. The terminal filter element 214-17 is in the form of a hollow bore filter element having a bore 219-17 (e.g., for airflow) formed there through. The diameter of the bore 219-17 is 2 mm. The terminal filter element 214-17 is formed of a porous (e.g., monoacetate) filter material. As set forth above, the downstream end 218-17 of the consumable 202-17 (i.e., where the terminal filter 214-17 is located) forms a mouthpiece portion of the consumable 202-17 upon which the user draws. Airflow is drawn from the upstream end 217-17, thorough the components of the consumable 202-17, and out of the downstream end 218-17. The airflow is driven by the user drawing on the downstream end 218-17 (i.e., the mouthpiece portion) of the consumable 202-17.

The upstream filter element 215-17 is located axially adjacent to the aerosol-forming substrate 213-17, between the aerosol-forming substrate 213-17 and the terminal filter element 214-17. Like the terminal filter 214-17, the upstream filter element 215-17 is in the form of a hollow bore filter element, such that it has a bore 220-17 extending axially there through. In this way, the upstream filter 215-17 may act as an airflow restrictor. The upstream filter element 215-17 is formed of a porous (e.g., monoacetate) filter material. The bore 220-17 of the upstream filter element 215-17 has a larger diameter (3 mm) than the terminal filter element 214-17.

The spacer 216-17 is in the form of a cardboard tube, which defines a cavity or chamber between the upstream filter element 215-17 and the terminal filter element 214-17. The spacer 216-17 acts to allow both cooling and mixing of the vapor/aerosol from the aerosol-forming substrate 213-17. The spacer has an external diameter of 7 mm and an axial length of 14 mm.

Although not apparent from the figure, the aerosol-forming substrate 213-17, upstream filter 215-17 and spacer 216-17 are circumscribed by a paper wrapping layer. The terminal filter 214-17 is circumscribed by a tipping layer that also circumscribes a portion of the paper wrapping layer (so as to connect the terminal filter 214-17 to the remaining components of the consumable 202-17). The upstream filter 215-17 and terminal filter 214-17 are circumscribed by further wrapping layers in the form of plug wraps.

Returning now to the device 201-17, FIG. 55D illustrates a detailed view of the end of the device 201-17 that is configured to engage with the consumable 202-17. The cap 210-17 of the device 201-17 includes an opening 221-17 to an internal cavity 222-17 (more apparent from FIG. 55D) defined by the cap 210-17. The opening 221-17 and the cavity 222-17 are formed so as to receive at least a portion of the consumable 202-17.

During engagement of the consumable 202-17 with the device 201-17, a portion of the consumable 202-17 is received through the opening 221-17 and into the cavity 222-17. After engagement (see FIG. 55B), the downstream end 218-17 of the consumable 202-17 protrudes from the opening 221-17 and thus also protrudes from the device 201-17. The opening 221-17 includes laterally disposed notches 226-17. When a consumable 202-17 is received in the opening 221-17, these notches 226-17 remain open and could, for example, be used for retaining a cover in order to cover the end of the device 201-17.

FIG. 55E shows a cross section through a central longitudinal plane through the device 201-17. The device 201-17 is shown with the consumable 202-17 engaged therewith.

The device 201-17 comprises a heater 204-17 comprising heating element 223-17A. The heater 204-17 forms part of the body 209-17 of the device 201-17 and is rigidly mounted to the body 209-17. In the illustrated embodiment, the heater 204-17 is a rod heater with a heating element 223A-17 having a circular transverse profile. In other embodiments the heater may be in the form of a blade heater (e.g., heating element with a rectangular transverse profile) or a tube heater (e.g., heating element with a tubular form).

The heating element 223A-17 of the heater 204-17 projects from an internal base of the cavity 222-17 along a longitudinal axis towards the opening 221-17. As is apparent from the figure, the length (i.e., along the longitudinal axis) of the heating element is less than a depth of the cavity 222-17. In this way, the heating element 223A-17 does not protrude from or extend beyond the opening 221-17.

When the consumable 202-17 is received in the cavity 222-17 (as is shown in FIG. 55E), the heating element 223A-17 penetrates the aerosol-forming substrate 213-17 of the consumable 202-17. In particular, the heating element 223-17 extends for nearly the entire axial length of the aerosol-forming substrate 213-17 when inserted therein. Thus, when the heater 204-17 is activated, heat is transferred radially from an outer circumferential surface the heating element 223A-17 to the aerosol-forming substrate 213-17.

In an embodiment, as shown in FIG. 56, the heating element 223A-17 of the heater 204-17 has a substantially longitudinal configuration. The longitudinal heating element 223A-17 includes a resistive heating track formed thereon. The heating track may be configured with a power source of the device 201-17 to supply heat to the aerosol forming substrate 213-17 of the consumable 202-17. The heating element 223A-17 has a proximal end and a distal end. The heater 204-17 is mounted to the device 201-17 in the vicinity of the internal base of the cavity 222-17 at the proximal end. The heater 204-17 further includes a tapered tip 223B-17 for penetrating the consumable 202-17 when received in the cavity 222-17. The tapered tip 223B-17 is located at the distal end of the heating element 223A-17.

The heating element 223A-17 is formed from a heater material having a first thermal conductivity. The tip 223B-17 is formed from a tip material having a second thermal conductivity, with the second thermal conductivity being at least 3 times lower than the first thermal conductivity. Optionally, in one aspect, the second thermal conductivity may be 6 times lower than the first thermal conductivity. Optionally, in another aspect, second thermal conductivity may be 10 times lower than the first thermal conductivity. In a preferred embodiment, the heater material may be alumina and the tip material may be zirconia. Zirconia material used can be 10 times less heat conductive than Alumina. The lower heat conductivity of Zirconia causes reflection of heat by the tip 223B-17 towards the heating element 223A-17, when operating the device. The specific configuration of the heating element 223A-17 and the tapered tip 223B-17 enable more heat being imparted and being kept where it is needed most. This in turn leads to more efficient heating and lower power consumption. Generally, the region where heat is needed the most is a portion defined along a length of the heating element 223A-17 between its proximal and distal ends.

The tip 2236-17 has a generally conical configuration. The conical geometry of the tip 223B-17 enables easy insertion of the heater 204-17 into the consumable 202-17. The cone of the tip 223B-17 has a predefined draft angle. In one aspect, the cone may have a draft angle of 20 to 70 degrees. In another aspect, the cone may have a draft angle of 30 to 60 degrees. In one other aspect, the cone may have a draft angle of 40 to 50 degrees or substantially equal to 45 degrees. The cone may be bonded to the distal end of the non-tapered portion of the heater 204-17.

In a preferred embodiment, the longitudinal heating element 223A-17 and the tip 223B-17 of the heater 204-17 may be coated with a protective layer. The protective layer may be formed of, but not limited to, silica. The device 201-17 further comprises an electronics cavity 224-17. A power source, in the form of a rechargeable battery 205-17 (a lithium ion battery), is located in electronics cavity 224-17.

The device 201-17 includes a connector (i.e., forming part of an IO module of the device 201-17) in the form of a USB port 206-17. The connector may alternatively be, for example, a micro-USB port or a USB-C port for examples. The USB port 206-17 may be used to recharge the rechargeable battery 205-17.

The device 201-17 includes a controller (not shown) located in the electronics cavity 224-17. The controller comprises a microcontroller mounted on a printed circuit board (PCB). The USB port 206-17 is also connected to the controller 208-17 (i.e., connected to the PCB and microcontroller).

The controller 208-17 is configured to control at least one function of the device 202-17. For example, the controller 208-17 is configured to control the operation of the heater 204-17. Such control of the operation of the heater 204-17 may be accomplished by the controller toggling the electrical connection of the rechargeable battery 205-17 to the heater 204-17. For example, the controller 208-17 is configured to control the heater 204-17 in response to a user depressing the button 212-17. Depressing the button 212-17 may cause the controller to allow a voltage (from the rechargeable battery 205-17) to be applied to the heater 204-17 (so as to cause the heating element 223-17 to be heated).

The controller is also configured to control the LEDs 211-17 in response to (e.g., a detected) a condition of the device 201-17 or the consumable 202-17. For example, the controller may control the LEDs to indicate whether the device 201-17 is in an on state or an off state (e.g., one or more of the LEDs may be illuminated by the controller when the device is in an on state).

The device 201-17 comprises a further input means (i.e., in addition to the button 212-17) in the form of a puff sensor 225-17. The puff sensor 225-17 is configured to detect a user drawing (i.e., inhaling) at the downstream end 218-17 of the consumable 202-17. The puff sensor 225-17 may, for example, be in the form of a pressure sensor, flow meter or a microphone. The puff sensor 225-17 is operatively connected to the controller 208-17 in the electronics cavity 224-17, such that a signal from the puff sensor 225-17, indicative of a puff state (i.e., drawing or not drawing), forms an input to the controller 208-17 (and can thus be responded to by the controller 208-17).

Nineteenth Mode of the Disclosure FIG. 57A is a schematic providing a general overview of a smoking substitute system 100-18. The system 100-18 includes a substitute smoking device 101-18 and an aerosol-forming article in the form of a consumable 102-18, which comprises an aerosol former 103-18. The system is configured to vaporize the aerosol former by heating the aerosol former 103-18 so as to form a vapor/aerosol for inhalation by a user).

In the illustrated system, the heater 104-18 forms part of the consumable 102-18 and is configured to heat the aerosol former 103-18. Heat from the heater 104-18 vaporizes the aerosol former 103-18 to produce a vapor. The vapor subsequently condenses to form an aerosol, which is ultimately inhaled by the user.

The system 100-18 further comprises a power source 105-18 that forms part of the device 101-18. In other embodiments the power source 105-18 may be external to (but connectable to) the device 101-18. The power source 105-18 is electrically connectable to the heater 104-18 such that it is able to supply power to the heater 104-18 (i.e., for the purpose of heating the aerosol former 103-18. Thus, control of the electrical connection of the power source 105-18 to the heater 104-18 provides control of the state of the heater 104-18. The power source 105-18 may be a power store, for example a battery or rechargeable battery (e.g., a lithium ion battery).

The system 100-18 further comprises an I/O module comprising a connector 106-18 (e.g., in the form of a USB port, Micro USB port, USB-C port, etc.). The connector 106-18 is configured for connection to an external source of electrical power, e.g., a mains electrical supply outlet. The connector 106-18 may be used in substitution for the power source 105-18. That is the connector 106-18 may be electrically connectable to the heater 104-18 so as to supply electricity to the heater 104-18. In such embodiments, the device may not include a power source, and the power source of the system may instead comprise the connector 106-18 and an external source of electrical power (to which the connector 106-18 provides electrical connection).

In some embodiments, the connector 106-18 may be used to charge and recharge the power source 105-18 where the power source 104-18 includes a rechargeable battery.

The system 100-18 also comprises a user interface (UI) 107-18. Although not shown, the UI 107-18 may include input means to receive commands from a user. The input means of the UI 107-18 allows the user to control at least one aspect of the operation of the system 100-18. The input means may, for example, be in the form of a button, touchscreen, switch, microphone, etc.

The UI 107-18 also comprises output means to convey information to the user. The output means may, for example, comprise lights (e.g., LEDs), a display screen, speaker, vibration generator, etc.

The system 100-18 further comprises a controller 108-18 that is configured to control at least one function of the device 101-18. In the illustrated embodiment, the controller 108-18 is a component of the device 101-18, but in other embodiments may be separate from (but connectable to) the device 101-18. The controller 108-18 is configured to control the operation of the heater 104-18 and, for example, may be configured to control the voltage applied from the power source 105-18 to the heater 104-18. The controller 108-18 may be configured to toggle the supply of power to the heater 105-18 between an on state, in which the full output voltage of the power source 105-18 is applied to the heater 104-18, and an off state, in which the no voltage is applied to the heater 104-18.

Although not shown, the system 100-18 may also comprise a voltage regulator to regulate the output voltage from the power source 105-18 to form a regulated voltage. The regulated voltage may then be applied to the heater 104-18.

In addition to being connected to the heater 104-18, the controller 108-18 is operatively connected to the UI 107-18. Thus, the controller 108-18 may receive an input signal from the input means of the UI 107-18. Similarly, the controller 108-18 may transmit output signals to the UI 107-18. In response, the output means of the UI 107-18 may convey information, based on the output signals, to a user.

FIG. 57B is a schematic showing a variation of the system 100-18 of FIG. 57A. In the system 100'-18 of FIG. 57B, the heater 104-18 forms part of the consumable 102-18, rather than the device 101-18. In this variation, the heater 104-18 is electrically connectable to the power source 105-18, for example, when the consumable 102-18 is engaged with the device 101-18.

FIG. 58A and FIG. 58B illustrate a heated-tobacco (HT) smoking substitute system 200-18. The system 200-18 is an example of the systems 100-18, 100'-18 described in relation to FIG. 57A or FIG. 57B. System 200-18 includes an HT device 201-18 and an consumable 202-18HT consumable 202-18. The description of FIG. 57A and FIG. 57B above is applicable to the system 200-18 of FIG. 58A and FIG. 586, and will thus not be repeated.

The device 201-18 and the consumable 202-18 are configured such that the consumable 202-18 can be engaged with the device 201-18. FIG. 58A shows the device 201-18 and the consumable 202-18 in an engaged state, whilst FIG. 58B shows the device 201-18 and the consumable 202-18 in a disengaged state.

The device 201-18 comprises a body 209-19 and cap 210-18. In use the cap 209-18 is engaged at an end of the body 209-19. Although not apparent from the figures, the cap 210-18 is moveable relative to the body 209-19. In particular, the cap 210-18 is slideable and can slide along a longitudinal axis of the body 209-19.

The device 201-18 comprises an output means (forming part of the UI of the device 201-18 in the form of a plurality of light-emitting diodes (LEDs) 211-18 arranged linearly along the longitudinal axis of the device 201-18 and on an outer surface of the body 209-19 of the device 201-18. A button 212-18 is also arranged on an outer surface of the body 209-19 of the device 201-18 and is axially spaced (i.e., along the longitudinal axis) from the plurality of LEDs 211-18.

FIG. 58C show a detailed section view of the consumable of 202 of the system 200-18. The consumable 202-18 generally resembles a cigarette. In that respect, the consumable 202-18 has a generally cylindrical form with a diameter of 7 mm and an axial length of 70 mm. The consumable 202 comprises an aerosol forming substrate 213-18, a terminal filter element 214-18, an upstream filter element 215-18 and a spacer element 216-18. In other embodiments, the consumable may further comprise a cooling element. A cooling element may exchange heat with vapor that is formed by the aerosol-forming substrate 213-18 in order to cool the vapor so as to facilitate condensation of the vapor.

The aerosol-forming substrate 213-18 is substantially cylindrical and is located at an upstream end 217-18 of the consumable 202-18, and comprises the aerosol former of the system 200-18. In that respect, the aerosol forming substrate 213-18 is configured to be heated by the device 201-18 to release a vapor. The released vapor is subsequently entrained in an airflow flowing through the aerosol-forming substrate 213-18. The airflow is produced by the action of the user drawing on a downstream 218 (i.e., terminal or mouth end) of the consumable 202-18.

In the present embodiment, the aerosol forming substrate 213-18 comprises tobacco material that may, for example, include any suitable parts of the tobacco plant (e.g., leaves, stems, roots, bark, seeds and flowers). The tobacco may comprise one or more of leaf tobacco, stem tobacco, tobacco powder, tobacco dust, tobacco derivatives, expanded tobacco, homogenized tobacco, shredded tobacco, extruded tobacco, cut rag tobacco and/or reconstituted tobacco (e.g., slurry recon or paper recon). For example, the aerosol-forming substrate 213-18 may comprise a gathered sheet of homogenized (e.g., paper/slurry recon) tobacco or gathered shreds/strips formed from such a sheet.

In order to generate an aerosol, the aerosol forming substrate 213-18 comprises at least one volatile compound that is intended to be vaporized/aerosolized and that may provide the user with a recreational and/or medicinal effect when inhaled. The aerosol-forming substrate 213-18 may further comprise one or more additives. For example, such additives may be in the form of humectants (e.g., propylene glycol and/or vegetable glycerin), flavorants, fillers, aqueous/non-aqueous solvents and/or binders.

The terminal filter element 214-18 is also substantially cylindrical, and is located downstream of the aerosol forming substrate 213-18 at the downstream end 218 of the consumable 202-18. The terminal filter element 214-18 is in the form of a hollow bore filter element having a bore 219-18 (e.g., for airflow) formed there through. The diameter of the bore 219-18 is 2 mm. The terminal filter element is formed of a porous (e.g., monoacetate) filter material. As set forth above, the downstream end 218 of the consumable 202-18 (i.e., where the terminal filter 214-18 is located) forms a mouthpiece portion of the consumable 202-18 upon which the user draws. Airflow is drawn from the upstream end 217-18, thorough the components of the consumable 202-18, and out of the downstream end 218. The airflow is driven by the user drawing on the downstream end 218 (i.e., the mouthpiece portion) of the consumable 202-18.

The upstream filter element 215-18 is located axially adjacent to the aerosol-forming substrate 213-18, between the aerosol-forming substrate 213-18 and the terminal filter element 214-18. Like the terminal filter 214-18, the upstream filter element 215-18 is in the form of a hollow bore filter element, such that it has a bore 220-18 extending axially there through. In this way, the upstream filter 215-18 may act as an airflow restrictor. The upstream filter element 215-18 is formed of a porous (e.g. monoacetate) filter material. The bore 220-18 of the upstream filter element 214 has a larger diameter (3 mm) than the terminal filter element 214-18.

The spacer 216-18 is in the form of a cardboard tube, which defines a cavity or chamber between the upstream filter element 215-18 and the terminal filter element 214-18. The spacer 216-18 acts to allow both cooling and mixing of the vapor/aerosol from the aerosol-forming substrate 213-18. The spacer has an external diameter of 7 mm and an axial length of 14 mm.

Although not apparent from the figure, the aerosol-forming substrate 213-18, upstream filter and spacer 216-18 are circumscribed by a paper wrapping layer. The terminal filter 214-18 is circumscribed by a tipping layer that also circumscribes a portion of the paper wrapping layer (so as to connect the terminal filter 214-18 to the remaining components of the consumable 202-18. The upstream filter 215-18 and terminal filter 214-18 are circumscribed by further wrapping layers in the form of plug wraps.

Returning now to the device 201-18, FIG. 58D illustrates a detailed view of the end of the device 201-18 that is configured to engage with the consumable 202-18. The cap 210-18 of the device 201-18 includes an opening 221-18 to an internal cavity 222-18 (more apparent from FIG. 58D) defined by the cap 210-18. The opening 221-18 and the cavity 222-18 are formed so as to receive at least a portion of the consumable 202-18. During engagement of the consumable 202-18 with the device 201-18, a portion of the consumable 202-18 is received through the opening 221-18 and into the cavity 222-18. After engagement (see FIG. 58B), the downstream end 218-18 of the consumable 202-18 protrudes from the opening 221-18 and thus protrudes also from the device 201-18. The opening 221-18 includes laterally disposed notches 226-18. When a consumable 202-18 is received in the opening 221-18, these notches remain open and could, for example, be used for retaining a cover to cover the end of the device 201-18.

FIG. 58E shows a cross section through a central longitudinal plane through the device 201-18. The device 201-18 is shown with the consumable 202-18 engaged therewith.

The device 201-18 comprises a heater 204-18 comprising heating element 223-18. The heater 204-18 forms part of the body 209-19-18 of the device 201-18 and is rigidly mounted to the body 209-19-18. In the illustrated embodiment, the heater 204-18 is a rod heater with a heating element 223-18 having a circular transverse profile. In other embodiments the heater may be in the form of a blade heater (e.g., heating element with a rectangular transverse profile) or a tube heater (e.g., heating element with a tubular form).

The heating element 223-18 of the heater 204-18 projects from an internal base of the cavity 222-18 along a longitudinal axis towards the opening 221-18. As is apparent from the FIG. 58E, the length (i.e. along the longitudinal axis) of the heating element is less than a depth of the cavity 222-18. In this way, the heating element 223-18 does not protrude from or extend beyond the opening 221-18.

When the consumable 202-18 is received in the cavity 222-18 (as is shown in FIG. 58E), the heating element 223-18 penetrates the aerosol-forming substrate 213-18 of the consumable 202-18. In particular, the heating element 223-18 extends for nearly the entire axial length of the aerosol-forming substrate 213-18 when inserted therein. Thus, when the heater 204-18 is activated, heat is transferred radially from an outer circumferential surface the heating element 223-18 to the aerosol-forming substrate 213-18.

Referring to FIG. 58F, which shows a schematic sectional view of the heater 204-18 of the heat not burn device 201-18. The heater 204-18 may be configured to penetrate the tobacco portion of the HNB consumable 202-18. As described above the heater 204-18 may be a tube heater. The heater may be of a circular cross section and includes a base 302-18 and distal end 303-18. Base portion 302-18 or base of the heater 204-18 may be fixedly or removably positioned inside the body 209-19-18 [as shown in FIG. 58E] of the heat not burn device 201-18. In an embodiment, the base 302-18 of the rod may be positioned in a slot defined in the body 209-19 of the heat not burn smoking device 201-18. The heater 204 includes a heating element 223-18, and the heating element may be an electrically conductive heating track 250-8. The heater 204-18 further includes an electrically conductive temperature sensing track 260-18. The temperature sensing track 260-18 has a serpentine section 261-18 that may extend along a major axis of the heater 204-18. In certain embodiment, the serpentine section 261-18 may extend along the longitudinal axis of the device 201-18. The electrically conductive heating track 250-8 and temperature sensing track 260-18 are disposed within the heater 204-18, such that the temperature sensing track 260-18 is interposed between the electrically conductive heating track 250-8.

Further, as illustrated in FIG. 58F, the serpentine section 261-18 may be greater than 20% of the length of the heating zone 251-18 of the heater 204-18. The serpentine section 261-18 may be at least 20% of the length of the heating zone 251-18 of the heater 204-18. In another embodiments, the serpentine section 261-18 may be at least 30% of the length of the heating zone 251-18 of the heater 204-18. In another embodiments, the serpentine section 261-18 may be at least 40% of the length of the heating zone 251-18 of the heater 204-18. In yet another embodiment, the serpentine section 261-18 may be at least 50% of the length of the heating zone 251-18 of the heater 204-18. In other embodiments, the serpentine section 261-18 may be at least 60% of the length of the heating zone 251 of the heater 204-18. Optionally, the serpentine section 261-18 may be at least 70% of the length of the heating zone 251-18 of the heater 204-18. Preferably, the serpentine section 261-18 may be at least 80% of the length of the heating zone 251-18 of the heater 204-18.

For example, considering the total length of the heater rod 204-18 may be between 15 mm and 25 mm long and may have a diameter of between 1.5 mm and 2.5 mm. Further, the heating zone 251 of the heater 204-18 may extend to a length of 14.5 mm.

The serpentine section 261-18 may comprise at least one turn of the temperature sensing track 260-18 of a first sense 262-18 and at least one turn of a second sense 264-18, such that each turn includes an apex 265-18. In an embodiment, the first sense 262-18 may be defined as a crest and the second sense 264-18 may be define by a trough each having the apex 265-18. The serpentine section 261-18 may include at least two turns of the first sense 262-18 and the second sense 264-18. Further, the apexes 265-18 of the each of the first sense 262-18 and the second sense 264-18 may be placed in a spaced apart configuration. In an embodiment, the apexes 265-18 of the adjacent turns of the first sense 262-18 and the second sense 264-18 may be separated by at least 1 mm. In respect of this, the apex 265-18 of the first sense 262-18 and the apex 265-18 of the second sense are placed at a distance of at least 1 mm.

As evident from FIG. 2F, the first line 266-18 may be formed by joining the apexes 265-18 of the first sense 262-18 configured on the temperature sensing track 260-18 such that the apexes 265-18 pf the first sense 262-18 may be aligned along a longitudinal direction of the heater 204-18 (i.e., along the major axis of the heater). Similarly, a second line 267-18 may be formed by joining 261-18 the apexes 265-18 of the second sense 264-18 configured on the temperature sensing track 260-18 such that the apexes 265-18 of the second sense 264-18 may be aligned along a longitudinal direction of the heater 204-18 (i.e., along the major axis of the heater). In another embodiments, the apex 265-18 of the first sense 262-18 may abut the electrically conductive heating track 250-8-18, such that the first line 266-18 may be formed by abutting the electrically conductive heating track 250-8. In another embodiments, the apex 265-18 of the second sense 264-18 may be away from the heating track 250-8, such that the second line 266-18 may be formed opposite to the first line 266-18 abutting the electrically conductive heating track 250-8. Further, the first line 266-18 and the second line 267-18 are configured parallel to each other.

The temperature sensing track 260-18 further includes a straight section 268-18 parallel to the first line 266-18 and the second line 267-18. The straight section 268-18 may form a forward path of the electrically temperature sensing track 260-18, and the serpentine section 261-18 may form a return path of the electrically temperature sensing track 260-18 and vice-versa. The heating of the sensor track may be achieved by the supplying power to the heater 204-18 by connecting at least one heating electrode and sensor electrode to the power source via a plurality of connecting wires 269-18. The temperature sensing track 260-18 having the serpentine section 261-18 may be a dimensioned senor for accurate measurement of temperature of the heater 204-18. In respect of this, the heater 204-18 yields higher impedances. In an embodiment, the impedances may be above 5 Ohms. The sensing element has an impedance in excess of 5 Ohms and a temperature coefficient in excess of 2000 ppm per degree Celsius. In order to increase the impedance of the sensing element it is made into a serpentine shape. This way the length of the sensing material is increased thus increasing the impedance.

The temperature sensing track 260-18 may have a configuration of at least one of sawtooth profile, a sinusoidal profile, a triangle wave or a square wave profile. In some embodiments, the temperature sensing track 260-18 may have a configuration in the form of a non-square wave profile. In some embodiments, the temperature sensing track may have a wave profile configuration, in which the wave profile comprises at least one region of the track which oriented so as to extend at an acute angle to the major axis of the heater 204-18. In arrangements of this type, it is proposed that the or each region of the track orientated at an acute angle to the major axis of the heater may be arranged at an angle of less than 40 degrees to the major axis of the heater 204-18. Optionally, the angle may be less than 35 degrees. Optionally the angle may be less than 30 degrees. Optionally the angle may be less than 25 degrees. Optionally the angle may be less than 20 degrees. Optionally the angle may be less than 15 degrees. Optionally, the angle may be less than 10 degrees. Optionally the angle may be less than 5 degrees.

The device 202-18 further comprises an electronics cavity 224-18. A power source, in the form of a rechargeable battery 205-18 (a lithium ion battery), is located in electronics cavity 224-18.

The device 202-18 includes a connector (i.e., forming part of an IO module of the device 201-18 in the form of a USB port 206-18. The connector may alternatively be, for example, a micro-USB port or a USB-C port for examples. The USB port 206-18 may be used to recharge the rechargeable battery 205-18.

The device 202-18 includes a controller (not shown) located in the electronics cavity 224-18. The controller comprises a microcontroller mounted on a printed circuit board (PCB). The USB port 206-18 is also connected to the controller 208-18 (i.e., connected to the PCB and microcontroller).

The controller 208-18 is configured to control at least one function of the device 202-18. For example, the controller 208-18 is configured to control the operation of the heater 204-18. Such control of the operation of the heater 204-18 may be accomplished by the controller toggling the electrical connection of the rechargeable battery 205-18 to the heater 204-18. For example, the controller 208-18 is configured to control the heater 204-18 in response to a user depressing the button 212-18. Depressing the button 212-18 may cause the controller to allow a voltage (from the rechargeable battery 205-18 to be applied to the heater 204-18 (so as to cause the heating element 223-18 to be heated).

The controller is also configured to control the LEDs 211-18 in response to (e.g., a detected) a condition of the device 201-18 or the consumable 202-18. For example, the controller may control the LEDs to indicate whether the device 201-18 is in an on state or an off state (e.g., one or more of the LEDs may be illuminated by the controller when the device is in an on state).

The device 202-18 comprises a further input means (i.e., in addition to the button 212-18 in the form of a puff sensor 225-18. The puff sensor 225-18 is configured to detect a user drawing (i.e., inhaling) at the downstream end 218-18 of the consumable 202-18. The puff sensor 225-18 may, for example, be in the form of a pressure sensor, flow meter or a microphone. The puff sensor 225-18 is operatively connected to the controller 208-18 in the electronics cavity 224-18, such that a signal from the puff sensor 225-18, indicative of a puff state (i.e., drawing or not drawing), forms an input to the controller 208-18 (and can thus be responded to by the controller 208-18.

Twentieth Mode of the Disclosure FIG. 59A is a schematic providing a general overview of a smoking substitute system 100-19. The system 100-19 includes a substitute smoking device 101-19 and an aerosol-forming article in the form of a consumable 102-19, which comprises an aerosol former 103-19. The system is configured to vaporize the aerosol former by heating the aerosol former 103-19 (so as to form a vapor/aerosol for inhalation by a user).

In the illustrated system, the heater 104-19 forms part of the consumable 102-19 and is configured to heat the aerosol former 103-19. In this variation, the heater 104-19 is electrically connectable to the power source 105-19, for example, when the consumable 102-19 is engaged with the device 101-19. Heat from the heater 104-19 vaporizes the aerosol former 103-19 to produce a vapor. The vapor subsequently condenses to form an aerosol, which is ultimately inhaled by the user.

The system 100-19 further comprises a power source 105-19 that forms part of the device 101-19. In other embodiments the power source 105-19 may be external to (but connectable to) the device 101-19. The power source 105-19 is electrically connectable to the heater 104-19 such that it is able to supply power to the heater 104-19 (i.e., for the purpose of heating the aerosol former 103-19). Thus, control of the electrical connection of the power source 105-19 to the heater 104-19 provides control of the state of the heater 104-19. The power source 105-19 may be a power store, for example a battery or rechargeable battery (e.g., a lithium ion battery).

The system 100-19 further comprises an I/O module comprising a connector 106-19 (e.g., in the form of a USB port, Micro USB port, USB-C port, etc.). The connector 106-19 is configured for connection to an external source of electrical power, e.g., a mains electrical supply outlet. The connector 106-19 may be used in substitution for the power source 105-19. That is the connector 106-19 may be electrically connectable to the heater 104-19 so as to supply electricity to the heater 104-19. In such embodiments, the device may not include a power source, and the power source of the system may instead comprise the connector 106-19 and an external source of electrical power (to which the connector 106-19 provides electrical connection).

In some embodiments, the connector 106-19 may be used to charge and recharge the power source 105-19 where the power source 105-19 includes a rechargeable battery.

The system 100-19 also comprises a user interface (UI) 107-19. Although not shown, the UI 107-19 may include input means to receive commands from a user. The input means of the UI 107-19 allows the user to control at least one aspect of the operation of the system 100-19. The input means may, for example, be in the form of a button, touchscreen, switch, microphone, etc.

The UI 107-19 also comprises output means to convey information to the user. The output means may, for example, comprise lights (e.g., LEDs), a display screen, speaker, vibration generator, etc.

The system 100-19 further comprises a controller 108-19 that is configured to control at least one function of the device 101-19. In the illustrated embodiment, the controller 108-19 is a component of the device 101-19, but in other embodiments may be separate from (but connectable to) the device 101-19. The controller 108-19 is configured to control the operation of the heater 104-19 and, for example, may be configured to control the voltage applied from the power source 105-19 to the heater 104-19. The controller 108-19 may be configured to toggle the supply of power to the heater 104-19 between an on state, in which the full output voltage of the power source 105-19 is applied to the heater 104-19, and an off state, in which the no voltage is applied to the heater 104-19.

Although not shown, the system 100-19 may also comprise a voltage regulator to regulate the output voltage from the power source 105-19 to form a regulated voltage. The regulated voltage may then be applied to the heater 104-19.

In addition to being connected to the heater 104-19, the controller 108-19 is operatively connected to the UI 107-19. Thus, the controller 108-19 may receive an input signal from the input means of the UI 107-19. Similarly, the controller 108-19 may transmit output signals to the UI 107-19. In response, the output means of the UI 107-19 may convey information, based on the output signals, to a user. The controller also comprises a memory 109-19, which is a non-volatile memory. The memory 109-19 includes instructions, which, when implemented, cause the controller to perform certain tasks or steps of a method.

FIG. 59B is a schematic showing a variation of the system 100-19 of FIG. 59A. In the system 100-19' of FIG. 59B, the heater 104-19 forms part of the device 101-19, rather than the consumable 102-19. In this variation, the heater 104-19 is electrically connected to the power source 105-19.

FIG. 60A and FIG. 60B illustrate a heated-tobacco (HT) smoking substitute system 200-19. The system 200-19 is an example of the systems 100-19, 100' described in relation to FIG. 59A or FIG. 59B. System 200-19 includes an HT device 201-19 and an HT consumable 202-19. The description of FIG. 59A and FIG. 59B above is applicable to the system 200-19 of FIG. 60A and FIG. 60B, and will thus not be repeated.

The device 201-19 and the consumable 202-19 are configured such that the consumable 202-19 can be engaged with the device 201-19. FIG. 60A shows the device 201-19 and the consumable 202-19 in an engaged state, whilst FIG. 60B shows the device 201-19 and the consumable 202-19 in a disengaged state.

The device 201-19 comprises a body 209-19 and cap 210-19. In use the cap 210-19 is engaged at an end of the body 209-19. Although not apparent from the figures, the cap 210-19 is moveable relative to the body 209-19. In particular, the cap 210-19 is slideable and can slide along a longitudinal axis of the body 209-19.

The device 201-19 comprises an output means (forming part of the UI of the device 201-19) in the form of a plurality of light-emitting diodes (LEDs) 211 arranged linearly along the longitudinal axis of the device 201-19 and on an outer surface of the body 209-19 of the device 201-19. A button 212-19 is also arranged on an outer surface of the body 209-19 of the device 201-19 and is axially spaced (i.e., along the longitudinal axis) from the plurality of LEDs 211-19.

FIG. 60C show a detailed section view of the consumable of 202 of the system 200-19. The consumable 202-19 generally resembles a cigarette. In that respect, the consumable 202-19 has a generally cylindrical form with a diameter of 7 mm, in particular 7.04 mm, and an axial length of 70 mm. The consumable 202-19 comprises an aerosol forming substrate 213-19, a terminal filter element 214-19, an upstream filter element 215-19 and a spacer element 216-19. In other embodiments, the consumable may further comprise a cooling element. A cooling element may exchange heat with vapor that is formed by the aerosol-forming substrate 213-19 in order to cool the vapor so as to facilitate condensation of the vapor.

The aerosol-forming substrate 213-19 is substantially cylindrical and is located at an upstream end 217-19 of the consumable 202-19, and comprises the aerosol former of the system 200-19. In that respect, the aerosol forming substrate 213-19 is configured to be heated by the device 201-19 to release a vapor. The released vapor is subsequently entrained in an airflow flowing through the aerosol-forming substrate 213-19. The airflow is produced by the action of the user drawing on a downstream 218 (i.e., terminal or mouth) end of the consumable 202-19.

In the present embodiment, the aerosol forming substrate 213-19 comprises tobacco material that may, for example, include any suitable parts of the tobacco plant (e.g., leaves, stems, roots, bark, seeds and flowers). The tobacco may comprise one or more of leaf tobacco, stem tobacco, tobacco powder, tobacco dust, tobacco derivatives, expanded tobacco, homogenized tobacco, shredded tobacco, extruded tobacco, cut rag tobacco and/or reconstituted tobacco (e.g., slurry recon or paper recon). For example, the aerosol-forming substrate 213-19 may comprise a gathered sheet of homogenized (e.g., paper/slurry recon) tobacco or gathered shreds/strips formed from such a sheet.

In order to generate an aerosol, the aerosol forming substrate 213-19 comprises at least one volatile compound that is intended to be vaporized/aerosolized and that may provide the user with a recreational and/or medicinal effect when inhaled. The aerosol-forming substrate 213-19 may further comprise one or more additives. For example, such additives may be in the form of humectants (e.g., propylene glycol and/or vegetable glycerin), flavorants, fillers, aqueous/non-aqueous solvents and/or binders.

The terminal filter element 214-19 is also substantially cylindrical, and is located downstream of the aerosol forming substrate 213-19 at the downstream end 218-19 of the consumable 202-19. The terminal filter element 214-19 is in the form of a hollow bore filter element having a bore 219-19 (e.g., for airflow) formed there through. The diameter of the bore 219-19 is 2 mm. The terminal filter element 214-19 is formed of a porous (e.g., monoacetate) filter material. As set forth above, the downstream end 218-19 of the consumable 202-19 (i.e., where the terminal filter 214-19 is located) forms a mouthpiece portion of the consumable 202-19 upon which the user draws. Airflow is drawn from the upstream end 217-19, thorough the components of the consumable 202-19, and out of the downstream end 218-19. The airflow is driven by the user drawing on the downstream end 218-19 (i.e., the mouthpiece portion) of the consumable 202-19.

The upstream filter element 215-19 is located axially adjacent to the aerosol-forming substrate 213-19, between the aerosol-forming substrate 213-19 and the terminal filter element 214-19. Like the terminal filter 214-19, the upstream filter element 215-19 is in the form of a hollow bore filter element, such that it has a bore 220-19 extending axially there through. In this way, the upstream filter 215-19 may act as an airflow restrictor. The upstream filter element 215-19 is formed of a porous (e.g., monoacetate) filter material. The bore 220-19 of the upstream filter element 215-19 has a larger diameter (3 mm) than the terminal filter element 214-19.

The spacer 216-19 is in the form of a cardboard tube, which defines a cavity or chamber between the upstream filter element 215-19 and the terminal filter element 214-19. The spacer 216-19 acts to allow both cooling and mixing of the vapor/aerosol from the aerosol-forming substrate 213-19. The spacer has an external diameter of 7 mm and an axial length of 14 mm.

Although not apparent from the figure, the aerosol-forming substrate 213-19, upstream filter 215-19 and spacer 216-19 are circumscribed by a paper wrapping layer. The terminal filter 214-19 is circumscribed by a tipping layer that also circumscribes a portion of the paper wrapping layer (so as to connect the terminal filter 214-19 to the remaining components of the consumable 202-19). The upstream filter 215-19 and terminal filter 214-19 are circumscribed by further wrapping layers in the form of plug wraps.

Returning now to the device 201-19, FIG. 60D illustrates a detailed view of the end of the device 201-19 that is configured to engage with the consumable 202-19. The cap 210-19 of the device 201-19 includes an opening 221-19 to an internal cavity 222-19 (more apparent from FIG. 60D) defined by the cap 210-19. The opening 221-19 and the cavity 222-19 are formed so as to receive at least a portion of the consumable 202-19. During engagement of the consumable 202-19 with the device 201-19, a portion of the consumable 202-19 is received through the opening 221-19 and into the cavity 222-19. After engagement (see FIG. 60B), the downstream end 218-19 of the consumable 202-19 protrudes from the opening 221-19 and thus also protrudes from the device 201-19. The opening 221-19 includes laterally disposed notches 226-19. When a consumable 202-19 is received in the opening 221-19, these notches 226-19 remain open and could, for example, be used for retaining a cover in order to cover the end of the device 201-19.

FIG. 60E shows a cross section through a central longitudinal plane through the device 201-19. The device 201-19 is shown with the consumable 202-19 engaged therewith.

The device 201-19 comprises a heater 204-19 comprising heating element 223-19. The heater 204-19 forms part of the body 209-19 of the device 201-19 and is rigidly mounted to the body 209-19. In the illustrated embodiment, the heater 204-19 is a rod heater with a heating element 223-19 having a circular transverse profile. In other embodiments the heater may be in the form of a blade heater (e.g., heating element with a rectangular transverse profile) or a tube heater (e.g., heating element with a tubular form).

The heating element 223-19 of the heater 204-19 projects from an internal base of the cavity 222-19 along a longitudinal axis towards the opening 221-19. As is apparent from the figure, the length (i.e., along the longitudinal axis) of the heating element is less than a depth of the cavity 222-19. In this way, the heating element 223-19 does not protrude from or extend beyond the opening 221-19.

Now referring to FIG. 61, which illustrates a heater apparatus 204-19 for a heat not burn smoking substitute device 201-19. The heater apparatus 204-19 may be a rod heater, which includes a rod 301-19 and a heater element 223-19 (not depicted in FIG. 61) located on the rod 301-19. The rod 301-19 may be of a circular cross section or oval cross section and includes a base 302-19 and distal end 303-19. Base portion 302-19 or the base of the rod 301-19 may be fixedly or removably positioned inside the body 209-19 [as shown in FIG. 60E] of the heat not burn smoking substitute device 201-19. In an embodiment, the base 302-19 of the rod 301-19 may be positioned in a slot defined in the body 209-19 of the heat not burn smoking substitute device 201-19. As an example, the base 302-19 of the rod 301-19 may have a diameter of about 1 to about 5 mm, in particular 1.5 to about 3 mm.

As shown in FIG. 61, the rod 301-19 includes a tip component 304-19 located at the distal end 303-19 of the rod 301-19. The tip component 304-19 is a conical shaped body and the distal end 303-19 of the rod 301-19 forms a base of the tip component 304-19. In an embodiment, the height H of the tip component 304-19 is larger than the width W of the tip component 304-19. At the same time, the distal end 303-19 substantially corresponds in width W to the width W of the tip component 304-19. In other words, the width W of the tip component 304-19 is the width W where the rod 301-19 meets with the tip component 304-19 at its distal end 303-19. The configuration of conical shape of the tip component 304-19 and the height H being larger than the width W helps in penetration of the HNB consumable 202-19 onto the heater apparatus 204-19 without much efforts by the user. Also, the conical shape of the tip component 304-19 may allow the HNB consumable 202-19 to be removed more freely. The conical tip component 304-19 tip component 304-19 is in particular separate from the tapered base of the rod 301-19. In other words, the heater apparatus 204-19 comprises a first region 301-19, which is substantially cylindrical in shape, and a second region 304-19, which has a shape distinct from the tapered shape, e.g., a conical shape. Being separate may allow the provision of different materials for the tip component 304-19 and the rod 301-19, e.g., a material with high rigidity or strength may be used for the tip component 304-19 to avoid premature wear, while the rod may be made of a material with preferred heat conductivity properties.

One example of dimensions is a width W of the rod 301-19, i.e., the diameter of the rod 301-19, of 2 mm and a height H of the tip component 304-19 of 2.5 mm.

When inserted in an aerosol-forming article, the tip component 304-19 may penetrate at least partly into a filter element of the aerosol-forming article. This penetration may provide a preferred aerosol path through the article, or in other words may ease the aerosol flow through the article. Therefore, the flow through the consumable may be improved, which potentially results in a better user experience when using the heat not burn device. Further, an at least partly penetrated filter may improve the properties in use of the heat not burn device, in particular improve properties related to a total particulate matter (tpm) level in the aerosol of the consumable in use received by a user. This, too, results in an improved user experience.

It is noted that for the beneficial properties described herein of at least partially penetrating the filter of a heat not burn article, i.e., with the tip component of a rod of the heater element, the height may not need to be larger than the width of the tip component. In consequence, the heat not burn smoking substitute device may merely comprise a heater element where, when the article is inserted into the heat not burn device, the rod may be arranged in the article and further contacting the filter element of the article, in particular at least partially penetrating the filter element.

When the consumable 202-19 is received in the cavity 222-19 (as is shown in FIG. 60E), the heating element 223-19 penetrates the aerosol-forming substrate 213-19 of the consumable 202-19. In particular, the heating element 223-19 extends for nearly the entire axial length of the aerosol-forming substrate 213-19 when inserted therein. Thus, when the heater 204-19 is activated, heat is transferred radially from an outer circumferential surface the heating element 223-19 to the aerosol-forming substrate 213-19.

The device 201-19 further comprises an electronics cavity 224-19. A power source, in the form of a rechargeable battery 205-19 (a lithium ion battery), is located in electronics cavity 224-19.

The device 201-19 includes a connector (i.e., forming part of an ID module of the device 201-19) in the form of a USB port 206-19. The connector may alternatively be, for example, a micro-USB port or a USB-C port for examples. The USB port 206-19 may be used to recharge the rechargeable battery 205-19.

The device 201-19 includes a controller (not shown) located in the electronics cavity 224-19. The controller comprises a microcontroller mounted on a printed circuit board (PCB). The USB port 206-19 is also connected to the controller 208-19 (i.e., connected to the PCB and microcontroller).

The controller 208-19 is configured to control at least one function of the device 202-19. For example, the controller 208-19 is configured to control the operation of the heater 204-19. Such control of the operation of the heater 204-19 may be accomplished by the controller toggling the electrical connection of the rechargeable battery 205-19 to the heater 204-19. For example, the controller 208-19 is configured to control the heater 204-19 in response to a user depressing the button 212-19. Depressing the button 212-19 may cause the controller to allow a voltage (from the rechargeable battery 205-19) to be applied to the heater 204-19 (so as to cause the heating element 223-19 to be heated).

The controller is also configured to control the LEDs 211-19 in response to (e.g., a detected) a condition of the device 201-19 or the consumable 202-19. For example, the controller may control the LEDs to indicate whether the device 201-19 is in an on state or an off state (e.g., one or more of the LEDs may be illuminated by the controller when the device is in an on state).

The device 201-19 comprises a further input means (i.e., in addition to the button 212-19) in the form of a puff sensor 225-19. The puff sensor 225-19 is configured to detect a user drawing (i.e., inhaling) at the downstream end 218-19 of the consumable 202-19. The puff sensor 225-19 may, for example, be in the form of a pressure sensor, flow meter or a microphone. The puff sensor 225-19 is operatively connected to the controller 208-19 in the electronics cavity 224-19, such that a signal from the puff sensor 225-19, indicative of a puff state (i.e., drawing or not drawing), forms an input to the controller 208-19 (and can thus be responded to by the controller 208-19).

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilized for realizing the disclosure in diverse forms thereof.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilized for realizing the disclosure in diverse forms thereof.

While the disclosure has been described in conjunction with the exemplary embodiments described above, many equivalent modifications and variations will be apparent to those skilled in the art when given this disclosure. Accordingly, the exemplary embodiments of the disclosure set forth above are considered to be illustrative and not limiting. Various changes to the described embodiments may be made without departing from the spirit and scope of the disclosure.

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the words "have", "comprise", and "include", and variations such as "having", "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent"about," it will be understood that the particular value forms another embodiment. The term "about" in relation to a numerical value is optional and means, for example, +/−10%.

The words "preferred" and "preferably" are used herein refer to embodiments of the disclosure that may provide certain benefits under some circumstances. It is to be appreciated, however, that other embodiments may also be preferred under the same or different circumstances. The recitation of one or more preferred embodiments therefore does not mean or imply that other embodiments are not useful, and is not intended to exclude other embodiments from the scope of the disclosure, or from the scope of the claims.

The invention claimed is:

1. A smoking substitute device for heating a consumable according to a consumable cycle, the smoking substitute device comprising:

a measurement means for measuring a usage of the smoking substitute device by a user during the consumable cycle, wherein the measurement means comprises a puff sensor configured to detect a puff state indicating whether a puff is occurring;

a heater for heating the consumable during the consumable cycle; and a controller configured to determine an exhaustion level of the consumable during the consumable cycle based on the usage, and wherein the controller is further configured to control an aspect of operation of the smoking substitute device during the consumable cycle based on the exhaustion level, wherein the aspect of operation of the smoking substitute device comprises modifying a duration of the consumable cycle by controlling a power supply to the heater based on the exhaustion level such that the controller shortens the duration of the consumable cycle if the determined exhaustion level is above a predefined maximum exhaustion threshold, thereby preventing continued heating of the consumable when the consumable is in an exhausted state.

2. A smoking substitute device according to claim 1, wherein the usage of the smoking substitute device is based on a detection of at least one puff by the puff sensor.

3. A smoking substitute device according to claim 1, wherein calculation of the exhaustion level is based on an operating temperature of the heater of the smoking substitute device during the consumable cycle.

4. A smoking substitute device according to claim 1, wherein the determination of the exhaustion level is based on a power level supplied to the heater of the smoking substitute device during the consumable cycle.

5. A smoking substitute device according to claim 1, wherein the smoking substitute device includes an environmental temperature measurement means configured to measure an environmental temperature of the smoking substitute device.

6. A smoking substitute device according to claim 5, wherein the determination of the exhaustion level is based on an environmental temperature measurement.

7. A smoking substitute device according to claim 1, wherein the determination of the exhaustion level is based on a user-selectable operating mode of the smoking substitute device during the consumable cycle.

8. A smoking substitute device according to claim 1, wherein the controller is configured to extend the duration of the consumable cycle by a predetermined extension period if the exhaustion level is below a predefined minimum exhaustion threshold.

9. A smoking substitute device according to claim 1, wherein the aspect of operation of the smoking substitute device includes controlling an operating temperature of the heater of the smoking substitute device during the consumable cycle based on the exhaustion level.

10. A smoking substitute device according to claim 1, comprising a user output means for providing user feedback to the user, wherein the controller is configured to control the user output means to indicate to the user the control of the aspect of the operation of the smoking substitute device.

11. A smoking substitute device according to claim 10, wherein the user output means includes one or more lights or a haptic feedback component.

12. A smoking substitute device for heating a consumable according to a consumable cycle, the smoking substitute device comprising:

a sensor configured to measure a usage of the smoking substitute device by a user during the consumable cycle, wherein the sensor comprises a puff sensor configured to detect a puff state indicating whether a puff is occurring;

a heater for heating the consumable during the consumable cycle; and a controller configured to determine an exhaustion level of the consumable during the consumable cycle based on the usage, and wherein the controller is further configured to control an aspect of operation of the smoking substitute device during the consumable cycle based on the exhaustion level, wherein the aspect of operation of the smoking substitute device comprises modifying a duration of the consumable cycle by controlling a power supply to the heater based on the exhaustion level such that the controller extends the duration of the consumable cycle if the determined exhaustion level is below a predefined minimum exhaustion threshold, thereby ensuring that the consumable is fully consumed.

13. A smoking substitute device according to claim 1, wherein the smoking substitute device is a heat not burn device.

14. A smoking substitute device according to claim 7, wherein the operating mode corresponds to a power level supplied to the heater.

15. A smoking substitute device according to claim 1, wherein the controller is configured to:

increase the duration of the consumable cycle if the exhaustion level is less than a predetermined threshold level; or decrease the duration of the consumable cycle if the exhaustion level is greater than the predetermined threshold level;

wherein the predetermined threshold level is based on an expected exhaustion level at for a time in the consumable cycle at which the exhaustion level is determined.

16. A smoking substitute device according to claim 1, wherein the controller is configured to:

extend the duration of the consumable cycle if the exhaustion level is below a predefined minimum exhaustion threshold; and shorten a duration of the consumable cycle if the exhaustion level is above a predefined maximum exhaustion threshold;

wherein the minimum exhaustion level and the maximum exhaustion level define a desired exhaustion range for a time in the consumable cycle at which the exhaustion level is determined.

17. A smoking substitute device according to claim 1, wherein the controller is configured to determine the exhaustion level and to adjust the duration of the consumable cycle based on the exhaustion level multiple times during the consumable cycle.

* * * * *